US005583328A

United States Patent [19]

Mitsuhashi et al.

[11] Patent Number: 5,583,328

[45] Date of Patent: Dec. 10, 1996

[54] HIGH VOLTAGE SWITCH INCLUDING U-SHAPED, SLITTED STATIONARY CONTACT ASSEMBLY WITH ARC EXTINGUISHING/MAGNETIC BLOWOUT FEATURES

[75] Inventors: Takao Mitsuhashi; Mitsugu Takahashi; Kazunori Fukuya; Kenichi Nishina; Shinji Yamagata, all of Hyogo, Japan

[73] Assignee: Mitsubishi Denki Kabushiki Kaisha, Tokyo, Japan

[21] Appl. No.: 76,741

[22] Filed: Jun. 15, 1993

[30] Foreign Application Priority Data

| | | | |
|---|---|---|---|
| Jul. 2, 1992 | [JP] | Japan | 4-197444 |
| Jul. 2, 1992 | [JP] | Japan | 4-197445 |
| Jul. 2, 1992 | [JP] | Japan | 4-197446 |
| Aug. 21, 1992 | [JP] | Japan | 4-243998 |
| Oct. 9, 1992 | [JP] | Japan | 4-296640 |
| Oct. 23, 1992 | [JP] | Japan | 4-307859 |
| Oct. 23, 1992 | [JP] | Japan | 4-307860 |
| Oct. 23, 1992 | [JP] | Japan | 4-309683 |

[51] Int. Cl.[6] ..... H01H 9/30; H01H 33/04

[52] U.S. Cl. ..... 218/33; 218/146

[58] Field of Search ..... 200/144 R, 147 R, 200/275; 218/8–42, 146–151; 335/16, 147, 195–201

[56] References Cited

U.S. PATENT DOCUMENTS

| | | | |
|---|---|---|---|
| 3,555,471 | 1/1971 | Mitskevich et al. | 335/195 |
| 3,593,227 | 7/1971 | Mitskevich et al. | 335/16 |
| 3,873,950 | 3/1975 | Guschin | 335/42 |
| 4,451,718 | 5/1984 | Yamagata et al. | 335/195 X |
| 4,491,705 | 1/1985 | Hayashi et al. | 200/147 R |
| 4,581,511 | 4/1986 | Leone | 200/306 |
| 4,654,490 | 3/1987 | Leone | 335/16 X |
| 4,654,491 | 3/1987 | Maier et al. | 335/16 X |
| 4,835,501 | 5/1989 | Hovanic | 335/16 |
| 4,970,481 | 11/1990 | Arnold | 335/16 X |
| 4,973,805 | 11/1990 | Paton et al. | 218/36 X |
| 5,268,661 | 12/1993 | Grunert et al. | 335/16 |
| 5,313,031 | 5/1994 | Takahashi et al. | 200/275 |

FOREIGN PATENT DOCUMENTS

| | | | |
|---|---|---|---|
| 0003447 | 8/1979 | European Pat. Off. | H01H 77/10 |
| 0231600 | 8/1987 | European Pat. Off. | H01H 9/44 |
| 0492456 | 7/1992 | European Pat. Off. | H01H 9/44 |
| 1763007 | 3/1971 | Germany | H01H 77/10 |
| 1638094 | 8/1971 | Germany | H01H 77/10 |
| 60-49533 | 3/1985 | Japan | H01H 73/04 |
| 60-49535 | 3/1985 | Japan | H01H 73/18 |
| 2-68831 | 3/1990 | Japan | H01H 73/02 |

*Primary Examiner*—J. R. Scott

*Attorney, Agent, or Firm*—Burns, Doane, Swecker & Mathis, LLP

[57] ABSTRACT

A switch includes a fixed contact having a first conductor portion connected to a terminal, a second conductor portion having a stationary contact, and a third conductor portion. The third conductor portion is disposed on the side of the other end of a moving contact to which a traveling contact is not mounted with respect to a position of the stationary contact, and on the side opposed to the terminal. The first conductor portion is disposed above a contact surface of contacts at a contact closing time, and is disposed below a contact surface of the traveling contact at a contact opening time. A position of the first conductor portion which can be surveyed from a surface of the traveling contact at an opening time of the contacts is coated with an insulator. Thereby, it is possible to provide an excellent current-limiting performance since an entire current path of the fixed contact generates electromagnetic force to stretch an arc on the side of the terminal, and since the arc is cooled by vapor generated from the insulator.

34 Claims, 135 Drawing Sheets

FIG. 44(a)
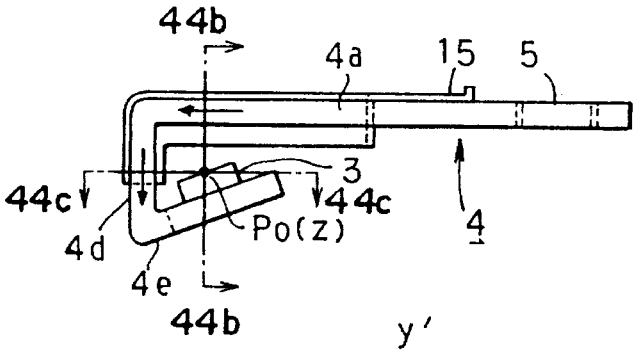
FIG. 44(b)
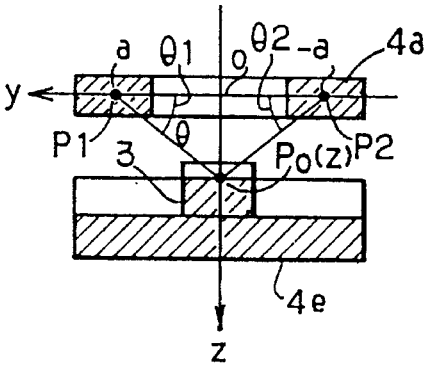
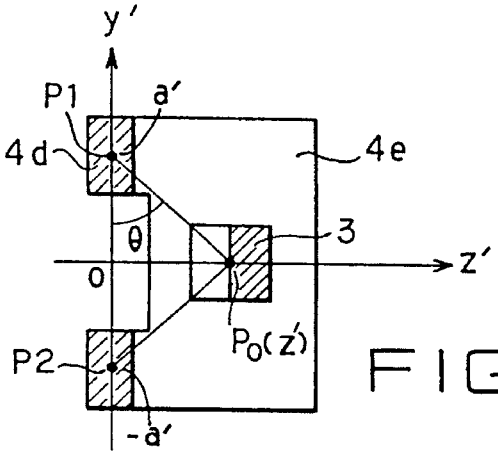
FIG. 44(C)
FIG. 45(a)
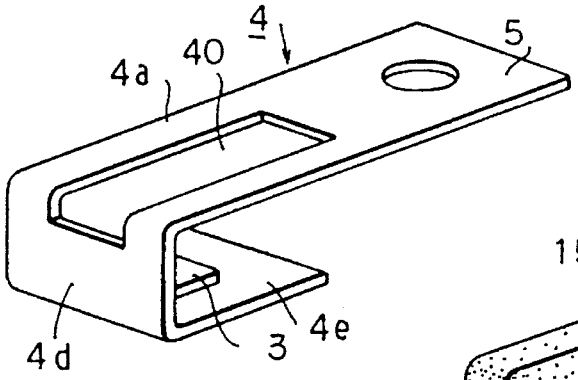
FIG. 45(b)
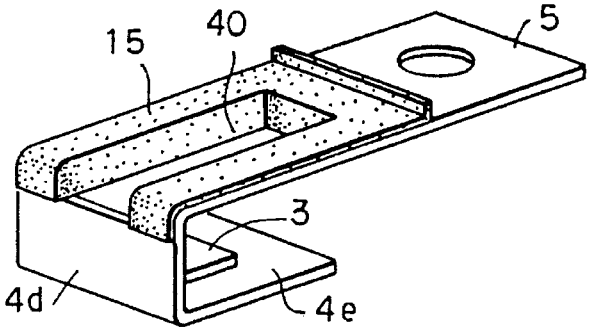

FIG. 69(a)
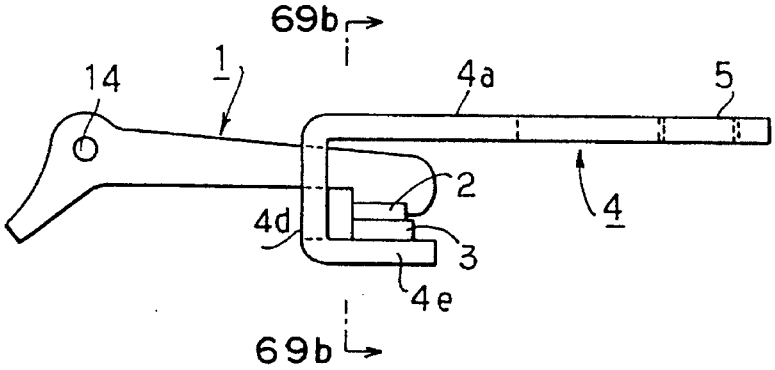
FIG. 69(b)
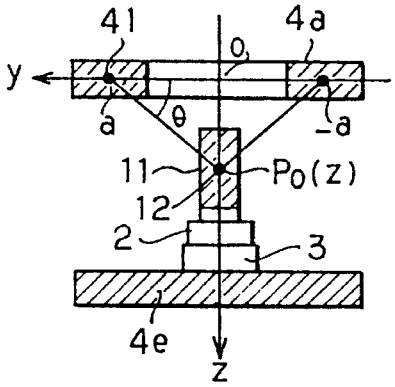
FIG. 70
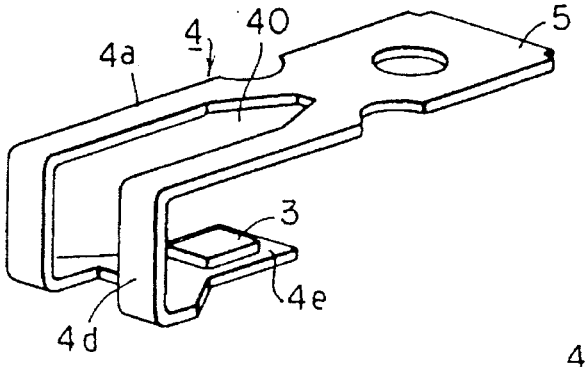
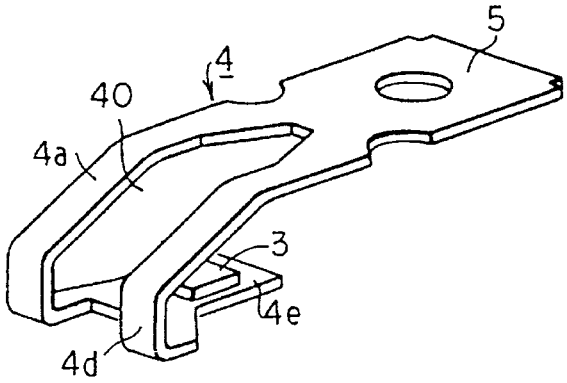
FIG. 71
FIG. 72
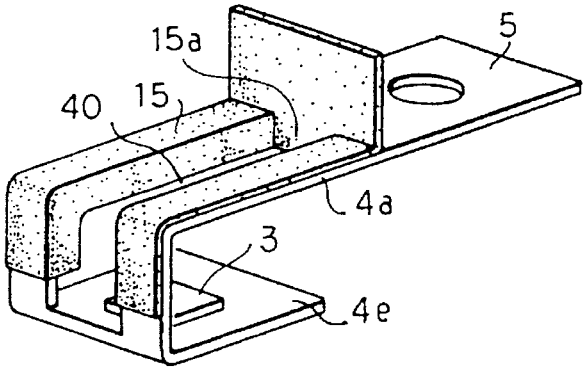

FIG. 94
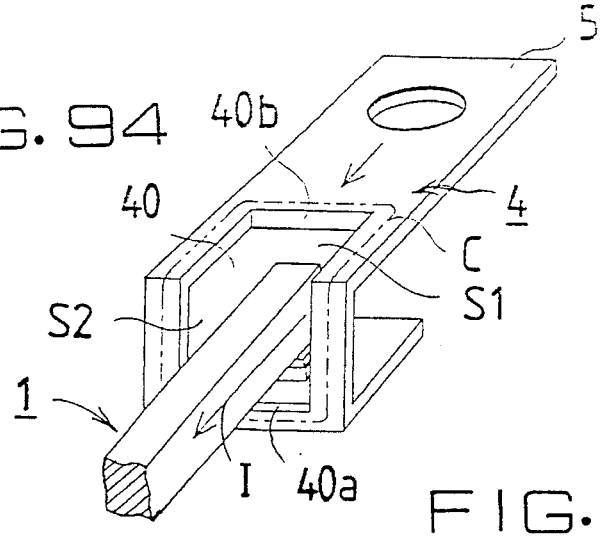
FIG. 95
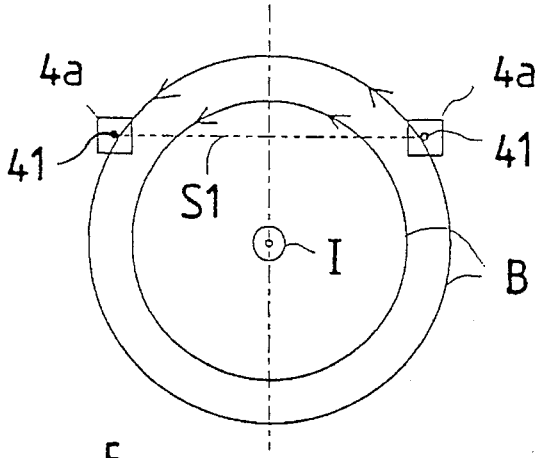
FIG. 96
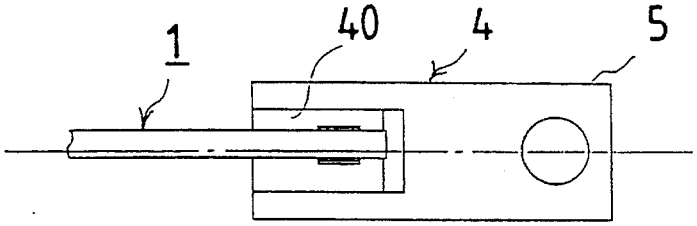
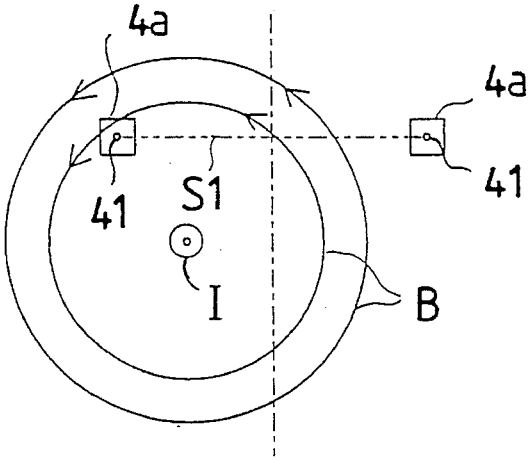
FIG. 97

FIG. 98
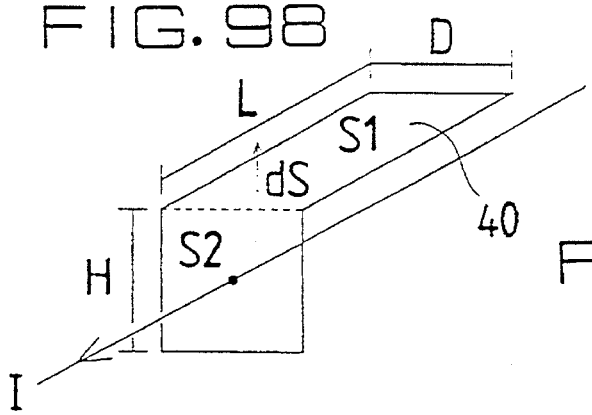
FIG. 99
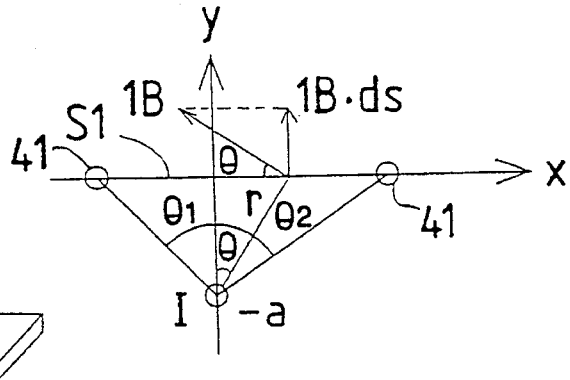
FIG. 100
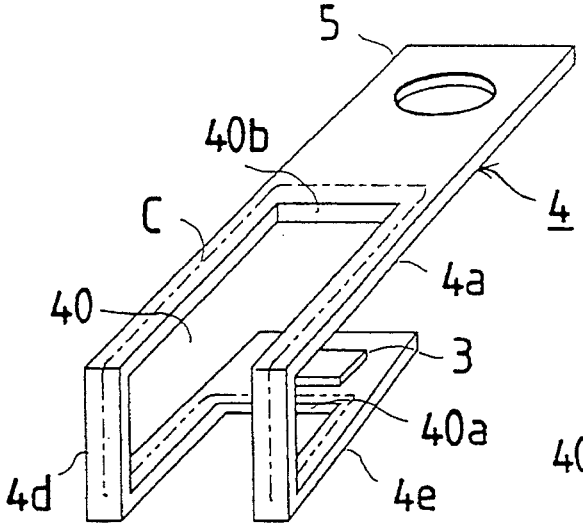
FIG. 101
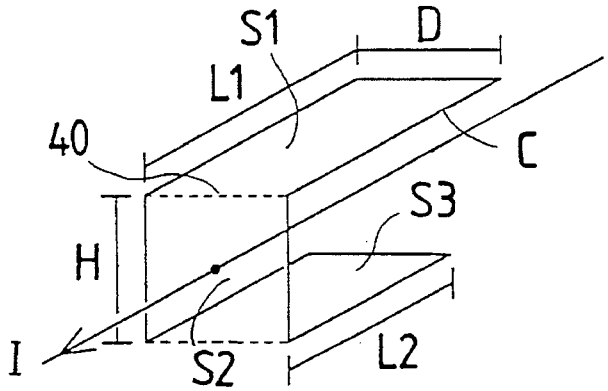
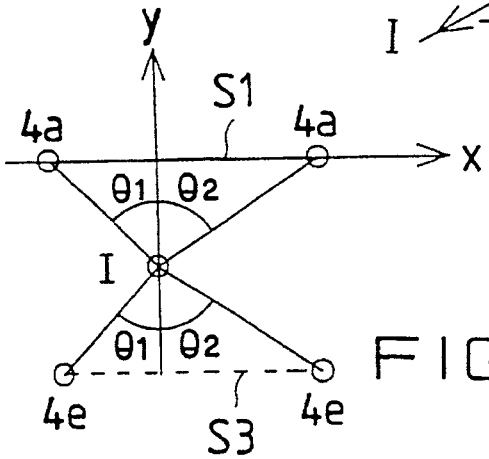
FIG. 102

FIG. 147(a)
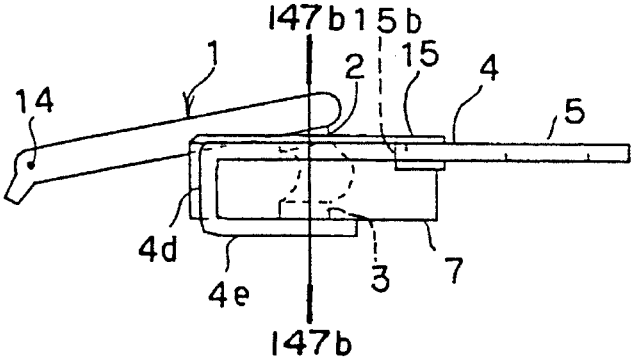
FIG. 147(b)
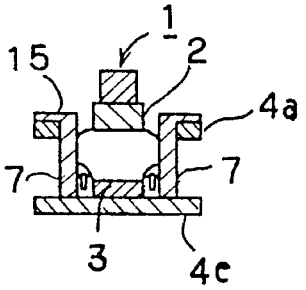
FIG. 148
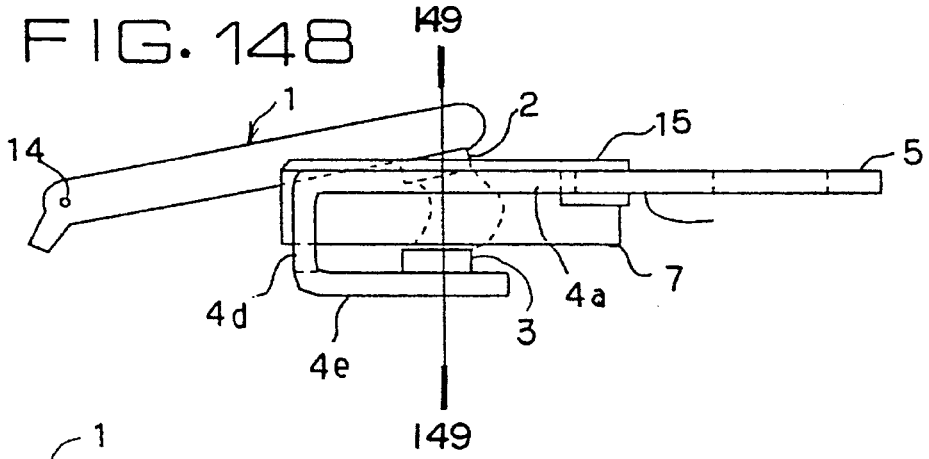
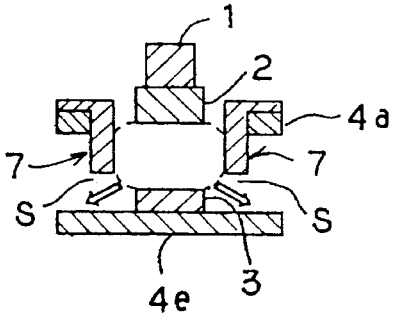
FIG. 149
FIG. 150
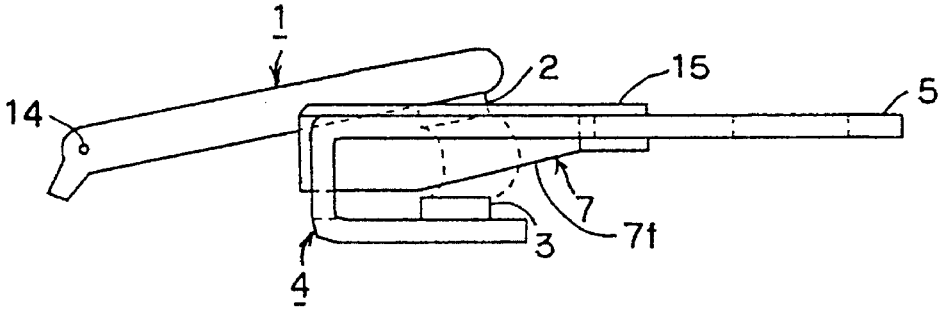

FIG. 195
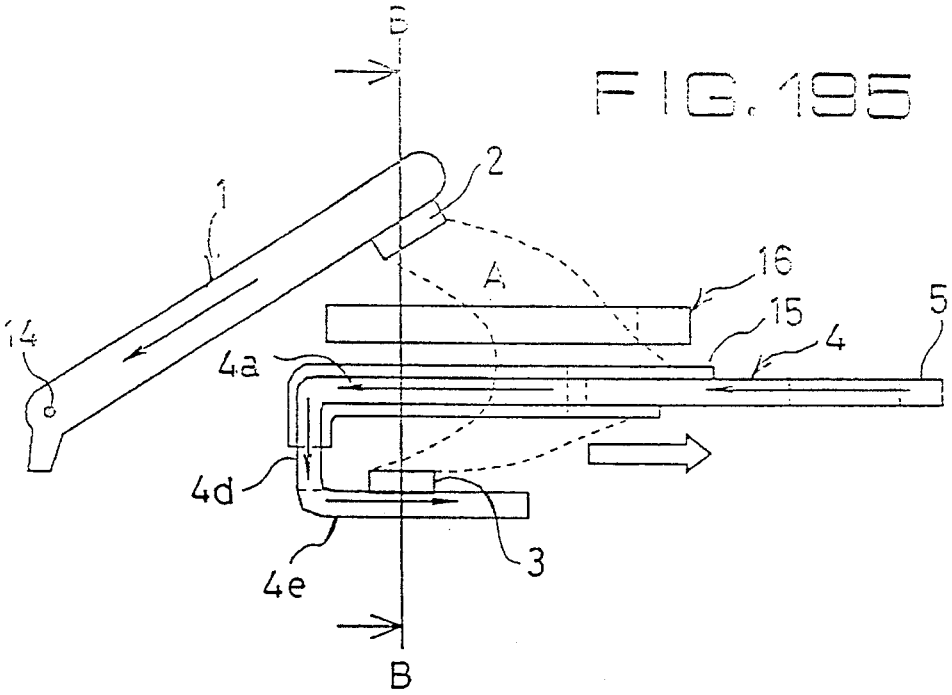
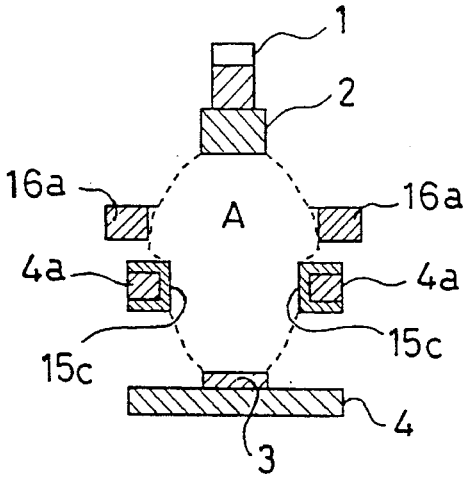
FIG. 196
FIG. 197
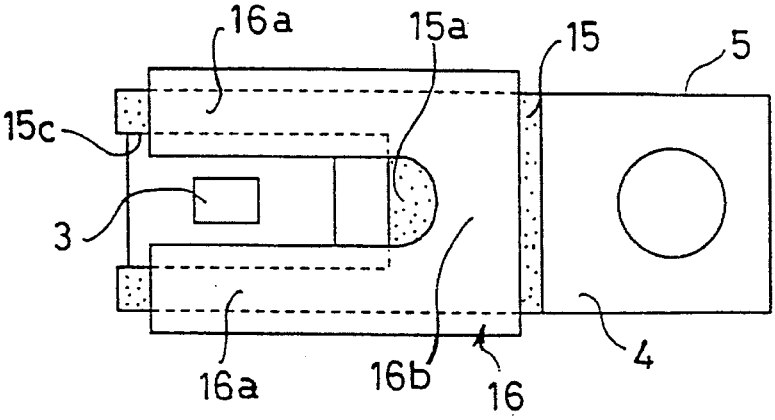

FIG. 207
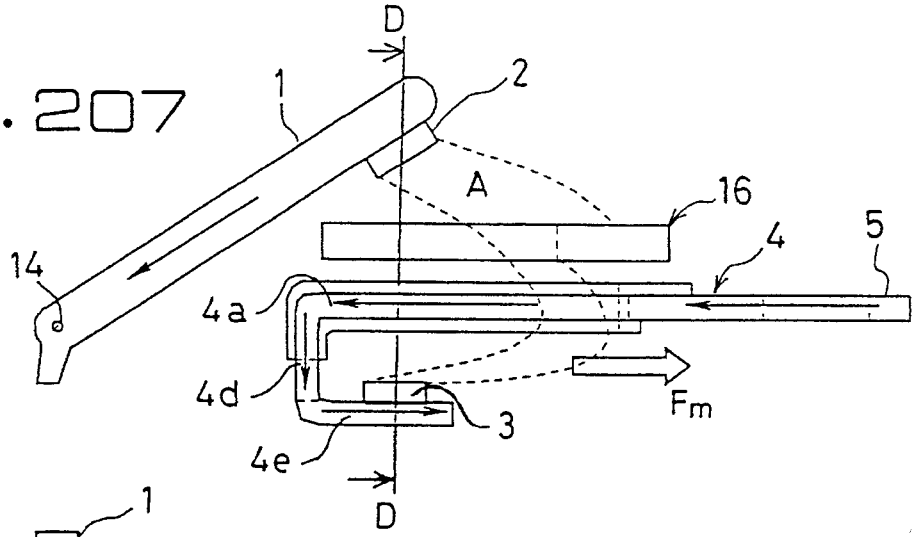
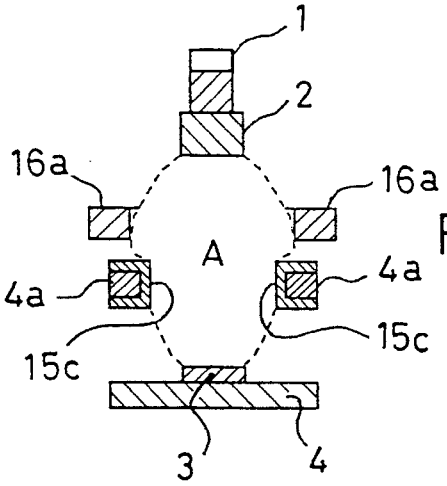
FIG. 208
FIG. 209
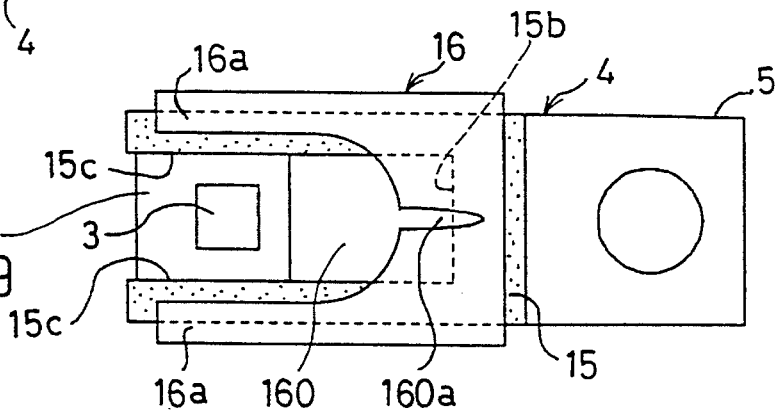
FIG. 210
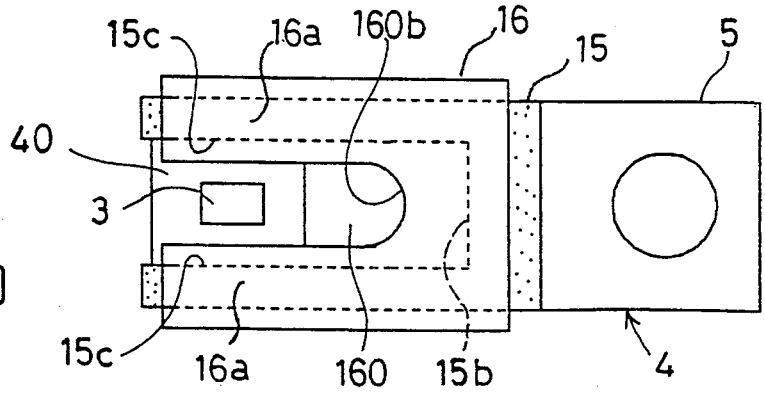

FIG. 269(a)
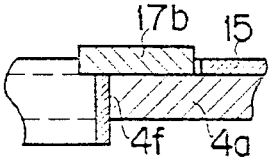
FIG. 269(b)
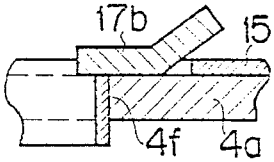
FIG. 269(c)
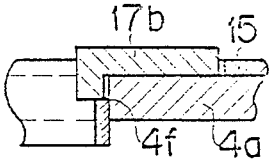
FIG. 269(d)
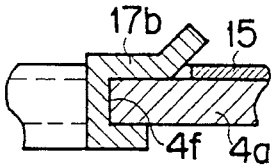
FIG. 269(e)
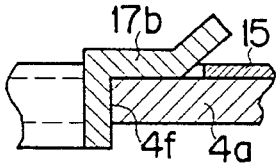
FIG. 269(f)
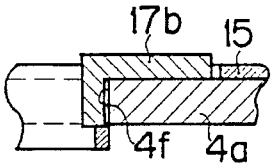
FIG. 269(g)
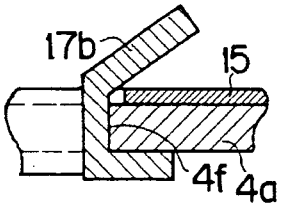
FIG. 269(h)
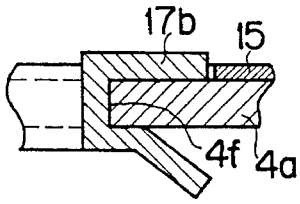
FIG. 269(i)
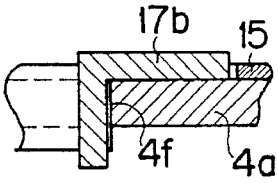
FIG. 269(j)
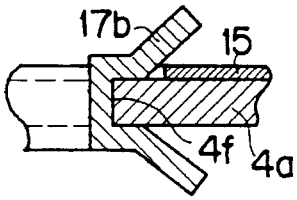
FIG. 269(k)
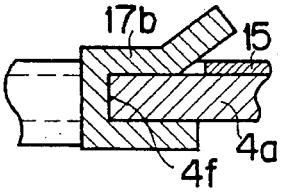
FIG. 269(ℓ)
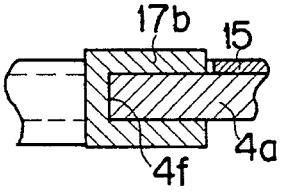

(a)

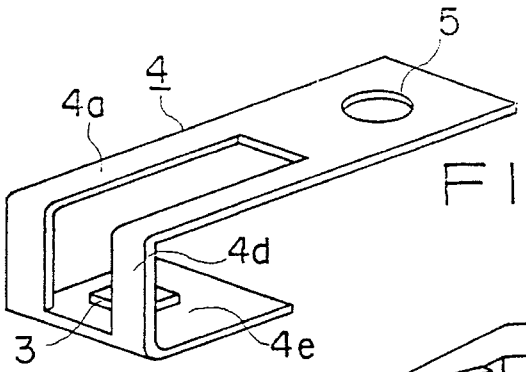
FIG. 285(a)
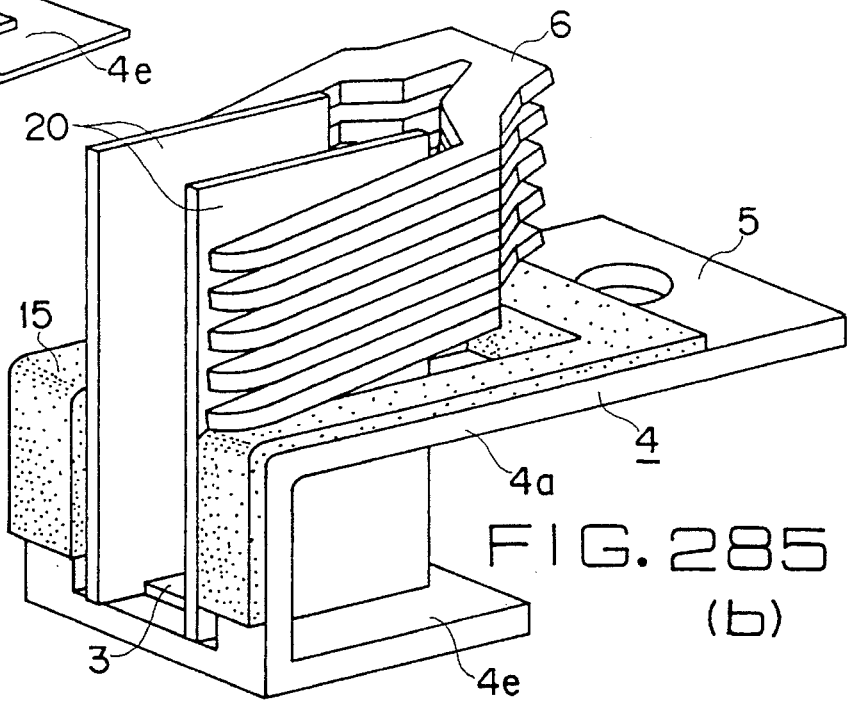
FIG. 285 (b)
FIG. 286
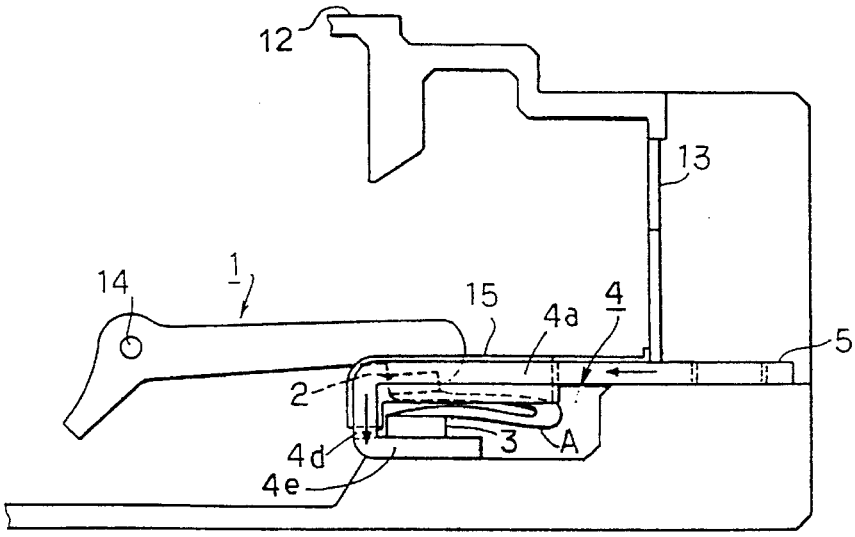

FIG. 314
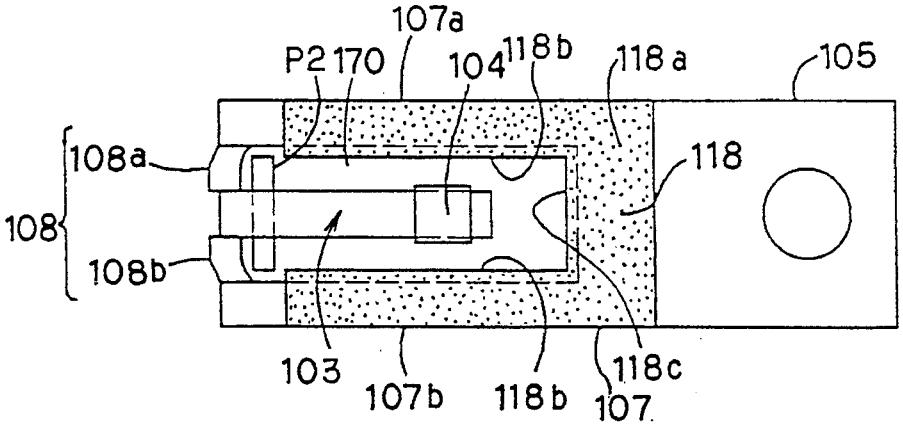
FIG. 315
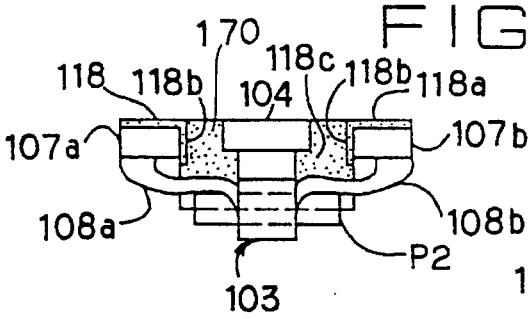
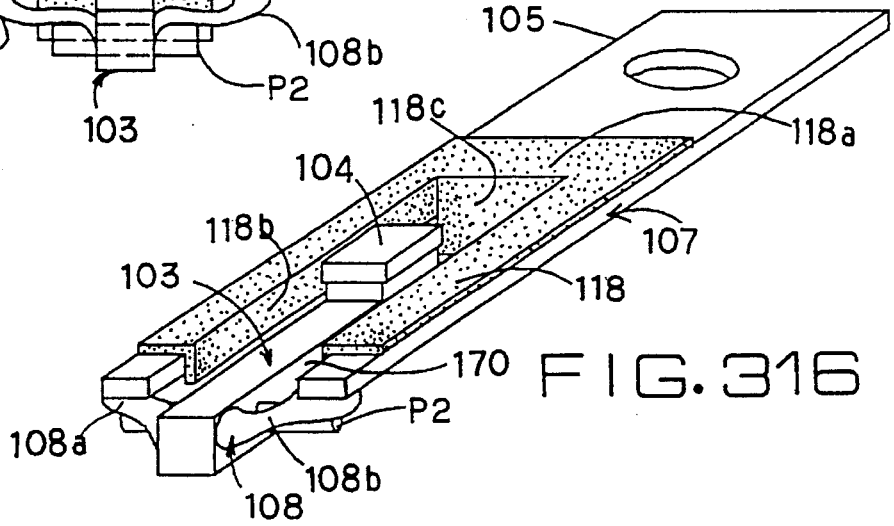
FIG. 316
FIG. 317
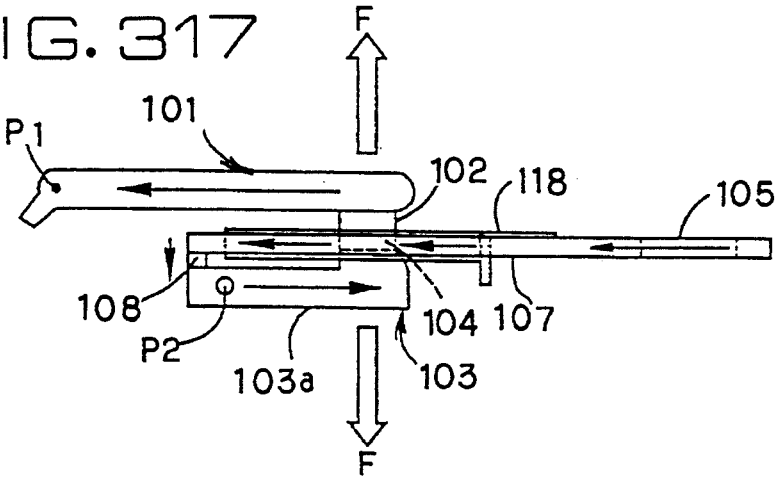

FIG. 334(a)
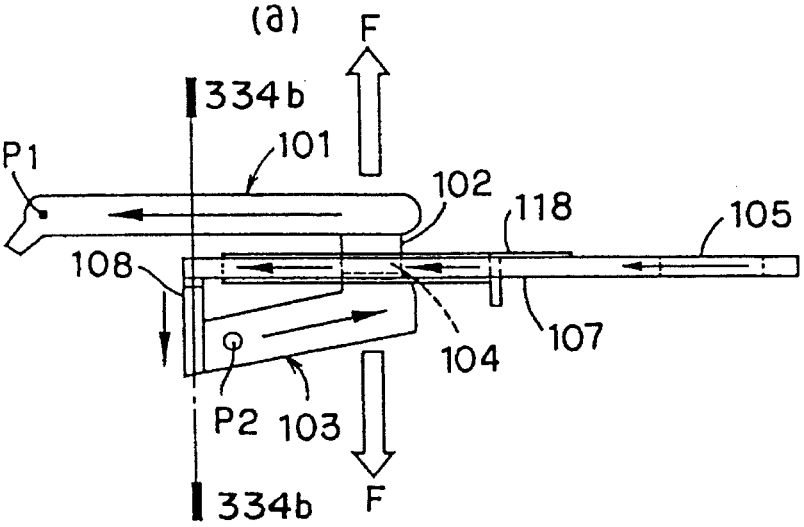
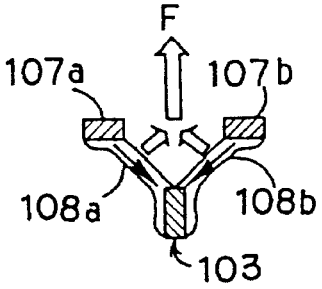
FIG. 334(b)
FIG. 335
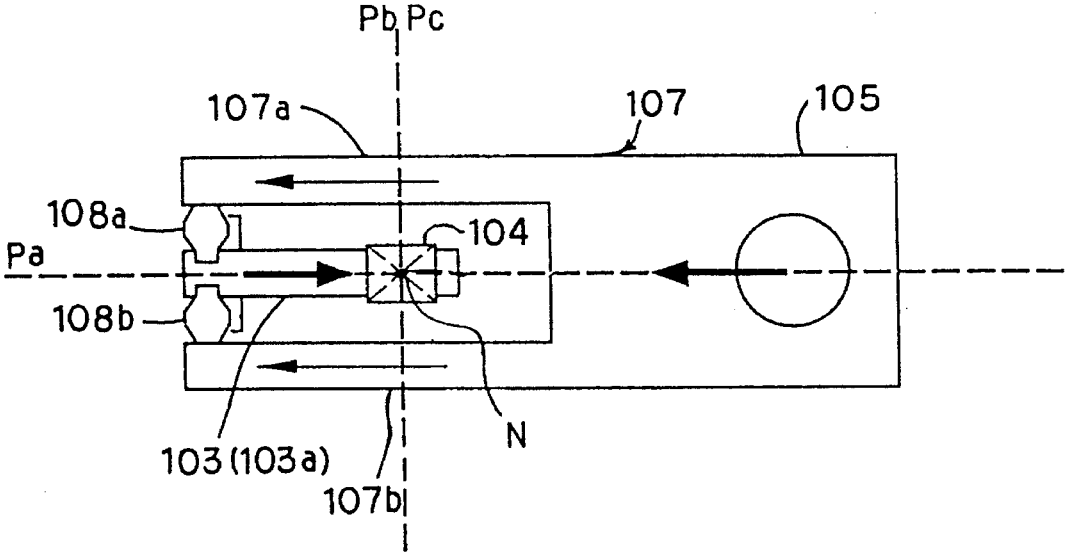

FIG. 336
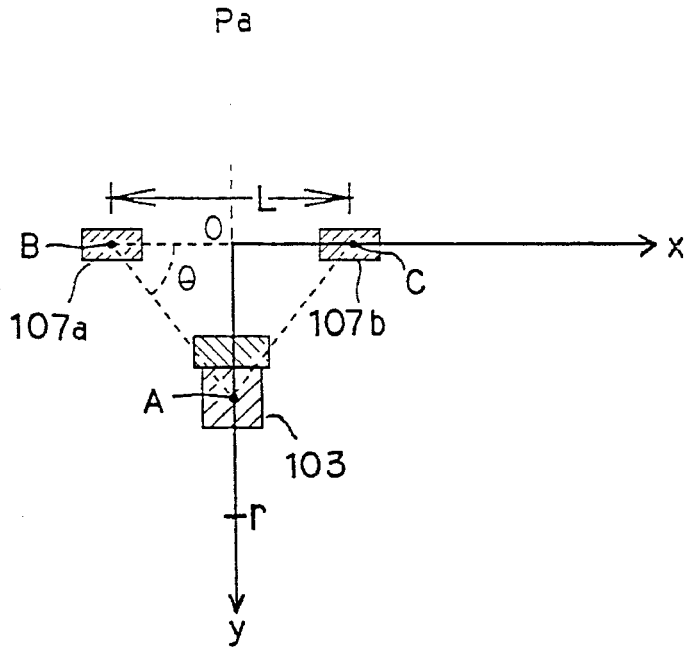
FIG. 337(a)
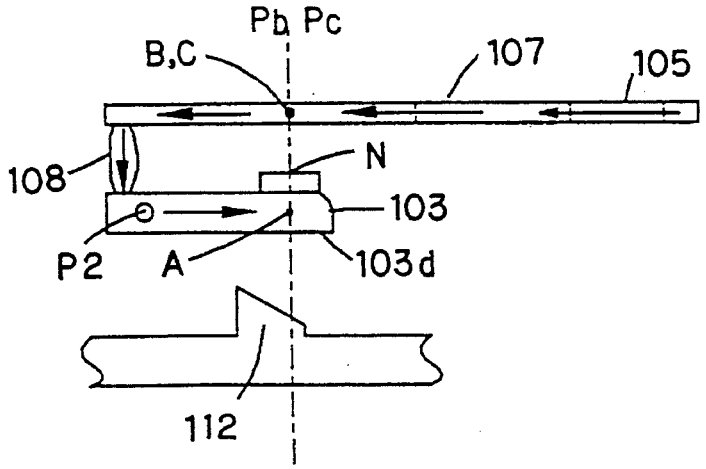
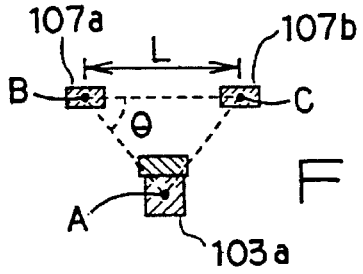
FIG. 337(b)

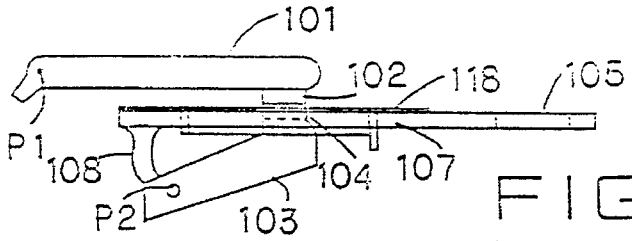
FIG. 347
FIG. 348
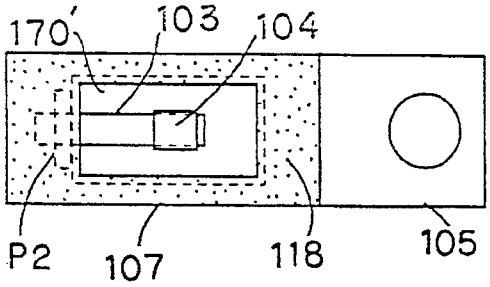
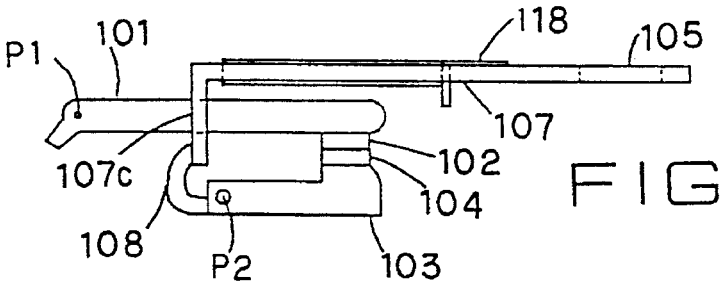
FIG. 349
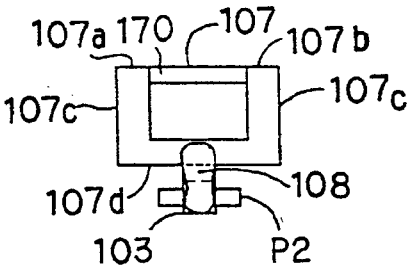
FIG. 350
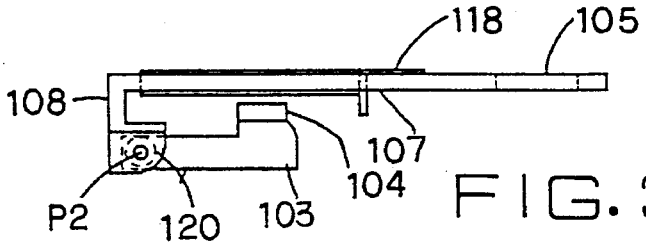
FIG. 351
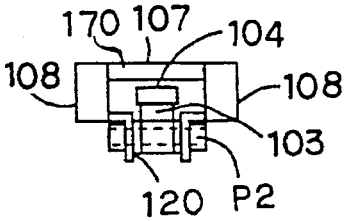
FIG. 352

HIGH VOLTAGE SWITCH INCLUDING U-SHAPED, SLITTED STATIONARY CONTACT ASSEMBLY WITH ARC EXTINGUISHING/MAGNETIC BLOWOUT FEATURES

BACKGROUND OF THE INVENTION

1. Field of the Invention

The present invention relates to a switch such as circuit breaker, current limiting device or electromagnetic contactor, in which an arc may form in a housing at a time of current cutoff.

2. Description of the Prior Art

FIG. 1 is a side view showing a circuit breaker in an opening condition as an example of conventional switches, and FIG. 2 is a side view showing a condition immediately after contact opening in the circuit breaker of FIG. 1. FIG. 3 is a side view showing the maximum opening condition of a moving contact in the circuit breaker of FIG. 2. In the drawings, reference numeral 1 means a moving contact of the circuit breaker, and the moving contact 1 is supported so as to rotate about a rotation supporting point (rotating center) 14 (see FIGS. 2 and 3) of a base portion. Reference numeral 2 means a traveling contact secured to one end (a lower surface of a free end) of the moving contact 1, and 3 means a stationary contact making and breaking contact with the traveling contact 2 by the rotation of the moving contact 1. Reference numeral 4 means a fixed contact having the stationary contact 3 at one end thereof, and a configuration of the fixed contact 4 will be described later. Reference numeral 5 means a terminal on a side of a power source, which is connected to the other end of the fixed contact 4, and 6 means an arc-extinguishing plate which functions to stretch and cool the arc formed between the traveling contact 2 and the stationary contact 3 at an opening time therebetween. Reference numeral 7 means an arc-extinguishing side plate holding the arc-extinguishing plates 6, and 8 means a mechanism portion which causes the moving contact 1 to rotate. The mechanism portion 8 includes a current detecting element (not shown), and is operated according to detection of short-circuit current by the current detecting element. Reference numeral 9 means a handle for manually operating the mechanism portion 8, 10 means a terminal on a side of a load, and 11 is a conductor for connecting the terminal 10 to the moving contact 1. Further, reference numeral 12 means a housing containing these circuit breaker components, and 13 means an exhaust hole provided in a wall portion of the housing 12.

A description will now be given of the configuration of the fixed contact 4.

In FIGS. 1 to 3, the fixed contact 4 is integrally provided in a form including a conductor portion 4*a* connected to the terminal 5 on the side of the power source to horizontally extend, a vertical conductor portion 4*b* downward bent at an end of the conductor portion 4*a* opposed to the terminal 5, a conductor portion 4*c* serving as a step-shaped lower portion horizontally extending from a lower end of the conductor portion 4*b* toward the opposite side of the conductor portion 4*a*, a conductor portion 4*d* vertically rising from a distal end of the conductor portion 4*c*, and a conductor portion 4*e* horizontally extending from an upper end of the conductor portion 4*d* toward the conductor portion 4*a*. Further, the stationary contact 3 is mounted on the conductor portion 4*e*.

In the fixed contact 4 shaped as set forth above, the conductor portion 4*d* connecting the conductor portion 4*c* serving as the step-shaped lower portion to the side of the stationary contact 3 is positioned on the side of the other end of the moving contact 1, to which the traveling contact 2 is not secured with respect to the stationary contact 3, and on the side opposed to the terminal 5. The conductor portion 4*e* having the stationary contact 3 is positioned below a contact surface between the traveling contact 2 and the stationary contact 3 at a time of contact closing therebetween. The fixed contact 4 is used in a skin exposed condition where an entire surface thereof is not insulated.

A description will now be given of the operation.

In a condition shown in FIG. 1, the terminal 5 of the fixed contact 4 is connected to the power source, and the terminal 10 on the side of the load is connected to the load.

In this condition, if the handle 9 is operated in a direction shown by the arrow B, the mechanism portion 8 is actuated so as to downward rotate the moving contact 1 about the rotation supporting point 14 (see FIGS. 2 and 3) of the base portion. Thereby, a contact closing condition where the traveling contact 2 contacts the stationary contact 3 is provided to feed power from the power source to the load. In this condition, the traveling contact 2 is pressed toward the stationary contact 3 with a specified contact pressure so as to ensure reliability of power supply.

If a short-circuit event or the like occurs in a circuit on the side of the load with respect to the circuit breaker to feed a large short-circuit current into the circuit, the current detecting element in the mechanism portion 8 detects the large current so as to actuate the mechanism portion 8. The moving contact 1 is thereby rotated in a contact opening direction to open the traveling contact 2 from the stationary contact 3. At a time of the contact opening, an arc A forms between the traveling contact 2 and the stationary contact 3 as shown in FIGS. 2 and 3.

However, when the larger current such as the short-circuit current flows, extremely strong electromagnetic repulsion is generally caused on the contact surface between the traveling contact 2 and the stationary contact 3. Accordingly, the moving contact 1 is rotated in the contact opening direction before the action of the mechanism portion 8 in order to overcome the contact pressure applied to the traveling contact 2.

Therefore, the rotation causes the opening between the traveling contact 2 and the stationary contact 3 so as to stretch and cool the arc A generated between the contacts 2 and 3 by the arc-extinguishing plate 6. As a result, arc resistance increases, and a current-limiting action is generated to diminish the short-circuit current so that the arc A is extinguished at a zero point of current, resulting in completion of current cutoff.

The current-limiting action is very important for improvement of a protection function of the circuit breaker. As set forth above, it is necessary to increase the arc resistance so as to enhance a current-limiting performance.

Preferred techniques to stretch the arc so as to increase the arc resistance includes a method using a fixed contact having a shape which is disclosed in, for example, Japanese Patent Application Laid-Open Nos. 60-49533 and 2-68831.

The shape of the fixed contact disclosed in these Japanese Patent Application publications is basically identical with that of the fixed contact 4 shown in FIGS. 1 to 3.

Referring to FIGS. 1 to 3, a current path including the fixed contact 4 extends from the terminal 5 on the side of the power source to the stationary contact 3 through the conductor portions 4*a*, 4*b*, 4*c*, 4*d* and 4*e* in this order.

In such a current path, current in the current path 4*e* on the side of the stationary contact 3 of the fixed contact 4 causes electromagnetic force applied to the arc A, and the electromagnetic force serves as force to stretch the arc A toward the arc-extinguishing plate 6. As a result, it is possible to increase the arc resistance so as to provide the circuit breaker having an improved current-limiting performance.

In order to enhance the current-limiting performance in a normal AC cutoff, it is necessary to increase the arc resistance as set forth above. In this case, it is however necessary to increase the arc resistance before the current reaches the maximum value immediately after opening the contacts 2 and 3. Even if the arc resistance is increased after the current becomes large, it is difficult to limit the current due to an inertial effect of the current. Rather worse damage is caused to the breaker because arc energy generated in the breaker becomes large due to the large current and the high resistance. Consequently, it is necessary to provide the fixed contact shape which can largely stretch the arc immediately after opening the contacts 2 and 3 by the strong electromagnetic force so as to rapidly increase the arc resistance.

However, the switch having the conventional fixed contact shape is provided as set forth above. Thus, as shown in FIG. 2, only the conductor portion 4*e* on the side of the stationary contact 3 can serve as the current path of the fixed contact 4 which can concurrently generate the electromagnetic force exerting in a direction to open the moving contact 1 immediately after opening the contacts 2 and 3, and the electromagnetic force to stretch the arc A in the direction of the terminal 5 on the side of the power source. Other current paths (conductor portions) 4*a*, 4*b*, 4*c* and 4*d* prevent an opening action of the moving contact 1 and generate electromagnetic force to stretch the arc A on the side opposed to the terminal 5. The current in the current path 4*d* has the same direction as that of the current of the arc A to attract each other while the current in the current path 4*b* has the direction opposed to the current of the arc A to repel each other. Therefore, the arc A should be stretched in the direction opposed to the terminal 5. Further, the current in the current paths 4*a* and 4*c* flow in the direction opposed to that of the current in the current path 4*e* so as to generate electromagnetic force to stretch the arc A in the direction opposed to the terminal 5.

In addition, only the current path 4*e* of the fixed contact 4 can exert the electromagnetic force in a rotating direction on the entire moving contact 1 as set forth above. In other current paths 4*a* and 4*c*, current flows in the same direction as that of the moving contact 1 so as to exert the electromagnetic force in a direction to close the moving contact 1. The current in the current path 4*d* can exert the electromagnetic force in the rotating direction on the side of the rotating center 14 of the moving contact 1, but exert the electromagnetic force in the closing direction on the side of the traveling contact 2.

Accordingly, with the shape of the fixed contact 4 used in the conventional switch, there is a problem in that the electromagnetic force generated by the current in the fixed contact 4 can not effectively act in order to stretch the arc A. Further, though only the electromagnetic force by the current path 4*e* of the fixed contact 4 contributes to high speed opening of the moving contact 1, the electromagnetic force rapidly decreases due to an extended distance between the traveling contact 2 and the stationary contact 3 as the moving contact 1 is rotated. Additionally, there is Generated a relatively large effect of the current in other current paths 4*a*, 4*b*, 4*c* and 4*d* which Generate the electromagnetic force in the direction to prevent the opening action. Hence, there is another problem of a reduced speed of the opening action. As a result, there are other problems in that the opening speed is reduced, and a required current-limiting performance can not be provided.

FIG. 4 is a side view showing a closing condition of the circuit breaker serving as the conventional switch disclosed in, for example, Japanese Patent Application Laid-Open No. 60-49535. FIG. 5 is a side view showing an opening condition of only a moving element in FIG. 4, and FIG. 6 is a side view showing an opening condition of the moving element and a repelling element in FIG. 4.

In the drawings, reference numeral 101 means one electric contact (hereafter referred to as moving element) of the circuit breaker, and the moving element 101 can rotate with a supporting shaft P1 of a main end as the rotating center as shown in FIGS. 7 and 8. Reference numeral 102 means a contact secured to a lower surface of a free end of the one moving element 101, and 103 means the other electric contact (repelling element) disposed under the one moving element 101. The electric element 103 can also rotate with a shaft P2 of a main end as the rotating center. Reference numeral 104 means the other contact secured to an upper surface of a free end of the other electric contact 103 so as to make and break contact with the other contact 102. The moving element 101 and the other electric contact 103 form a pair of electric contacts.

Reference numeral 105 means a terminal of a power source system, and 106 means a conductor electrically connecting the other electric contact 103 to the terminal 105. Reference numeral 107 means a first conductor portion horizontally extending at a position below the moving element 101, and the terminal 105 is connected to one end of the first conductor portion 107. Reference numeral 108 means a second conductor portion continuously formed with the other end of the first conductor portion 107 so as to rise at a position below the moving element 101, and the conductor 106 includes the first conductor portion 107 and the second conductor portion 108. Here, the second conductor portion 108 has flexibility so as not to prevent rotation of the electric contact 103. Further, the main end of the repelling element 103 is rotatably coupled with an upper end of the second conductor portion 108 through the shaft P2.

Reference numeral 109 means a torsion spring which is fitted with a main end coupling shaft P2 of the other electric contact 103, and 110 means a mechanism portion for rotating the moving element 101. The mechanism portion 110 has a function to automatically rotate the moving element 101 in the opening direction when current having a predetermined current value or more (short-circuit current) flows in the circuit breaker. In view of the fact, in general, the other electric element 101 is referred to as the moving element 101, and the contact 102 will be referred to as traveling contact 102.

Reference numeral 110*a* means a spring anchor which is provided at a side surface portion of a casing of the mechanism portion 110. One end of the torsion spring 109 anchors the spring anchor 110*a*, and the other end of the torsion spring 109 anchors the moving element 101. The torsion spring 109 contacts the contacts 102 and 104 with a predetermined force at a closing time. Further, a stopper (not shown) is provided for the electric contact 103 such that the other electric contact 103 is held at a position shown in FIG. 5 at an opening time of the moving element 101.

Therefore, the other electric contact 103 can rotate in the opening direction if force larger than that of the torsion spring 109 is applied to the other electric contact 103. As noted above, since the electric contact 103 can repel with a large force, the electric contact 103 will be hereafter referred to as repelling element, and the contact 104 will be referred to as repelling contact.

Reference numeral 111 means a handle for manually operating the mechanism portion 110, and the handle 110 is operated so as to manually switch the moving element 101. Reference numeral 112 means a stopper to set the maximum opening position of the repelling element 103, 113 means an arc-extinguishing plate, and 114 is an arc-extinguishing side plate holding the arc-extinguishing plate 113. Reference numeral 115 means a terminal on a side of a load, 116 means a housing containing the components of the circuit breaker, and 117 is an exhaust hole provided in a wall portion of the housing 116.

A description will now be given of the operation.

In FIG. 4, in case the one terminal 105 is connected to the power source and the other terminal 115 is connected to the load, it is possible to feed the power from the power source to the load. At this time, the traveling contact 102 and the repelling contact 104 are in a closing condition where the traveling contact 102 and the repelling contact 104 contact each other with a predetermined contact pressure by a contact pressure spring (not shown) of the moving element 101 and the torsion spring 109 of the repelling element 103. In the closing condition, current as shown in FIG. 7 flows in the moving element 101 and the repelling element 103. That is, as shown by the narrow arrow in FIG. 7, the current enters the terminal 105 to pass through the first conductor portion 107, the second conductor portion 108, the repelling element 103, and the repelling contact 104 in this order. Subsequently, the current reaches the moving element 101 after passing through a contact surface between the repelling contact 104 and the traveling contact 102. The current in the moving element 101 exits from a conductor in a vicinity of the rotating center P1 to the side of the load.

As will be clear in FIG. 7, the current in the repelling element 103 and the current in the moving element 101 are substantially parallel to each other, but have opposite directions. Accordingly, electromagnetic repulsion F is applied between the moving element 101 and the repelling element 103. The contact pressure between the traveling contact 102 and the repelling contact 104 is set to a magnitude larger than that of electromagnetic repulsion which is generated by small current such as load current or overload current. With the small current, the traveling contact 102 and the repelling contact 104 are never opened by rotating the moving element 101 or rotating the repelling element 103 without operating the mechanism portion 110.

The moving element 101 may be rotated by the handle 111 in order to cut off normal load current, and the mechanism portion 110 is automatically operated to rotate the moving element 101 to an opening position shown in FIG. 5 when the overload current flows. In either case, the repelling element 103 is never operated by the torsion spring 109 in the opening direction. This condition is shown in FIG. 8*a*. In FIG. 8, magnetic field generated by the current in the repelling element 103 exerts force Fm on the arc A in a direction of the arc-extinguishing plate 113. As a result, the arc A is stretched in the direction marked Fm, and is cooled and extinguished by the arc-extinguishing plate 113, resulting in completion of the current cutoff.

On the other hand, in the closing condition shown in FIG. 7, if the large current such as short-circuit current flows, the electromagnetic repulsion F applied between the moving element 101 and the repelling element 103 becomes larger than the contact pressure between the contacts 102 and 104, that is, the pressure of the torsion spring 109 or the contact pressure spring of the moving element 101. Consequently, the moving element 101 and the repelling element 103 are started to rotate in the respective opening directions.

As shown in FIG. 9, since both the moving element 101 and the repelling element 103 move in the opening directions, that is, move in each opposite direction, an interval between the traveling contact 102 and the repelling contact 104 thereof increases twice as compared with a case where only the moving element 101 is moved. In other words, the opening speed becomes twice as fast. Hence, it is possible to reach a condition where the moving element 101 and the repelling element 103 rotate to the maximum extent as shown in FIG. 10 in a short time after the short-circuit current starts to flow.

The magnetic field generated by the current in the repelling element 103 exerts the force Fm in the direction of the arc-extinguishing plate 113 on the arc A so as to stretch the arc A. As a result, it is possible to rapidly increase arc voltage, and provide an excellent current-limiting performance. Though the arc A is still generated by the current diminished by the excellent current-limiting performance, the arc A is extinguished by undergoing the cooling operation by the arc-extinguishing plate 113.

Since the conventional switch is provided as set forth above, the electromagnetic repulsion F is reliably generated between the moving element 101 and the repelling element 103 by the current path as shown in FIG. 7. However, another electromagnetic repulsion is also generated between the repelling element 103 and the first conductor portion 107, and the electromagnetic repulsion serves as force in a direction opposed to the opening direction of the repelling element 103. Further, magnetic field generated by the second conductor portion 108 exerts electromagnetic force on the repelling element 103, and the electromagnetic force also serves as force in a direction opposed to the opening direction of the repelling element 103. That is, there is a problem in that the electromagnetic force generated by the current of the moving element 101 to rotate the repelling element 103 in the opening direction may considerably decreased by the electromagnetic force in the opposite direction generated by the current in the first and the second conductor portions 107 and 108.

As shown in FIGS. 9 and 10, as the moving element 101 and the repelling element 103 rotate in the respective opening directions, the interval therebetween becomes larger. Accordingly, electromagnetic force to rotate the moving element 101 and the repelling element 103 in the respective opening directions also becomes weak. To the contrary, intervals between the repelling element 103 and the first conductor portion 107, and between the repelling element 103 and the second conductor portion 108 are decreased. Therefore, the electromagnetic force to rotate the repelling element in the direction opposed to the opening direction becomes large. As a result, as the interval between the contacts 102 and 104 becomes large because of the rotation of the moving element 101 and repelling element 103, the electromagnetic force to rotate the moving element 101 and repelling element 103 in the opening direction is decreased. In particular, since the electromagnetic force in the direction opposed to the opening direction also increases in the repelling element 103, reduction of the electromagnetic force in the opening direction is remarkable.

In a typical arrangement in the housing 116 of the circuit breaker as shown in FIG. 4, the repelling element 103 is shorter than the moving element 101 because of the mechanism portion 110.

In general, in case the rotating center is provided at one end of a rod, moment of inertia with respect to the rotating center is proportional to the square of a length of the rod, and moment of force is proportional to the length of the rod. Accordingly, angular acceleration with respect to the rotating center is inversely proportional to the length of the rod. In case this relationship is applied to the moving element 101 and the repelling element 103, the repelling element 103 can rotate faster than the moving element 101 immediately after the short-circuit current starts to flow because the repelling element 103 is shorter than the moving element 101. Hence, it can be considered that the repelling element 103 rather than the moving element 101 greatly contributes to the increased arc length initially generated between the contacts 102 and 104, that is, the current-limiting performance.

However, in the circuit breaker having a terminal structure as set forth above, it is impossible to effectively generate electromagnetic force to rotate the repelling element 103 in the opening direction. Consequently, there is a problem in that the rotation of the repelling element 103 is slow, and rapid initial rising of the arc voltage required for the current-limiting can be obtained.

Further, the electromagnetic force to rotate the repelling element 103 in the opening direction is considerably reduced in a condition where the repelling element 103 is rotated to the maximum extent as shown in FIG. 10. Hence, the repelling element 103 easily turns back to an original position by the force of the torsion spring 109 if the electromagnetic force is slightly reduced due to reduction of the current. As a result, there are problems in that, even if the repelling element 103 is rotated to the maximum extent so as to provide the maximum arc voltage, the repelling element 103 immediately turns back, and the arc voltage is easily reduced.

The repelling element 103 exerts the electromagnetic force in the direction of the arc-extinguishing plate 113 on the arc A between the contacts 102 and 104. The current in the first conductor portion 107 exerts the electromagnetic force in the direction opposed to the arc-extinguishing plate 113 on the arc because the current in the first conductor portion 107 has a direction opposed to that of the current in the repelling element 103. Further, the current in the second conductor portion 108 and the current in the arc attract each other because of the same direction thereof. Therefore, the arc A is stretched in the direction opposed to the arc-extinguishing plate 113. Accordingly, only the current in the repelling element 103 can be used for the electromagnetic force to stretch the arc A, and other current in the first conductor portion 107 and the second conductor portion 108 exert the electromagnetic force in the opposite direction. As a result, there are problems in that the electromagnetic force extending the arc A in the direction of the arc-extinguishing plate 113 is weak, and high arc voltage can not be obtained since the arc can not be stretched.

As set forth above, in the conventional circuit breaker, there is a problem in that a sufficient current-limiting performance can not be provided due to the above causes.

SUMMARY OF THE INVENTION

In view of the foregoing, it is an object of the present invention to provide a switch having an excellent current-limiting performance, in which an entire current path of a fixed contact immediately after contact opening generates electromagnetic force to stretch an arc on the side of a terminal so as to rapidly rise arc voltage, and when an opening distance of a moving contact is increased, it is possible to generate and maintain high arc voltage by cooling the arc.

It is another object of the present invention to provide a switch which can increase rise of an opening speed of a moving contact by electromagnetic force.

It is still another object of the present invention to provide a switch so as to facilitate fabrication of a fixed contact without a risk that a switching action of a moving contact is prevented by the fixed contact.

It is a further object of the present invention to provide a switch in which a switching action of a moving contact is not prevented by a fixed contact, an arc is cooled so as to limit current for an initial period of contact opening of the moving contact, and a housing is hardly damaged by pressure because the pressure in the housing is reduced for a later period of cutoff action.

It is a still further object of the present invention to provide a switch which can prevent a traveling contact from dropping out due to an effect of an arc, and can increase vertical mechanical strength of a moving contact.

It is a still further object of the present invention to provide a switch having an excellent current-limiting performance, in which a large electromagnetic force is applied to a moving contact in an opening direction so as to quickly open a contact when a large current such as short-circuit current flows, entire the current in a fixed contact can stretch an arc on the side of a terminal immediately after contact opening so as to rapidly extend an arc length and rapidly rise arc voltage, and the arc is cooled so as to generate and maintain high arc voltage when an opening distance of the moving contact is increased.

It is a still further object of the present invention to provide a switch which can substantially make full use of force of current in a first conductor portion to attract a moving contact immediately after opening, and can accelerate a rise of an opening speed.

It is a still further object of the present invention to provide a switch having an excellent current-limiting performance, in which an entire current path of a fixed contact immediately after contact opening generates electromagnetic force to stretch an arc on the side of a terminal so as to rapidly rise arc voltage, and the arc is cooled so as to generate and maintain high arc voltage when an opening distance of the moving contact is increased.

It is a still further object of the present invention to provide a switch in which arc voltage immediately after contact opening rapidly increases, and an arc at a contact opening time is forcedly cooled so as to maintain high arc voltage and reduce unbalance on electromagnetic force applied to a moving contact or the arc.

It is a still further object of the present invention to provide a switch having excellent current-limiting performance and cutoff performance, which can apply a strong driving magnetic field to an arc immediately after contact opening, achieve great effect of arc-extinguishing side plates, and forcedly cool the arc so as to enhance an arc cooling effect in an opening condition.

It is a still further object of the present invention to provide a switch having an excellent current-limiting performance, which can forcedly cool in a contact opening condition, and increase an opening speed of a moving contact.

It is a still further object of the present invention to provide a switch having an improved current-limiting performance, in which an arc immediately after contact opening is stretched on the side of a terminal with respect to a current component in a conductor, and is cooled by contacting an arc-extinguishing plate.

It is a still further object of the present invention to provide a switch having excellent current-limiting performance and cutoff performance, which can provide quick rise of arc voltage, stretch an arc in a predetermined direction without exerting a inverse magnetic field generated by a fixed contact on the arc, and further increase and maintain the arc voltage for an initial period of opening.

It is a still further object of the present invention to provide a switch having an excellent current-limiting performance and high security, which can prevent pressure in the switch from abnormally increasing due to gas generated by an arc contacting an insulator covering a first conductor portion, concurrently avoid degradation of dielectric strength by protection of the insulator, generate and maintain high arc voltage, and have arc-extinguishing plates whose number can be increased effectively with respect to the arc so as to enhance an arc cooling effect and immediately extinguish the arc.

It is a still further object of the present invention to provide a switch having excellent current-limiting performance and high durability, in which an arc runner is mounted on a second conductor portion so as to immediately cool an arc, and generate and maintain high arc voltage.

It is a still further object of the present invention to provide a switch having excellent current-limiting performance and cutoff performance, in which an arc runner is mounted on a first conductor portion so as to protect an insulator.

It is a still further object of the present invention to provide a switch having excellent current-limiting performance and cutoff performance, in which an electrode is mounted on a first conductor portion to reduce rise of internal pressure for a later period of cutoff so as to prevent a crack of a housing.

It is a still further object of the present invention to provide a switch having an excellent current-limiting performance, which enables high speed opening of an electric contact at a time of large current cutoff.

It is a still further object of the present invention to provide a switch in which strong magnetic field drives and extends an arc on a contact even at a time of small current cutoff so as to have excellent current-limiting performance and small current cutoff performance.

According to the first aspect of the present invention, for achieving the above-mentioned objects, there is provided a switch including a moving contact having a traveling contact at one end thereof, a fixed contact having a stationary contact at one end thereof, which can make and break contact with the traveling contact by a switching action of the moving contact, and a terminal connected to the other end of the fixed contact. In the switch, the fixed contact includes a first conductor portion connected to the terminal, a second conductor portion having the stationary contact, and a third conductor portion vertically connecting the first conductor portion with the second conductor portion in case the traveling contact in a contact closing condition is upward opened from the stationary contact. Further, the third conductor portion is disposed on the side of the other end of the moving contact to which the traveling contact is not mounted with respect to a position of the stationary contract, and on the side opposed to the terminal. The first conductor portion is disposed above a contact surface of contacts at a contact closing time, and is disposed below a contact surface of the traveling contact at an opening time of the contacts. A position of the first conductor portion which can be surveyed from a surface of the traveling contact at an opening time of the contacts is coated with an insulator.

Consequently, in the switch according to the first aspect of the present invention, the arc is stretched in a direction of the terminal by the entire current in conductor portions forming a fixed contact immediately after contact opening, and thereafter the arc is left pressed onto an insulator covering the first conductor portion so as to generate and maintain high arc voltage.

According to the second aspect of the present invention, there is provided a switch in which a fixed contact is provided in a form having a portion connected immediately to the stationary contact in a connecting conductor connecting a terminal to a stationary contact, and the portion is substantially parallel to a moving contact at a closing time on the side opposed to the terminal with respect to a position of the stationary contact.

Consequently, in the switch according to the second aspect of the present invention, a fixed contact is provided with a portion substantially parallel to the moving contact at a closing time at a position on the side opposed to the terminal with respect to a position of the stationary contact of a second conductor portion. As a result, it is possible to improve a rise of an opening speed of the moving contact by electromagnetic force.

According to the third aspect of the present invention, there is provided a switch in which a fixed contact includes a substantially U-shaped connecting conductor position, a stationary contact is secured to the inside of one end of the U-shaped form, a terminal is connected to the other end of the U-shaped form, and a slit is provided in a position of the connecting conductor positioned above a secured surface of the stationary so as to allow a switching action of a moving contact to the fixed contact.

Consequently, in the switch according to the third aspect of the present invention, the fixed contact is provided in a substantially U-shaped form so that fabrication of the fixed contact is very easy. The slit is provided in the fixed contact at a conductor position which is positioned above the secured surface of the stationary contact so as to allow the switching action of the moving contact. As a result, it is possible to eliminate a risk that the switching action of the moving contact is prevented by the fixed contact.

According to the fourth aspect of the present invention, there is provided a switch in which a fixed contact includes a first conductor portion positioned above a stationary contact on either side of both sides of a plane including a locus described by a switching action of a moving contact.

Consequently, in the switch according to the fourth aspect of the present invention, the first conductor portion of the fixed contact is positioned above the stationary contact on either side of both sides of the plane including the locus described by the switching action of the moving contact. Therefore, a switching action of the moving contact is not prevented by the fixed contact. Further, an arc forming between contacts is cooled by an insulator covering the first conductor portion so as to limit current for an initial opening period of the moving contact. In addition, for a later period of cutoff action, the arc is separated from the insulator, and pressure generated in a housing is decreased so that the housing is hardly damaged due to the pressure generated therein at a time of cutoff action.

According to the fifth aspect of the present invention, there is provided a switch in which a moving conductor serving as one part of a moving contact has a narrower lateral width than that of a traveling contact when a direction perpendicular to the plane including the locus described by the switching action of the moving contact is defined as a lateral direction.

Consequently, in the switch according to the fifth aspect of the present invention, the moving conductor serving as one part of the moving contact has the narrower lateral width than that of the traveling contact. As a result, it is possible to prevent the traveling contact from dropping out since a secured surface of the traveling contact is shaded from an arc, and increase vertical mechanical strength of the moving contact.

According to the sixth aspect of the present invention, there is provided a switch in which a first conductor portion is disposed above a center of a conductive path of one end of a moving contact to which a traveling contact is mounted at a time of a contact closing condition, and is disposed below a contact surface of the traveling contact at a time of a contact opening condition, and a position of a first conductor portion which can be surveyed from a traveling contact surface at a time of the contact opening condition, is coated with an insulator.

Consequently, in the switch according to the sixth aspect of the present invention, entire the current in the fixed contact generates large electromagnetic force which is applied to the moving contact in an opening direction. Therefore, the moving contact can be quickly opened, and a distance between contacts can be increased. Further, an arc is stretched in a direction of a terminal by the entire current in a conductor forming the fixed contact immediately after contact opening. Then, an arc length is increased so as to rapidly rise arc voltage, and thereafter the arc is left pressed onto an insulator covering a first conductor portion. As a result, it is possible to generate and maintain high arc voltage.

According to the seventh aspect of the present invention, there is provided a switch including a first conductor portion having a notch along a plane including a locus described by a moving contact. Further, angles θ1 and θ2 are provided on the side of the plane including the locus to become 45°±10° between a line connecting the center of gravity P1 to the center of gravity P2 in respective sections of conductor portions on both sides of the notch, and lines respectively connecting the center of gravity P3 in a section of a moving contact conductor serving as one portion of a moving contact to the centers of gravity P1 and P2 in a section perpendicular to the plane including the locus in a contact closing condition and perpendicular to the notch of the first conductor portion.

Consequently, in the switch according to the seventh aspect of the present invention, it is possible to enhance a rise of an opening speed immediately after contact opening by substantially making full use of force of current in the first conductor portion of the fixed contact to attract the moving contact.

According to the eighth aspect of the present invention, there is provided a switch including a moving contact having a traveling contact at one end thereof, and a fixed contact having a stationary contact at one end thereof, which can make and break contact with the traveling contact by a switching action of the moving contact, and a power source system connected to the fixed contact. In the switch, the fixed contact includes a first conductor portion connected to the power source system, a second conductor portion having the stationary contact, and a third conductor portion vertically connecting the first conductor portion with the second conductor portion in case the traveling contact in a contact closing condition is upward opened from the stationary contact. Further, the third conductor portion is disposed on the side of the other end of the moving contact to which the traveling contact is not mounted with respect to a position of the stationary contract, and on the side opposed to the power source system. The first conductor portion is disposed above a contact surface of the contacts at a contact closing time, is disposed below a contact surface of the traveling contact at an opening time of the contacts, and is continuously positioned above one portion of the moving contact for a period from the contact closing time to the contact opening time. A position of the first conductor portion which can be surveyed from a surface of the traveling contact at an opening time of the contacts is coated with an insulator.

Consequently, in the switch according to the eighth aspect of the present invention, an arc is stretched in a direction of a terminal by entire current in conductors forming a fixed contact immediately after contact opening, and electromagnetic force is applied to a moving contact by a second conductor portion of the fixed contact and electromagnetic attraction is applied to the moving contact by the first conductor portion so as to open the moving contact at a high speed. Thereafter, force in a rotating direction is continuously applied to the fixed contact by the electromagnetic force since the fixed contact is partially positioned below the first conductor portion of the fixed contact until the maximum rotating time, resulting in the maximum rotation of the moving contact in a short time. As a result, arc voltage rapidly increases, and the arc is pressed onto the insulator covering the first conductor portion by strong electromagnetic force so as to be forcedly cooled. Therefore, it is possible to provide a switch having an excellent current-limiting performance, which can generate and maintain high arc voltage.

According to the ninth aspect of the present invention, there is provided a switch in which a fixed contact is provided in a substantially U-shaped form, a surface of a stationary contact secured to one end of the fixed contact makes and breaks contact with a traveling contact, and faces the side of the other end of the fixed contact, a slit is provided in the fixed contact so as not to prevent a switching action of the moving contact when the traveling contact makes and breaks contact with the stationary contact, one end of the slit is positioned on the side of the other end of the fixed contact, and the other end of the slit is positioned closer to the stationary contact of the fixed contact than a U-shaped bottom portion of the fixed contact.

Consequently, in the switch according to the ninth aspect of the present invention, an arc immediately after contact opening is stretched in a direction of a terminal so as to open a moving contact at a high speed, and a high arc voltage is generated and maintained. A slit is provided so as to reduce induced voltage which is induced around the slit of a fixed contact by time-varying current in the moving contact. Therefore, the induced current around the slit is reduced so that current in conductor portions of the both sides of the slit of the fixed contact are balanced, resulting in reduced unbalance on electromagnetic force applied to the moving contact or the arc.

According to the tenth aspect of the present invention, there is provided a switch in which a first conductor portion is disposed above a contact surface of contacts at a contact closing time, and is disposed below a contact surface of a traveling contact in a contact opening time, a position of the first conductor portion which can be surveyed from a contact surface of the traveling contact at the contact opening time is coated with an insulator, arc-extinguishing side plates are disposed on both sides of a plane including a locus of the traveling contact at a time of switching the moving contact, and at least one of the arc-extinguishing side plates is disposed between the plane and a portion of the first conductor portion corresponding to the plane.

Consequently, in the switch according to the tenth aspect of the present invention, an arc forming between contacts is prevented by the arc-extinguishing side plates on both sides from laterally extending so as to protect a portion of the first conductor portion opposed to the arc. Further, the arc is prevented, by electromagnetic force generated by entire current in conductor portions forming the fixed contact, from extending in a direction opposed to the side of a power source system with respect to a stationary contact in a direction perpendicular to the lateral direction for an initial period of opening. As a result, the arc naturally extends in a direction of the power source system so that arc voltage rapidly increases. When the moving contact is completely opened, hot gas of the arc is ejected from the traveling contact, and is forcedly cooled by colliding with an insulated position of the first conductor portion which can be surveyed from a contact surface. Therefore, it is possible to generate and maintain high arc voltage.

According to the eleventh aspect of the present invention, there is provided a switch in which a traveling contact never extends above an arc-extinguishing side plate in an opening condition of a moving contact.

Consequently, in the switch according to the eleventh aspect of the present invention, the arc is not narrowed by the arc-extinguishing side plate after the traveling contact upward moves above the first conductor portion for a later period of cutoff. Therefore, no gas is discharged by the arc from the arc-extinguishing side plate so as to reduce a rise of pressure.

According to the twelfth aspect of the present invention, there is provided a switch in which a contact surface of a stationary contact contacting a traveling contact is disposed below a terminal, a third conductor portion is disposed on the side of the other end of a moving contact to which the traveling contact is not mounted with respect to the stationary contact and on the side opposed to the terminal, a first conductor portion is disposed above the contact surface of contacts at a time of contact closing condition, a position of the first conductor portion which can be surveyed from a surface of the traveling contact at a time of contact opening condition is coated with an insulator, and an arc-extinguishing plate is disposed below the first conductor portion.

Consequently, in the switch according to the twelfth aspect of the present invention, an arc immediately after contact opening is stretched in a direction of the terminal by entire current in conductors forming the fixed contact, and thereafter the arc is pressed onto the insulator covering the first conductor portion so as to generate and maintain high arc voltage. The arc is stretched by a strong magnetic field generated by the fixed contact in the direction of the terminal immediately after the contact opening. Therefore, the arc is cooled by momentarily contacting the arc-extinguishing plate below the first conductor portion, resulting in an improved current-limiting performance.

According to the thirteenth aspect of the present invention, there is provided a switch in which a first conductor portion is disposed above a stationary contact, and is disposed below a contact surface of a traveling contact in an opening condition of a moving contact, a position of the first conductor portion which can be surveyed from a contact surface of the traveling contact in the opening condition is coated with an insulator, one or more magnetic material plates are disposed above the first conductor portion so as to be substantially parallel to the first conductor portion, and a notched space is provided in the magnetic material plate so as to allow a switching action of the moving contact.

Consequently, in the switch according to the thirteenth aspect of the present invention, the entire current in a fixed contact generates electromagnetic force in a direction of a power source system in a space below the first conductor portion of the fixed contact immediately after opening. Therefore, an arc is strongly stretched so as to rapidly rise the arc voltage. A magnetic material plate can absorb an inverse magnetic field which is generated by current in the fixed contact in a space above the first conductor portion. Hence, the inverse magnetic field is not applied to the arc above the first conductor portion in an opening condition of the moving contact. As a result, the arc can extend in the direction of the power source system so as to further increase and maintain arc voltage for an initial period of opening.

According to the fourteenth aspect of the present invention, there is provided a switch in which a contact surface of a stationary contact contacting a traveling contact is disposed below a terminal, a third conductor portion is disposed on the side of the other end of a moving contact to which the traveling contact is not mounted with respect to the stationary contact and on the side opposed to the terminal, a first conductor portion is disposed above a contact surface of contacts at a contact closing time, and is disposed below the contact surface of the contacts at the contact opening time, a position of the first conductor portion which can be surveyed from a surface of the traveling contact at a contact opening time is coated with an insulator, an arc-extinguishing plate is disposed so as not to prevent rotation of the moving contact, and one of the arc-extinguishing plates is in a surface contact with at least one of insulators covering upper and lower portions of the first conductor portion.

Consequently, in the switch according to the fourteenth aspect of the present invention, one of the arc-extinguishing plates is in the surface contact with at least one of the insulators covering the upper and lower portions of the first conductor portion. It is thereby possible to prevent pressure in the switch from abnormally increasing due to gas generated by the arc contacting the insulator covering the first conductor portion after the traveling contact is positioned above the first conductor portion by rotation of the moving contact. Further, it is also possible to concurrently protect the insulator, and efficiently increase the number of the arc-extinguishing plates disposed above the first conductor portion.

According to the fifteenth aspect of the present invention, there is provided a switch in which an arc runner is provided for a second conductor portion to which a stationary contact is secured.

Consequently, in the switch according to the fifteenth aspect of the present invention, since the arc runner is provided for the second conductor portion, an arc spot on a contact at a contact opening time can be quickly transferred to the arc runner so as to reduce damage to the stationary contact by the arc, and so as to immediately cool the arc.

According to the sixteenth aspect of the present invention, there is provided a switch including an arc runner electrically contacting a first conductor portion.

Consequently, in the switch according to the sixteenth aspect of the present invention, since the arc runner is provided to electrically contact the first conductor portion, the arc for a later period of cutoff can be transferred to the arc runner so that the arc can easily contact the arc-extinguishing plate, and so that it is possible to protect the insulator.

According to the seventeenth aspect of the present invention, there is provided a switch including an electrode which is provided on an insulator covering a first conductor portion, and is insulated from a fixed contact.

Consequently, in the switch according to the seventeenth aspect of the present invention, since the electrode is provided on the insulator covering the first conductor portion, and is insulated from the fixed contact, the arc is cooled by the electrode when a traveling contact surface is rotated up to a position above the first conductor portion, and so that it is possible to reduce rise of internal pressure period of cutoff for later so as to prevent a crack of a housing. Further, an arc spot on the side of the fixed contact can be maintained to the very end so as to extend an arc length.

According to the eighteenth aspect of the present invention, there is provided a switch including a moving element having a traveling contact at one end thereof, and a repelling element substantially parallel to the moving element, having a repelling contact at one end thereof, which can make and break contact with the traveling contact. A conductor connecting the repelling element to the side of a power source system, includes a first conductor portion which is positioned between the traveling contact and the repelling contact when the moving element and the repelling element are opened so as to be connected to the side of the power source system, and a second conductor portion connecting the first conductor portion to the repelling element at an end on the side opposed to the repelling contact.

Consequently, in the switch according to the eighteenth aspect of the present invention, current in the moving element and the repelling element generate electromagnetic repulsion at a time of short-circuit current cutoff. In addition to the electromagnetic repulsion, current in the first conductor portion connecting the repelling element to the power source system generates another electromagnetic repulsion to open the repelling element. The electromagnetic repulsion is applied to the repelling element which opens when predetermined force or more are applied to the repelling element in an opening direction. As a result, it is possible to provide a very quick opening speed, and an excellent current-limiting performance.

According to the nineteenth aspect of the present invention, there is provided a switch in which a first conductor portion is positioned above surfaces of a traveling contact and a repelling contact when a moving element and a repelling element are closed.

Consequently, in the switch according to the nineteenth aspect of the present invention, in case a repelling element is in a closing condition, a moving element paired with the repelling element is opened, and an arc forms between contacts at a time of small current cutoff, current in a first conductor connected to the repelling element and a second conductor portion also generate electromagnetic force which is applied to the arc on a repelling contact of the repelling element. As a result, it is possible to stretch the arc in an appropriate direction, and provide excellent current-limiting performance and small current cutoff performance.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 13(*b*) is a perspective view of the fixed contact of FIG. 13(*a*) in an insulated condition;

FIG. 15(*b*) is a sectional view taken along line 15*b*—15*b* of FIG. 15(*a*);

FIG. 15(*c*) is a graph diagram showing the intensity distribution of the magnetic field which is generated by the current in the fixed contact on Z-axis of FIG. 15(*b*);

FIG. 17(*b*) is a perspective view of the fixed contact of FIG. 17(*a*) in an insulated condition;

FIG. 18(*b*) is a side view of the electrode portion of a circuit breaker showing the maximum opening condition of the contact of FIG. 18;

FIG. 28(*b*) is a side view of the electrode portion of a circuit breaker showing the maximum opening condition of FIG. 28(*a*);

FIG. 34(*b*) is a side view of FIG. 34(*a*);

FIG. 38(*b*) is a side view of FIG. 38(*a*);

FIG. 39(*b*) is a sectional view taken along line 39*b*—39*b* of FIG. 39(*a*);

FIG. 40(*b*) is a graph diagram showing a relationship between angle θ shown in FIG. 40(*a*) and magnetic field By in a direction of y;

FIG. 40(*c*) is a graph diagram which is obtained by transforming a transverse axis of FIG. 40(*b*) into a length of Z-axis by using a relation of $z=a\cdot\tan\theta$;

FIG. 41(*b*) is a sectional view taken along line 41*b*—41*b* of FIG. 41(*a*);

FIG. 44(*a*) is a side view of the fixed contact of FIG. 43;

FIG. 44(*b*) is a sectional view taken along line 44*b*—44*b* of FIG. 44(*a*);

FIG. 44(*c*) is a sectional view taken along line 44*c*—44*c* of FIG. 44(*a*);

FIG. 45(*a*) is a perspective view of a fixed contact according to the embodiment 25;

FIG. 45(*b*) is a perspective view of the fixed contact of FIG. 45(*a*) in an insulated condition;

FIG. 53(*b*) is a sectional view taken along line 53*b*—53*b* of FIG. 53(*a*);

FIG. 53(*c*) is a graph diagram showing the intensity distribution of the magnetic field which is generated by the current in the fixed contact on Z-axis of FIG. 53(*b*);

FIG. 55(*b*) is a perspective view of the fixed contact of FIG. 55(*a*) in an insulated condition;

FIG. 56(*b*) is a side view of the electrode portion of a circuit breaker, showing the maximum opening condition of the contact of the FIG. 56 (*a*);

FIG. 68(*b*) is a sectional view taken along line 68*b*—68*b* of FIG. 68(*a*);

FIG. 69(*a*) is a side view of a fixed contact according to the embodiment 40;

FIG. 69(*b*) is a sectional view taken along line 69*b*—69*b* of FIG. 69(*a*);

FIG. 70 is a perspective view of a fixed contact according to the embodiment 41;

FIG. 71 is a perspective view showing an alternative embodiment of the fixed contact of FIG. 70;

FIG. 72 is a perspective view of a fixed contact according to the embodiment 43;

FIG. 86(*b*) is a side view of FIG. 86(*a*);

FIG. 86(*c*) is a plan view of FIG. 86(*b*);

FIG. 94 is a perspective view showing the fixed contact of FIG. 93 with a moving contact in a closed condition;

FIG. 95 is a sectional view perpendicular to a slit surface S1 of the fixed contact of FIG. 94;

FIG. 96 is a plan view of FIG. 94;

FIG. 97 is a sectional view perpendicular to the slit surface S1 of FIG. 95;

FIG. 98 is a model diagram used for calculation to find magnitude of magnetic flux $\phi$ interlinked with the slit surface S1 of the fixed contact, and magnitude of induced current in a loop current path C in the embodiment 49;

FIG. 99 is a coordinate diagram showing a section of FIG. 98;

FIG. 100 is a perspective view showing the fixed contact of FIG. 88 without an insulation;

FIG. 101 is a calculation model diagram of FIG. 100;

FIG. 102 is a coordinate diagram showing a section of FIG. 101;

FIG. 103 is a side view showing a fixed contact according the embodiment 50 with a moving contact in a closing condition;

FIG. 104 is a side view showing a fixed contact according the embodiment 51 with a moving contact in an opening condition;

FIG. 105 is a side view of a circuit breaker, illustrating a comparison to the embodiment 51;

FIG. 106 is a side view of the circuit breaker, illustrating the operation of the embodiment 51;

FIG. 107 is a side view of an electrode portion of a circuit breaker according to the embodiment 52;

FIG. 108 is an explanatory view of the operation of FIG. 107;

Figure 109:
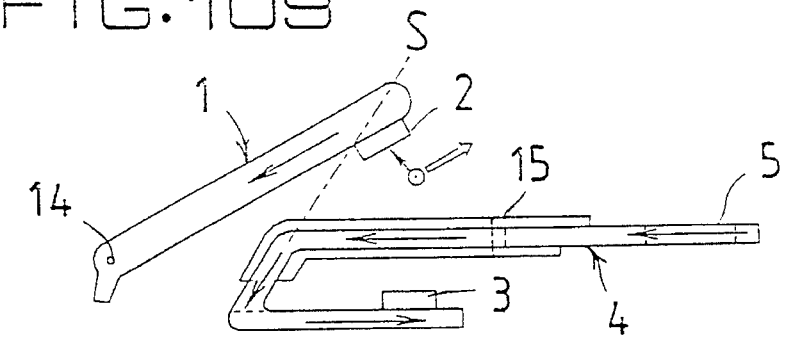
Figure 110:
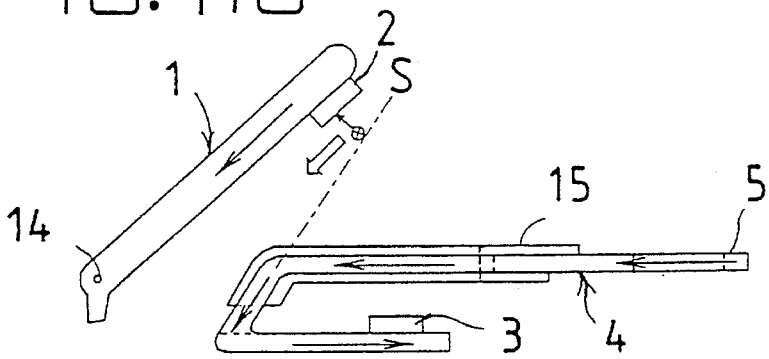
Figure 111:
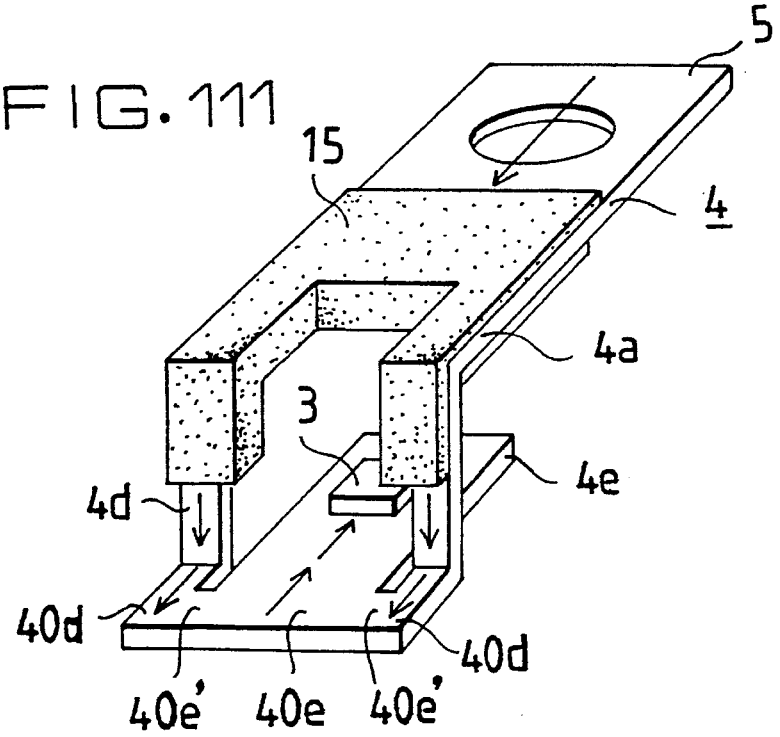
Figure 112:
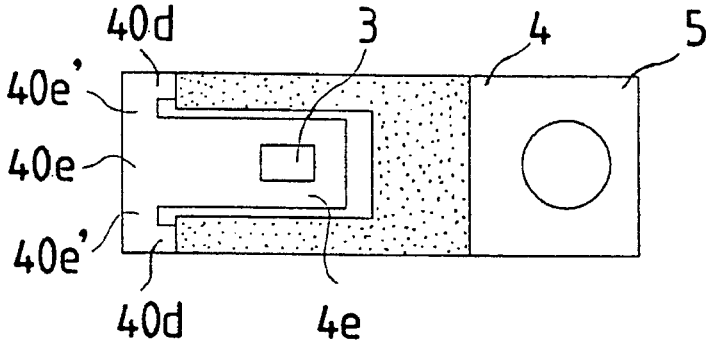
Figure 113:
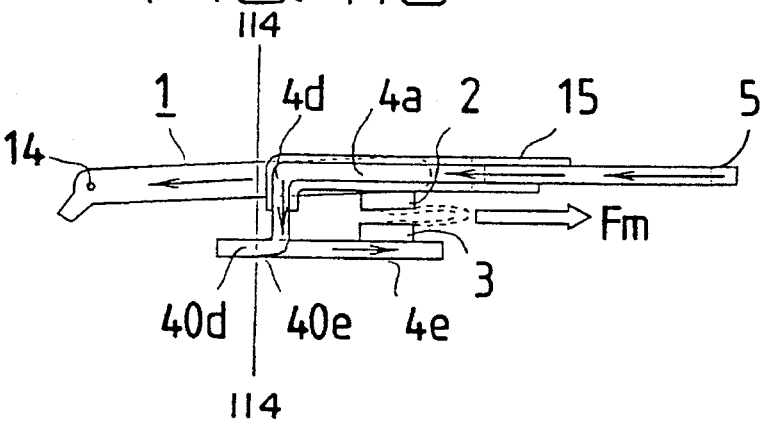
Figure 114:
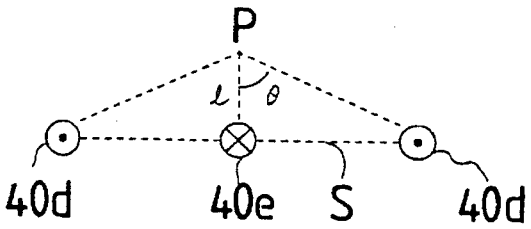
Figure 115:
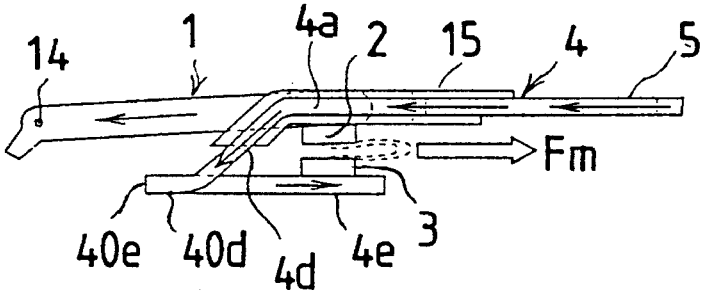
Figure 116:
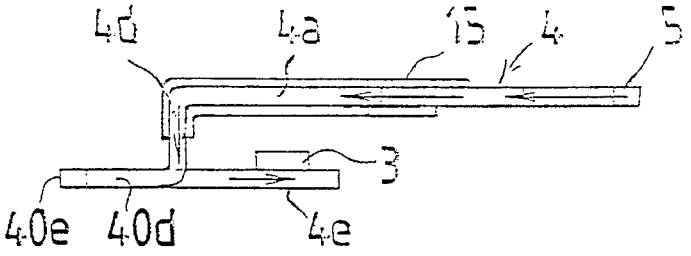
Figure 117:
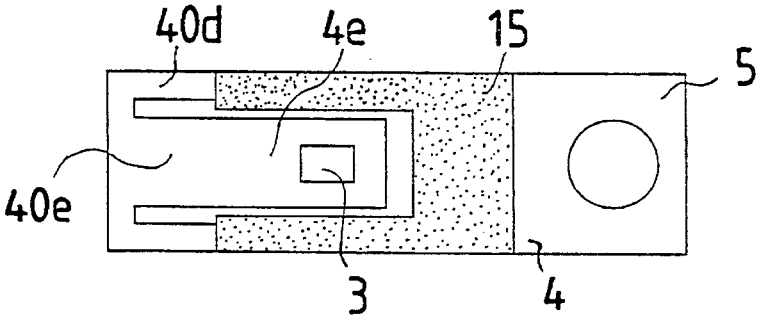
Figure 118:
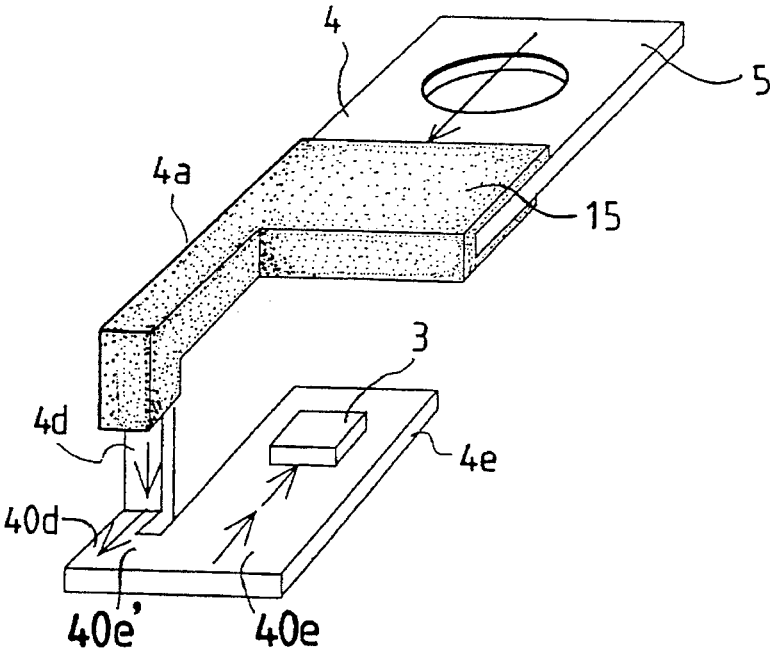
Figure 119:
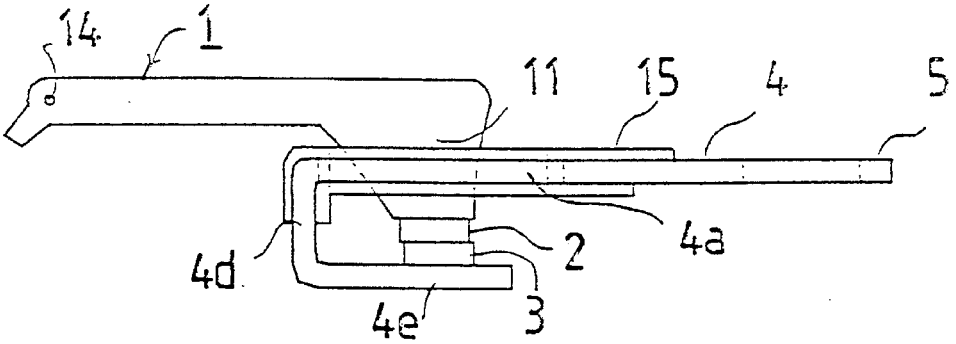
Figure 120:
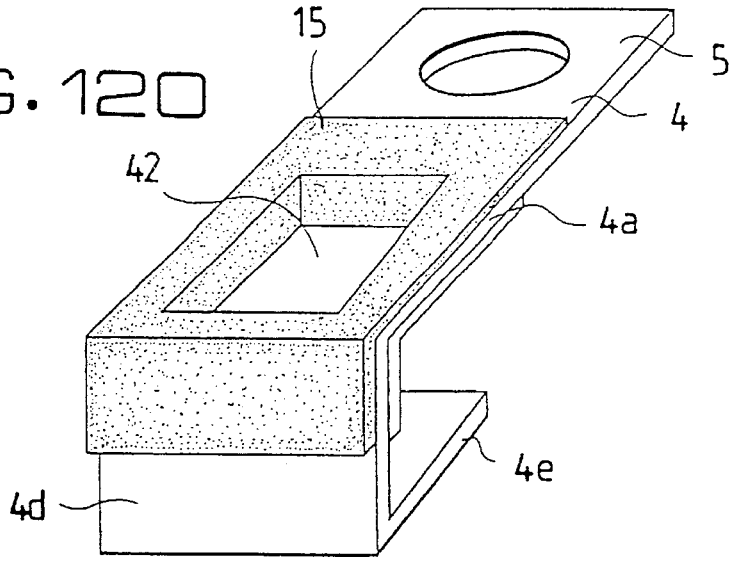
Figure 121:
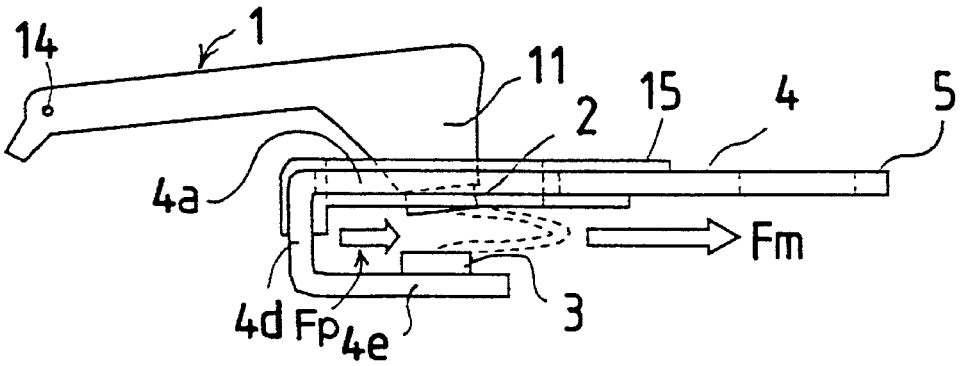
Figure 122:
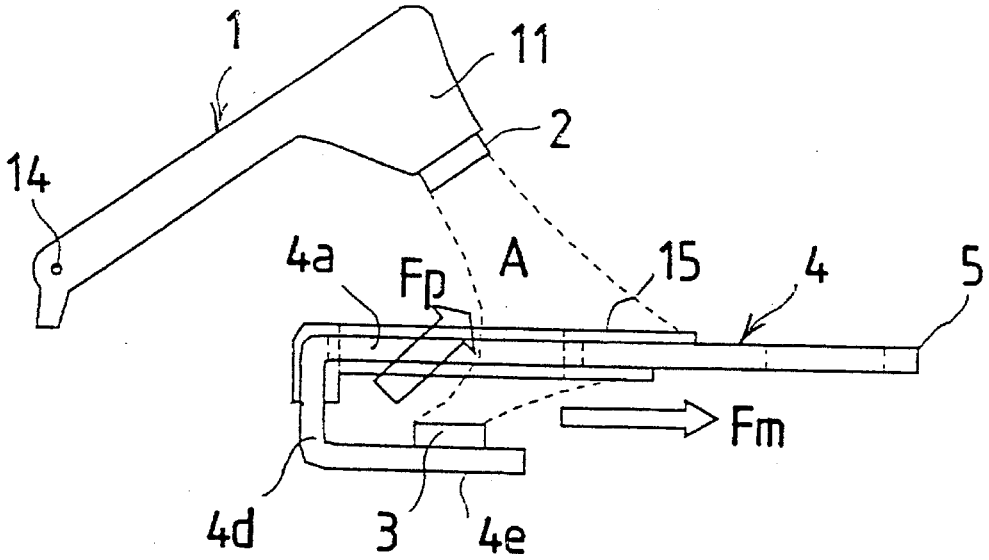
Figure 123:
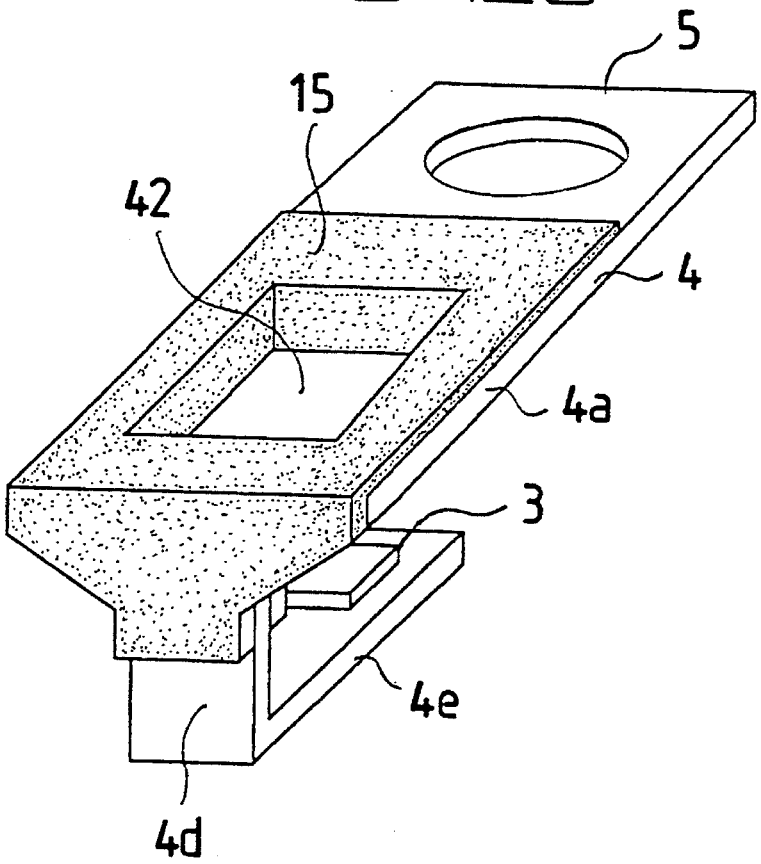
Figure 124:
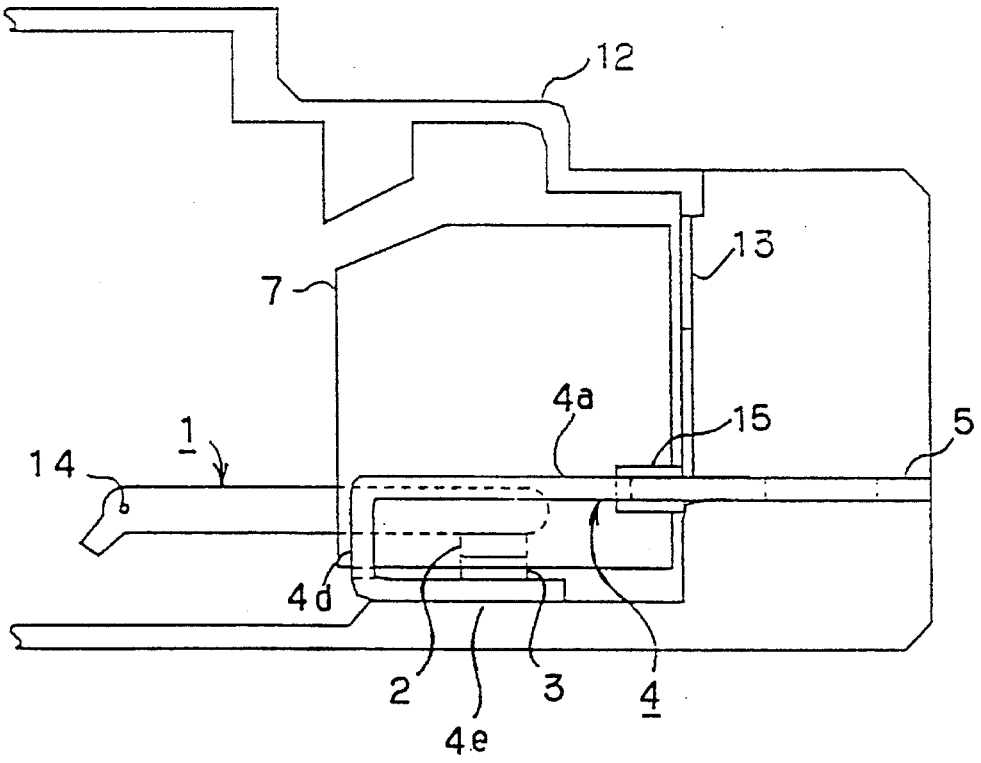
Figure 125:
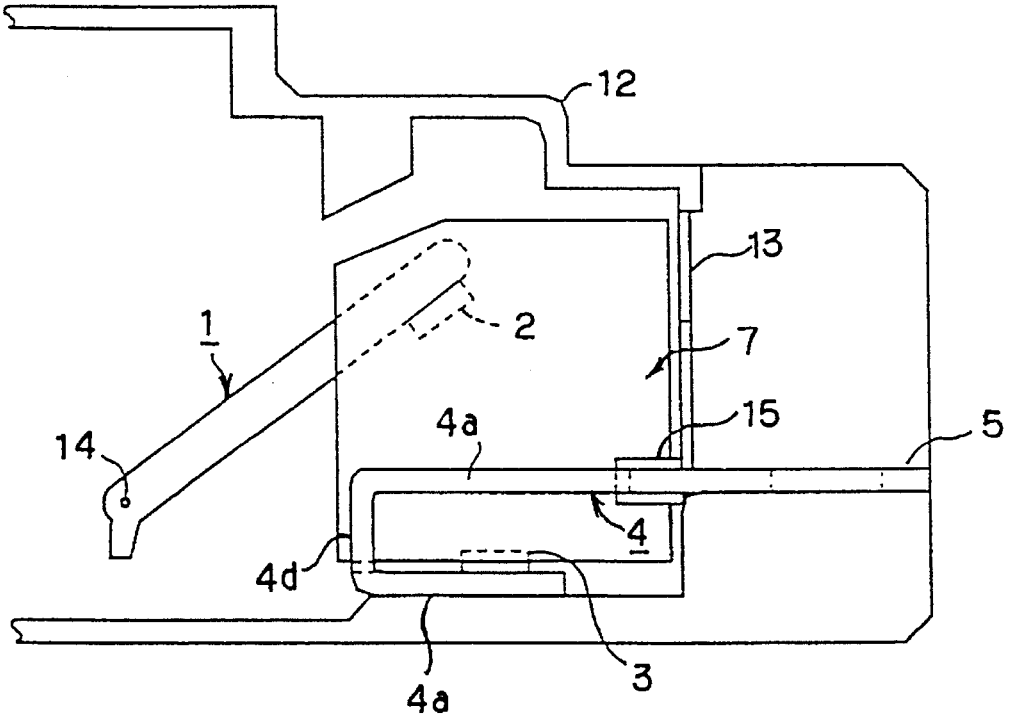
Figure 126:
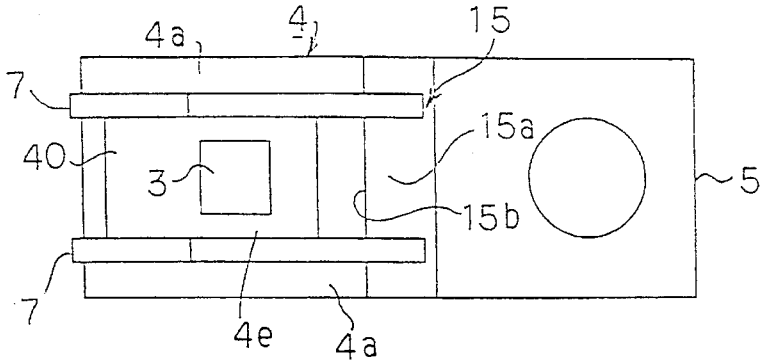
Figure 127:
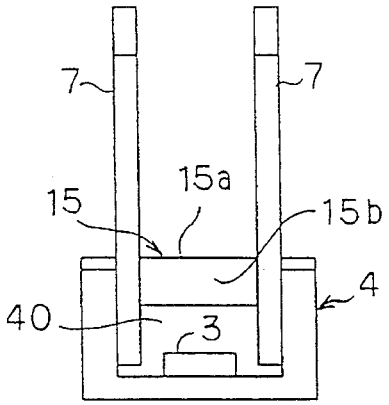
Figure 128:
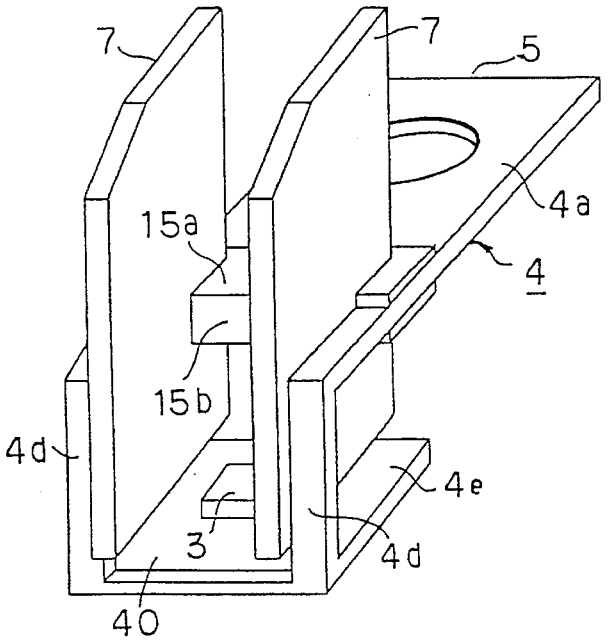
Figure 129:
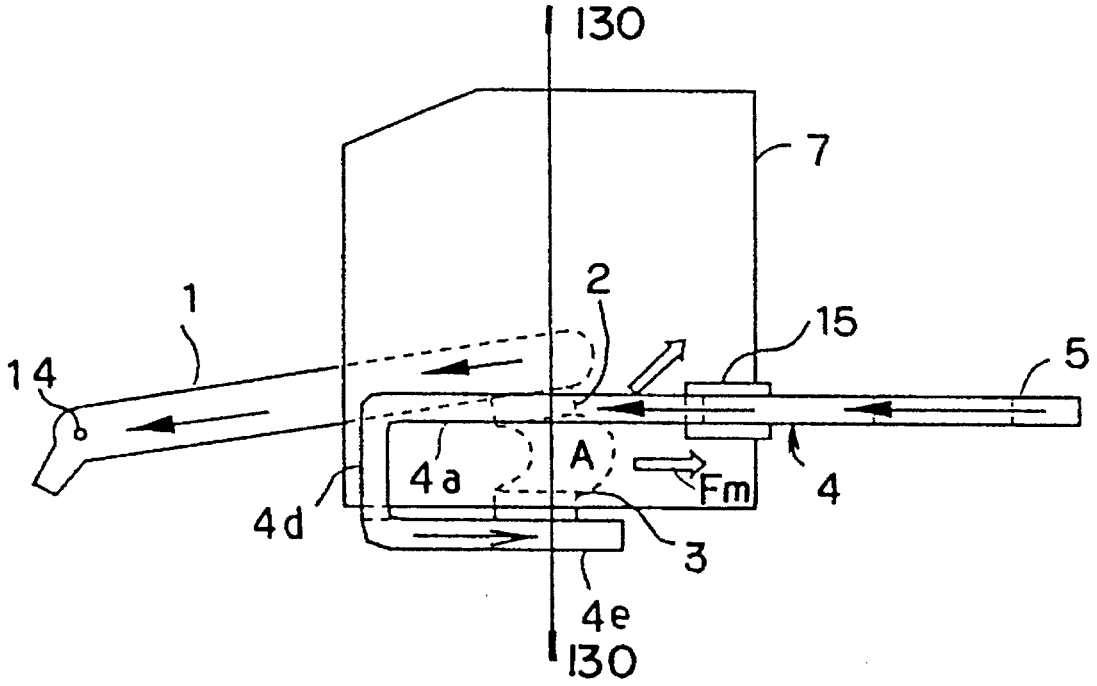
Figure 130:
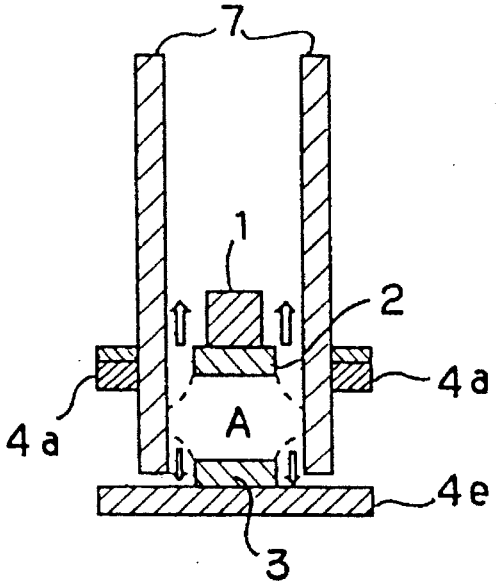
Figure 131:
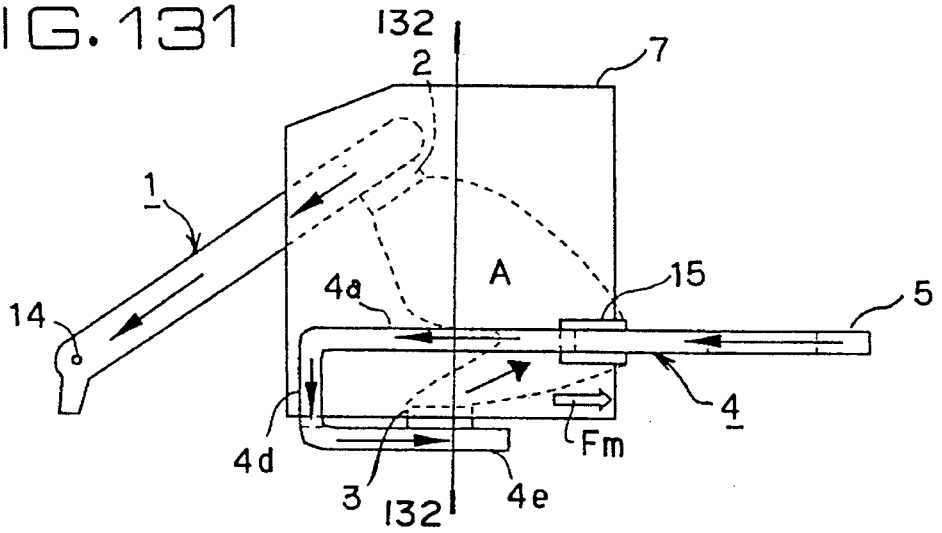
Figure 132:
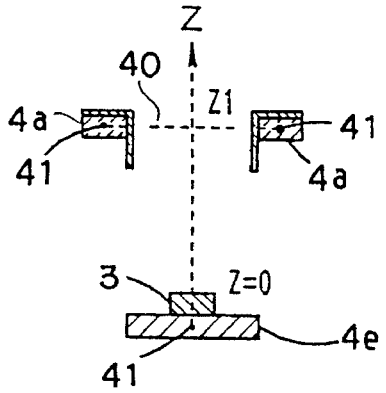
Figure 133:
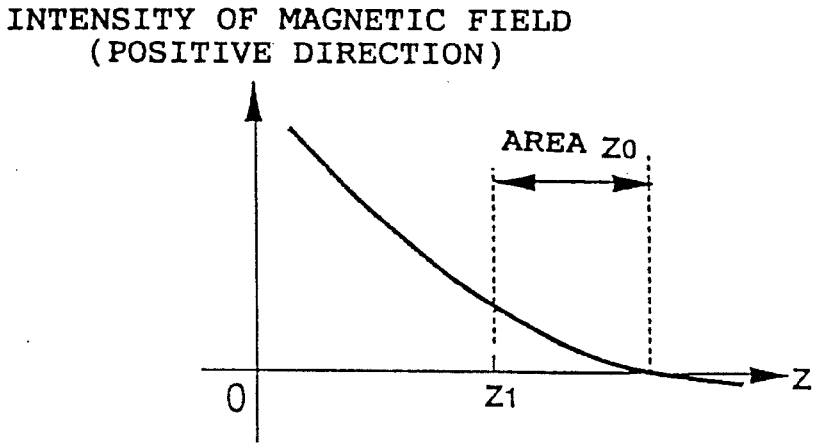
Figure 134:
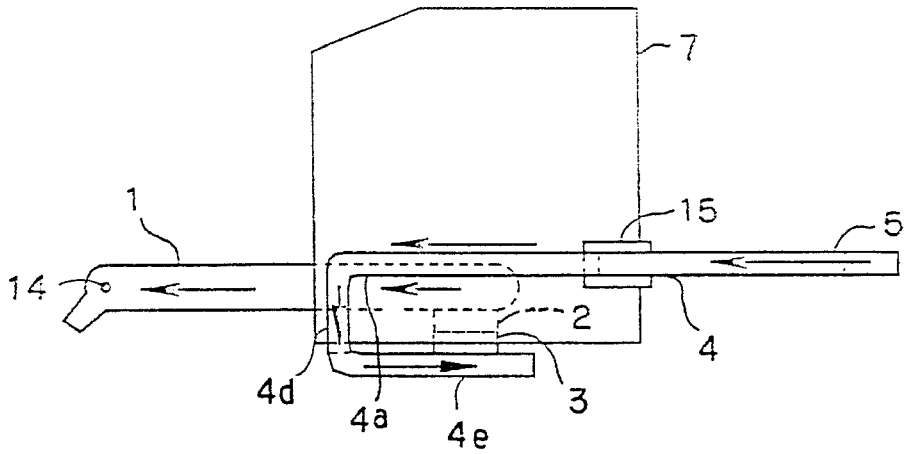
Figure 135A:
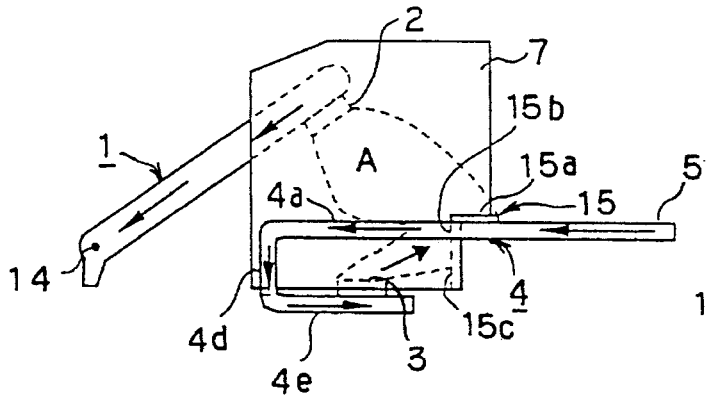
Figure 135B:
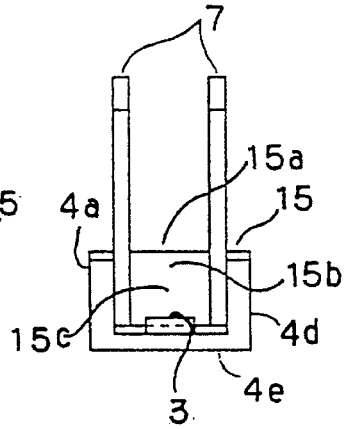
Figure 136:
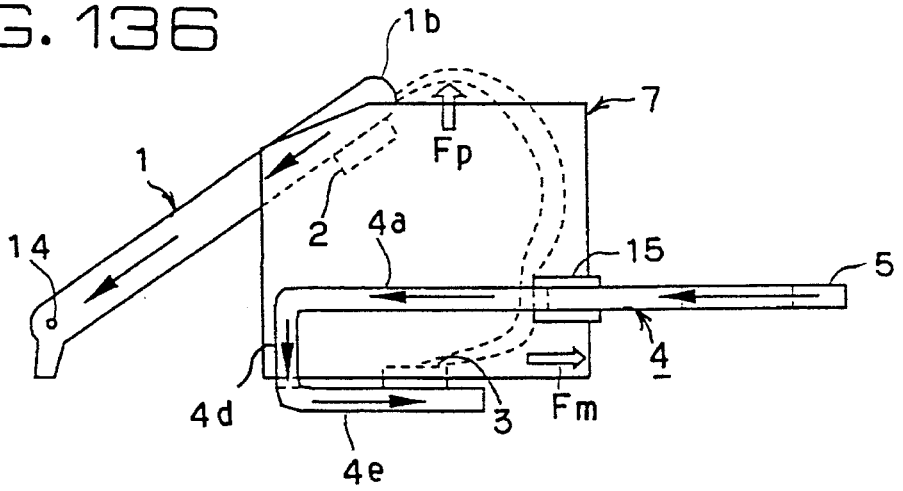
Figure 137:
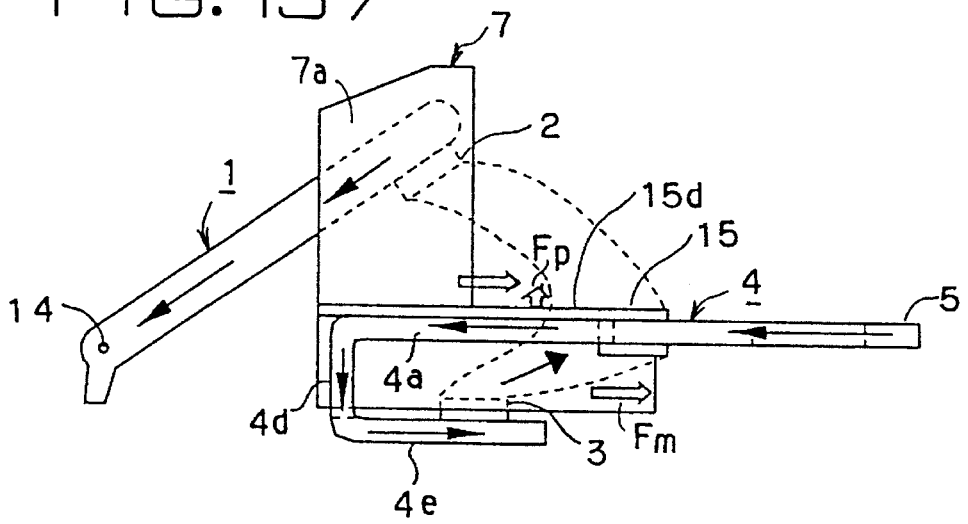
Figure 138A:
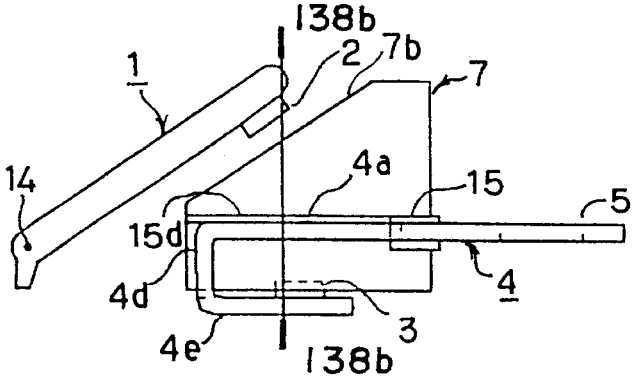
Figure 138B:
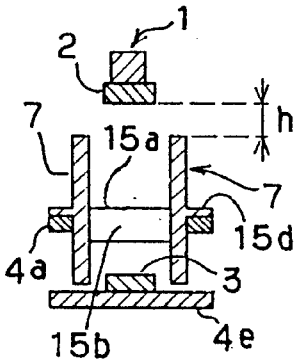
Figure 139:
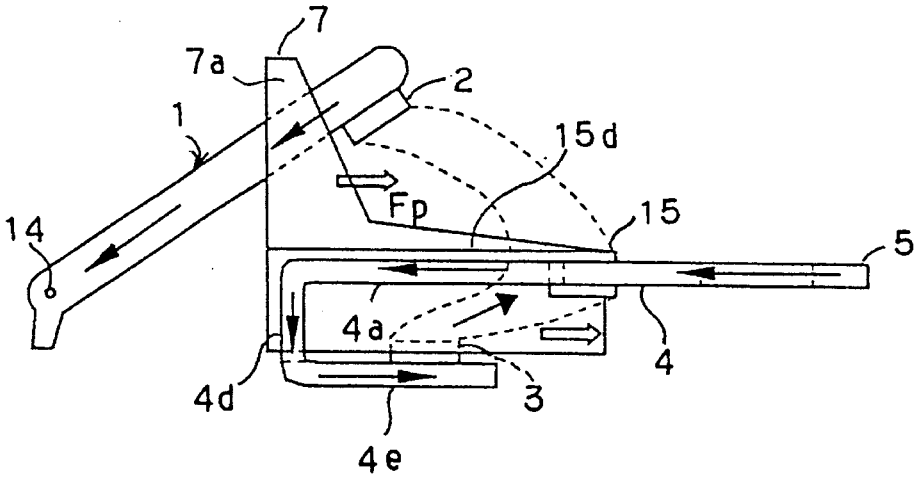
Figure 140:
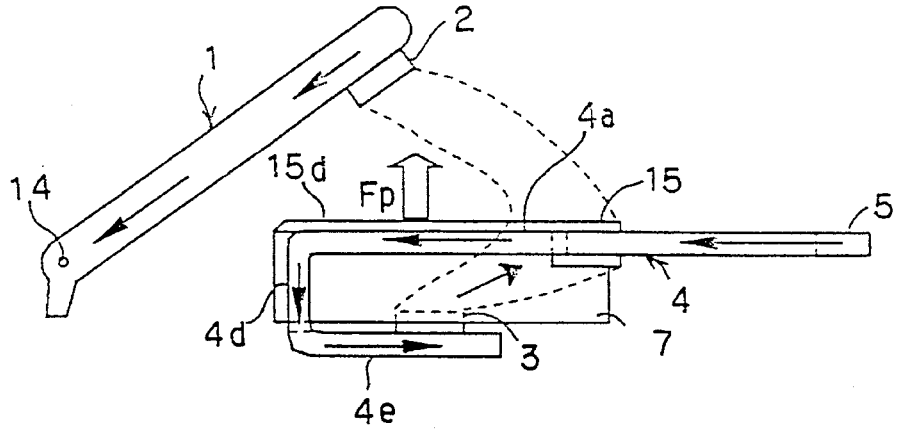
Figure 141:
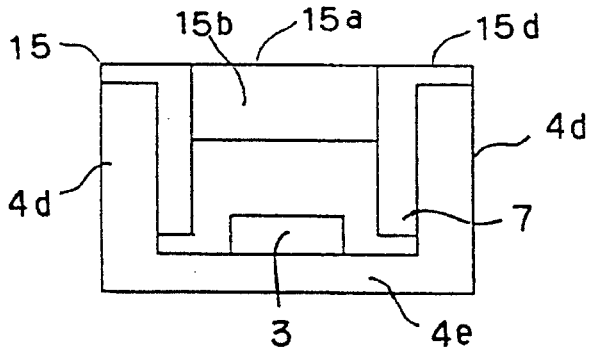
Figure 142:
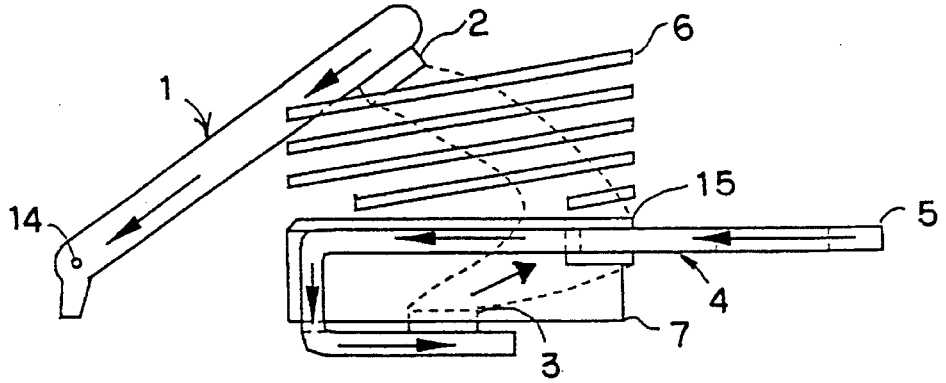
Figure 143:
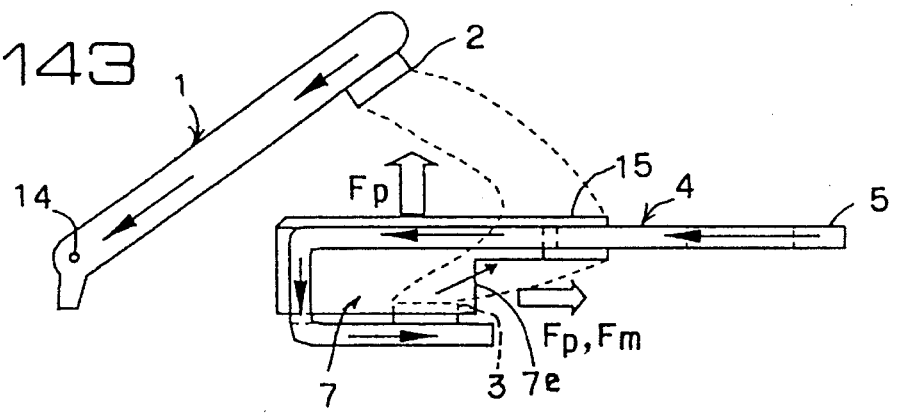
Figure 144:
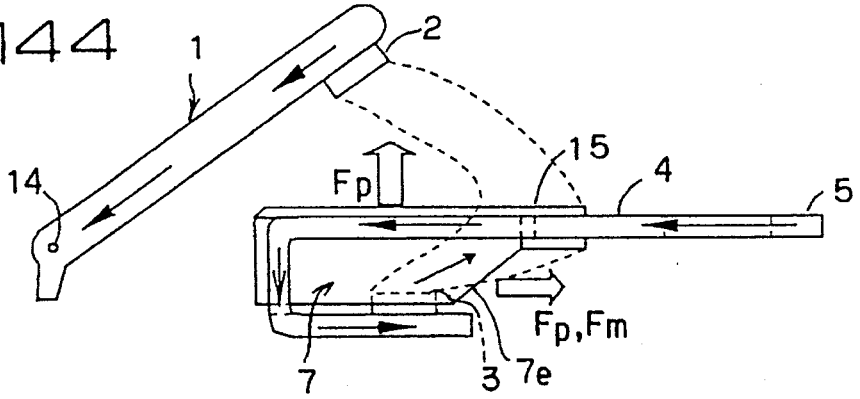
Figure 145A:
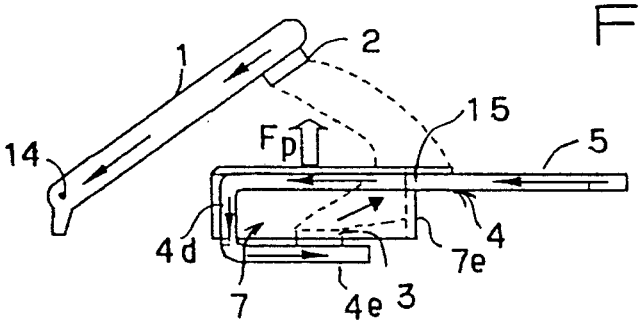
Figure 145B:
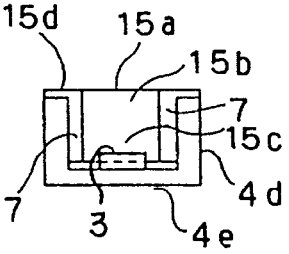
Figure 146A:
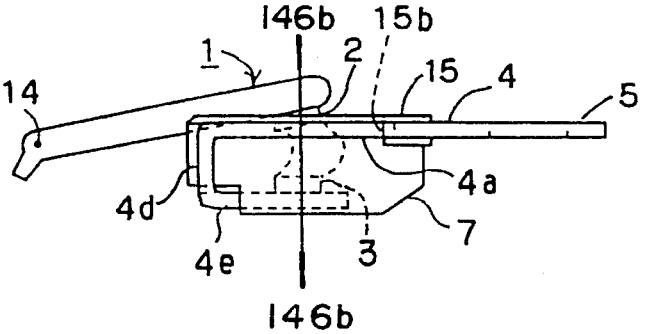
Figure 146B:
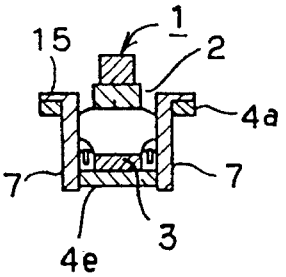
Figure 151:
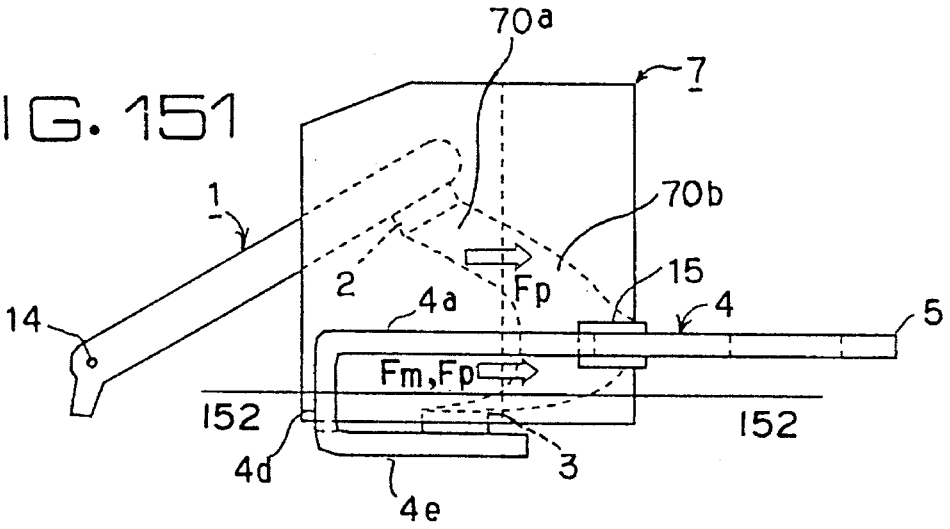
Figure 152:
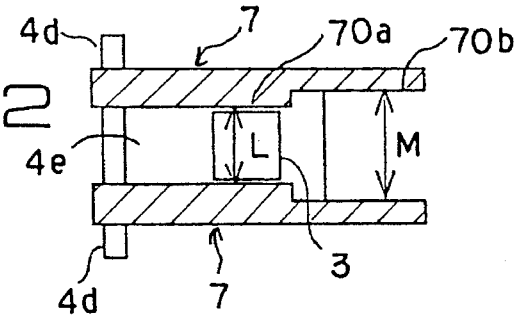
Figure 153:
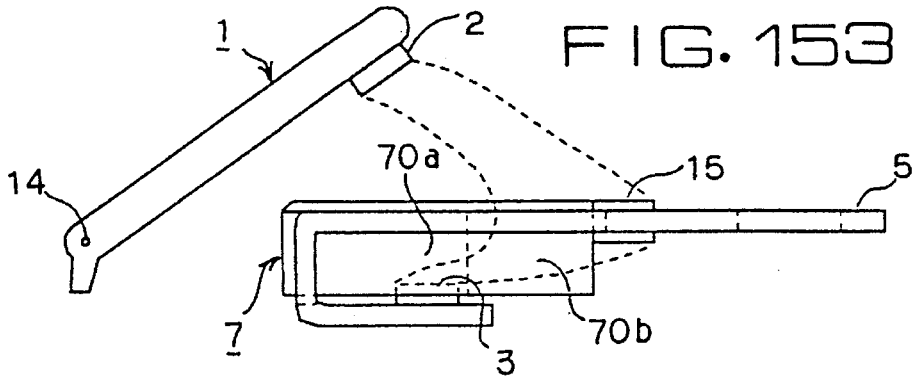
Figure 154:
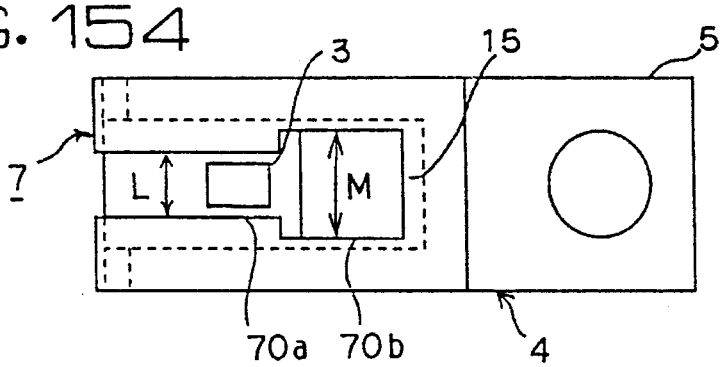
Figure 155:
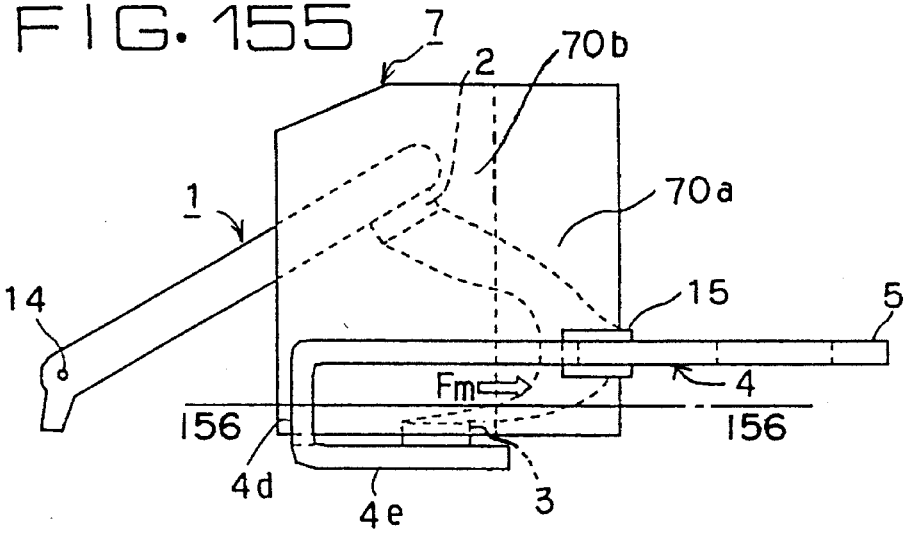
Figure 156:
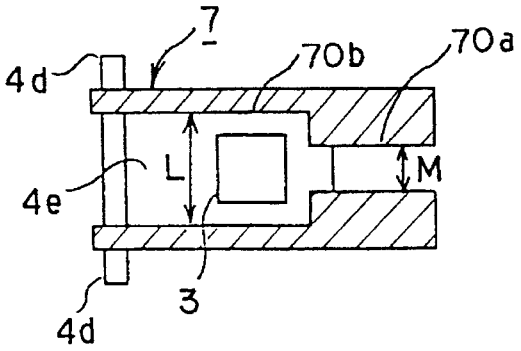
Figure 157:
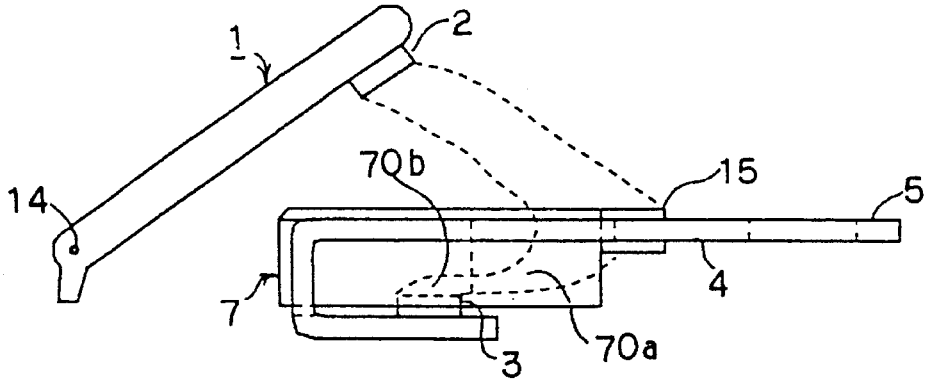
Figure 158:
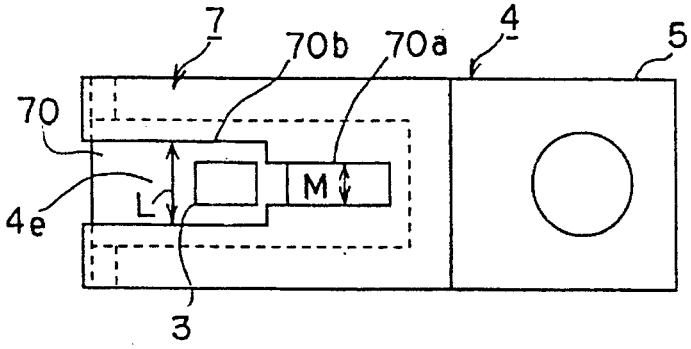
Figure 159:
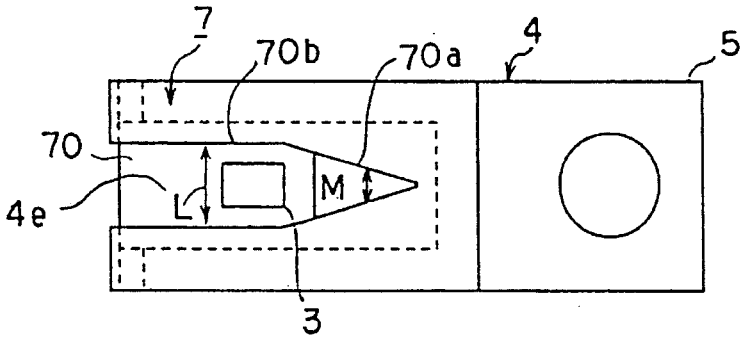
Figure 160:
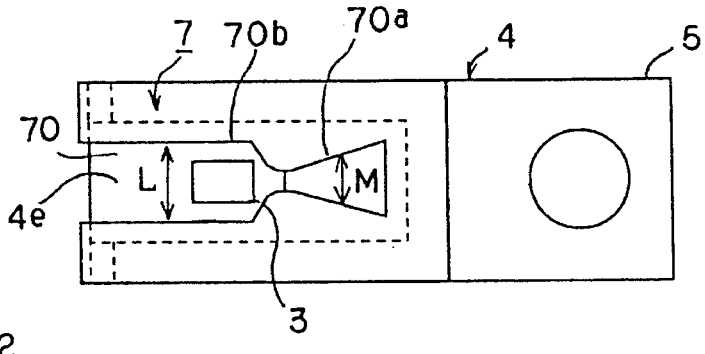
Figure 161A:
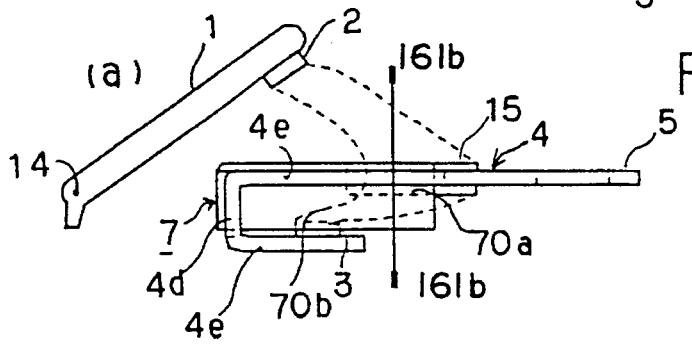
Figure 161B:
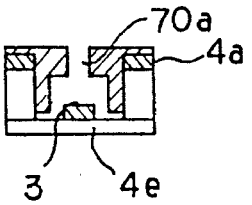
Figure 161C:
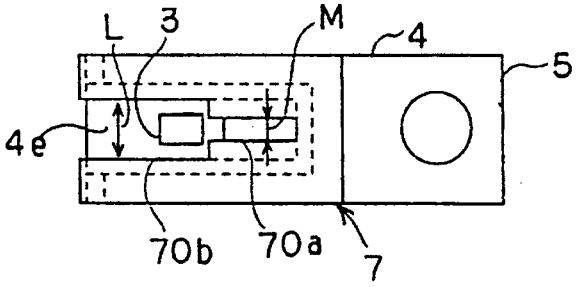
Figure 162:
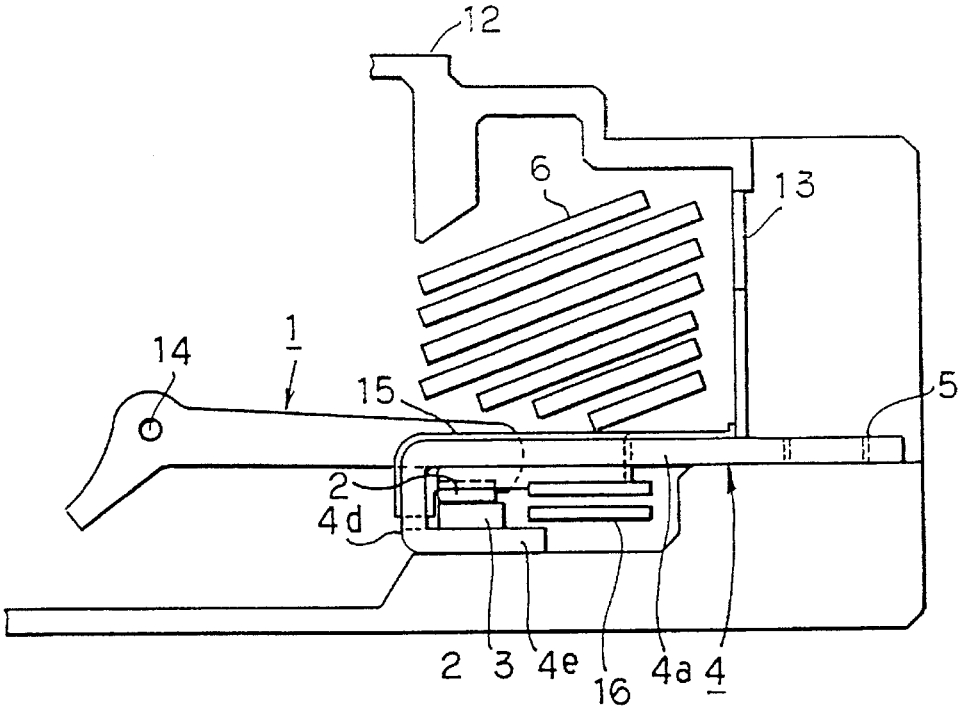
Figure 163:
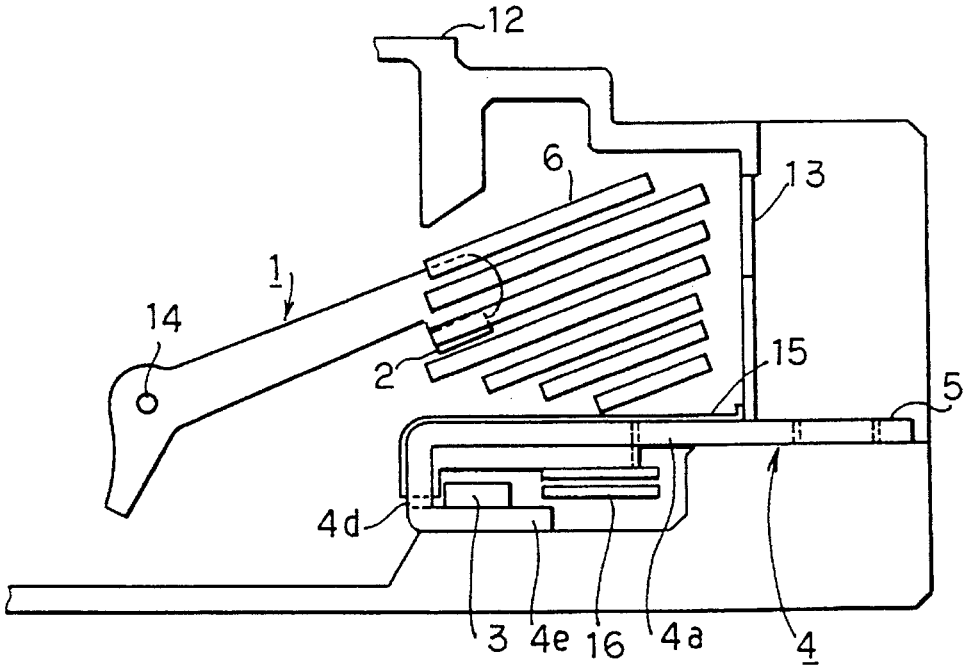
Figure 164A:
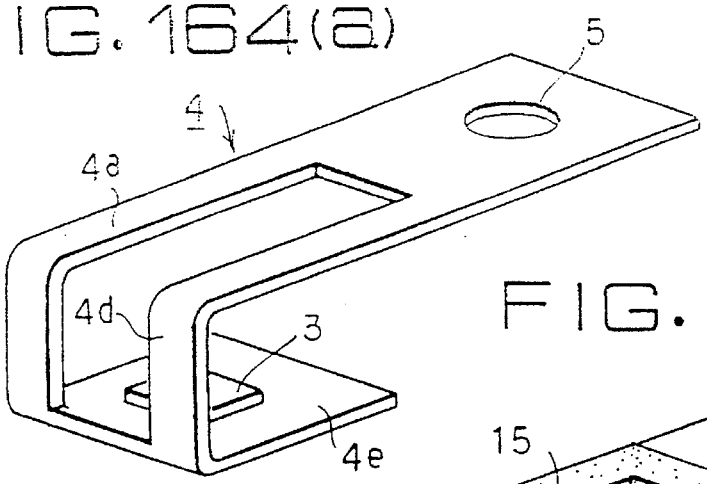
Figure 164B:
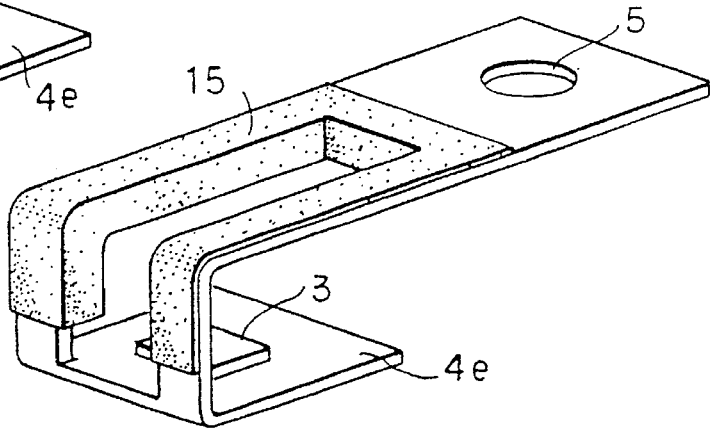
Figure 165:
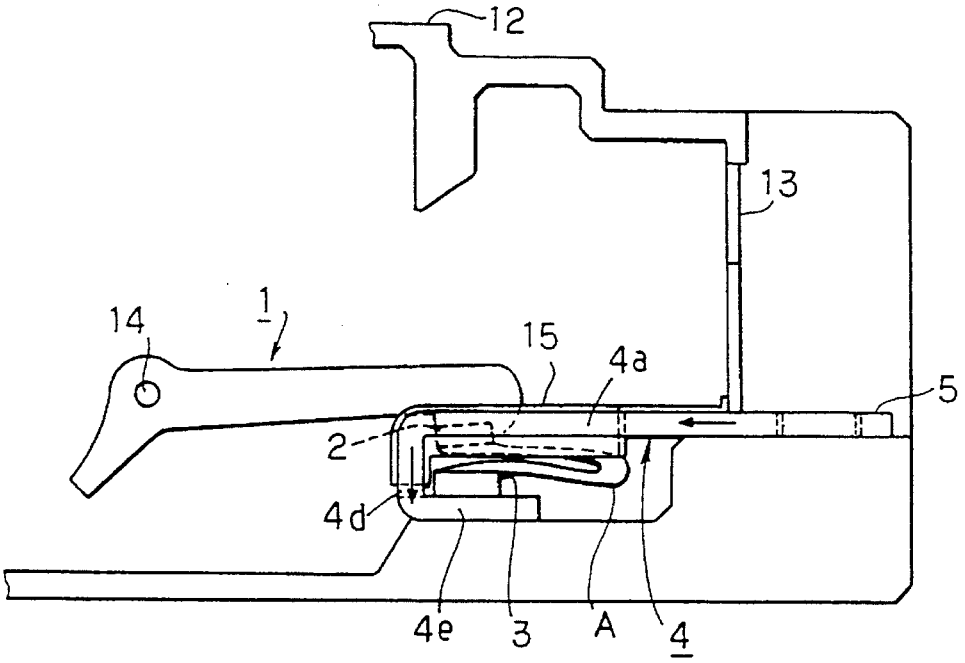
Figure 166:
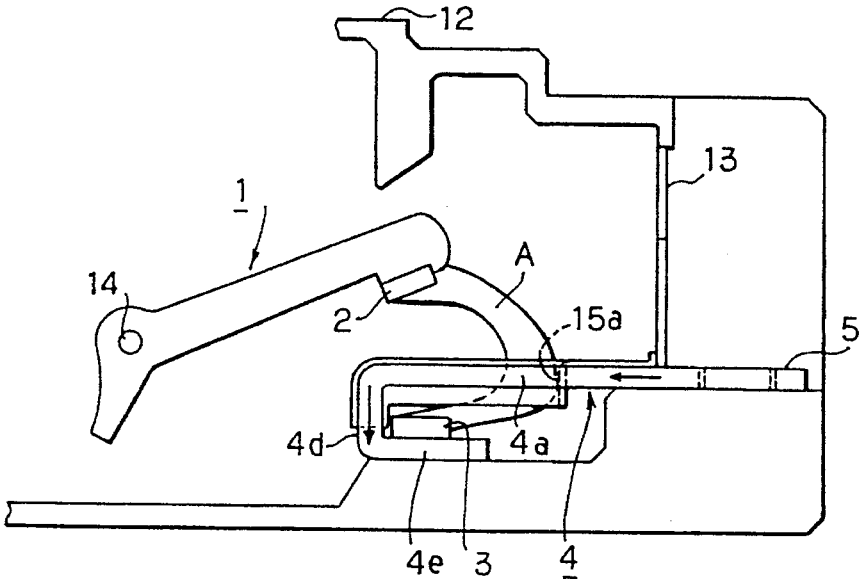
Figure 167A:
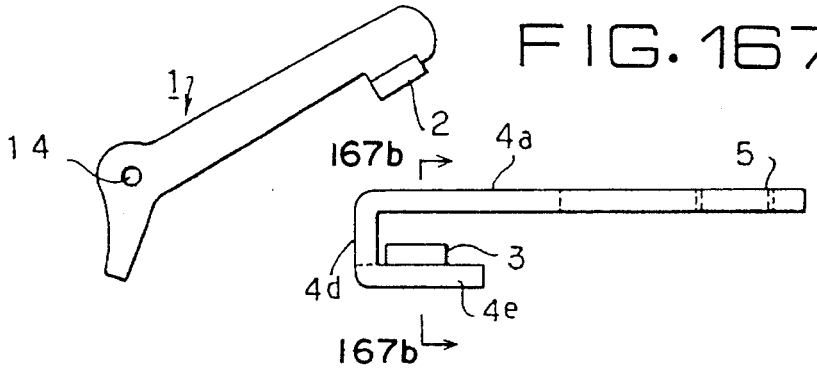
Figure 167B:
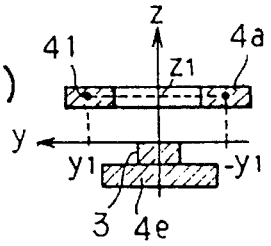
Figure 167C:
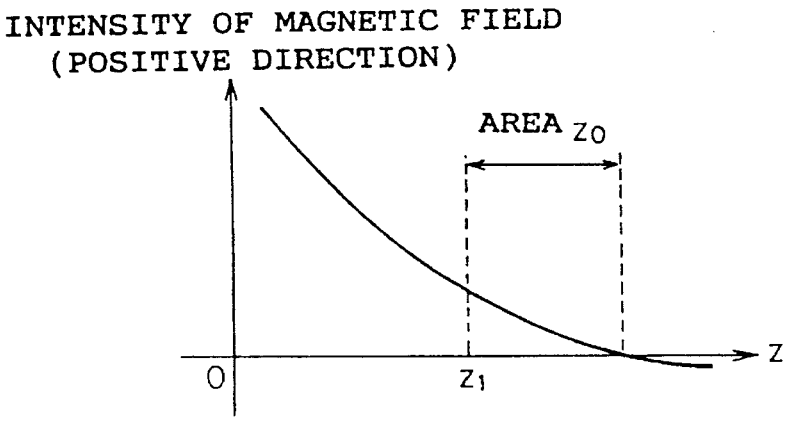
Figure 168:
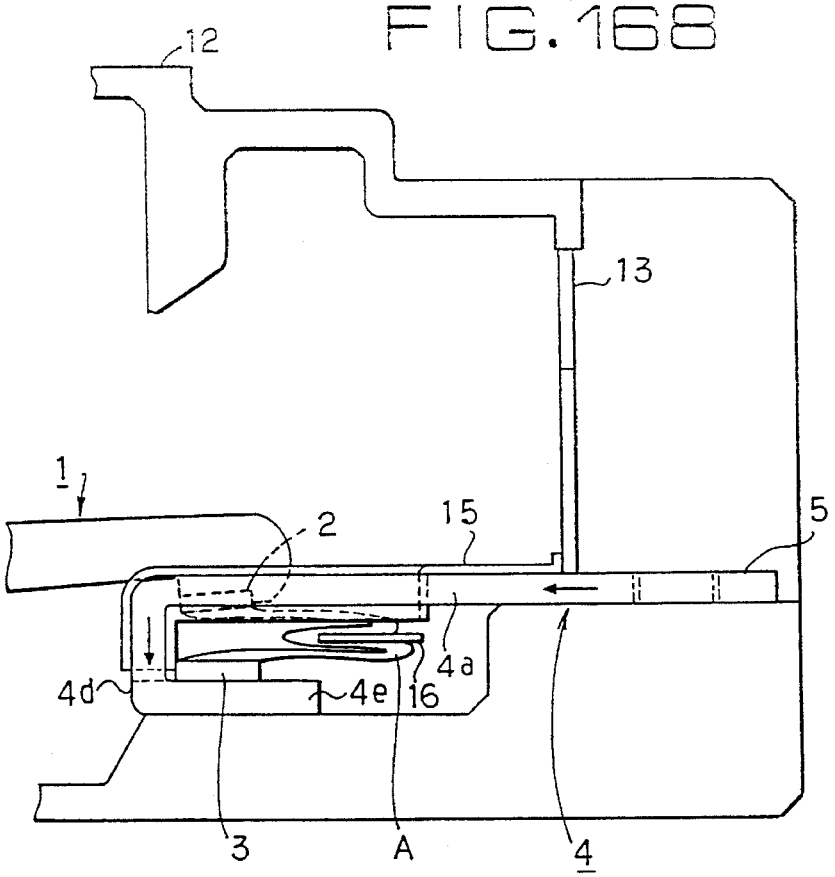
Figure 169:
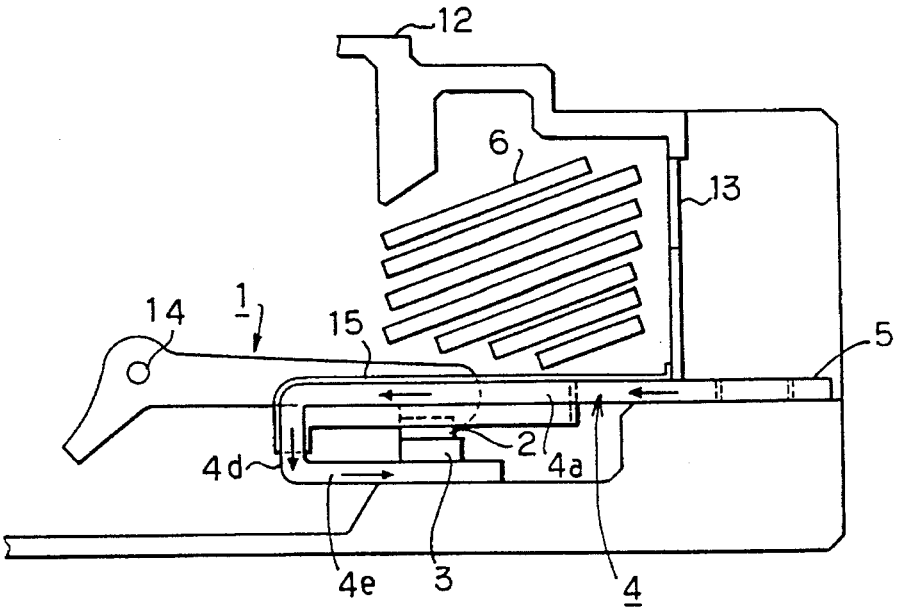
Figure 170A:
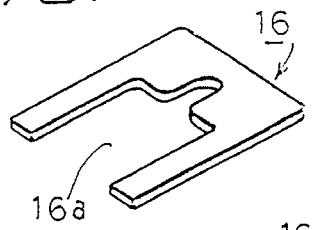
Figure 170B:
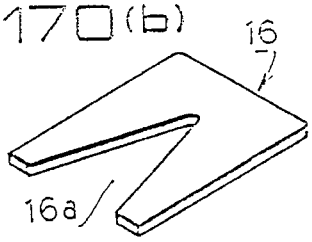
Figure 170C:
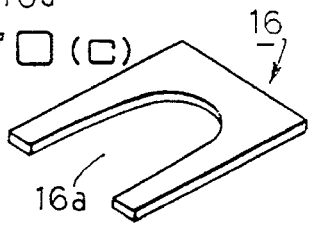
Figure 170D:
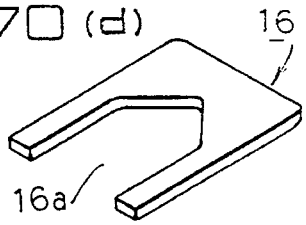
Figure 170E:
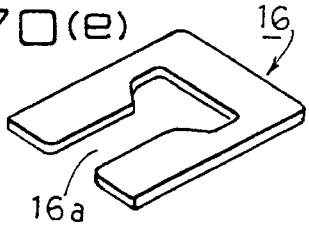
Figure 170F:
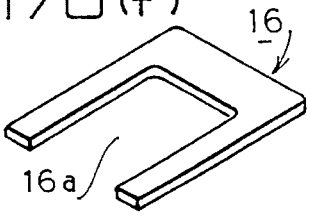
Figure 170G:
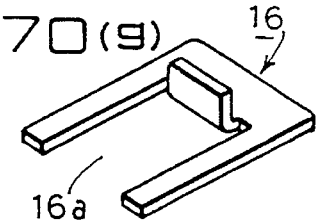
Figure 170H:
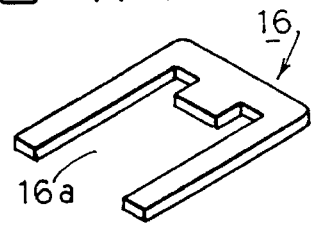
Figure 171A:
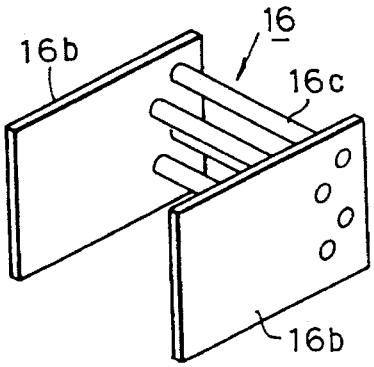
Figure 171B:
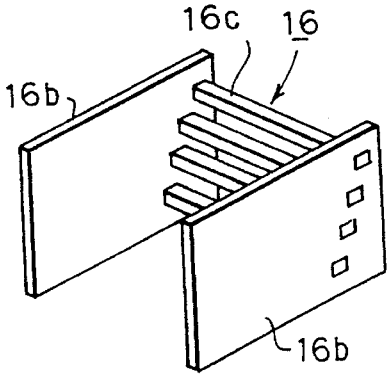
Figure 172:
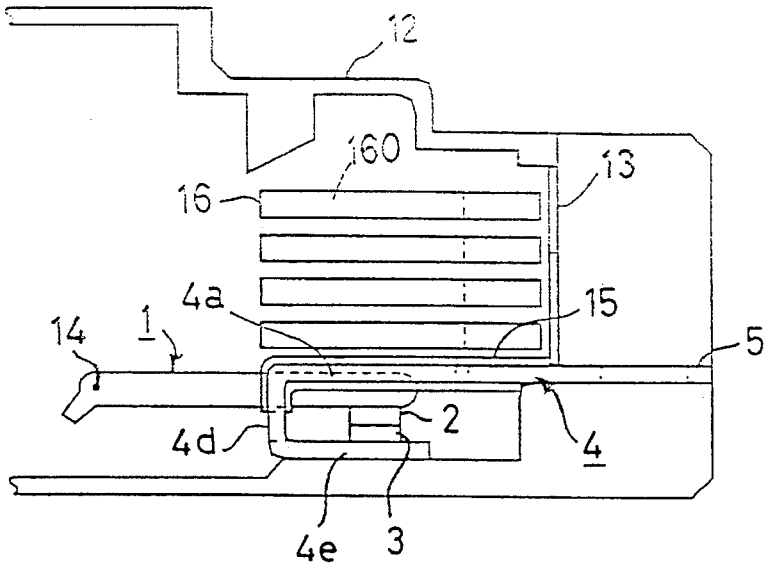
Figure 173:
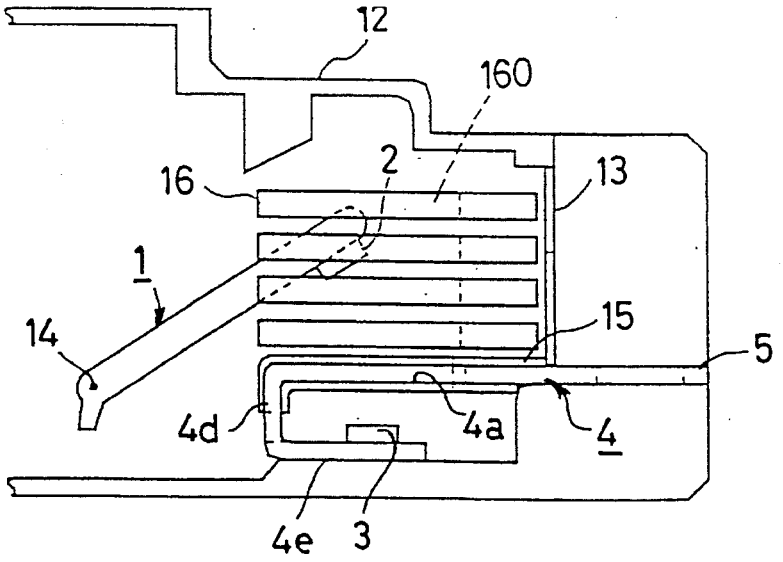
Figure 174A:
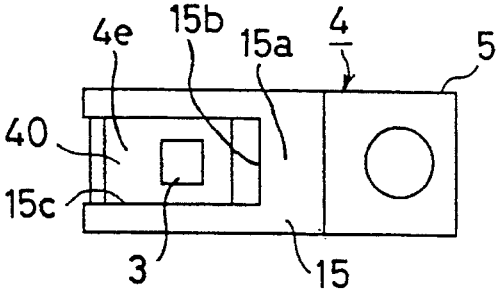
Figure 174B:
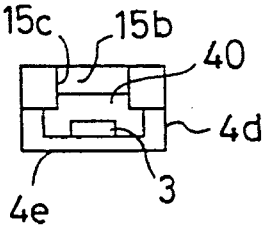
Figure 175:
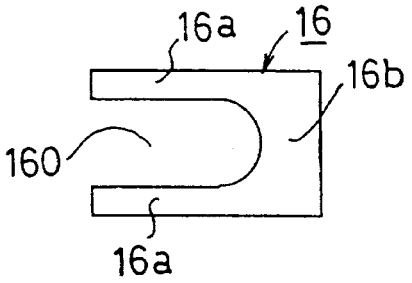
Figure 176:
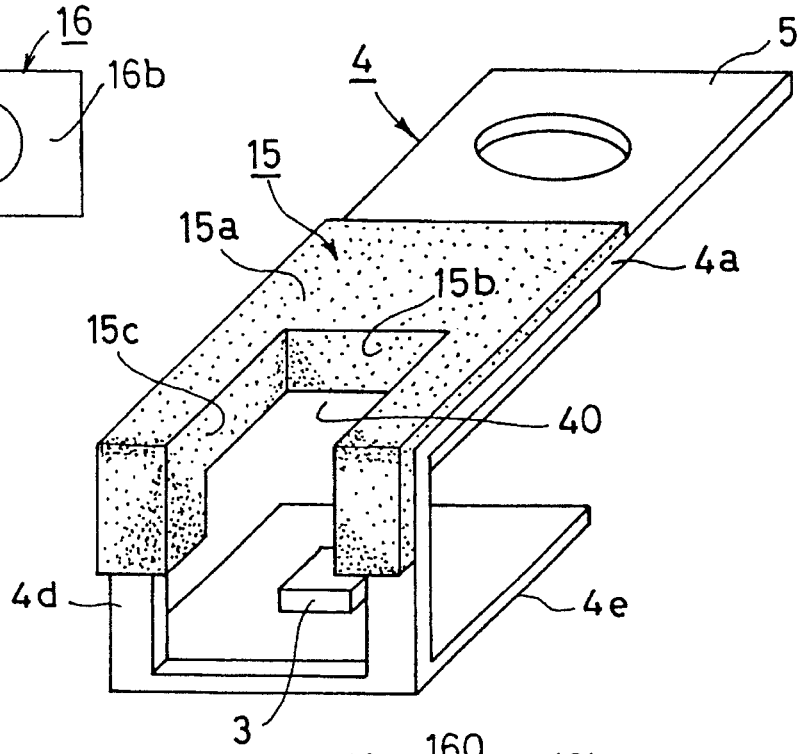
Figure 177:
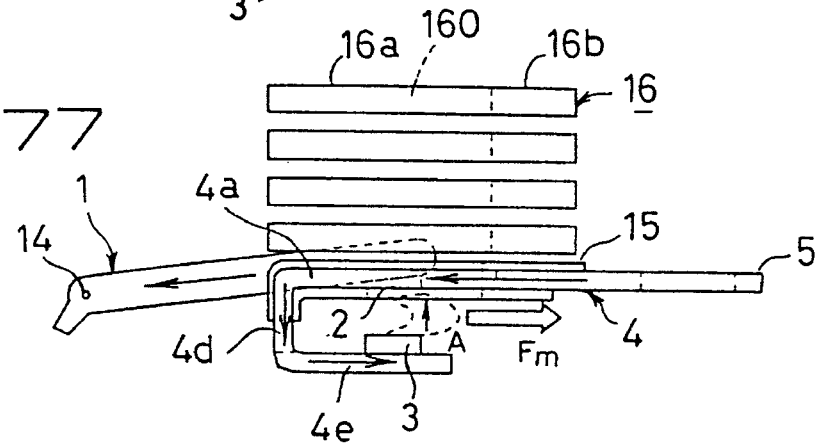
Figure 178:
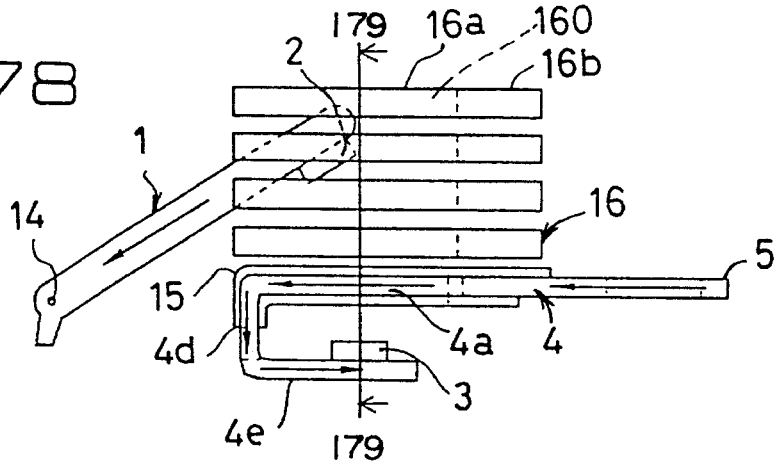
Figure 179:
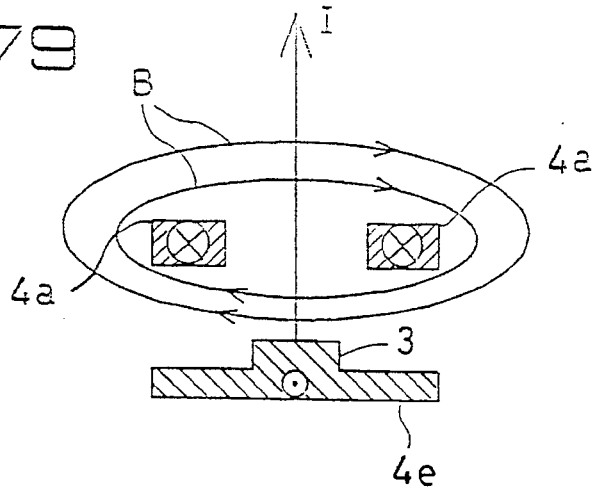
Figure 180:
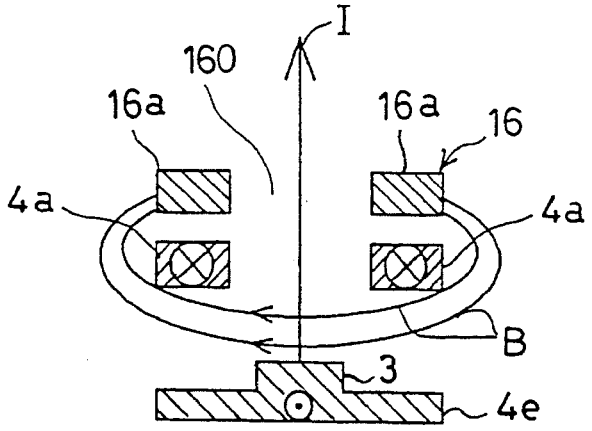
Figure 181:
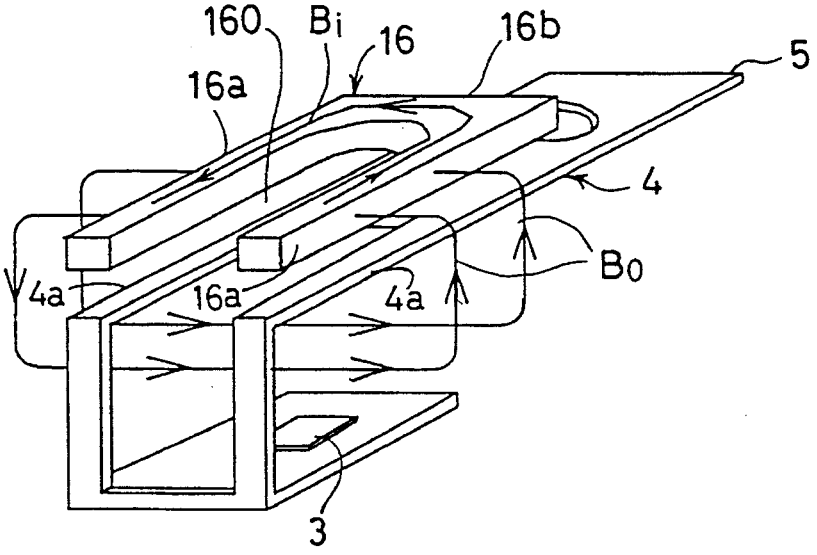
Figure 182:
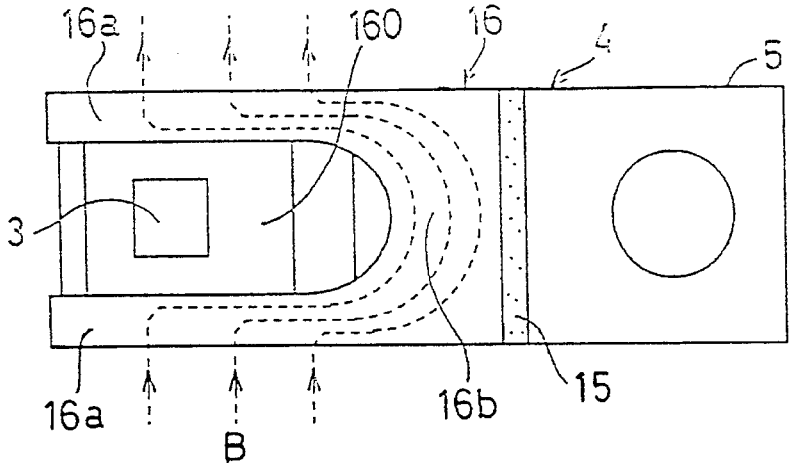
Figure 183:
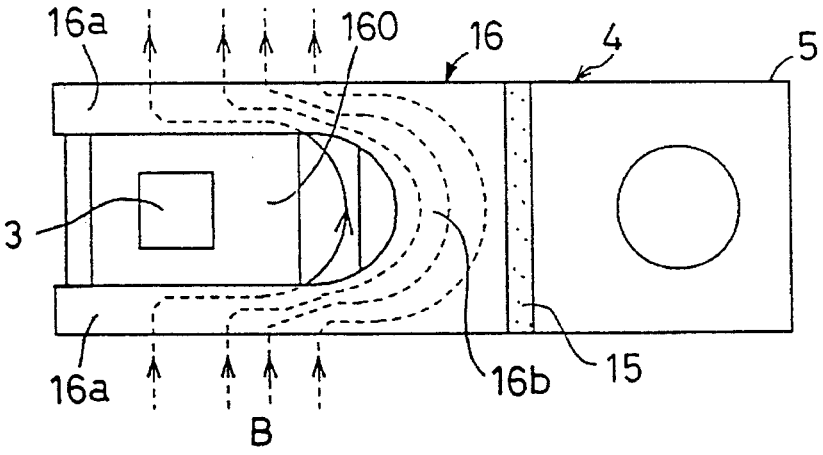
Figure 184:
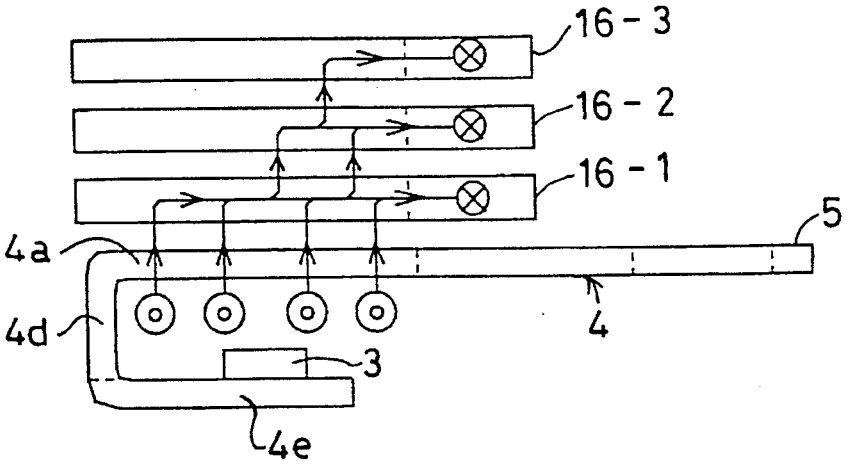
Figure 185:
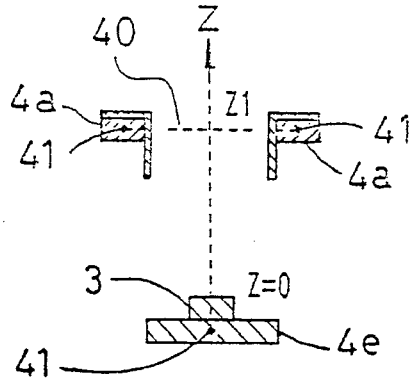
Figure 186:
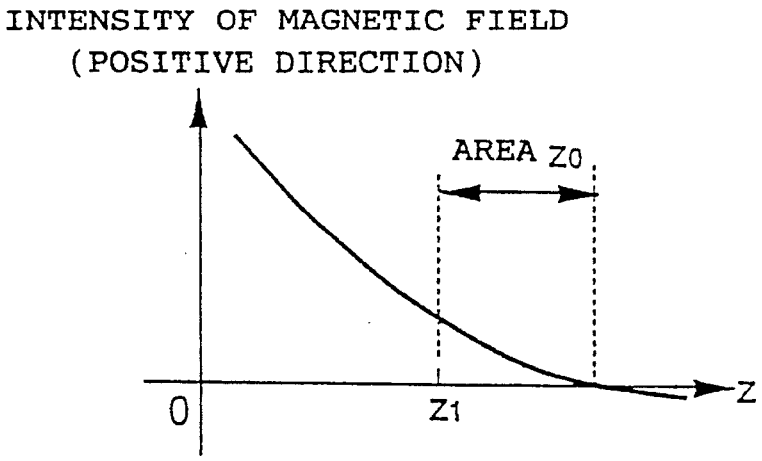
Figure 187:
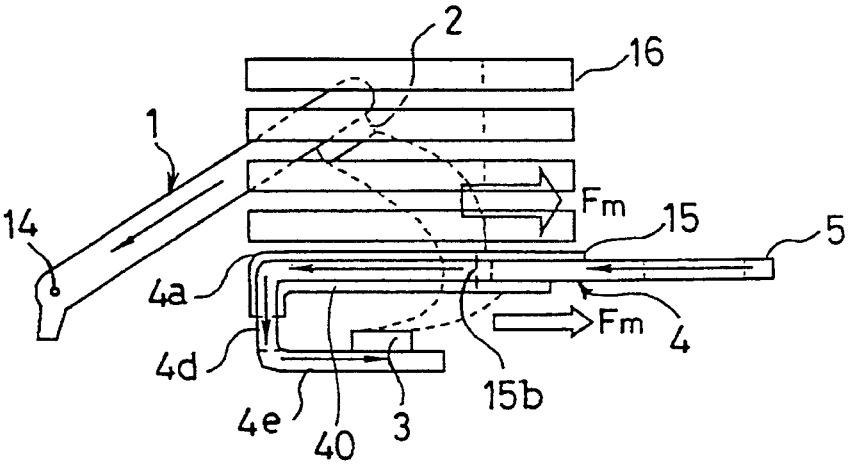
Figure 188A:
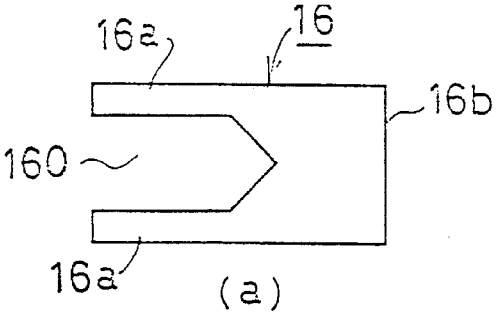
Figure 188B:
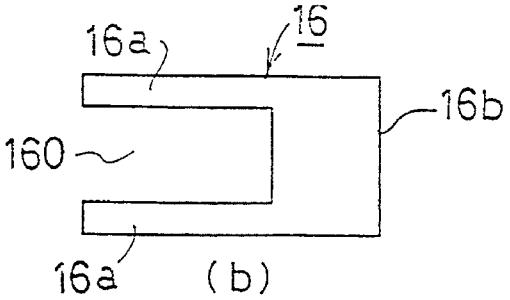
Figure 188C:
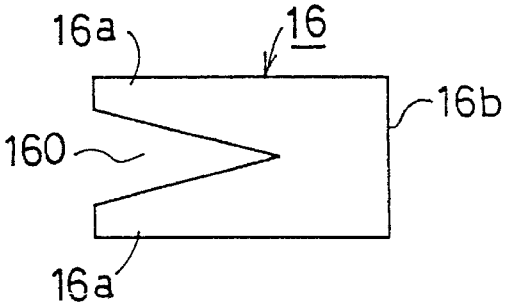
Figure 188D:
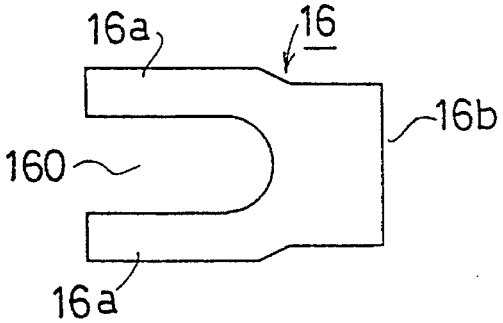
Figure 189A:
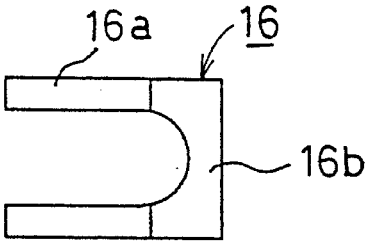
Figure 189B:
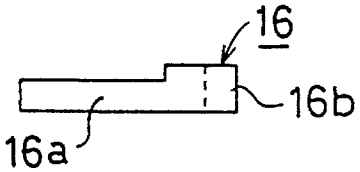
Figure 190A:
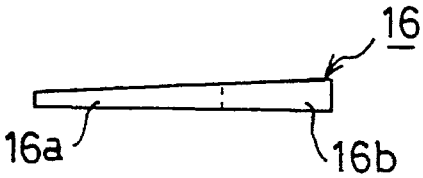
Figure 190B:
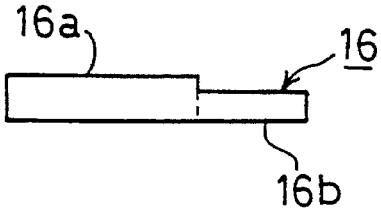
Figure 191:
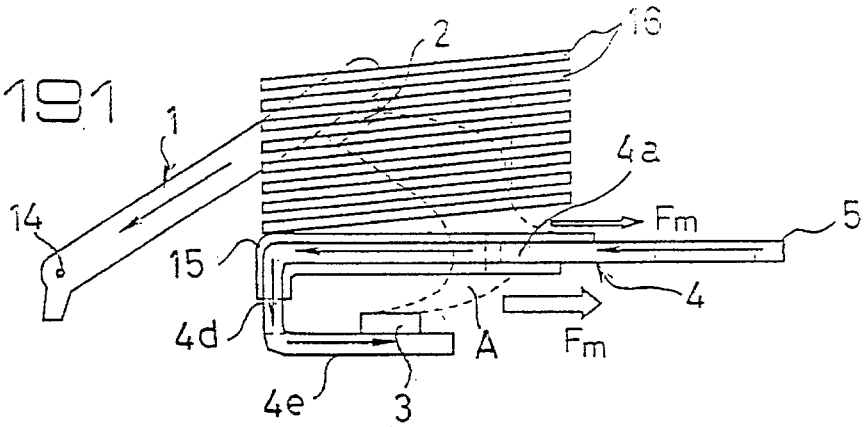
Figure 192:
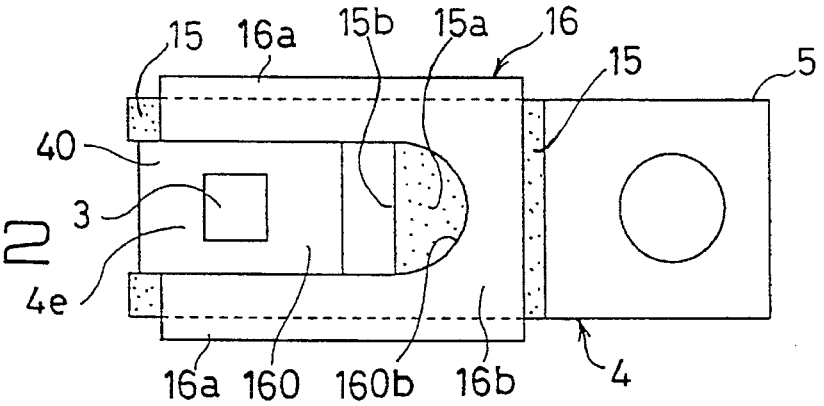
Figure 193:
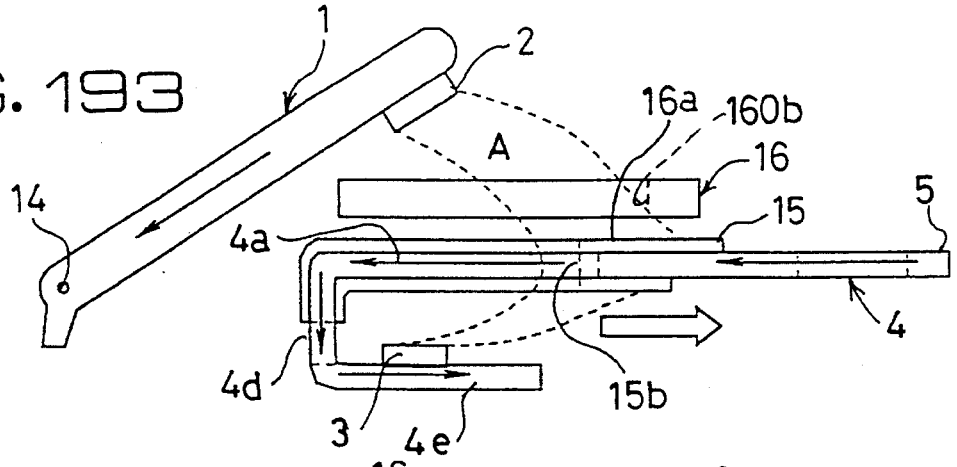
Figure 194:
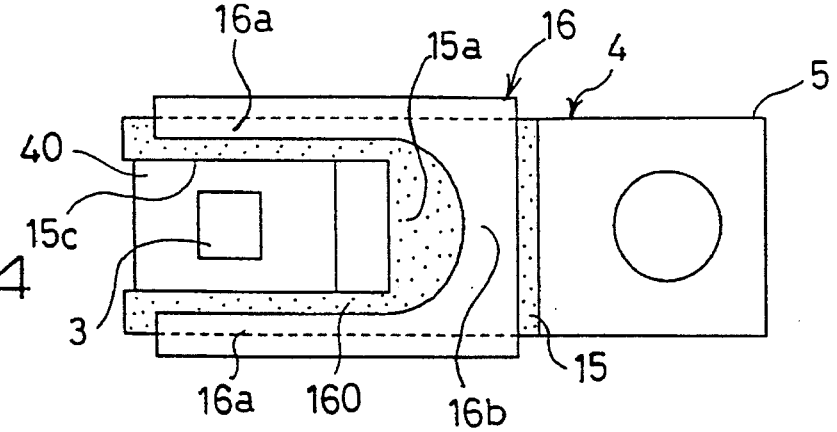
Figure 198:
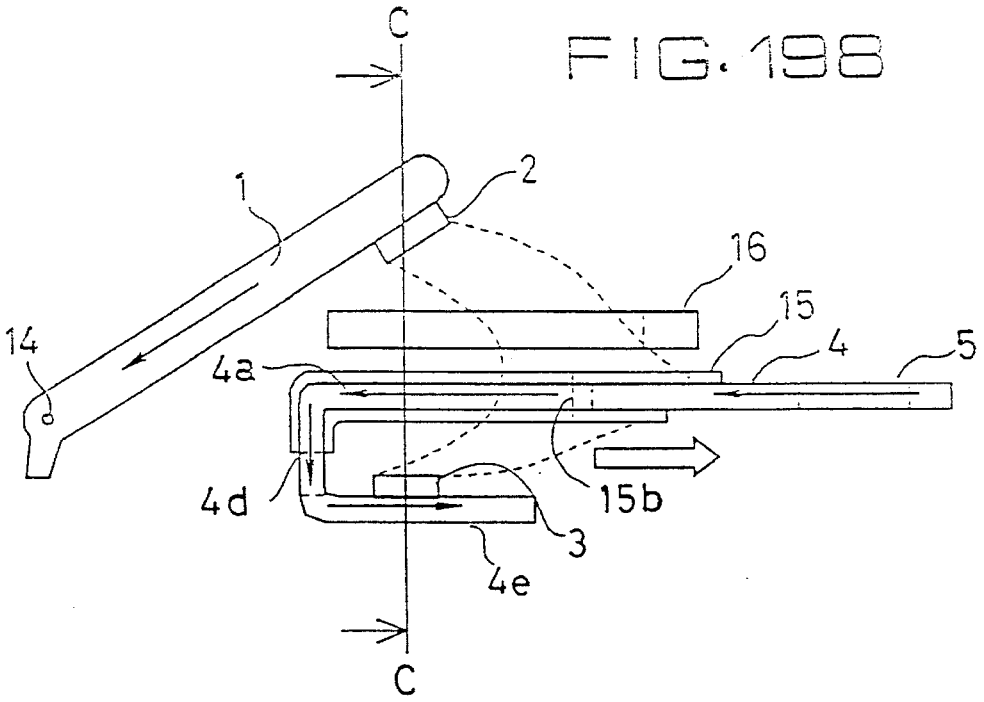
Figure 199:
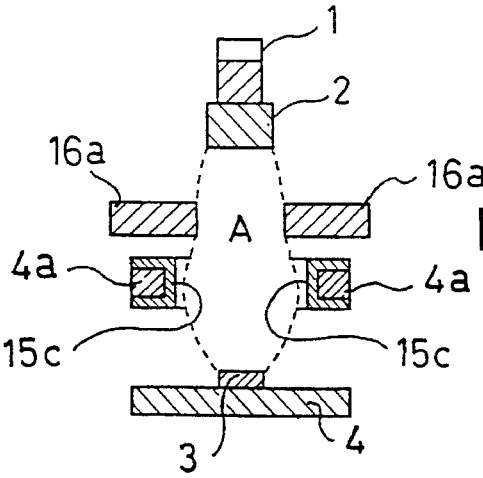
Figure 200:
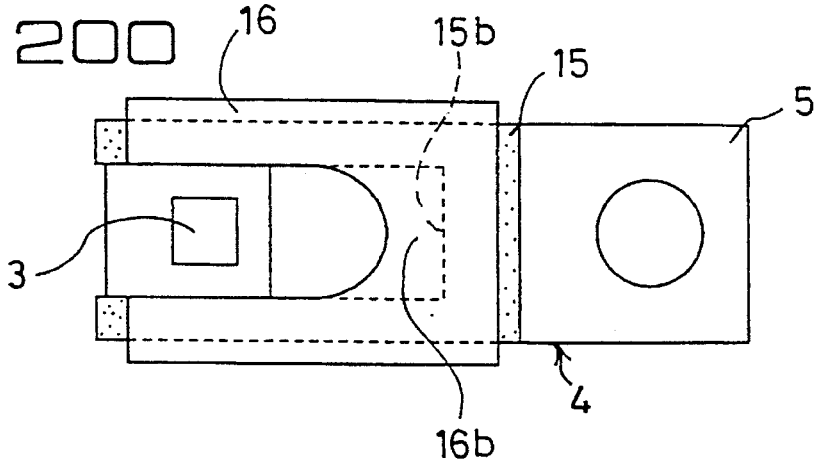
Figure 211:
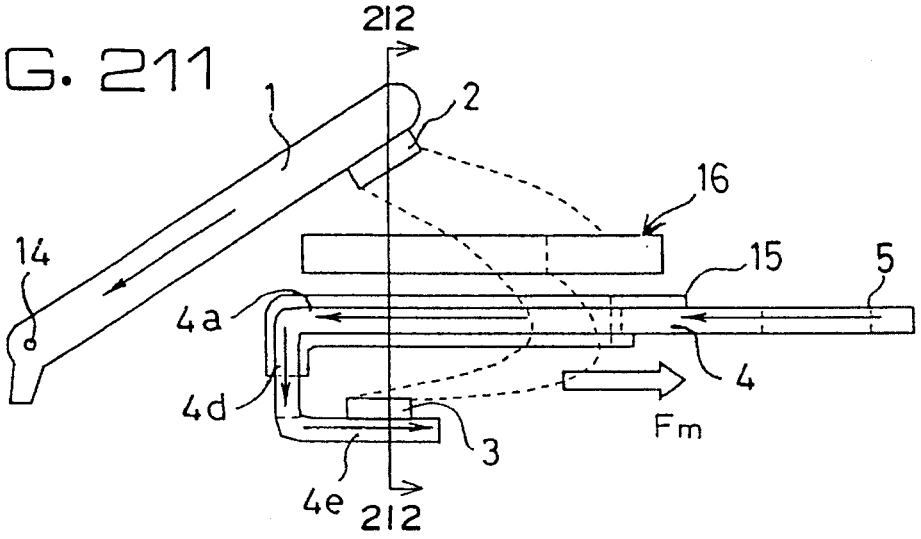
Figure 212:
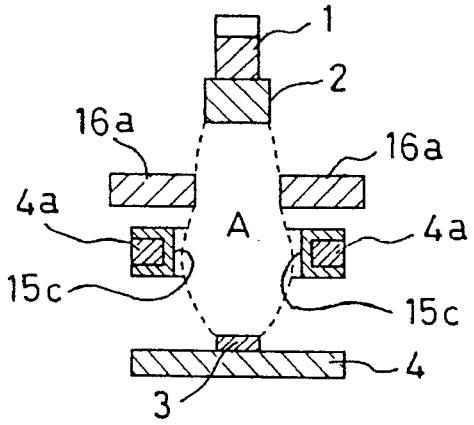
Figure 213:
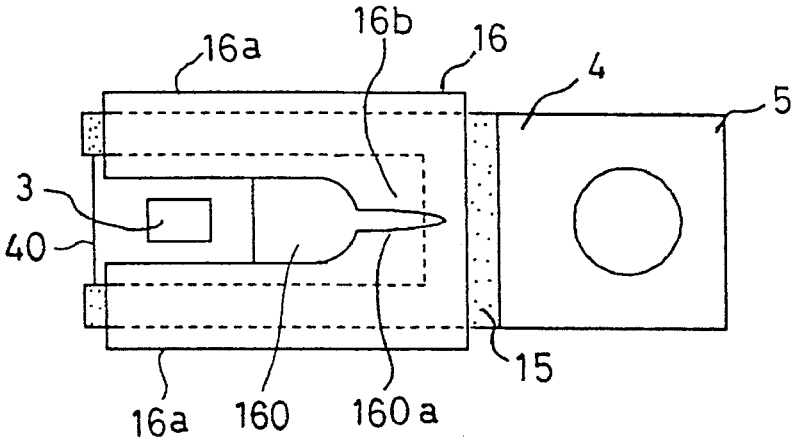
Figure 214:
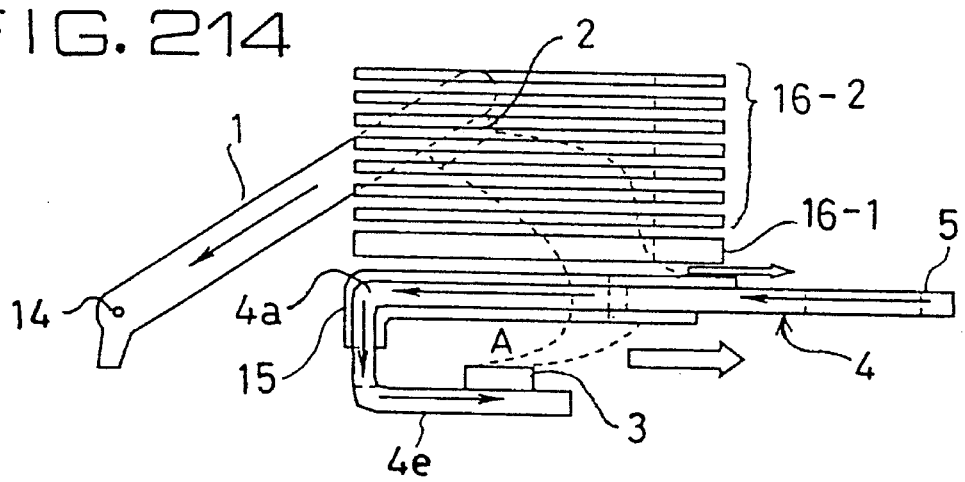
Figure 215:
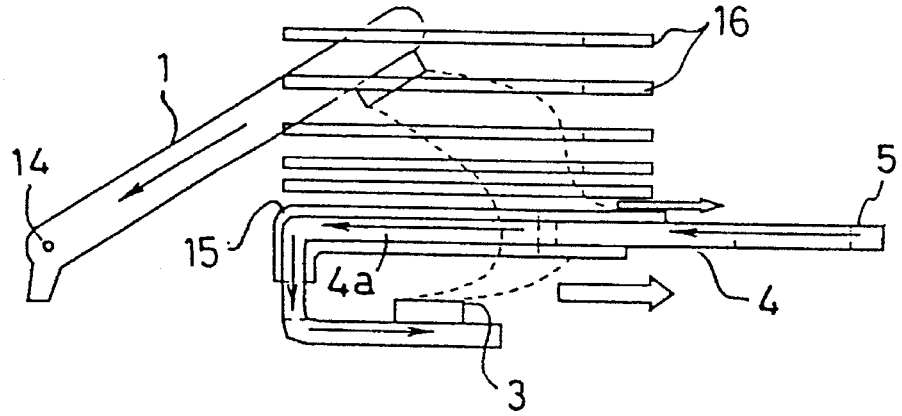
Figure 216A:
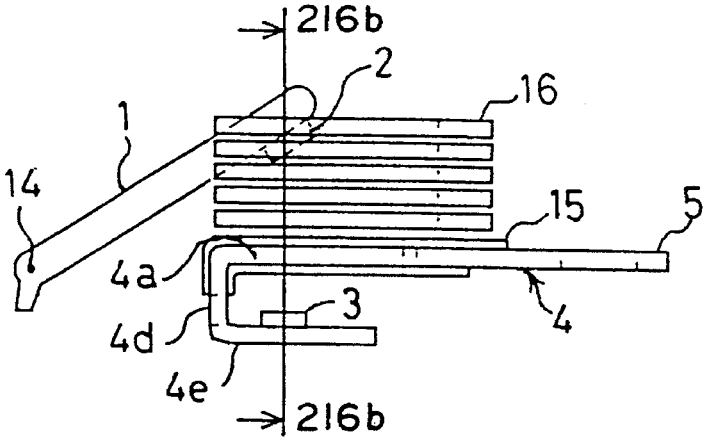
Figure 216B:
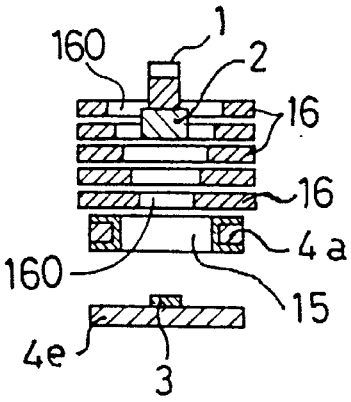
Figure 217:
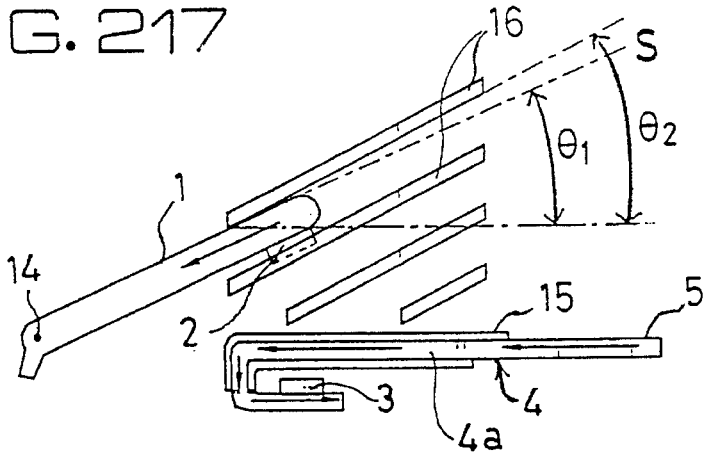
Figure 218:
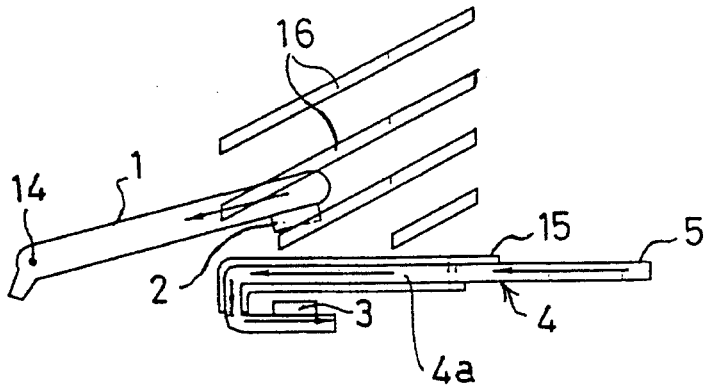
Figure 219A:
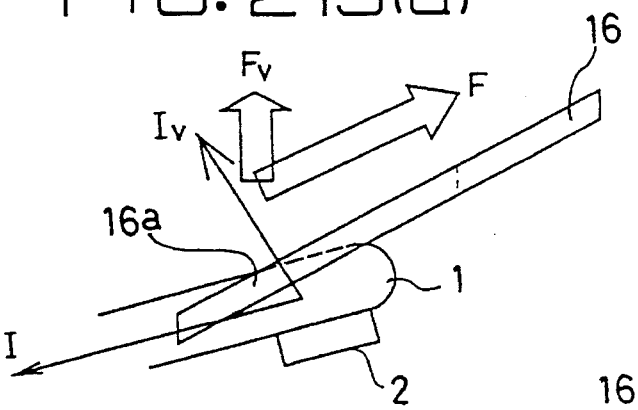
Figure 219B:
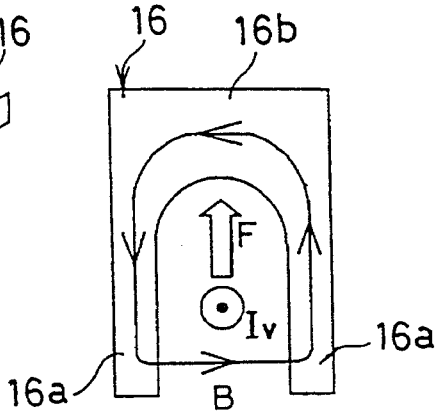
Figure 220:
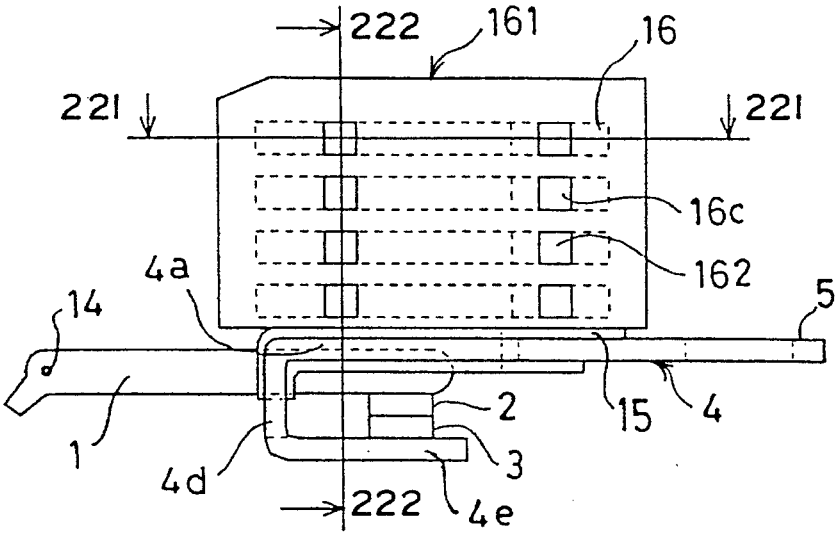
Figure 221:
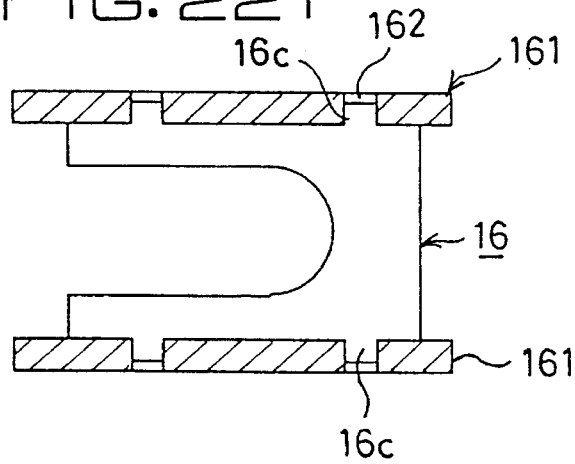
Figure 222:
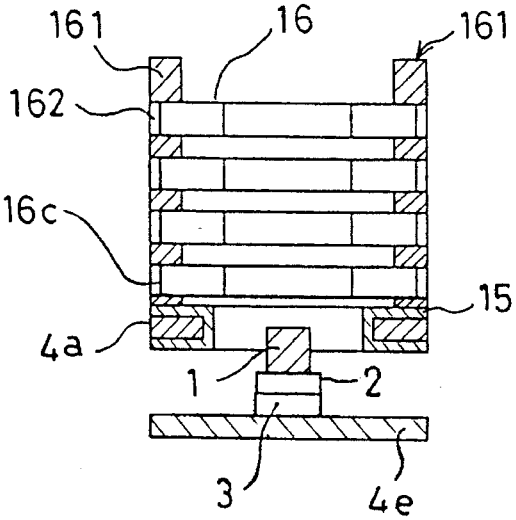
Figure 223:
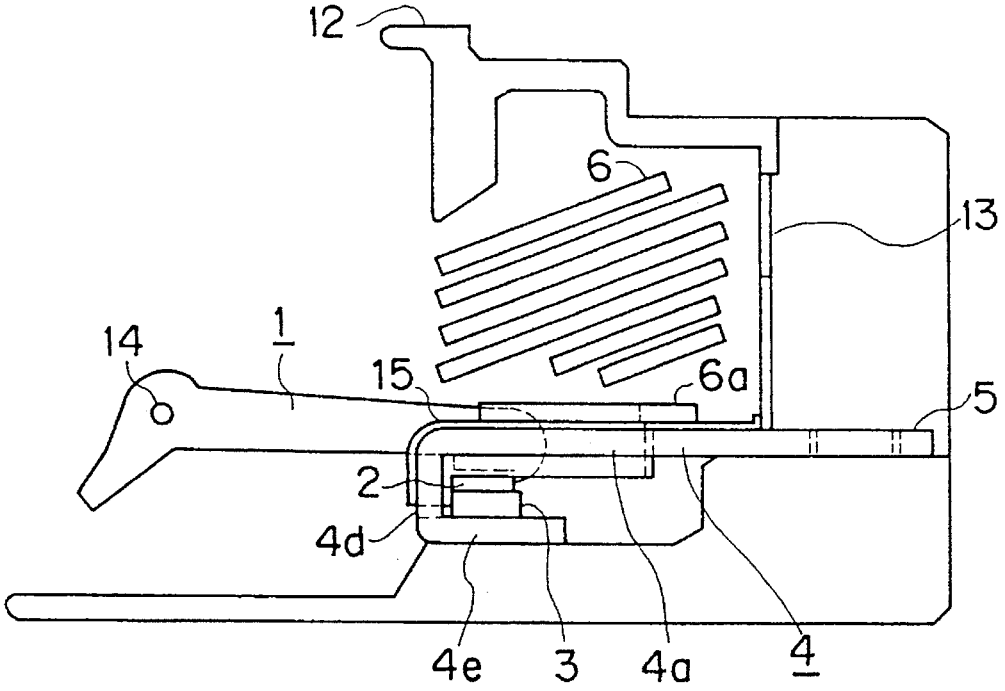
Figure 224:
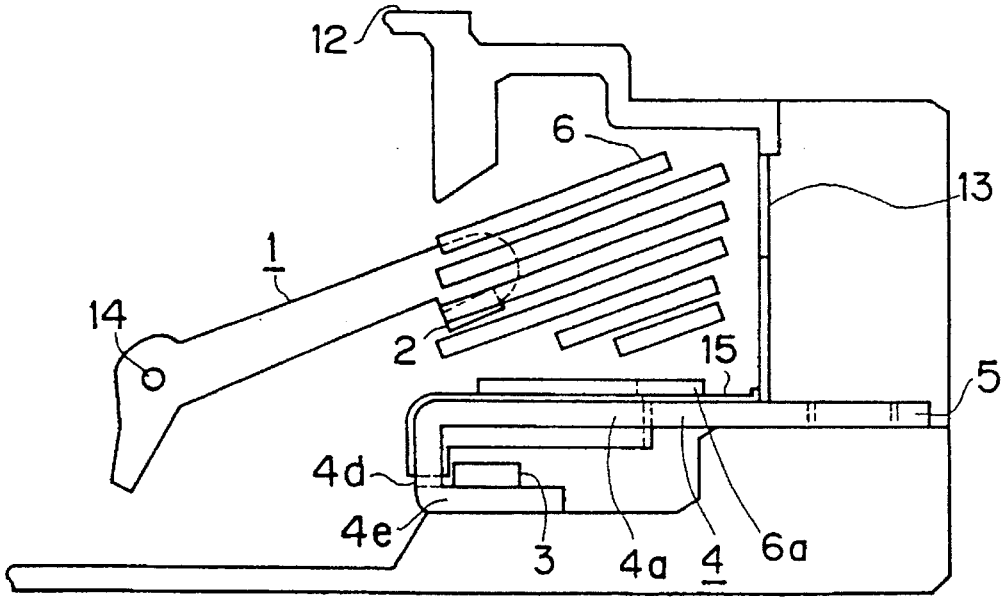
Figure 225A:
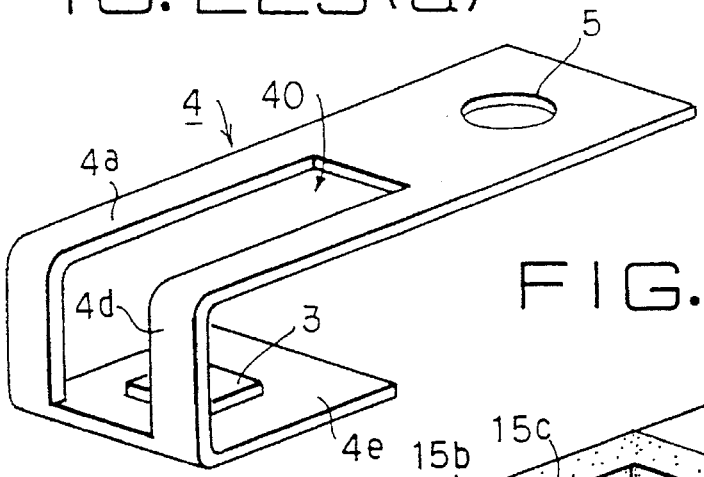
Figure 225B:
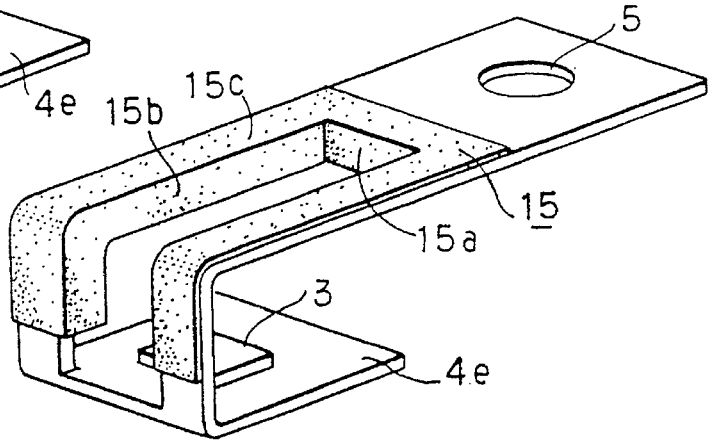
Figure 226:
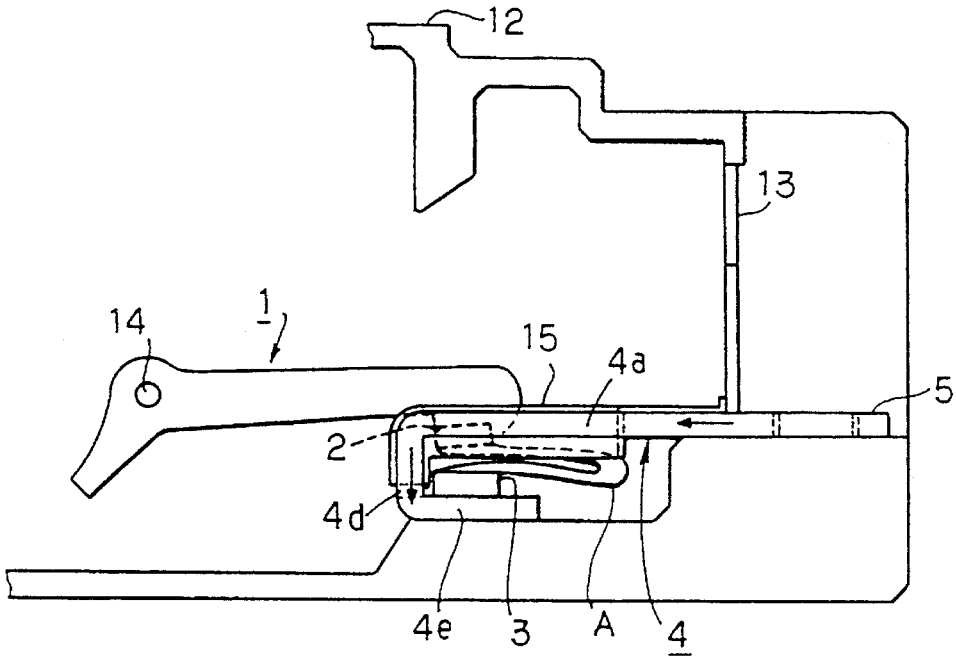
Figure 227A:
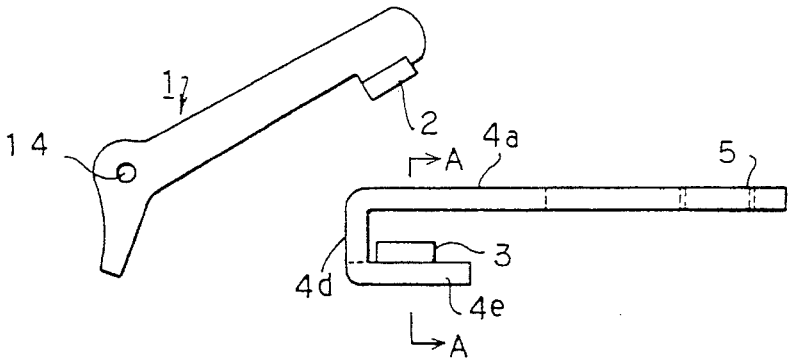
Figure 227B:
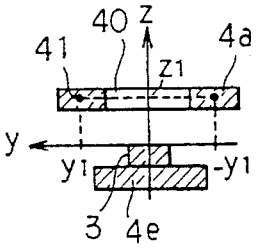
Figure 227C:
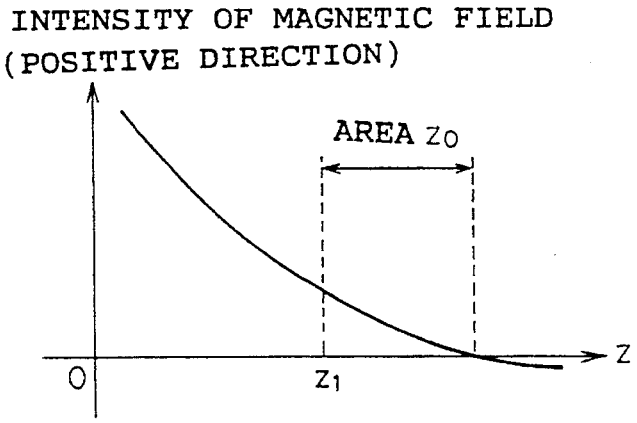
Figure 228:
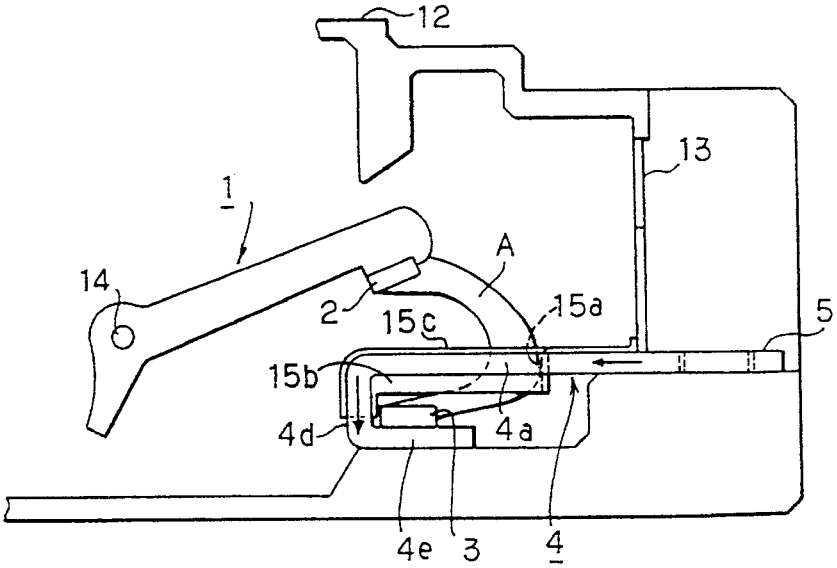
Figure 229:
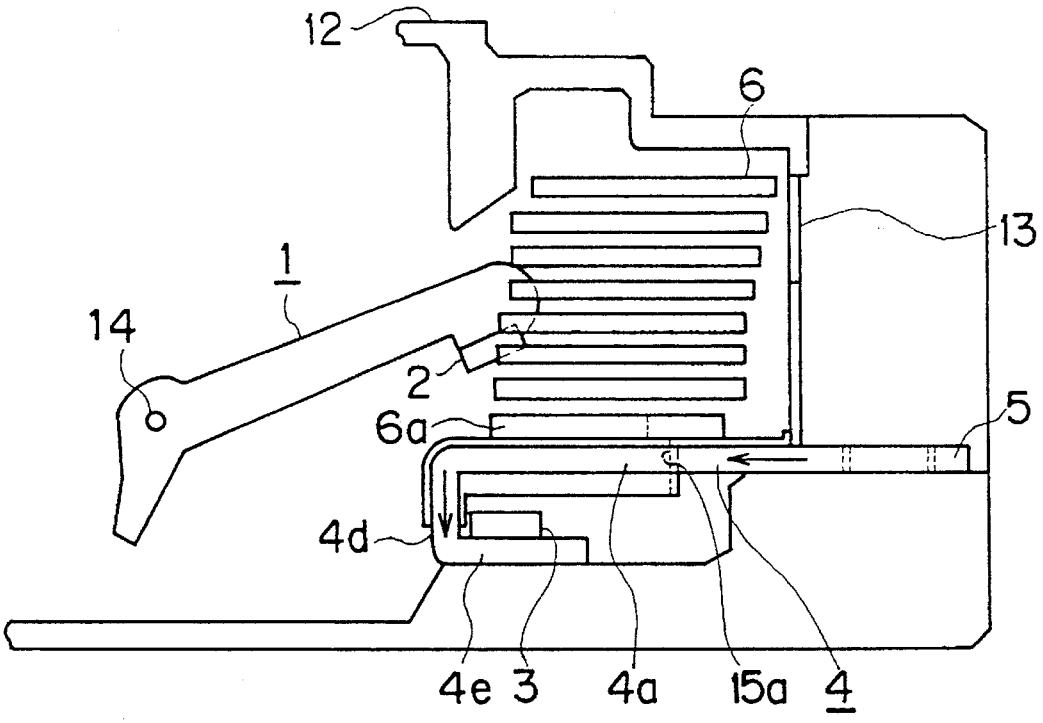
Figure 230:
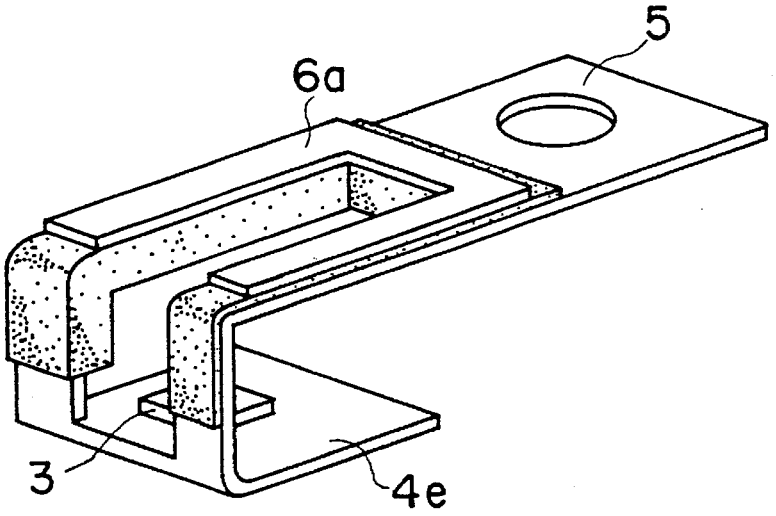
Figure 231A:
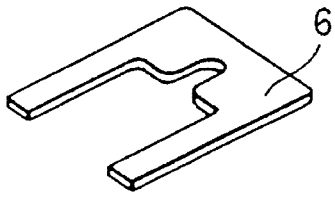
Figure 231B:
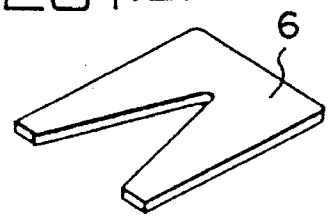
Figure 231C:
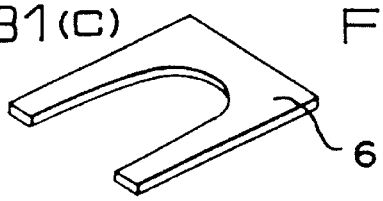
Figure 231D:
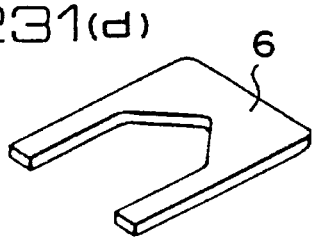
Figure 231E:
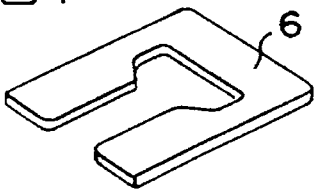
Figure 231F:
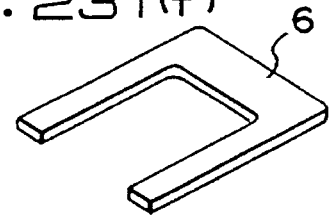
Figure 231G:
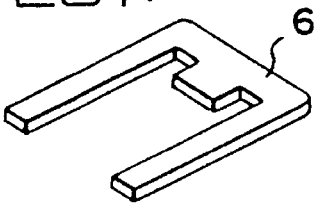
Figure 232:
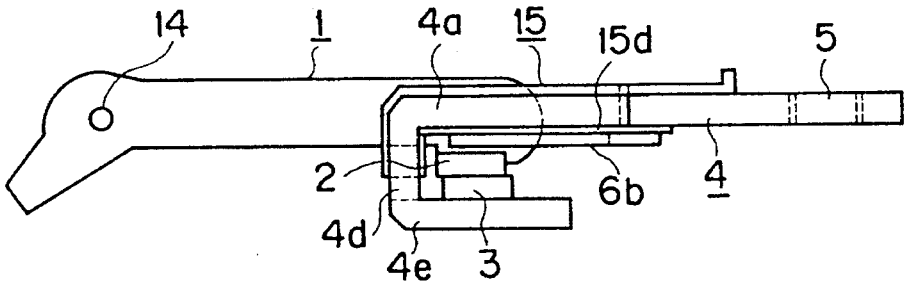
Figure 233:
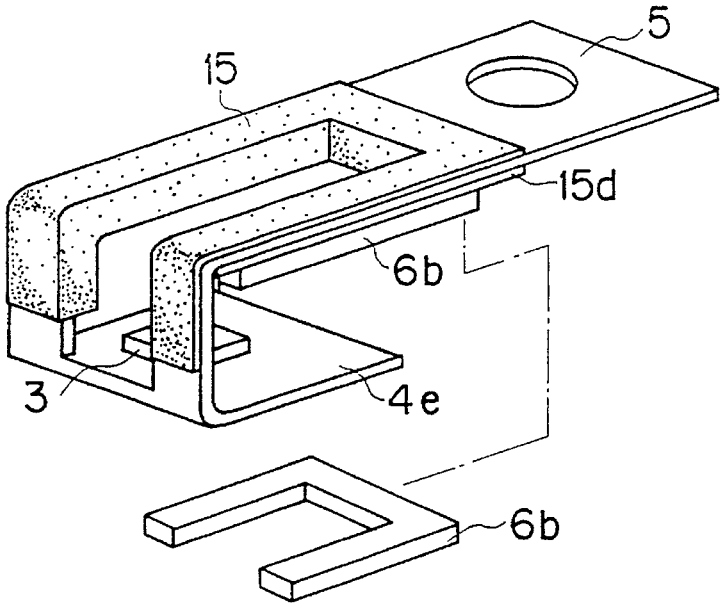
Figure 234:
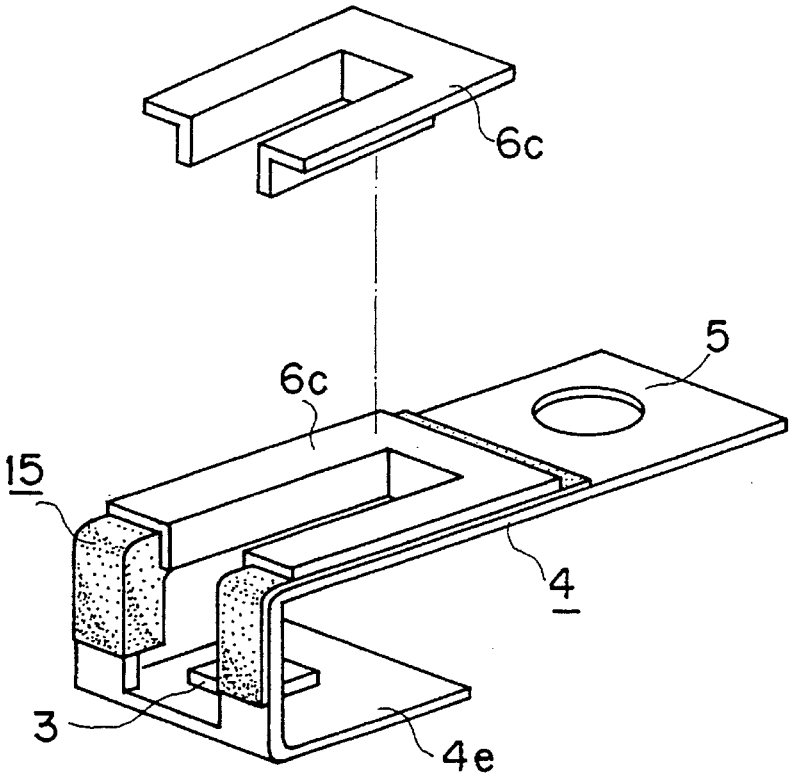
Figure 235:
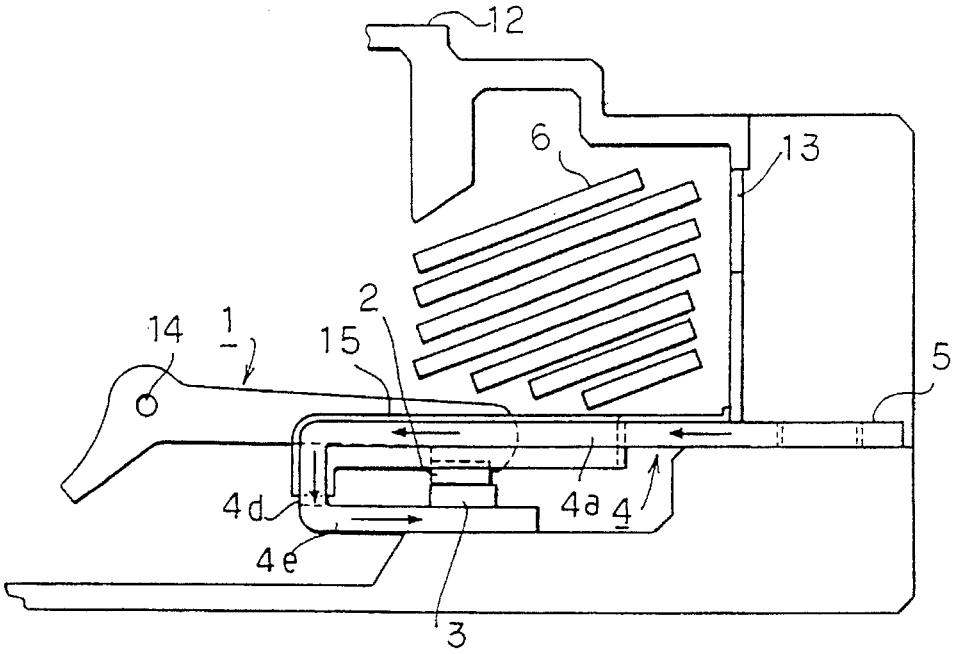
Figure 236:
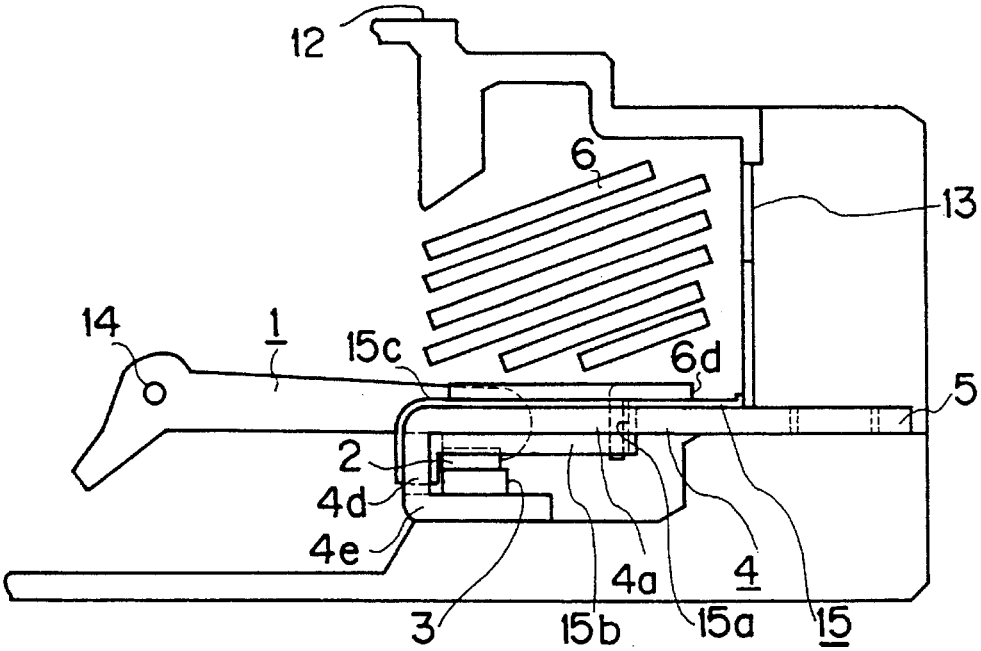
Figure 237:
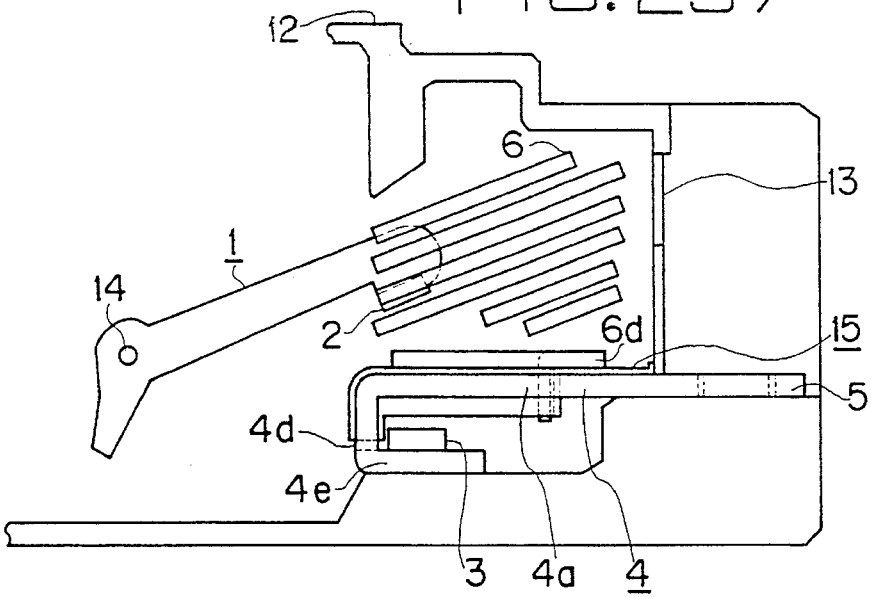
Figure 238A:
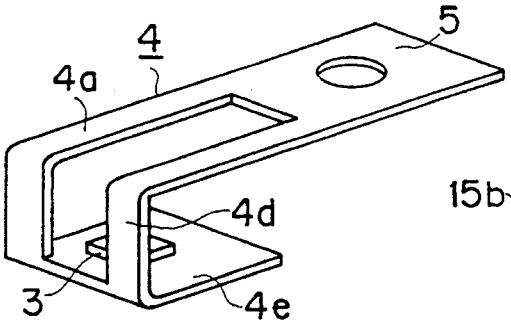
Figure 238B:
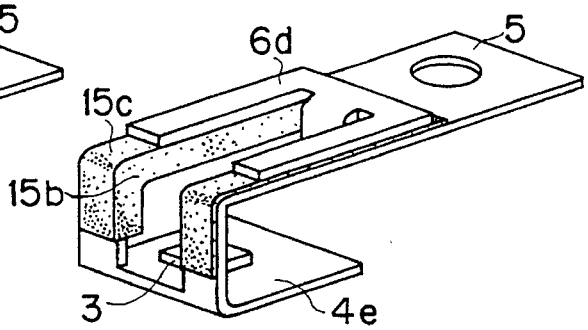
Figure 239:
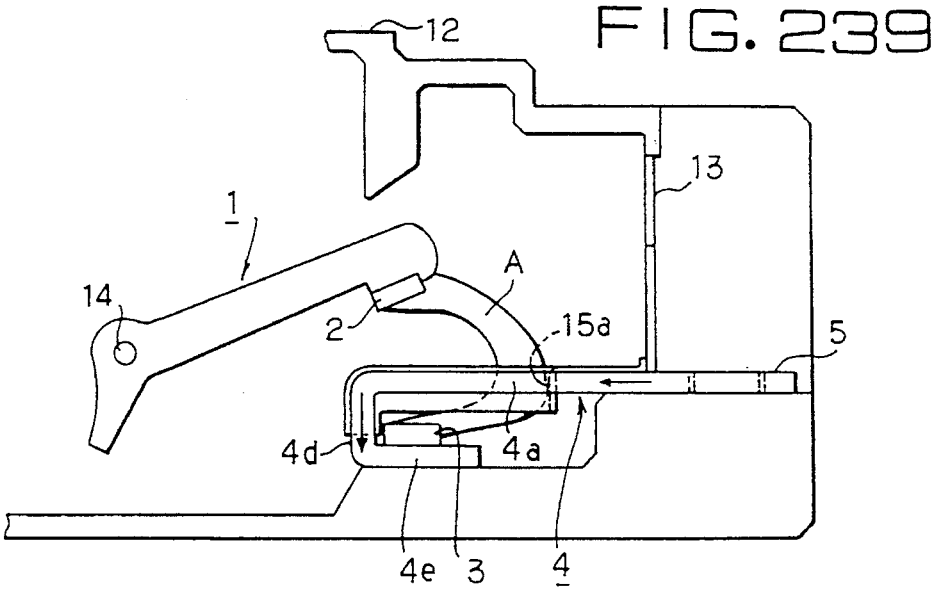
Figure 240A:
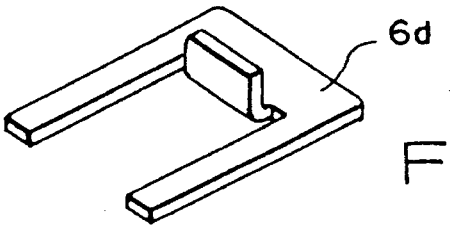
Figure 240B:
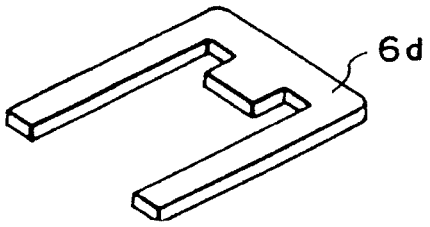
Figure 241:
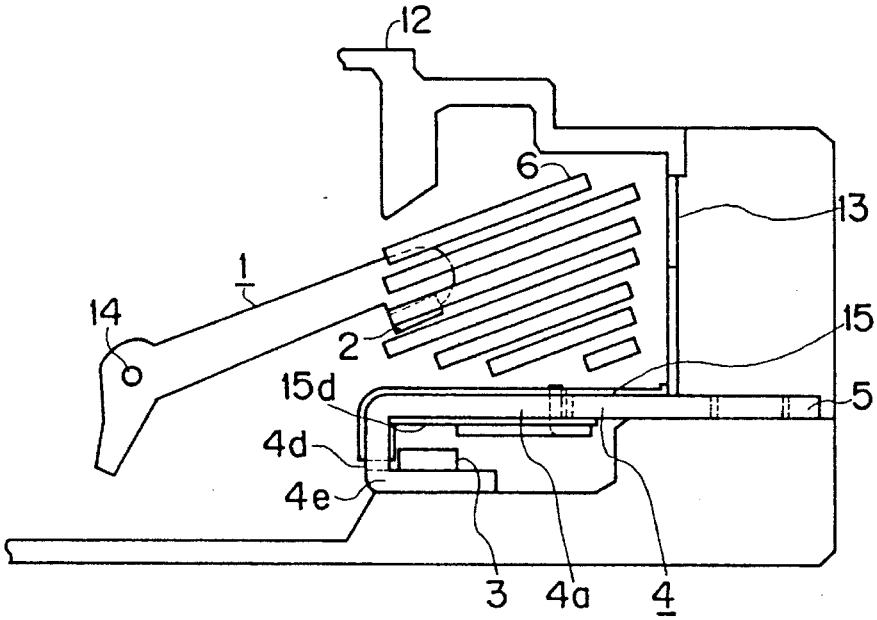
Figure 242:
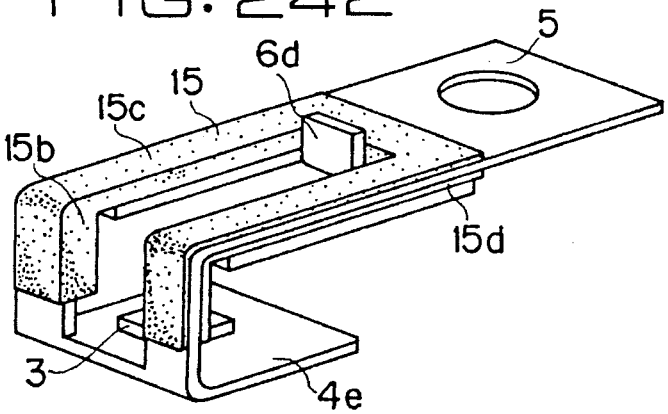
Figure 243:
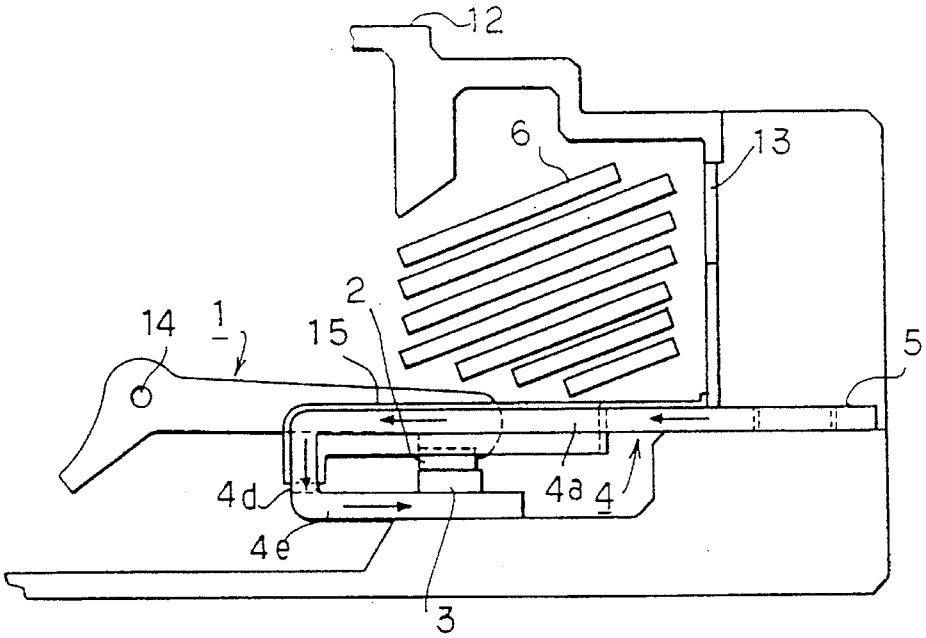
Figure 244:
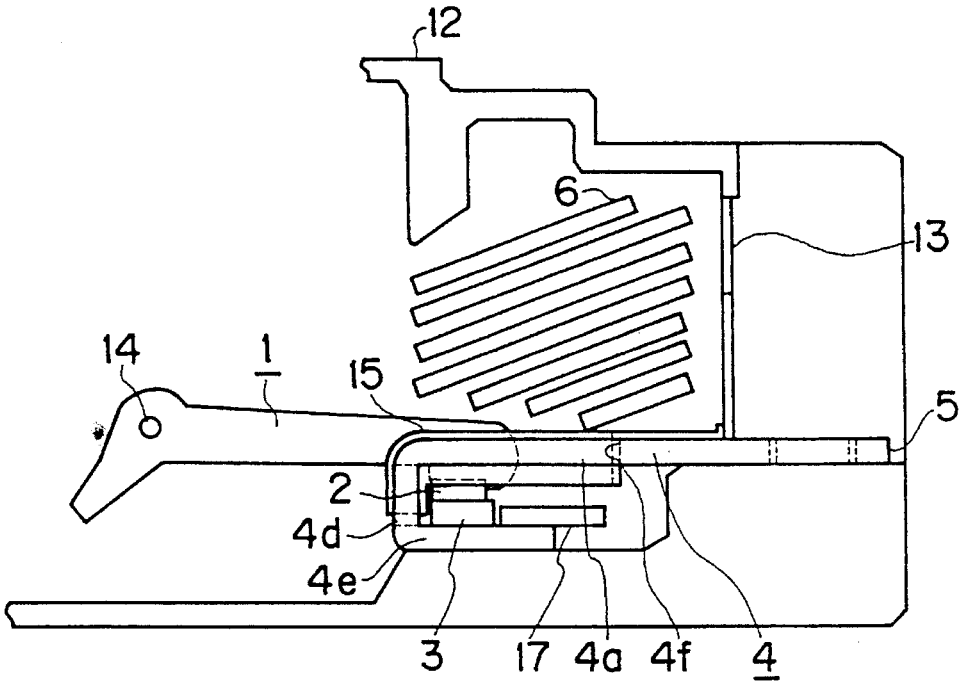
Figure 245:
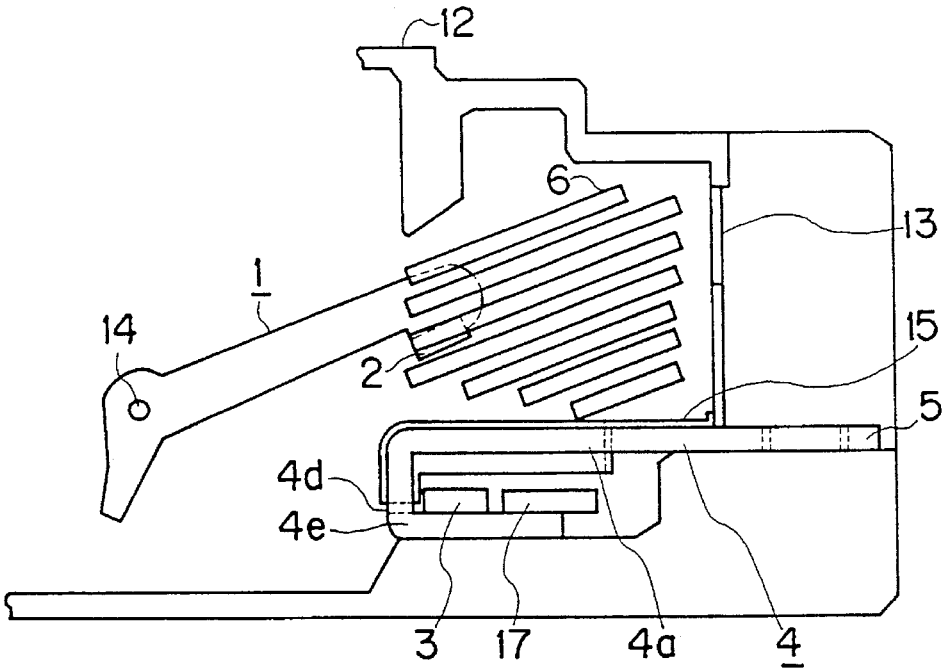
Figures 246A, 246B:
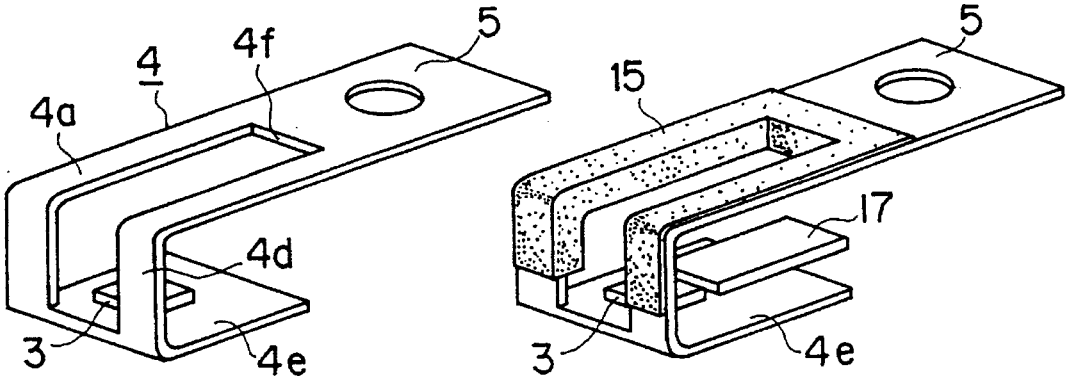
Figure 247:
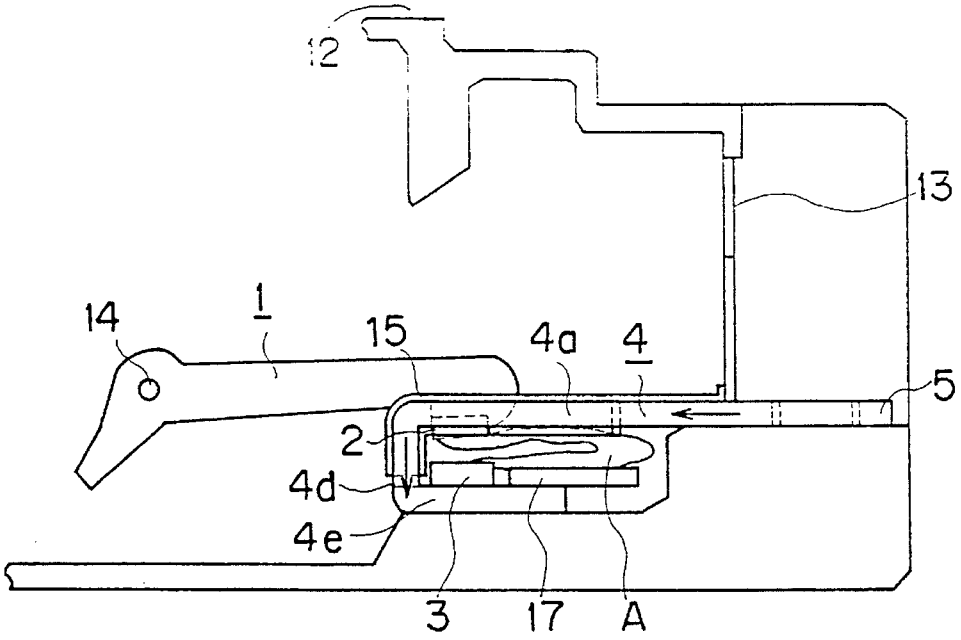
Figure 248:
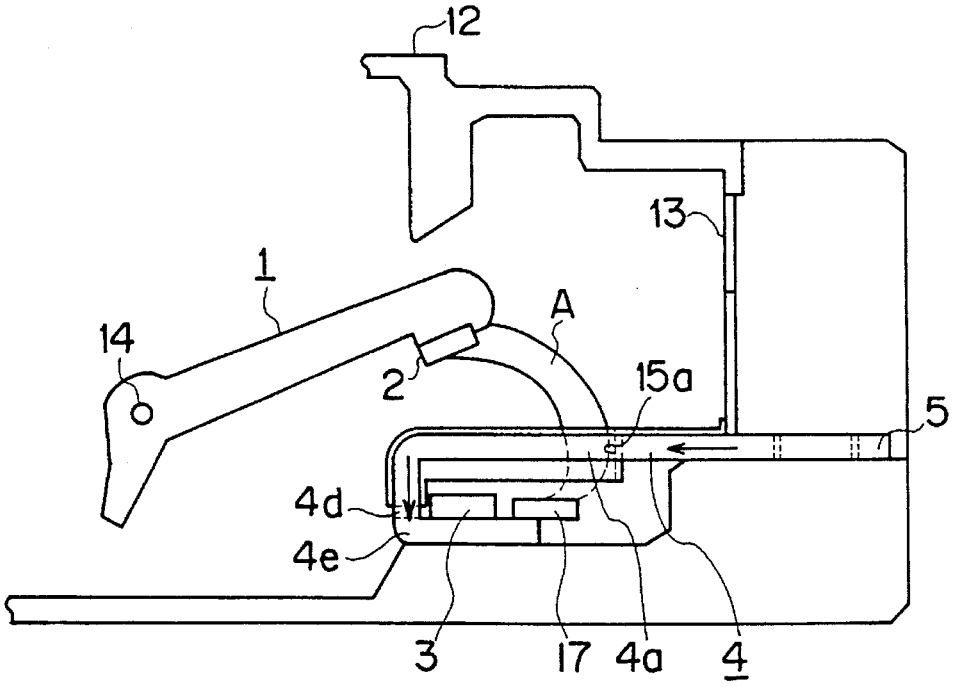
Figure 249A:
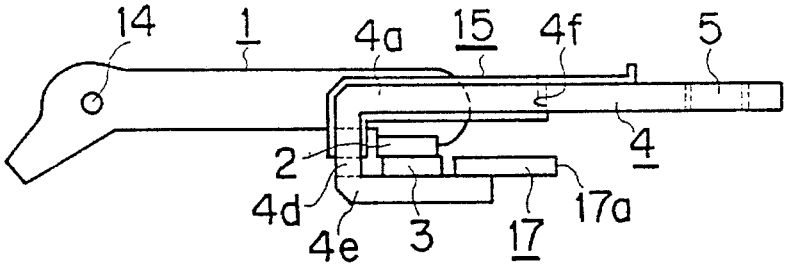
Figure 249B:
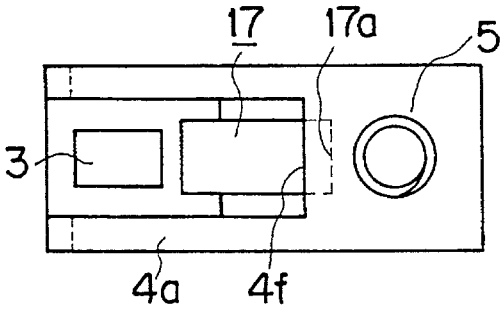
Figure 250:
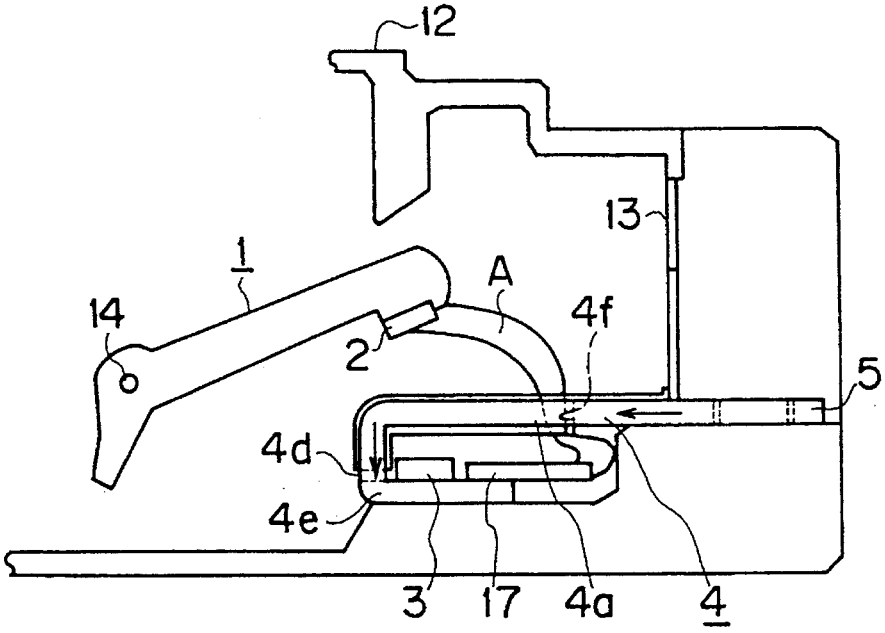
Figure 251:
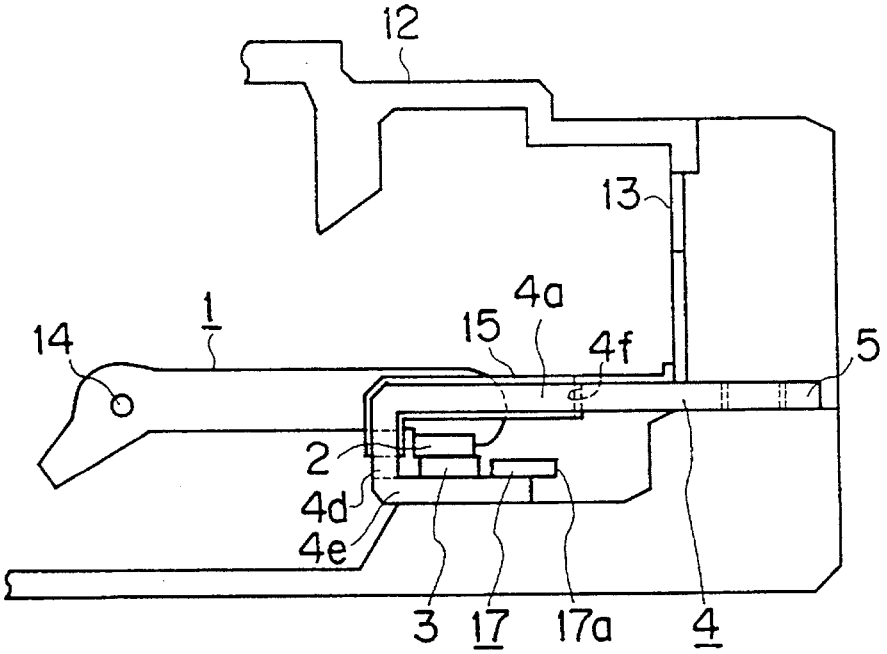
Figure 252:
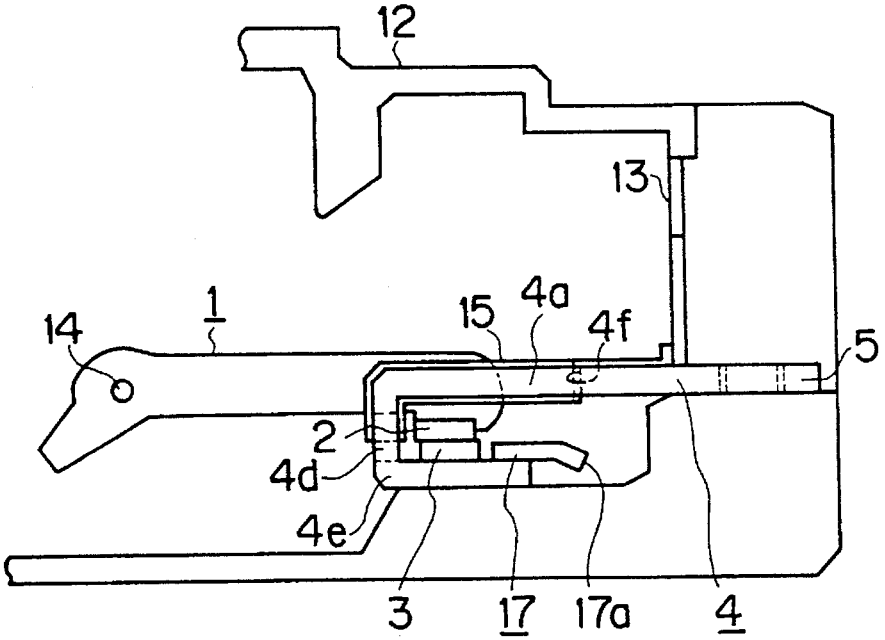
Figure 253A:
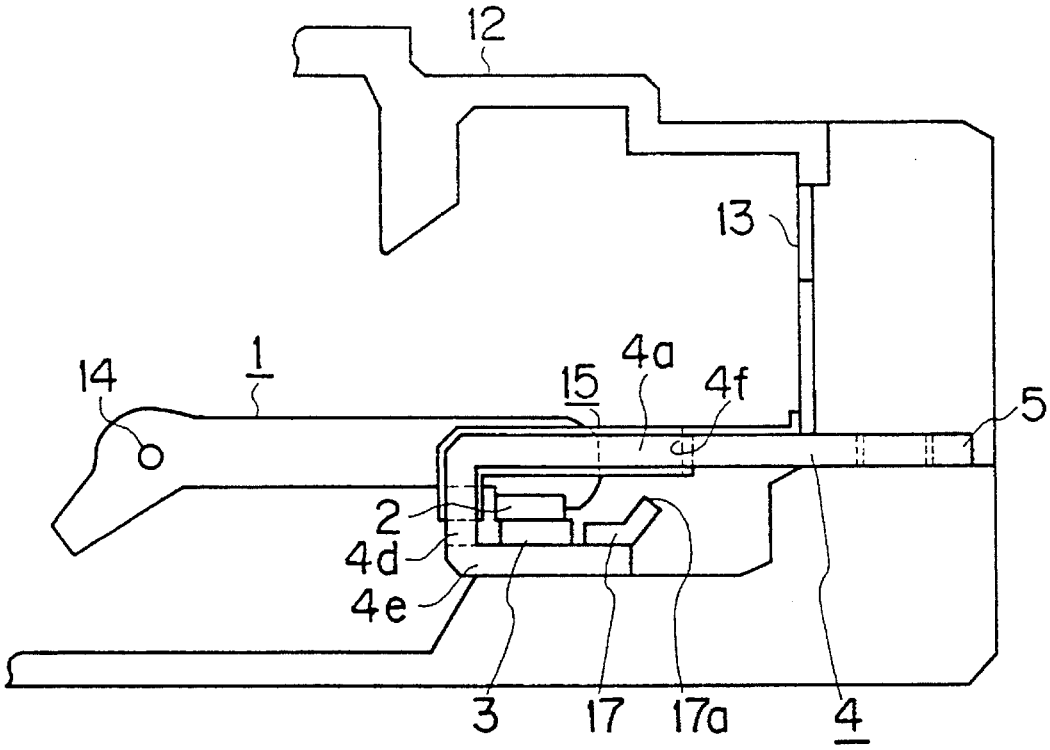
Figure 253B:
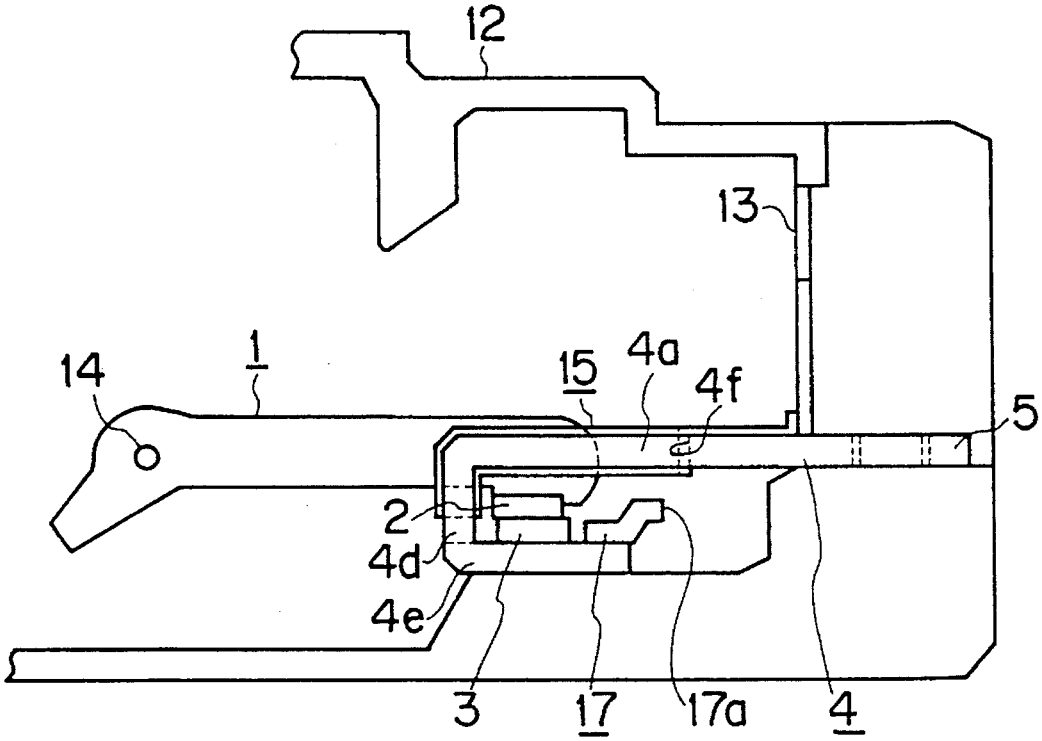
Figure 254A:
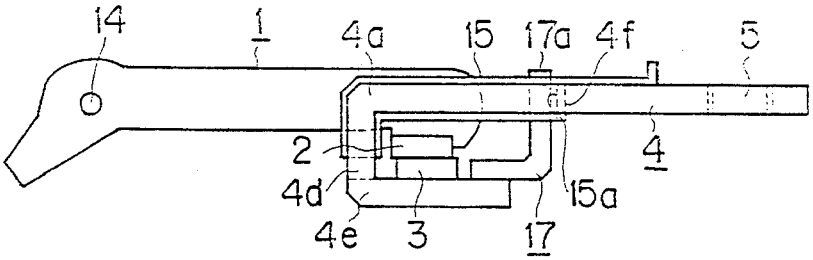
Figure 254B:
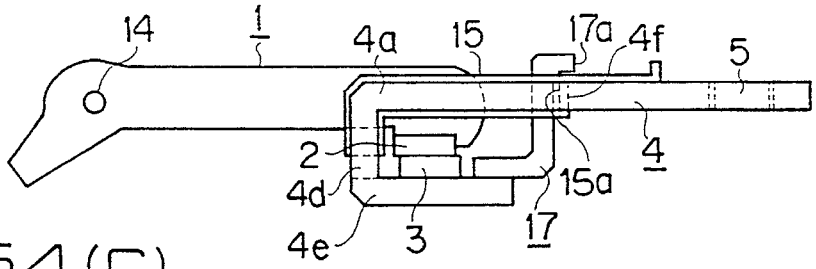
Figure 254C:
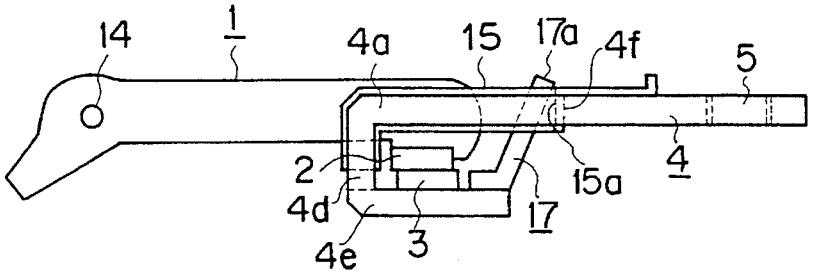
Figure 255A:
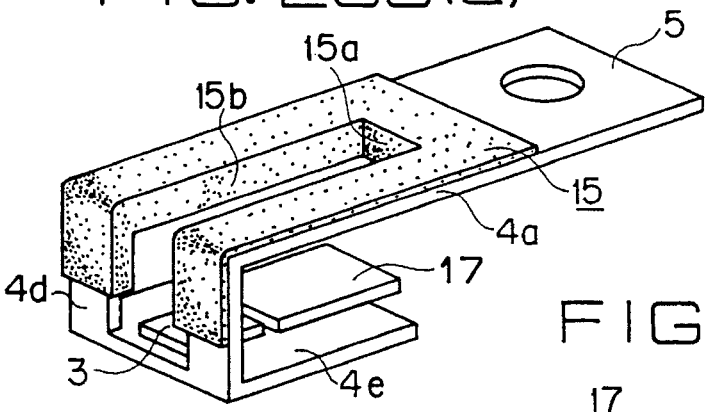
Figure 255B:
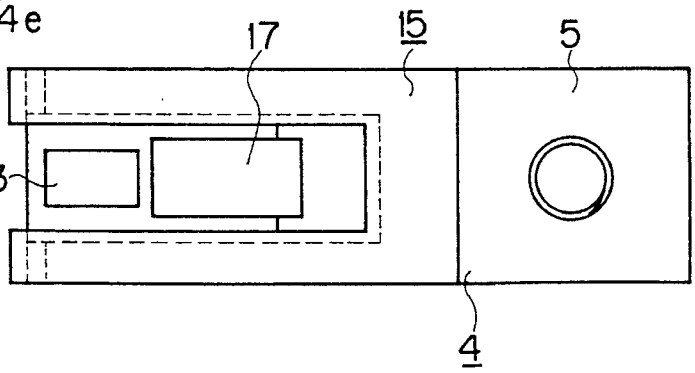
Figure 256A:
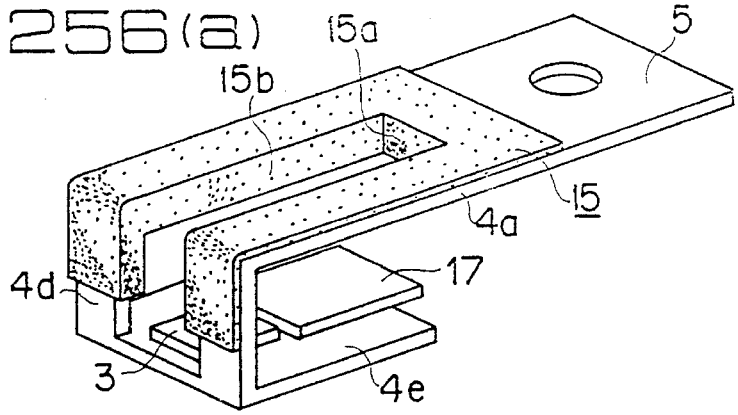
Figure 256B:
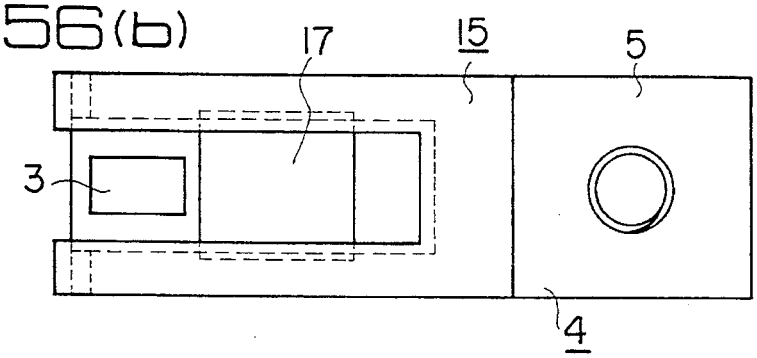
Figure 257A:
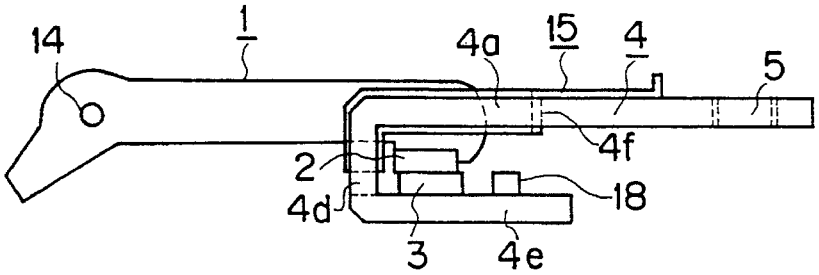
Figure 257B:
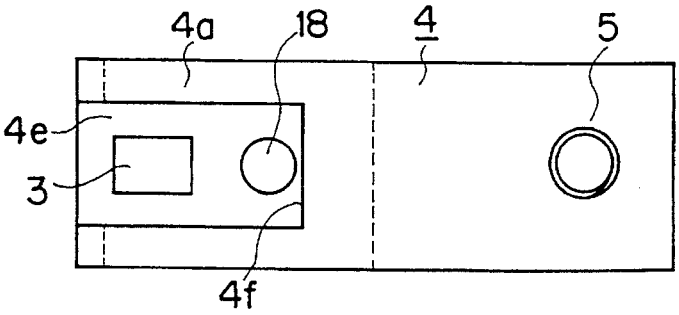
Figure 258A:
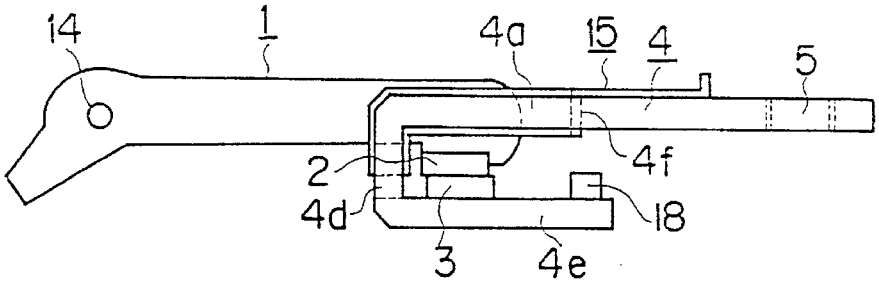
Figure 258B:
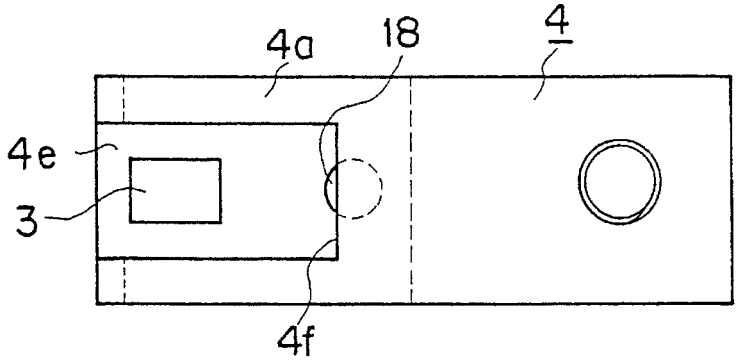
Figure 259:
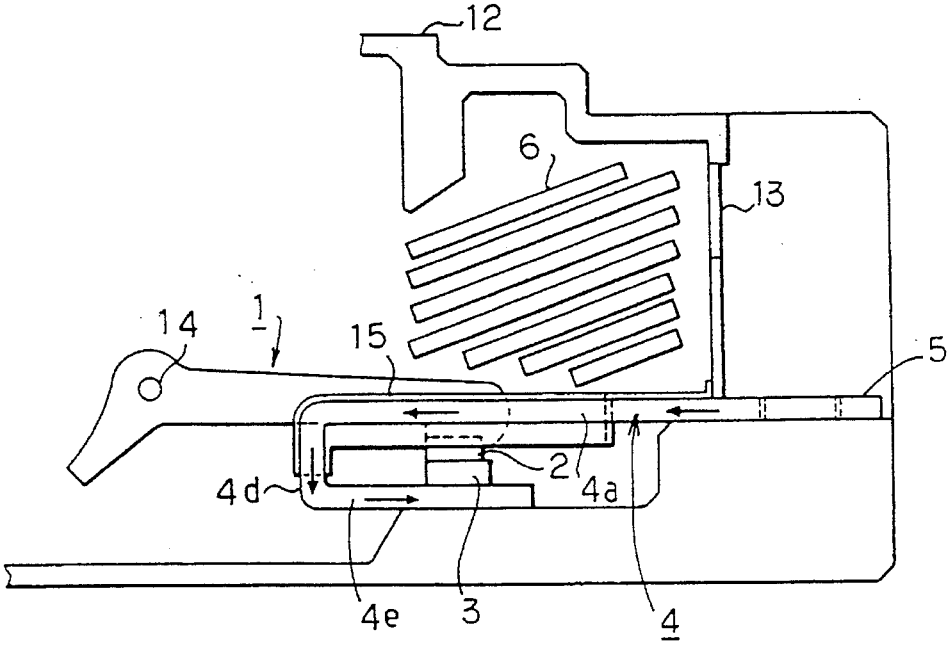
Figure 260:
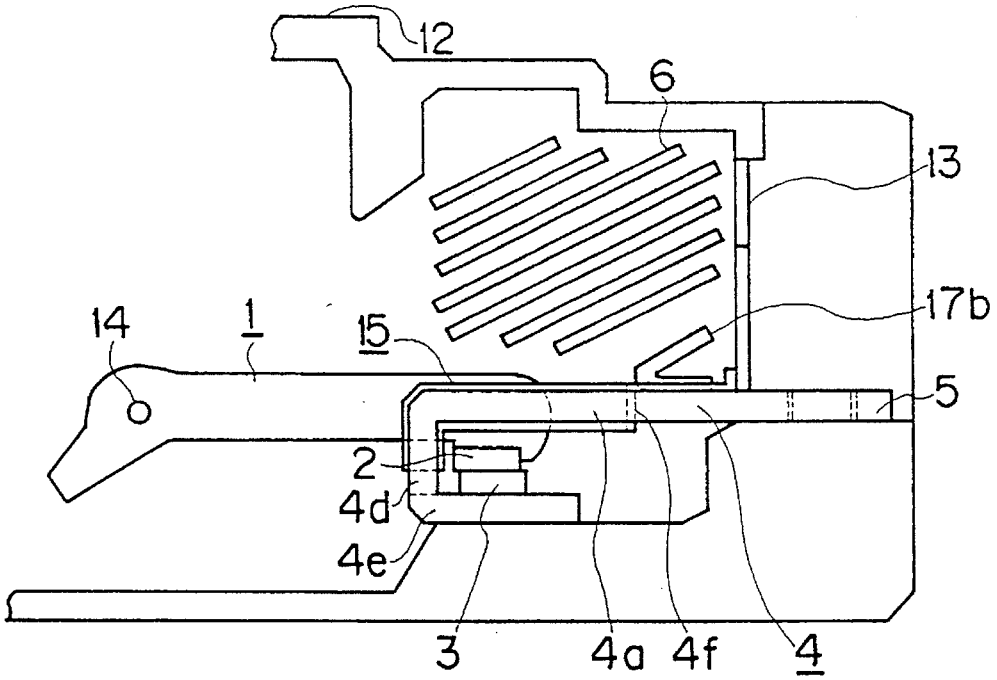
Figure 261:
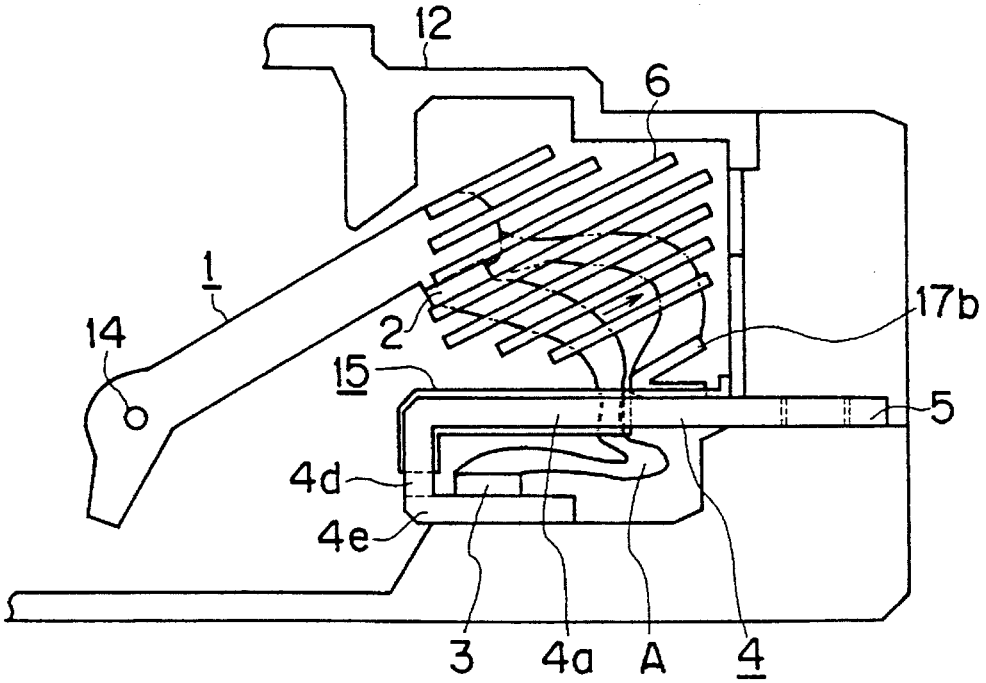
Figure 262A:
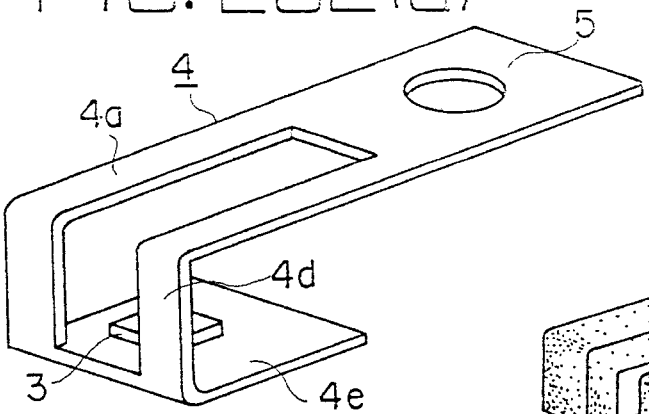
Figure 262B:
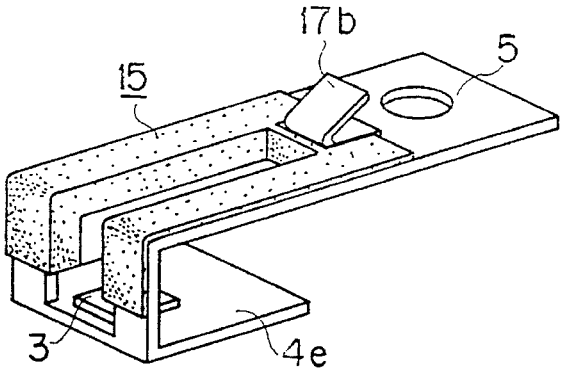
Figure 263A:
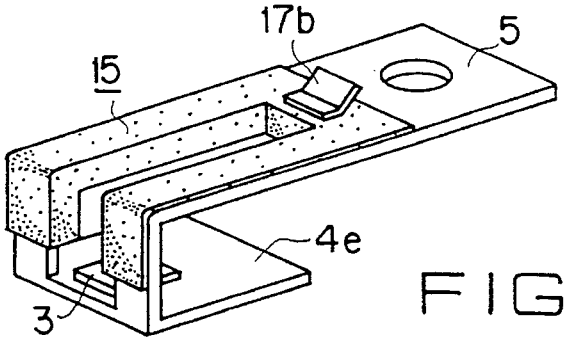
Figure 263B:
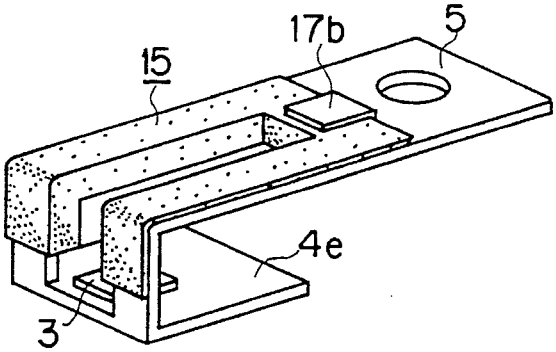
Figure 263C:
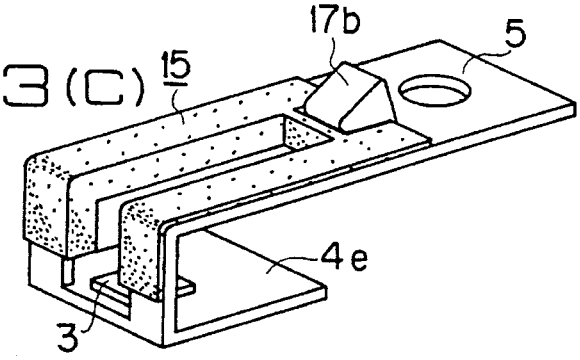
Figure 264:
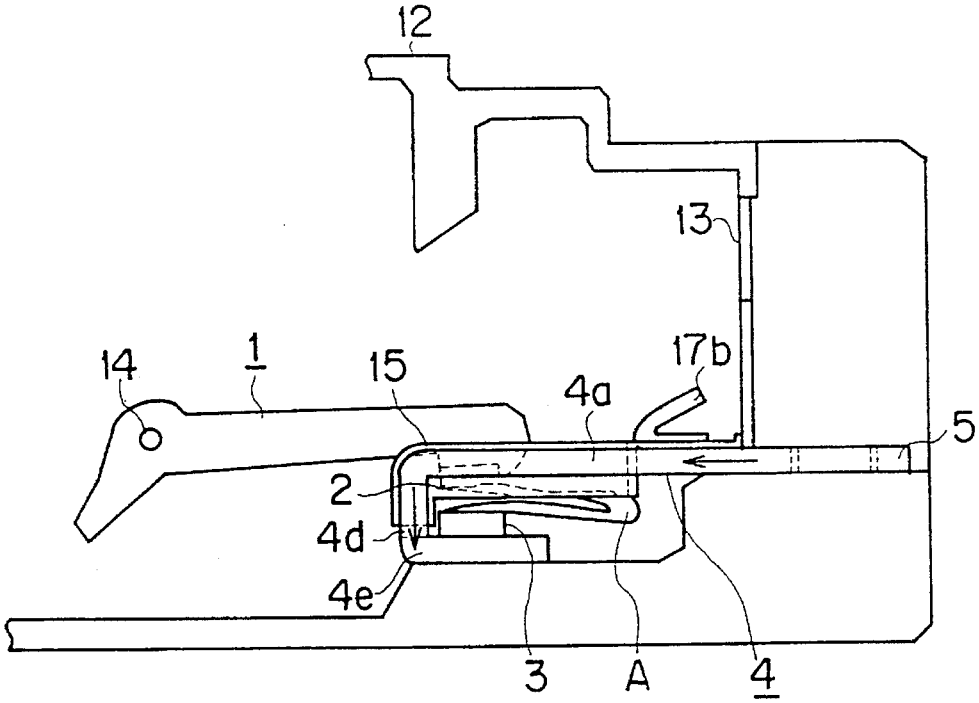
Figure 265:
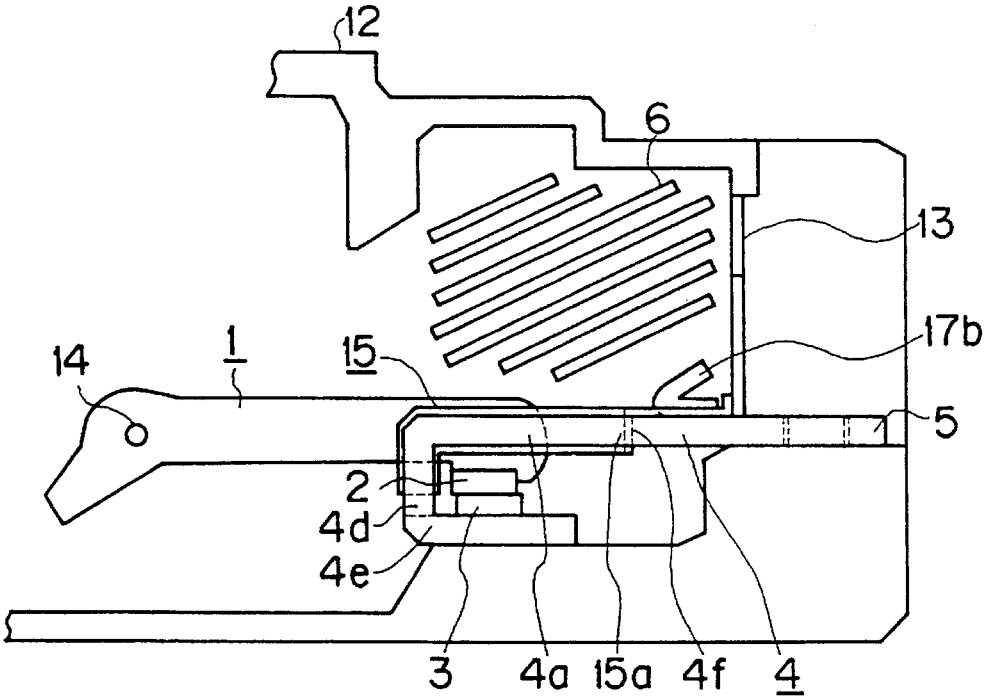
Figure 266A:
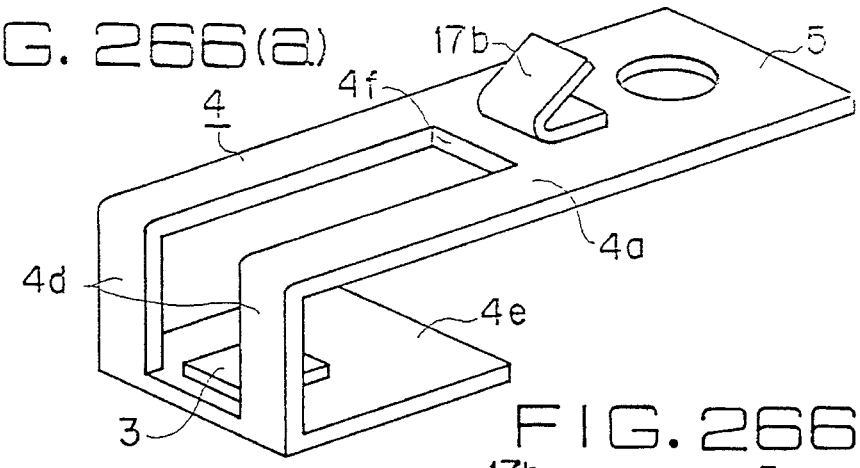
Figure 266B:
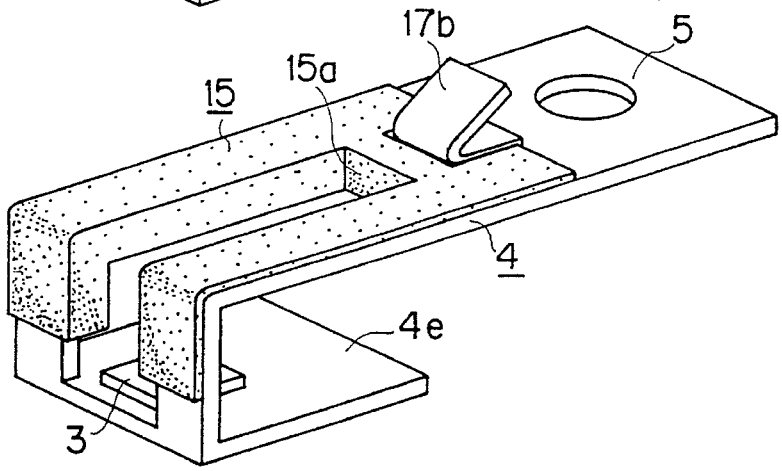
Figure 267:
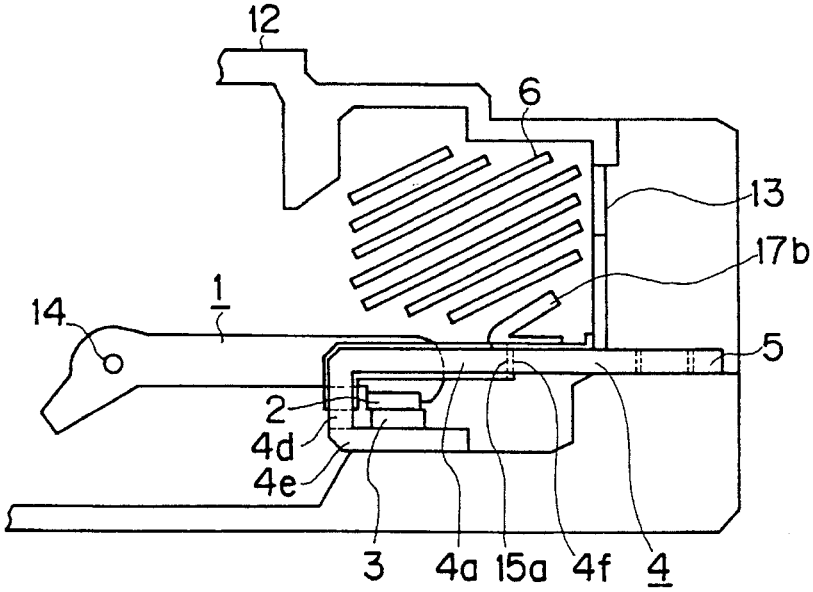
Figure 268A:
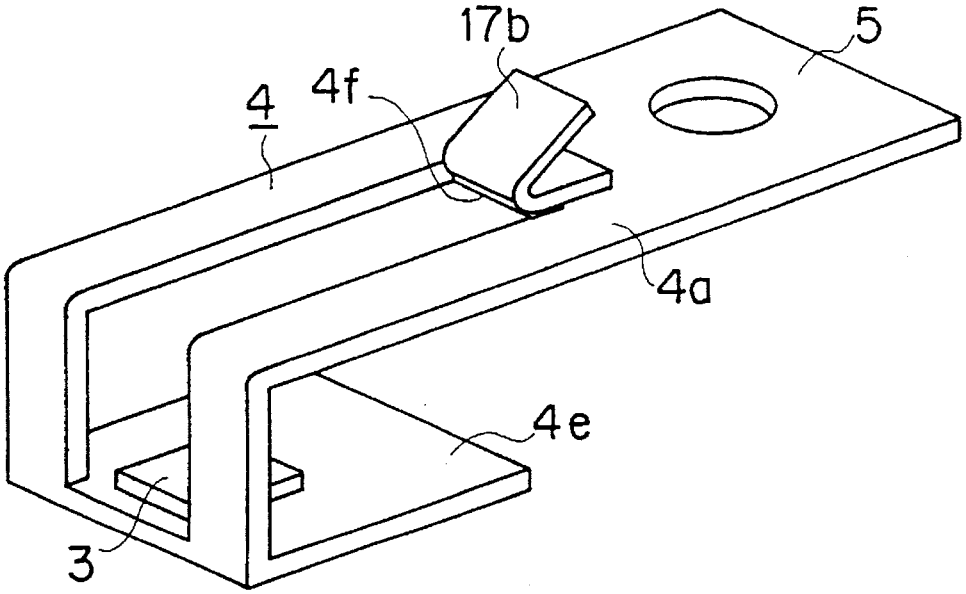
Figure 268B:
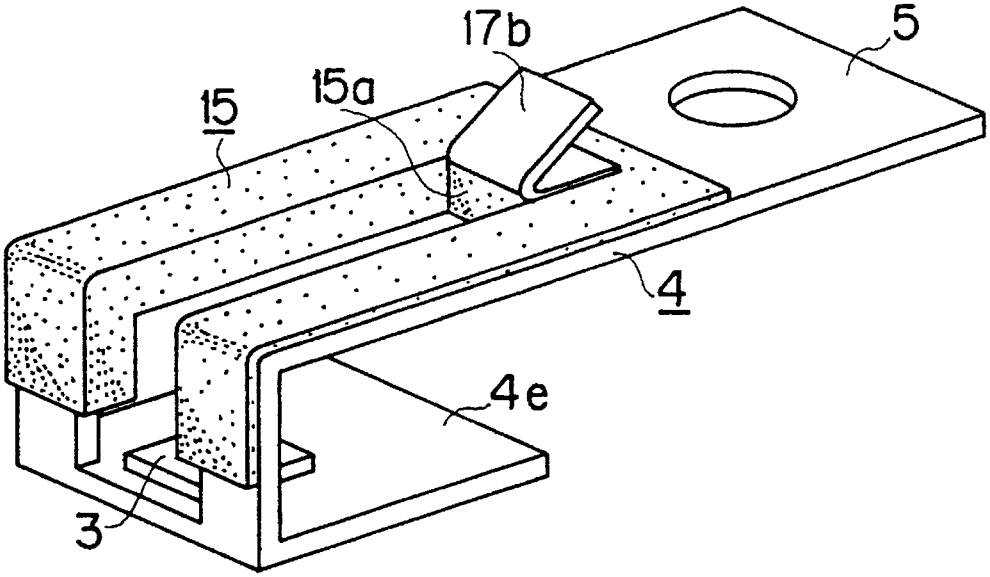
Figure 270:
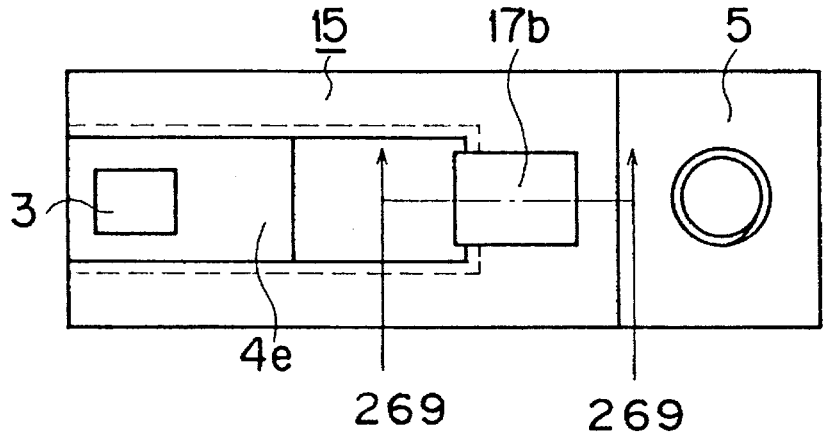
Figure 271:
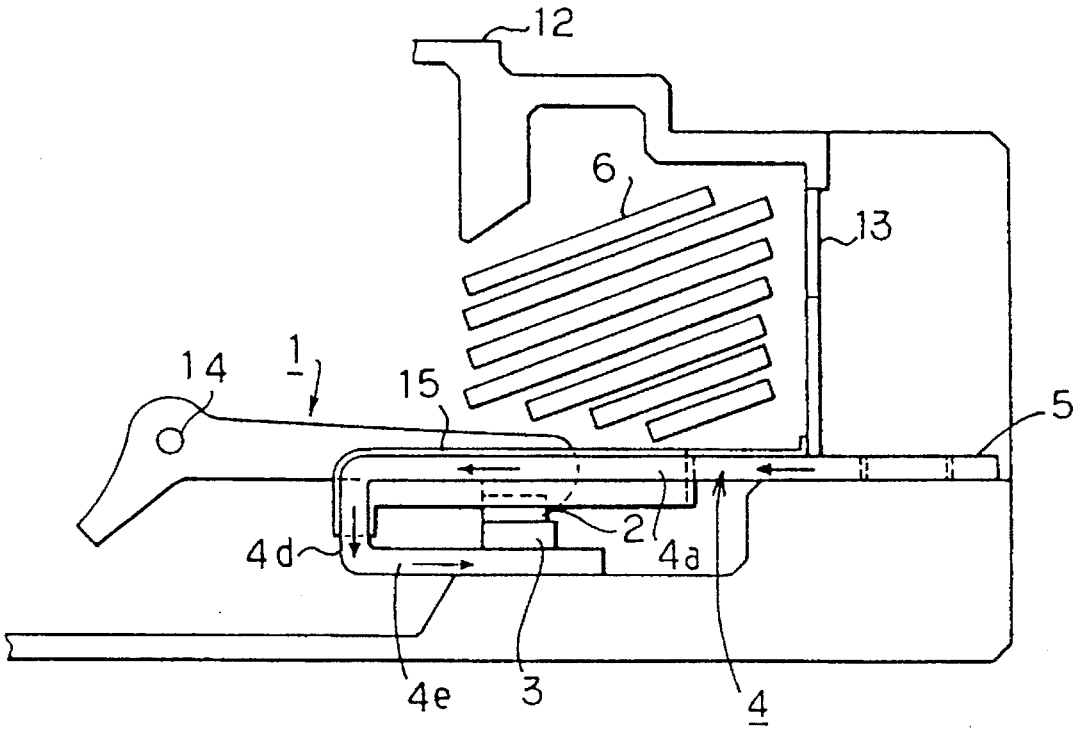
Figure 272:
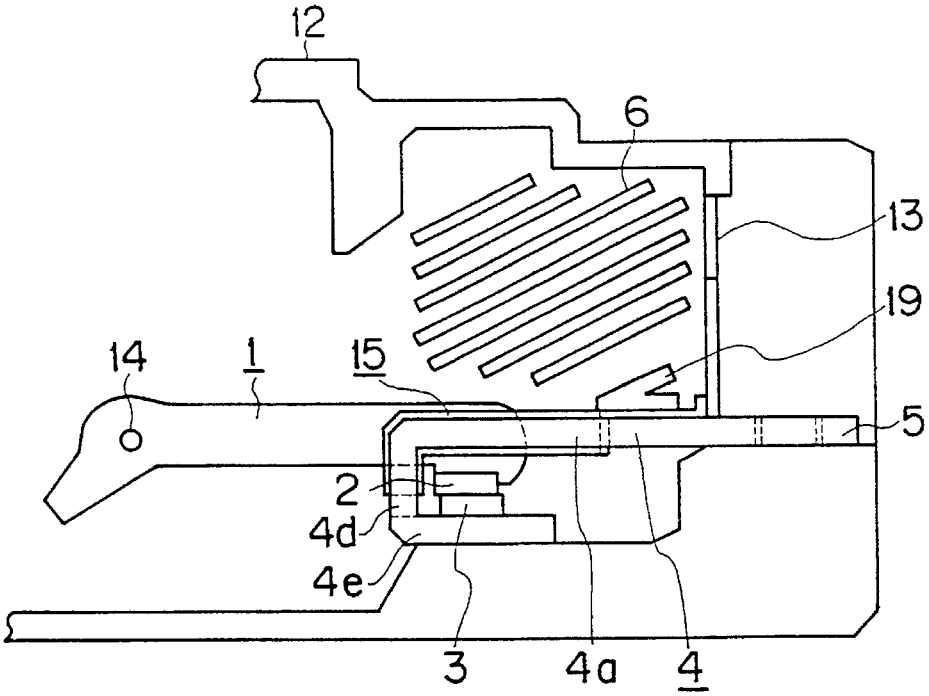
Figure 273:
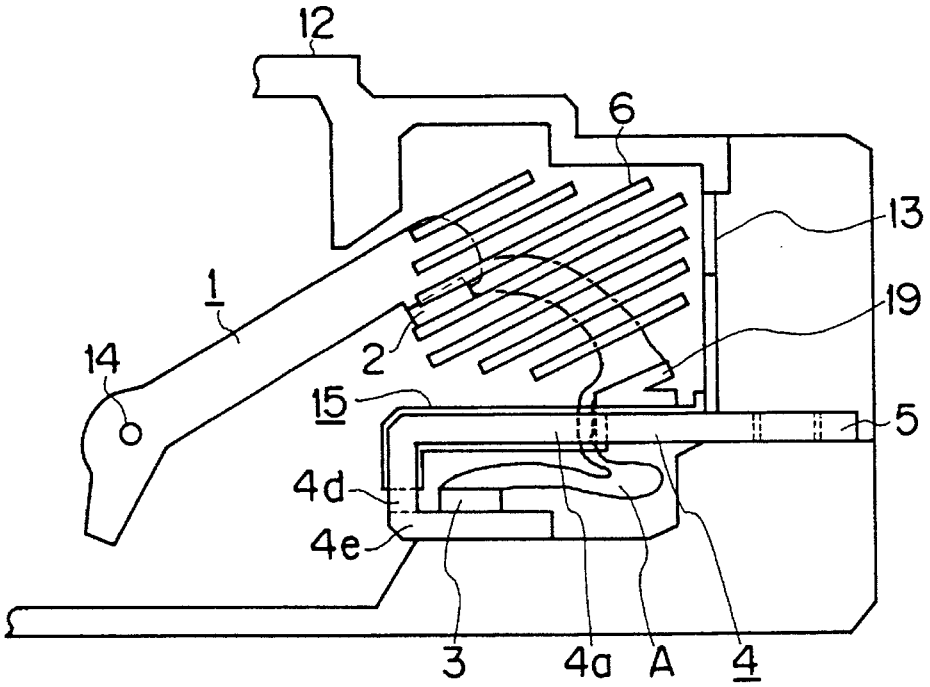
Figure 274A:
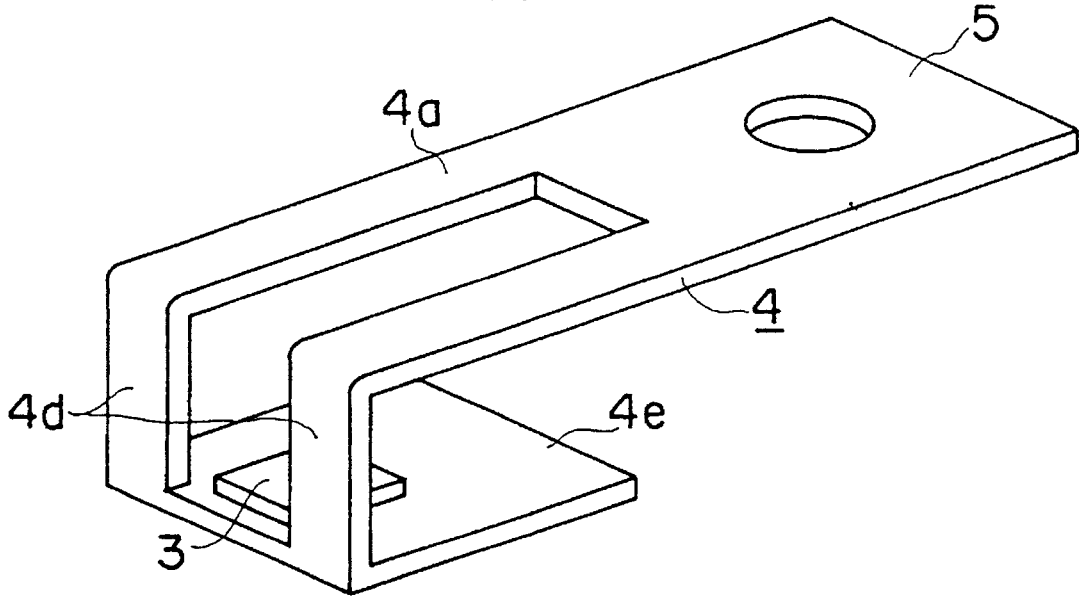
Figure 274B:
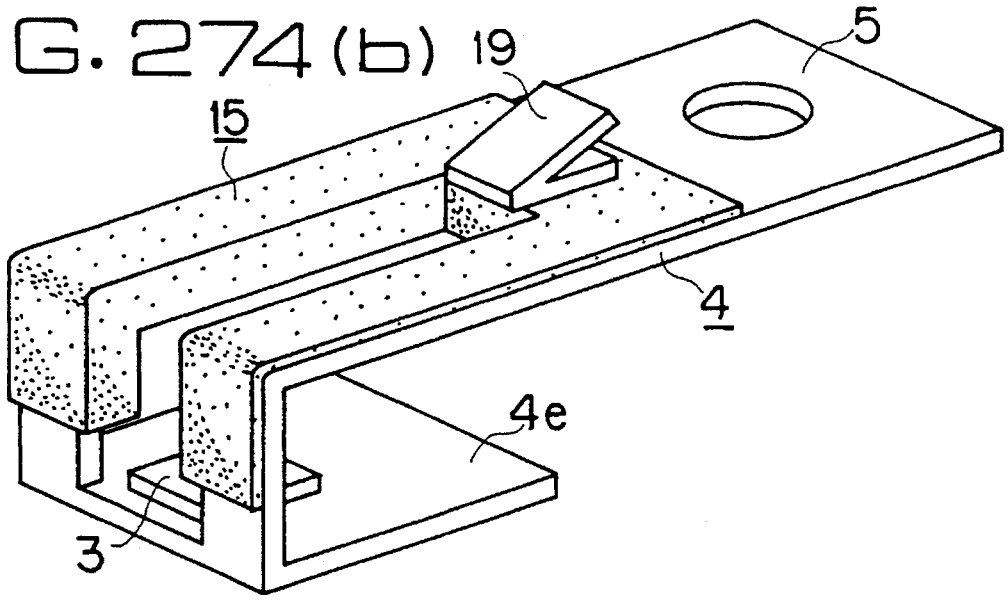
Figure 275:
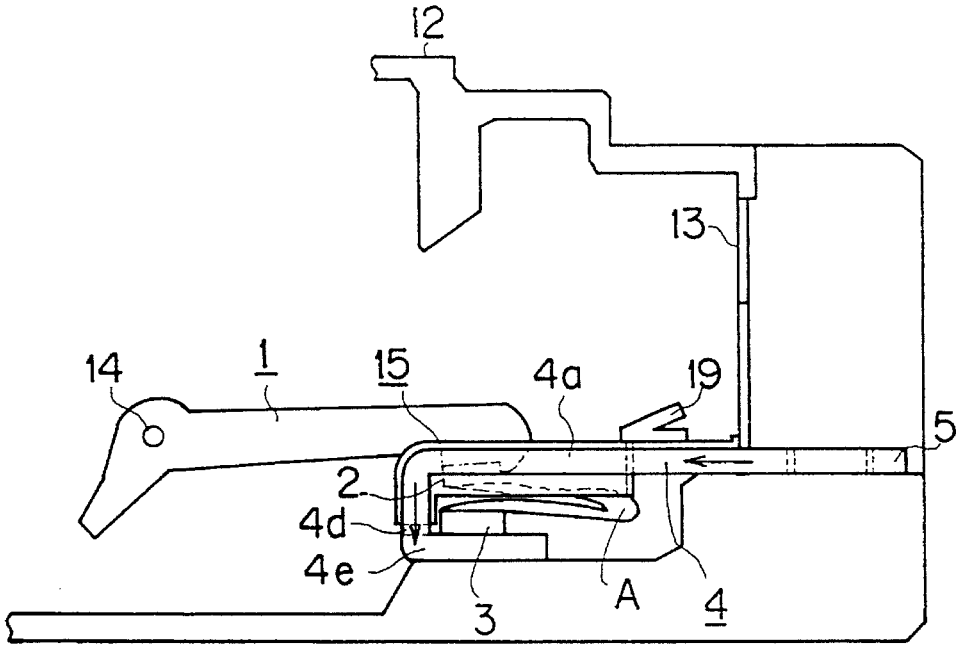
Figure 276:
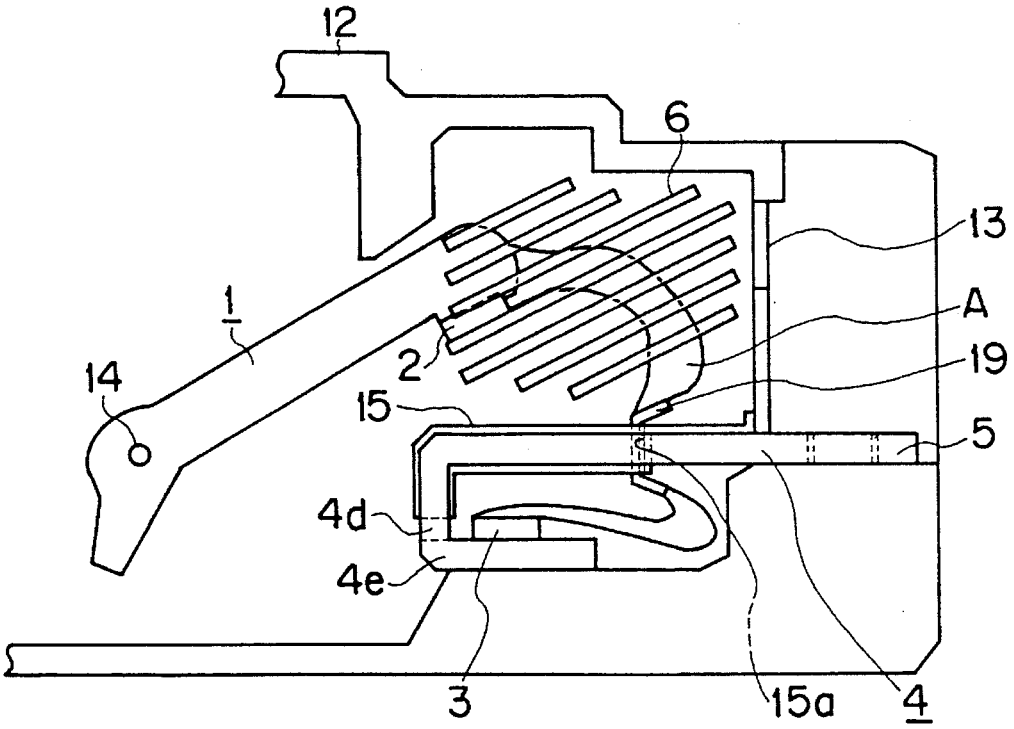
Figure 277A:
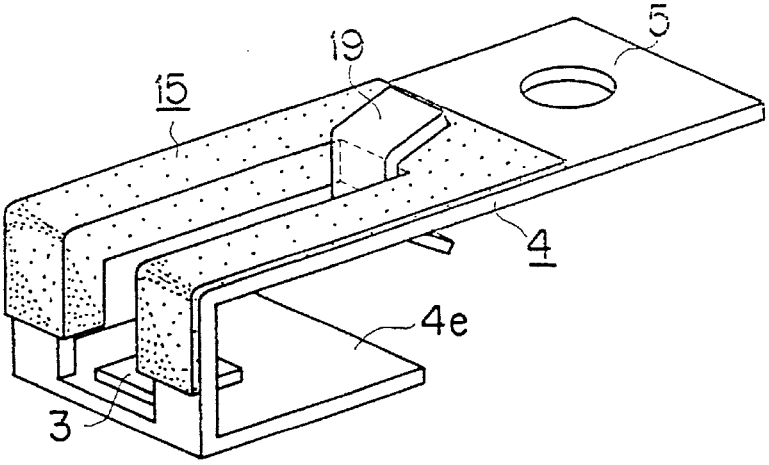
Figure 277B:
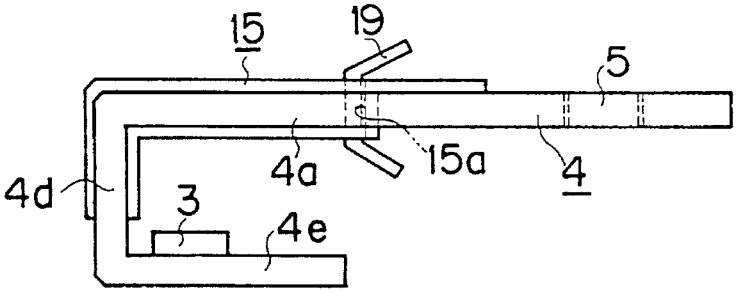
Figure 278:
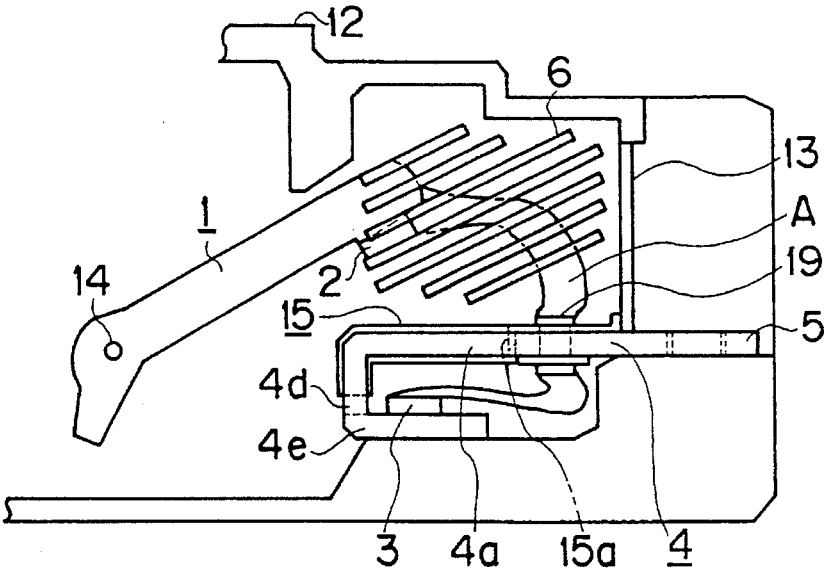
Figure 279A:
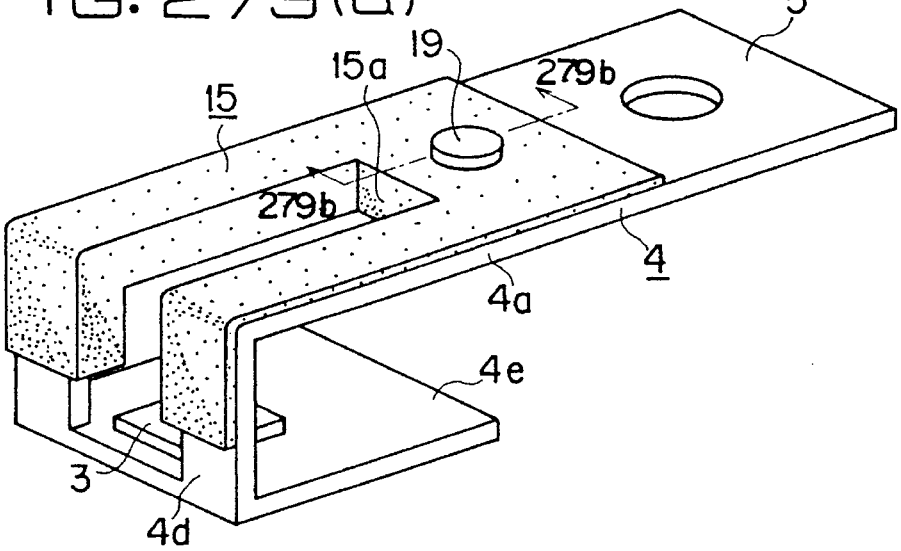
Figure 279B:
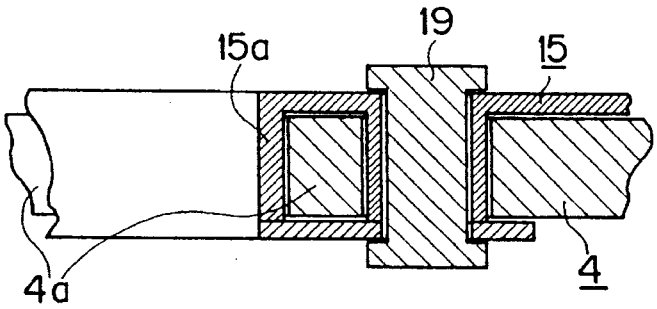
Figure 280:
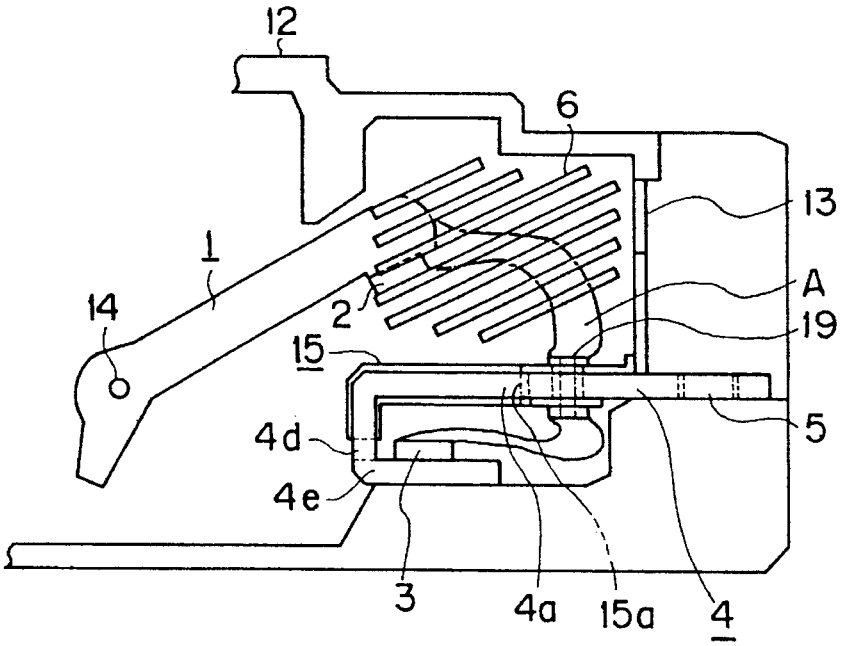
Figure 281A:
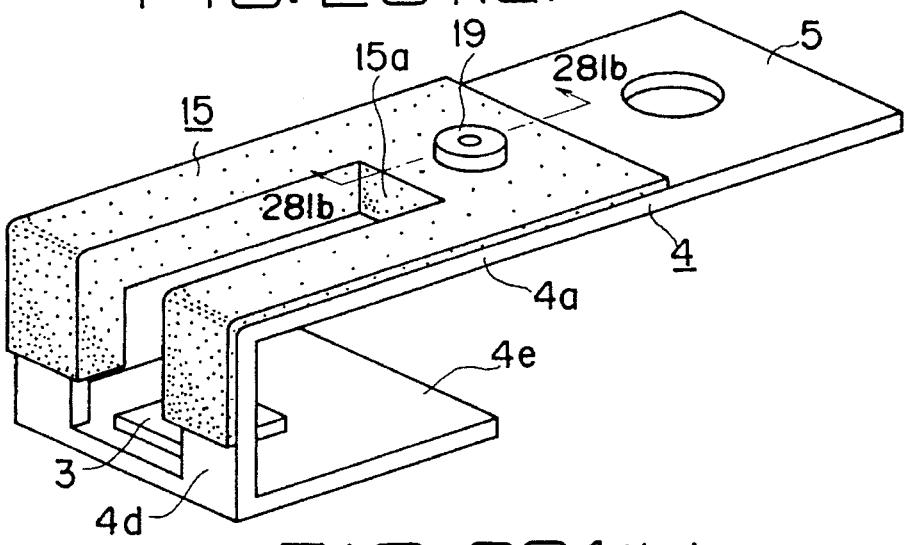
Figure 281B:
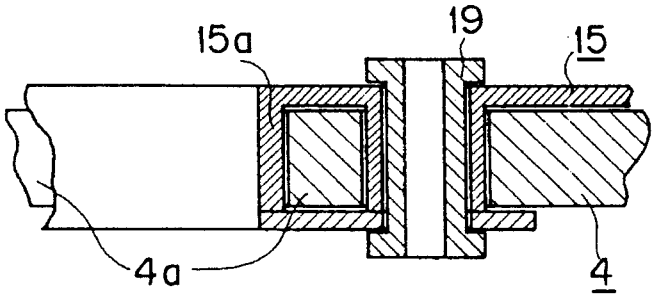
Figure 282:
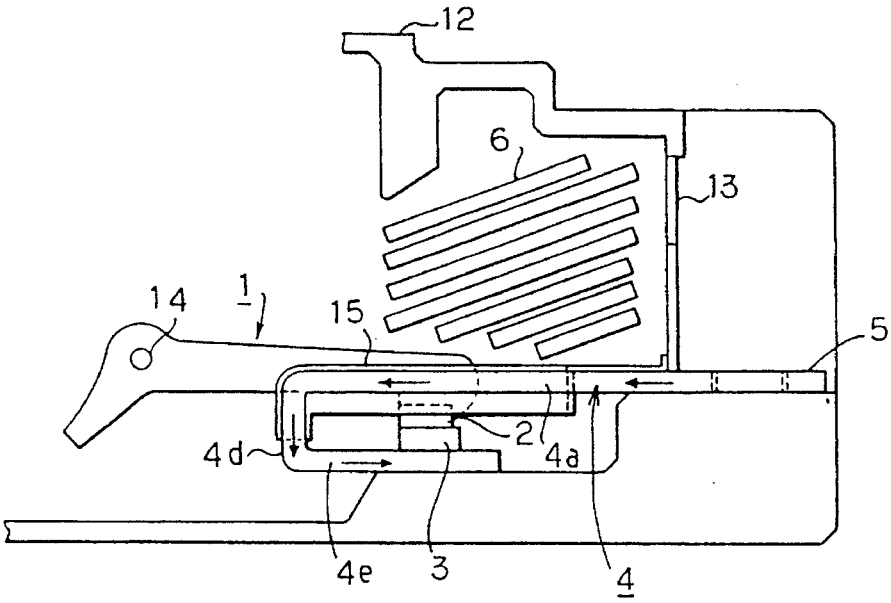
Figure 283:
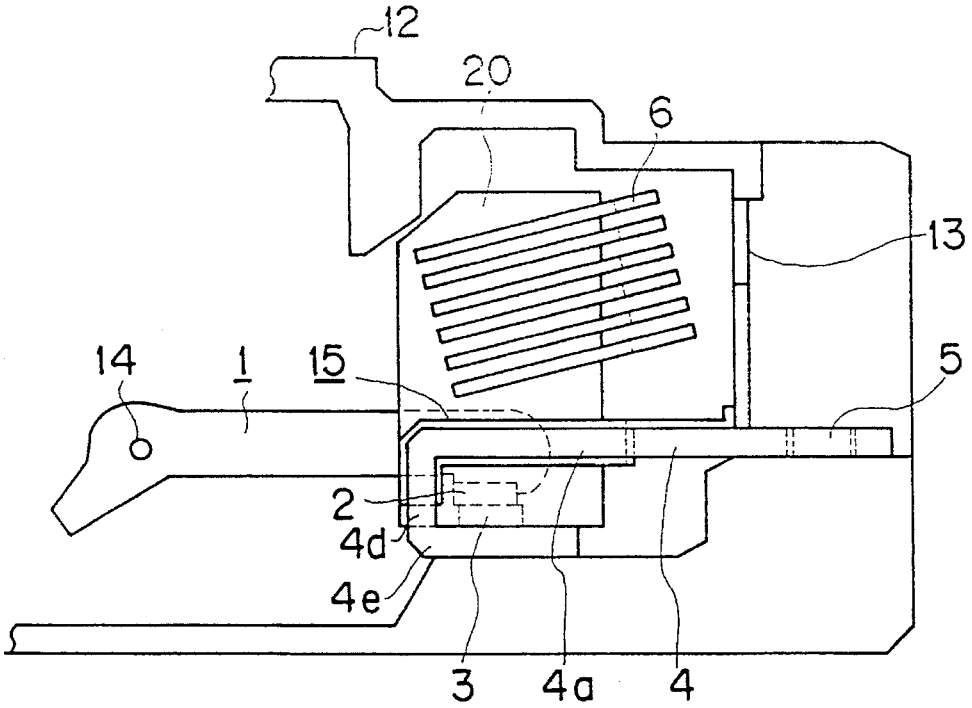
Figure 284:
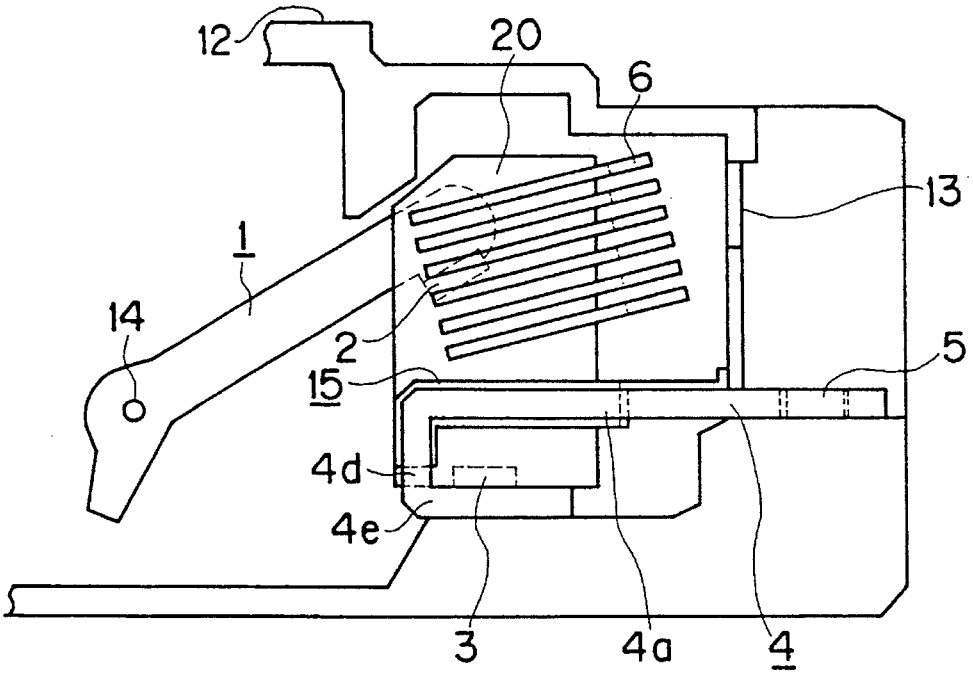
Figure 287:
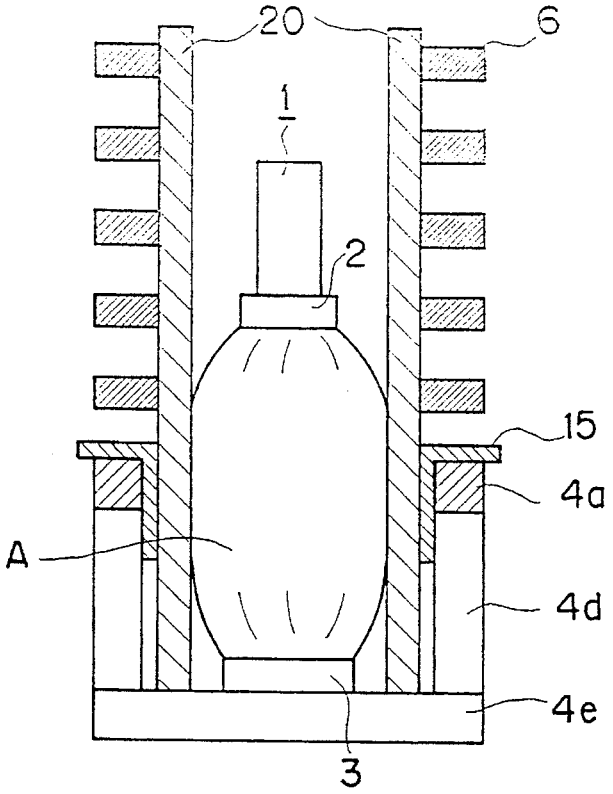
Figure 288:
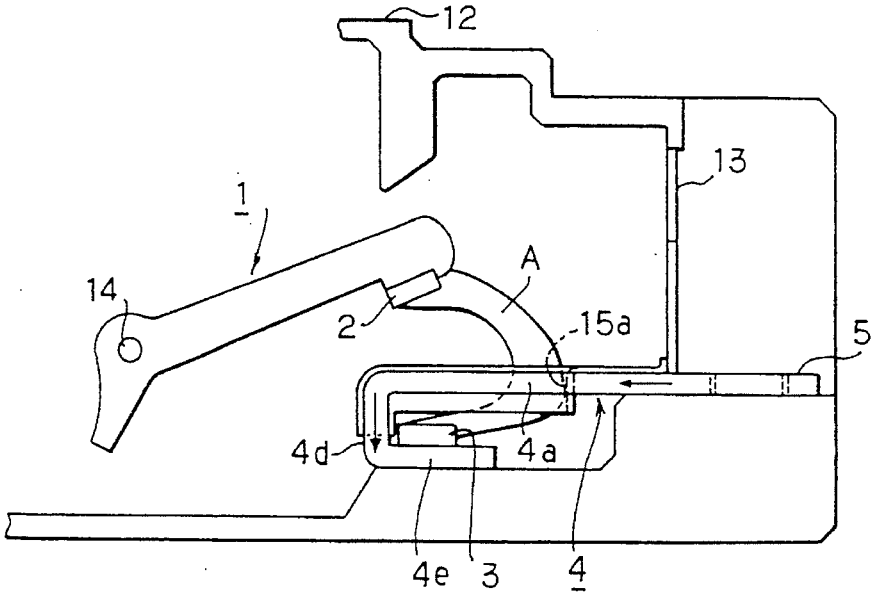
Figure 289:
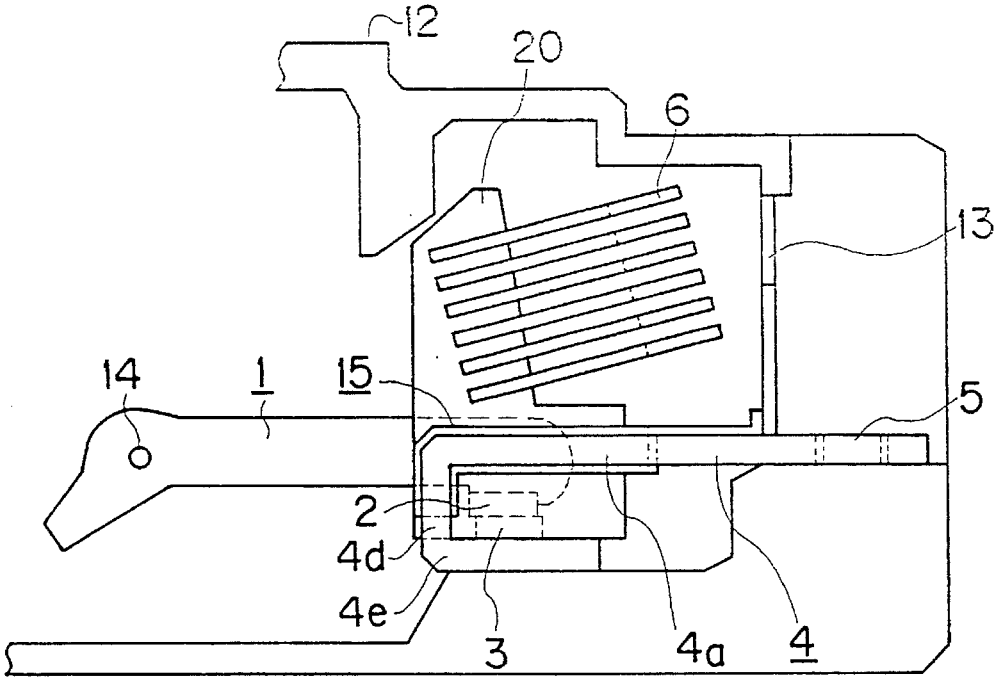
Figure 290:
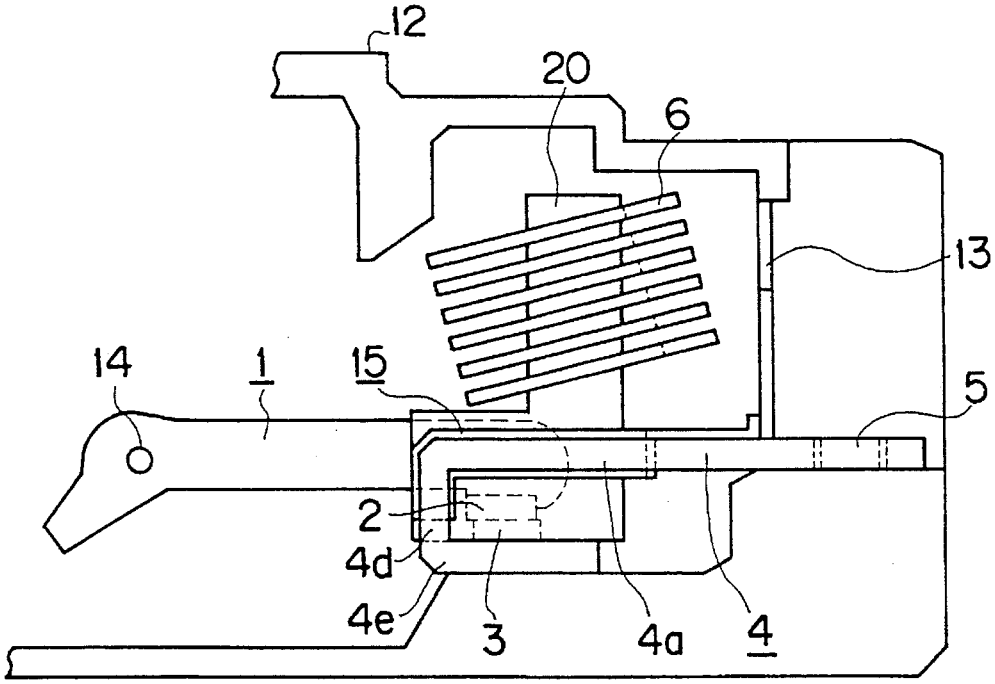
Figure 291:
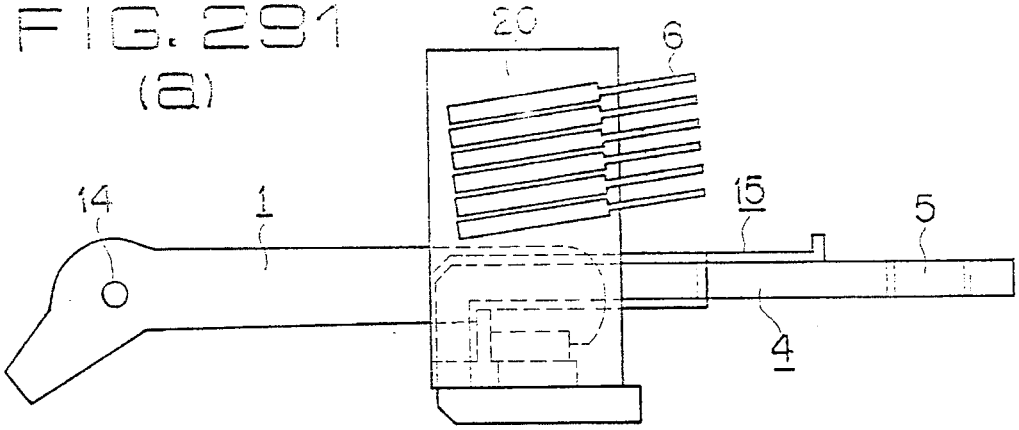
Figure 291:
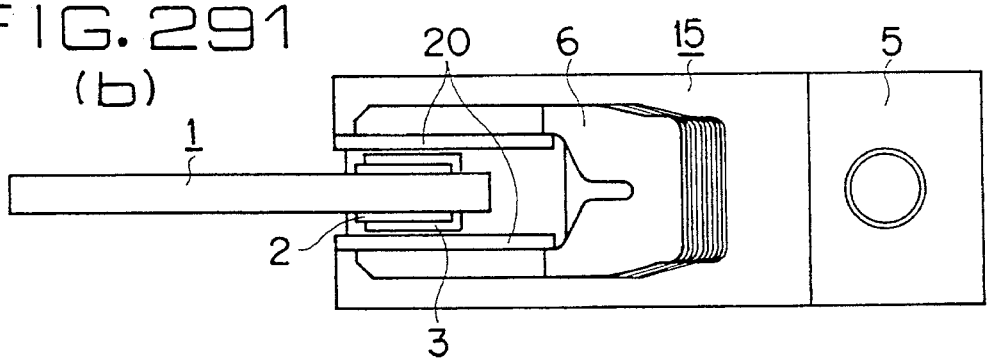
Figure 292A:
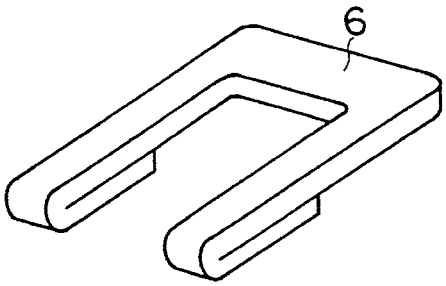
Figure 292B:
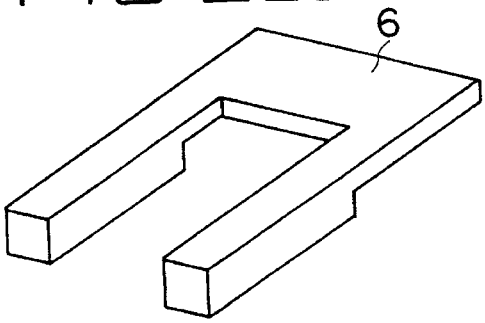
Figure 292C:
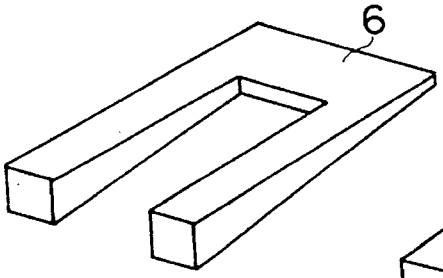
Figure 292D:
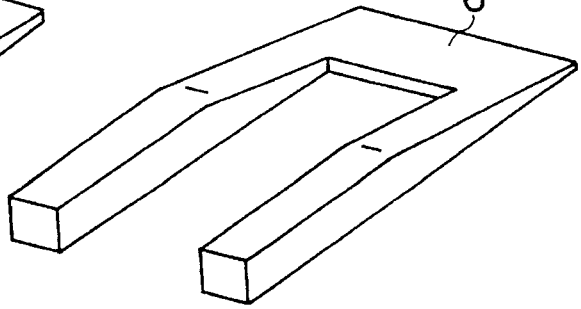
Figure 293A:
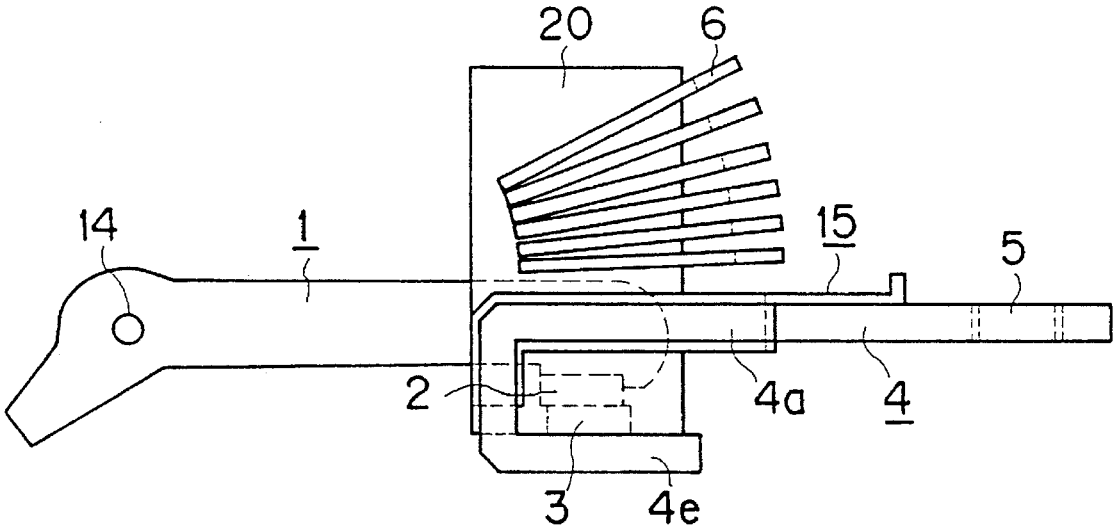
Figure 293B:
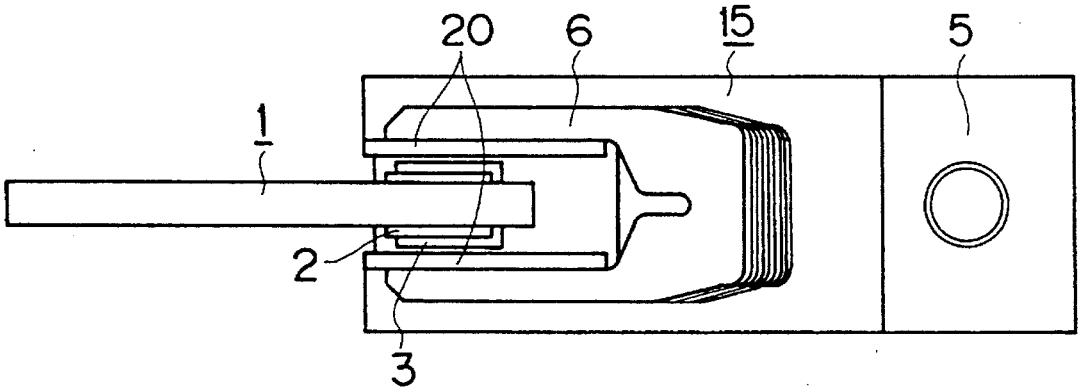
Figure 294A:
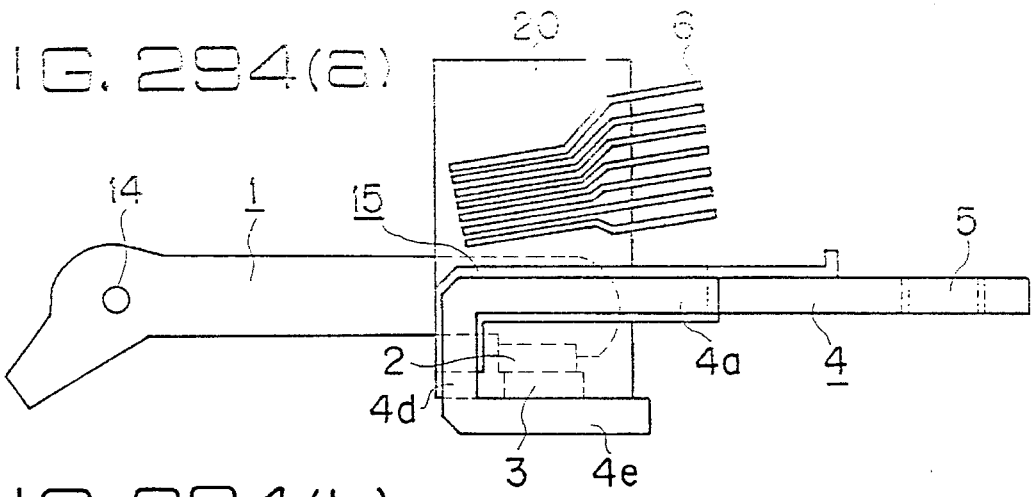
Figure 294B:
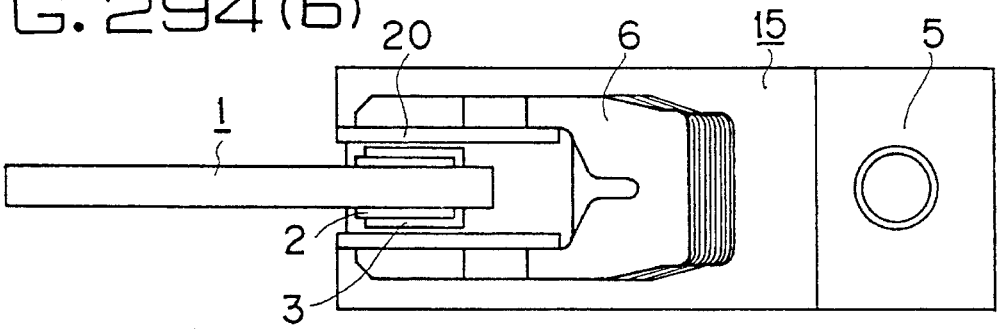
Figure 295:
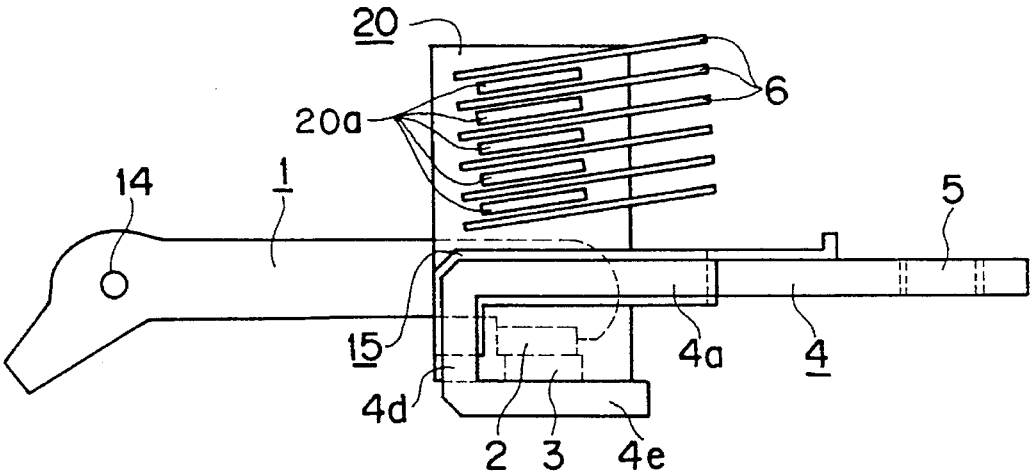
Figure 296:
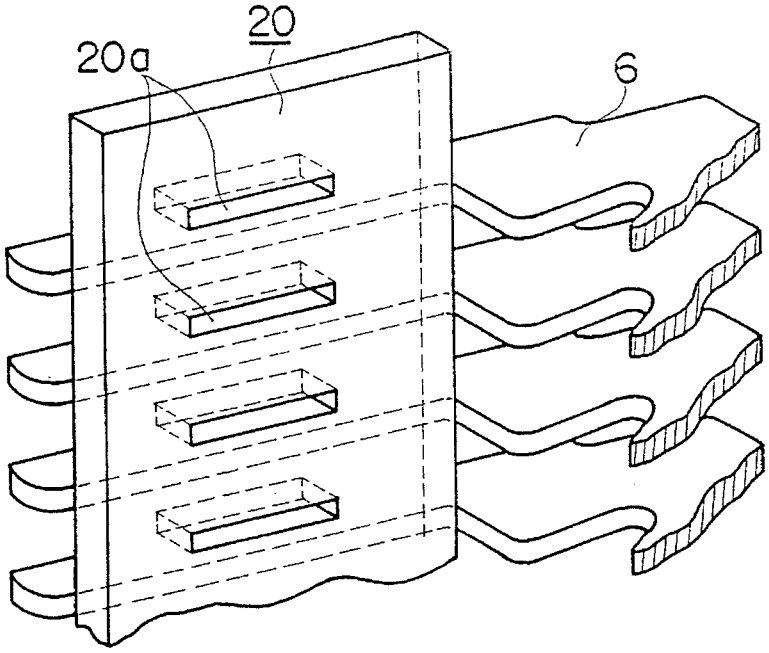
Figure 297:
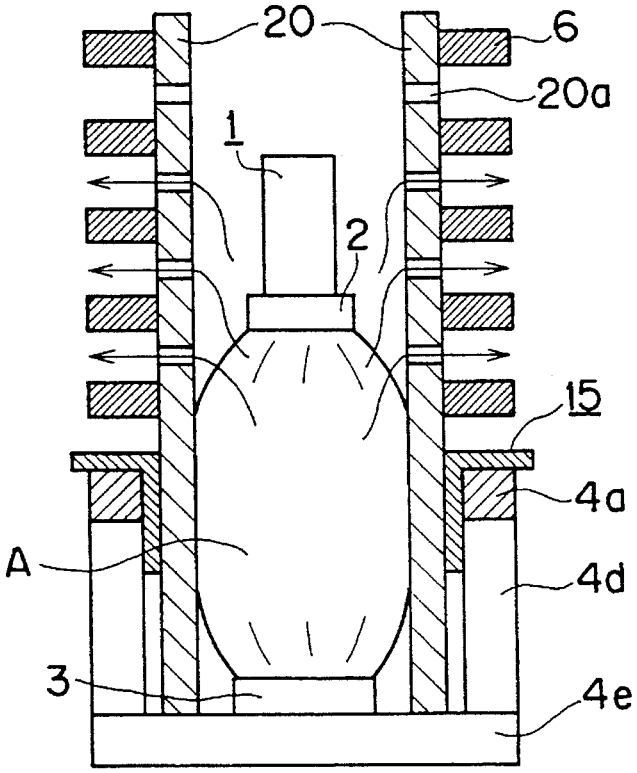
Figure 298:
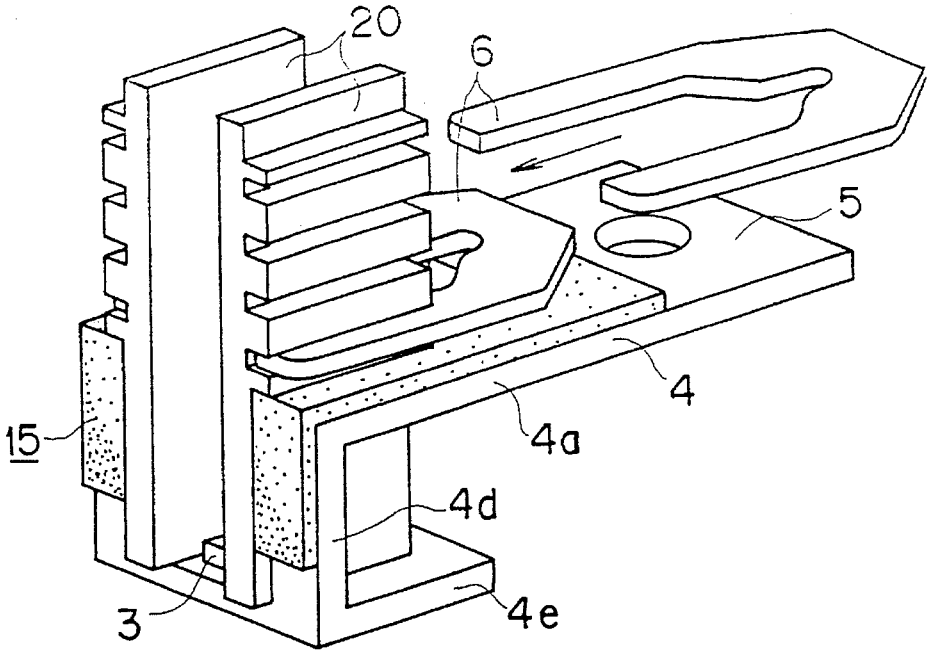
Figure 299:
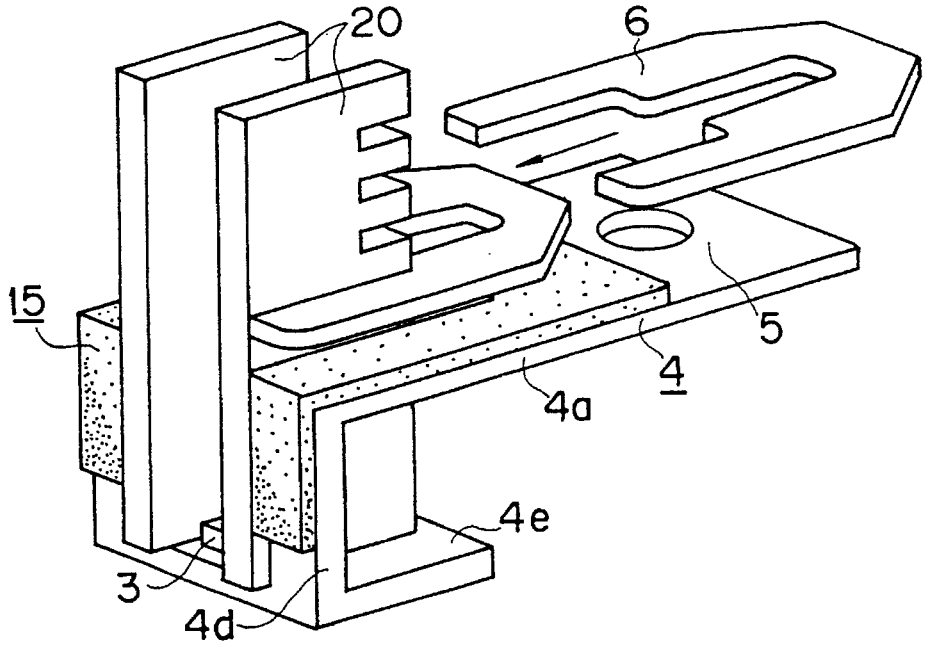
Figure 300:
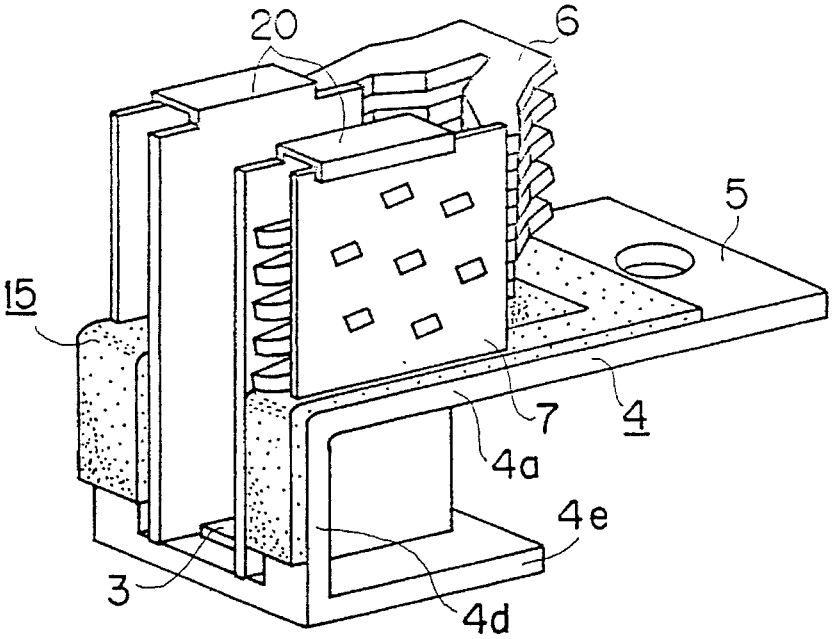
Figure 301:
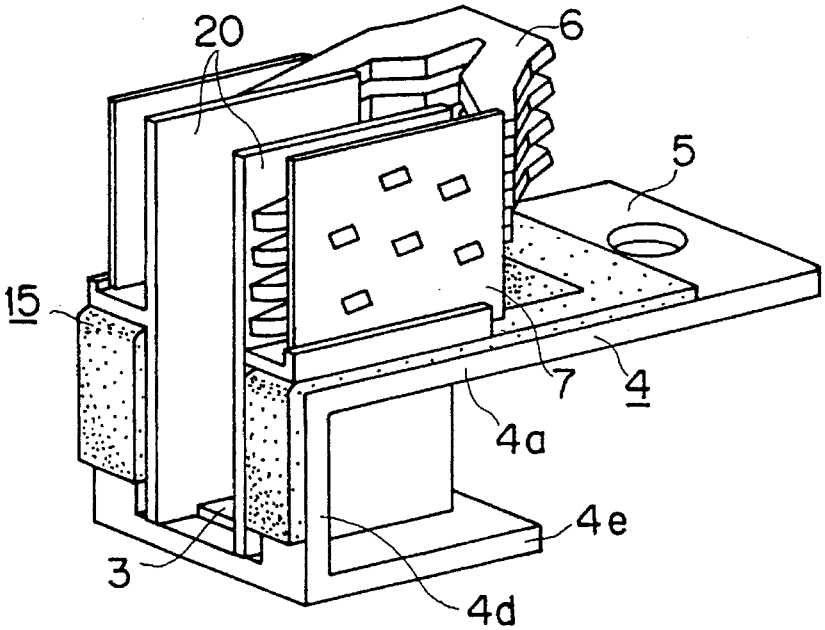
Figure 302:
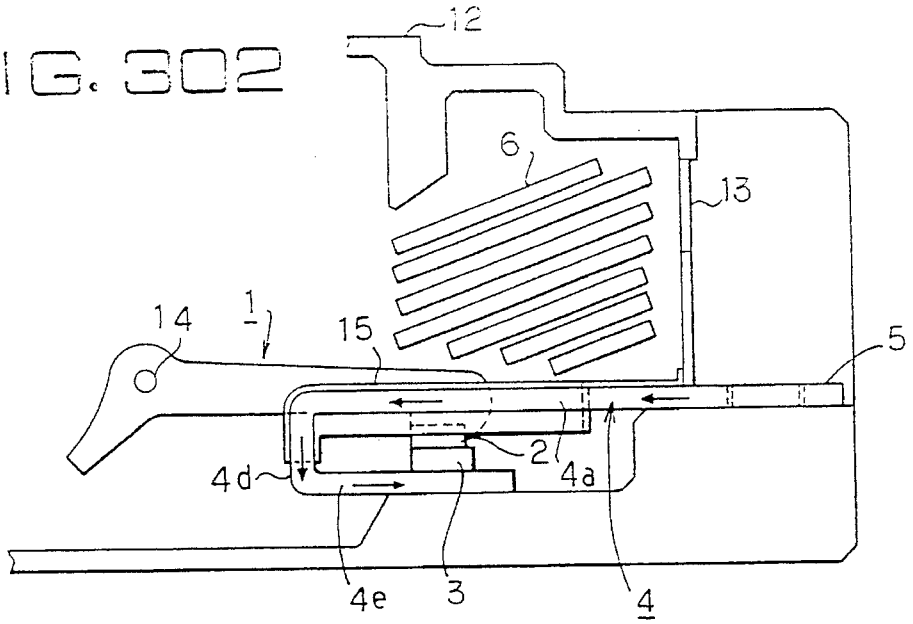
Figure 303:
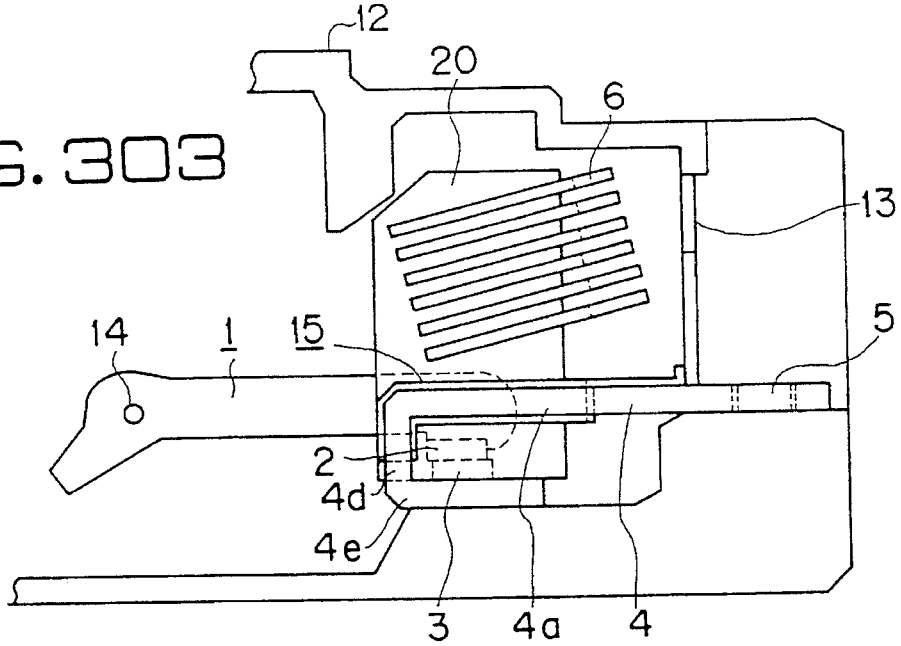
Figure 304:
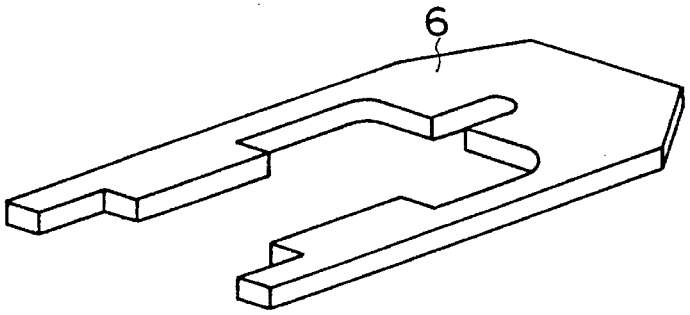
Figure 305:
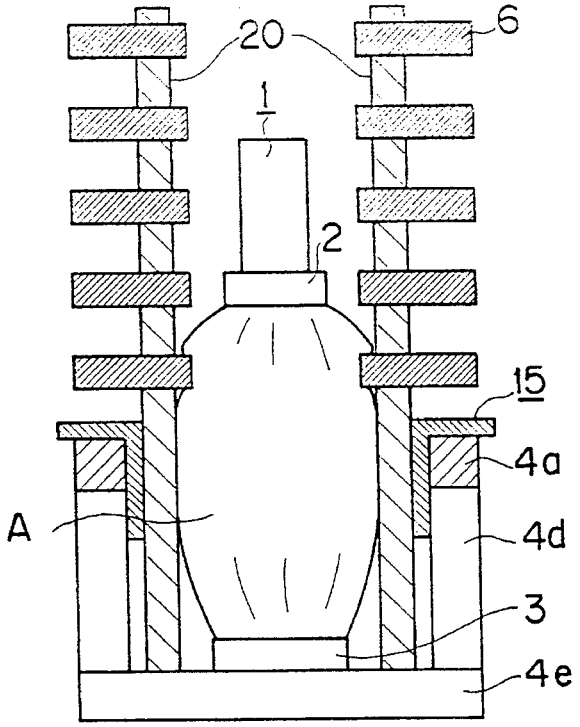
Figure 306:
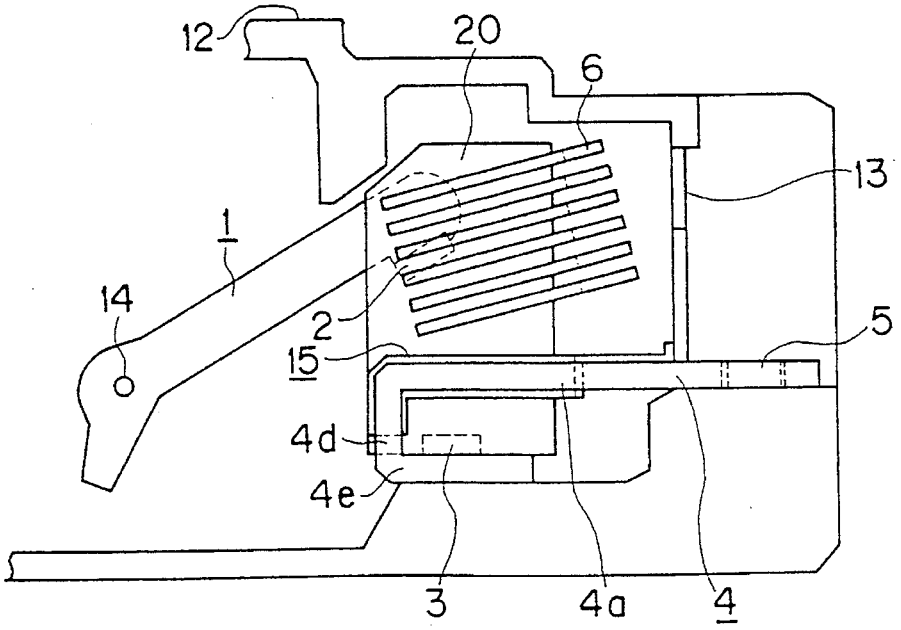
Figure 307A:
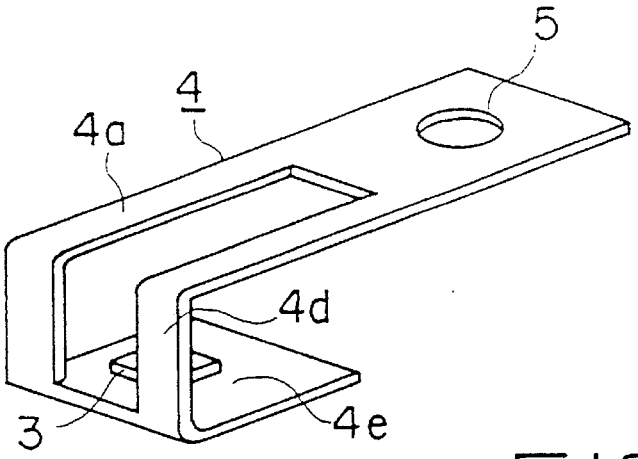
Figure 307B:
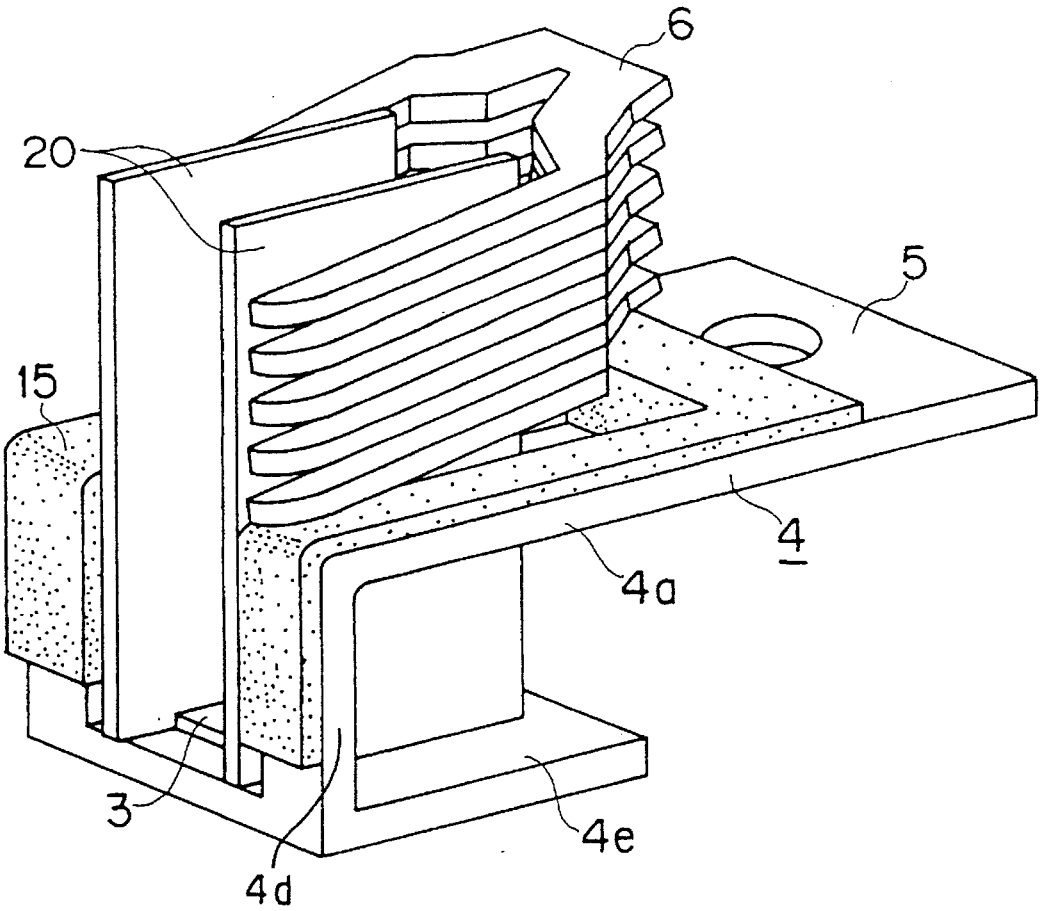
Figure 308:
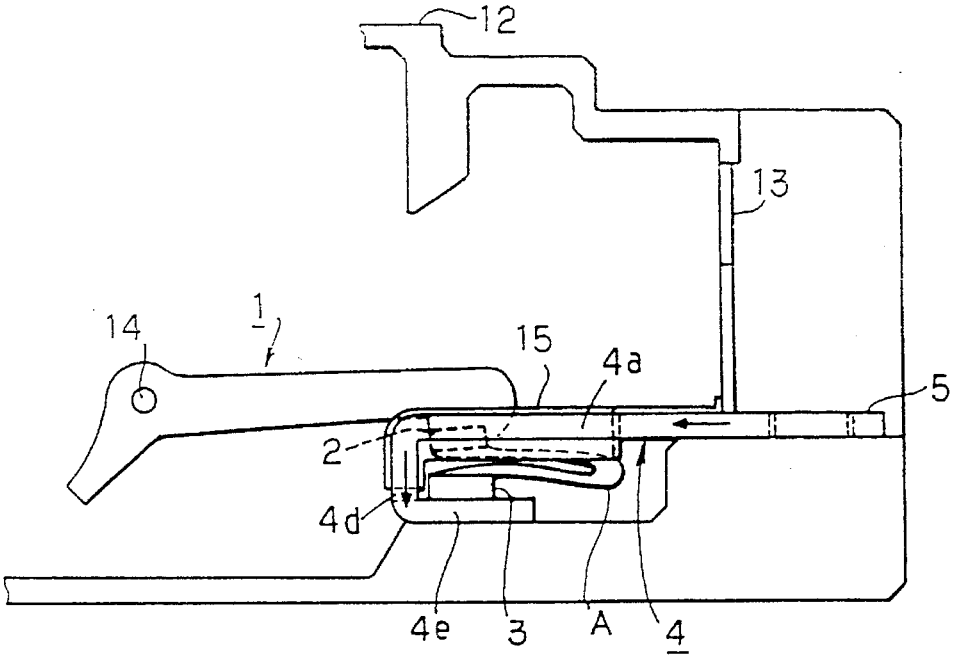
Figure 309:
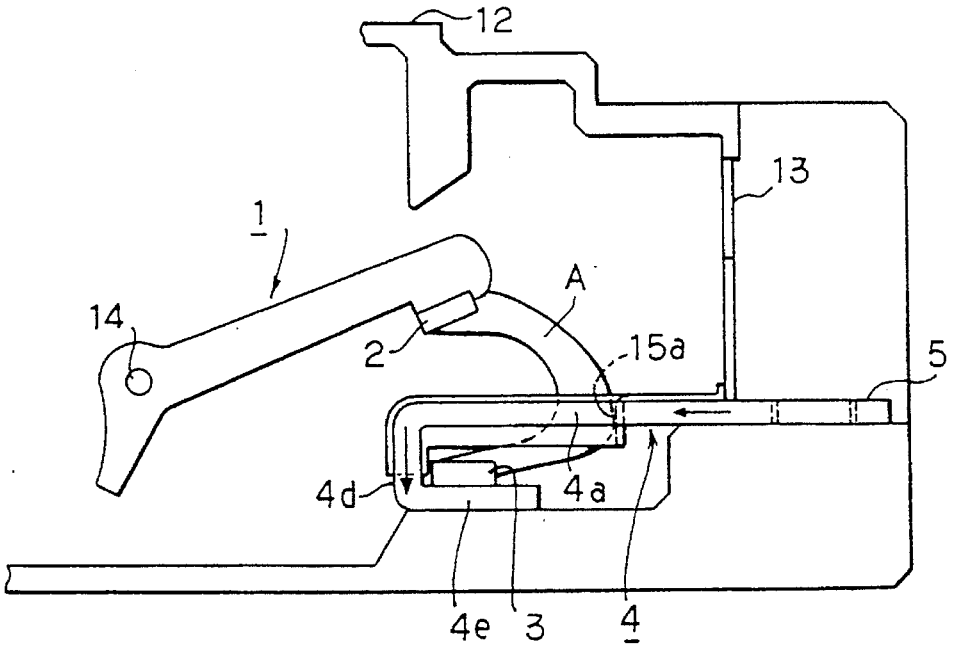
Figure 310:
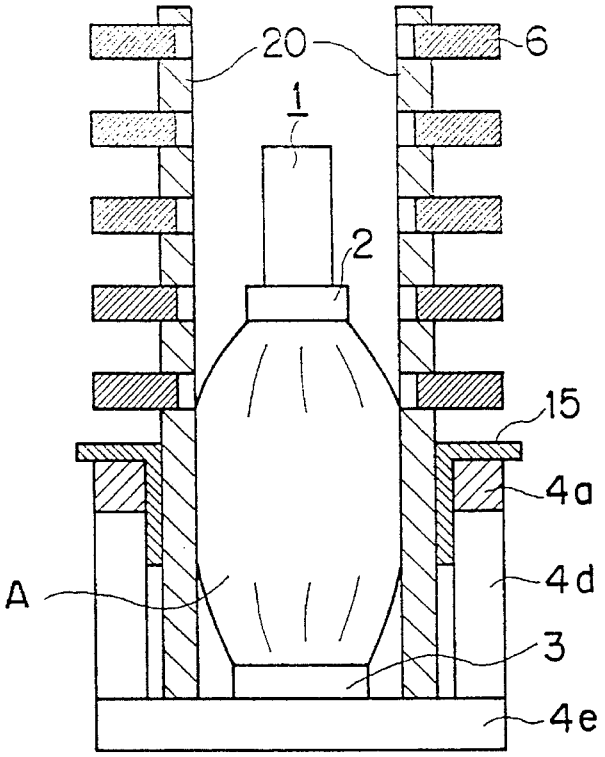
Figure 311:
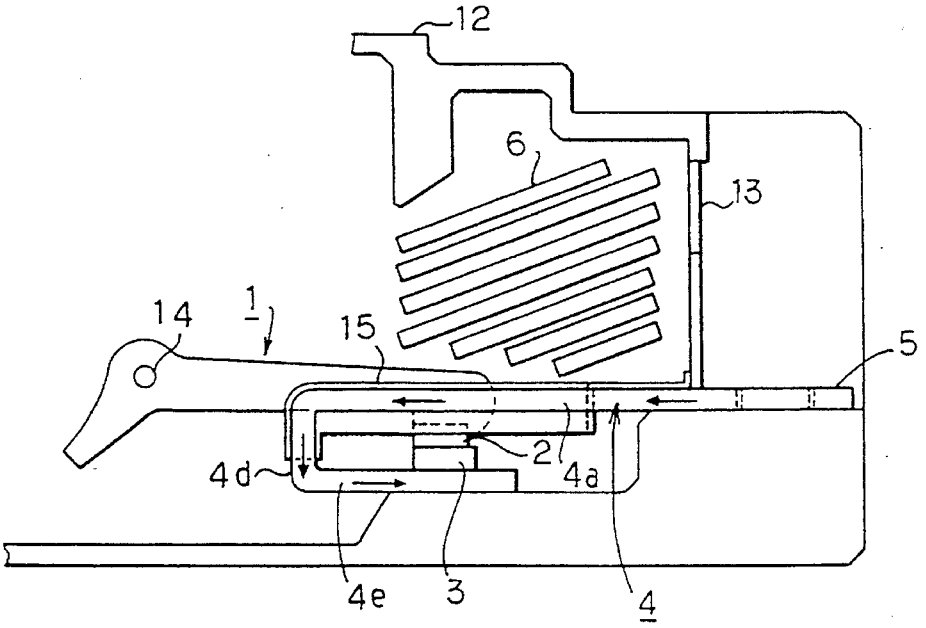
Figure 312:
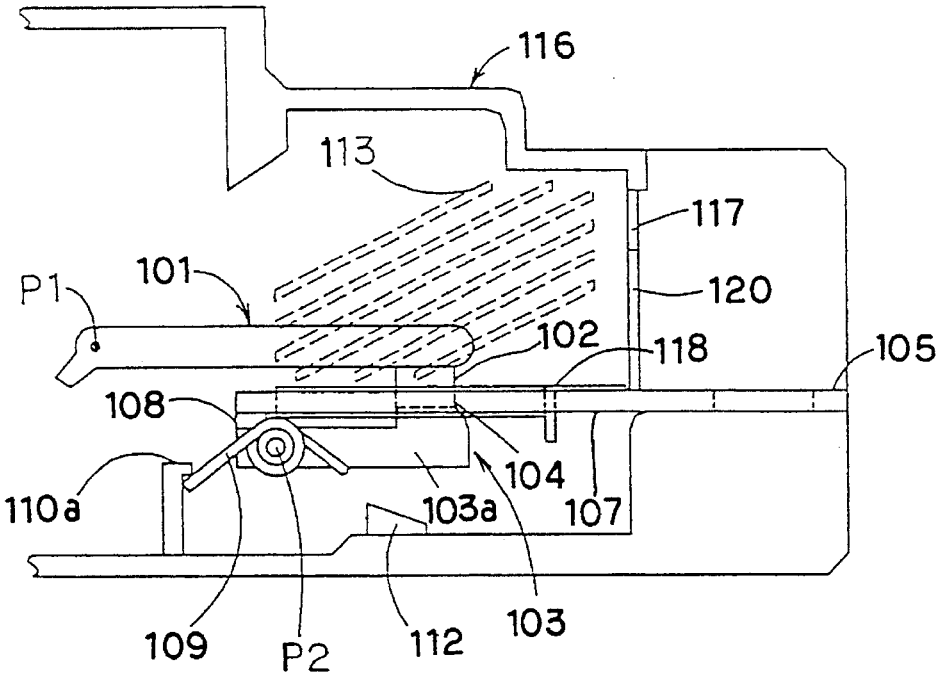
Figure 313:
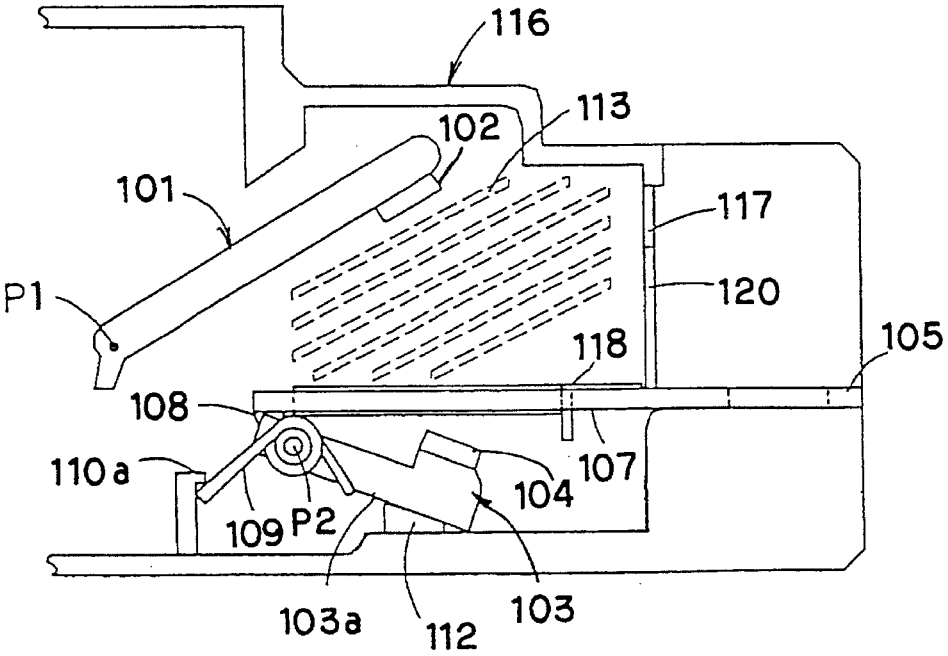
Figure 318:
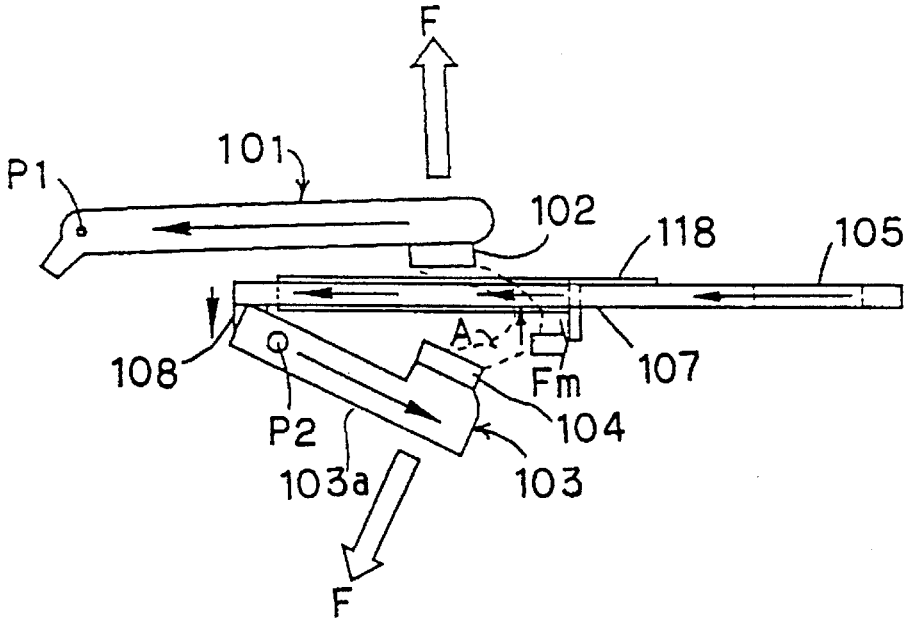
Figure 319:
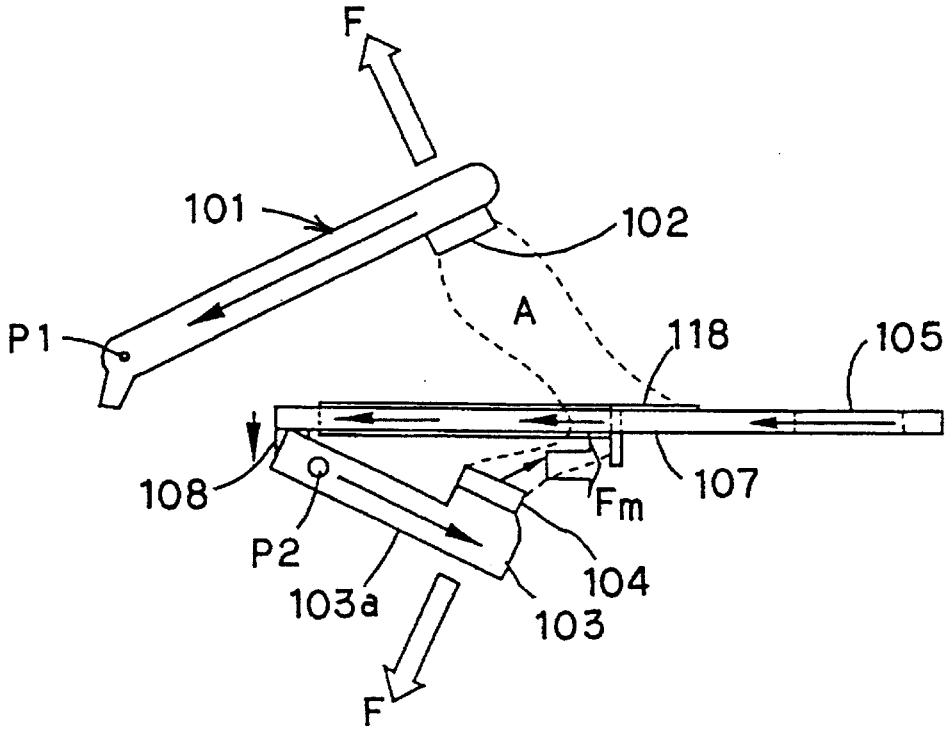
Figure 320:
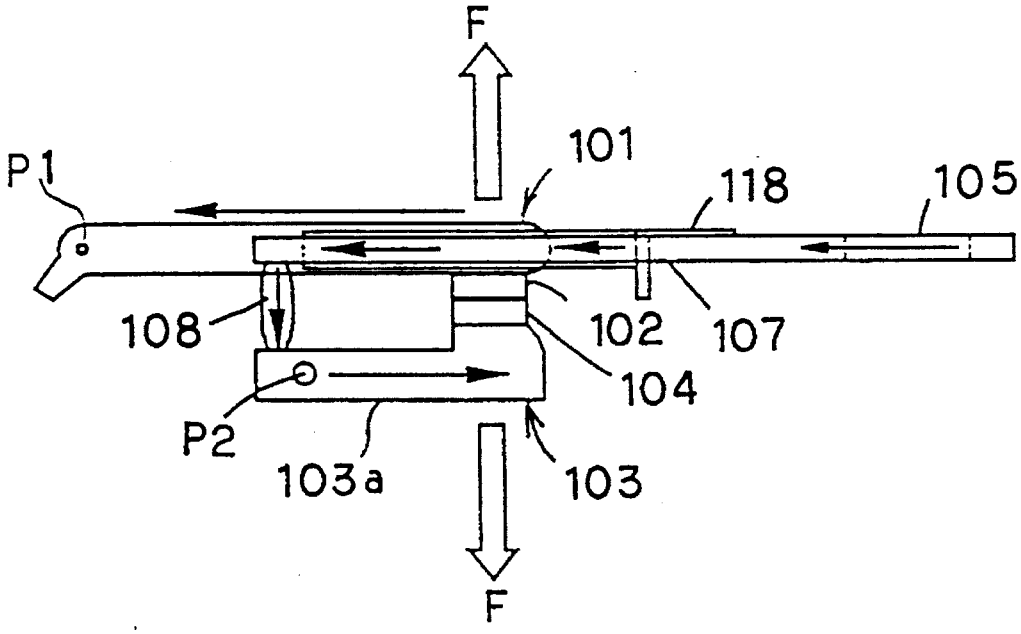
Figure 321:
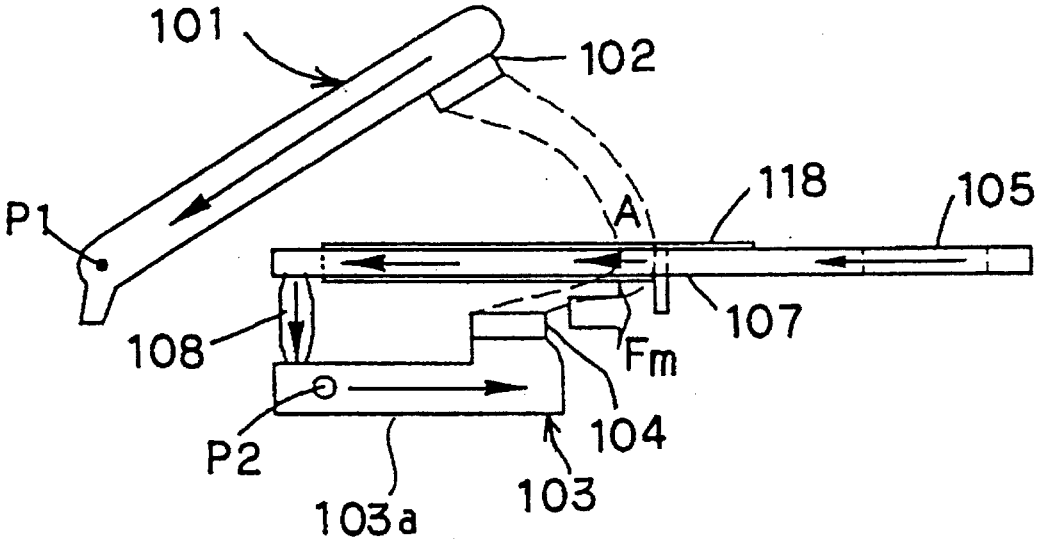
Figure 322:
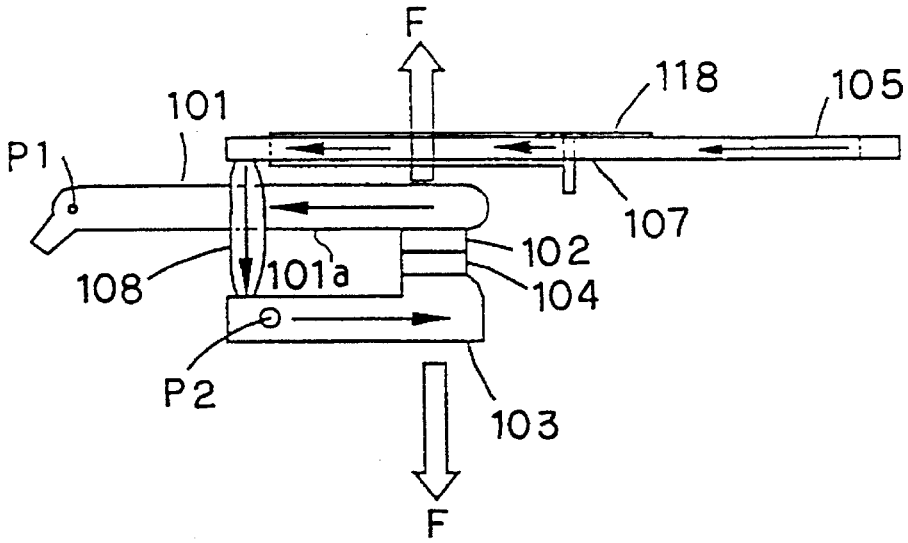
Figure 323:
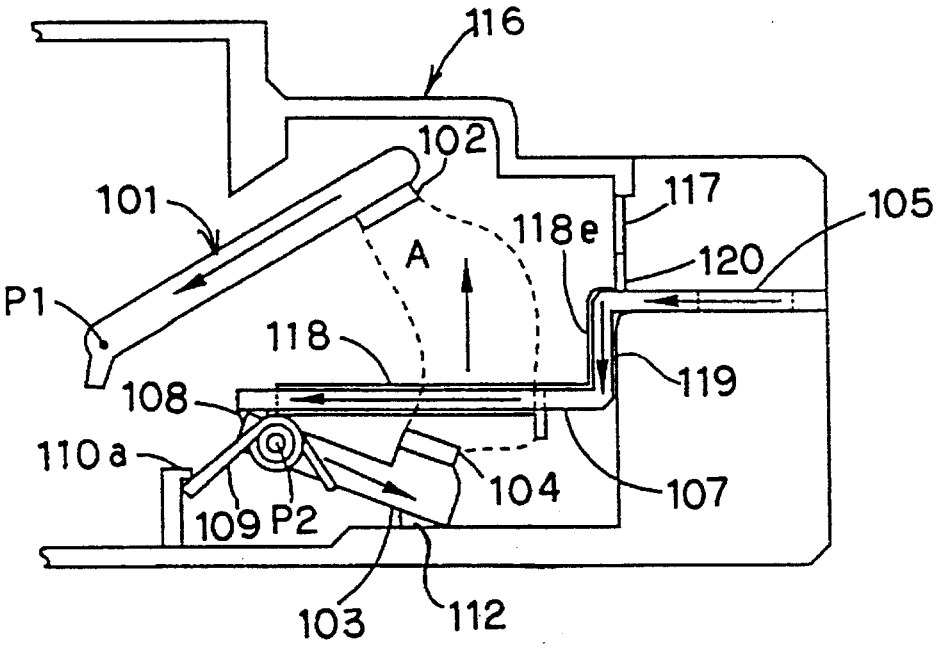
Figure 324:
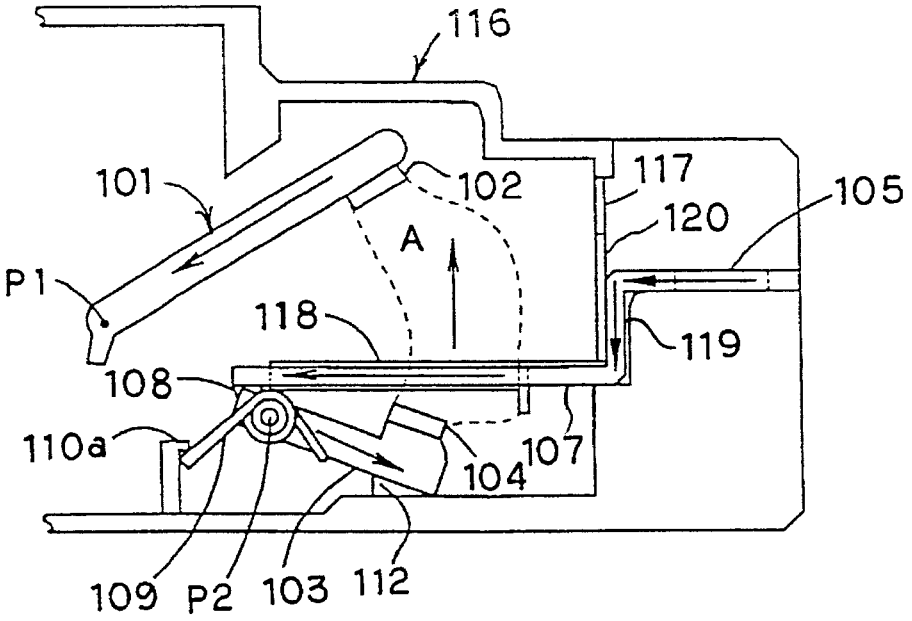
Figure 325:
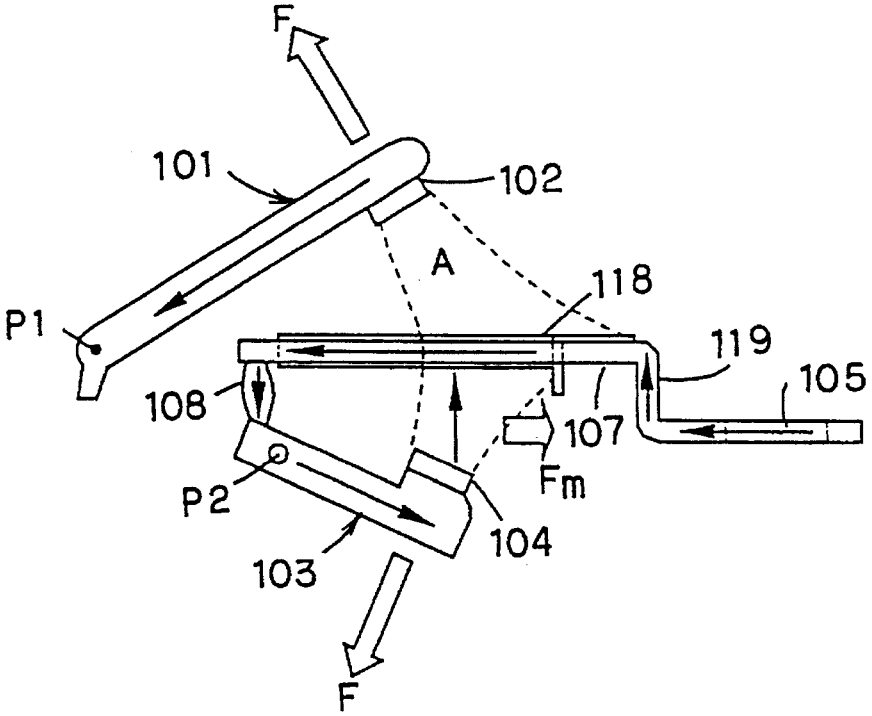
Figure 326:
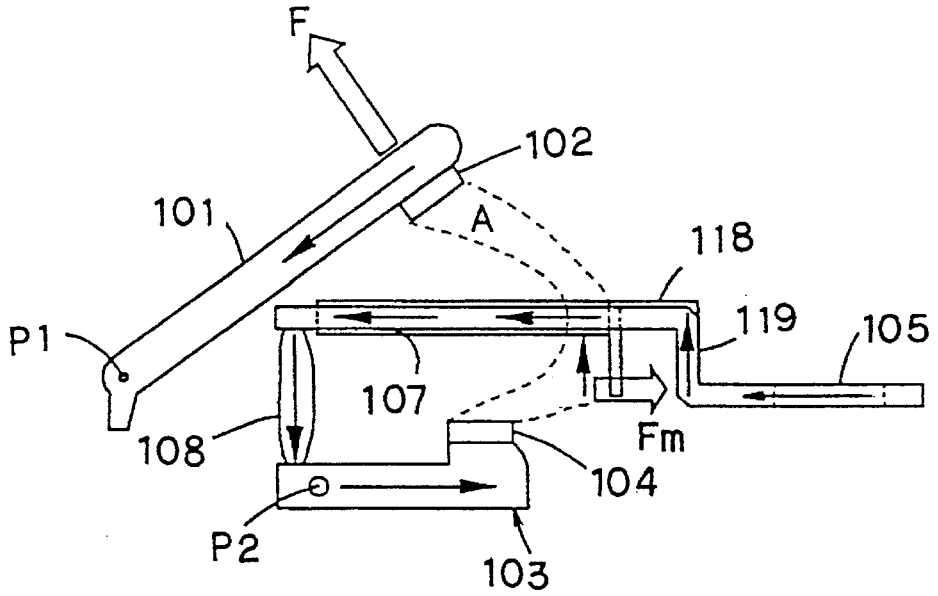
Figure 327:
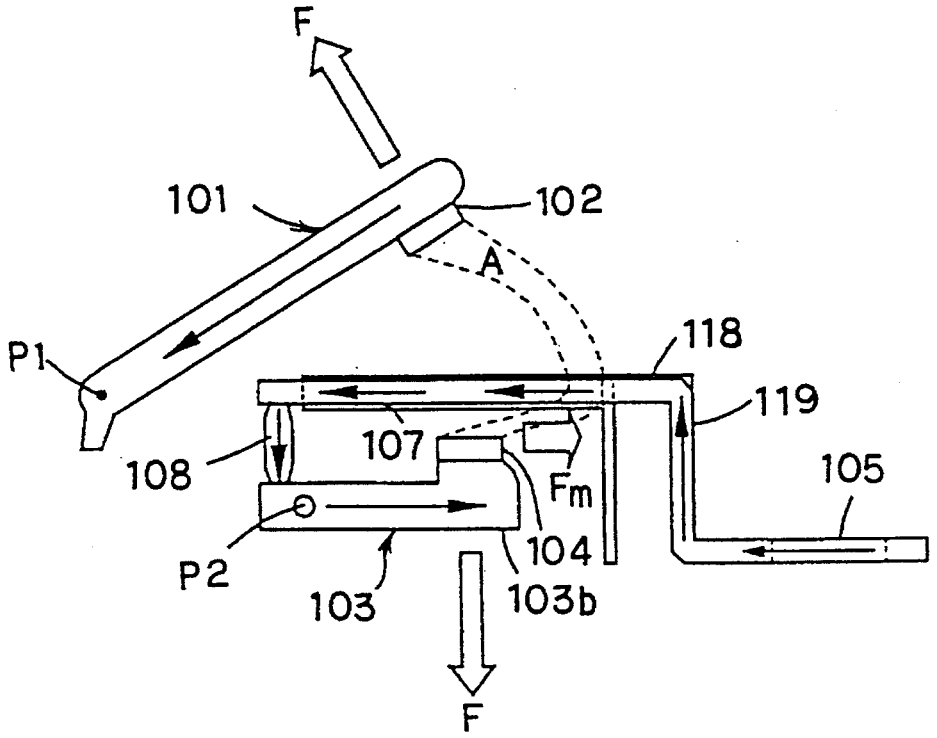
Figure 328:
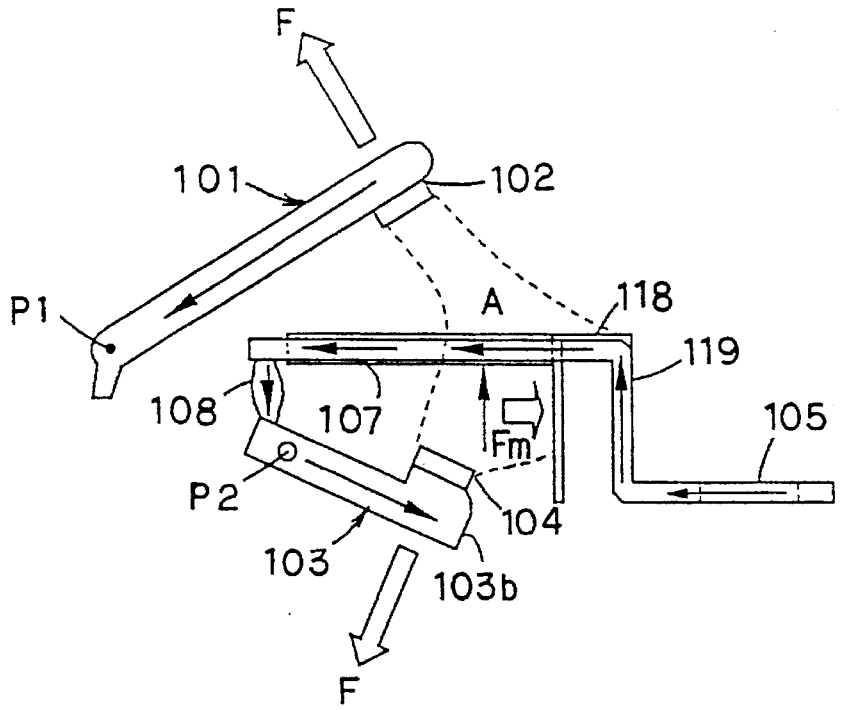
Figure 329:
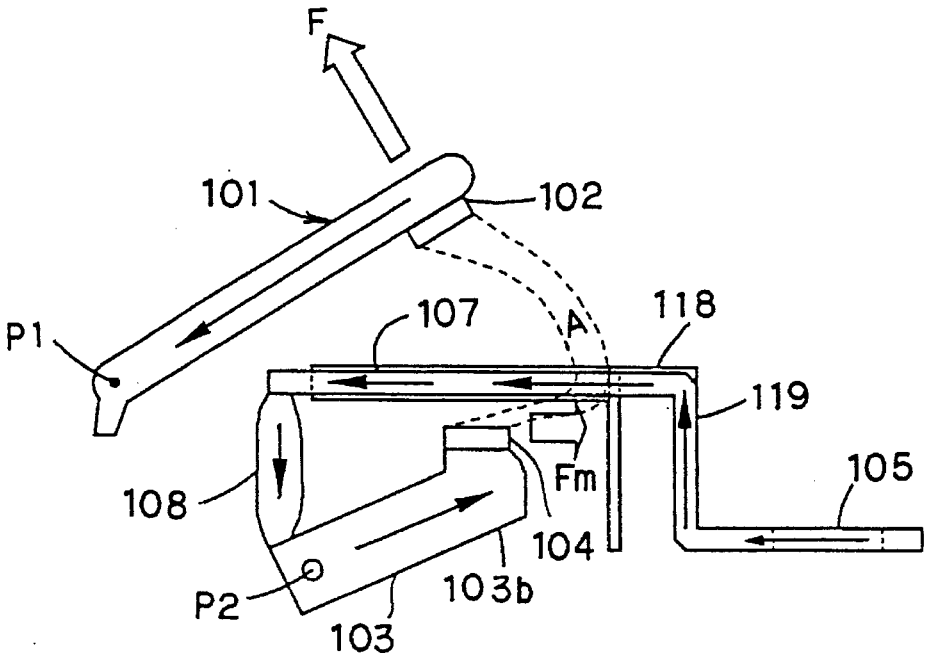
Figure 330:
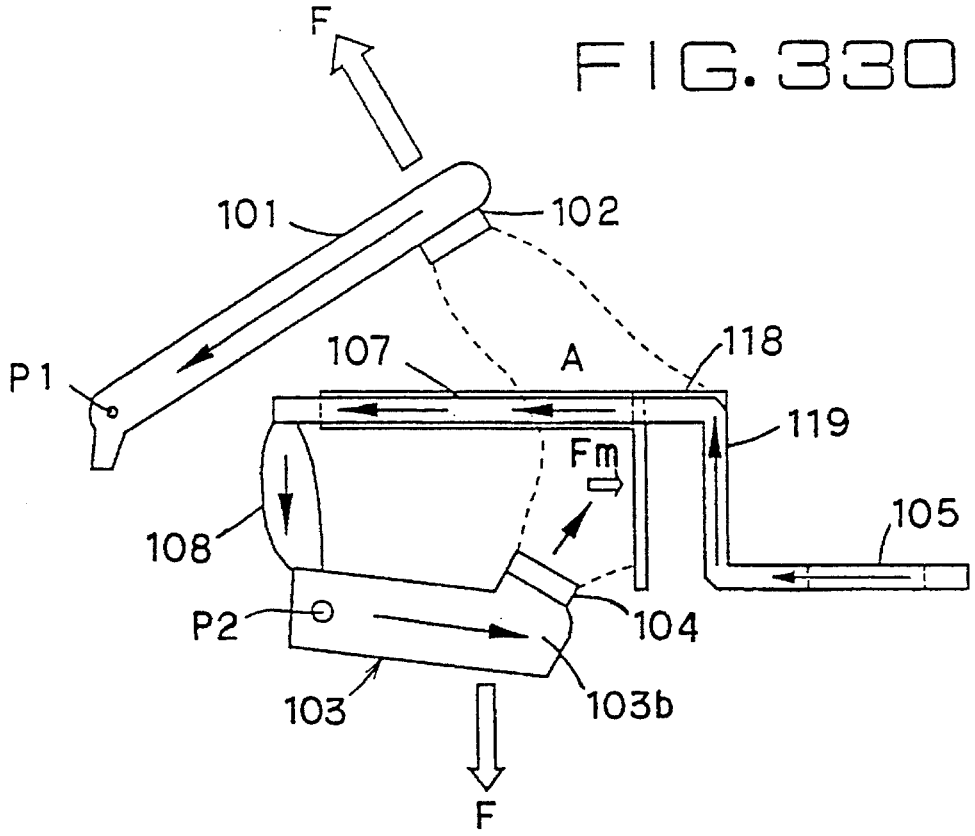
Figure 331:
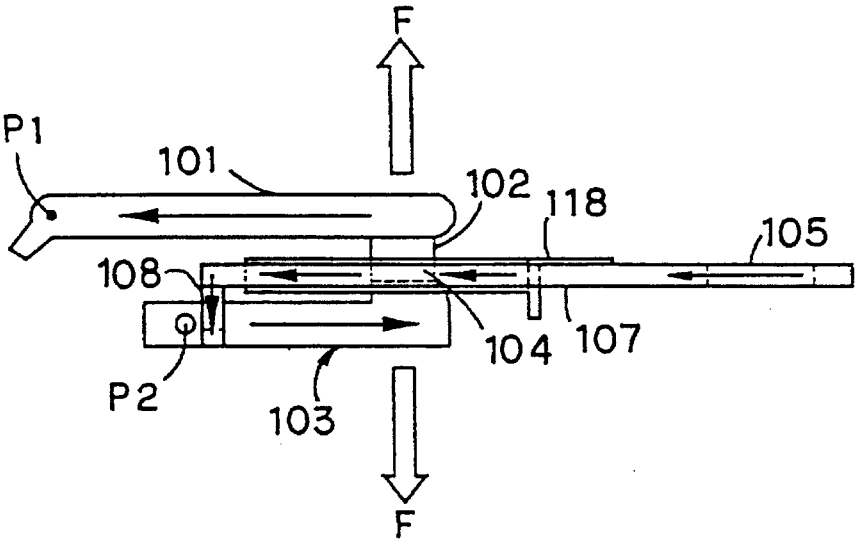
Figure 332:
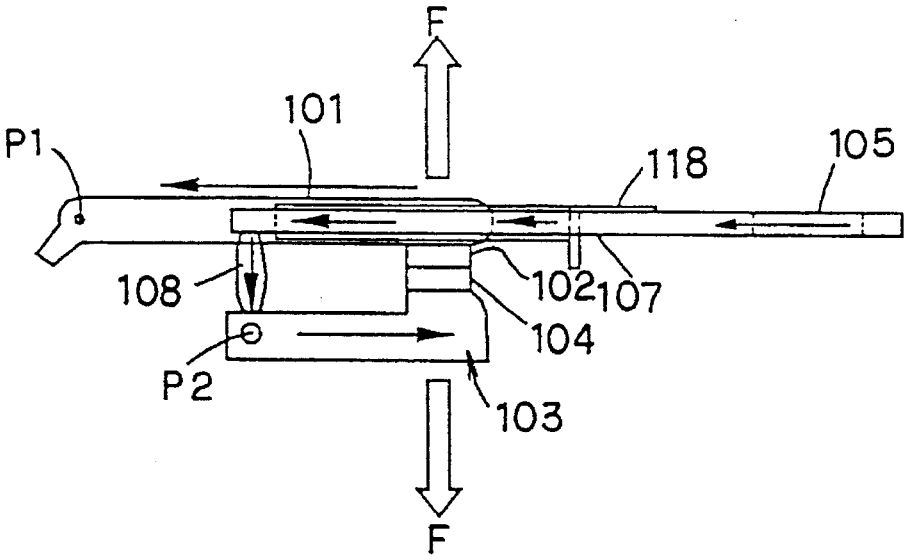
Figure 333:
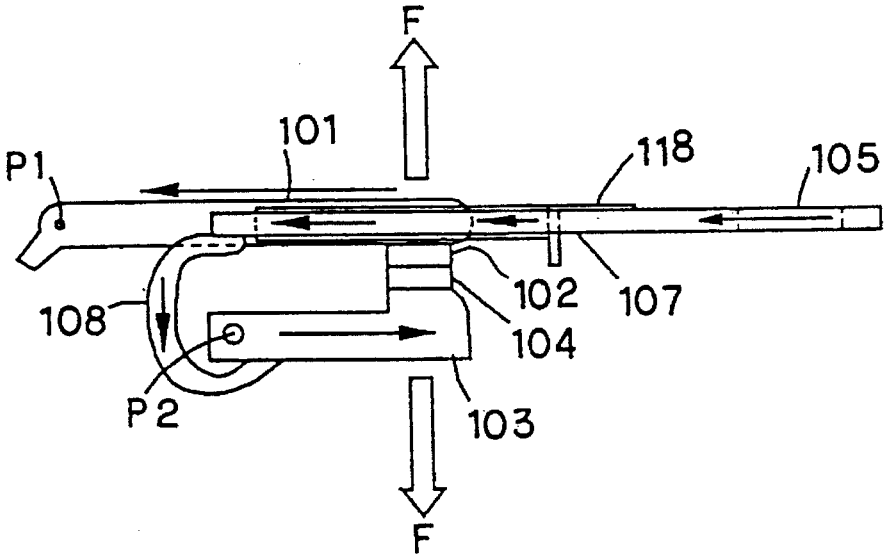
Figure 338A:
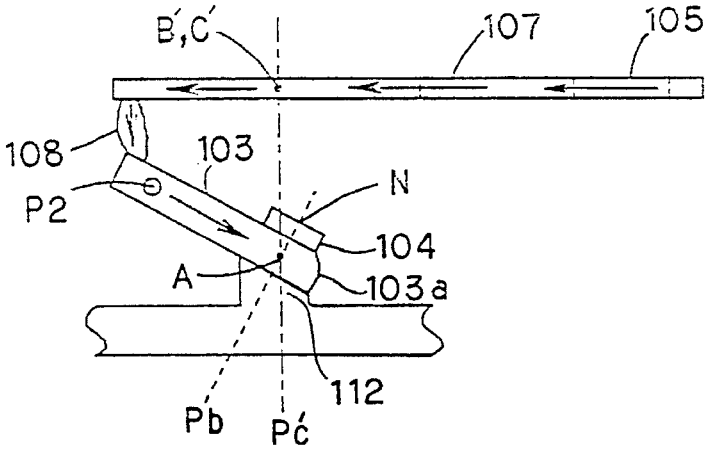
Figure 338B:
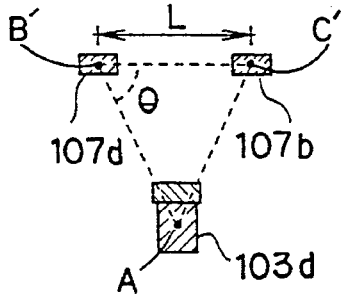
Figure 339:
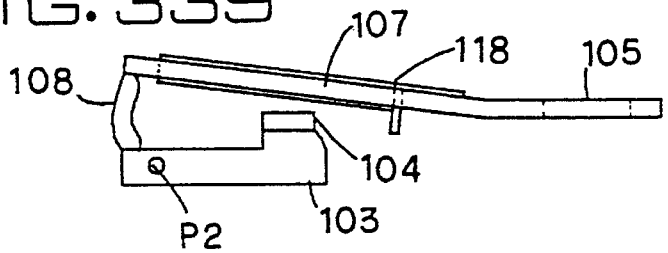
Figure 340:
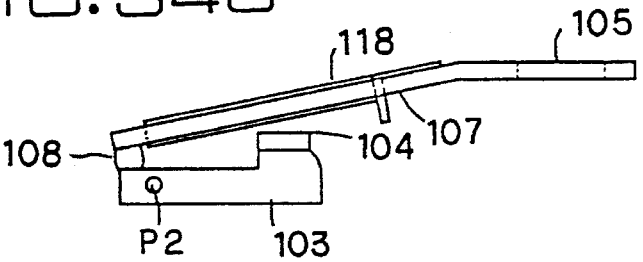
Figure 341:
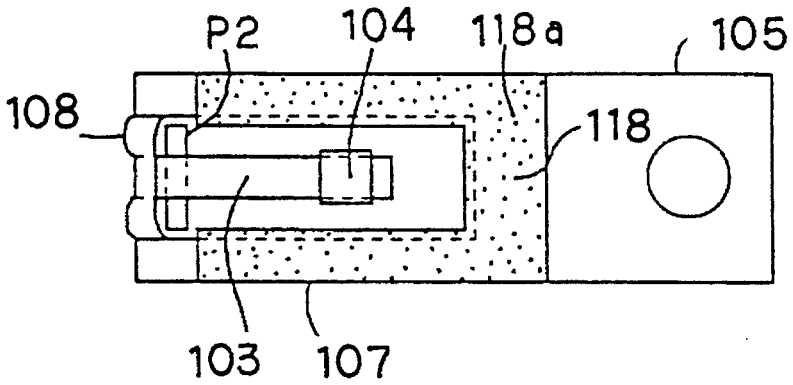
Figure 342:
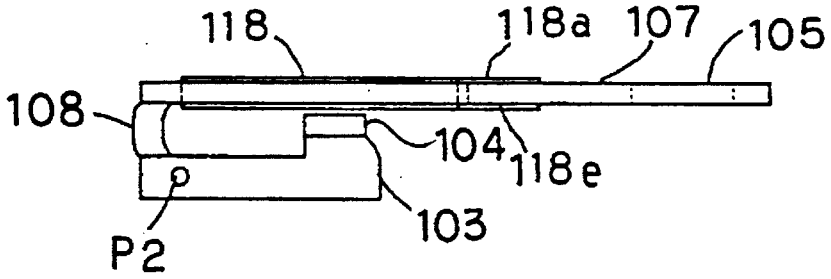
Figure 343:
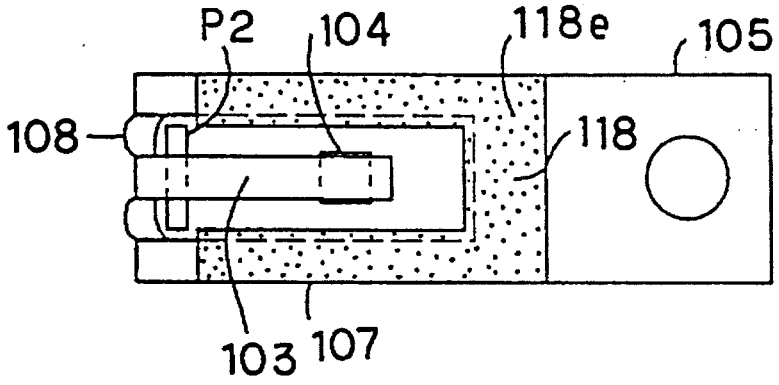
Figure 344:
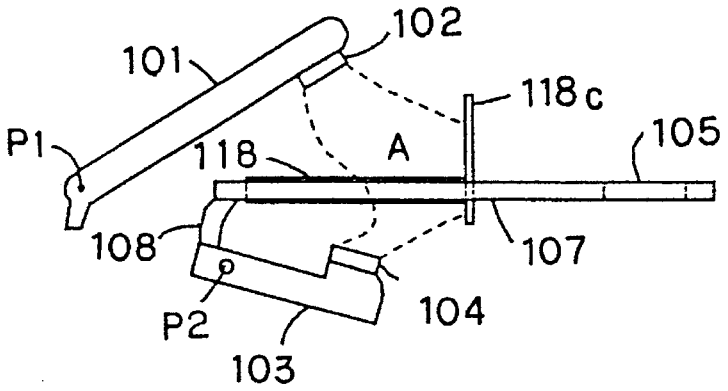
Figure 345:
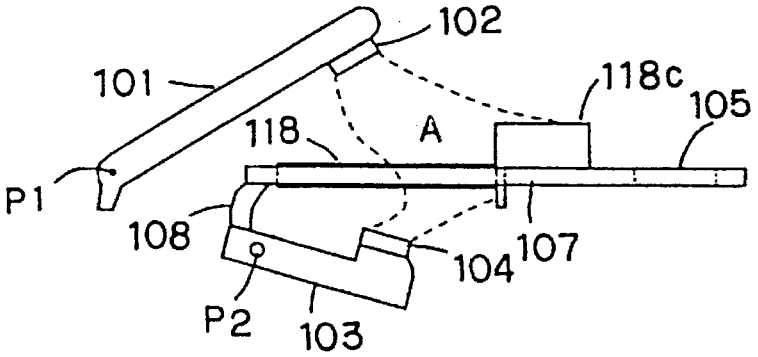
Figure 346A:
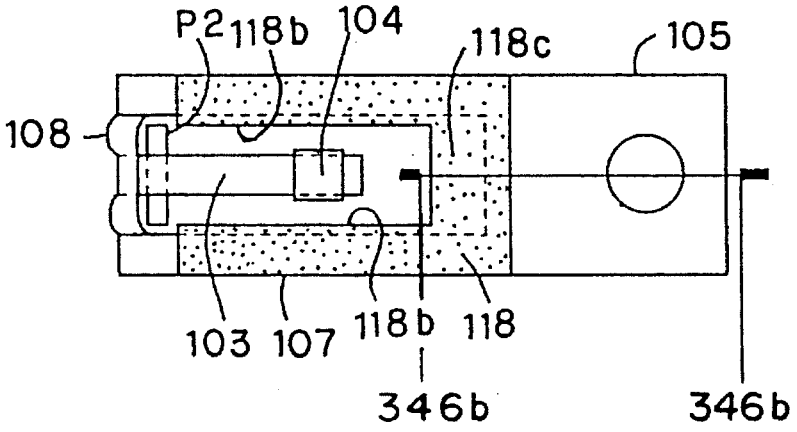
Figure 346B:
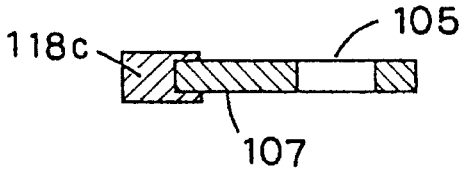
Figure 353:
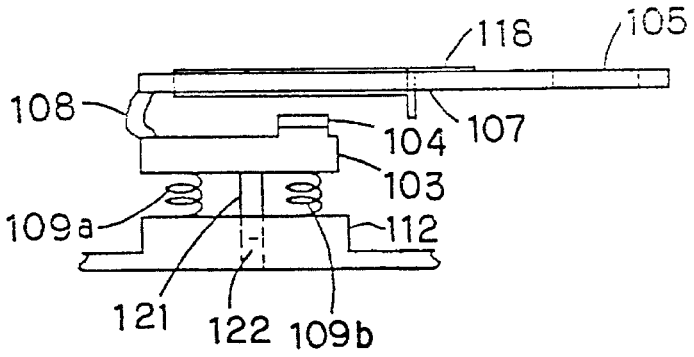
Figure 354:
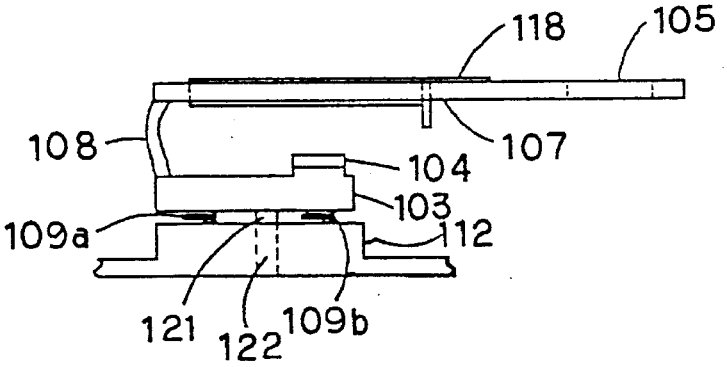
Figure 355:
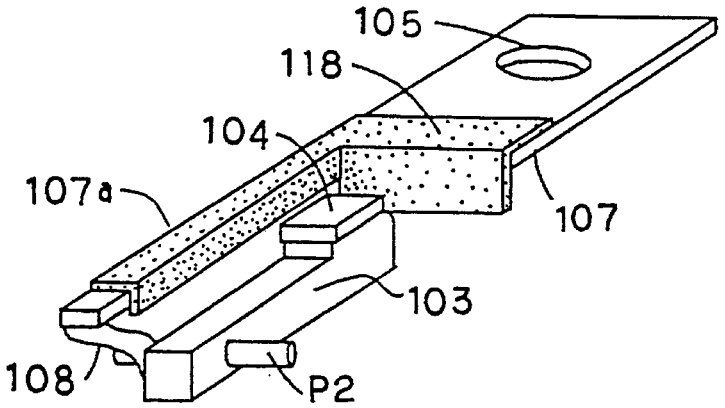

FIG. 109 is a side view showing an electrode portion of a circuit breaker according to the embodiment 53 with a moving contact in the opening condition;

FIG. 110 is a side view showing the maximum opening condition of the moving contact of FIG. 109;

FIG. 111 is a perspective view of a fixed contact according to the embodiment 54;

FIG. 112 is a plan view of FIG. 111;

FIG. 113 is a side view showing a condition immediately after a moving contact is opened with respect to the fixed contact according to the embodiment 54;

FIG. 114 is a sectional view along line 114—114 of FIG. 113;

FIG. 115 is a side view showing an alternative embodiment of the fixed contact according to the embodiment 54;

FIG. 116 is a side view showing another alternative embodiment of the fixed contact according to the embodiment 54;

FIG. 117 is a plan view of FIG. 116;

FIG. 118 is a side view showing still another embodiment of the fixed contact according to the embodiment 54;

FIG. 119 is a side view showing an electrode portion of a circuit breaker according to the embodiment 55 in a closing condition;

FIG. 120 is a perspective view of the fixed contact shown in FIG. 119;

FIG. 121 is a side view immediately after the opening in FIG. 119;

FIG. 122 is a side view showing the maximum opening condition of FIG. 121;

FIG. 123 is a perspective view showing an alternative embodiment of the fixed contact according to the embodiment 55;

FIG. 124 is a side view of an arc-extinguishing portion, showing a closing condition of a circuit breaker according to the embodiment 56;

FIG. 125 is a side view showing an opening condition of the circuit breaker of FIG. 124;

FIG. 126 is a plan view of a fixed contact including an arc-extinguishing side plate in FIGS. 124 and 125;

FIG. 127 is a front view of FIG. 126;

FIG. 128 is a perspective view of FIG. 126;

FIG. 129 is an explanatory view of the operation of the circuit breaker according to the embodiment 56, showing a condition immediately after the contact opening;

FIG. 130 is a sectional view along line 130—130 of FIG. 129;

FIG. 131 is an explanatory view of the operation of the circuit breaker, showing the maximum opening condition of FIG. 129;

FIG. 132 is a sectional view along line 132—132 of FIG. 131;

FIG. 133 is a graph diagram showing intensity distribution of magnetic field which is generated by current in a fixed contact on Z-axis of FIG. 132;

FIG. 134 is a side view showing a contact closing condition of a circuit breaker according to the embodiment 57;

FIG. 135(*a*) is a side view showing an electrode portion of a circuit breaker according to the embodiment 58;

FIG. 135(*b*) is a front view of FIG. 135(*a*) without a moving contact;

FIG. 136 is a side view showing an electrode portion of a circuit breaker according to the embodiment 59;

FIG. 137 is a side view showing an electrode portion of a circuit breaker according to the embodiment 60;

FIG. 138(*a*) is a side view showing an electrode portion of a circuit breaker according to the embodiment 61;

FIG. 138(*b*) is a sectional view taken along line 138*b*—138*b* of FIG. 138(*a*);

FIG. 139 is a side view showing a circuit breaker including an arc-extinguishing side plate according to an alternative embodiment of FIG. 138;

FIG. 140 is a side view of a circuit breaker according to the embodiment 62;

FIG. 141 is a front view of FIG. 140;

FIG. 142 is a side view of a circuit breaker according to an alternative embodiment of the embodiment 62;

FIG. 143 is a side view showing an electrode portion of a circuit breaker according to the embodiment 63;

FIG. 144 is a side view showing an electrode portion of a circuit breaker according to an alternative embodiment of the embodiment 63;

FIG. 145(*a*) is a side view showing an electrode portion of a circuit breaker according to the embodiment 64;

FIG. 145(*b*) is a front view of FIG. 145(*a*);

FIG. 146(*a*) is a side view showing an electrode portion of a circuit breaker according to the embodiment 65;

FIG. 146(*b*) is a sectional view taken along line 146*b*—146*b* of FIG. 146(*a*);

FIG. 147(*a*) is a side view showing an electrode portion of a circuit breaker according to an alternative embodiment of FIGS. 146(*a*) and (*b*);

FIG. 147(*b*) is a sectional view taken along line 147*b*—147*b* of FIG. 147(*a*);

FIG. 148 is a side view showing an electrode portion of a circuit breaker according to the embodiment 66;

FIG. 149 is a sectional view taken along line 149—149 of FIG. 148;

FIG. 150 is a side view showing an electrode portion of a circuit breaker according to an alternative embodiment of the embodiment 66;

FIG. 151 is a side view showing an electrode portion of a circuit breaker according to the embodiment 67;

FIG. 152 is a sectional view taken along line 152—152 of FIG. 151;

FIG. 153 is a side view showing an electrode portion of a circuit breaker according to an alternative embodiment of the embodiment 67;

FIG. 154 is a plan view of FIG. 153;

FIG. 155 is a side view showing an electrode portion of a circuit breaker according to the embodiment 68;

FIG. 156 is a sectional view taken along line 156—156 of FIG. 155;

FIG. 157 is a side view showing an electrode portion of a circuit breaker according to an alternative embodiment of the embodiment 68;

FIG. 158 is a plan view of FIG. 157;

FIG. 159 is a plan view of a fixed contact including an arc-extinguishing side plate according to another alternative embodiment of the embodiment 68;

FIG. 160 is a plan view of a fixed contact including an arc-extinguishing side plate according to still another alternative embodiment of the embodiment 68;

FIG. 161(*a*) is a side view showing an electrode portion of a circuit breaker according to a still further alternative embodiment of the embodiment 68;

FIG. 161(*b*) is a sectional view taken along line 161*b*—161*b* of FIG. 161(*a*);

FIG. 161(*c*) is a plan view of FIG. 161(*a*);

FIG. 162 is a side view of an arc-extinguishing portion, showing a closing condition of a moving contact of a circuit breaker according to the embodiment 69, 70 and 71 of the present invention;

FIG. 163 is a side view of the arc-extinguishing portion, showing an opening condition of the moving contact of the circuit breaker of FIG. 162;

FIG. 164(*a*) is a perspective view showing a fixed contact of FIG. 162;

FIG. 164(*b*) is a perspective view of the fixed contact of FIG. 164(*a*) in an insulated condition;

FIG. 165 is an explanatory view of the operation, showing a condition immediately after contact opening of the circuit breaker of FIG. 162;

FIG. 166 is an explanatory view of the operation, showing the maximum opening condition of the moving contact of the circuit breaker of FIG. 162;

FIG. 167 is an explanatory view of intensity distribution of magnetic field which is generated by current in the fixed contact of FIG. 163;

FIG. 167(*b*) is a sectional view taken along line 167*b*—167*b* of FIG. 167(*a*);

FIG. 167(*c*) is a graph diagram showing the intensity distribution of the magnetic field which is generated by the current in the fixed contact on the z-axis of FIG. 167(*b*);

FIG. 168 is an explanatory view of the operation of a circuit breaker according to the embodiment 72 of the present invention;

FIG. 169 is an explanatory view of the operation of another circuit breaker according to the embodiment 72 of the present invention;

FIGS. 170(*a*) to (*h*) are perspective views showing alternative embodiments of an arc-extinguishing plate according to the embodiment 72 of the present invention;

FIGS. 171 (*a*) and (*b*) are perspective views of other arc-extinguishing plates according to the embodiment 72 of the present invention;

FIG. 172 is a side view of an arc-extinguishing portion, showing a closing condition of a circuit breaker according to the embodiment 73;

FIG. 173 is a side view showing an opening condition of the circuit breaker of FIG. 172;

FIG. 174(*a*) is a plan view of the fixed contact shown in FIGS. 172 and 173;

FIG. 174(*b*) is a front view of FIG. 174(*a*);

FIG. 175 is a plan view of a magnetic material plate shown in FIGS. 172 and 173;

FIG. 176 is a perspective view of the fixed contact shown in FIGS. 173 to 175;

FIG. 177 is a side view showing a condition immediately after contact opening for illustrating the operation in the embodiment 73;

FIG. 178 is a side view showing the maximum opening condition of FIG. 177;

FIG. 179 is a sectional view taken along line 179—179 of FIG. 178 without a magnetic material plate;

FIG. 180 is a sectional view taken along line 179—179 of FIG. 178 with the magnetic material plate;

FIG. 181 is a perspective view of a magnetic material plate and the fixed contact, illustrating the operation in the embodiment 73;

FIG. 182 is a plan view illustrating the operation at a time of magnetic unsaturation of the magnetic material plate;

FIG. 183 is a plan view illustrating the operation at a time of magnetic saturation of the magnetic material plate;

FIG. 184 is a side view showing a condition where a plurality of, magnetic material plates are arranged in an upper space adjacent to of the fixed contact in the embodiment 73, FIG. 185 is a sectional view taken along line 179—179 of the fixed contact 4 shown in FIG. 178;

FIG. 186 is a graph diagram showing intensity distribution of magnetic field which is generated by current in a fixed contact on Z-axis of FIG. 185;

FIG. 187 is a side view showing the maximum opening condition of the moving contact, illustrating the operation in the embodiment 73;

FIGS. 188(*a*) to (*d*) are plan views showing alternative embodiments of the magnetic material plates having each different plane configuration;

FIG. 189(*a*) is a plan view of the magnetic material plate according to another alternative embodiment;

FIG. 189(*b*) is a side view of FIG. 189(*a*);

FIG. 190(*a*) is a side view of the magnetic material plate according to still another alternative embodiment;

FIG. 190(*b*) is a side view of the magnetic material plate according to a further alternative embodiment;

FIG. 191 is a side view showing an electrode portion including the magnetic material plate according to a still further alternative embodiment of the embodiment 73;

FIG. 192 is a plan view of a fixed contact including a magnetic material plate according to the embodiment 74 of the present invention;

FIG. 193 is a side view with a moving contact in an opening condition added to FIG. 192;

FIG. 194 is a plan view of a fixed contact including a magnetic material plate according to the embodiment 75 of the present invention;

FIG. 195 is a side view showing an electrode portion of a circuit breaker with a moving contact in an opening condition added to FIG. 194;

FIG. 196 is a sectional view taken along line 196—196 of FIG. 195;

FIG. 197 is a plan view of a fixed contact including a magnetic material plate according to the embodiment 76 of the present invention;

FIG. 198 is a side view showing an electrode portion of a circuit breaker with a moving contact in an opening condition added to FIG. 197;

FIG. 199 is a side view taken along line 196—196 of FIG. 198;

FIG. 200 is a plan view of a fixed contact including a magnetic material plate according to the embodiment 77 of the present invention;

FIG. 201 is a side view showing an electrode portion of a circuit breaker with a moving contact in an opening condition added to FIG. 200;

FIG. 202 is a plan view of a fixed contact including a magnetic material plate according to the embodiment 78 of the present invention;

FIG. 203 is a side view showing an electrode portion of a circuit breaker at a time of large current cutoff, with a moving contact in an opening condition added to FIG. 202;

FIG. 204 is a side view showing the electrode portion of the circuit breaker at a time of small current cutoff;

FIG. 205 is a plan view of a fixed contact including a magnetic material plate according to an alternative embodiment of the embodiment 78;

FIG. 206 is a plan view of a fixed contact including a magnetic material plate according to the embodiment 79 of the present invention;

FIG. 207 is a side view showing an electrode portion of a circuit breaker with a moving contact in an opening condition added to FIG. 206;

FIG. 208 is a sectional view taken along line 208—208 of FIG. 207;

FIG. 209 is a plan view of a fixed contact including a magnetic material plate according to the embodiment 80 of the present invention;

FIG. 210 is a plan view of a fixed contact including a magnetic material plate according to the embodiment 81 of the present invention;

FIG. 211 is a side view showing an electrode portion of a circuit breaker with a moving contact in an opening condition added to FIG. 210;

FIG. 212 is a sectional view taken along line 212—212 of FIG. 211;

FIG. 213 is a plan view of a fixed contact including a magnetic material plate according to the embodiment 82 of the present invention;

FIG. 214 is a side view showing an electrode portion of a circuit breaker including a magnetic material plate according to the embodiment 83 of the present invention;

FIG. 215 is a side view showing an electrode portion of a circuit breaker according to an alternative embodiment of the embodiment 83;

FIG. 216(*a*) is a side view showing an electrode portion of a circuit breaker according to another alternative embodiment of the embodiment 83;

FIG. 216(*b*) is a sectional view taken along line 216*b*–216*b* of FIG. 216(*a*);

FIG. 217 is a side view showing a related arrangement of a fixed contact of a circuit breaker, a moving contact and a magnetic material plate according to the embodiment 84 of the present invention;

FIG. 218 is a side view showing a condition where the moving contact in FIG. 217 is in the course of opening;

FIG. 219(*a*) is a side view showing an intersecting condition between the moving contact and an arm portion of the magnetic material plate;

FIG. 219(*b*) is a plan view of FIG. 219(*a*);

FIG. 220 is a side view showing an electrode portion of a circuit breaker including a magnetic material plate according to the embodiment 85 of the present invention;

FIG. 221 is a sectional view taken along line 221 without the moving contact in FIG. 220;

FIG. 222 is a sectional view taken along line 222 of FIG. 220;

FIG. 223 is a side view showing the closing condition of the circuit breaker;

FIG. 224 is a side view showing the opening condition of the circuit breaker;

FIGS. 225(*a*) and (*b*) are perspective views of the fixed contact of the circuit breaker;

FIG. 226 is an explanatory view of the operation of the circuit breaker;

FIGS. 227(*a*) to (*c*) are explanatory views of the intensity distribution of the magnetic field which is generated by the current in the fixed contact of the circuit breaker;

FIG. 228 is an explanatory view of the operation of the circuit breaker;

FIG. 229 is a side view showing a configuration of the circuit breaker;

FIG. 230 is a perspective view showing a configuration of the fixed contact, the insulator, the arc-extinguishing plate of the circuit breaker;

FIGS. 231(*a*) to (*g*) are perspective views showing shapes of the arc-extinguishing plate;

FIG. 232 is a side view of the arc-extinguishing portion of the circuit breaker;

FIG. 233 is a perspective view showing a configuration of the fixed contact, the insulator, the arc-extinguishing plate of the circuit breaker;

FIG. 234 is a perspective view showing a configuration of the fixed contact, the insulator, the arc-extinguishing plate of the circuit breaker;

FIG. 235 is a side view of the arc-extinguishing portion of the circuit breaker;

FIG. 236 is a side view showing the closing condition of the circuit breaker;

FIG. 237 is a side view showing the opening condition of the circuit breaker;

FIGS. 238(*a*) and (*b*) are perspective views of the fixed contact of the circuit breaker;

FIG. 239 is an explanatory view of the operation of the circuit breaker;

FIGS. 240(*a*) and (*b*) are perspective views of the arc-extinguishing plates;

FIG. 241 is a side view of the circuit breaker;

FIG. 242 is a side view of the fixed contact of the circuit breaker;

FIG. 243 is a side view of the arc-extinguishing portion of the circuit breaker;

FIG. 244 is a side view showing the closing condition of the circuit breaker;

FIG. 245 is a side view showing the opening condition of the circuit breaker;

FIG. 246(*a*) and (*b*) are perspective views of the fixed contacts of the circuit breaker;

FIG. 247 is an explanatory view of the operation of the circuit breaker;

FIG. 248 is an explanatory view of the operation of the circuit breaker;

FIGS. 249(*a*) and (*b*) are respectively a side view and a top view showing a configuration of the fixed contact and an arc runner of the circuit breaker;

FIG. 250 is an explanatory view of the operation of the circuit breaker;

FIG. 251 is a side view showing a configuration of the fixed contact and the arc runner of the circuit breaker;

FIG. 252 is a side view showing a configuration of the fixed contact and the arc runner of the circuit breaker;

FIGS. 253(*a*) and (*b*) are side views showing a configuration of the fixed contact and the arc runner of the circuit breaker;

FIGS. 254(*a*) to (*c*) are side views showing a configuration of the fixed contact and the arc runner of the circuit breaker;

FIGS. 255(*a*) and(*b*) are respectively a perspective view and a top view showing a configuration of the fixed contact and the arc runner of the circuit breaker;

FIGS. 256(*a*) and (*b*) are respectively a perspective view and a top view showing a configuration of the fixed contact and the arc runner of the circuit breaker;

FIGS. 257(*a*) and (*b*) are respectively a side view and a top view showing a configuration of the fixed contact and the arc runner of the circuit breaker;

FIGS. 258(*a*) and (*b*) are respectively a side view and a top view showing a configuration of the fixed contact and the arc runner of the circuit breaker;

FIG. 259 is a side view of the arc-extinguishing portion of the circuit breaker;

FIG. 260 is a side view showing the closing condition of the circuit breaker;

FIG. 261 is a side view showing the opening condition of the circuit breaker;

FIGS. 262(*a*) and (*b*) are perspective views of the fixed contact and the arc runner of the circuit breaker;

FIGS. 263(*a*) to (*c*) are perspective views of the fixed contact and the arc runner of the circuit breaker;

FIG. 264 is an explanatory view of the operation of the circuit breaker;

FIG. 265 is a side view of the circuit breaker;

FIGS. 266(*a*) and (*b*) are perspective views of the fixed contact and the arc runner of the circuit breaker;

FIG. 267 is a side view of the circuit breaker;

FIGS. 268(*a*) and (*b*) are perspective views of the fixed contact and the arc runner of the circuit breaker;

FIGS. 269(*a*) to (*l*) are sectional views showing shapes of the arc runner of the circuit breaker along the line 169—169 of FIG. 270;

FIG. 270 is a top view of the fixed contact and the arc runner of the circuit breaker;

FIG. 271 is a side view of the circuit breaker;

FIG. 272 is a side view showing the closing condition of the circuit breaker;

FIG. 273 is a side view showing the opening condition of the circuit breaker;

FIGS. 274(*a*) and (*b*) are perspective views of the fixed contact and an electrode of the circuit breaker;

FIG. 275 is an explanatory view of the operation of the circuit breaker;

FIG. 276 is a side view of the circuit breaker;

FIGS. 277(*a*) and (*b*) are respectively a perspective view and a side view of the fixed contact and the electrode of the circuit breaker;

25 FIG. 278 is a side view of the circuit breaker;

FIGS. 279(*a*) and (*b*) are respectively a perspective view along the line 279*b*—279*b* of FIG. 279(*a*) and a sectional view of the fixed contact and the electrode of the circuit breaker;

FIG. 280 is a side view of the circuit breaker;

FIGS. 281(*a*) and (*b*) are respectively a perspective view along the line 281*b*—281*b* of FIG. 281(*b*) and a sectional view of the fixed contact and the electrode of the circuit breaker;

FIG. 282 is a side view of the circuit breaker;

FIG. 283 is a side view showing the closing condition of the circuit breaker;

FIG. 284 is a side view showing the opening condition of the circuit breaker;

FIGS. 285(*a*) and (*b*) are perspective views of the fixed contact of the circuit breaker;

FIG. 286 is an explanatory view of the operation of the circuit breaker;

FIG. 287 is a sectional view in a vicinity of a contact of the circuit breaker;

FIG. 288 is an explanatory view of the operation of the circuit breaker;

FIG. 289 is a side view of the circuit breaker;

FIG. 290 is a side view of the circuit breaker;

FIGS. 291(*a*) and (*b*) are respectively a side view and a top view of the arc-extinguishing portion of the circuit breaker;

FIGS. 292(*a*) to (*d*) are perspective views of circuit arc-extinguishing plates;

FIGS. 293(*a*) and (*b*) are respectively a side view and a top view of the arc-extinguishing portion of the circuit breaker;

FIGS. 294(*a*) and (*b*) are respectively a side view and a top view of the arc-extinguishing portion of the circuit breaker;

FIG. 295 is a side view of the circuit breaker;

FIG. 296 is a partial perspective view of the arc-extinguishing portion of the circuit breaker;

FIG. 297 is a sectional view in the vicinity of the contact of the circuit breaker;

FIG. 298 is a perspective view of the arc-extinguishing portion of the circuit breaker;

FIG. 299 is a perspective view of the arc-extinguishing portion of the circuit breaker;

FIG. 300 is a perspective view of the arc-extinguishing portion of the circuit breaker;

FIG. 301 is a perspective view of the arc-extinguishing portion of the circuit breaker;

FIG. 302 is a side view of the arc-extinguishing portion of the circuit breaker;

FIG. 303 is a side view showing the closing condition of the circuit breaker;

FIG. 304 is a perspective view of the circuit arc-extinguishing plate;

FIG. 305 is a sectional view in the vicinity of the contact of the circuit breaker;

FIG. 306 is a side view showing the opening condition of the circuit breaker;

FIGS. 307(*a*) and (*b*) are perspective views of the fixed contact of the circuit breaker;

FIG. 308 is an explanatory view of the operation of the circuit breaker;

FIG. 309 is an explanatory view of the operation of the circuit breaker;

FIG. 310 is a sectional view in the vicinity of the contact of the circuit breaker;

FIG. 311 is a side view of the circuit breaker;

FIG. 312 is a side view of the arc-extinguishing plate, showing the closing condition of the circuit breaker serving as a switch according to the embodiment 119 with a housing broken away;

FIG. 313 is a side view showing the opening condition of the circuit breaker of FIG. 312;

FIG. 314 is a plan view of a related configuration of a repelling element, a first conductor portion and a second conductor portion of FIG. 312;

FIG. 315 is a front of FIG. 314;

FIG. 316 is a perspective view of FIG. 314;

FIG. 317 is a side view of an electrode portion, showing the closing condition of the circuit breaker so as to illustrate the operation in the embodiment 119;

FIG. 318 is a side view of the electrode portion immediately after contact opening, illustrating the operation at a time of large current cutoff in the embodiment 119;

FIG. 319 is a side view showing the maximum opening condition of a moving element and the repelling element;

FIG. 320 is a side view showing a closing condition of a circuit breaker according to the embodiment 120;

FIG. 321 is a side view of the electrode portion showing a contact opening condition of FIG. 320;

FIG. 322 is a side view of an electrode portion, showing a closing condition of a circuit breaker according to the embodiment 121;

FIG. 323 is a side view of an electrode portion, showing a closing condition of a circuit breaker according to the embodiment 122;

FIG. 324 is a side view of an arc-extinguishing portion of a circuit breaker according to an alternative embodiment of the embodiment 122;

FIG. 325 is a side view of an electrode portion, showing an opening condition of a circuit breaker according to the embodiment 123;

FIG. 326 is a side view of an electrode portion, showing an opening condition of a circuit breaker according to the embodiment 124;

FIG. 327 is a side view of an electrode portion, showing an opening condition of a circuit breaker according to the embodiment 125;

FIG. 328 is a side view of the electrode portion, showing an opening condition of a repelling element;

FIG. 329 is a side view showing the electrode portion in a condition where only a moving element is opened at a time of small current cutoff in the circuit breaker according to an alternative embodiment of the embodiment 125;

FIG. 330 is a side view showing a condition where both the moving element and the repelling element are opened at a time of large current cutoff in FIG. 329;

FIG. 331 is a side view of an electrode portion, showing a closing condition of a circuit breaker according to the embodiment 126;

FIG. 332 is a side view showing an electrode portion according to an alternative embodiment of the embodiment 126;

FIG. 333 is a side view showing an electrode portion according to another alternative embodiment of the embodiment 126;

FIG. 334(*a*) is a side view of an electrode portion, showing a closing condition of a circuit breaker according to the embodiment 127;

FIG. 334(*b*) is a sectional view taken along line 334*b*—334*b* of FIG. 334(*a*);

FIG. 335 is a side view showing an electrode portion of a circuit breaker according to the embodiment 128;

FIG. 336 is a sectional view of FIG. 335;

FIG. 337(*a*) is a side view showing an electrode portion of a circuit breaker according to the embodiment 129;

FIG. 337(*b*) is a sectional view of the electrode portion without a moving element and an insulator shown in FIG. 337;

FIG. 338(*a*) is a side view of the electrode portion, showing an opening condition of a repelling element of FIG. 337(*a*);

FIG. 338(*b*) is a sectional view of FIG. 338(*a*);

FIG. 339 is a side view of an electrode portion, showing another alternative embodiment of the circuit breaker according the embodiment of present invention;

FIG. 340 is a side view of an electrode portion, showing still another alternative embodiment of the circuit breaker according to the embodiment of the present invention;

FIG. 341 is a plan view of an electrode portion, showing a further alternative embodiment of the circuit breaker according to the embodiment of the present invention;

FIG. 342 is a side view of FIG. 341;

FIG. 343 is a bottom view of FIG. 342;

FIG. 344 is a side view of an electrode portion, showing a still further alternative embodiment of the circuit breaker according to the embodiment of the present invention;

FIG. 345 is a side view of an electrode portion, showing a further alternative embodiment of the circuit breaker according to the embodiment of the present invention;

FIG. 346(*a*) is a plan view of an electrode portion, showing a further alternative embodiment of the circuit breaker according to the embodiment of the present invention;

FIG. 346(*b*) is a sectional view taken along line 346*b*—346*b* of FIG. 346(*a*);

FIG. 347 is a side view of an electrode portion, showing a further alternative embodiment of the circuit breaker according to the embodiment of the present invention;

FIG. 348 is a plan view of FIG. 347 without a moving element;

FIG. 349 is a side view of an electrode portion, showing a further alternative embodiment of the circuit breaker according to the embodiment of the present invention;

FIG. 350 is a front view of FIG. 349 without a moving element and an insulator;

FIG. 351 is a side view of an electrode portion, showing a further alternative embodiment of the circuit breaker according to the embodiment of the present invention;

FIG. 352 is a front view of FIG. 351 without insulators;

FIG. 353 is a side view showing a closing condition of a repelling element of a circuit breaker according to the embodiment 130 of the present invention;

FIG. 354 is a side view of an electrode portion, showing the closing condition of the repelling element of FIG. 353; and FIG. 355 is a perspective view of an electrode portion, showing a further alternative embodiment of the circuit breaker according to the embodiment of the present invention.

DETAILED DESCRIPTION OF THE PREFERRED EMBODIMENTS

Preferred embodiments of the invention will now be described in detail referring to the accompanying drawings.

Embodiment 1

Figure 1:
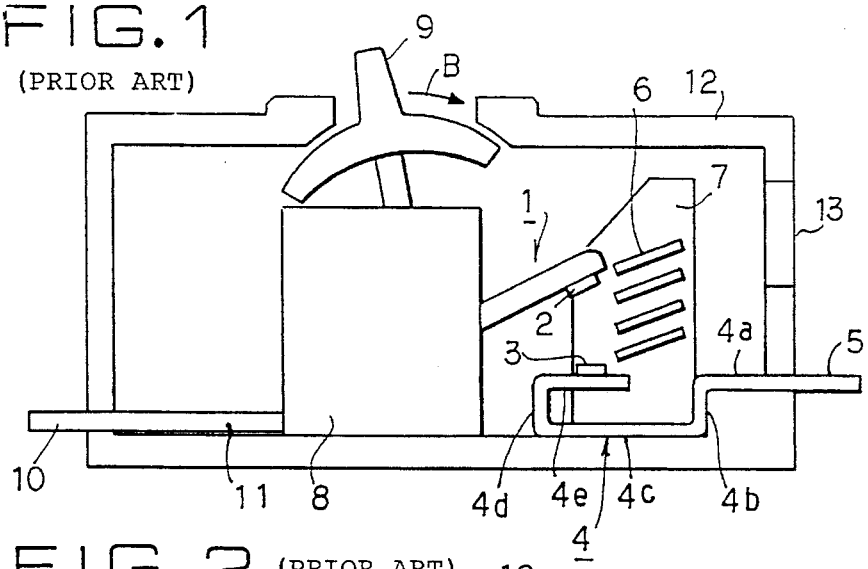
FIG. 1 (PRIOR ART)
FIG. 1 is a side view showing an opening condition of a conventional circuit breaker.
Figure 2:
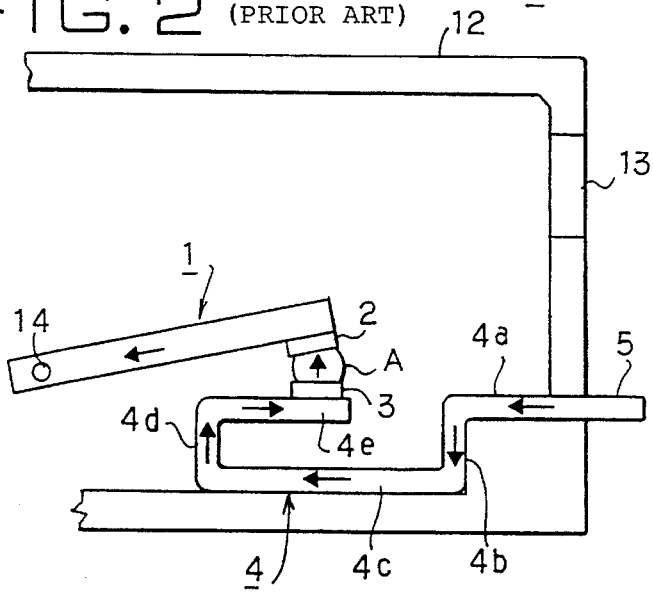
FIG. 2 (PRIOR ART)
FIG. 2 is a side view showing a condition immediately after contact opening in the circuit breaker shown in FIG. 1.
Figure 3:
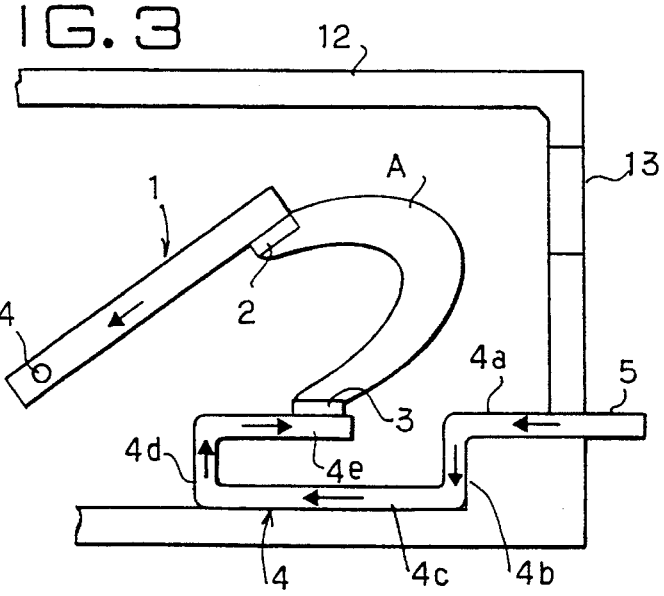
FIG. 3 (PRIOR ART)
FIG. 3 is a side view showing the maximum opening condition of a moving contact in the circuit breaker of FIG. 2.
Figure 4:
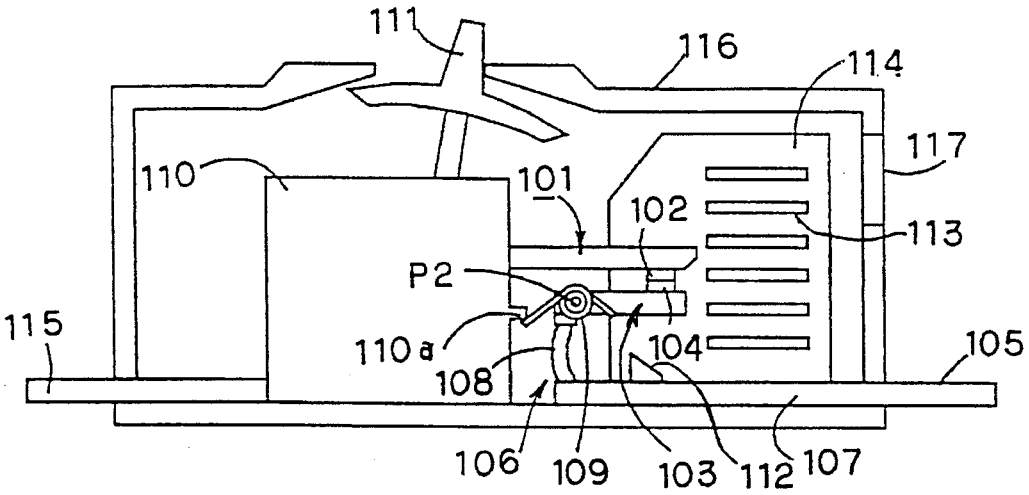
FIG. 4 (PRIOR ART)
FIG. 4 is a side view showing a closing condition of the circuit breaker as an example of conventional switches.
Figure 5:
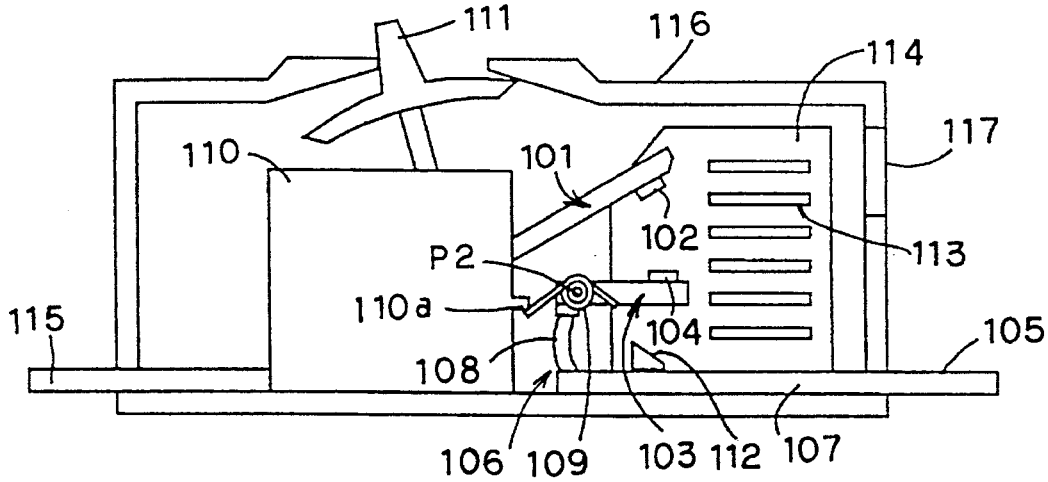
FIG. 5 (PRIOR ART)
FIG. 5 is a side view showing the opening condition of only a moving element in FIG. 4.
Figure 6:
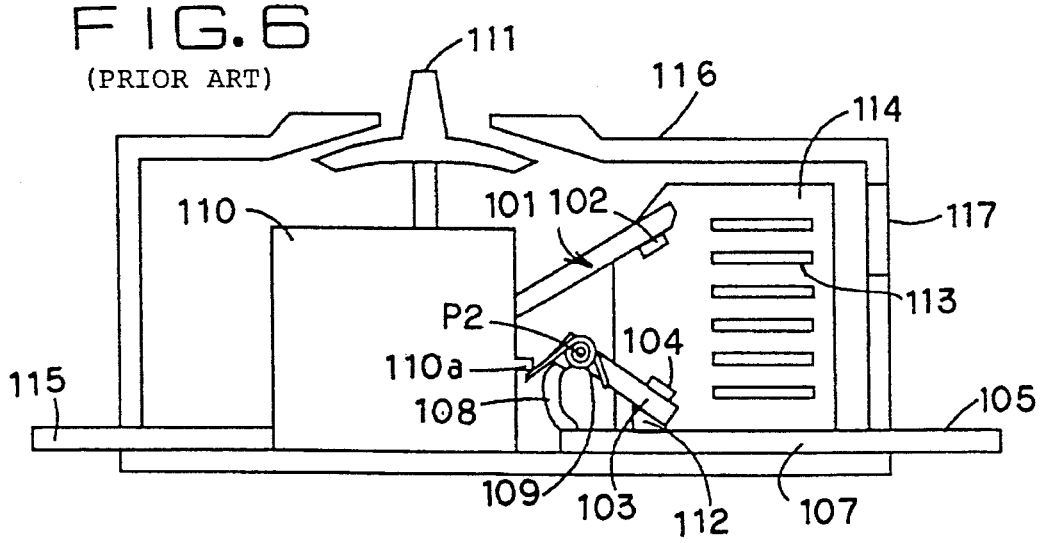
FIG. 6 (PRIOR ART)
FIG. 6 is a side view showing the maximum opening condition of the moving element and a repelling element in FIG. 4.
Figure 7:
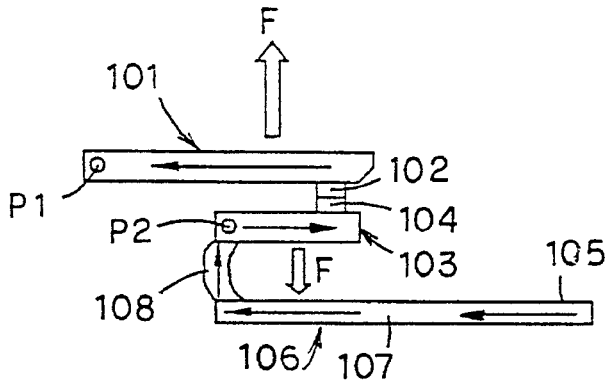
FIG. 7 (PRIOR ART)
FIG. 7 is a side view showing the closing condition of an electrode portion, for purpose of illustration of the operation of the conventional circuit breaker.
Figure 8:
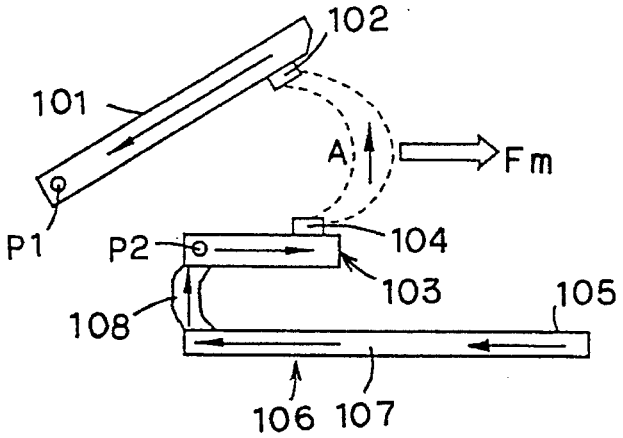
FIG. 8 (PRIOR ART)
FIG. 8 is a side view of the electrode portion, showing a condition where the moving element is opened from the closing condition shown in FIG. 7.
Figure 9:
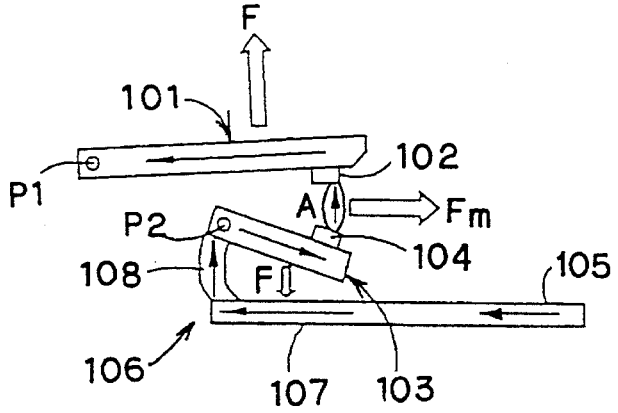
FIG. 9 (PRIOR ART)
FIG. 9 is a side view of the electrode portion, showing a condition where the moving element and the repelling element in FIG. 4 respectively move in their opening directions.
Figure 10:
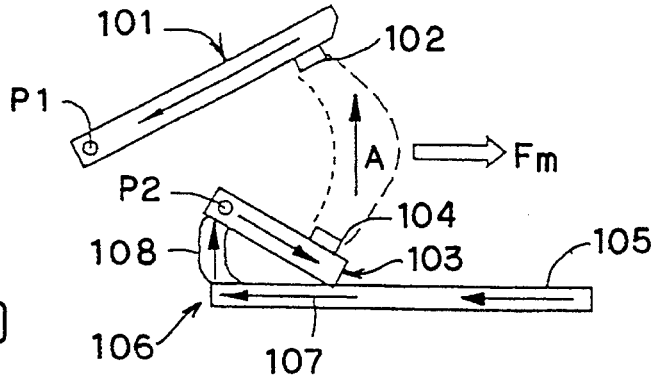
FIG. 10 (PRIOR ART)
FIG. 10 is a side view of the electrode portion, showing the maximum opening condition of the moving element and the repelling element in FIG. 9.
Figure 11:
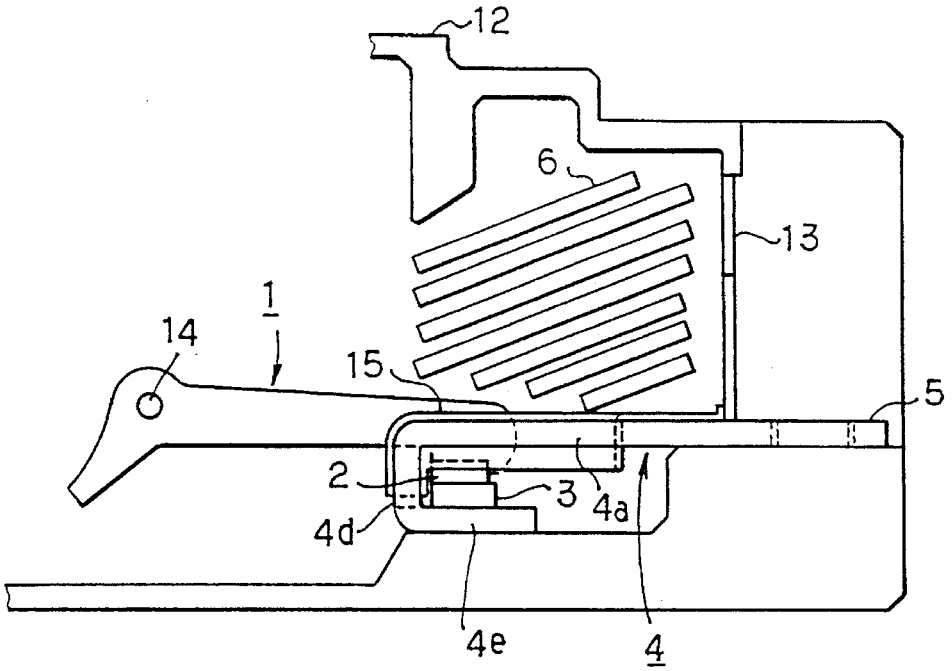
FIG. 11 is a side view of an arc-extinguishing portion, showing the closing condition of a circuit breaker according to the embodiment 1.
Figure 12:
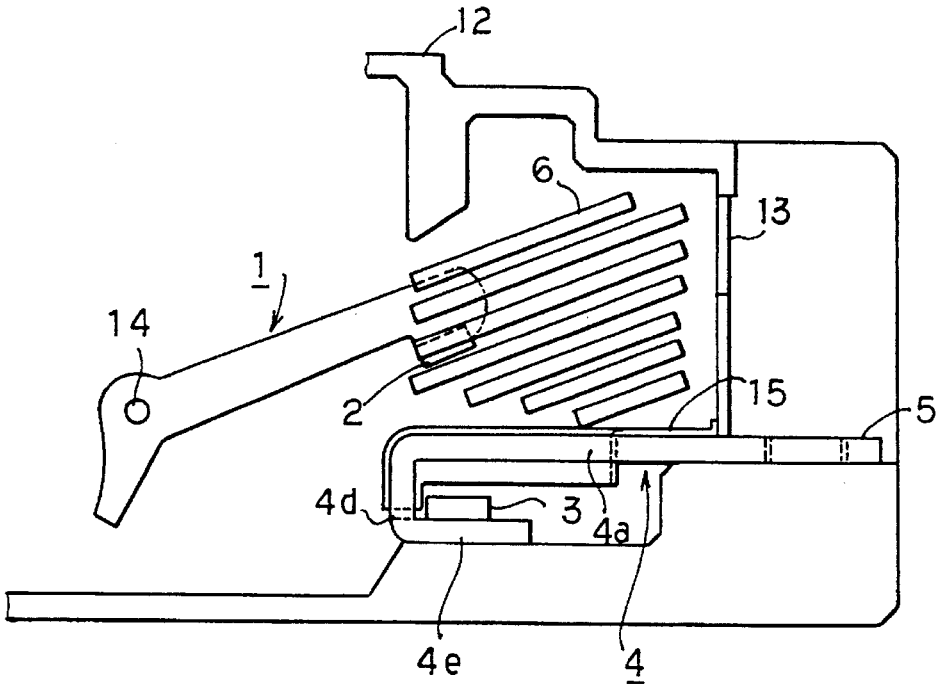
FIG. 12 is a side view showing the opening condition of the circuit breaker of FIG. 11.

A description will now be given of the embodiment 1 of the present invention with reference to the drawings. FIG. 11 is a side view of an arc-extinguishing portion, showing a closing condition of a circuit breaker serving as a switch according to the embodiment 1 of the invention with a housing broken away. FIG. 12 is a side view showing an opening condition of the circuit breaker of FIG. 11. The component parts common or equivalent to FIGS. 1 to 3 are designated by common reference numerals. The descriptions of the common component parts are omitted here to avoid unnecessary repetition.

In the drawings, reference numeral 4 means a fixed contact or element with a stationary contact 3 provided at one end thereof. The fixed contact 4 includes a first conductor portion 4*a*, a second conductor portion 4*e*, and a third conductor portion 4*d*.

Specifically, in a contact closing condition of FIG. 11, if the traveling contact 2 of the moving contact 1 is upward opened from the stationary contact 3, the fixed contact 4 is integrally provided in a form including the first conductor portion 4*a* connected to a terminal 5 on the side of the power source so as to horizontally extend, the second conductor portion 4*e* positioned under the first conductor portion 4*a* with a space, and the third conductor portion 4*d* vertically connecting the second conductor portion 4*e* with the first conductor portion 4*a* on the side opposed to the terminal 5. Further, the stationary contact 3 is secured to the second conductor portion 4*e* so as to be positioned under the first conductor portion 4*a*.

The fixed contact 4 is mounted and set to the housing 12 such that the third conductor portion 4*d* is positioned on a side of the other end of the moving contact 1 to which the traveling contact 2 is not secured with respect to the stationary contact 3 and on the side opposed to the terminal 5 (i.e., on the side of the rotation supporting point 14 of the moving contact 1). In this case, the first conductor portion 4*a* is arranged such that the entire first conductor portion 4*a* is positioned above a contact surface of the contacts at a contact closing time when the traveling contact 2 contacts the stationary contact 3, and is positioned below the contact surface of the traveling contact 2 at a contact opening time.

The arc-extinguishing plates 6 shown in FIGS. 11 and 12 is provided with a notch portion (not shown) so as not to prevent the rotation of the moving contact 1. The mechanism portion 8, the handle 9 and the terminal 10 on the side of the load which are shown in FIG. 1 are omitted in FIGS. 11 and 12, but are naturally contained and arranged in the housing 12.

Figure 13A:
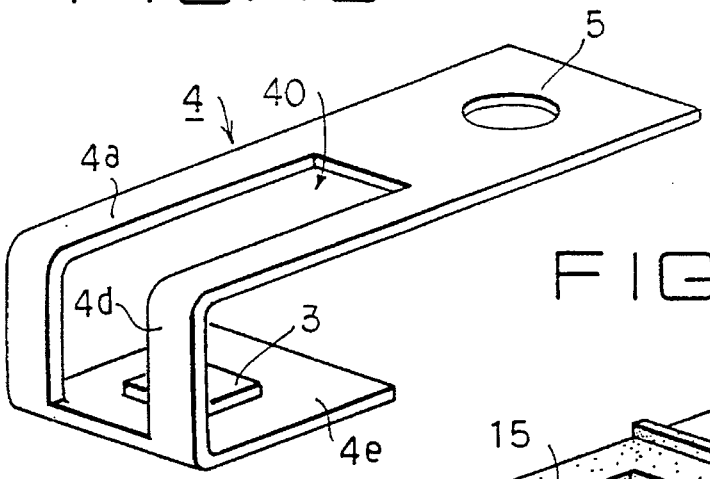
FIG. 13(*a*) is a perspective view showing a fixed contact of FIG. 11.
Figure 13B:
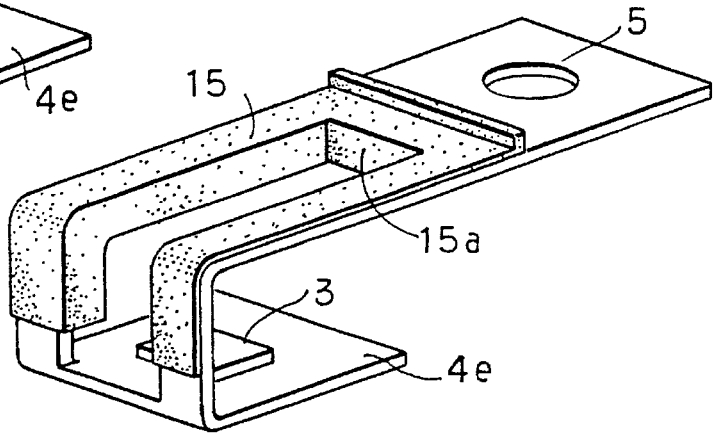

FIGS. 13(*a*) and (*b*) are perspective views showing a fixed contact according to the embodiment 1.

The fixed contact 4 shown in FIG. 13(*a*) is integrally provided in a substantially U-shaped form including the first conductor portion 4*a*, the second conductor portion 4*e* and the third conductor portion 4*d*. The terminal 5 on the side of the power source is connected to one end of the U-shaped form, that is, an end of the first conductor portion 4*a* on the side connected to the power source. Further, the stationary contact 3 is secured to the inside of the U-shaped form serving as the opposite side end, that is, an upper surface portion of the second conductor portion 4*e*. Moreover, in the fixed contact 4, a slit 40 is provided in a connecting conductor portion (i.e., the first conductor portion 4*a* and the third conductor portion 4*d*) positioned above a secured surface of the stationary contact 3 so as not to prevent a switching action of the moving contact 1 to the stationary contact 3 on the second conductor portion 4*e*.

In FIG. 13(*b*), reference numeral 15 means an insulator, and a surface of the fixed contact 4 and an inner surface of the slit 40 are coated with the insulator 15 over an area from a vicinity of a connecting portion between the first conductor portion 4*a* and the terminal 5 to the third conductor portion 4*d*.

A description will now be given of the operation.

As in the prior art, if large current such as short-circuit current flows, the moving contact 1 rotates to open the traveling contact 2 and the stationary contact 3 before the operation of the mechanism portion, and the arc A forms between the contacts 2 and 3.

Figure 14:
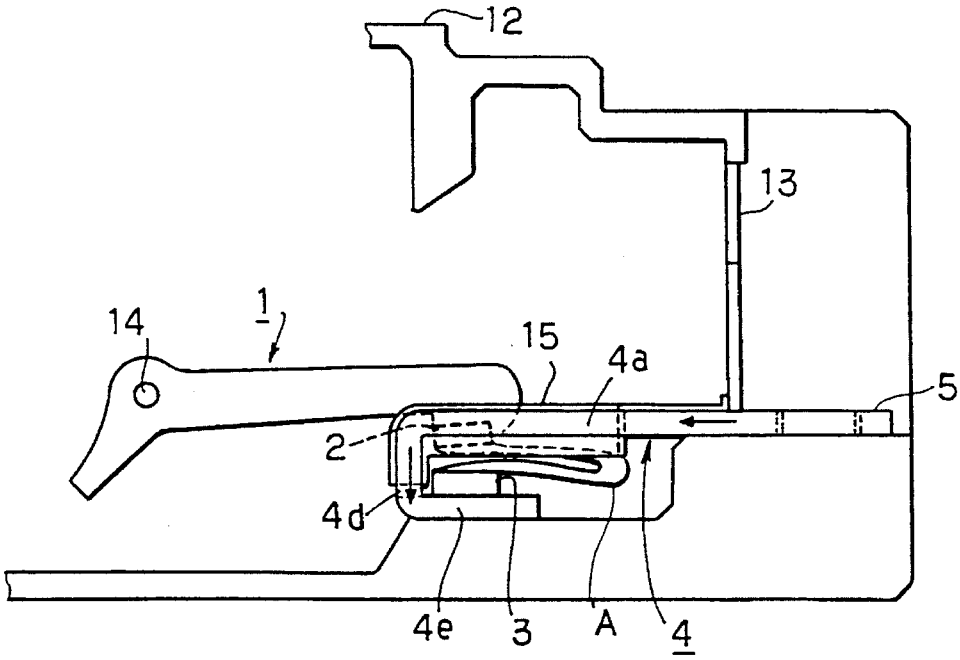
FIG. 14 is an explanatory view of the operation, showing a condition immediately after the contact opening of the circuit breaker of FIG. 11.

FIG. 14 shows a condition where the contact surface of the traveling contact 2 is still positioned below the first conductor portion 4*a* immediately after opening of the contacts 2 and 3. In FIG. 14, the arrow means current, and the arc-extinguishing plate 6 is omitted for the sake of simplicity.

An entire current path including an area from the terminal 5 to the first conductor portion 4*a* is positioned above the arc A. As a result, the electromagnetic force which is generated by the current path and is applied to the arc A can serve as a force to stretch the arc A on the side of the terminal 5. Further, current in the third conductor portion 4*d* has a direction opposed to that of the current of the arc A so that electromagnetic force generated by the current in the third conductor portion 4*d* can also serve as the force to stretch the arc on the side of the terminal 5.

Therefore, entire electromagnetic force generated by current in the fixed contact 4 can serve as the force to stretch the arc A on the side of the terminal 5. As a result, the arc A is strongly stretched immediately after the contact opening so as to rapidly increase arc resistance.

Figure 15A:
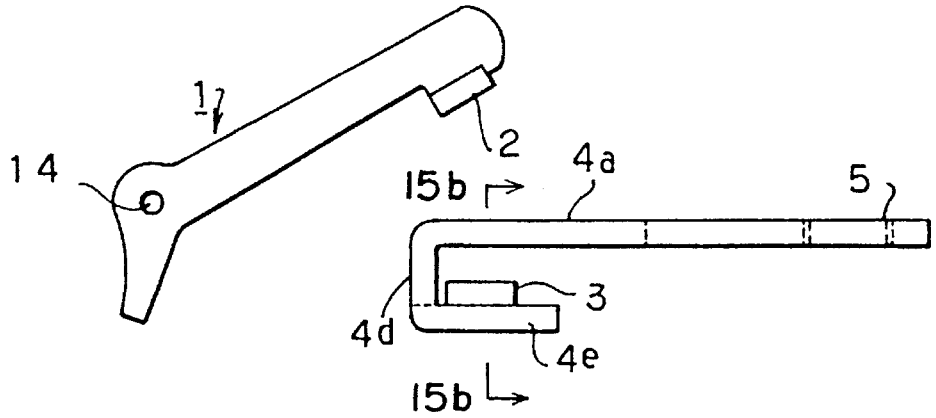
FIG. 15(*a*) is an explanatory view of intensity distribution of magnetic field which is generated by current in the fixed contact of FIG. 12.
Figure 15B:
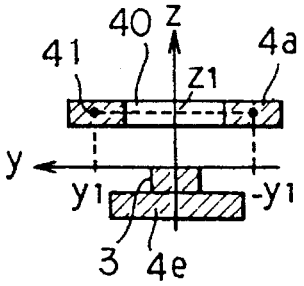
Figure 15C:
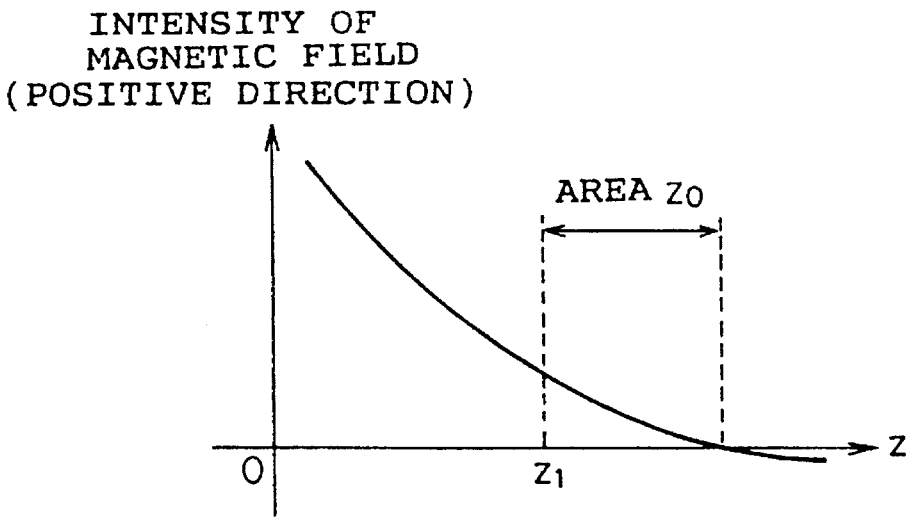

FIG. 15(*a*) is a side view of a moving contact and a fixed contact, illustrating intensity distribution of magnetic field which is generated by the current in the fixed contact of the embodiment 1. FIG. 15(*b*) is a sectional view taken along line 15*b*—15*b* of FIG. 15(*a*). In FIG. 15(*b*), reference numeral 41 means the center of gravity of respective sections of the first conductor portions 4*a* on the right and left sides, between which the slit 40 is interposed.

FIG. 15(*c*) shows the intensity distribution of the magnetic field on the Z-axis of FIG. 15(*b*), which is generated by the current in the fixed contact 4, and the intensity distribution of the magnetic field is found by a theoretical calculation. In FIG. 15(*c*), magnetic field in a positive direction serves as a magnetic field component to stretch the arc on the side of the terminal 5.

As shown in FIG. 15(*b*), the first conductor portion 4*a* is positioned at a position laterally offset from a plane in which the moving contact 1 is rotated.

Figure 16:
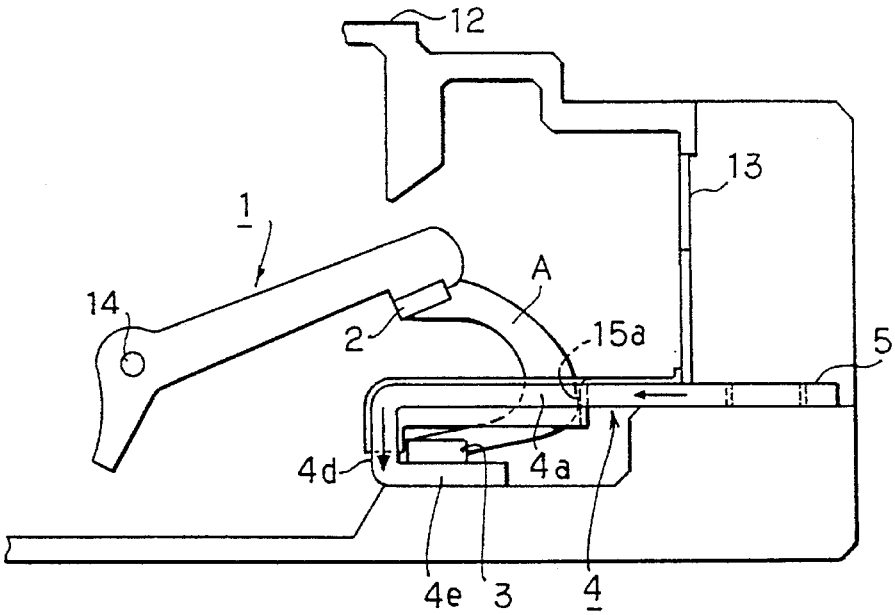
FIG. 16 is an explanatory view of the operation, showing the maximum opening condition of the moving contact of the circuit breaker of FIG. 11.

In such a conductor arrangement, there is a magnetic field component to stretch the arc A on the side of the terminal 5 even in a space (area Z0) above the first conductor portion 4*a* due to an effect caused by the current in the second conductor portion 4*e* and the third conductor portion 4*d*. Accordingly, as shown in FIG. 16, even if a traveling contact surface is rotated up to a position above the first conductor portion 4*a*, force is applied to the arc A on the side of the terminal 5 in the slit 40 of the first conductor portion 4*a*, and is pressed for cooling onto an insulator 15*a* covering an inner portion of the slit 40 (i.e., an inner surface of an end of the slit 40 on the side of the terminal 5). As a result, the arc resistance rapidly increasing immediately after the contact opening is further increased so as to maintain high arc voltage. Thus, it is possible to provide a circuit breaker which can reduce current peak and running energy, and have an excellent current-limiting performance.

Figure 17A:
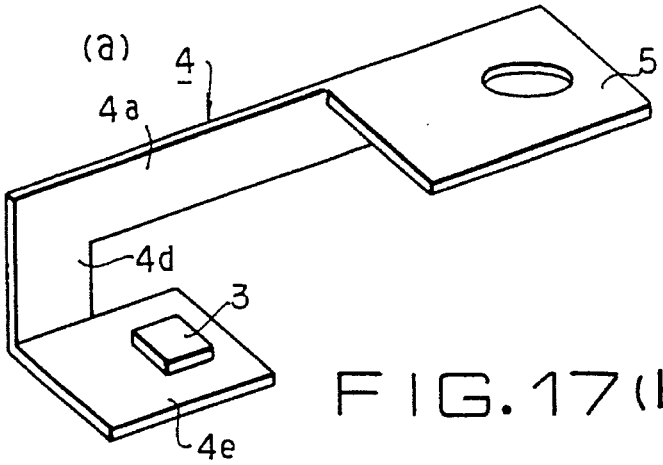
FIG. 17(*a*) is a perspective view of a fixed contact according to the embodiment 2.
Figure 17B:
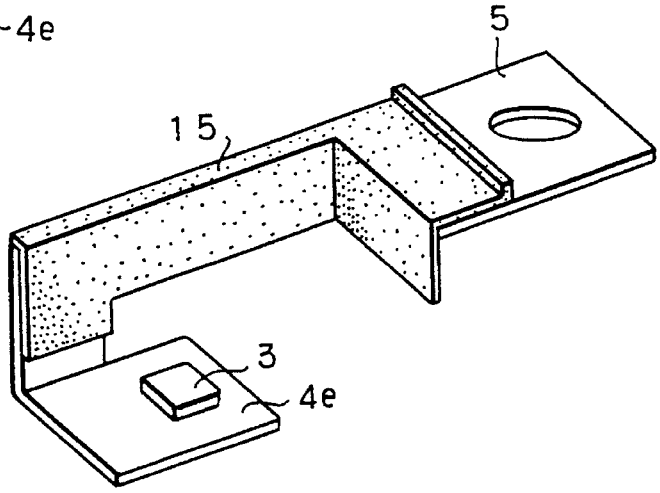

In the embodiment 1, though a description has been given with reference to the shape of the fixed contact 4 in which the slit 40 is symmetrically provided with respect to a rotation surface of the moving contact 1 so as not to prevent the rotation of the moving contact 1, the fixed contact 4 may be provided in forms as shown in FIGS. 17(*a*) and (*b*) in order to obtain the same effect.

Embodiment 2

FIG. 17(*a*) is a perspective view of a fixed contact according to the embodiment 2, and FIG. 17(*b*) is a perspective view of the fixed contact of FIG. 17(*a*) in an insulated condition.

As shown in FIG. 17(*a*), the fixed contact 4 according to the embodiment 2 is provided in a form in which the first conductor portion 4*a* is disposed only on the left side facing the side of the terminal 5.

Figure 18:
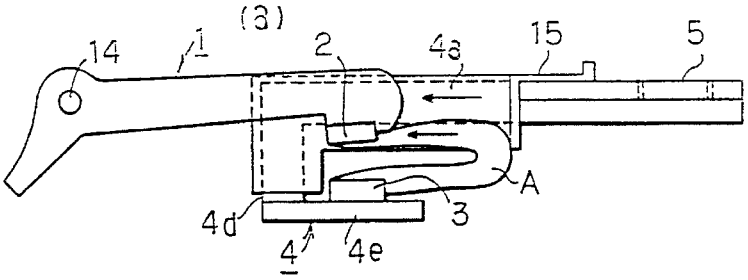
FIG. 18(*a*) is a side view of an electrode portion of a circuit breaker showing a condition immediately after the contact opening of the circuit breaker employing the fixed contact of FIG. 17(*b*)
Figure 18:
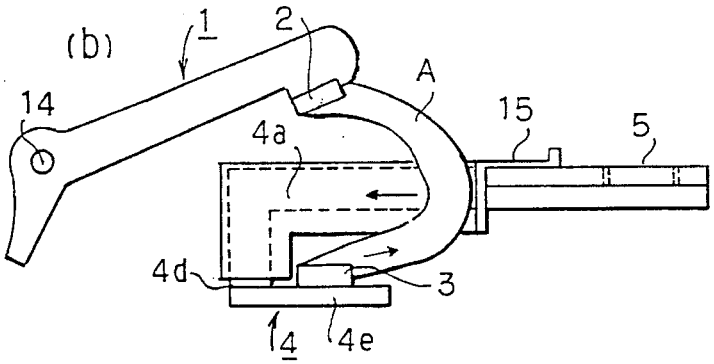

In the fixed contact 4, current in the arc A has the same direction as that of current in the first conductor portion 4*a* only on the left side at an upper half of the arc A for an opening initial period of the moving contact as shown in FIG. 18(*a*). Consequently, the arc A is attracted to the first conductor portion 4*a* only on the left side, and is cooled by strongly contacting the insulator 15 covering the first conductor portion 4*a*. Hence, the arc voltage can more rapidly rise for the opening initial period.

On the other hand, when the traveling contact 2 is positioned above the first conductor portion 4*a* because of the further opening between the contacts 2 and 3, the arc current and the current in the first conductor portion 4*a* only on the left side have each opposite direction so as to repel each other at a lower half of the arc A as shown in FIG. 18(*b*). Accordingly, the arc A is separated from the insulator 15 covering the first conductor portion 4*a* only on the left side, and an amount of vapor generated from the insulator 15 can be reduced. It is possible to reduce rise of pressure in the housing 12 according to increased current, and previously prevent damage by the pressure to the housing 12.

In other words, if any one of the first conductor portions 4*a* of the fixed contact 4 with respect to the rotation surface of the moving contact 1 is employed as described in the embodiment 2, it is possible to provide the fixed contact 4 having an excellent current-liming effect, and a configuration in which the damage to the housing 12 is hardly produced by the pressure.

Embodiment 3

Figure 19:
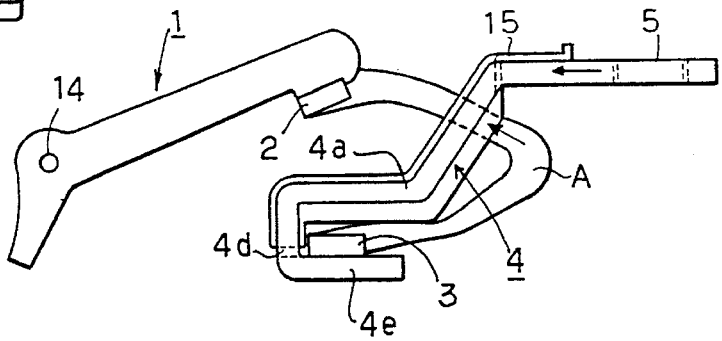
FIG. 19 is a side view of an electrode portion of a circuit breaker according to the embodiment 3.

FIG. 19 is a side view of an essential part according to the embodiment 3. In the embodiment 3, the terminal 5 on the side of the power source is arranged above the first conductor portion 4*a*. In case the terminal 5 is arranged above the first conductor portion 4*a* as set forth above, partial current of the arc A stretched to a vicinity of the terminal 5 and the current in the terminal 5 attract each other. Accordingly, it is possible to effectively stretch the arc A immediately before a cutoff time when the arc A largely extends.

In such a way, the arc length immediately before the cutoff can be extended by the electromagnetic force. Therefore, the embodiment 3 is effective in case a cutoff performance is significantly affected by the arc stretching action by the electromagnetic force immediately before the cutoff, such as cutoff operation of relatively small current in a relatively high voltage circuit.

Embodiment 4

Figure 20:
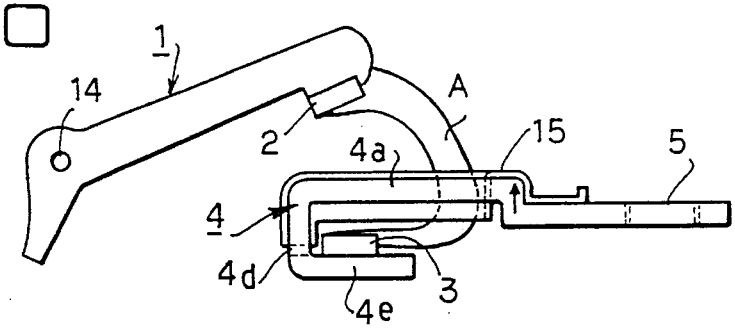
FIG. 20 is a side view of an electrode portion of a circuit breaker according to the embodiment 4.

FIG. 20 is a side view of an essential part according to the embodiment 4. The fixed contact 4 according to the embodiment 4 is provided such that the terminal 5 is positioned below the first conductor portion 4*a* and above a surface of the stationary contact 3.

In case the terminal 5 of the fixed contact 4 is positioned below the first conductor portion 4*a* as set forth above, an upward current component is generated at a portion of the fixed contact 4 on the side of the terminal 5 with respect to the arc, and this current component and the arc A attract each other. Consequently, it is possible to complement the arc A stretched by opening the contacts 2 and 3 in a vicinity of the upward current flow to some extent. As a result, it is possible to prevent the arc A from being drawn back between the contacts 2 and 3 in the course of the cutoff operation, and maintain high arc voltage.

Further, as stated above, the terminal 5 positioned below the first conductor portion 4*a* is disposed above the surface of the stationary contact 3 so that electromagnetic component is generated by the current in the terminal 5 so as to stretch the arc A on the surface of the stationary contact 3. As a result, it is possible to more rapidly rise the arc voltage.

Embodiment 5

Figure 21:
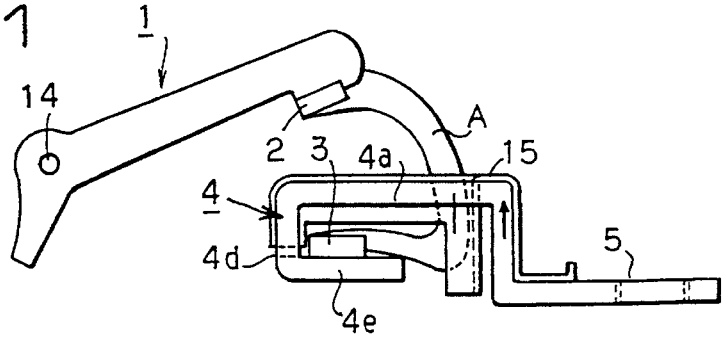
FIG. 21 is a side view of an electrode portion of a circuit breaker according to the embodiment 5.

FIG. 21 is a side view of an essential part according to the embodiment 5.

The fixed contact 4 according to the embodiment is provided such that the terminal 5 is positioned below the first conductor portion 4*a* and a surface of the stationary contact 3. There is the same effect because of the terminal 5 disposed below the first conductor portion 4*a* as in the case of the embodiment 4.

In the embodiment 5, the terminal 5 is further downward positioned below the surface of the stationary contact 3. Thereby, the upward current component to complement the arc is increased so as to enhance the complementary effect, and higher arc voltage can be maintained in an end half of the cutoff operation. As a result the, it is possible to reduce time period required for completion of current cutoff, and reduce a total amount of energy and running energy generated in the breaker by the cutoff operation.

Embodiment 6

Figure 22:
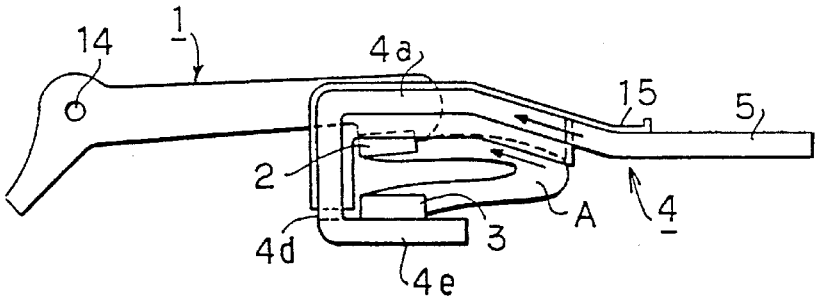
FIG. 22 is a side view of an electrode portion of a circuit breaker according to the embodiment 6.
Figure 23:
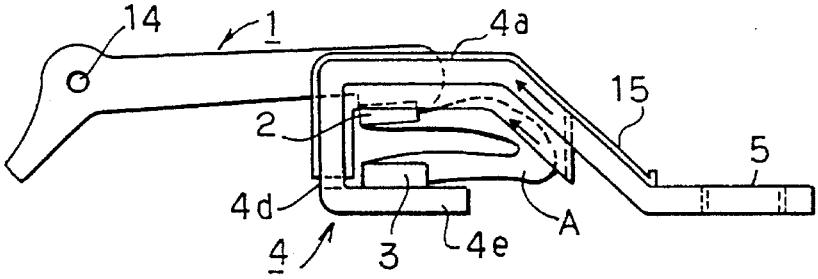
FIG. 23 is a side view of an electrode portion of a circuit breaker according to an alternative embodiment of the embodiment 6.

FIGS. 22 and 23 are side views of essential parts according to the embodiment 6. The fixed contact 4 according to the embodiment 6 is integrally formed with the first conductor portion 4*a* having a convex-shaped bent portion on the side opposed to the stationary contact 3. In FIGS. 22 and 23, the bent portions of the first conductor portions 4*a* have each different bending angle.

In case of the fixed contact 4, though the complementary effect by the upward current component is decreased, it is possible to accelerate an initial rising of the arc voltage since the arc A in the vicinity of the traveling contact 2 can be partially stretched efficiently during a contact opening initial period with relatively small current.

Further, the bent portion of the first conductor portion 4*a* has an obtuse angle, and it is thereby possible to facilitate bending of the fixed contact 4.

In addition, in case a position of the terminal is limited for the sake of connection to an external circuit, the first conductor portion 4*a* is disposed above the terminal 5 as shown in FIGS. 20 to 23. Accordingly, a length of the third conductor portion 4*d* is naturally extended, resulting in an increased action of repulsion between downward current in the third conductor portion 4*d* and upward current in the arc A. As a result, it is possible to enhance stretch of the arc A.

Embodiment 7

Figure 24:
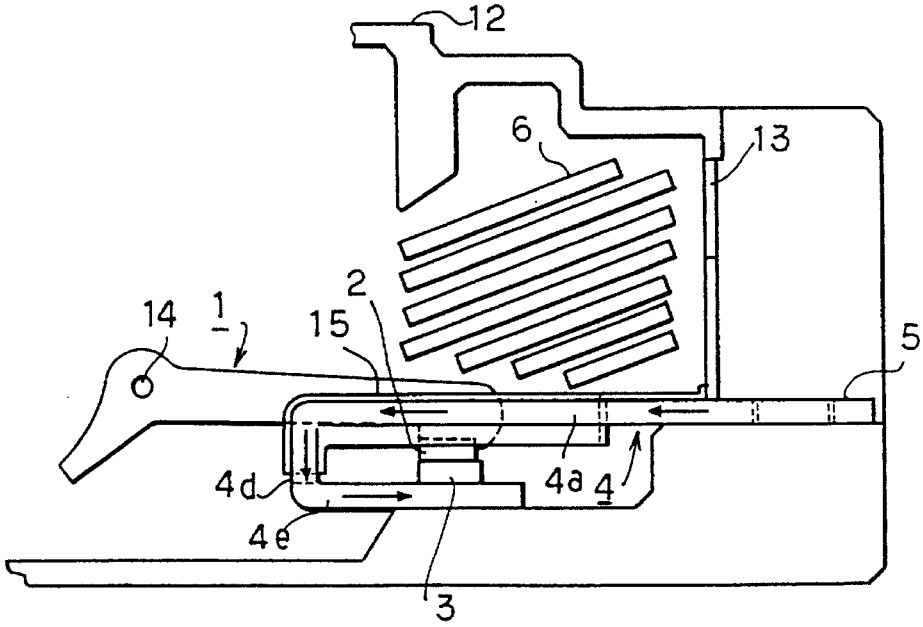
FIG. 24 is a side view of an electrode portion of a circuit breaker according to the embodiment 7.

FIG. 24 is a side view of an essential part according to the embodiment 7. In the embodiment 7, instead of the second conductor portion 4*e* to which the stationary contact 3 is secured in the fixed contact 4 according to the embodiment 1, the second conductor portion 4*e* extends in a direction of the rotating center 14 of the moving contact 1 such that the current in the second conductor portion 4*e* can be substantially antiparallel to the current in the moving contact 1 at the closing time.

In a configuration as set forth above, the electromagnetic force generated by the current in the second conductor portion 4*e* to stretch the arc A on the side of the terminal 5 can be increased, and electromagnetic repulsion is applied between the moving contact 1 and the second conductor portion 4*e* at the closing time. Thus, a rotation speed of the moving contact 1 is increased so as to rapidly extend the arc length immediately after the contact opening. As a result, it is possible to provide more rapid rising of arc resistance, and a further improved current-limiting performance.

Embodiment 8

Figure 25:
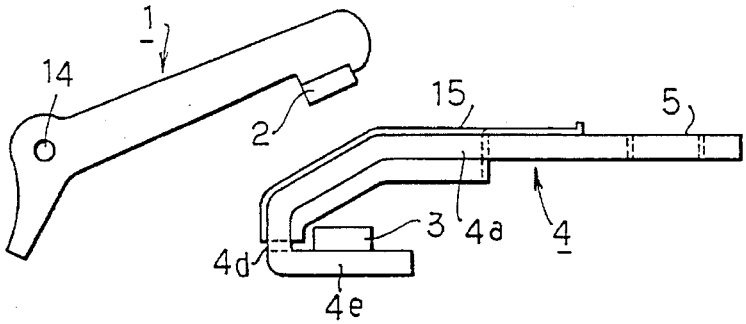
FIG. 25 is a side view of an electrode portion of a circuit breaker according to the embodiment 8.

FIG. 25 is a side view of an essential part according to the embodiment 8. In the fixed contact 4 according to the embodiment 8, the first conductor portion 4*a* includes a diagonal position which is connected to the third conductor portion 4*d*. As a result, it is possible to increase intensity of magnetic field to stretch the arc A on the surface of the stationary contact 3.

A further detail description will now be given of the above discussion.

In order to provide the maximum intensity of the magnetic field generated by the fixed contact 4 in a direction to stretch the arc at a central point of the surface of the stationary contact 3, it is ideally necessary to dispose a conductor portion of the fixed contact 4 on a cylindrical surface perpendicular to a rotation surface of the moving contact 1 with the central point of the surface of the stationary contact 3 as a center, having a radius so as to provide the maximum magnetic field in a direction to stretch the arc A. The radius may be varied according to a configuration of the conductor portion of the fixed contact 4.

For example, in case there is disposed the symmetrical first conductor portion 4*a* between which the slit 40 is interposed with respect to the rotation surface of the moving contact 1 as shown in FIG. 13, the radius is equal to a value half a distance between the right and left conductor portions.

However, it is difficult or very costly to completely dispose the conductor portion along the cylindrical surface in actuality.

Therefore, the conductor portion is desirably provided in a form which is similar to that of the ideal cylinder, and can be easily fabricated.

As in the embodiment 1, though decreasing the number of the bent portions causes a simplified fabrication of the fixed contact 4, more increased number of conductor portions of the fixed contact 4 are deviated from positions on the ideal cylinder.

Hence, as shown in FIG. 25, the number of the bent portions in the first conductor portion 4*a* is increased so as to reduce the deviation from the ideal cylinder, and increase the intensity of the magnetic field to stretch the arc on the surface of the stationary contact 3. Further, it is possible to minimize a rise of the fabrication cost or the like.

Embodiment 9

Figure 26:
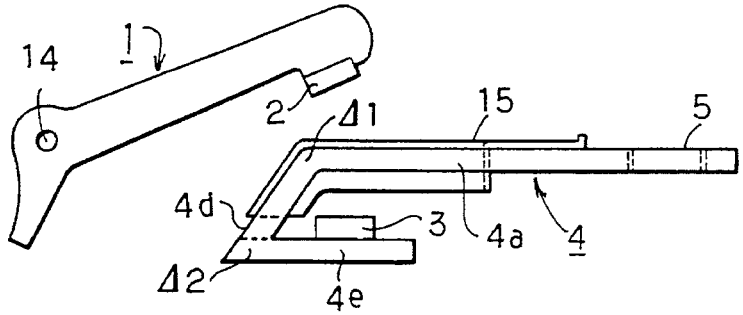
FIG. 26 is a side view of an electrode portion of a circuit breaker according to the embodiment 9.

FIG. 26 is a side view of an essential part according to the embodiment 9. In the fixed contact 4 according to the embodiment 9, the first conductor portion 4*a* is continuously formed with the third conductor portion 4*d* through an obtuse bent portion Δ1, and the third conductor portion 4*d* is continuously formed with the second conductor portion 4*e* through an acute bent portion Δ2. Further, the third conductor portion 4*d* is diagonally provided such that the obtuse and the acute can form a convex shape on the side opposed to the stationary contact 3.

According to the embodiment 9, it is possible to further reduce the deviation from the ideal cylinder without increasing the number of the bent portions than more the deviation in the embodiment 1.

In case a circuit breaker has a large current-carrying ability, the conductor portion of the fixed contact 4 has a large-sized section. As a result, it is difficult to perform the bending with a small radius as shown in FIGS. 25 and 26.

Embodiment 10

Figure 27:
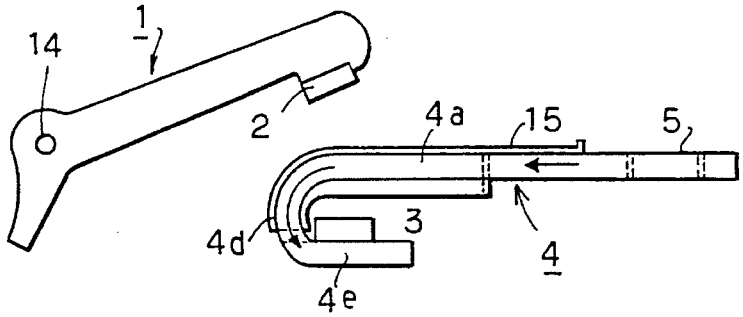
FIG. 27 is a side view of an electrode portion of a circuit breaker according to the embodiment 10.

FIG. 27 is a side view of an essential part according to the embodiment 10. The fixed contact 4 according to the embodiment 10 is provided in a curve-shape in which the third conductor portion 4*d* forms a convex shape on the side opposed to the stationary contact 3.

Thereby, the conductor portions can be disposed like the ideal cylindrical form even if the conductor portion of the moving contact 1 has a large sized section. As a result, it is possible to provide a rapid rising of the arc voltage.

Embodiment 11

Figure 28A:
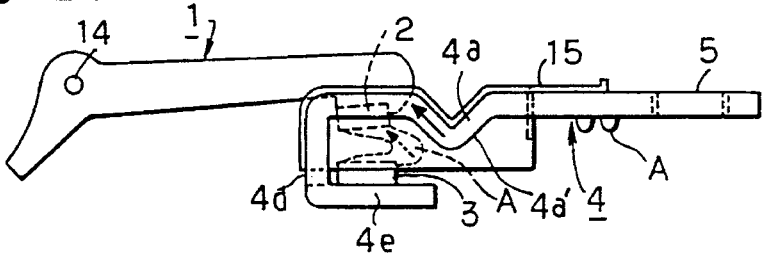
FIG. 28(*a*) is a side view of an electrode portion of a circuit breaker according to the embodiment 11, showing a condition immediately after the contact opening.
Figure 28B:
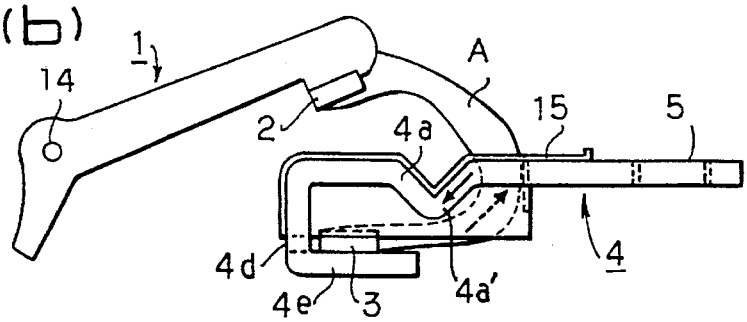

FIG. 28(*a*) is a side view of an essential part according to the embodiment 11, showing a condition immediately after the contact opening. FIG. 28(*b*) is a side view of an essential part, showing the maximum opening condition of FIG. 28(*a*).

In the fixed contact 4 according to the embodiment, the first conductor portion 4*a* is provided with a projecting portion 4*a*, so as to project on the side of the fixed contact 4, and a top of the projecting portion 4*a* is positioned on the side of the terminal 5 with respect to the stationary contact 3.

In such a configuration as described above, for a contact opening initial period, the arc A is attracted by a current component of a diagonally upward current flow in the projecting portion 4*a*, as shown FIG. 28(*a*) so that the arc A is rapidly stretched. Accordingly, it is possible to provide more rapid rising of the arc voltage.

As shown in FIG. 28(*b*), when the contacts 2 and 3 are further opened so as to extend the arc length, the arc A is stretched from the top of the projecting portion 4*a* of the first conductor portion 4*a* to the side of the terminal 5. At this time, a current component of a diagonally downward current flow in the projecting portion 4*a* and the arc current have reverse directions so as to repel each other. Consequently, it is possible to prevent the arc A from turning back in a direction between the contacts 2 and 3, and maintain high arc voltage.

Embodiment 12

Figure 29:
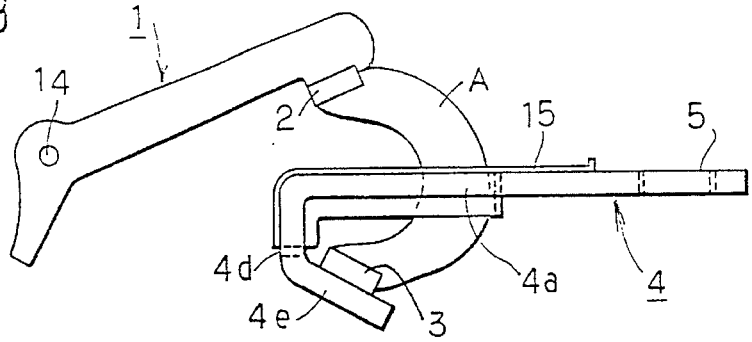
FIG. 29 is a side view of an electrode portion of a circuit breaker according to the embodiment 12.

FIG. 29 is a side view of an essential part according to the embodiment 12. In the fixed contact 4 according to the embodiment 12, one end of the second conductor portion 4*e* to which the stationary contact 3 is secured is arranged below the other end thereof, and the contact surface of the stationary contact 3 vertically faces the side of the terminal 5 with respect to a vertical line.

In such a configuration as described above, it is possible to direct an emitting direction of the arc A on the stationary contact 3 to the side of the terminal 5.

In general, as the current of the arc A becomes large, emitting force of the arc from a contact surface is increased, and stretch effect by the magnetic field becomes relatively small. Hence, the arc stretched by the magnetic field in a relatively small current area for a cutoff operation initial period may be also drawn back to the direction between the contacts according to the increase of the current, resulting in the reduced arc voltage.

Therefore, in case the emitting direction of the arc is directed to the side of the terminal 5 as shown in FIG. 29, the arc A never turns back between the contacts 2 and 3 even if the emitting force of the arc A becomes large. As a result, it is possible to maintain the arc voltage.

Embodiment 13

Figure 30:
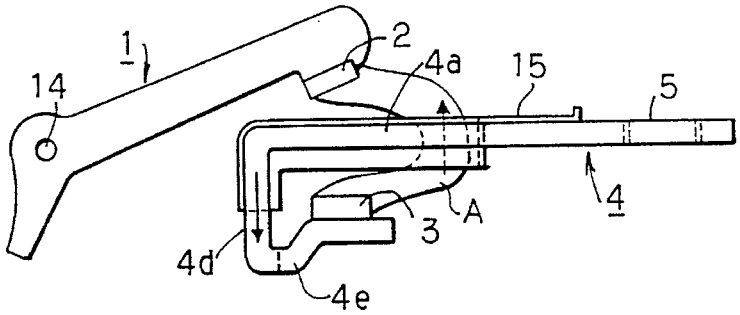
FIG. 30 is a side view of an electrode portion of a circuit breaker according to the embodiment 13.

FIG. 30 is a side view of an essential part according to the embodiment 13. In the fixed contact 4 according to the embodiment 13, a conductor position of the second conductor portion 4*e* to which the stationary contact 3 is secured is positioned above a connecting position between the second conductor portion 4*e* and the third conductor portion 4*d*.

In the above configuration, a current path of the third conductor portion 4*d* is extended so as to increase force generated by the current in the current path to eject the arc A on the side of the terminal 5. Further, a conductor position of the second conductor portion 4*e* on the side of the third conductor portion 4*d* with respect to the stationary contact 3 is separated from the arc. Hence, the arc is difficult to extend on the side of a mechanism portion (which is generally disposed on the side of the rotating center 14 of the moving contact 1) even if the arc has a larger diameter as the arc current increases. Accordingly, it is possible to avoid a heat flow and fused material with the heat flow from flowing into the mechanism portion. As a result, it is possible to avoid incapability of a switching action after the cutoff operation.

In the embodiment 13 (i.e., in FIG. 30), though a housing is not shown, a space may be provided between the conductor position and the housing by further upward positioning the conductor position to which the stationary contact 3 is secured.

In case there is not the space as described before, pressure generated by the arc. A which is ejected on the side of the terminal 5 with respect to the stationary contact 3 is reflected from an adjacent housing portion so that the arc is hardly ejected further on the side of the terminal 5.

Thus, reflection of the arc pressure is reduced by separating the adjacent housing portion from the conductor position. As a result, it is possible to generate an air flow which facilitates the ejection of arc A on the side of the terminal 5.

Embodiment 14

Figure 31:
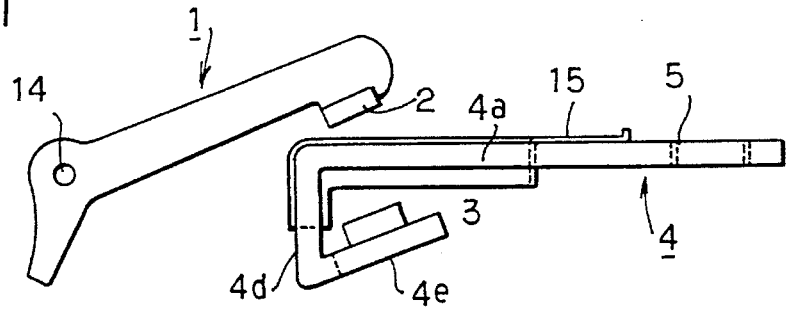
FIG. 31 is a side view of an electrode portion of a circuit breaker according to the embodiment 14.

FIG. 31 is a side view of an essential part according to the embodiment 14. In the fixed contact 4 according to the embodiment 14, an acute connecting portion is provided between the second conductor portion 4*e* and the third conductor portion 4*d*, and the second conductor portion 4*e* is provided with no bent portion. Therefore, it is possible to provide the same effect as in the embodiment 13.

Embodiment 15

Figure 32:
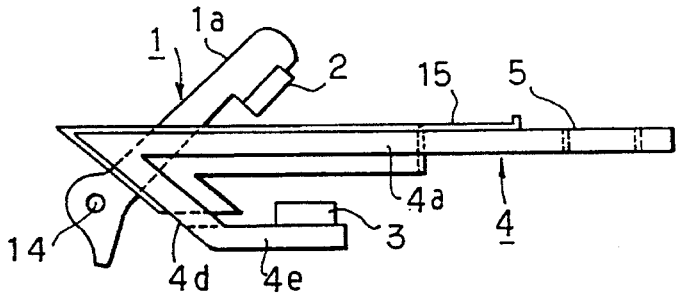
FIG. 32 is a side view of an electrode portion of a circuit breaker according to the embodiment 15.

FIG. 32 is a side view of an essential part according to the embodiment 15. In the fixed contact 4 according to the embodiment 15, the third conductor portion 4*d* is diagonally provided such that an upper portion of the third conductor portion 4*d* rather than a lower portion thereof can be positioned on the side of the rotating center 14 of the moving contact 1.

In the above configuration, for a relative long period from a contact opening initial time to an end half of a contact circuit operation, the moving contact 1 is partially positioned in a space which is defined by the first conductor portion 4*a*, the second conductor portion 4*e* and the third conductor portion 4*d*. For the relative long period, force is applied to the moving contact 1 in a contact opening direction by magnetic field generated by current in the fixed contact 4. Accordingly, an opening speed of the moving contact 1 is not decreased even after the traveling contact 2 rises above an upper portion of the first conductor portion 4*a* in addition to the contact opening period. As a result, it is possible to advance a time for achieving the maximum opening distance.

Typically, in the cutoff operation for a relatively small short-circuit current area in a circuit having a relative high power source voltage (of, for example, 550 V), small electromagnetic repulsion is applied to the moving contact 1, and the opening distance between contacts is small even immediately before current cutoff. Hence, dielectric breakdown may occur between the contacts, resulting in cutoff failure.

Therefore, it is possible to avoid the cutoff failure by advancing the time for achieving the maximum opening distance of the contacts as described with reference to FIG. 32.

Embodiment 16

Figure 33:
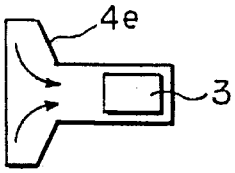
FIG. 33 is a top view of a second conductor portion according to the embodiment 16.

FIG. 33 is a top view of a second conductor portion according to the embodiment 16. As shown in FIG. 33, the second conductor portion 4*e* has a narrow width on the side to which the stationary contact 3 is secured so as to concentrate current in the second conductor portion 4*e* on the side of the stationary contact 3 along a center line of the conductor portion as close to the center line as possible.

In such a way, the current is centered so as to increase the magnetic component to stretch the arc A in the vicinity of the stationary contact 3, which is generated by the current in the second conductor portion 4*e*. Further, electromagnetic repulsion is increased between the current in a conductor of the moving contact 1 and the current in the second conductor portion 4*e* so as to increase the opening speed of the moving contact 1.

The above effects provide more rapid rising of the arc voltage and an improved current-limiting performance. In general, though the arc diameter extends as the arc current increases, extension of the arc diameter can be limited so as to increase arc current density in case the second conductor portion 4*e* has the narrow width on the side to which the stationary contact 3 is secured as shown in FIG. 33. Accordingly, it is possible to maintain high arc voltage because of increased arc resistance.

Embodiment 17

Figure 34A:
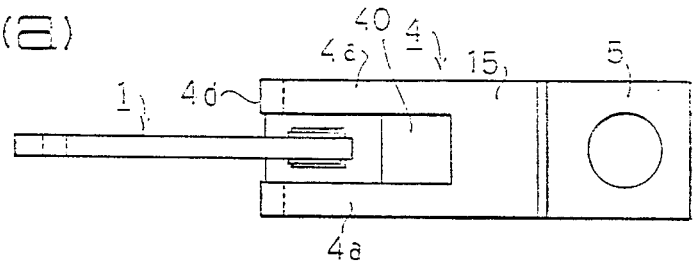
FIG. 34(*a*) is a top view of a moving contact and a fixed contact according to the embodiment 17.
Figure 34B:
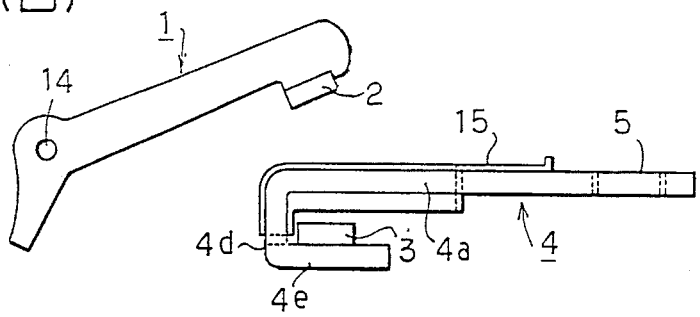

FIG. 34(*a*) is a top view of the moving contact 1 and the fixed contact 4 according to the embodiment 17, and FIG. 34(*b*) is a side view of FIG. 34(*a*).

In the embodiment 17, a slit 40 is provided in the fixed contact 4 so as not to prevent the switching action of the moving contact 1, and the conductor portions 4*a*, 4*a* on the right and left sides of the slit 40 are disposed substantially parallel to each other.

Embodiment 18

Figure 35:
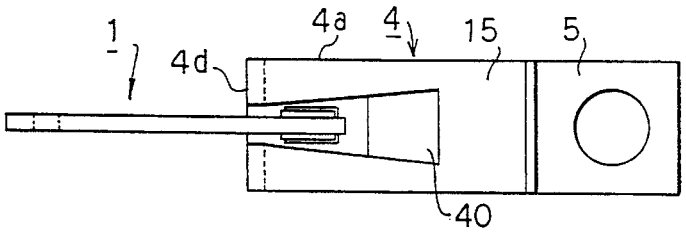
FIG. 35 is a top view of a moving contact and a fixed contact according to the embodiment 18.

FIG. 35 is a top view of the moving contact 1 and the fixed contact 4 according to the embodiment 18. In the embodiment 18, the slit 40 is provided in the fixed contact 4 so as to have a width on the side of the rotating center 14 of the moving contact 1, which becomes gradually less than a width on the side of terminal 5.

Since the slit 40 is formed as set forth above, it is possible to prevent a heat flow from flowing into the side of the rotating center 14 at a time of cutoff operation.

A mechanism portion is typically provided on the side of the rotating center 14 of the moving contact 1 in order to switch the moving contact 1. The heat flow allows a fused material to adhere to the mechanism portion, thereby contributing to incapability of reclosing after the cutoff operation. Further, the heat flow may cause the arc to form at a conductor position on the side of the rotating center 14 of the moving contact 1 with respect to the traveling contact 2 so as to rapidly decrease the arc voltage, resulting in capability of cutoff.

Therefore, the slit 40 is provided so as to have a narrower width on the side of the rotating center 14 of the moving contact 1 than that on the side of the terminal 5 as shown in FIG. 35. It is thereby possible to avoid the heat flow so as to implement a highly reliable cutoff performance.

Embodiment 19

Figure 36:
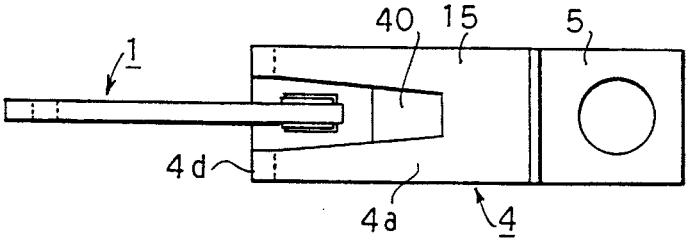
FIG. 36 is a top view of a moving contact and a fixed contact according to the embodiment 19.

FIG. 36 is a plan view of an essential part according to the embodiment 19. In the embodiment 19, the slit 40 in the fixed contact 4 has larger width on the side of the rotating center 14 of the moving contact 1 than that of the slit 40 on the side of terminal 5 in contrast with the case of FIG. 35. As the width of the slit 40 becomes narrower, an effect that the arc is cooled by contacting the insulator 15 becomes greater. Further, in case an arc section is increased according to increased pass current, the arc section can be restricted by the width of the slit 40 so as to further increase the arc voltage.

However, lateral deviation of the moving contact 1 occurs in the course of the switching action thereof in actuality. Hence, it is difficult to provide a slit width or less which is set by taking the deviated width into account.

Therefore, the lateral width of the fixed contact 4 is extended larger than the deviated width, and the slit width on the side of the terminal 5 with respect to the fixed contact 4 is reduced as shown in FIG. 36. As a result, it is possible to provide a reliable switching action, cool the arc stretched in the direction of the terminal 5 by the insulator 15, and implement a high current-limiting performance by restricting the arc section. Further, in case the width of the slit 40 becomes narrower toward the inner side of the slit 40 as set forth above, it is possible to facilitate attachment of the insulator 15 to an inner surface of the slit 40.

Embodiment 20

Figure 37:
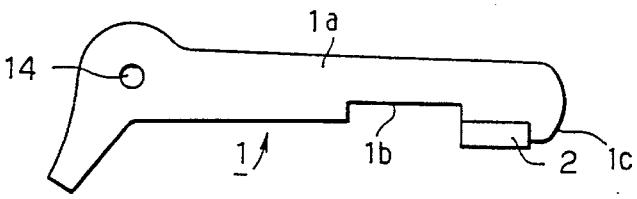
FIG. 37 is a side view of a moving contact according. to the embodiment 20.

FIG. 37 is a side view of a moving element according to the embodiment 20. The moving contact 1 is provided such that a position 1*b* of a moving conductor 1*a* on the side of the rotating center 14 with respect to the traveling contact 2 is withdrawn above a secured surface of the traveling contact 2.

In general, an area of an arc spot increases according to increase of current at a time of the cutoff operation, resulting in increased arc section. At this time, if the position 1*b* of the moving conductor 1*a* is not withdrawn upward unlike FIG. 37, it is impossible to limit the extending arc spot in only the traveling contact 2 and a position 1*c* of the moving conductor 1*a* on the side of the terminal 5 with respect to the traveling contact 2. The arc spot further extends up to the position 1*b* of the moving conductor 1*a* on the side of the rotating center 14 with respect to the traveling contact 2 so that the moving conductor 1*a* is melted into a thinner moving conductor and has reduced mechanical strength. Further, the extended arc spot may develop heat when the moving conductor 1*a* is energized after the cutoff operation. In the worst condition, the moving conductor on the side of the traveling contact 2 may partially drop out, resulting in capability of reclosing. Since the moving conductor 1*a* may be generally made of copper or copper alloy so as to be easier fused than the traveling contact 2, a large amount of metallic vapor is generated in an area from the position 1*b* of the moving conductor 1*a* to the traveling contact 2 in case the arc extends to the position 1*b* of the moving conductor 1*a*. Therefore, a vicinity of the position 1*b* of the moving conductor 1*a* is recovered from insulation with delay immediately before the current cutoff so that incapability of cutoff may occur.

In order to overcome the problems as set forth above, there are two methods, that is, one method of covering the position 1*b* of the moving conductor 1*a* with the insulator, and the other method of separating the position 1*b* of the moving conductor 1*a* from the arc.

Embodiment 21

Figure 38A:
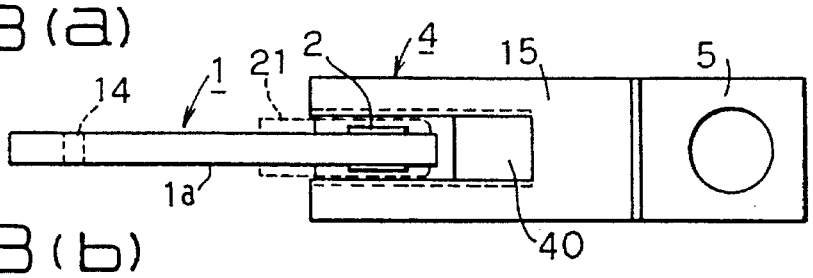
FIG. 38(*a*) is a plan view of an electrode portion of a circuit breaker according to the embodiment 21.
Figure 38B:
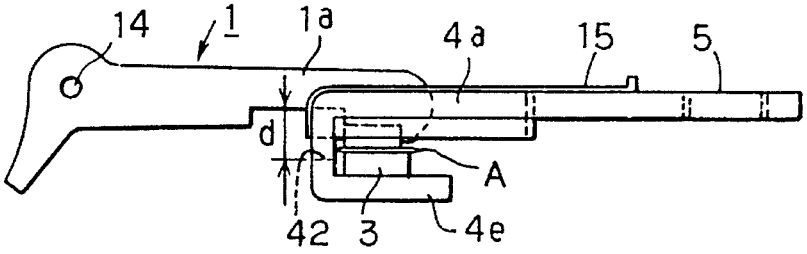

FIG. 38(*a*) is a plan view of an essential part according to the embodiment 21, and FIG. 38(*b*) is a side view of FIG. 38(*a*).

As shown in FIG. 38(*a*), in case an insulator 21 is attached to the moving contact 1, the width of the moving contact 1 is increased. Therefore, it is necessary to provide a wide width of the slit 40 as shown by the broken line in FIG. 38(*a*). Accordingly, conductor portions on the right and left sides of the slit 40 have smaller section so that a sufficient power supply performance can not be obtained.

For this reason, in case it is difficult to employ a method of covering the position 1*b* of the moving conductor 1*a* with the insulator, a configuration of the moving contact 1 as shown in FIG. 37 can be effectively provided to separate the position 1*b* of the moving conductor 1*a* from the arc.

When the fixed contact 4 shown in FIG. 38(*a*) is employed, it is possible to substantially restrict the arc spot extending according to the increasing current to areas including the traveling contact 2 and a position 1*c* of the moving conductor 1*a* on the side of the terminal 5 with respect to the traveling contact 2. As a result, it is possible to increase the arc voltage.

Further, if the position 1*b* of the moving conductor 1*a* is withdrawn upward, it is possible to extend a distance d between one end 42 of the slit 40 and the moving conductor 1*a* immediately after arcing as shown in FIG. 38(*b*). As a result, it is possible to prevent the arc voltage from decreasing according to dielectric breakdown between the one end 42 of the slit 40 and the moving conductor 1*a*.

Embodiment 22

Figure 39A:
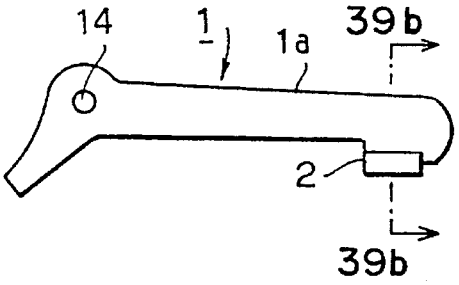
FIG. 39(*a*) is a side view of a moving contact according to the embodiment 22.
Figure 39B:
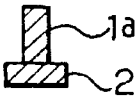

FIG. 39(*a*) is a side view of a moving contact according to the embodiment 22, and FIG. 39(*b*) is a sectional view taken along line 39*b*—39*b*. The moving contact according to the embodiment is provided such that the moving conductor 1*a* has a narrower width than that of the traveling contact 2.

According to the embodiment 22, the moving contact 1 is accelerated by receiving large electromagnetic force in an opening direction at a time of cutoff operation of short-circuit current.

The moving contact 1 accelerated at a high speed typically collides with a stopper provided for a part of the housing, so as to stop. At this time, impact force is applied to the moving contact 1 so that the moving conductor 1*a* with insufficient mechanical strength may be deformed.

In order to improve the mechanical strength of the moving contact 1, the moving conductor 1*a* may have a large section. However, as the width of the moving conductor 1*a* becomes large, the width of the slit 40 should be also large, resulting in reduced current-limiting performance.

Therefore, as shown in FIG. 39(*b*), the moving contact 1 is preferably provided such that a lateral width of the moving conductor 1*a* is less than a lateral width of the traveling contact 2, and a sectional area and sufficient mechanical strength required for the power supply can be ensured by a vertical width of the moving conductor 1*a*.

Though the traveling contact 2 is typically secured by brazing, it is possible to prevent the traveling contact 2 from dropping out with melt of the brazing point by an arc if the moving contact 1 is provided as set forth above.

As described previously, as the width of the slit 40 is more reduced, the arc cooling action and the restriction action of the arc section by the vapor of the insulator of the slit 40 become larger, resulting in improved current-limiting performance. However, since a large amount of vapor is generated according to the increased arc cooling action, pressure in the housing increases so that the housing may be damaged. Hence, in case there is a margin for current-carrying ability in conductors on the right and left sides of the slit 40, the width of the slit 40 may be relatively widely provided so as to reduce the generating pressure.

Though the extension of the width of the slit 40 causes reduced current-limiting performance, it is possible to compensate for the reduced current-limiting performance by disposing the insulator so as to restrict the arc section on the side of the moving contact 1.

As stated above, when the insulator is attached around the traveling contact 2, the moving conductor 1*a* having a narrower width than that of the traveling contact 2 as shown in FIG. 39(*b*) is employed. As a result, it is thereby possible to attach the insulator while reducing increase of the width of the moving contact 1 to a relatively small rate.

Embodiment 23

Before the detailed description of the embodiment 23, a description will now be given of a general characteristic of the magnetic field which is generated by current in current paths in case there are two substantially parallel current paths.

Figure 40A:
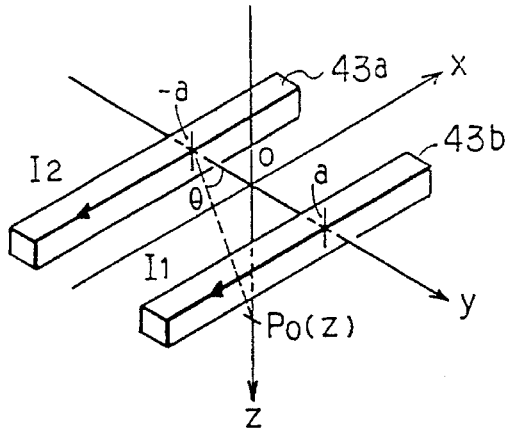
FIG. 40(*a*) is an explanatory view of a typical characteristic of magnetic field in a symmetry surface of parallel current.
Figure 40B:
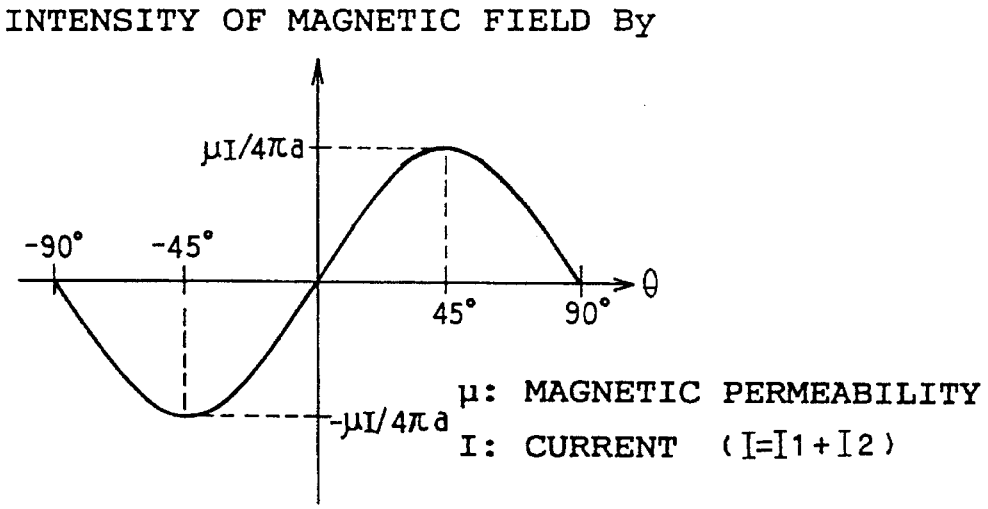
Figure 40C:
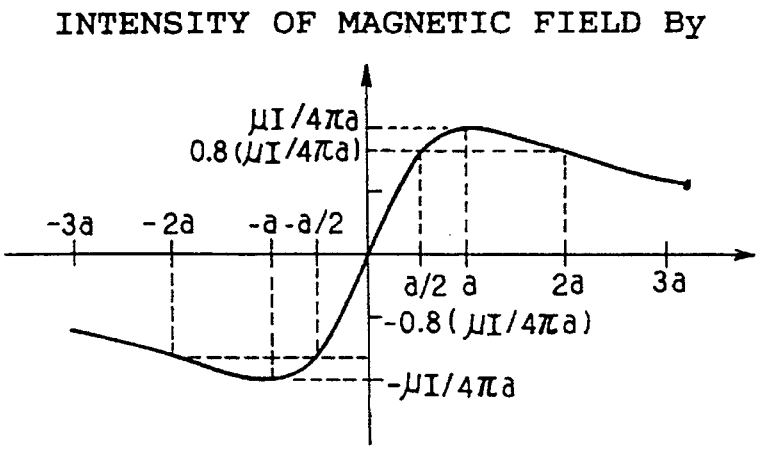

FIG. 40(*a*) is a simplified view illustrating the magnetic characteristic generated in the two current paths which are positioned on the right and left sides of the rotating surface of the moving contact. In FIG. 40(*a*), the z-x plane corresponds to a plane including a locus of the moving contact. Further, the terminal is positioned in a positive direction of the x-axis, the rotating center of the moving contact is positioned in a negative direction of the x-axis, and the traveling contact is positioned in a positive direction of the z-axis, respectively. Center lines of the current paths in right and left conductors 43*a* and 43*b* are arranged parallel to each other at an interval of 2*a* on the x-y plane. The right and left conductors 43*a* and 43*b* are symmetrically provided with respect to the z-x plane, and current I1 and I2 in the right and left conductors flow in a direction of −x. It is assumed that both magnitudes of the current are equal to each other, a component in a positive direction of the y-axis exerts on the arc so as to stretch on the side of the terminal (i.e., in the positive direction of the x-axis). At this time, for an angle θ between a line connecting the origin 0 to a point −a on the y-axis and a line connecting the point −a on the y-axis to an optional point P0 on the z-axis, variation of a y-directional magnetic field By in the point P0 can be expressed by the following expression:

$$By=(\mu I/4\pi a)\sin(2\theta)$$

where θ is in a range of −90°<θ<90°, μ is magnetic permeability, and current I=I1+I2

FIG. 40(*b*) is a graph diagram showing a relationship between the angle θ and the y-directional magnetic field By depending upon the expression. FIG. 40(*c*) is a diagram which is obtained by transforming a transverse axis of FIG. 40(*b*) into a length on the z-axis by using a relation of z=a·tanθ.

As understood from FIG. 40(*c*), an average rate of variation of the y-directional magnetic field By according to an increasing value of z in a range of a<z becomes smaller than that with the value of z in a range of 0≦z≦a. For example, the y-directional magnetic field can reach a peak value of 80% when z=a/2 in the range of 0≦z≦a, and when z=2a in the range of a<z.

Figure 41A:
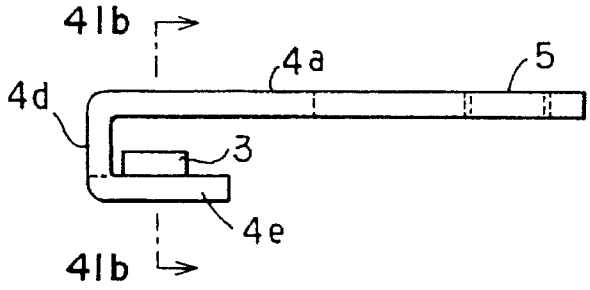
FIG. 41(*a*) is a side view of a fixed contact according to the embodiment 23.
Figure 41B:
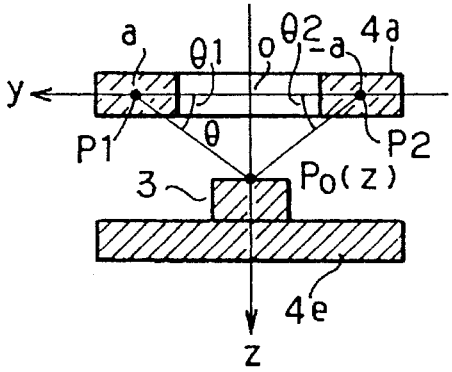

The relationship between the parallel conductors on the x-y plane and the point P0 on the z-axis can be applied to a practical embodiment as shown in FIG. 41.

FIG. 41(*a*) is a side view of a fixed contact according to the embodiment 23, and FIG. 41(*b*) is a sectional view taken along line 41*b*—41*b* FIG. 41(*a*). In the embodiment 23, the section taken along line 41*b*—41*b* corresponds to the y-z plane, P1 and P2 are defined as the centers of gravity in respective sections of the right and left first conductor portions 4*a*, and the point P0 is defined as a center of a surface of the stationary contact 3.

If the fixed contact 4 is provided so as to have the angle θ of 45° or more (a≦P0(z)), a point Pmax is positioned above the surface of the stationary contact and on the z-axis. At the point Pmax, the y-directional magnetic field By Generated by current in the right and left conductors of the slit 40 is maximized. Further, the y-directional magnetic field by generated by the current in the right and left conductors can reach a value which is substantially equal to the peak value even on the surface of the stationary contact 3.

That is, it is possible to increase the arc stretching force on the surface of the fixed contact and in a space in a vicinity above the surface, and improve rising of the arc voltage by providing the angle θ of 45° or more (a≦P≦0 (z)).

However, if the angle θ is set to 45° or more (a≦P0(z)), a large y-directional magnetic field By is applied to the current path of the second conductor portion so that downward electromagnetic force is applied to the conductor portion forming the current path. Further, since the first conductor portion 4*a* is positioned closer to the current path of the second conductor portion, the first conductor portion 4*a* receives a diagonally upward electromagnetic force as reaction against the electromagnetic force applied to the current path of the second conductor portion.

Consequently, in case the fixed contact can not have sufficient strength due to restrictions such as dimension, material cost, or processing technique, the fixed contact may be deformed by the electromagnetic force.

Therefore, in case magnetic field effect can be provided so as to stretch at least sufficient arc to cut off the current, it is possible to adjust the y-directional magnetic field applied to the current path so as to avoid the deformation by providing the angle θ1 and θ2 less than 45° (0<0(z)<a).

In the embodiment 1 of FIG. 11, the slit 40 is provided in the third conductor portion 4*d* as well as the first conductor portion 4*a*. Accordingly, it is possible to obtain the same magnetic field characteristic in right and left conductor portions of the third conductor portion 4*d* on both sides of the slit 40 as that in the right and left conductor portions of the first conductor portion 4*a* on both sides of the slit 40.

Figure 42:
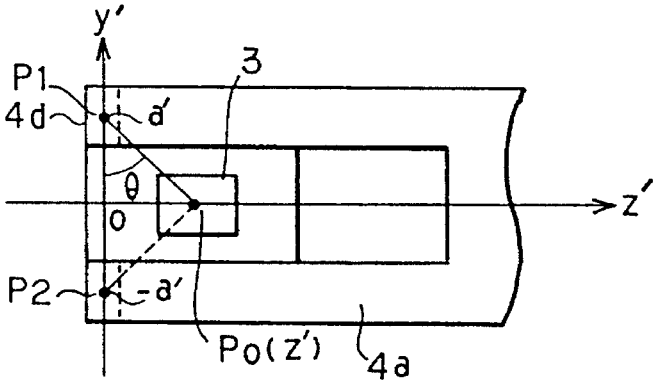
FIG. 42 is a partial view of a fixed contact according to the embodiment 23 as seen from the upper side.

FIG. 42 is a partial top view of a fixed contact according to the embodiment 23. In FIG. 42, a line for connecting the centers of gravity 42 in sections of the right and left conductors of the third conductor portion 4*d* on both sides of the slit 40 is defined as the y-axis. Further, x1, y1 and z1 coordinates are defined such that the z1-axis obtained by rotating the z-axis about the y-axis by −90° can pass through the central point P0 on the surface of the stationary contact 3. At this time, the relationship holding between the y-directional magnetic field By and z shown in FIG. 40(*c*), can also hold between the y-directional magnetic field generated by the current in the right and left sides of the third conductor portion 4*d* on both sides of the slit 40 and the z1.

In FIG. 42, if the angle θ1 is 45° or more (a1≦P0 (z)), the peak of the y-directional magnetic field By generated by the current in the right and left conductor portions on both sides of the slit 40 is positioned on the side of the third conductor portion 4*d* with respect to the stationary contact 3. Further, the y-directional magnetic field By generated by the current in the right and left conductor portions can have a value which is substantially equal to the peak value even on the surface of the stationary contact 3.

Even if the y1-z1 plane in the x1, y1 and z1 coordinates is moved in the direction of x1 in a range of a length of the third conductor portion 4*d*, the same relationship can be obtained.

For these reasons, if the angle θ is set to 45° or more (a≦P0 (z)), it is possible to increase the arc stretching force on the surface of the stationary contact 3 and in the space in the vicinity above the surface, and improve the rise of the arc voltage.

Further, the peak of the y-directional magnetic field By is positioned on the side of the rotating center of the moving contact with respect to the stationary contact 3 so that the arc is difficult to extend on the side of the mechanism portion. As a result, it is possible to reduce the heat flow into the side of the mechanism portion.

The arc spot is driven from the stationary contact 3 to the arc runner on the side of the terminal 5 in case an arc runner is provided on the side of the terminal 5 with respect to the stationary contact 3 (in case conductors of the second conductor portion 4*e* extend on the side of the terminal 5 with respect to the stationary contact 3, a position of the second conductor portion 4*e* on the side of the terminal 5 with respect to the stationary contact 3 is regarded as arc runner). However, even if the arc spot is transferred to the arc runner, the y-directional magnetic field By is not extremely reduced. As a result, it is possible to perform quick arc driving, and effectively stretch the arc at a distal end of the arc runner.

As described above, it is possible to reduce consumption of the fixed contact by transferring the arc to the arc runner so as to stretch the arc.

Focused on a cutoff performance when the arc runner is employed, the angle θ may be often preferably less than 45° (0<P0 (z)<a1).

The arc is typically positioned at the distal end of the arc runner immediately before current is cut off. The cutoff performance is seriously affected by how much the arc in the position can be stretched by the electromagnetic force.

In particular, in case a circuit voltage has relatively high voltage, and a current value to be cut off is relatively small, it is necessary to stretch the arc immediately before the cutoff. Therefore, the angle θ1 is set less than 45° (0<P0 (z)<a1), and the fixed contact 4 is provided so as to provide the maximum y-directional magnetic field By which is generated by the right and left conductors of the third conductor portion 4*d* on both sides of the slit 40. As a result, it is possible to enhance the cutoff performance in the cutoff condition as set forth above.

Embodiment 24

Figure 43:
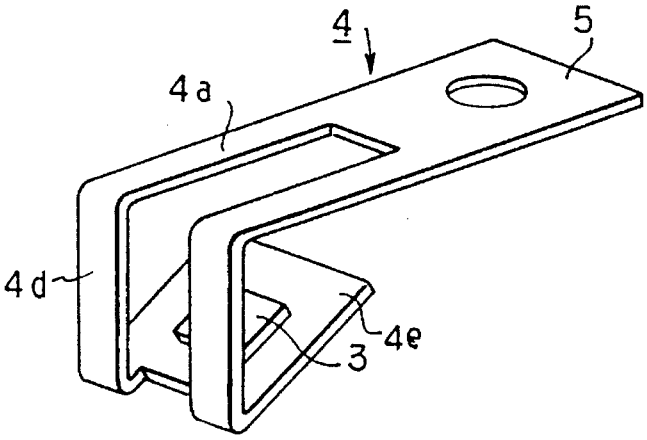
FIG. 43 is a perspective view of a fixed contact according to the embodiment 24.

FIG. 43 is a perspective view showing a fixed contact according to the embodiment 24. In the embodiment, the slit 40 is provided in the first conductor portion 4*a* and the third conductor portion 4*d*, and a conductor position of the second conductor portion 4*e* to which the stationary contact 3 is secured is positioned above a connecting portion between the second conductor portion 4*e* and the third conductor portion 4*d*. Accordingly, as in the embodiment shown in FIGS. 30 and 31, it is possible to extend the length of the third conductor portion 4*d*, resulting in larger force to press the arc on the side of the terminal 5.

FIG. 44(*a*) is a side view of the fixed contact of FIG. 43, FIG. 44(*b*) is a sectional view taken along line 44*b*—44*b* of FIG. 44(*a*), and FIG. 44(*c*) is a sectional view taken along line C2—C2 of FIG. 44(*a*). In the fixed contact 4 of the embodiment, the center point P0 on the surface of the stationary contact 3 is positioned such that the angles θ and θ1 are substantially equal to 45°. As a result, it is possible to increase a y-directional magnetic field component on the surface of the stationary contact 3.

Embodiment 25

FIG. 45(*a*) is a perspective view of a fixed contact according to the embodiment 25, and FIG. 45(*b*) is a perspective view of the fixed contact of FIG. 45(*a*) in an insulated condition.

While the slit 40 is provided in an area from the first conductor portion 4*a* to the third conductor portion 4*d* in the fixed contact 4 of FIG. 13, a very little slit 40 is provided in the third conductor portion 4*d* in the fixed contact 4 of the embodiment 25.

In case the slit 40 in the third conductor portion 4*d* is omitted as set forth above, it is possible to avoid the heat flow into the side of the rotating center 14 of the moving contact 1, and increase the arc stretching action by the current in the third conductor portion 4*d*.

Embodiment 26

Figure 46:
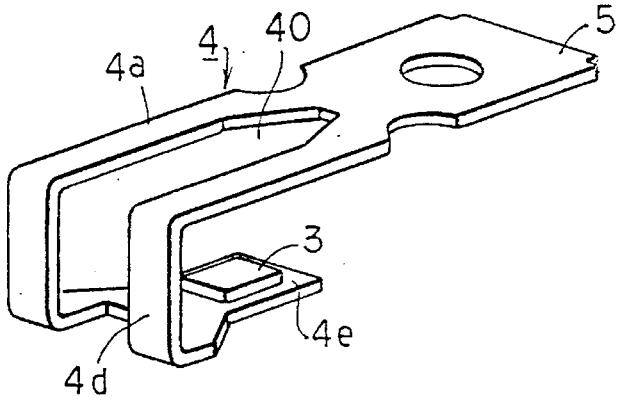
FIG. 46 is a perspective view of a fixed contact according to the embodiment 26.

FIG. 46 is a perspective view of a fixed contact according to the embodiment 26. In the fixed contact 4 according to the embodiment 26, the slit 40 is provided in the first conductor portion 4*a* and the third conductor portion 4*d*, and is partially provided in the second conductor portion 4*e*.

It is possible to facilitate bending of the fixed contact 4 by employing the slit 40.

Embodiment 27

Figure 47:
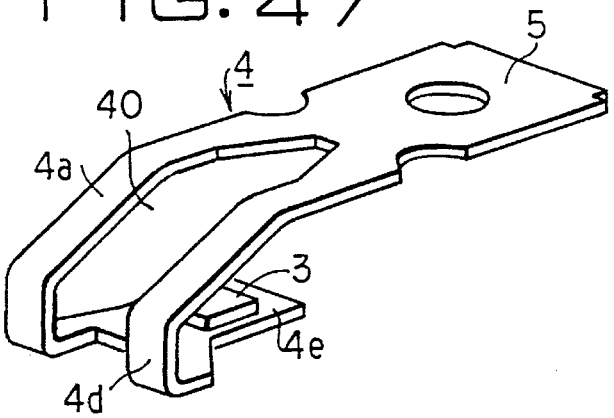
FIG. 47 is a perspective view of an alternative embodiment of the fixed contact of FIG. 46, showing the embodiment 27.

FIG. 47 is a perspective view of a fixed contact according to the embodiment 27. In the fixed contact 4 according to the embodiment 27, the first conductor portion 4*a* on the side of the third conductor portion 4*d* is diagonally formed.

Further, the slit 40 is provided in the first conductor portion 4*a* and the third conductor portion 4*d*, and is partially provided in the second conductor portion 4*e* as in the case of FIG. 46.

Accordingly, in the embodiment 27, it is possible to provide the same effect as that in the embodiment 26.

Embodiment 28

Figure 48:
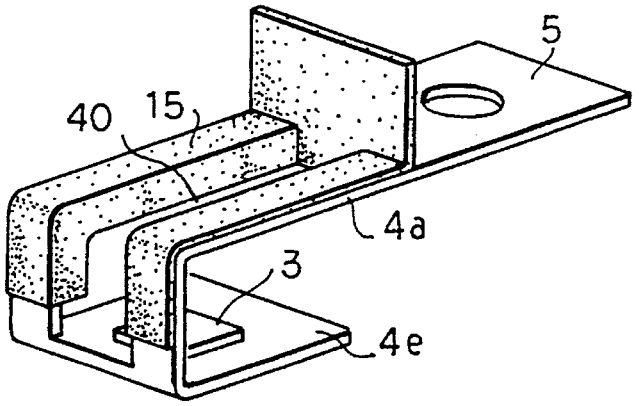
FIG. 48 is a perspective view of a fixed contact according to the embodiment 28.

FIG. 48 is a perspective view of a fixed contact according to the embodiment 28. According to the embodiment 28, an insulator 15*a* is upward extended to coat an inner portion of the slit 40 of the moving contact 1.

Since the fixed contact 4 is provided as described above, it is possible to increase an area of the insulator onto which the arc stretched on the side of the terminal 5 is pressed, improve an effect for cooling the arc, and increase arc voltage. As a result, a current-limiting performance can be enhanced.

It is also possible to prevent hot gas drawn on the side of the terminal 5 from an exhaust hole from contacting the terminal 5, and prevent the arc voltage from decreasing according to the arcing between the moving contact 1 and the terminal 5.

Embodiment 29

Figure 49:
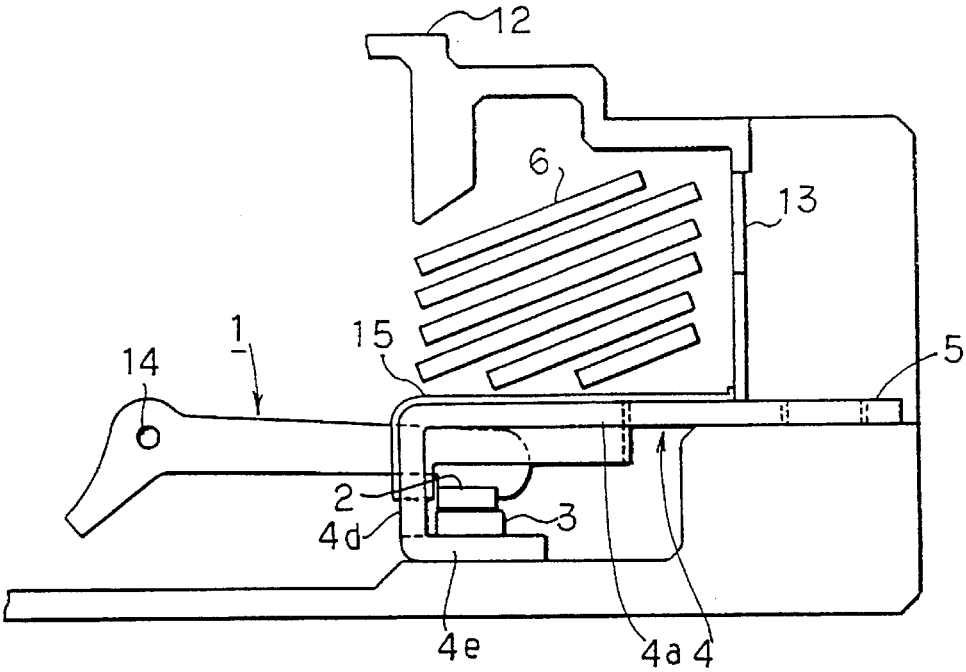
FIG. 49 is a side view of an arc-extinguishing portion, showing the closing condition of the circuit breaker according to the embodiment 29.
Figure 50:
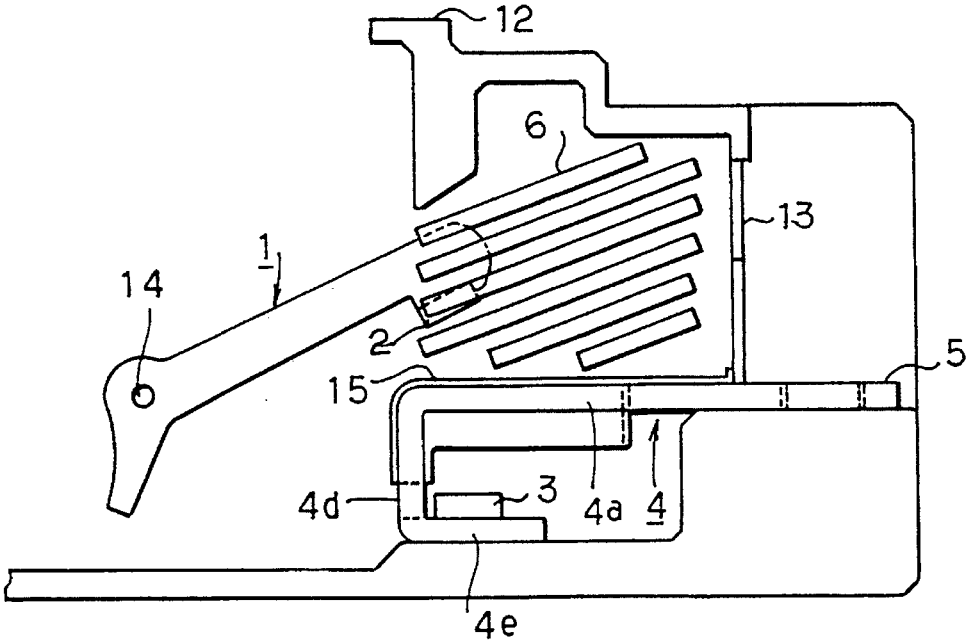
FIG. 50 is a side view showing the opening condition of the circuit breaker of FIG. 49.

FIG. 49 is a side view of an arc-extinguishing portion according to the embodiment 29, and FIG. 50 is a side view showing an opening condition of the circuit breaker of FIG. 49. The embodiment 29 differs from the above embodiment 1 in that the first conductor portion 4*a* is positioned above a center of a current path of the moving contact 1 in the embodiment 29.

A description will now be given of the operation.

As in the prior art, if large current such as short-circuit current flows, the moving contact 1 rotates to open the traveling contact 2 and the stationary contact 3 before the operation of the mechanism portion, and the arc A forms between the contacts 2 and 3.

Figure 51:
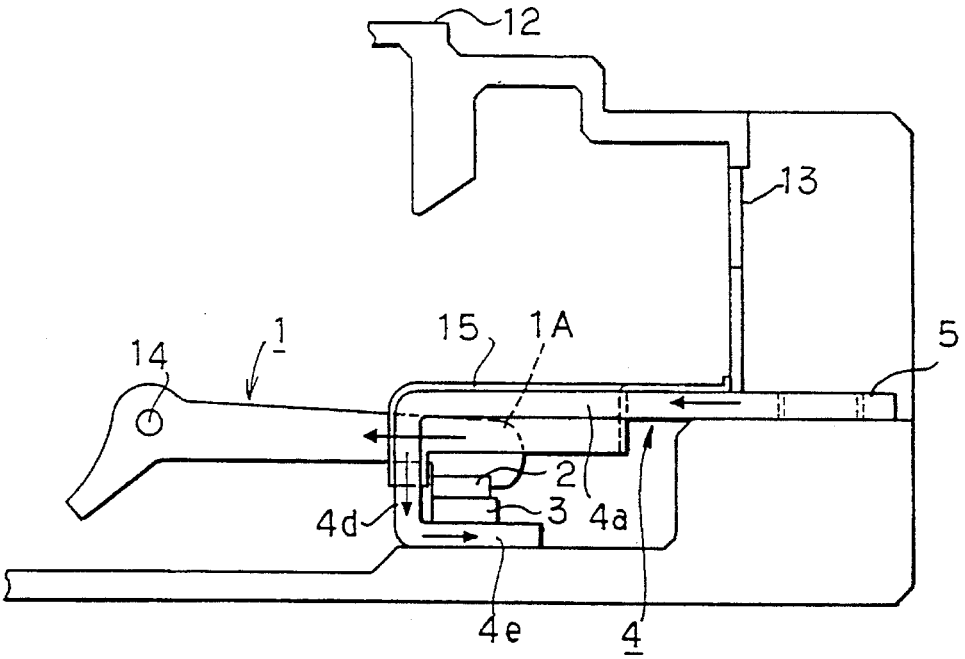
FIG. 51 is an explanatory view of the operation, showing a condition immediately before the contact opening of the circuit breaker of FIG. 49.

FIG. 51 shows a condition immediately before opening between the contacts 2 and 3. In FIG. 51, the arrow means current, and the arc-extinguishing plate 6 is omitted for the sake of simplicity.

In FIG. 51, since current in the moving contact 1 has the same direction as that of current in the first conductor portion 4*a*, the moving contact 1 is sucked upward. Current in the third conductor portion 4*d* flows perpendicular to the current in the moving contact 1. Therefore, force is applied to a position 1A of the moving contact 1 on the side of the terminal 5 with respect to the third conductor portion 4*d* in a direction to open the moving contact 1.

On the other hand, force is applied to a position 1B of the moving contact 1 on the side of the rotating center 14 with respect to the third conductor portion 4*d* in a direction opposed to the direction to open the moving contact 1.

However, an interval from the rotating center 14 to the position 1A is larger than that from the rotating center 14 to the position 1B. Hence, a total moment of inertia is applied to the moving contact 1 by the current in the third conductor portion 4*d* exerted in the direction to open the moving contact 1.

Therefore, whole electromagnetic force generated by each current component in the fixed contact 4 can serve as a force in the direction to open the moving contact 1.

As a result, a distance between the contacts 2 and 3 can rapidly increase immediately after the contact opening, and the arc resistance can rise quickly.

Figure 52:
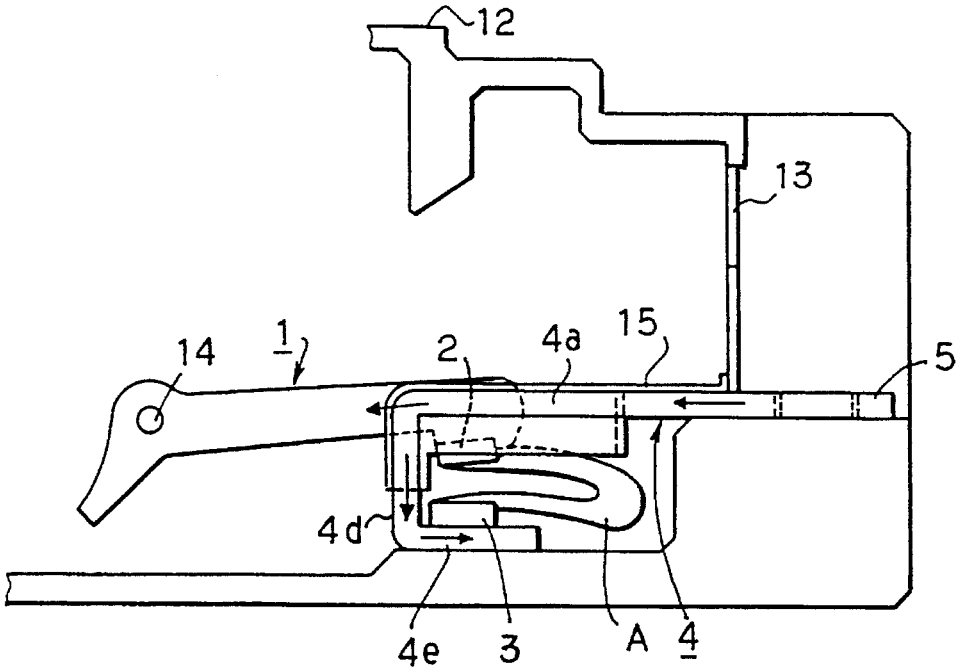
FIG. 52 is an explanatory view of the operation, showing a condition immediately after the contact opening of the circuit breaker of FIG. 51.

FIG. 52 shows a condition immediately after opening the contacts 2 and 3, where the traveling contact 2 is still positioned below the first conductor portion 4*a*.

A current path including an area from the terminal 5 to the first conductor portion 4*a* is entirely positioned above the arc A. As a result, electromagnetic force applied to the arc A, which is generated by the current path, can serve as force to stretch the arc A on the side of the terminal 5. Further, the current in the third conductor portion 4*d* has a direction opposed to that of current of the arc A so that electromagnetic force generated by the current in the third conductor portion 4*d* can also serve as force to stretch the arc on the side of the terminal 5.

Accordingly, the entire electromagnetic force generated by the current in the fixed contact 4 can serve as the force to stretch the arc A on the side of the terminal 5. As a result, the arc A is strongly stretched immediately after the contact opening so as to rapidly increase the arc resistance.

Figure 53A:
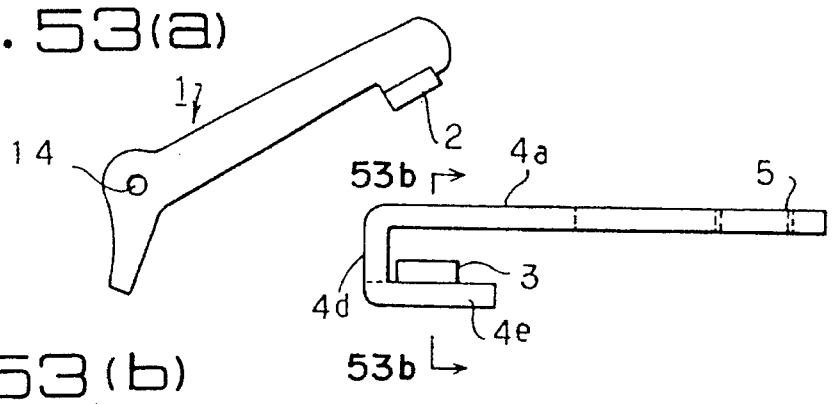
FIG. 53(*a*) is an explanatory view of intensity distribution of magnetic field which is generated by current in the fixed contact of FIG. 50.
Figure 53B:
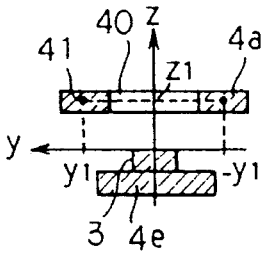
Figure 53C:
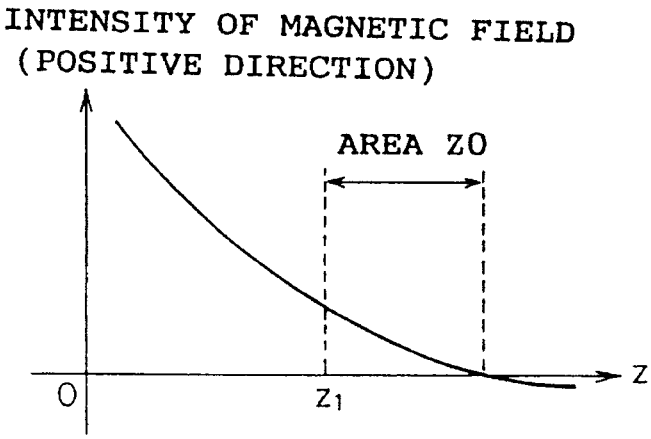

FIG. 53(*a*) is a side view of a moving element and a fixed contact, illustrating intensity distribution of magnetic field which is generated by the current in the fixed contact. FIG. 53(*b*) is a sectional view taken along line 53*b*—53*b* of FIG. 53(*a*). The embodiment 29 differs from the above embodiment 1 in a relative position of the moving contact 1 with respect to the first conductor portion 4*a*.

In the drawings, reference numeral 41 means the centers of gravity of respective sections of the first conductor portions 4*a* on the right and left sides of the slit 40.

FIG. 53(*c*) shows the intensity distribution of the magnetic field on the Z-axis of FIG. 53(*b*), which is generated by the current in the fixed contact 4, and the intensity distribution of the magnetic field is found by a theoretical calculation. In FIG. 53(*c*), magnetic field in a positive direction is a magnetic field component to stretch the arc on the side of the terminal 5.

As shown in FIG. 53(*b*), the first conductor portion 4*a* is positioned at positions laterally offset from a plane in which the moving contact 1 is rotated.

Figure 54:
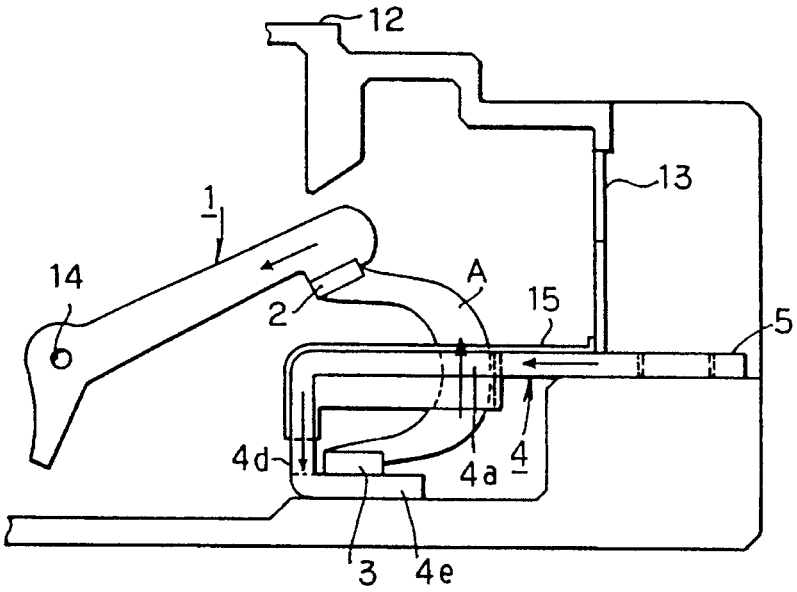
FIG. 54 is an explanatory view of the operation, showing the maximum opening condition of a moving contact of the circuit breaker of FIG. 49.

In such a conductor arrangement, there is a magnetic field component to stretch the arc A on the side of the terminal 5 even in a space (area Z0) above the first conductor portion 4*a* due to an effect caused by the current in the second conductor portion 4*e* and the third conductor portion 4*d*. Accordingly, as shown in FIG. 54, even if a traveling contact surface is rotated up to a position above the first conductor portion 4*a*, force is applied to the arc A on the side of the terminal 5 in the slit 40 of the first conductor portion 4*a*, and is pressed onto an insulator 15*a* covering the inner portion of the slit 40 (i.e., an inner surface of an end of the slit 40 on the side of the terminal 5) so as to be cooled. As a result, the arc resistance rapidly increasing immediately after the contact opening is further increased so as to maintain high arc voltage. Thus, it is possible to provide a circuit breaker which can reduce current peak and running energy, and have an excellent current-limiting performance.

Figure 55A:
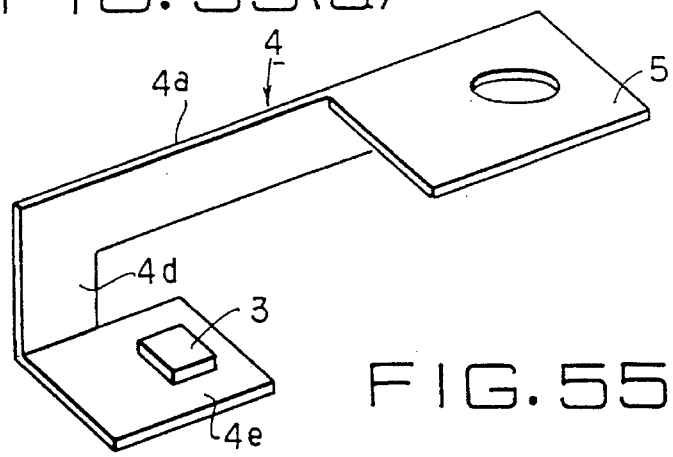
FIG. 55(*a*) is a perspective view of a fixed contact according to the embodiment 30.
Figure 55B:
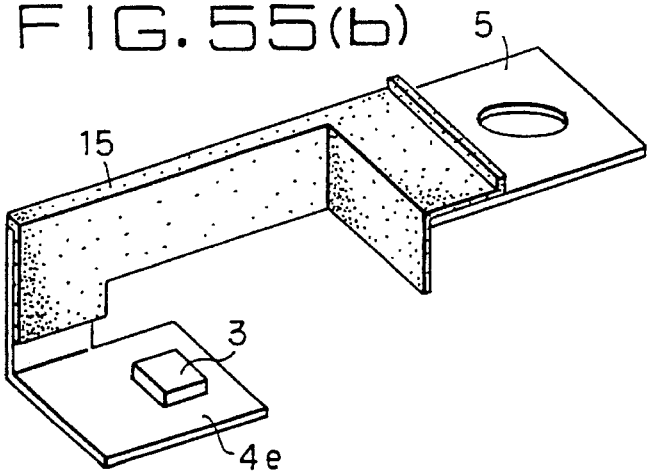

In the embodiment 29, though a description has been given of the shape of the fixed contact 4 in which the slit 40 is symmetrically provided with respect to a rotation surface of the moving contact 1 so as not to prevent the rotation of the moving contact 1, the fixed contact 4 may be provided in forms as shown in FIGS. 55(*a*) and (*b*) in order to obtain the same effect.

Embodiment 30

FIG. 55(*a*) is a perspective view of a fixed contact according to the embodiment 30, and FIG. 55(*b*) is a perspective view showing the fixed contact of FIG. 55(*a*) in an insulated condition.

As shown in FIG. 55(*a*), the fixed contact 4 according to the embodiment 30 is provided in a form in which the first conductor portion 4*a* is disposed only on the left side facing the side of the terminal 5.

Figure 56A:
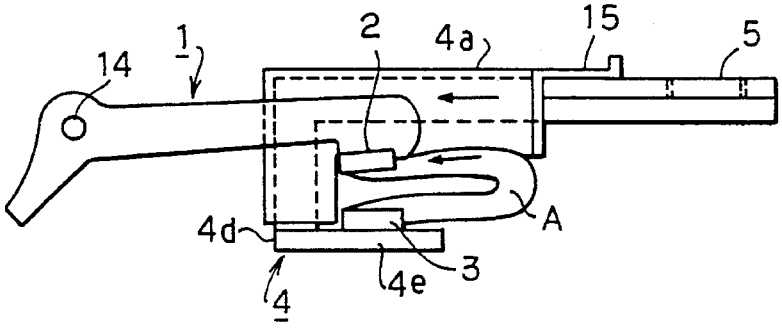
FIG. 56(*a*) is a side view of an electrode portion of a circuit breaker showing a condition immediately after the contact opening of the circuit breaker employing the fixed contact of FIG. 55(*b*)
Figure 56B:
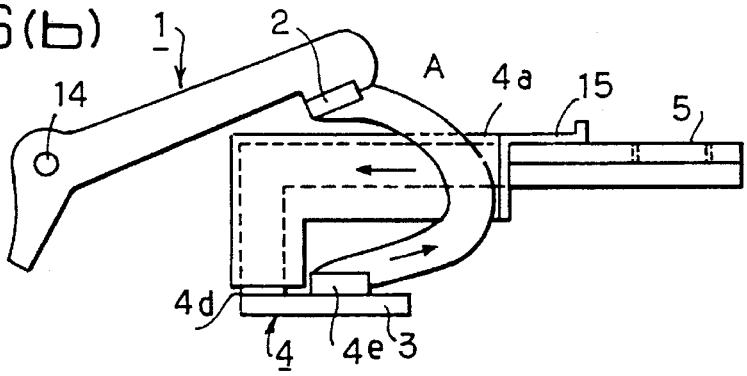

In the fixed contact 4, current in the arc A has the same direction as that of current in the first conductor portion 4*a* only on the left side at an upper half of the arc A for an opening initial period of the moving contact as shown in FIG. 56(*a*). Consequently, the arc A is attracted to the first conductor portion 4*a* only on the left side, and is cooled by strongly contacting the insulator 15 covering the first conductor portion 4*a*. Hence, the arc voltage can more rapidly rise for the opening initial period.

On the other hand, when the traveling contact 2 is positioned above the first conductor portion 4*a* because of the further opening between the contacts 2 and 3, the arc current and the current in the first conductor portion 4*a* only on the left side have each opposite direction so as to repel each other at a lower half of the arc A as shown in FIG. 56(*b*). Accordingly, the arc A is separated from the insulator 15 covering the first conductor portion 4*a* only on the left side, and an amount of vapor can be reduced. It is possible to reduce a rise of pressure in the housing 12 according to increased current, and previously prevent damage by the pressure to the housing 12.

In other words, if any one of the first conductor portions 4*a* on the right and left sides of the fixed contact 4 with respect to the rotation surface of the moving contact 1 is employed as in the embodiment 30, it is possible to provide the fixed contact 4 having an excellent current-limiting effect, and a configuration in which the housing 12 is hardly damaged by the pressure.

Embodiment 31

Figure 57:
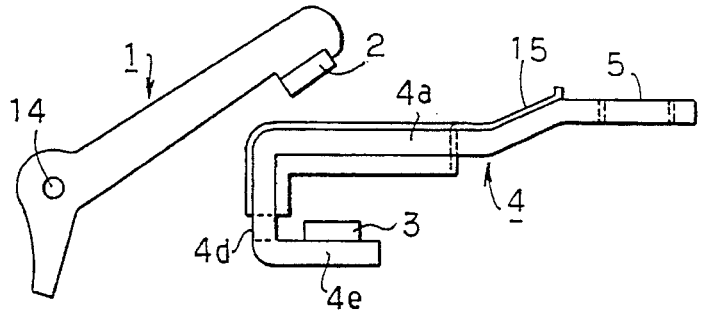
FIG. 57 is a side view of an electrode portion of a circuit breaker according to the embodiment 31.

FIG. 57 is a side view of an essential part according to the embodiment 31. In the fixed contact 4 according to the embodiment 31, the terminal 5 on the side of the power source is arranged above the first conductor portion 4*a*. In case the terminal 5 is arranged above the first conductor portion 4*a* as set forth above, it is possible to further effectively accelerate rising of the arc voltage for the opening initial period.

Embodiment 32

Figure 58:
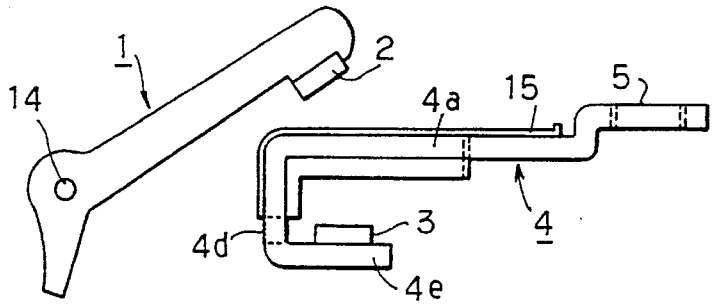
FIG. 58 is a side view of an electrode portion of a circuit breaker according to the embodiment 32.

FIG. 58 is a side view of an essential part according to the embodiment 32. In the fixed contact 4 according to the embodiment 32, the terminal 5 on the side of the power source is arranged above the first conductor portion 4*a*. Therefore, it is possible to provide the same effect as in the embodiment 31.

Embodiment 33

Figure 59:
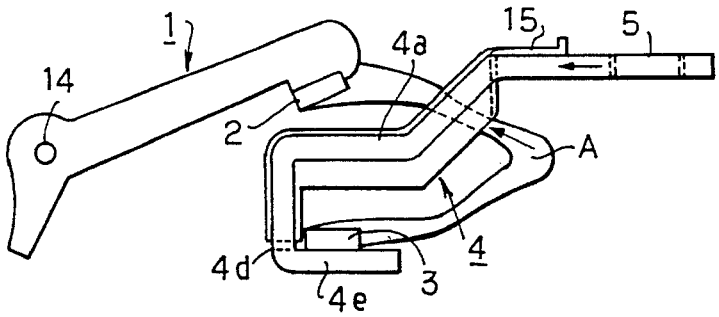
FIG. 59 is a side view of an electrode portion of a circuit breaker according to the embodiment 33.

FIG. 59 is a side view of an essential part according to the embodiment 33. In the fixed contact 4 according to the embodiment 33, the terminal 5 is arranged above the first conductor portion 4*a*, and a slit corresponding to the slit (notch) 40 as shown in FIGS. 13(*a*) and (*b*) is provided so as to be in close proximity to the side of the terminal 5.

In such a configuration, partial current of the arc A stretched to the vicinity of the terminal 5 and the current in the terminal 5 attract each other. Accordingly, it is possible to effectively stretch the arc A immediately before a cutoff time when the arc A largely extends.

As set forth above, since the arc length immediately before the cutoff can be extended by the electromagnetic force, the fixed contact 4 according to the embodiment 33 is particularly effective in case the cutoff performance is significantly affected by the arc stretching action by the electromagnetic force immediately before the cutoff, such as cutoff operation of relatively small current in a relatively high voltage circuit (of, for example, 550 V).

Embodiment 34

Figure 60:
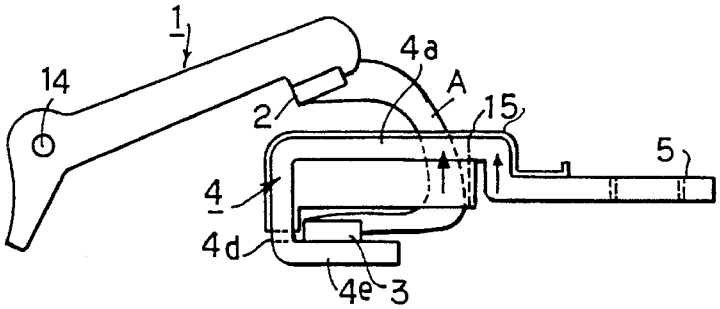
FIG. 60 is a side view of an electrode portion of a circuit breaker according to the embodiment 34.

FIG. 60 is a side view of an essential part according to the embodiment 34. According to the embodiment 34, the fixed contact 4 is provided such that the terminal 5 is positioned below the first conductor portion 4*a*. In such a configuration, a current component is generated at a portion of the fixed contact 4 on the side of the terminal 5 with respect to the arc, and has the same direction as that of the arc. A magnetic field generated by the current component in the same direction as that of the arc is exerted in a direction to open the moving contact 1 for the opening initial period so as to improve rising of the arc voltage for the opening initial period. Further, the current component in the same direction as that of the arc, and the arc attract each other. Consequently, it is possible to complement the arc A stretched by opening the contacts 2 and 3 in a vicinity of the upward current flow to some extent. As a result, the arc A is never drawn back between the contacts 2 and 3 in the course of the cutoff operation, and high arc voltage can be maintained.

Further, in the embodiment 34, the terminal 5 is disposed above the surface of the stationary contact 3 so that electromagnetic component is generated by the current in the terminal 5 so as to stretch the arc A on the surface of the stationary contact 3. As a result, it is possible to more rapidly rise the arc voltage.

Embodiment 35

Figure 61:
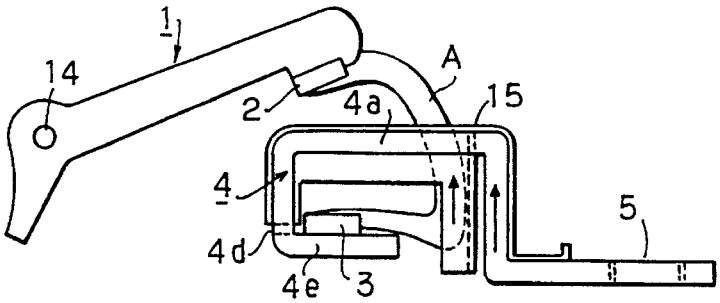
FIG. 61 is a side view of an electrode portion of a circuit breaker according to the embodiment 35.

FIG. 61 is a side view of an essential part according to the embodiment 35. In the fixed contact 4 according to the embodiment 35, the terminal 5 is positioned below the first conductor portion 4*a* and a surface of the stationary contact 3.

In case the terminal 5 is positioned below the surface of the stationary contact 3 as set forth above, the current component to complement the arc having the same direction as that of the arc is increased so as to enhance the complementary effect. Further, higher arc voltage can be maintained in an end half of the cutoff operation. As a result, it is possible to reduce a time period required for completion of current cutoff, and reduce a total amount of energy and running energy generated in the breaker by the cutoff operation.

Figure 62:
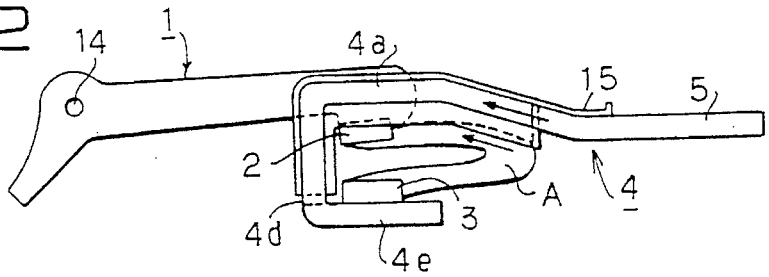
FIG. 62 is a side view of an electrode portion of a circuit breaker according to an alternative embodiment of the embodiment 35.
Figure 63:
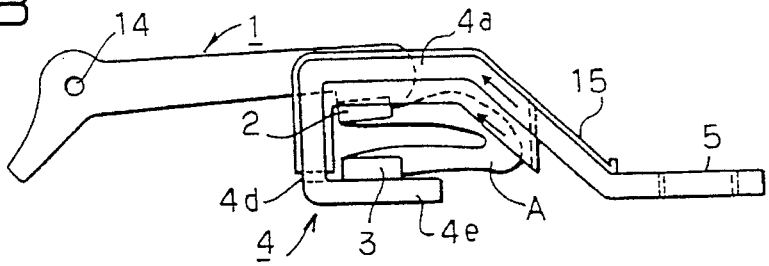
FIG. 63 is a side view of an electrode portion of a circuit breaker according to still another alternative embodiment of the embodiment 34.

In the embodiment 35, the terminal 5 and the fixed contact 4 are connected through a vertical conductor, but may be connected through a diagonally extending conductor as shown in FIGS. 62 and 63. In this case, it is possible to provide substantially the same effect as that in the embodiment 35. Further, an obtuse angle is formed in a bent portion of the connecting portion so that bending of the fixed contact 4 is facilitated.

Embodiment 36

Figure 64:
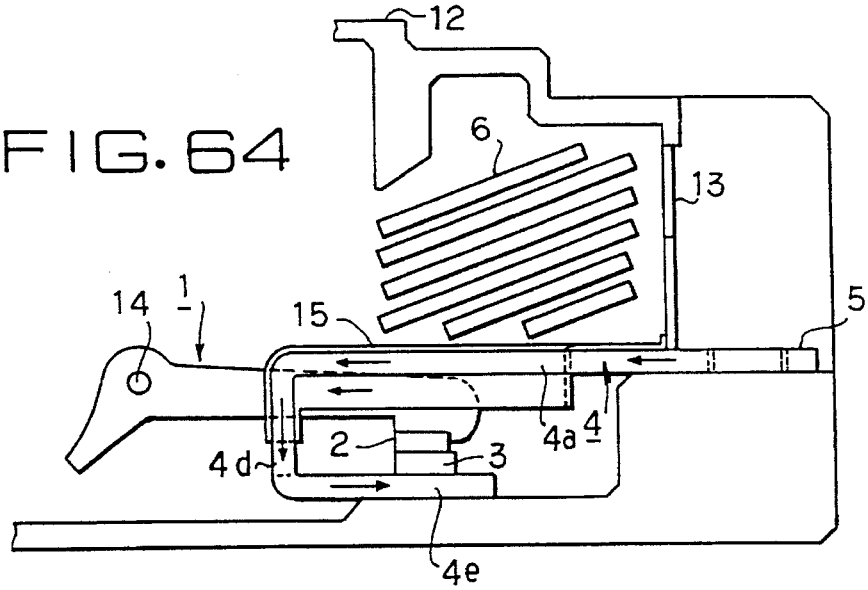
FIG. 64 is a side view of an electrode portion of a circuit breaker according to the embodiment 36.

FIG. 64 is a side view of an essential part according to the embodiment 36. In the embodiment 36, the second conductor portion 4*e* extends in a direction of the rotating center 14 of the moving contact 1 instead of the second conductor portion 4*e* of the fixed contact 4, to which the stationary contact 3 is secured, according to the embodiment 29. Consequently, the current in the second conductor portion 4*e* becomes substantially antiparallel to the current in the moving contact 1 at a closing time.

In case the fixed contact 4 is provided as set forth above, the electromagnetic force generated by the current in the second conductor portion 4*e* to stretch the arc A on the side of the terminal 5 can be increased, and magnetic repulsion is applied between the moving contact 1 and the second conductor portion 4*e* at a closing time. Thus, a rotation speed of the moving contact 1 is increased so as to rapidly extend the arc length immediately after the contact opening. As a result, it is possible to provide more rapid rising of the arc resistance, and a further improved current-limiting performance.

Embodiment 37

Figure 65:
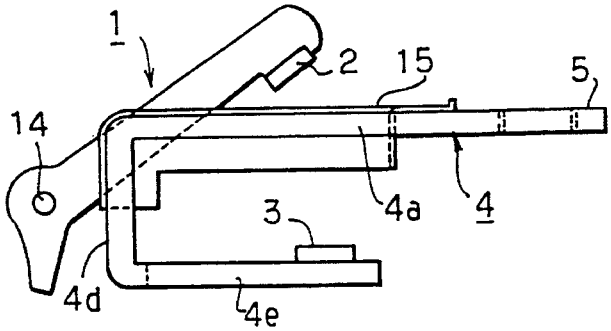
FIG. 65 is a side view of an electrode portion of a circuit breaker according to the embodiment 37.

FIG. 65 is a side view of an essential part according to the embodiment 37. According to the embodiment 37, the fixed contact 4 is provided such that the moving contact 1 can be partially positioned in a space which is defined by the first conductor portion 4*a*, the second conductor portion 4*e* and the third conductor portion 4*d* of the fixed contact 4 in an opening condition as well as in a closing condition.

In the above configuration, for a relative long period from a contact opening initial period to an end half of the contact opening action, a large magnetic force is applied to the moving contact 1 in the opening direction by magnetic field generated by current in the fixed contact 4.

Accordingly, an opening speed of the moving contact 1 does not decrease even after the traveling contact 2 rises above the first conductor portion 4*a* as well as for the contact opening initial period. As a result, it is possible to advance a time for achieving the maximum opening distance.

Typically, in the cutoff operation for a relatively small short-circuit current area in a circuit having a relative high power source voltage (of, for example, 550 V), small electromagnetic repulsion is applied to the moving contact 1, and the opening distance between contacts is small even immediately before the current cutoff. Hence, dielectric breakdown may occur between the contacts, resulting in cutoff failure.

Therefore, it is possible to avoid the cutoff failure by advancing the time for achieving the maximum opening distance between the contacts as described in the embodiment 37 (shown in FIG. 65).

In addition, a typical circuit breaker is provided with means for specifying a range in which the moving contact 1 can be rotated (for example, a stopper mounted in the housing 12). The number of the rotation specifying means should not be limited to one, and the maximum openable distance d1 when the mechanism portion is operated may differ from the maximum openable distance d2 when the mechanism is not operated.

As described in the above embodiment 29, the moving contact 1 is rotated by the electromagnetic force before the operation of the mechanism portion in case large current such as short-circuit current flows. The operation of the mechanism portion at a time of the large current is typically performed slower than the opening by the electromagnetic force. Therefore, the current-limiting performance of the circuit breaker is seriously affected by the maximum openable distance d2 when the mechanism portion is not operated.

Embodiment 38

Figure 66:
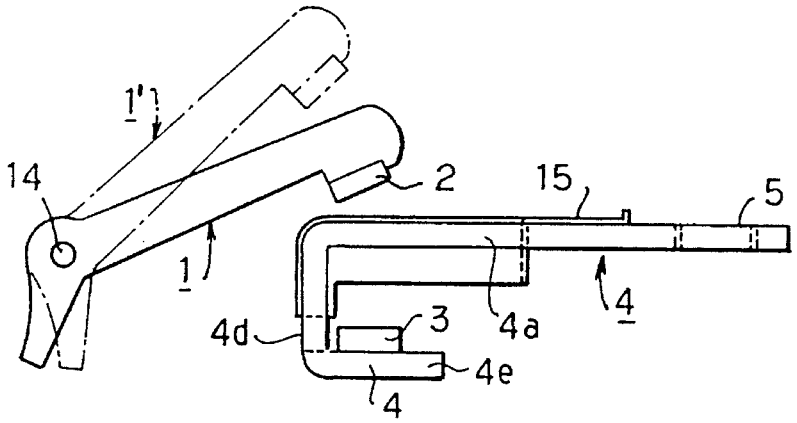
FIG. 66 is a side view of an electrode portion of a circuit breaker according to the embodiment 38.
Figure 67:
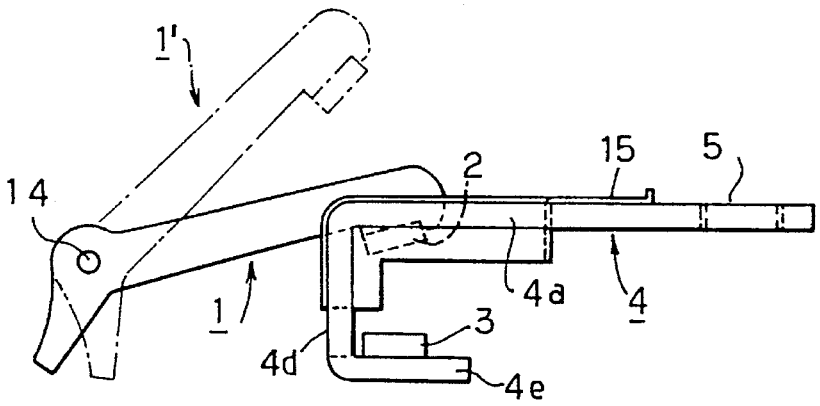
FIG. 67 is a side view of an electrode portion of a circuit breaker according to an alternative embodiment of the embodiment 38.

FIGS. 66 and 67 show side views of essential parts according to the embodiment 38, and an alternative embodiment thereof, respectively. Further, in FIGS. 66 and 67, there is shown a case where the maximum openable distance d1 of the moving contact 1 differs from the maximum openable distance d2 thereof.

In FIGS. 66 and 67, reference numeral 1 means a moving contact in the maximum openable distance d2, and 1' means a moving contact shown by the one dot chain line in the maximum openable distance d1.

In case a contact surface of the traveling contact 2 in the maximum openable distance d2 is positioned above the first conductor portion 4*a* as shown in FIG. 66, at a time of large current cutoff, the moving contact 1 temporarily stays at a position marked 1 in FIG. 66 until the mechanism portion (not shown) is operated. In the course of the cutoff operation or later, the arc forms in a vicinity of the arc spot on the side of the moving contact 1, and magnetic field component to stretch the arc on the side of the terminal 5 is reduced. Since an exhaust hole (not shown) is typically provided above the first conductor portion 4*a*, the reduction of the magnetic field component can reduce emissions such as spark or fused material from the exhaust hole.

That is, it is possible to reduce an arc space by the configuration as shown in FIG. 66.

On the other hand, in case the contact surface of the traveling contact 2 in the maximum openable distance d2 is positioned below the first conductor portion 4*a* as shown in FIG. 67, the moving contact 1 temporarily stays at a position marked 1 in FIG. 67 until the mechanism portion is operated. Consequently, the moving contact 1 can be positioned in the space in the course of the cutoff operation so as to effectively stretch the arc by the entire current component in the fixed contact 4. As a result, it is possible to maintain high arc voltage even in the course of the cutoff operation. However, in a relatively high voltage circuit, the stretched arc may be drawn back between the contacts 2 and 3 due to the dielectric breakdown between the contacts 2 and 3 in case the maximum openable distance d2 is too small. Further, the sufficient maximum openable distance d2 may not be provided due to restriction of external dimension. That is, FIG. 67 shows a configuration in which great importance is attached to the current-limiting performance at a time of large current cutoff in relatively low circuit voltage.

Embodiment 39

Figure 68A:
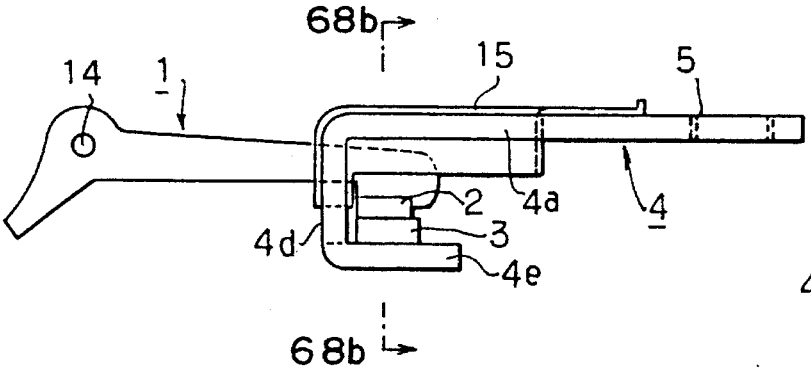
FIG. 68(*a*) is a side view of an electrode portion of a circuit breaker according to the embodiment 39.
Figure 68:
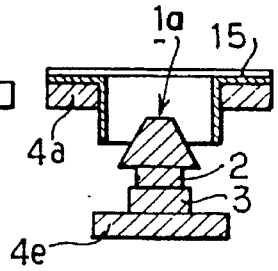

FIG. 68(*a*) is a side view of an essential part according to the embodiment 39, and FIG. 68(*b*) is a sectional view taken along line. 68*b*—68*b* of FIG. 68(*a*).

In the embodiment 39, a moving contact conductor portion 1*a* serving as a part of the moving contact 1 has an umbrella-shaped section as shown in FIG. 68(*b*).

Accordingly, current in the moving contact conductor portion 1*a* is offset downward so that repulsion generated by the current in the second conductor portion 4*e* increases immediately before and after the opening, resulting in further improved rising of the contact opening speed.

Further, it is possible to reduce air resistance when the moving contact 1 is opened by employing the moving contact 1 which is shaped as set forth above.

In addition, the moving contact 1 is employed in an area having relatively small arc current for the opening initial period. Consequently, an amount of ambient air drawn into the arc more increases as the moving contact 1 is opened. As a result, it is possible to cool the arc and increase the arc voltage so as to improve the current-limiting performance.

In the above embodiments, the slit 40 is provided in a substantially intermediate portion of the moving contact 1, and is laterally interposed between the first conductor portion 4*a* and the third conductor portion 4*d*.

Referring to FIGS. 40(*a*), (*b*) and (*c*), the detailed description has been given of the typical characteristic of the magnetic field which is generated by the current in the current paths in case two current paths are provided substantially parallel to each other.

The relationship between the parallel conductors on the x-y plane and the point P0 on the z-axis can be applied to practical embodiments as shown in FIGS. 69(*a*) and (*b*).

Embodiment 40

FIG. 69(*a*) is a side view of a fixed contact according to the embodiment 40, and FIG. 69(*b*) is a sectional view taken along line 69*b*—69*b* of FIG. 69(*a*). In the embodiment 40, the section taken along the line 69*b*—69*b* is defined as the y-z plane, reference numeral 41 means the centers of gravity in respective sections of the right and left first conductor portions 4*a*, and the point P0 means the center of gravity of one section of the moving contact 1.

In the embodiment, the angle θ is set to 45°±10°. With the angle θ, the y-directional magnetic field By is generated by the current in the right and left conductors with respect to a notch portion (the slit 40) in the center of gravity P0, and the y-directional magnetic field By can achieve the minimum value which is about 94% of the maximum value thereof.

Therefore, it is possible to substantially make full use of power of the current in the first conductor portion 4*a* to suck the traveling contact 2 immediately after the opening, enhance rising of the opening speed of the moving contact 1 immediately after opening of the moving contact 1, and improve rising of the arc voltage.

Embodiment 41

FIG. 70 is a perspective view of a fixed contact according to the embodiment 41. In the fixed contact 4 according to the embodiment 41, the slit 40 is provided in the first conductor portion 4*a* and the third conductor portion 4*d*, and is partially provided in the second conductor portion 4*e*.

It is possible to facilitate bending of the fixed contact 4 by the slit 40 provided in a bent portion of the fixed contact 4.

Embodiment 42

FIG. 71 is a perspective view of a fixed contact according to the embodiment 42. In the fixed contact 4 according to the embodiment 42, the first conductor portion 4*a* on the side of the third conductor portion 4*d* is diagonally formed.

Further, the slit 40 is provided in the first conductor portion 4*a* and the third conductor portion 4*d*, and is partially provided in the second conductor portion 4*e* as in the case of FIG. 70.

Accordingly, in the embodiment 42, it is possible to provide the same effect as that in the embodiment 41.

Embodiment 43

FIG. 72 is a perspective view of a fixed contact according to the embodiment 43. According to the embodiment 43, an insulator 15*a* is upward extended to coat an inner portion of the slit 40 of the moving contact 1.

Since the fixed contact 4 is provided as described above, it is possible to increase an area of the insulator onto which the arc stretched on the side of the terminal 5 is pressed, improve an effect for cooling the arc, and increase arc voltage. As a result, current-limiting performance can be enhanced.

It is also possible to prevent hot gas drawn on the side of the terminal 5 from an exhaust hole from contacting the terminal 5, and prevent the arc voltage from decreasing according to arcing between the moving contact 1 and the terminal 5.

Embodiment 44

Figure 73:
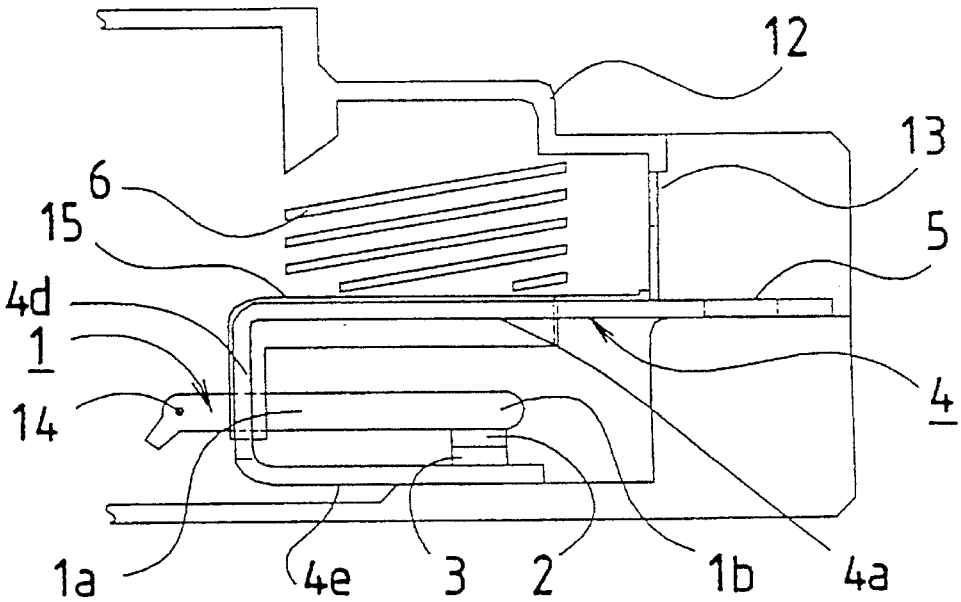
FIG. 73 is a side view of an arc-extinguishing portion, showing a closing condition of a circuit breaker according to the embodiment 44.
Figure 74:
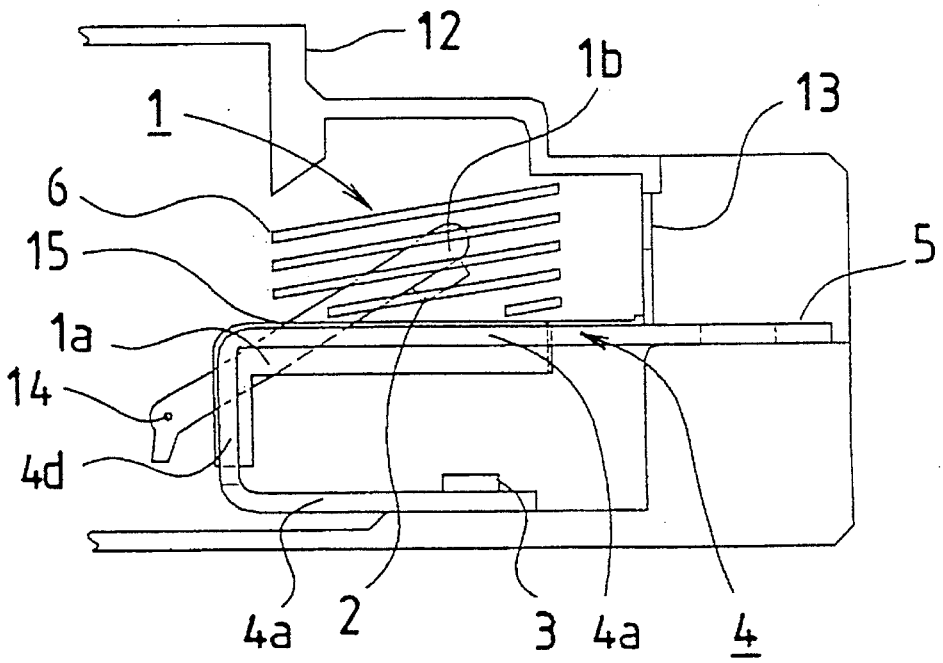
FIG. 74 is a side view showing the opening condition of the circuit breaker of FIG. 73.
Figure 75:
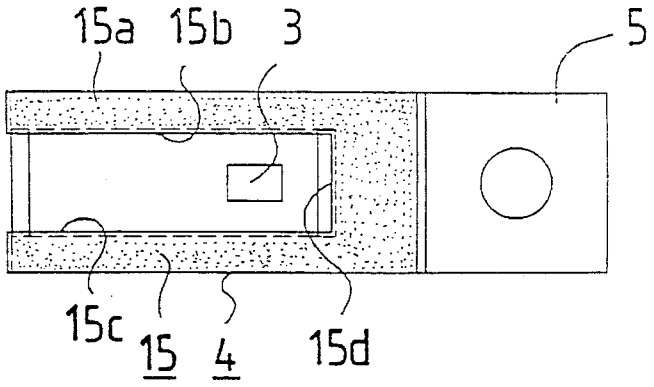
FIG. 75 is a plan view of the fixed contact in FIGS. 73 and 74.
Figure 76:
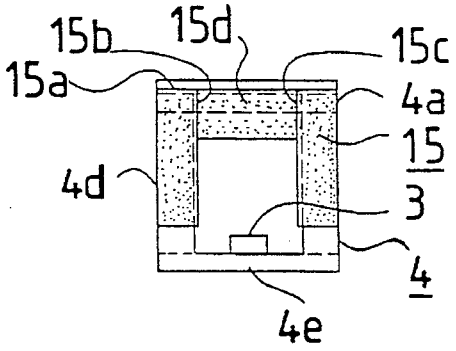
FIG. 76 is a front view of FIG. 75.
Figure 77:
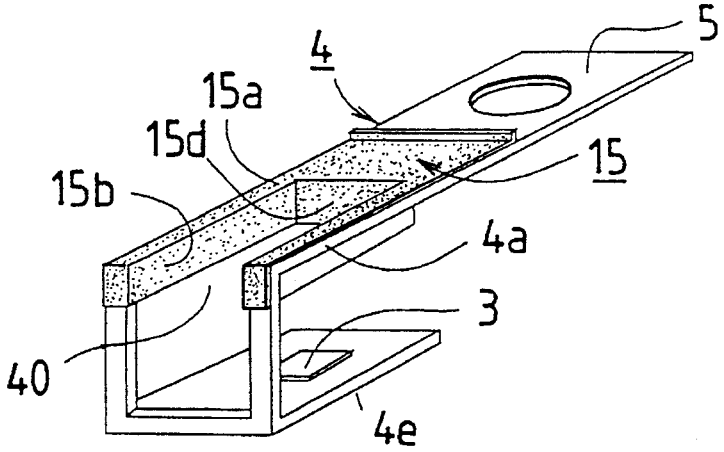
FIG. 77 is a front view of FIG. 75.

FIG. 73 is a side view of an arc-extinguishing portion, showing a closing condition of a circuit breaker as a switch according to the embodiment 44 with a housing broken away. FIG. 74 is a side view showing the opening condition of the circuit breaker of FIG. 73, FIG. 75 is a plan view of the fixed contact of FIGS. 73 and 74, FIG. 76 is a front view of the fixed contact of FIG. 75, and FIG. 77 is a perspective view of the fixed contact of FIG. 75.

A configuration in the embodiment is identical with that in the above embodiment 1 except a related configuration between the moving contact 1 and the fixed contact 4 as will be described later, and the description thereof is omitted.

The fixed contact 4 is mounted and set to the housing 12 such that the third conductor portion 4*d* is positioned on a side of the other end of the moving contact 1 to which the traveling contact 2 is not secured with respect to the stationary contact 3 and on the side opposed to the terminal 5 (i.e., on the side of the rotation supporting point 14 of the moving contact 1). In this case, the entire first conductor portion 4*a* is positioned above a contact surface of the contacts at a contact closing time when the traveling contact 2 contacts the stationary contact 3, and is positioned below the contact surface of the traveling contact 2 at a contact opening time.

A detailed description will now be given of the related configuration between the moving contact 1 and the fixed contact 4.

The fixed contact 4 is integrally provided in a substantially U-shaped form including the first conductor portion 4*a*, the second conductor portion 4*e* and the third conductor portion 4*d*. The terminal 5 on the side of a power source is connected to one end of the U-shaped form, that is, an end of the first conductor portion 4*a* on the side connected to the power source. Further, the stationary contact 3 is secured to the inside of the U-shaped form serving as the opposite side end, that is, an upper surface portion of the second conductor portion 4*e*. Moreover, in the fixed contact 4, a slit 40 is provided in a connecting conductor portion (i.e., the first conductor portion 4*a* and the third conductor portion 4*d*) positioned above a secured surface of the stationary contact 3.

The slit 40 is provided so as not to prevent a switching action of the moving contact 1 with respect to the stationary contact 3 on the second conductor portion 4*e*.

In a range of height of the third conductor portion 4*d* of the fixed contact 4, the rotating center 14 of the moving contact 1 is disposed at an external position opposed to the slit 40 in the third conductor portion 4*d*. Thereby, the moving contact 1 can rotate through the slit 40 in contact switching directions. Further, the moving contact 1 is positioned such that one portion 1*a* of the moving contact 1 is continuously overlapped with the fixed contact 4 through the slit 40 irrespective of a contact closing position or a contact opening position.

Accordingly, in the opening condition of the moving contact 1, the first conductor portion 4*a* of the fixed contact 4 is positioned below the contact surface of the traveling contact 2, and is positioned above the one portion 1*a* of the moving contact 1. The one portion 1*a* of the moving contact 1 is continuously positioned below the first conductor portion 4*a* of the fixed contact 4 until the moving contact 1 at the closing position moves to be in the opening condition.

In the contact opening condition, a portion facing a surface of the traveling contact 2 in the first conductor portion 4*a* of the fixed contact 4 is coated with the insulator 15. The insulator 15 includes an insulator 15*a* to insulate an upper surface of the first conductor portion 4*a*, insulators 15*b*, 15*c* and 15*d* which insulate an inner surface of the slit 40 of the first conductor portion 4*a* without prevention of the rotation of the moving contact 1.

A description will now be given of the operation.

Figure 78:
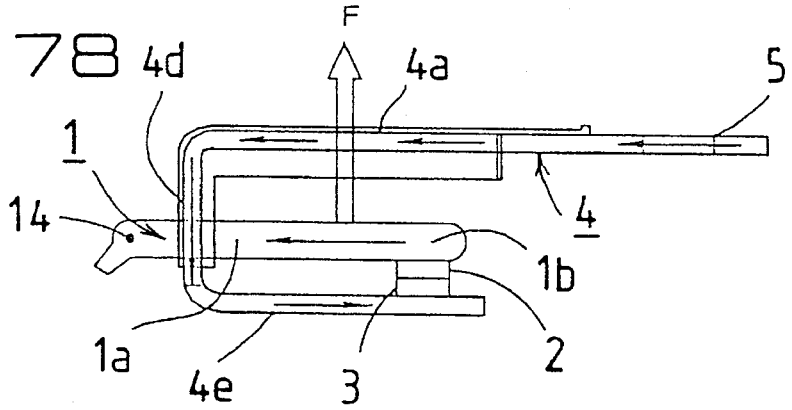
FIG. 78 is a side view showing the closing condition of the moving contact, for illustrating the operation according to the embodiment 44.

FIG. 78 is an explanatory view of the operation, illustrating the closing condition of the moving contact 1. As in the prior art, if a large current such as a short-circuit current flows in the closing condition, the moving contact 1 rotates to open the traveling contact 2 and the stationary contact 3 before the operation of a mechanism portion, and the arc A forms between the contacts 2 and 3.

Figure 79:
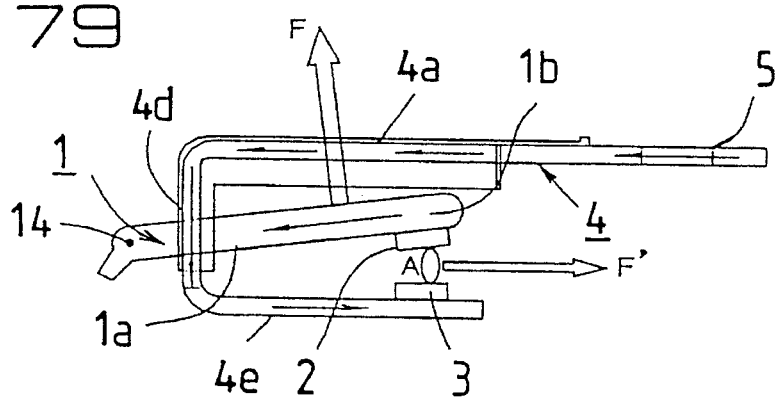
FIG. 79 is a side view showing a condition immediately after the opening of the moving contact shown in FIG. 78.

FIG. 79 shows a condition immediately after the traveling contact 2 is opened from the stationary contact 3 due to contact electromagnetic repulsion. In this condition the contact surface of the traveling contact 2 is still positioned below the first conductor portion 4*a*. In FIG. 79, the arrow means current.

In the condition immediately after the contact opening, strong a electromagnetic force is applied to the moving contact 1 in a rotating direction by the following two forces. One is upward force F shown by the large arrow in the drawings, which is applied to the moving contact 1 because current flowing from the terminal 5 on the side of the power source to the first conductor portion 4*a* and current in the moving contact 1 have the same flow direction as shown by the arrow in the drawings so as to attract each other. The other is a repulsion forces to move the moving contact 1 in the rotating direction because current in the second conductor portion 4*e* of the fixed contact 4 and current in the moving contact 1 have opposite flow directions so as to repel each other.

The magnetic field generated by the current in the third conductor portion 4*d* of the fixed contact 4 also exerts the upward force F on the one portions 1*a* and 1*b* of the moving contact 1 on the side of the stationary contact 3 with respect to the third conductor portion 4*d*. Hence, upward rotating force is generated at the moving contact 1 immediately after the opening as shown in FIG. 79 by the entire current flowing from the terminal 5 to the fixed contact 4, and thereby opening the moving contact 1 at a high speed. As a result, a distance between the contacts, that is, an arc length is rapidly increased so as to provide rapid rising of the arc voltage.

In the condition as shown in FIG. 79, the entire magnetic field generated by the current in the terminal 5 and the fixed contact 4 exerts force F' to stretch the arc A in the direction of the terminal 5 on the arc A generated between the contacts 2 and 3.

That is, the current in the terminal 5 and the first conductor portion 4*a* have a right-to-left flow direction in FIG. 79. Consequently, electromagnetic force to stretch the arc A on the side of the terminal 5 is applied to the arc A positioned below the first conductor portion 4*a* having the current flow. The current in the second conductor portion 4*e* has a left-to-right flow direction in FIG. 79 so as to exert the electromagnetic force to stretch the arc A on the side of the terminal 5 on the arc A generated above the current. Further, the current in the third conductor portion 4*d* of the fixed contact 4 and the current of the arc A have opposite flow directions, and repel each other, resulting in stretching the arc A on the side of the terminal 5.

Therefore, the arc A is strongly stretched by the entire current in the terminal 5 and the fixed contact 4 on the side of the terminal 5 so that the arc voltage rapidly increases.

Figure 80:
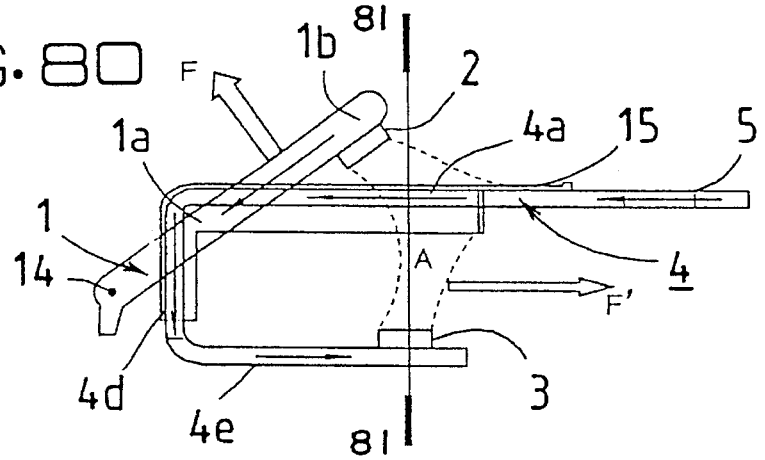
FIG. 80 is a side view showing the maximum opening condition of the moving contact shown in FIG. 79.

FIG. 80 shows the maximum opening condition of the moving contact 1. As shown in FIG. 80, the moving contact 1 is partially overlapped with the fixed contact 4 even when the moving contact 1 is opened, and the one portion 1*a* of the moving contact 1 is continuously positioned below the first conductor portion 4*a* of the fixed contact 4. Accordingly, the force F in the rotating direction is continuously applied to the one portion 1*a* of the moving contact 1 so that the moving contact 1 can be completely opened in a short time without reduced opening speed.

As set forth above, it is possible to provide the high speed opening of the moving contact 1, and an effect for strongly stretching the arc A between the contacts 2 and 3, and thereby rapidly increasing the arc voltage immediately after the opening.

In large current arcs such as short-circuit current, it has been known that a metallic vapor flow is ejected from a leg of the arc on a contact surface in a direction perpendicular to the contact surface because of vaporization of the contact, and the vapor flow is an essential constituent component of the arc A.

As shown in FIG. 80, the first conductor portion 4*a* facing the surface of the traveling contact 2 is insulated through the insulator 15 so that the metallic vapor ejected from the surface of the traveling contact 2 collides with the insulator 15 so as to be cooled, resulting in increased arc voltage.

Further, the arc A also contacts the insulator 15 so as to be cooled by the electromagnetic force generated by the fixed contact 4 to stretch the arc A in the direction of the terminal 5.

Figure 81:
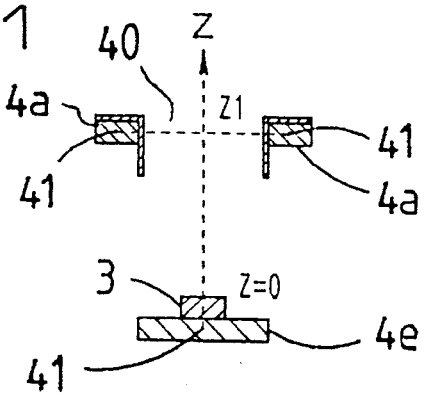
FIG. 81 is a sectional view along line 81—81 of FIG. 80.

FIG. 81 is a sectional view taken along line 81—81 of FIG. 80. In FIG. 81, reference numeral 41 means the centers of gravity of respective sections of the right and left first conductor portions 4*a* on both sides of the slit 40, and the center of gravity of the second conductor portion 4*e*.

Figure 82:
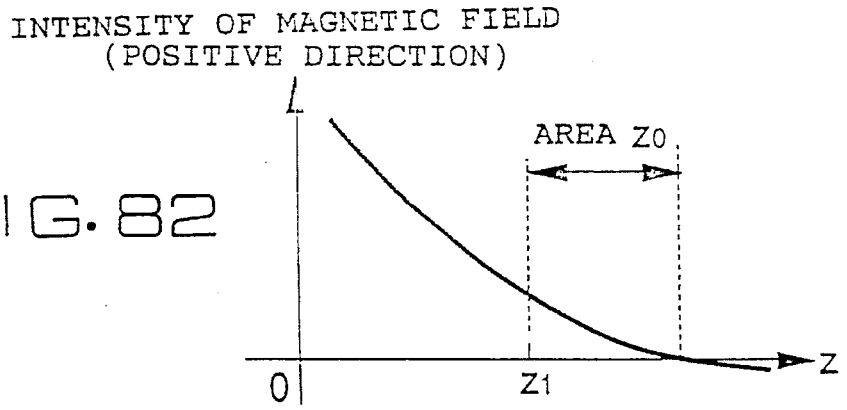
FIG. 82 is a graph diagram showing intensity distribution of magnetic field which is generated by current in the fixed contact on the Z-axis of FIG. 81.

FIG. 82 shows the intensity distribution of the magnetic field on the Z-axis of FIG. 81, which is generated by the current in the fixed contact 4, and the intensity distribution of the magnetic field is found by a theoretical calculation. In FIG. 82, magnetic field in a positive direction is a magnetic field component (hereafter referred to as arc driving magnetic field) to stretch the arc A on the side of the terminal 5.

As shown in FIG. 81, the first conductor portions 4*a* are positioned at positions laterally offset from a plane in which the moving contact 1 is rotated.

In the conductor arrangement, as shown in FIG. 82, there is the arc driving magnetic field serving as a magnetic field component to stretch the arc A up to a space (area Z0) above the first conductor portion 4*a* on the side of the terminal 5 due to an effect caused by the current in the second conductor portion 4*e* and the third conductor portion 4*d*.

Accordingly, electromagnetic force is applied to the arc A on the side of the terminal 5 even in the slit 40 of the first conductor portion 4*a*, and is pressed onto the insulator 15*a* covering an inner portion of the slit 40 (i.e., an inner surface of an end of the slit 40 on the side of the terminal 5) so as to be cooled. As a result, the arc resistance rapidly increasing immediately after the contact opening is further increased so as to maintain high arc voltage. Thus, it is possible to provide a circuit breaker which can reduce current peak and running energy, and has an excellent current-limiting performance.

Embodiment 45

Figure 83:
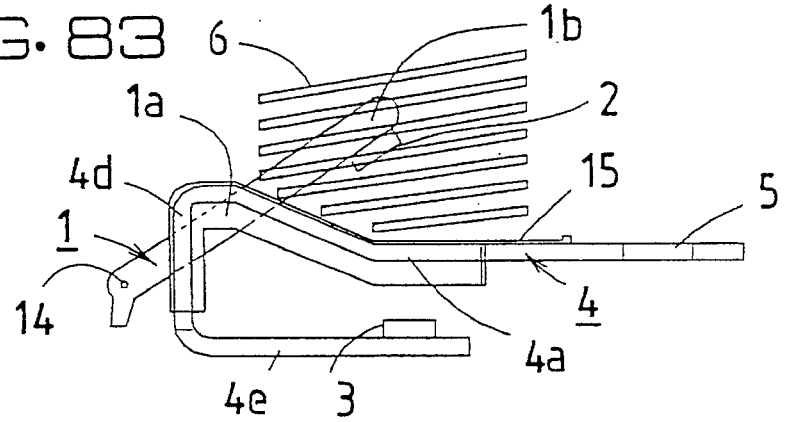
FIG. 83 is a side view of an electrode portion of a circuit breaker according to the embodiment 45.

Though a description has been given of the fixed contact 4 including the first conductor portion 4*a* having an entirely flat shape, the fixed contact 4 may be provided in a form as shown in FIG. 83.

FIG. 83 is a side view of an essential part according to the embodiment 45, showing an opening condition of the moving contact 1.

The fixed contact 4 according to the embodiment 45 is provided with an inclined conductor portion 4*a*′ in which the first conductor portion 4*a* on the side of the third conductor portion 4*d* is gradually diagonally upward inclined toward the first conductor portion 4*a*.

That is, a large space is provided above the first conductor portion 4*a*, and the first conductor portion 4*a* is upward bent at a midway portion thereof such that the moving conductor 1*a* of the moving contact 1 is continuously positioned below the first conductor portion 4*a* forming the fixed contact 4 for a period from the contact closing time to the contact opening time.

In case of the embodiment 45, it is possible to provide an advantage in that the number of the arc-extinguishing plates 6 can be increased by extending the space above the first conductor portion 4*a* on the side of the terminal 5, as well as the same effect in the above embodiment 44. As a result, it is possible to provide a circuit breaker which has an enhanced cooling action to the arc A by the arc-extinguishing plate 6 when the moving contact 1 is opened, and has an excellent current-limiting performance.

Embodiment 46

Figure 84:
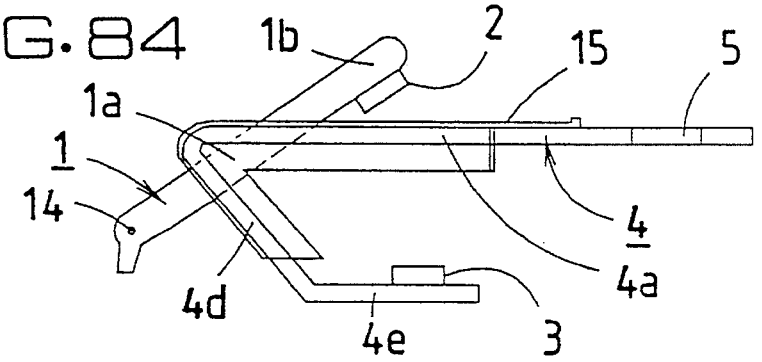
FIG. 84 is a side view of an electrode portion of a circuit breaker according to the embodiment 46.

FIG. 84 is a side view of an essential part according to the embodiment 46. According to the embodiment 46, the fixed contact 4 is provided with the inclined third conductor portion 4*d* which is substantially vertically formed in the previous embodiment. Thereby, a connected position between the second conductor portion 4*e* and the third conductor portion 4*d* is positioned on the side of the terminal 5 with respect to a connecting position between the first conductor portion 4*a* and the third conductor portion 4*d*.

In the embodiment 46, it is possible to provide an advantage in that a large space can be provided between the rotating center 14 of the moving contact 1 and the third conductor portion 4*d* of the fixed contact 4 so as to facilitate design of a mechanism portion actuating the moving contact 1, as well as the same effect as that in the embodiment 45.

Embodiment 47

Figure 85:
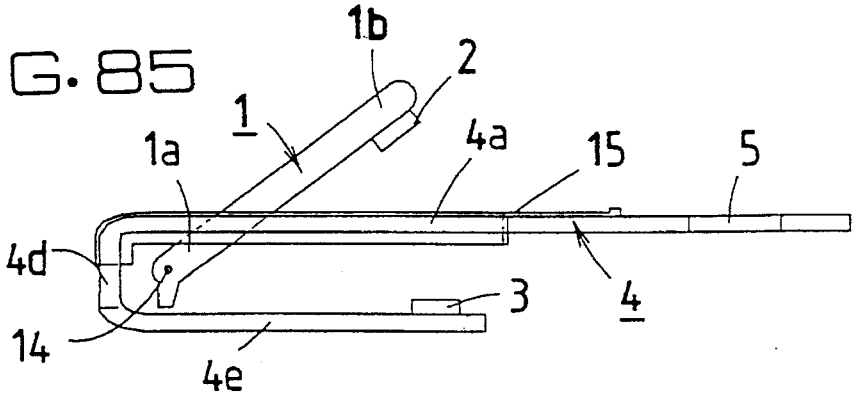
FIG. 85 is a side view of an electrode portion of a circuit breaker according to the embodiment 47.

FIG. 85 is a side view of an essential part according to the embodiment 47. In the embodiment 47, the first conductor portion 4*a* and the second conductor portion 4*e* of the fixed contact 4 elongatedly extend on the side of the rotating center 14 of the moving contact 1 so as to position the rotating center 14 between the first conductor portion 4*a* and the second conductor portion 4*e* (in an internal space of the fixed contact 4).

That is, while the rotating center 14 of the moving contact 1 is positioned on the outside of the third conductor portion 4*d* of the fixed contact 4 in the embodiment 46, the rotating center 14 of the moving contact 1 is positioned in the internal space of the fixed contact 4 in the embodiment 47. As a result, it is possible to provide a circuit breaker having a more quick opening speed of the moving contact 1, and an excellent current-limiting performance. Further, it is naturally possible to provide the same effect as that in the embodiment 46.

Embodiment 48

Figure 86A:
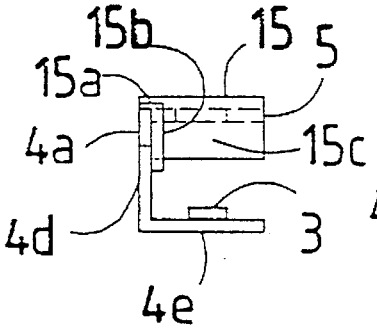
FIG. 86(*a*) is a front view of the fixed contact according to the embodiment 48.
Figure 86B:
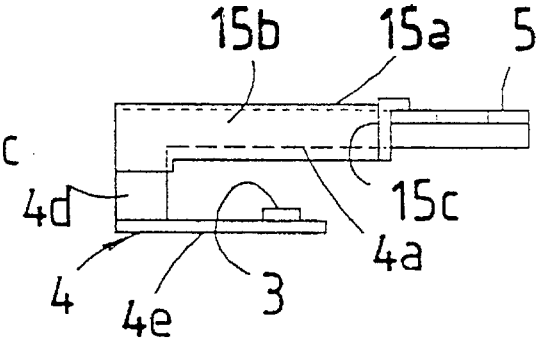
Figure 86C:
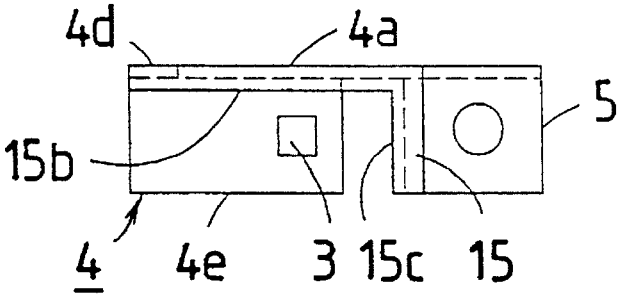
Figure 87:
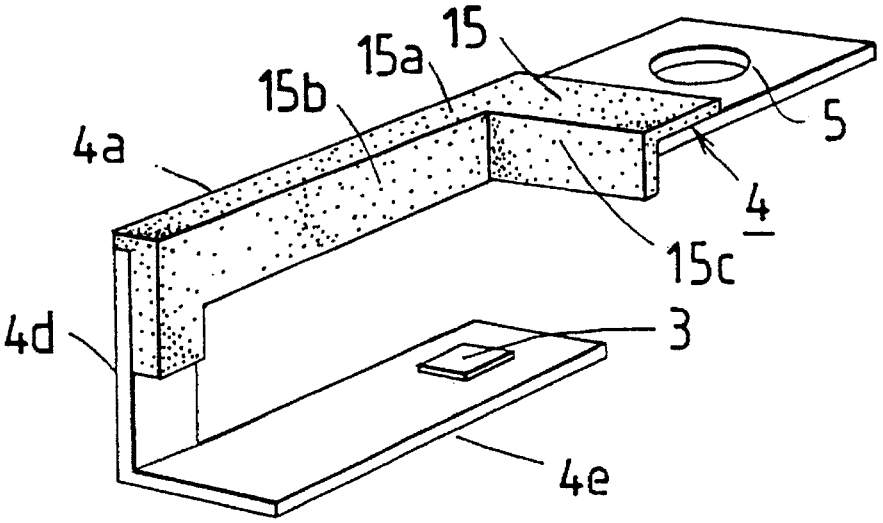
FIG. 87 is a perspective view of the fixed contact according to the embodiment 48.

FIG. 86(*a*) is a front view of a fixed contact according to the embodiment 48, FIG. 86(*b*) is a side view of FIG. 86(*a*), FIG. 86(*c*) is a plan view of FIG. 86(*b*), and FIG. 87 is a perspective view of the fixed contact.

According to the embodiment 48, the fixed contact 4 is provided with the first conductor portion 4*a* on the single side by omitting either of the first conductor portions 4*a* on both sides of the slit 40 in the embodiment 47.

In the fixed contact 4, the current in the arc A has the same direction as that of the current in the first conductor portion 4*a* only on the single side at an upper half of the arc A for an opening initial period of the moving contact 1. Consequently, the arc A is attracted to the first conductor portion 4*a* only on the single side, and is cooled by strongly contacting the insulator 15 covering the first conductor portion 4*a*. Hence, the arc voltage can more rapidly rise for the opening initial period.

On the other hand, when the traveling contact 2 is positioned above the first conductor portion 4*a* after the opening between the contacts 2 and 3, the arc current and the current in the first conductor portion 4*a* only on the single side have opposite directions so as to repel each other at a lower half of the arc A. Accordingly, the arc A is separated from the insulator 15 covering the first conductor portion 4*a* only on the single side, and an amount of vapor generated from the insulator 15 is reduced. It is possible to reduce a rise of pressure in the housing 12 according to increased current, and previously prevent damage by pressure to the housing 12.

In other words, if any one of the first conductor portions 4*a* of the fixed contact 4 with respect to the rotation surface of the moving contact 1 is employed as in the embodiment 48, it is possible to provide the fixed contact 4 having an excellent current-liming effect, and a configuration in which the housing 12 is hardly damaged by the pressure.

Embodiment 49

Figure 88:
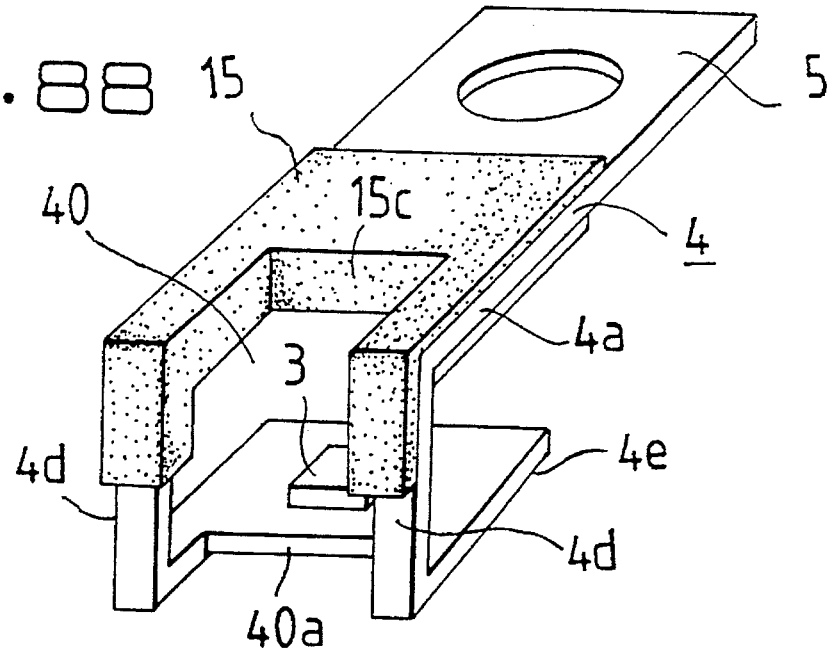
FIG. 88 is a perspective view of a fixed contact according to the embodiment 49.
Figure 89:
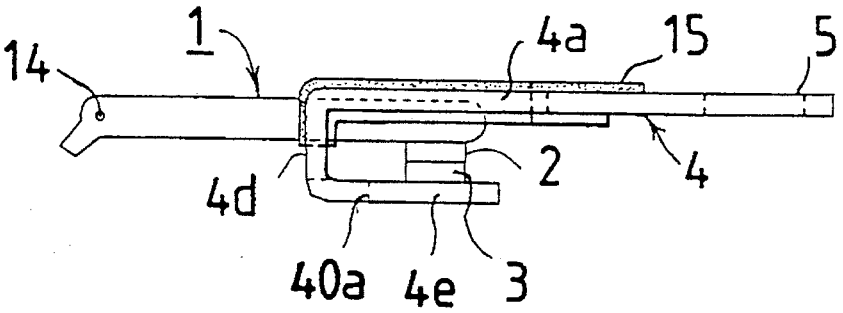
FIG. 89 is a side view showing the closing condition of the moving contact with respect to the fixed contact.
Figure 90:
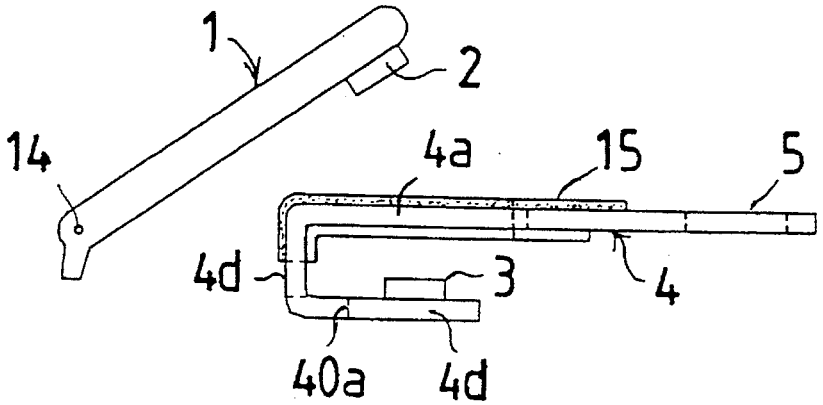
FIG. 90 is a side view showing an opening condition of FIG. 89.

FIG. 88 is a perspective view of a fixed contact according to the embodiment 49, FIG. 89 is a side view showing the closing condition of a moving contact with respect to the fixed contact, and FIG. 90 is a side view showing an opening condition of FIG. 89.

In the embodiment 49, the slit 40 is provided in the fixed contact 4 so as not to prevent the rotation of the moving contact 1 as in the respective embodiments.

However, in the embodiment 49, the slit 40 provided in the fixed contact 4 extend from the first conductor portion 4*a* to a vicinity of the stationary contact 3 of the second conductor portion 4*e* through the third conductor portion 4*d*. Thus, one end 40*a* of the slit 40 is provided in the second conductor portion 4*e* so as to be closer to the stationary contact 3. In the fixed contact 4, an area from the first conductor portion 4*a* to a midway portion of the third conductor portion 4*d* is coated with the insulator 15 as in the previous embodiment 48.

Figure 91:
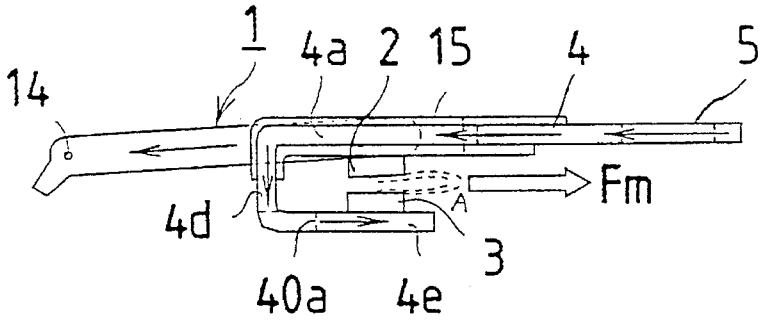
FIG. 91 is a side view showing a condition immediately after the contact opening of FIG 89.
Figure 92:
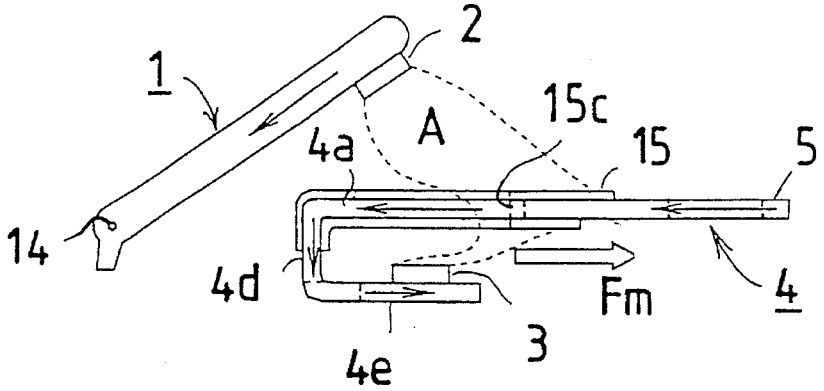
FIG. 92 is a side view showing the maximum opening condition of the moving contact of FIG. 91.

A description will now be given of the operation in the embodiment 49. FIGS. 91–92 are side views showing an essential part before and immediately after respectively the contact opening, illustrating the operation. As set forth above, the fixed contact 4 is provided such that the first conductor portion 4*a* is positioned above the surface of the stationary contact 3, and the third conductor portion 4*d* for connecting the second conductor portion 4*e* with the first conductor portion 4*a* is positioned on the side of the rotating center 14 of the moving contact 1 with respect to the stationary contact. In this condition, electromagnetic force Fm is generated in the direction of the terminal 5 by the current in the entire conductor portion forming the fixed contact 4, and is applied to the arc A below the first conductor portion 4*a* immediately after the contact opening. Accordingly, the arc A is largely stretched so that rising of the arc voltage becomes extremely large immediately after the contact opening.

As set forth above, it is possible to maintain high arc voltage in the contact opening condition because of the following two effects. One is an effect in that electrode vapor ejected from the surface of the traveling contact 2 is sprayed on the insulator 15 covering the first conductor portion 4*a* of the fixed contact 4 so as to be forcedly cooled. The other is an effect in that the arc A is pressed by strong electromagnetic force onto an insulator 15*c* covering an inner surface of the slit 40 on the side of the terminal 5 so as to be cooled.

Subsequently, a description will be given of an effect of the one end 40*a* of the slit 40 which is provided for the second conductor portion 4*e*.

Figure 93:
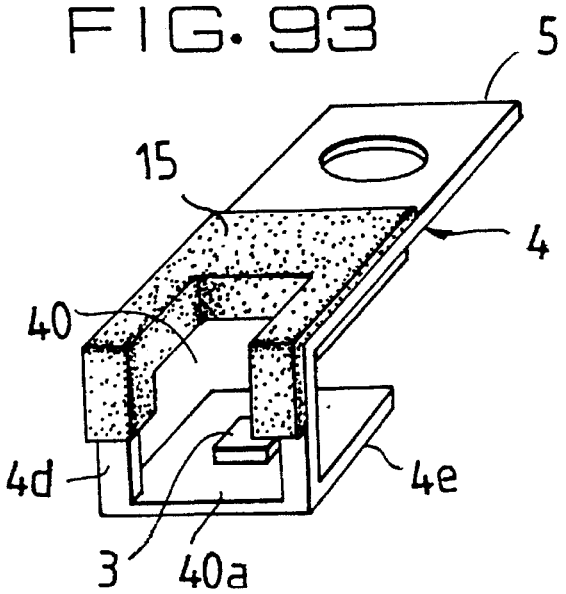
FIG. 93 is a perspective view of the same fixed contact as that of FIG. 77.

FIG. 93 is a perspective view of the same fixed contact as that of FIG. 88, and FIG. 94 is a perspective view showing the fixed contact of FIG. 93 with a moving contact in an opening condition. In FIG. 94, the insulator 15 is omitted.

A description will now be given of a case where the one end 40*a* of the slit 40 provided in the fixed contact 4 is positioned on the third conductor portion 4*d* as shown in FIG. 93.

As understood from FIG. 94, a loop current path C is formed about current I (shown by the arrow in FIG. 94) in the moving contact 1 by the slit 40 of the fixed contact 4.

Therefore, when the time varying current I flows in the moving contact 1, electromotive force may be possibly generated in the loop current path C positioned in the vicinity of the current I by electromagnetic induction. The electromotive force is generated in case time varying magnetic flux is interlinked with a surface with the loop current path C as a boundary.

In this case, the one end 40*a* of the slit 40 is positioned on the third conductor portion 4*d*, and the other end 40*b* of the slit 40 is positioned on the first conductor portion 4*a*. Accordingly, there are two surfaces with the loop current path C as the boundaries, that is, a slit surface S1 parallel to the third conductor portion 4*d*, and a slit surface S2 parallel to the first conductor portion 4*a*. The slit surface S2 parallel to the third conductor portion 4*d* is substantially perpendicular to the current in the moving contact 1, and is substantially parallel to the magnetic flux generated by the current. Hence, it is not necessary to consider a fact that the magnetic flux generated by the current in the moving contact 1 is interlinked with the slit surface S2. Further, in the slit surface S1, there is no magnetic flux interlinked with the slit surface S1 if the slit 40 is completely symmetrical with respect to the current in the moving contact 1 as understood from FIG. 95.

FIG. 95 is a side view perpendicular to the slit surface S1 of FIG. 94. In FIG. 95, reference numeral 41 means centers of the right and left first conductor portions 4*a* on both sides of the slit 40, that is, centers of the loop current path C, and I means a center of the current in the moving contact 1. Magnetic flux B generated by the current I is coaxial with the center I. When the slit 40 is symmetrical with respect to the center I, magnitude of the magnetic flux upward passing through the slit surface S1 is identical with that of the magnetic flux passing downward. As a whole, magnitude of the magnetic flux interlinked with the slit surface S1 is equal to zero.

However, it is generally difficult to manufacture a completely symmetrical slit 40 with respect to the moving contact 1. Further, it is impossible to avoid offset of the moving contact 1 on both sides of the slit 40 as shown in FIG. 96 as large force is applied to the moving contact 1, for example, at a time of the large current cutoff. FIG. 97 shows a section perpendicular to the slit surface S1 at this time, and it can be seen that the magnetic flux generated by the current I is interlinked with the slit surface S1.

At this time, it is possible to evaluate, by a simple calculation, the magnitude of magnetic flux interlinked with the slit surface S1, and the magnitude of induced current in the loop current path C.

FIG. 98 is a model diagram used for the calculation in which the current I in the loop current path C and the moving contact 1 by the slit 40 is linearly approximated, and dimensions of sides of the slit surface S1 and the slit surface S2 are defined as D, L and H. In the calculation, the magnetic flux interlinked with the slit surface S2 is neglected as described before. Further, an area element vector of the slit surface S1 is defined as a direction ds shown in FIG. 98.

FIG. 99 is a sectional view perpendicular to the slit surface S1. In FIG. 99, the conductor centers 41 of the first conductor portions 4*a* on both sides of the slit 40, are positioned on the x-axis, a center of the current in the moving contact 1 is positioned on the y-axis, and the intersection of the x-axis and the y-axis is defined as the origin. The y-coordinate of the current I is defined as a (a<0), and angles between the y-axis and the respective centers 41 of the conductors on both sides of the slit 40, are defined as θ1 (<0) and θ2 (<0), respectively.

The magnetic flux ϕ interlinked with the slit surface S1 by the current I can be expressed as follows:

$$\phi=\int B\cdot ds \quad (1)$$

Since a direction of the current I in FIG. 99 is fixed, the following expressions be obtained:

$$B\cdot ds=|B| \text{ SIN } \theta dxL \quad (2)$$

$$dx=-ad\theta/\text{COS}^2\theta \quad (3)$$

Further, by using the expression:

$$r=-a/\text{COS } \theta \quad (4)$$

the following expression can be derived:

$$|B|=-\mu I \text{ COS } \theta/2\pi a \quad (5)$$

where μ is space permeability. When the expressions (2) to (5) are substituted in the expression (1), $$\phi=\int^2 \tan \theta dx\mu IL/2\pi \quad (6)$$

Therefore, $$\phi=-\mu IL\log (\cos \theta 2/\cos \theta 1)/2\pi \quad (7)$$

With law of electromagnetic induction, voltage Vc induced by the loop current path can be expressed as follows:

$$Vc=-d\phi/dt \quad (8)$$

If the current I is sinusoidal current with peak value of Ip, and angular frequency of ω, $$I=Ip \sin \omega t \quad (9)$$

When the expressions (7) and (9) are substituted in the expression (8), $$Vc=\mu IpL\omega \cos \omega t\log (\cos \theta 2/\cos \theta 1)/2\pi \quad (10)$$

The induced current Ic of the loop current path can be expressed as follows:

$$Ic=Vc/R \quad (11)$$

where R is resistance of the loop current path C. For specific resistance of p, and sectional area of S, R can be found by the following expression:

$$R=\rho 2(D+L+H)/S \quad (12)$$

Even if the current in the fixed contact 4 is uniformly divided so as to flow in the conductors on both sides of the slit 40, the induced current occurs in the loop current path C as set forth above, resulting in unbalanced current in the conductors on both sides of the slit 40. When the unbalanced current Iu=Ic, balanced current Ib=I/2. The unbalanced current with respect to the balanced current is given by:

$$Iu=Ib\propto L \cos \omega t/\sin \omega t \quad (13)$$

As understood from the expression (13), as t becomes smaller, a rate of the unbalanced current becomes larger. Accordingly, there is the maximum unbalance of the current in the fixed contact 4 on the both sides of the slit 40 immediately after the opening of the moving contact 1, that is, at a time of the condition as shown in FIG. 91. Large unbalance occurs in the electromagnetic force applied to the arc A so that the arc A is stretched in an offset way in the direction of the terminal 5. In this case, the insulator 15 covering the first conductor portion 4*a* and the slit 40 is locally damaged by the arc A so as to increase risk of the dielectric breakdown. Since prediction of the offset way is difficult, it is impossible to prevent the dielectric breakdown of the fixed contact 4 unless the entire insulator 15 is thickened, resulting in extremely serious restriction on design of an electrode portion.

On the other hand, the fixed contact 4 according to the embodiment 49 is provided with a slit 40 which is formed as shown in FIG. 100. In the slit 40, one end 40*a* is positioned on the first conductor portion 4*a*. Hence, there are surfaces with the loop current path C about the slit 40 as boundaries for the second conductor portion 4*e*, as well as for the first conductor portion 4*a* and the third conductor portion 4*d*. FIGS. 101 and 102 show models to find the unbalanced current in this case.

In FIG. 101, L1 means a length of the slit surface S1 of the first conductor portion 4*a*, and L2 means a length of the slit surface S2 of the second conductor portion 4*e*. As shown in FIG. 102, angles between a line for connecting the center of the current of the moving contact 1 with centers of the conductors of the second conductor portion 4*e* on the both sides of the slit 40, and the y-axis are respectively defined as θ1, and θ2 as in the angles with respect to the first conductor portion 4*a*.

With respect to the models, the same calculation as described above is performed in order to find the rate of the unbalanced current, resulting in the following expression:

$$Iu/Ib\propto(L1-L2) \cos \omega t/\sin \omega t \quad (14)$$

This expression indicates that the unbalanced current can be reduced by increasing the length L2 of the slit surface S3 of the second conductor portion 4*e*.

Therefore, it can be seen that the one end 1*a* of the slit 40 provided for the second conductor portion 4*e* as described in the embodiment 49 is effective in reducing the unbalance in the current in the fixed contact 4 on the both sides of the slit 40, and providing uniform electromagnetic force applied to the arc A. As a result, the insulator 15 of the fixed contact 4 is never locally damaged by the arc A, and the risk of the dielectric breakdown of the fixed contact 4 can be avoided.

Embodiment 50

Figure 103:
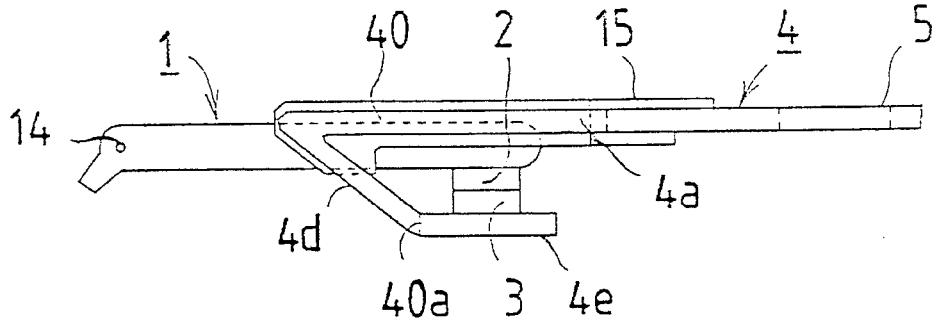

FIG. 103 is a side view showing a fixed contact according to the embodiment 50 with a moving contact in a closing condition.

In the fixed contact 4 according to the embodiment 50, the third conductor portion 4*d* is inclined so as to have an acute angle between the first conductor portion 4*a* and the third conductor portion 4*d*.

That is, the expression (14) indicates that the magnetic flux interlinked with the slit surface S1 of the first conductor portion 4*a* may be canceled by the magnetic flux interlinked with a slit surface S3 of the second conductor portion 4*e* in order to decrease the unbalanced current.

Therefore, it is also effective in reducing the unbalanced current that the third conductor portion 4*d* is inclined to a contact surface 1 at a contact closing time so as to cancel the magnetic flux interlinked with the slit surface S1 by the magnetic flux interlinked with the slit surface S2 of the third conductor portion 4*d* as in the embodiment 50.

In this case, a slit width of the slit surface S2 or the slit surface S3 may be further effectively extended greater than that of the slit surface S1 in order to cancel the magnetic flux interlinked with the slit surface S1 of the first conductor portion 4*a*.

Embodiment 51

Figure 104:
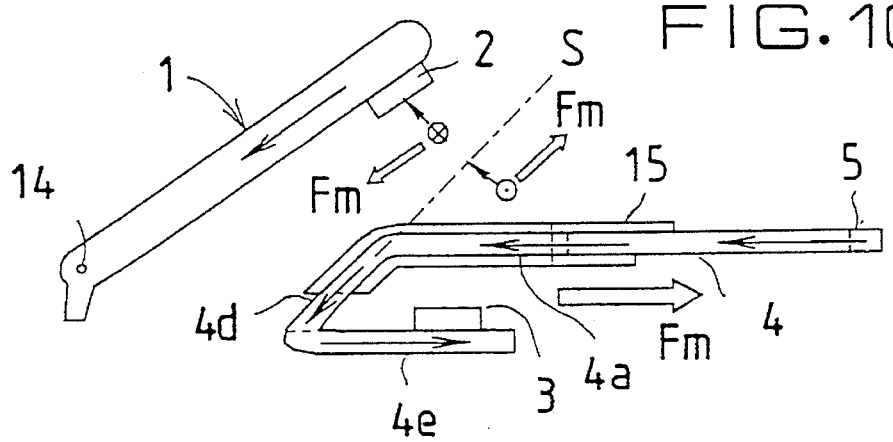

FIG. 104 is a side view showing a fixed contact according to the embodiment 51 with a moving contact in an opening condition.

In the fixed contact 4 according to the embodiment 51, the third conductor portion 4*d* is inclined so as to have an acute angle between the first conductor portion 4*a* and the third conductor portion 4*d* in a direction opposed to the direction in the embodiment 50. Further, the third conductor portion 4*d* is provided such that a plane S never intersects the moving contact 1 at a time of switching. The plane S includes a flow line of the current (shown by the arrow in FIG. 104) in the third conductor portion 4*d*, and is perpendicular to a locus described by the moving contact 1 at a time of switching. Other structures are identical with those in the previous embodiment 50.

In the embodiment 51, it is also possible to provide remarkably quick rising of arc voltage in case a strong electromagnetic force in the direction of the terminal 5 is applied to the arc immediately after the opening by the current in an entire conductor forming the fixed contact 4.

Figure 105:
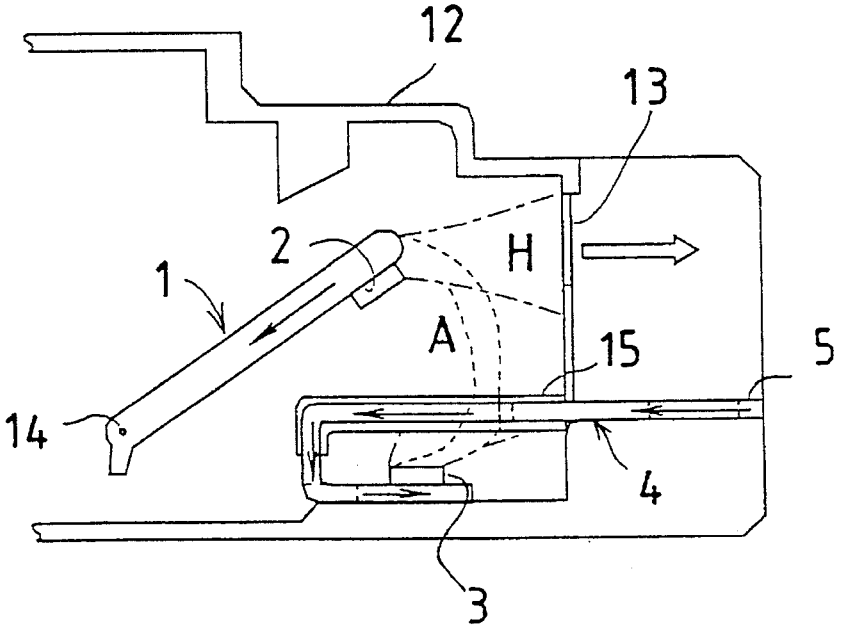

FIG. 105 is a side view of the circuit breaker, illustrating a comparison to the embodiment 51.

As described before, a metallic vapor flow is ejected from a leg of a large current arc in a direction perpendicular to a contact surface. In case the leg of the arc on the traveling contact 2 is moved in a direction of a distal end of the moving contact 1 at an opening time as shown in FIG. 105, the metallic vapor flow H ejected from the leg of the arc is directed to the exhaust hole 13. This is extremely dangerous because the metallic vapor flow H at hot temperatures is directly externally discharged. In addition, this is undesirable because a forced cooling effect on the metallic vapor flow H by the insulator 15 is reduced. In FIG. 105, the metallic vapor flow H is shown by the one dot chain line, and the current path A of the arc is shown by the dotted line.

However, in the embodiment 51, the surface of the traveling contact 2 at the opening time is positioned above the surface S including the flow line of the current in the third conductor portion 4*d*. In the area, the magnetic field generated by the current in the third conductor portion 4*d* generates electromagnetic force to stretch the leg of the arc in a direction opposed to the exhaust hole 13, that is, on the traveling contact 2 on the side of the rotating center of the moving contact 1 as shown in FIG. 104.

Figure 106:
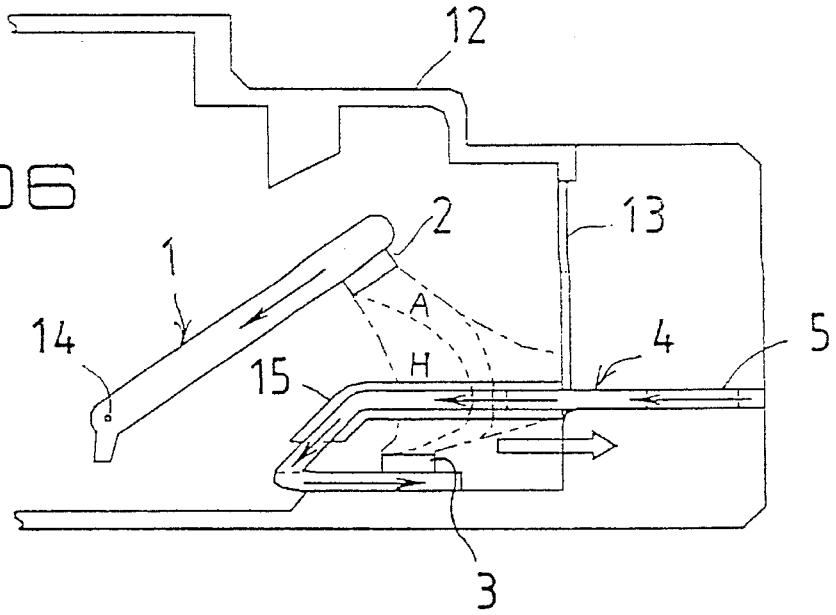

Accordingly, the leg of the arc on the traveling contact 2 at the opening time is hardly moved in the direction of the distal end of the moving contact 1. As shown in FIG. 106, the leg of the arc A on the side of the moving contact 1 at the opening time can easily stay on the traveling contact 2 so that the metallic vapor flow ejected from the leg of the arc A is safely undischarged directly from the exhaust hole 13. Further, it is possible to provide sufficient forced cooling effect which is obtained by spraying the metallic vapor flow on the insulator 15, and maintain higher arc voltage as set forth above.

Embodiment 52

Figure 107:
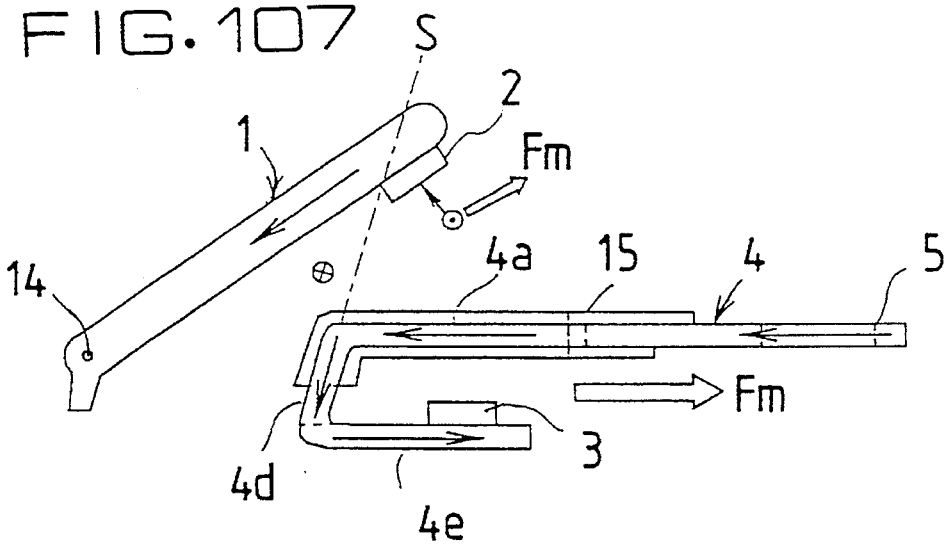

FIG. 107 is a side view of an essential part according to the embodiment 51 with a moving contact in an opening condition.

According to the embodiment 52, the third conductor portion 4*d* is provided such that the plane S can intersect the moving contact 1 at the opening time in contrast with the embodiment 51. The plane S includes a flow line of current (shown by the arrow in FIG. 107) in the third conductor portion 4*d* of the fixed contact 4, and is perpendicular to a locus described by the moving contact 1 at a time of switching. Other structures are identical with those in the previous embodiment 51.

In the embodiment 52, it is also possible to provide remarkably quick rising of arc voltage since strong electromagnetic force in the direction of the terminal 5 is applied to the arc immediately after the opening by the current in the entire conductor forming the fixed contact 4 at a time of large current cutoff. Further, it is similarly possible at the opening time to maintain high arc voltage by spraying the metallic vapor flow ejected from the traveling contact 2 on the insulator 15, and pressing the arc onto the insulator 15 by strong electromagnetic force.

In addition, in the embodiment 52, the surface of the traveling contact 2 is positioned below the surface S including the flow line of the current in the third conductor portion 4*d* at a time of small current cutoff. In the area, the current in the third conductor portion 4*d* generates electromagnetic force to drive the leg of the arc on the traveling contact 2 in the direction of a distal end of the moving contact 1.

Figure 108:
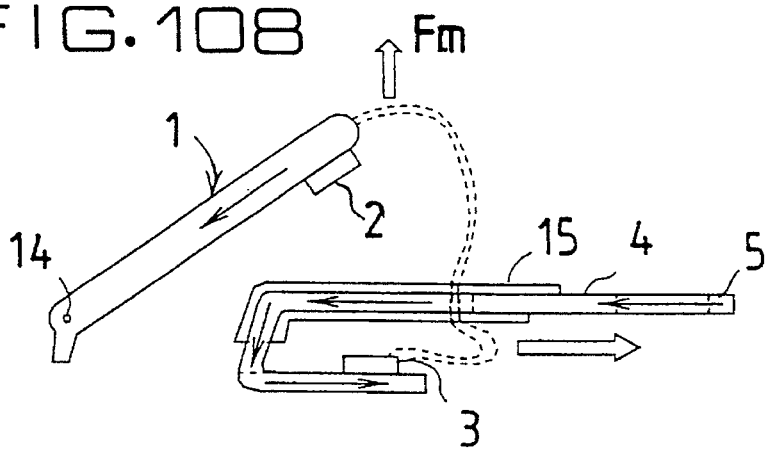

Therefore, the leg of the small arc on the traveling contact 2 on the side of the moving contact 1 can be excellently driven in the direction of the distal end of the moving contact 1 so as to be largely stretched as shown in FIG. 108. As a result, it is possible to improve a small current cutoff performance.

Embodiment 53

FIG. 109 is a side view of an essential part according to the embodiment 53, illustrating a condition where the moving contact 1 is opened by motion of a mechanism portion (which is identical with the mechanism portion 8 in FIG. 1). FIG. 110 is a side view showing the maximum opening condition of the moving contact 1 by electromagnetic repulsion which is applied to the moving contact 1, for example, at a time of the large current cutoff.

In the embodiment 53, the third conductor portion 4*d* is inclined such that a plane S intersects the moving contact 1 which is opened by only the motion of the mechanism portion as shown in FIG. 109, and never intersects the moving contact 1 in the maximum opening condition by the electromagnetic repulsion or the like as shown in FIG. 110. The plane S includes a flow line of the current (shown by the arrow in FIG. 109) in the third conductor portion 4*d* of the fixed contact 4, and is perpendicular to a locus described by the moving contact 1 at a time of switching. Other structures are identical with those in the previous embodiment.

In the embodiment 53, it is also possible to provide remarkably quick rising of the arc voltage since the strong electromagnetic force in the direction of the terminal 5 is applied to the arc immediately after the opening by the current in an entire conductor forming the fixed contact 4 at the time of the large current cutoff. In addition, as shown in FIG. 110, the electromagnetic repulsion or arc pressure sets the moving contact 1 in the maximum opening condition at the time of the large current cutoff. Therefore, the magnetic field generated on the surface of the traveling contact 2 by the third conductor portion 4*d* serves as the electromagnetic force to leave the leg of the arc on the traveling contact 2.

Accordingly, as described in the embodiment 51, the hot metallic vapor flow ejected from the leg of the arc can be safely undischarged externally. Further, the forced cooling can be ideally performed by the insulator 15 to the metallic vapor flow so as to maintain higher arc voltage.

At a time of the small current, the moving contact 1 can be opened by only the mechanism portion so that the magnetic field generated by the third conductor portion 4*d* generates the electromagnetic force to drive the leg of the arc to a distal end of the moving contact 1 on the surface of the traveling contact 2 as shown in FIG. 109. As a result, the arc can be largely stretched so as to improve the small current cutoff performance as set forth above.

Therefore, in the embodiment 53, it is possible to previously avoid the external discharge of the metallic vapor flow at the time of the large current cutoff, maintain high arc voltage, and improve the small current cutoff performance.

Embodiment 54

FIG. 111 is a perspective view of a fixed contact according to the embodiment 54, FIG. 112 is a plan view of FIG. 111, and FIG. 113 is a side view showing a condition of the fixed contact immediately after the moving contact.

According to the embodiment 54, the fixed contact 4 is provided with an outward conductor portion 40*e* extending from the second conductor portion 4*e* in a direction opposed to the stationary contact 3, and an extending conductor portion 40*d* which is integrally formed with the third conductor portions 4*d* so as to integrally connect the third conductor portions 4*d* to both side ends 40*e*' of the outward conductor portion 40*e*. Further, a plane includes a flow line of current in the outward conductor portion 40*e* of the second conductor portion 4*e* and is perpendicular to a locus of the moving contact 1 at a time of switching, and the plane is positioned below a surface of the stationary contact 3.

In the embodiment 54, as shown in FIG. 113, it is also possible to provide remarkably quick rising of the arc voltage since the strong electromagnetic force in the direction of the terminal 5 is applied to the arc immediately after the opening by the current in the entire conductor forming the fixed contact 4 at the time of the large current cutoff. Further, it is similarly possible at the opening time to maintain high arc voltage by spraying the metallic vapor flow-ejected from the traveling contact 2 on the insulator 15, and pressing the arc onto the insulator 15 by strong electromagnetic force.

In addition, in the embodiment 54, arc driving magnetic field in a space above the stationary contact 3 is reinforced by the current in the outward conductor portion 40*e* extending in the direction opposed to the stationary contact 3 of the second conductor portion 4*e*.

FIG. 114 is a schematic sectional view taken along line 114—114 of FIG. 113. FIG. 114 shows a center of the outward conductor portion 40*e* of the second conductor portion 4*e*, and centers of the extending conductor portion 40*d* of the third conductor portion 4*d*. In FIG. 114, P means a junction surface, and S means a plane which includes the current in the outward conductor portion 40*e*, and is perpendicular to a locus of the moving contact 1 at the time of switching.

A length of a perpendicular drawn from the point P to the center of the outward conductor portion 40*e* is defined as 1. Further, an angle is defined as θ between a perpendicular from the point P to the extending conductor portion 40*d* and the perpendicular to the outward conductor portion 40*e*. In case the magnetic field to drive the arc at the point P on the side of the terminal 5 is positive, magnetic field Bp in the point P can be expressed as follows:

$$Bp \propto \mu I(1-\cos^2\theta)/2\pi l \quad (15)$$

Therefore, it is possible to reinforce the electromagnetic force to stretch the arc A in the space above the stationary contact 3 on the side of the terminal 5 by extending the second conductor portion 4*e* of the fixed contact 4 on the side opposed to the stationary contact 3.

FIG. 115 is a side view showing an alternative embodiment of the fixed contact according to the embodiment 54, FIG. 116 is a side view showing another alternative embodiment of the fixed contact, and FIG. 117 is a plan view of FIG. 116.

In the fixed contact 4 according to the embodiment 54, the third conductor portion 4*d* may be diagonally formed as shown in FIG. 115, and the outward conductor portion 40*e* may be further extended as shown in FIGS. 116 and 117. In either case, further effective results can be provided.

FIG. 118 is a side view showing still another alternative embodiment of the fixed contact according to the embodiment 54. According to the alternative embodiment, the fixed contact 4 is provided with the first conductor portion 4*a* and the third conductor portion 4*d* only on a single side, resulting in the same effect as in the embodiment 54.

Embodiment 55

FIG. 119 is a side view showing a contact closing condition of an essential part according to the embodiment 55, and FIG. 120 is a perspective view of a fixed contact shown in FIG. 119.

In the embodiment 55, a downward projecting portion 11 is bent at a free end of the moving contact 1 so as to face on the side of the stationary contact 3 of the fixed contact 4, and the traveling contact 2 is secured to a lower surface of the projecting portion 11.

In the fixed contact 4, an opening 42 is provided in the first conductor portion 4*a* so as to allow the projecting portion 11 to pass through the opening 42 such that the third conductor portion 4*d* can ensure a current path in a portion proximate to a locus of the moving contact 1 at a time of switching. Other structures are identical with those in the previous embodiment, and descriptions thereof are omitted.

In the embodiment 55, it is also possible to provide remarkably quick rising of arc voltage since strong electromagnetic force in the direction of the terminal 5 is applied to the arc A immediately after the opening by the current in the entire conductor forming the fixed contact 4 at the time of the large current cutoff. Further, it is similarly possible at the opening time to maintain high arc voltage by spraying the metallic vapor flow ejected from the traveling contact 2 on the insulator 15, and pressing the arc onto the insulator 15 by strong electromagnetic force.

FIG. 121 is a side view showing the essential part according to the embodiment 55 immediately after the opening, and FIG. 122 is a side view of the essential part showing the maximum opening condition of FIG. 121.

In the embodiment 55, the current in the third conductor portion 4*d* generates electromagnetic force to stretch the arc A on the side of the terminal 5 immediately after the opening, and flows in a portion proximate to the arc A as shown in FIG. 121. That is, the third conductor portion 4*d* ensures the current path of the portion proximate to the locus of the moving contact 1 at the time of switching so that larger electromagnetic force Fm can be provided to stretch the arc A.

Further, no opening is provided in the third conductor portion 4d of the fixed contact 4 so that no pressure generated by the arc A can escape. Accordingly, there is an effect in that the arc A can be stretched by pressure Fp in the direction of the terminal 5. Since the pressure Fp can not escape in the direction of the third conductor portion 4d of the fixed contact 4, the arc A is upward blown away by the pressure Fp. As a result, it is possible to further enhance arc voltage.

FIG. 123 is a perspective view of an alternative embodiment of the fixed contact according to the embodiment 55. In the fixed contact 4 according to the alternative embodiment, the third conductor portion 4d has a narrower width than that of the first conductor portion 4a, and thereby concentrating the current in the current path including the third conductor portion 4d (i.e., the current path proximate to the arc). Therefore, according to the alternative embodiment, it is possible to concentrate the current in the third conductor portion 4d having the portion proximate to the switching locus of the traveling contact 2

Embodiment 56

FIG. 124 is a side view of an arc-extinguishing portion, showing a closing condition of a circuit breaker serving as a switch according to the embodiment 56 with a housing broken away. FIG. 125 is a side view showing an opening condition of the circuit breaker of FIG. 124, and FIG. 126 is a plan view of a fixed contact including the arc-extinguishing portion shown in FIGS. 124 and 126. FIG. 127 is a front view of FIG. 126, and FIG. 128 is a perspective view of FIG. 126.

Structures are identical with those in the above embodiment 1 except a related configuration between the moving contact 1 and the fixed contact 4 as will be described later.

The fixed contact 4 is mounted and set to the housing 12 such that the third conductor portion 4d is positioned on a side of the other end of the moving contact 1 to which the traveling contact 2 is not secured with respect to the stationary contact 3 and on the side opposed to the terminal 5 (i.e., on the side of the rotation supporting point 14 of the moving contact 1). In this case, the first conductor portion 4a is arranged such that the entire first conductor portion 4a is positioned above a contact surface of the contacts at a contact closing time when the traveling contact 2 contacts the stationary contact 3, and is positioned above the moving contact 1 at a contact opening time.

A more specific description will now be given of the related configuration between the moving contact 1 and the fixed contact 4.

The fixed contact 4 is integrally provided in a substantially U-shaped form including the first conductor portion 4a, the second conductor portion 4e and the third conductor portion 4d. The terminal 5 on the side of the power source is connected to one end of the U-shaped form, that is, an end of the first conductor portion 4a on the side connected to the power source. Further, the stationary contact 3 is secured to the inside of the U-shaped form serving as the opposite side end, that is, an upper surface portion of the second conductor portion 4e. Moreover, in the fixed contact 4, a slit 40 is provided in a connecting conductor portion (i.e., the first conductor portion 4a and the third conductor portion 4d) positioned above a secured surface of the stationary contact 3 as shown in FIGS. 126 to 128.

The slit 40 is provided so as not to prevent a switching action of the moving contact 1 with respect to the stationary contact 3 on the second conductor portion 4e.

In a range of height of the third conductor portion 4d of the fixed contact 4, the rotating center 14 of the moving contact 1 is disposed at an external position opposed to the slit 40 in the third conductor portion 4d. Thereby, the moving contact 1 can rotate through the slit 40 in contact switching directions.

In the fixed contact 4, two arc-extinguishing side plates 7 are disposed on internal both sides of the slit 40. The arc-extinguishing side plates 7 are parallel to each other on the internal both sides of the slit 40 at an interval between which a locus surface of the moving contact 1 at the time of a switching action is interposed, and rise up to a position above the first conductor portion 4a at the parallel interval.

In the fixed contact 4 including the arc-extinguishing side plates 7, inner surfaces of the first conductor portion 4a in the slit 40 and upper surface portions of portions of the first conductor portion 4a positioned on the outside of the arc-extinguishing side plates 7 are separated from a surface of the traveling contact 2 through the arc-extinguishing side plates 7. Portions of the first conductor portion 4a which can be surveyed from the surface of the traveling contact 2 other than the above portions, that is, an inner surface and an upper surface of the first conductor portion 4a on the side of the terminal 5 are coated with an insulator 15. The insulator 15 includes an insulator 15a covering the upper surface of the first conductor portion 4a, and an insulator 15b covering the inner surface of the slit 40.

The mechanism portion 8, the handle 9 and the like shown in FIG. 1 are omitted in FIGS. 124 and 125.

A description will now be given of the operation.

As in the prior art, if large current such as short-circuit current flows, the moving contact 1 rotates to open the traveling contact 2 and the stationary contact 3 before the operation of the mechanism portion, and the arc A forms between the contacts 2 and 3.

FIG. 129 is an explanatory view of the operation, showing a condition immediately after the contact opening, and FIG. 130 is a sectional view taken along line 130—130 of FIG. 129. In such a condition immediately after the contact opening, a contact surface of the traveling contact 2 is still positioned below the first conductor portion 4a of the fixed contact 4. In FIG. 129, the arrow means current.

In this condition, a current path including an area from the terminal 5 to the first conductor portion 4a of the fixed contact 4 are entirely positioned above the arc A. As a result, electromagnetic force applied to the arc A which is generated by the current path can serve as forge to stretch the arc A on the side of the terminal 5. Further, the current in the third conductor portion 4d of the fixed contact 4 has a direction opposed to the that of current of the arc A so that electromagnetic force generated by the current in the third conductor portion 4d can also serve as forge to stretch the arc on the side of the terminal 5.

Accordingly, the entire electromagnetic forge generated by the current in the fixed contact 4 can serve as the forge to stretch the arc A on the side of the terminal 5, and an extremely strong arc driving magnetic field can be provided.

As shown in FIG. 130, the arc A forming between the traveling contact 2 and the stationary contact 3 is interposed between the right and left arc-extinguishing side plates 7. Hence, the arc A never extends in both sides directions so that a sectional area thereof in the directions is restricted. On the other hand, since the extremely strong electromagnetic force Fm is applied to the arc A in the direction of the terminal 5 as shown in FIG. 129, the arc A between the traveling contact 2 and the stationary contact 3 never extends in a direction opposed to the terminal 5.

That is, so to speak, an electromagnetic wall allows the arc-extinguishing side plates 7 to effectively restrict the sectional area of the arc A. The arc A is cooled since heat is taken from a portion of the arc A contacting the arc-extinguishing side plates 7. Further, the arc A is interposed between the arc-extinguishing side plates 7 as set forth above so as to increase pressure in an arc generating area. The traveling contact 2 is forcedly pressed upward by the pressure, resulting in increased opening speed of the moving contact 1.

Thus, the arc A immediately after the contact opening is strongly stretched, and is cooled by restricting the sectional area thereof. Concurrently, a distance between the contacts 2 and 3 is more quickly increased so as to rapidly increase arc voltage.

FIG. 131 is a side view showing the maximum opening condition of the fixed contact of FIG. 129. In large current arc such as short-circuit current, it has been known that a metallic vapor flow is ejected from a leg of the arc on a contact surface in a direction perpendicular to the contact surface because of vaporization of the contact, and the vapor flow is an essential constituent component of the arc A.

As shown in FIG. 131, the first conductor portion 4*a* with which the surface of the traveling contact 2 faces is insulated through the insulator 15 so that the metallic vapor ejected from the surface of the traveling contact 2 collides with the insulator 15 so as to be cooled, resulting in increased arc voltage.

Electromagnetic force Fm is generated by strong arc driving magnetic field, and is applied to the arc A which is positioned below the first conductor portion 4*a* of the fixed contact 4. There is another arc driving magnetic field in the slit 40 of the first conductor portion 4*a* as will be described in the following.

FIG. 132 is a sectional view taken along line 132—132 of FIG. 131 without the arc-extinguishing side plates 7. In FIG. 132, reference numeral 41 means the centers of gravity of respective sections of the right and left first conductor portions 4*a* on both sides of the slit 40, and the center of gravity of the second conductor portion 4*e*.

FIG. 133 shows the intensity distribution of the magnetic field on the Z-axis of FIG. 132, which is generated by the current in the fixed contact 4, and the intensity distribution of the magnetic field is found by a theoretical calculation. In FIG. 133, magnetic field in a positive direction is a magnetic field component (hereafter referred to as arc driving magnetic field) to stretch the arc A on the side of the terminal 5.

As shown in FIG. 132, the first conductor portions 4*a* are positioned at positions laterally offset from a plane in which the moving contact 1 is rotated.

In the conductor arrangement, as shown in FIG. 133, there is the arc driving magnetic field to stretch the arc A up to a space area Z0 above the first conductor portion 4*a* on the side of the terminal 5 due to an effect caused by the current in the second conductor portion 4*e* and the third conductor portion 4*d*.

Accordingly, strong electromagnetic force is applied to the arc A on the side of the terminal 5 in a range from the stationary contact 3 to a certain upper side of the first conductor portion 4*a* so that the arc A is pressed onto the insulator 15*b* covering the inner surface of the slit 40 so as to be cooled. As a result, the arc resistance rapidly increasing immediately after the contact opening is further increased so as to maintain high arc voltage. Thus, it is possible to provide a circuit breaker which can reduce current peak and running energy, and has an excellent current-limiting performance.

In the embodiment 56, the traveling contact 2 never rises above the arc-extinguishing side plates 7 even if the traveling contact 2 is in the opening condition. That is, the arc A above the first conductor portion 4*a* is interposed between the arc-extinguishing side plates 7 even if the traveling contact 2 is in the maximum opening condition so as to be positioned above the first conductor portion 4*a*. Therefore, there are effects on the arc A in the range in that the arc A can have the restricted sectional area and be cooled by the arc-extinguishing side plates 7. Further, since pressure in a space below the moving contact 1 is increased so as to exert force to lift the moving contact 1, an opening speed of the moving contact 1 never decelerates and a current-limiting performance can be further improved.

Embodiment 57

FIG. 134 is a side view showing an electrode portion of a circuit breaker according to the embodiment 57 of the present invention. In the embodiment 57, current in the second conductor portion 4*e* flows substantially parallel to current in the moving contact 1 in a direction opposed to that of the current in the moving contact 1 at a time of substantially closing.

In such a configuration, it is possible to increase force to stretch the arc A on the side of the terminal 5, which is generated by electromagnetic force of the current path of the second conductor portion 4*e*. Further, electromagnetic repulsion is applied between the moving contact 1 and the second conductor portion 4*e* of the fixed contact 4 at the closing time so as to increase the rotation speed of the moving contact 1, and an arc length can be more quickly increased immediately after the contact opening. As a result, it is possible to provide more rapid rising of arc resistance, and improve current-limiting performance.

In case current in the one portion 1*a* of the moving contact 1 at the closing time is positioned substantially below the first conductor portion 4*a* of the fixed contact 4 as in the embodiment 57 (FIG. 134), the current in the one portion 1*a* of the moving contact 1 and the current in the first conductor portion 4*a* of the fixed contact 4 flow in the same direction so as to attract each other, resulting in the increased rotation speed of the moving contact 1. As a result, a distance between contacts for opening initial period, that is, an arc length can be more quickly increased so that a current-limiting performance can be improved.

Embodiment 58

FIG. 135(*a*) is a side view showing an electrode portion of a circuit breaker according to the embodiment 58, and FIG. 135(*b*) is a front view of FIG. 135(*a*) without a moving contact.

The embodiment 58 is characterized by a configuration of an insulator 15 covering the first conductor portion 4*a* of the fixed contact 4.

That is, the insulator 15 according to the embodiment 58 includes a surface insulator 15*a* covering a surface of the first conductor portion 4*a* in a vicinity of an inner portion of the slit 40 (i.e., a slit end on the side of the terminal 5), an inner surface insulator 15*b* covering an inner surface of the slit 40 between the arc-extinguishing side plates 7 on both sides, and trailing extension insulator 15*c* downward extending directly from the inner surface insulator 15*b*.

In case the insulator 15 is provided as set forth above, the arc A below the first conductor portion 4*a* is surrounded from all directions by strong magnetic field generated by the fixed contact 4, the right and left arc-extinguishing side plates 7, and the trailing extension insulator 15*c*. Accordingly, it is possible to considerably reduce a sectional area of the arc A, and enhance a cooling effect by the arc-extinguishing side plates 7 and the insulator 15*c*. Further, since a space below the first conductor portion 4*a* is surrounded from three directions immediately after the contact opening, pressure in the space can easily rise. Rise of the pressure increases force to lift the moving contact 1 so that the opening speed can be increased. As a result, a current-limiting performance can be further improved.

Embodiment 59

FIG. 136 is a side view showing an electrode portion of a circuit breaker according to the embodiment 59.

The embodiment 59 is characterized in that a distal end 1*b* of the moving contact 1 can rise up to a position above the arc-extinguishing side plate 7 at the maximum opening time.

When the circuit breaker is provided as set forth above, pressure in a space between the arc-extinguishing side plates 7 is increased at a time of cutoff of small current such as load current. Consequently, pressure Fp in a direction external to the arc-extinguishing side plates 7 is applied to the arc A in the vicinity of the traveling contact 2 so that a leg of the arc A on the traveling contact 2 can be easily moved to the distal end 1*b* of the moving contact 1. As a result, it is possible to reduce consumption of the traveling contact 2 caused by the arc A, and improve a cutoff performance because of elongated extension of the arc A.

Embodiment 60

FIG. 137 is a side view showing an electrode portion of a circuit breaker according to the embodiment 60.

The embodiment 60 is characterized by a configuration of the arc-extinguishing side plates 7. In the arc-extinguishing side plate 7 according to the embodiment 60, a rising portion 7*a* is positioned above the first conductor portion 4*a* of the fixed contact 4, and is offset on the side of the rotating center 14 of the moving contact 1 with respect to the traveling contact 2 at the maximum opening time. Further, an upper surface of the first conductor portion 4*a* which can be surveyed from the traveling contact 2 at the opening time is insulated by a one portion 15*d* of the insulator 15.

In the configuration, when the moving contact 1 is in the maximum opening condition, the arc A is blown away above the first conductor portion 4*a* by pressure Fp in a space interposed between the arc-extinguishing side plates 7 on the side of a space which is not interposed between the arc-extinguishing side plates 7, that is, on the side of the terminal 5. Subsequently, pressure from a space below the first conductor portion 4*a* is added to the arc A so that the arc A can be stretched. As a result, it is possible to extend an arc length above the first conductor portion 4*a*, and increase arc voltage so as to improve a current-limiting performance.

In addition, since the arc A is interposed only for a short time between the two arc-extinguishing side plates 7 above the first conductor portion 4*a*, it is possible to reduce damage to the arc-extinguishing side plates 7 by the arc A, and degradation of dielectric strength on surfaces of the arc-extinguishing side plates 7.

Therefore, dielectric breakdown hardly occurs through the surface of the arc-extinguishing side plates 7 between the traveling contact 2 and the stationary contact 3, and a cutoff performance can be also improved.

Embodiment 61

FIG. 138(*a*) is a side view showing an electrode portion of a circuit breaker according to the embodiment 61, and FIG. 138(*b*) is a sectional view taken along line 138—138 of FIG. 138(*a*).

In the embodiment 61, upper projecting portions of the arc-extinguishing side plates 7 are provided so as not to interpose the traveling contact 2 of the moving contact 1 at the maximum opening time between the arc-extinguishing side plates 7. As an example, an inclined portion 7*b* is provided for the upper projecting portion of the arc-extinguishing side plate 7 in FIG. 138(*a*).

Accordingly, since the traveling contact 2 at the maximum opening time can extend above the arc-extinguishing side plates 7, the insulator 15 is provided with a portion 15*d* to cover upper surfaces of the first conductor portion 4*a* on both sides of the slit 40 so as not to expose the upper surfaces of the first conductor portion 4*a* external to the arc-extinguishing side plates 7 to a metallic vapor flow ejected from the traveling contact 2.

In an opening action, the moving contact 1 is considerably affected by electromagnetic force generated by current in the first conductor portion 4*a* since the moving contact 1 passes by the first conductor portion 4*a*, and pressure in a space below the first conductor portion 4*a* is also applied to the moving contact 1. Consequently, there is a risk in that the traveling contact 2 may contact either of the right and left arc-extinguishing side plates 7 at an opening time because the moving contact 1 in the course of the opening action is laterally swung facing FIG. 138(*b*) due to slight unbalance of the pressure or the electromagnetic force. The surface of the arc-extinguishing side plate 7 exposed to the arc A has extremely degraded dielectric strength. Therefore, insulation between the traveling contact 2 and the stationary contact 3 can not last in a condition where the traveling contact 2 contacts the arc-extinguishing side plate 7, resulting in large risk of incapability of cutoff. Even if the traveling contact 2 does not contact the arc-extinguishing side plate 7, dielectric breakdown between the traveling contact 2 and the stationary contact 3 occurs through the surface of the arc-extinguishing side plate 7 in case an insulation distance between the traveling contact 2 and the arc-extinguishing side plate 7 is to small. Hence, it is impossible to provide a sufficient cutoff performance.

However, according to the embodiment 61, the traveling contact 2 in the opening condition is not interposed between the arc-extinguishing side plates 7 so that the traveling contact 2 never contacts the arc-extinguishing side plate 7 even if the moving contact 1 is laterally offset. In addition, it is possible to provide a large insulation distance between the traveling contact 2 and the arc-extinguishing side plate 7. Thus, it is possible to eliminate the risk of the incapability of cutoff, and improve the current-limiting performance and the cutoff performance.

FIG. 139 is a side view showing a circuit breaker including an arc-extinguishing side plate according to an alternative embodiment of the embodiment 61.

In the arc-extinguishing side plate 7 according to the alternative embodiment, a rising portion rising from the first conductor portion 4*a* is offset on the side of the rotating center 14 of the moving contact 1 to the maximum extent such that the traveling contact 2 at the opening time is not interposed between the arc-extinguishing side plates 7, and the moving contact 1 at the opening time is interposed between the arc-extinguishing side plates 7.

In the configuration, the traveling contact 2 at the opening time is not interposed between the arc-extinguishing side plates 7 so as to provide the same effect as that in the embodiment 61. In addition to the effect, it is possible to increase force to stretch the arc A by pressure Fp in the direction of the terminal 5 since a position of the moving contact 1 at the opening time on the side of the rotating center 14 with respect to the traveling contact 2 is interposed between the arc-extinguishing side plates 7.

Embodiment 62

FIG. 140 is a side view of a circuit breaker according to the embodiment 62, and FIG. 141 is a front view of FIG. 140. In FIG. 141, the moving contact 1 shown in FIG. 140 is omitted.

In the embodiment 62, upper edges of the arc-extinguishing side plates 7 extends so as not to exceed a range of height of the fixed contact 4. Further, the insulator 15 is provided with an insulating portion 15*d* to cover upper surfaces of the first conductor portion 4*a* on both sides of the slit 40, which is exposed to a metallic vapor flow ejected from the traveling contact 2 at the opening condition.

Even in such a configuration, the arc A generates high arc voltage immediately after opening by the action of the arc-extinguishing side plates 7 and the arc driving magnetic field as described before.

That is, when the traveling contact 2 is opened up to a position above the first conductor portion 4*a*, pressure in a space above the first conductor portion 4*a* increases less than that in a space below the first conductor portion 4*a* since the space above the first conductor portion 4*a* is not interposed between the arc-extinguishing side plates 7. As a result, the arc A is upward stretched by the pressure Fp in the space below the first conductor portion 4*a*. Further, the pressure in the space above the first conductor portion 4*a* can easily escape upward, and the arc-extinguishing side plate 7 has small area (pressure receiving area). Hence, force applied to the arc-extinguishing side plates 7 is reduced, and high mechanical strength of the arc-extinguishing side plates 7 is not required.

As set forth above, the metallic vapor flow ejected from the surface of the traveling contact 2 is sprayed onto the insulator 15 covering the first conductor portion 4*a* so as to be cooled. In the embodiment, there is no arc-extinguishing side plate 7 above the first conductor portion 4*a*. Accordingly, the metallic vapor flow ejected from the traveling contact 2 is further sprayed in a direction of the insulator 15*d* on the upper surface of the first conductor portion 4*a* on the both sides of the slit 40, and is not concentrated on only the insulator 15*a* covering the slit 40 on the side of the terminal 5.

Therefore, it is possible to reduce damage to the insulator 15*a* by the arc A. In addition, since the arc A is pressed for forced cooling by the electromagnetic force of the fixed contact 4 onto the insulator 15*b* on the side of the terminal 5 of the slit 40 of the first conductor portion 4*a*, it is possible to maintain high arc voltage as in the case of the above description. Further, no cutoff incapability occurs because the traveling contact 2 never contacts the arc-extinguishing side plates 7 even if the moving contact 1 is laterally offset in the opening condition.

FIG. 142 is a side view of a circuit breaker according to an alternative embodiment of the embodiment 62.

In the alternative embodiment, the upper edges of the arc-extinguishing side plates 7 extend so as not to exceed a range of height of the fixed contact 4. As a result, an arc-extinguishing plate 6 can be easily disposed in the space above the first conductor portion 4*a* of the fixed contact 4, and the cutoff performance can be further enhanced because of the arrangement of the arc-extinguishing plate 6.

Embodiment 63

FIG. 143 is a side view showing an electrode portion of a circuit breaker according to the embodiment 63.

In the embodiment 63, the arc-extinguishing side plates 7 are provided such that a space below the first conductor portion 4*a* of the fixed contact 4 on the side of the terminal 5 is not interposed between the arc-extinguishing side plates 7. The arc-extinguishing side plate 7 according to the embodiment 63 has an end 7*e* on the side of the terminal 5 which is provided at a right angle.

According to the embodiment 63, a space in a vicinity of the stationary contact 3 is interposed between the arc-extinguishing side plates 7 for an opening initial period or at an opening time as shown in FIG. 143. Consequently, pressure in the space increases, and the arc A is stretched by the increased pressure Fp on the side of the terminal 5. Therefore, it is possible to enhance an increasing speed of arc voltage for the opening initial period, or enhance the arc voltage by reinforced drive of the arc A at the opening time to the insulator 15*b*.

FIG. 144 is a side view showing an electrode portion of a circuit breaker according to an alternative embodiment of the embodiment 63. In the alternative embodiment, the end 7*e* of the arc-extinguishing side plate 7 on the side of the terminal 5 is inclined as shown in FIG. 144 so as to provide the same effect as that in the embodiment 63.

Embodiment 64

FIG. 145(*a*) is a side view showing an electrode portion of a circuit breaker according to the embodiment 64, and FIG. 145(*b*) is a front view of FIG. 145(*a*).

In the embodiment 64, the circuit breaker is provided with arc-extinguishing side plates 7 extending so as not to exceed a range of height of the fixed contact 4, and a trailing extension insulator 15*c* is formed by downward extending the insulator 15*b* covering an inner surface of the slit 40 of the first conductor portion 4*a* on the side of the terminal 5 as in the embodiments 62 and 63.

According to the embodiment 64, a strong electromagnetic force in a direction of the terminal 5 is applied to the arc A below the first conductor portion 4*a* so that the arc A is pressed onto the trailing extension insulator 15*c* of the insulator 15 so as to be forcedly cooled, resulting in improved cooling effect. Further, the first conductor portion 4*a* in the direction of the terminal 5 is blocked by the insulator 15*c* so as to more effectively limit the arc area by the arc-extinguishing side plates 7 on both sides.

Embodiment 65

FIG. 146(*a*) is a side view showing an electrode portion of a circuit breaker according to the embodiment 65, and FIG. 146(*b*) is a sectional view taken along line 146*b*—146*b* of FIG. 146(*a*).

In the embodiment 65, the upper edges of the arc-extinguishing side plates 7 are provided so as not to exceed a range of height of the fixed contact 4, and lower ends of the arc-extinguishing side plates 7 are provided so as to be positioned below the stationary contact 3.

Since the arc-extinguishing side plates 7 are constructed as set forth above, pressure generated by heat of the arc A can not escape from the lower side of the arc-extinguishing side plate 7 in a space below the first conductor portion 4*a* of the fixed contact 4 for opening initial period as shown in FIG. 146(*a*). Consequently, the pressure is increased so as to increase pressure to lift the moving contact 1. As a result, it is possible to increase the opening speed of the moving contact 1 for the opening initial period.

As set forth above, the strong electromagnetic force exerts in the direction of the terminal 5 in the space below the first conductor portion 4*a* of the fixed contact 4. Hence, the arc A can not move in a direction of the rotating center of the moving contact 1, which is opposite to the direction of the terminal 5. Further, the pressure never escapes from the lower side of the arc-extinguishing side plates 7 in the embodiment 65 so that force to press the arc A in the direction of the terminal 5 becomes extremely large. The arc A is largely stretched by the large force in the direction of the terminal 5 so as to enhance an initial increasing speed of the arc voltage. In addition, the force can serve as force to press the arc A onto the inner surface insulator 15*b* of the insulator 15 at the opening time, resulting in improved cooling effect.

FIG. 147(*a*) is a side view showing an electrode portion of a circuit breaker according to an alternative embodiment of FIGS. 146(*a*) and (*b*), and FIG. 147(*b*) is a sectional view taken along line 147*b*—146*b* of FIG. 147(*a*).

In the alternative embodiment, lower ends of the arc-extinguishing side plates 7 contact an upper surface of the second conductor portion 4*e*, and the second conductor portion 4*e* has a width broader than a distance between the arc-extinguishing side plates 7. It is thereby possible to prevent the pressure from escaping from the lower end of the arc-extinguishing side plates 7.

Embodiment 66

FIG. 148 is a side view showing an electrode portion of a circuit breaker according to the embodiment 66, and FIG. 149 is a sectional view taken along line 149—149 of FIG. 148(*a*).

In the embodiment 66, lower ends of the arc-extinguishing side plates 7 are positioned above the stationary contact 3 unlike the embodiment 65. That is, gaps S are provided between the respective lower ends of the arc-extinguishing side plates 7 on both side and the second conductor portion 4*e* of the fixed contact 4.

In such a configuration, pressure in a space below the first conductor portion 4*a* of the fixed contact 4 can escape from the gas S at the lower ends of the arc-extinguishing side plates 7 so as to reduce a rise of pressure increasing in the space below the first conductor portion 4*a*. As a result, it is possible to reduce pressure applied to the arc-extinguishing side plates 7, and reduce mechanical strength required for the arc-extinguishing side plates 7. If surfaces of the arc-extinguishing side plates 7 have small dielectric strength at a time of current cutoff, dielectric breakdown may reach the traveling contact 2 from the stationary contact 3 through the surfaces of the arc-extinguishing side plates 7. In such a case, since a large insulation distance can be provided between the stationary contact 3 and the arc-extinguishing side plates 7 in the embodiment, no dielectric breakdown will occur and a cutoff performance can be improved.

FIG. 150 is a side view showing an electrode portion of a circuit breaker according to an alternative embodiment of the embodiment 66.

In the alternative embodiment, an inclined portion 7*f* is provided for the arc-extinguishing side plate 7 on the side of the stationary contact 3. This alternative embodiment is characterized by a distance between the stationary contact 3 and the lower end of the arc-extinguishing side plate 7, which becomes broader toward the side of the terminal 5.

Since the arc A moves toward the side of the terminal 5 by electromagnetic force generated by the fixed contact 4, the arc-extinguishing side plates 7 on the side of the terminal 5 are more badly damaged by the arc A. Therefore, degradation can more easily occur in the dielectric strength on the surfaces of the arc-extinguishing side plates 7 on the side of the terminal 5.

According to the configuration of the alternative embodiment, it is possible to make full use of an arc cooling effect or a sectional area limiting effect by the arc-extinguishing side plates 7 because the lower ends of the arc-extinguishing side plates 7 are provided so as to be closer to a top of the stationary contact 3 at a portion of the arc-extinguishing side plates 7 having a less degraded surface. Further, lower ends of the arc-extinguishing side plates 7 are provided sufficiently higher than the stationary contact 3 so as to provide a large insulation distance at a portion of the arc-extinguishing side plates 7 having badly degraded surface. As a result, it is possible to improve a current-limiting performance and a cutoff performance.

Embodiment 67

FIG. 151 is a side view showing an electrode portion of a circuit breaker according to the embodiment 67, and FIG. 152 is a sectional view taken along line 152—152 of FIG. 151(*a*).

In the embodiment 67, a distance between the right and left arc-extinguishing side plates 7 (hereafter referred to as width) on the side of the terminal 5 is different from that on the side opposed to the terminal 5.

That is, a portion opposed to a locus of the traveling contact 2 at a time of opening action is defined as a narrow width portion 70*a*, and a portion on the side of the terminal 5 with respect to the narrow width portion 70*a* is defined as a wide width portion 70*b* between the right and left arc-extinguishing side plates 7 as shown in FIG. 152. Further, the arc-extinguishing side plates 7 are provided so as to hold L<M in case L is a width dimension of the narrow width portion 70*a*, and M is a width dimension of the wide width portion 70*b*.

When the arc-extinguishing side plates 7 are provided as set forth above, small current arc A generated between the contacts 2 and 3 immediately after opening is easily affected by the arc-extinguishing side plates 7 before the arc A becomes large current. Because the small current arc A is positioned in a narrow width space which is interposed between the narrow width portions 70*a* of the arc-extinguishing side plates 7. It is possible to provide more rapid rising of arc voltage by strong arc driving magnetic field generated by the fixed contact 4 in addition to the above effect of the arc-extinguishing side plates 7.

Subsequently, when the moving contact 1 is further opened, the arc A below the first conductor portion 4*a* of the fixed contact 4 is driven by strong arc driving magnetic field further generated by the fixed contact 4 in addition to the pressure Fp in a space interposed between the arc-extinguishing side plates 7 on both sides to a space which is interposed between the wide width portions 70*b* of the arc-extinguishing side plates 7. Once the arc A enters the space between the wide width portions 70*b* of the arc-extinguishing side plates 7, the arc A is difficult to return to the space of the narrow width portion 70*a* from the wide width portion 70*b*. As a result, it is possible to facilitate stretch of the arc A, and generate and maintain high arc voltage because of easy retention of the stretched condition.

When the arc A is positioned in a space between the wide width portions 7*b* of the arc-extinguishing side plates 7 in a space below the first conductor portion 4*a*, the space is wide so as to reduce a rise of pressure, and provide a large distance from the arc A to the wide width portion 70*b* of the arc-extinguishing side plate 7. Accordingly, surfaces of the wide width portions 70*b* of the arc-extinguishing side plates 7 are less damaged by exposure to the arc A. As a result, it is possible to provide a relaxed condition such as mechanical strength or arc resistance required for the arc-extinguishing side plates 7.

FIG. 153 is a side view of an electrode portion of a circuit breaker according to an alternative embodiment of the embodiment 67, and FIG. 154 is a plan view of FIG. 153. In the alternative embodiment, a height of the arc-extinguishing side plate 7 according to the embodiment 67 is provided so as not to exceed a height of the first conductor portion 4*a* of the fixed contact 4, resulting in the same effect as that in the embodiment 67.

Embodiment 68

FIG. 155 is a side view showing an electrode portion of a circuit breaker according to the embodiment 68, and FIG. 156 is a sectional view taken along line 156—156 of FIG. 155.

In the embodiment 68, there is provided a relationship reverse to that in the embodiment 67 between the narrow width portions 70*a* of the arc-extinguishing side plates 7 and the wide width portions 70*b*.

That is, as shown in FIG. 156, a portion of the arc-extinguishing side plate 7 opposed to a locus of the traveling contact 2 at a time of opening action is defined as a wide width portion 70*b*, and a portion of the arc-extinguishing side plate 7 on the side of the terminal 5 with respect to the wide width portion 70*b* is defined as a narrow width portion 70*a*.

In such a configuration, strong arc driving magnetic field Fm which is generated by the fixed contact 4 is applied to the arc A in a space below the first conductor portion 4*a* of the fixed contact 4. Hence, the arc A generated between the contacts 2 and 3 is positioned in a wide width space between the wide width portions 70*b* of the arc-extinguishing side plates, and is forced into a narrow width space which is interposed between the narrow width portions 70*a* of the arc-extinguishing side plates 7.

It is generally difficult to hold the arc in the narrow width space since pressure in the narrow width space increases.

However, it is possible to force the arc A into the narrow width space between the narrow width portions 70*a* of the arc-extinguishing side plates 7 by providing extremely large arc driving magnetic field Fm as in the present invention. The arc A forced into the narrow width space as described before is further largely affected by the arc-extinguishing side plates 7 so as to generate high arc voltage.

FIG. 157 is a side view showing an electrode portion of a circuit breaker according to an alternative embodiment of the embodiment 68, and FIG. 158 is a plan view of FIG. 157.

In the alternative embodiment, a height of the arc-extinguishing side plate 7 is provided so as not to exceed a height of the first conductor portion 4*a* of the fixed contact 4. As shown in FIG. 158, the arc-extinguishing side plates 7 are integrally provided, and a laid convex notch 70 is provided in the arc-extinguishing side plate 7 so as to continuously form the wide width portions 70*b* and the narrow width portions 70*a* through the notch 70. In this case, it is also possible to provide the same effect.

FIG. 159 is a plan view of a fixed contact including an arc-extinguishing side plate according to another alternative embodiment of the embodiment 68. In the alternative embodiment, the narrow width portion 70*a* of the arc-extinguishing side plate 7 shown in FIG. 158 is provided in a V-shaped form having an acute portion which is gradually formed toward the side of the terminal 5, resulting in the same effect as that in the embodiment 68.

FIG. 160 is a plan view of a fixed contact including an arc-extinguishing side plate according to still another alternative embodiment of the embodiment 68. In the alternative embodiment, the narrow width portion 70a of the arc-extinguishing side plate 7 is provided so as to have a width which gradually becomes wider toward the side of the terminal 5 in contrast with the case in the embodiment 159, resulting in the same effect.

FIG. 161(*a*) is a side view showing an electrode portion of a circuit breaker according to a still further alternative embodiment of the embodiment 68. FIG. 161(*b*) is a sectional view taken along line 161*b*—161*b* FIG. 161(*a*), and FIG. 161(*c*) is a plan view of FIG. 161(*a*).

In the alternative embodiment, the narrow width portion 70*a* is provided in an upper portion of the arc-extinguishing side plate 7 on the side of the terminal 5, resulting in the same effect.

Inorganic or organic insulator may be employed as the arc-extinguishing side plate 7 and the insulator 15 of the present invention. The inorganic insulator may be used so as to reduce damage to a surface which is exposed to the arc. On the other hand, the organic insulator may be used so as to discharge a great amount of cracked gas from the surface exposed to the arc, resulting in extremely enhanced arc cooling effect. The organic insulator of melamine/phenolic family can discharge a great amount of arc-extinguishing gas, and no degradation of dielectric strength occurs on a surface of the organic insulator. Therefore, in case the arc-extinguishing side plate 7 or the insulator 15 is made of organic material of melamine/phenolic family, it is possible to further improve a current-limiting performance and a cutoff performance.

Embodiment 69

A description will now be given of the embodiment 69 of the present invention with reference to the drawings. FIG. 162 is a side view of an arc-extinguishing portion, showing a closing condition of a circuit breaker serving as a switch according to the embodiment 69 with a housing broken away. FIG. 163 is a side view showing an opening condition of the circuit breaker of FIG. 162.

A configuration in the embodiment is identical with that in the above embodiments except a related configuration between the moving contact 1 and the fixed contact 4 as will be described later, and the description thereof is omitted.

The fixed contact 4 is mounted and set to the housing 12 such that the third conductor portion 4*d* is positioned on a side of the other end of the moving contact 1 to which the traveling contact 2 is not secured with respect to the stationary contact 3 and on the side opposed to the terminal 5 (i.e., on the side of the rotation supporting point 14 of the moving contact 1). In this case, the first conductor portion 4*a* is arranged such that the entire first conductor portion 4*a* is positioned above a contact surface of the contacts at a contact closing time when the traveling contact 2 contacts the stationary contact 3, and is positioned below the contact surface of the traveling contact 2 at a contact opening time.

The terminal 5 connected to the fixed contact 4 is positioned above a contact surface of the stationary contact 3.

The second conductor portion 4*e* of the fixed contact 4 to which the stationary contact 3 is secured is connected to the terminal 5 through the first conductor portion 4*a* and the third conductor portion 4*d*. The entire first conductor portion 4*a* is positioned above the contact surface of the stationary contact 3, and the third conductor portion 4*d* is connected to the first conductor portion 4*a* on the side of the rotation supporting point 14 with respect to a position of the stationary contact 3.

In FIG. 162, reference numeral 16 means an arc-extinguishing plate, and the arc-extinguishing plate 16 is positioned below the first conductor portion 4*a*. A notch 16*a* (see FIG. 170) is provided in the arc-extinguishing plate 16 so as not to prevent rotation of the moving contact 1 and a switching action of the traveling contact 2 to the stationary contact 3.

As is obvious from FIG. 170, the notch 16*a* of the arc-extinguishing plate 16 may be provided in various forms.

Further, a notch (not shown) is provided in the arc-extinguishing plate 6 so as not to prevent the rotation of the moving contact 1. Though the mechanism portion 8, the handle 9 and the terminal 10 on the side of the load in the prior circuit breaker which are shown in FIG. 1 are omitted in FIGS. 162 and 163, these component parts are naturally contained and arranged in the housing 12.

FIGS. 164(*a*) and (*b*) are perspective views showing a fixed contact according to the embodiment 69.

The fixed contact 4 shown in FIG. 164(*a*) is integrally provided in a substantially U-shaped form including the first conductor portion 4*a*, the second conductor portion 4*e* and the third conductor portion 4*d*. The terminal 5 on the side of the power source is connected to one end of the U-shaped form, that is, an end of the first conductor portion 4*a* on the side connected to the power source. Further, the stationary contact 3 is secured to the inside of the U-shaped form serving as the opposite side end, that is, an upper surface portion of the second conductor portion 4*e*. Moreover, in the fixed contact 4, a slit 40 is provided in a connecting conductor portion (i.e., the first conductor portion 4*a* and the-third conductor portion 4*d*) positioned above a secured surface of the stationary contact 3 so as not to prevent a switching action of the moving contact 1 to the stationary contact 3 on the second conductor portion 4*e*.

In FIG. 164(*b*), reference numeral 15 means an insulator, and a surface of the fixed contact 4 and an inner surface of the slit 40 are coated with the insulator 15 in an area from a vicinity of a connecting portion of the first conductor portion 4*a* and the terminal 5 to the third conductor portion 4*d*.

A description will now be given of the operation.

As in the prior art, if large current such as short-circuit current flows, the moving contact 1 rotates to open the traveling contact 2 and the stationary contact 3 before the operation of the mechanism portion, and the arc A forms between the contacts 2 and 3.

FIG. 165 shows a condition immediately after opening between the contacts 2 and 3. In FIG. 165, the arrow means current, and the arc-extinguishing plates 6 and 16 are omitted for the sake of simplicity.

FIG. 166 is an explanatory view of the operation, showing the maximum opening condition of the moving contact 1 of the circuit breaker shown in FIG. 162.

An entire current path including an area from the terminal 5 to the first conductor portion 4*a* is positioned above the arc A. As a result, electromagnetic force applied to the arc A which is generated by the current path can serve as force to stretch the arc A on the side of the terminal 5. Further, current in the third conductor portion 4*d* has a direction perpendicular to that of current in the moving contact 1, and the current in the third conductor portion 4*d* of the fixed contact 4 has a direction opposed to that of the current of the arc A. Consequently, electromagnetic force generated by the current in the third conductor portion 4*d* can also serve as the force to stretch the arc on the side of the terminal 5.

Therefore, the entire electromagnetic force generated by current in the fixed contact 4 can serve as the force to stretch the arc A on the side of the terminal 5. As a result, the arc A is strongly stretched and cooled by the arc-extinguishing plate 16 immediately after the contact opening so as to rapidly increase arc resistance.

FIG. 167(*a*) is a side view of a moving contact and a fixed contact, illustrating intensity distribution of magnetic field which is generated by the current in the fixed contact. FIG. 167(*b*) is a sectional view taken along line 167*b*—167*b* of FIG. 167(*a*).

In FIG. 167(*b*), reference numeral 41 means the center of gravity of respective sections of the first conductor portions 4*a* on both sides of the slit 40.

FIG. 167(*c*) shows the intensity distribution of the magnetic field on the Z-axis of FIG. 167(*b*), which is generated by the current in the fixed contact 4, and the intensity distribution of the magnetic field is found by a theoretical calculation. In FIG. 167(*c*), a magnetic field in a positive direction is a magnetic field component to stretch the arc on the side of the terminal 5 (hereafter referred to as arc driving magnetic field).

As shown in FIG. 167(*b*), the first conductor portions 4*a* are positioned at positions laterally offset from a plane in which the moving contact 1 is rotated.

In such a conductor arrangement, there is a magnetic field component to stretch the arc A on the side of the terminal 5 even in a space (area Z0) above the first conductor portion 4*a* due to an effect caused by the current in the second conductor portion 4*e* and the third conductor portion 4*d*. Accordingly, as shown in FIG. 166, even if a traveling contact surface is rotated up to a position above the first conductor portion 4*a*, force is applied to the arc A on the side of the terminal 5 in the slit 40 of the first conductor portion 4*a*, and is pressed onto an insulator 15*a* covering an inner portion of the slit 40 (i.e., an inner surface of an end of the slit 40 on the side of the terminal 5) so as to be cooled. As a result, the arc resistance rapidly increasing immediately after the contact opening is further increased so as to maintain high arc voltage. Thus, it is possible to provide a circuit breaker which can reduce current peak and running energy, and has an excellent current-limiting performance.

Embodiment 70

In FIG. 162, in case the arc-extinguishing plate 16 is made of magnetic material, it is possible to reinforce the driving magnetic field to the arc immediately after the contact opening at a time of current cutoff in an area having rated current or excess current, that is, an area having small current value in the fixed contact 4 and small magnetic field generated by the current. Further, it is possible to provide an excellent cutoff performance to a wide range of current.

Embodiment 71

In FIG. 162, in case the arc-extinguishing plate 16 is made of non-magnetic material, it is possible to drive and cool the arc without disturbing the arc driving magnetic field below the first conductor portion 4*a*. In particular, in case the arc-extinguishing plate 16 is made of non-magnetic metal, it is possible to further effectively cool the arc, and provide high arc voltage.

Embodiment 72

In FIG. 162, in case one or more arc-extinguishing plates 16 are made of the insulator and disposed as shown in FIG. 168, the arc A stretched immediately after the contact opening can be forcedly pressed in a wave form. Further, it is possible to extend the arc, and provide high arc voltage.

In the embodiments 69 to 72, the arc-extinguishing plate 16 may be a rod type plate as shown in FIGS. 171 (*a*) and (*b*). In this case, the arc-extinguishing plate 16 must be disposed so as not to prevent the rotation of the moving contact 1 and the switching action between the contacts 2 and 3 as described before, resulting in the same effects as those in the embodiments 69 to 72.

Instead of the second conductor portion 4*e* to which the stationary contact 3 is secured in the fixed contact 4 as shown in the embodiments 69 to 72, the second conductor portion 4*e* as shown in FIG. 169 may extend in a direction of a rotation contact such that the current in the second conductor portion 4*e* can be substantially antiparallel to the current in the moving contact 1 at the closing time. In such a way, the electromagnetic force generated by the second conductor portion 4*e* to stretch the arc A on the side of the terminal 5 can be increased, and magnetic repulsion is applied between the moving contact 1 and the second conductor portion 4*e* of the fixed contact 4 at the closing time. Thus, a rotation speed of the moving contact 1 is increased so as to rapidly increase the arc immediately after the contact opening. As a result, it is possible to provide more rapid rising of arc resistance, and an improved current-limiting performance.

Though the descriptions have been given with reference to a circuit breaker in the above embodiments 69 to 72, another switch may be applied so as to provide the same effects as those in the embodiments 69 to 72.

Embodiment 73

A description will now be given of the embodiment 73 of the present invention with reference to the drawings. FIG. 172 is a side view of an arc-extinguishing portion, showing a closing condition of a circuit breaker serving as a switch according to the embodiment 73 with a housing broken away. FIG. 173 is a side view showing an opening condition of the circuit breaker of FIG. 172.

In FIGS. 172 and 173, reference numeral 4 means a fixed contact including the first conductor portion 4*a*, the second conductor portion 4*e*, and the third conductor portion 4*d*, and is provided with the stationary contact 3 on the second conductor portion 4*e*.

Specifically, in a contact closing condition of FIG. 172, if the traveling contact 2 of the moving contact 1 is upward opened from the stationary contact 3, the fixed contact 4 is integrally provided in a form including the first conductor portion 4*a* connected to the terminal 5 on the side of the power source so as to horizontally extend, the second conductor portion 4*e* downward spaced at an interval from the first conductor portion 4*a* to extend parallel to the first conductor portion 4*a*, and the third conductor portion 4*d* vertically connecting the second conductor portion 4*e* with the first conductor portion 4*a* on the side opposed to the terminal 5. Further, the stationary contact 3 is secured to the second conductor portion 4*e* so as to be positioned under the first conductor portion 4*a*.

The fixed contact 4 is mounted and set to the housing 12 such that the third conductor portion 4*d* is positioned on a side of the other end of the moving contact 1 to which the traveling contact 2 is not secured with respect to the stationary contact 3 and on the side opposed to the terminal 5 (i.e., on the side of the rotation supporting point 14 of the moving contact 1). In this case, the entire first conductor portion 4*a* is positioned above a contact surface of the contacts at a contact closing time when the traveling contact 2 contacts the stationary contact 3, and is positioned above the moving contact 1 even at a contact opening time.

A further detailed description will now be given of the related configuration between the moving contact 1 and the fixed contact 4.

The fixed contact 4 is integrally provided in a substantially U-shaped form including the first conductor portion 4*a*, the second conductor portion 4*e* and the third conductor portion 4*d*. The terminal 5 on the side of the power source is connected to one end of the U-shaped form, that is, an end of the first conductor portion 4*a* on the side connected to the power source. Further, the stationary contact 3 is secured to the inside of the U-shaped form serving as the opposite side end, that is, an upper surface portion of the second conductor portion 4*e*.

FIG. 174(*a*) is a plan view of the fixed contact shown in FIGS. 172 and 173, FIG. 174(*b*) is a front view of FIG. 174(*a*), and FIG. 176 is a perspective view of the fixed contact.

Moreover, in the fixed contact 4, a slit 40 is provided in a connecting conductor portion (i.e., the first conductor portion 4*a* and the third conductor portion 4*d*) positioned above a secured surface of the stationary contact 3 so as to allow a switching action of the moving contact 1.

In a range of height of the third conductor portion 4*d* of the fixed contact 4, the rotating center 14 of the moving contact 1 is disposed at an external position opposed to the slit 40 in the third conductor portion 4*d*. Thereby, the moving contact 1 can rotate through the slit 40 in contact switching directions.

In an opening condition of the moving contact 1 shown in FIG. 173, the first conductor portion 4*a* of the fixed contact 4 is positioned below a contact surface of the traveling contact 2. Portions of the first conductor portion 4*a* which can be surveyed from the surface of the traveling contact 2 other than the above portions are coated with the insulator 15.

The insulator 15 continuously includes an insulator 15*a* covering the upper surface of the first conductor portion 4*a*, an insulator 15*b* covering an inner end surface of the slit 40 on the side of the terminal 5, and the insulator 15*c* covering inner surfaces on both sides of the slit 40 (i.e., surfaces opposed to a plane including a locus of the moving contact 1).

As shown in FIGS. 172 and 173, a plurality of magnetic material plates 16 are vertically disposed parallel to each other at appropriate intervals in a space above the first conductor portion 4*a* of the fixed contact 4.

FIG. 175 is a plan view of the magnetic material plates in FIGS. 172 and 173.

The magnetic material plate 16 includes a flat plate which is provided with a substantially U-shaped notched space 160 so as to allow the switching action of the moving contact 1. More specifically, the magnetic material plate 16 includes two arm portions 16*a* between which the notched space 160 is interposed, and a connecting portion 16b integrally connecting the arm portions 16*a* on the side of the terminal 5 of the fixed contact 4.

In FIGS. 172 and 173, the mechanism portion 8, the handle 9 and the like shown in FIG. 1 are omitted, but are naturally provided in the embodiment.

A description will now be given of the operation.

As in the prior art, if large current such as short-circuit current flows in the contact closing condition as shown in FIG. 172, the moving contact 1 rotates to open the traveling contact 2 and the stationary contact 3 before the operation of the mechanism portion, and the arc A forms between the contacts 2 and 3.

FIG. 177 shows a condition immediately after the traveling contact 2 is opened from the stationary contact 3 due to electromagnetic repulsion. In this condition, the contact surface of the traveling contact 2 is still positioned below the first conductor portion 4*a*. In FIG. 177, the arrow means current.

In such a condition immediately after the contact opening, strong electromagnetic force is applied to the moving contact 1 in a rotating direction thereof. This is because an entire current path including an area from the terminal 5 on the side of the power source to the first conductor portion 4*a* of the fixed contact 4 is positioned above the arc A. As a result, electromagnetic force applied to the arc A which is generated by the current path can serve as force to stretch the arc A on the side of the terminal 5. At this time, current in the third conductor portion 4*d* of the fixed contact 4 has a direction opposed to that of the current of the arc A. Accordingly, electromagnetic force generated by the current in the third conductor portion 4*d* of the fixed contact 4 can also serve as the force to stretch the arc on the side of the terminal 5. Further, the current in the second conductor portion 4*e* of the fixed contact 4 can also generate the electromagnetic force to stretch the arc on the side of the terminal 5.

Therefore, the entire electromagnetic force generated by current in the fixed contact 4 can serve as force Fm to stretch the arc A on the side of the terminal 5. As a result, an extremely strong arc driving magnetic field can be provided so that the arc A can be stretched on the side of the terminal 5 to rapidly increase the arc voltage.

FIG. 178 shows the maximum opening condition of the moving contact 1 without the arc A forming between the contacts 2 and 3.

In this condition, the current in the entire conductor portion of the fixed contact 4 generates magnetic field serving as magnetic field to stretch the arc A in the direction of the terminal 5 in a space below the first conductor portion 4*a*. In the following discussion, the magnetic field in the direction of the terminal 5 will be referred to as driving magnetic field, and another magnetic field in the opposite direction, that is, magnetic field to drive the arc A on the side of the rotating center 14 of the moving contact 1 will be referred to as inverse driving magnetic field.

FIG. 179 is a sectional view taken along line, 179—179 of FIG. 178 without the magnetic material plate 16. In FIG. 179, B means magnetic field generated by the first conductor portion 4*a*, and I means arc current flowing from the stationary contact 3 to the traveling contact 2

As is obvious from FIG. 179, it can be seen that the magnetic field B serves as the inverse driving magnetic field in a space above the first conductor portion 4*a* while the magnetic field B generated by the current in the first conductor portion 4*a* can surely serve as the driving magnetic field in a space below the first conductor portion 4*a*.

FIG. 180 is a normal sectional view taken along line 179—179 of FIG. 178, showing a condition where the magnetic material plate 16 is disposed in FIG. 179. In FIG. 180, only one magnetic material plate 16 is shown for the sake of simplicity. In this case, though there are fluctuations in distribution of the magnetic field generated by the current in the first conductor portion 4*a* in the space below the first conductor portion 4*a*, the magnetic field can serve as driving magnetic field.

On the other hand, the magnetic field B generated by the current in the first conductor portion 4*a* is absorbed into the magnetic material plate 16 in the space above the first conductor portion 4*a*. Hence, there appears no inverse driving magnetic field in the notched space 160 between the arm portions 16*a* of the magnetic material plate 16, which is shown in a perspective view of FIG. 181.

In FIG. 181, the arrow means magnetic field generated by the current in the first conductor portion 4*a*, Bo means magnetic field in a space, and Bi is magnetic field in the magnetic material plate 16.

The magnetic field Bo generated by the current below the first conductor portion 4*a* exists in a space so as to exert the electromagnetic force in the direction of the terminal 5 on the arc in the space. Since the magnetic field Bo above the first conductor portion 4*a* tends to pass through an inside of the magnetic material plate 16 having low magnetic reluctance, the magnetic field enters one arm portion 16*a* of the magnetic material plate 16 to pass through the connecting portion 16*b*, and exits from the other arm portion 16*a*.

Thus, there is no inverse driving magnetic field in the notched space 160 between the arm portions 16*a* of the magnetic material plate 16. Consequently, no inverse electromagnetic force is applied to the arc in the notched space 160.

FIG. 182 is a plan view showing a condition where the inverse driving magnetic field in the space above the first conductor portion 4*a* is completely absorbed by the magnetic material plate 16.

In case the inverse driving magnetic field is completely absorbed by the magnetic material plate 16 as set forth above, no inverse electromagnetic force is applied to the arc above the first conductor portion 4*a*.

However, the magnetic field generated by the current also increases more as the current in the first conductor portion 4*a* increases more so that the magnetic material plate 16 can not absorb the inverse driving magnetic field. That is, the magnetic material plate 16 is magnetically saturated.

The entire magnetic field in the magnetic material plate 16 passes through the other arm portion 16*a* after the connecting portion 16*b*. Accordingly, magnetic flux density in the magnetic material plate 16 becomes larger as the magnetic field comes closer to the connecting portion 16*b*.

Therefore, the magnetic material plate 16 is magnetically saturated in order of a portion close to the connecting portion 16*b* connecting the arm portions 16*a*. As a result, the inverse driving magnetic field leaks due to the magnetic saturation of the magnetic material plate 16 into a space of the notched space 160 between the arm portions 16*a*, which is proximate to the connecting portion 16*b*, that is, into a space on the side proximate to the terminal 5 with respect to the stationary contact 3 as shown in FIG. 183.

Hence, leaked inverse driving magnetic field does not have so large effect on the arc between the traveling contact 2 and the stationary contact 3.

FIG. 184 is a side view showing a condition where a plurality of magnetic material plates are disposed in a space above a fixed contact.

In case the plurality of magnetic material plates 16-1 to 16-3 are disposed as shown in FIG. 184, the magnetic material plate 16-1 proximate to the first conductor portion 4*a* is first saturated when the current in the first conductor portion 4*a* increases. However, the inverse driving magnetic field leaked from the magnetic material plate 16-1 can be absorbed by the magnetic material plate 16-2 positioned immediately above the magnetic material plate 16-1. Hence, no inverse driving magnetic field appears in the notched space 160 including the arc. Even if the magnetic material plate 16-2 is magnetically saturated due to further increased current, the inverse driving magnetic field can be absorbed by the magnetic material plate 16-3 positioned immediately over the magnetic material plate 16-2. Therefore, if the plurality of magnetic material plates 16-1 to 16-3 are disposed as set forth above, it is possible to further completely absorb the inverse driving magnetic field in the space above the first conductor portion 4*a*.

As described referring to FIG. 177, the electromagnetic force Fm is generated by strong arc driving magnetic field, and is applied to the arc A which is positioned below the first conductor portion 4*a* of the fixed contact 4. There is another arc driving magnetic field in the slit 40 of the first conductor portion 4*a* as described in the following.

FIG. 185 is a sectional view of the fixed contact, taken along line 179—179 of FIG. 178. In FIG. 185, reference numeral 41 means the centers of gravity of respective sections of the right and left first conductor portions 4*a* on both sides of the slit 40, and the center of gravity of the second conductor portion 4*e*.

FIG. 186 shows the intensity distribution of the magnetic field on the Z-axis of FIG. 185, which is generated by the current in the fixed contact 4, and the intensity distribution of the magnetic field is found by a theoretical calculation. In FIG. 186, magnetic field in a positive direction is a magnetic field component (driving magnetic field) to stretch the arc A on the side of the terminal 5.

As shown in FIG. 185, the first conductor portions 4*a* are positioned at positions laterally offset from a plane in which the moving contact 1 is rotated.

In the conductor arrangement, as shown in FIG. 186, there is the arc driving magnetic field to stretch the arc A up to a space area Z0 above the first conductor portion 4*a* on the side of the terminal 5 due to an effect caused by the current in the second conductor portion 4*e* and the third conductor portion 4*d*.

Accordingly, there is no inverse driving magnetic field in the space above the first conductor portion 4*a*, and a strong electromagnetic force is applied to the arc A on the side of the terminal 5 in a range from the stationary contact 3 to a certain upper side of the first conductor portion 4*a*. Hence, the arc A is pressed for cooling onto the insulator 15*b* covering the inner end surface of the slit 40 of the fixed contact 4 on the side of the terminal 5 or the magnetic material plates 16 in the maximum opening condition of the moving contact 1 as shown in FIG. 187. As a result, the arc resistance rapidly increasing immediately after the contact opening is further increased so as to maintain high arc voltage. Thus, it is possible to provide a circuit breaker having an excellent current-limiting performance.

FIGS. 188(*a*) to (*d*) are plan views showing alternative embodiments of the magnetic material plate having each different plane configuration.

As shown in FIGS. 188 (*a*) to (*d*), it is possible to variously modify the plane configuration of the magnetic material plate 16 in the embodiment 73 by, for example, varying a configuration of the notched space 160 of the magnetic material plate 16.

FIG. 189(*a*) is a plan view of the magnetic material plate according to another alternative embodiment, and FIG. 189(*b*) is a side view of FIG. 189(*a*).

In the magnetic material plate 16 according to the alternative embodiment, arm portions 16*a* are integrally formed with a connecting portion 16*b* in a step fashion so as to provide the thin arm portions 16*a* and the thick connecting portion 16*b*, resulting in the same effects.

FIG. 190(*a*) is a side view of a magnetic material plate according to still another alternative embodiment. In the magnetic material plate 16 according to the alternative embodiment, arm portions 16*a* are integrally formed with a connecting portion 16*b* so as to provide a thickness which gradually becomes more thick from a distal end of the arm portions 16*a* on both sides toward an end of the connecting portion 16*b*. FIG. 190(*b*) is a side view of a magnetic material plate according to a further alternative embodiment. According to the alternative embodiment, the magnetic material plate 16 is provided so as to provide the thick arm portions 16*a* on both sides and the thin connecting portion 16*b* in contrast with the case of FIG. 189. In either case, it is possible to provide the same effects.

FIG. 191 is a side view showing an electrode portion of a circuit breaker including a magnetic material plate according to a still further alternative embodiment of the embodiment 73.

In the alternative embodiment, thickness of the magnetic material plate 16 is decreased, the number of the magnetic material plates 16 is increased, and the magnetic material plates 16 are inclined parallel to each other with slits in a space above the first conductor portion 4*a* of the fixed contact 4. In this case, the same effects can be provided, and there is another effect in that the plurality of respective magnetic material plates 16 can also serve as arc-extinguishing plates.

In the above embodiments, the magnetic material plates 16 can easier absorb the inverse driving magnetic field if the magnetic material plates 16 is made of material having high magnetic permeability. That is, the magnetic material plates 16 may be made of iron as metallic material, or may be made of magnetic material of inorganic ferrite family.

Embodiment 74

FIG. 192 is a plan view of a fixed contact including a magnetic material plate according to the embodiment 74, and FIG. 193 is a side view with a moving contact in an opening condition added to FIG. 192.

In the embodiment 74, an inner edge 160*b* on the side of the stationary contact 3 of the connecting portion 16*b* in the magnetic material plate 16 is set to the side of the terminal 5 with respect to the insulator 15*b* covering the slit 40 of the fixed contact 4 in the direction of the terminal 5. In other words, a notched space 160 is elongatedly provided in the magnetic material plate 16 such that the depth closing end surface 160*b* is positioned on the side of the terminal 5 with respect to the insulator 15*b* in the plan view. Other structures are identical with those in the embodiment 73, and the same effects can be provided in the embodiment.

According to the embodiment 74, the arc A stretched by magnetic field in an opening condition in the direction of the terminal 5 can easily contact the insulator 15*b* without obstruction of the inner edge 160*b* of the connecting portion 16*b* in the magnetic material plate 16 as shown in FIG. 193. Therefore, the arc cooling effect can be improved.

Further, in large current arc such as short-circuit current, it has been known that a metallic vapor flow is ejected from a leg of the arc on a contact surface in a direction perpendicular to the contact surface because of vaporization of the contact, and the vapor flow is an essential constituent component of the arc A.

In the embodiment 74, as shown in FIG. 193, the metallic vapor flow is sprayed on the insulator 15, in particular, on an upper surface 15*a* so as to be forcedly cooled. As a result, arc voltage is further increased, and current-limiting performance can be improved.

Embodiment 75

FIG. 194 is a plan view of a fixed contact including a magnetic material plate according to the embodiment 75. FIG. 195 is a side view showing an electrode portion of a circuit breaker with a moving contact in an opening condition added to FIG. 194, and FIG. 196 is a sectional view taken along line 196—196 of FIG. 195.

In the embodiment 75, inside edges of arm portions 16*a* of the magnetic material plate 16 are positioned so as to be spaced from the stationary contact 3 further than the insulator 15*c* covering an inner surface of the slit 40 of the fixed contact 4. In other words, a notched space 160 is provided in the magnetic material plate 16 so as to have a wider width than that of the slit 40 of the fixed contact 4. Other structures are identical with those in the embodiment 74, and the same effects can be provided in the embodiment.

Further, according to the embodiment 75, the insulator 15*c* covering the inner surface of the slit 40 is positioned closer to the arc A than the inside edges of the arm portions 16*a* of the magnetic material plate 16. Accordingly, the arc A can easier contact the insulator 15*c* so as to be effectively cooled. As a result, it is possible to improve the current-limiting performance.

Embodiment 76

FIG. 197 is a plan view of a fixed contact including a magnetic material plate according to the embodiment 76. FIG. 198 is a side view showing an electrode portion of a circuit breaker with a moving contact in an opening condition added to FIG. 197, and FIG. 199 is a sectional view taken along line 199—199 of FIG. 198.

In the embodiment 76, inside edges of arm portions 16*a* of the magnetic material plate 16 is positioned so as to be closer to the stationary contact 3 than the insulator 15*c* covering an inner surface of the slit 40 of the fixed contact 4. In other words, a notched space 160 is provided in the magnetic material plate 16 so as to have a narrower width than that of the slit 40 of the fixed contact 4 in contrast with the embodiment 75. Other structures are identical with those in the embodiment 74, and it is possible to provide the same effects as those in the embodiment 74.

Further, according to the embodiment 76, the insulator 15*c* covering the inner surface of the slit 40 is spaced further from the arc A than the inside edges of the arm portions 16*a* of the magnetic material plate 16 as shown in FIG. 199. Accordingly, the arc A is difficult to contact the insulator 15*c* so that the insulator is hardly damaged by the arc. As a result, it is possible to employ materials having small arc resistanee, or thin materials as the insulator 15*c* covering the inner surface of the slit 40 of the fixed contact 4.

Embodiment 77

FIG. 200 is a plan view of a fixed contact including a magnetic material plate according to the embodiment 77. FIG. 201 is a side view showing an electrode portion of a circuit breaker with a moving contact in an opening condition added to FIG. 200.

In the embodiment 77, an inner edge 160*b* of a connecting portion 16*b* of the magnetic material plate 16 is positioned on the side of the stationary contact 3 with respect to the insulator 15*b* covering an inner end surface of the slit 40 of the fixed contact 4 in the direction of the terminal 5. In other words, a notched space 160 in the magnetic material plate 16 is provided in a reduced size on the side of the stationary contact 3 with respect to the insulator 15*b* of the fixed contact 4. Other structures are identical with those in the embodiment 76, and it is possible to provide the same effects as those in the embodiment 73.

Further, according to the embodiment 77, the arc A is stretched in the direction of the terminal 5 by magnetic field at the opening time, and is stopped by an edge of the magnetic material plate 16. Thus, the arc A is difficult to contact the insulator 15*b* so as to reduce damage to the insulator 15*b* by the arc A. On the other hand, the magnetic material plate 16 has a cooling effect on the arc A pressed onto the edge of the magnetic material plate 16. As a result, it is possible to provide a circuit breaker having reduced dielectric breakdown in the fixed contact 4, and an excellent current-limiting performance.

Embodiment 78

FIG. 202 is a plan view of a fixed contact including a magnetic material plate according to the embodiment 78. FIG. 203 is a side view showing an electrode portion of a circuit breaker at a time of large current cutoff with a moving contact in an opening condition added to FIG. 202. FIG. 204 is a side view showing the electrode portion of the circuit breaker at a time of small current cutoff.

In the embodiment 78, a narrow width slit 160*a* having a narrower width than that of a notched space 160 is provided by notching in a connecting portion 16*b* of the magnetic material plate 16 so as to be continuously formed with the notched space 160. Other structures are identical with those in the embodiment 77.

According to the embodiment 78, electromagnetic force is applied to the arc A at the opening time of the moving contact 1 so as to drive the arc A on the side of the terminal 5. However, since a diameter of the arc A increases at a time of the large current cutoff, the arc A never enters the narrow width slit 106*a* as shown in FIG. 203. Thus, in the embodiment 78, it is possible to provide the same effects as those in the embodiment 77.

As shown in FIG. 204, since the arc A has a small diameter at a time of the small current cutoff, the arc A enters the narrow width slit 160*a* so as to be largely stretched, and is effectively cooled by the insulator 15*b*. As a result, it is possible to improve the small current cutoff performance.

In the embodiment 78, the narrow width slit 160*a* is elongatedly provided such that a closing inner end of the narrow width slit 160*a* (on the right end in FIG. 202) is positioned on the side of the terminal 5 with respect to the insulator 15*b*. However, the narrow width slit 160*a* may be provided in a reduced size such that the closing inner end of the narrow width slit 160*a* is positioned on the side of the stationary contact 3 with respect to the insulator 15*b* as shown in FIG. 205, resulting in the same effects.

Embodiment 79

FIG. 206 is a plan view of a fixed contact including a magnetic material plate according to the embodiment 79. FIG. 207 is a side view showing an electrode portion of a circuit breaker with a moving contact in an opening condition added to FIG. 206, and FIG. 208 is a sectional view taken along line 208—208 of FIG. 207.

In the embodiment 79, inside edges of arm portions 16*a* of the magnetic material plate 16 are positioned so as to be spaced from the stationary contact 3 further than the insulator 15*c* covering an inner surface of the slit 40 of the fixed contact 4. In other words, a notched space 160 is provided in the magnetic material plate 16 so as to have a wider width than that of the slit 40 of the fixed contact 4 as in the case of the embodiment 75 described with reference to FIG. 194. However, the embodiment 79 is different from the embodiment 75 in that a notched space 160 is provided in a reduced size such that an inner edge 160*b* of the notched space 106 of the magnetic material plate 16 is positioned on the side of the stationary contact 3 with respect to the insulator 15*b* of the fixed contact 4. Other structures are identical with those in the embodiment 75, and the same effects can be provided in the embodiment 75.

Further, according to the embodiment 79, the insulator 15*c* covering the inner surface of the slit 40 is positioned closer to the arc A than the inside edges of the arm portions 16*a* of the magnetic material plate 16 as shown in FIG. 208. Accordingly, the arc A can easier contact the insulator 15*c* so as to be effectively cooled. As a result, it is possible to improve a current-limiting performance.

Embodiment 80

FIG. 209 is a plan view of a fixed contact including a magnetic material plate according to the embodiment 80.

In the embodiment 80, a narrow width slit 160*a* having a narrower width than that of a notched space 160 is provided by notching in a connecting portion 16*b* of the magnetic material plate 16 so as to be continuously formed with the notched space 160 as in the case of the embodiment 78 shown in FIG. 202. The embodiment 80 is different from the embodiment 78 in that the notched space 16 in the magnetic material plate 16 is provided so as to have a wider width than that of the slit 40 of the first conductor portion 4*a* of the fixed contact 4 such that inside surfaces of the notched space 160 is positioned externally with respect to the insulators 15*c* covering an inner surface of the slit 40. Other structures are identical with those in the embodiment 79.

According to the embodiment 80, the narrow width slit 160*a* has no effect on large current arc as set forth above, and it is possible to provide the same effects as those in the embodiment 79.

Further, in the embodiment 80, the arc enters the narrow width slit 160*a* so as to be largely stretched at a time of small current cutoff. As a result, it is possible to improve a small current cutoff performance.

Embodiment 81

FIG. 210 is a plan view of a fixed contact including a magnetic material plate according to the embodiment 81. FIG. 211 is a side view showing an electrode portion of a circuit breaker with a moving contact in an opening condition added to FIG. 210, and FIG. 212 is a sectional view taken along line 212—212 of FIG. 211.

In the embodiment 81, inside edges of arm portions 16*a* of the magnetic material plate 16 is positioned so as to be closer to the stationary contact 3 than the insulator 15*c* covering an inner surface of the slit 40 of the fixed contact 4. In other words, a notched space 160 is provided in the magnetic material plate 16 so as to have a narrower width than that of the slit 40 of the fixed contact 4 as in the case of the embodiment 76 described with reference to FIG. 197. The embodiment 81 is different from the embodiment 76 in that a notched space 160 is provided in a reduced size such that an inner edge 160*b* of the notched space 160 is positioned on the side of the stationary contact 3 with respect to the insulator 15*b* covering the slit 40 of the first conductor portion 4*a* of the fixed contact 4. Other structures are identical with those in the embodiment 76, and it is possible to provide the same effects as those in the embodiment 76.

Further, according to the embodiment 76, the insulator 15*c* covering an inner surface of the slit 40 is spaced further from the arc A than the inside edges of the arm portions 16*a* of the magnetic material plate 16 as shown in FIG. 212. Accordingly, the arc A is difficult to contact the insulator 15*c* so that the insulator is hardly damaged by the arc. As a result, it is possible to employ materials having small arc resistance, or thin materials as the insulator 15*c* covering the inner surface of the slit 40 of the fixed contact 4.

Embodiment 82

FIG. 213 is a plan view of a fixed contact including a magnetic material plate according to the embodiment 82 of the present invention.

In the embodiment 82, a narrow width slit 160*a* is provided in a connecting portion 16*b* of the magnetic material plate 16. Other structures are identical with those in the embodiment 81. The narrow width slit 160*a* has no effect on large current arc as set forth above, and it is possible in the embodiment 82 to provide the same effects as those in the embodiment 81. Further, in the embodiment 82, at a time of small current cutoff, the arc enters the narrow width slit 160*a* so as to be largely stretched. As a result, it is possible to improve a small current cutoff performance.

Embodiment 83

FIG. 214 is a plan view showing an electrode portion a circuit breaker including a magnetic material plate according to the embodiment 83 of the present invention.

In the embodiment 83, a plurality of magnetic material plates 16-1 to 16-2 are disposed in a space above the first conductor portion 4*a* of the fixed contact 4, and the magnetic material plates 16-1 proximate to the first conductor portion 4*a* is provided so as to be thicker than each magnetic material plates 16-2.

Other structures are identical with those in the embodiment 73, and it is possible to provide the same effects as those in the embodiment 73.

Further, according to embodiment 83, since the magnetic material plates 16-1 proximate to the first conductor portion 4*a* is thicker than the magnetic material plates 16-2, it is possible to further completely absorb inverse driving magnetic field generated by the current in the first conductor portion 4*a*.

As set forth above, when the magnetic material plate 16-1 proximate to the first conductor portion 4*a* can not absorb the inverse driving magnetic field due to magnetic saturation, the inverse driving magnetic field leaked from the magnetic material plate 16-1 can be absorbed by the magnetic material plates 16-2 positioned immediately above the magnetic material plate 16-1. However, in case a distance from the magnetic material plate 16-1 to the magnetic material plates 16-2 is large, the inverse driving magnetic field may leak into a space including the arc before the absorption.

Therefore, in the embodiment 83, the magnetic material plate 16-1 proximate to the first conductor portion 4*a* is provided in a thick form so that no magnetic saturation occurs so as to further completely eliminate the effect generated by the inverse driving magnetic field. As a result, it is possible to provide a circuit breaker having an excellent current-limiting performance.

FIG. 215 is a side view showing an electrode portion of a circuit breaker according to an alternative embodiment of the embodiment 83.

In the embodiment 83, a plurality of magnetic material plates 16-1 to 16-2 are disposed in a space above the first conductor portion 4*a* of the fixed contact 4, and the magnetic material plates 16-1 proximate to the first conductor portion 4*a* is provided so as to be thicker than each magnetic material plates 16-2.

Other structures are identical with those in the embodiment 73, and it is possible to provide the same effects as those in the embodiment 73.

In the alternative embodiment, a plurality of magnetic material plates 16 are disposed in the space above the first conductor portion 4*a* of the fixed contact 4 at each interval which is provided to become narrower in a direction closer to the first conductor portion 4*a*. It is possible to provide the same effects as those in the embodiment 83.

FIG. 216(*a*) is a side view showing an electrode portion of a circuit breaker according to another alternative embodiment of the embodiment 83, and FIG. 216(*b*) is a sectional view taken along line 216—216 of FIG. 216(*a*).

In the alternative embodiment, notched spaces 160 are provided in the plurality of magnetic material plates 16 disposed in the space above the first conductor portion 4*a* such that the notched space 160 of magnetic material plates 16 has a width which becomes narrower in a the direction of the first conductor portion 4*a* as shown in FIG. 216(*b*). It is possible to provide the same effects as those in the embodiment 83.

Embodiment 84

FIG. 217 is a side view showing a related configuration between a fixed contact, a moving contact and a magnetic material plate in a circuit breaker according to the embodiment 84, and FIG. 218 is a side view showing a condition where the moving contact in FIG. 217 is in the course of opening.

In the embodiment 84, an angle θ1 of a plane S is larger than an angle θ2 of the magnetic material plate 16. The plane S is parallel to a plane including a flow line of the current in the third conductor portion 4*d* at an opening time and perpendicular to a plane including a locus of the moving contact 1 at a switching time. Other structures are identical with those in the embodiment 73, and it is possible to provide the same effects as those in the embodiment 73.

In case the above conditions are satisfied at the opening time of the moving contact 1, there is a point where the moving contact 1 intersects the arm portions 16*a* of the magnetic material plate 16 in the course of opening of moving contact 1 as shown in FIG. 218. The point of intersection is enlarged in FIG. 219(*a*).

FIG. 219(*a*) is a side view showing an intersecting condition between the moving contact and the arm portion of the magnetic material plate, and FIG. 219(*b*) is a plan view of FIG. 219(*a*).

In FIG. 219(*a*), I means current in the moving contact 1, and Iv is a current component of the current perpendicular to a surface of the magnetic material plate 16. FIG. 219(*b*) shows a relationship between the current component Iv and the magnetic material plate 16.

In a condition as shown in FIG. 219(*b*), it is well known that magnetic field B generated by the current component Iv per se is distorted by the magnetic material plate 16, and force F is applied to the current component Iv in an inner direction of the notched space 160 of magnetic material plates 16. Though the force F is parallel to the magnetic material plate 16 as shown in FIG. 219(*a*), a component Fv of the force F perpendicular to the moving contact 1 can serve as force in a direction to open the moving contact 1.

Therefore, in the embodiment 84, it is possible to improve an opening speed of the moving contact 1 after the moving contact 1 rises above the first conductor portion 4*a*, and further enhance a current-limiting performance.

Embodiment 85

FIG. 220 is a side view showing an electrode portion of a circuit breaker including a magnetic material plate according to the embodiment 85. FIG. 221 is a sectional view taken along line 221—221 of FIG. 220, and FIG. 222 is a sectional view taken along line 222—222 FIG. 220. In FIG. 221, a moving contact shown in FIG. 220 is omitted.

In the embodiment 85, the magnetic material plates 16 are held by flat supports 161 on both sides. That is, engaging projections 16*c* are integrally provided for both sides of the magnetic material plate 16 while the supports 161 are provided with engaging holes 162 into which the engaging projections 16*c* can be fitted. The magnetic material plates 16 can be held by the supports 161 by the engaging projections 16*c* fitted into the engaging holes 162. In this case, the engaging projections 16*c* of the magnetic material plate 16 are fitted into the engaging holes 162 of the support 161 so as not to project from the engaging holes 162. In such a configuration, it is possible to provide the same effects as those in the embodiment 73.

When the magnetic material plates 16 are held by the supports 161 as set forth above, the engaging projection 16*c* is positioned close to the first conductor portion 4*a* of the fixed contact 4 as shown in FIG. 222.

In an electrode structure according to the present invention, it is possible to generate extremely high arc voltage at a time of current cutoff. Consequently, hot gas is generated by arc at a time of large current cutoff and the electrode structure is filled with the hot gas in case the magnetic material plate 16 is made of metal such as iron. Therefore, there is a risk of dielectric breakdown between the engaging projection 16*c* and the first conductor portion 4*a*.

However, according to the embodiment 85, the engaging projection 16*c* is retracted in the engaging hole 162 while the engaging projection 16*c* is positioned close to the first conductor portion 4*a*. Thus, it is possible to avoid the dielectric breakdown between the engaging projections 16*c* of the magnetic material plate 16 and the first conductor portion 4*a* of the fixed contact 4.

Though the embodiments 73 to 85 have been described with reference to the circuit breaker, the present invention may be applied to another switch in order to provide the same effects as those in the embodiments 73 to 85.

Embodiment 86

A description will now be given of one embodiment of the present invention with reference to the drawings. FIG. 223 is a side view showing a closing condition of a circuit breaker according to the embodiment 86, and FIG. 224 is a side view showing an opening condition of the circuit breaker of FIG. 223.

A configuration in the embodiment is identical with that in the respective embodiments except a related configuration between the moving contact 1 and the fixed contact 4, and the description thereof is omitted.

The fixed contact 4 is mounted and set to the housing 12 such that the third conductor portion 4*d* is positioned on a side of the other end of the moving contact 1 to which the traveling contact 2 is not secured with respect to the stationary contact 3 and on the side opposed to the terminal 5 (i.e., on the side of a rotating center 14 of the moving contact 1). In this case, the first conductor portion 4*a* is arranged such that the entire first conductor portion 4*a* is positioned above a contact surface of the contacts at a contact closing time when the traveling contact 2 contacts the stationary contact 3, and is positioned below the contact surface of the traveling contact 2 at a contact opening time. In FIGS. 223 and 224, reference numeral 15 means an insulator, and the first conductor portion 4*a* which can be surveyed from the surface of the traveling contact 2 is coated with the insulator 15.

The arc-extinguishing plates 6 shown in FIGS. 223 and 224 is provided with a notch portion (not shown) so as not to prevent the rotation of the moving contact 1. An arc-extinguishing plate 6a which is one of the arc-extinguishing plates 6 is positioned in a surface contact with or adhered to the insulator 15 on an upper portion of the first conductor portion 4*a*. The mechanism portion 8, the handle 9 and the terminal 10 on the side of the load which are shown in FIG. 3 are omitted in FIGS. 223 and 224, but are naturally contained and arranged in the housing 12.

FIGS. 225(*a*) and (*b*) are perspective views showing a fixed contact according to one embodiment of the invention. The fixed contact 4 shown in FIG. 225(*a*) is integrally provided in a form including the first conductor portion 4*a*, the second conductor portion 4*e* and the third conductor portion 4*d*. The terminal 5 is connected to an end of the first conductor portion 4*a* on the side connected to the power source. Further, the stationary contact 3 is secured to an upper surface portion of the second conductor portion 4*e*. Moreover, in the fixed contact 4, a slit 40 is provided in a connecting conductor portion (i.e., the first conductor portion 4*a* and the third conductor portion 4*d*) positioned above a secured surface of the stationary contact 3 so as not to prevent a switching action of the moving contact 1 to the stationary contact 3 on the second conductor portion 4*e*.

In FIG. 225(*b*), reference numeral 15 means an insulator, and a surface of the fixed contact 4 and an inner surface of the slit 40 are coated with the insulator 15 over an area from a vicinity of a connecting portion between the first conductor portion 4*a* and the terminal 5 to the third conductor portion 4*d*.

A description will now be given of the operation.

As in the prior art, if large current such as short-circuit current flows, the moving contact 1 rotates to open the traveling contact 2 and the stationary contact 3 before the operation of the mechanism portion, and the arc A forms between the contacts 2 and 3. FIG. 226 shows a condition where the contact surface of the traveling contact 2 is still positioned below the first conductor portion 4*a* immediately after opening of the contacts 2 and 3. In FIG. 226, the arrow means current, and the arc-extinguishing plate 6 is omitted for the sake of simplicity.

An entire current path including an area from the terminal 5 to the first conductor portion 4*a* is positioned above the arc A. As a result, electromagnetic force applied to the arc A which is generated by the current path can serve as force to stretch the arc A on the side of the terminal 5. Further, current in the third conductor portion 4*d* has a direction opposed to that of the current of the arc A so that electromagnetic force generated by the current in the third conductor portion 4*d* can also serve as the force to stretch the arc on the side of the terminal 5. Therefore, the entire electromagnetic force generated by current in the fixed contact 4 can serve as the force to stretch the arc A on the side of the terminal 5. As a result, the arc A is strongly stretched immediately after the contact opening so as to rapidly increase arc resistance.

FIG. 227(*a*) is a side view of a moving contact and a fixed contact, and FIG. 227(*b*) is a sectional view taken along line 227*b*—227*b* of FIG. 227(*a*). In FIG. 227(*b*), reference numeral 41 means the centers of gravity of respective sections of the first conductor portions 4*a* on both sides of the slit 40. FIG. 227(*c*) shows the intensity distribution of the magnetic field on the Z-axis of FIG. 227(*b*), which is generated by the current in the fixed contact 4, and the intensity distribution of the magnetic field is found by a theoretical calculation. In FIG. 227(*c*), magnetic field in a positive direction is a magnetic field component to stretch the arc on the side of the terminal 5. As shown in FIG. 227(*b*), the first conductor portions 4*a* are positioned at positions laterally offset from a plane in which the moving contact 1 is rotated.

In such a conductor arrangement, there is a magnetic field component to stretch the arc A on the side of the terminal 5 even in a space (area Z0) above the first conductor portion 4*a* due to an effect caused by the current in the second conductor portion 4*e* and the third conductor portion 4*d*. Accordingly, as shown in FIG. 229, even if a traveling contact surface is rotated up to a position above the first conductor portion 4*a*, force is applied to the arc A on the side of the terminal 5 in a slit of the first conductor portion 4*a*, and is pressed onto the insulator 15*a* covering an inner portion of the slit so as to be cooled. Further, the insulators 15*b* and 15*c* covering an inner surface and an upper surface of the first conductor portion 4*a* are positioned at positions which are exposed to the arc. The insulators contact the arc so as to discharge gas having cooling effect. However, there are some drawbacks in that, for example, the housing is cracked since the gas increases pressure in the breaker.

Therefore, the arc-extinguishing plate 6*a* is positioned in the surface contact with or adhered to the insulator 15*c* on the upper portion of the first conductor portion 4*a* as shown in FIG. 223. Consequently, it is possible to protect and reduce direct contact of the partial insulators 15*a*, 15*c* to the arc after the traveling contact surface is rotated up to a position above the first conductor portion 4*a*, resulting in reduction of the pressure in the breaker. Further, the arc-extinguishing plate 6*a* never electrically contacts the first conductor portion 4*a*, and a leg of the arc is continuously positioned on the stationary contact 3 or the second conductor portion 4*e*, resulting in high arc voltage. As a result, it is possible to provide a circuit breaker having an excellent current-limiting performance and high security. In addition, the conventional arc-extinguishing plates 6 are positioned parallel to the arc-extinguishing plate 6*a* positioned in the surface contact with the insulator 15 as shown in FIG. 229. Accordingly, it is possible to effectively increase the number of the arc-extinguishing plates 6 with respect to division of the arc so as to further enhance the arc cooling effect and improve a cutoff performance. FIG. 230 is a perspective view of one embodiment according to the embodiment 86, and FIGS. 231(*a*) to (*g*) show sample configurations of the arc-extinguishing plate 6*a*.

Embodiment 87

FIG. 232 is a side view showing an essential part according to the embodiment 87. In FIG. 232, reference numeral 15*d* means an insulator covering a lower portion of the first conductor portion 4*a* of the fixed contact 4. In case the arc-extinguishing plate 6*a* is positioned in a surface contact with or adhered to the insulator 15*d* on the lower portion of the first conductor portion 4*a*, it is possible to protect and reduce direct contact of the partial insulator 15*d* to the arc immediately after contact opening, resulting in the same effects as those in the embodiment 86. FIG. 233 is a perspective view of one embodiment according to the embodiment, and FIGS. 231(*a*) to (*g*) show sample configurations of the arc-extinguishing plate 6*a*.

Embodiment 88

FIG. 234 is a perspective view showing an essential part according to the embodiment 88. In FIG. 234, reference numeral 6*c* means an arc-extinguishing plate concurrently covering the insulator 15*a* covering an inner portion of a slit of the first conductor portion 4*a* of the fixed contact 4, the insulator 15*b* covering an inner surface thereof and the insulator 15*c* covering an upper surface thereof. The arc-extinguishing plate 6*c* enables protection of the insulator 15*a* covering the inner portion of the slit, which is most greatly consumed by driving the arc. As a result, it is possible to provide a circuit breaker having effects greater than those in the embodiments 1 and 2.

Instead of the second conductor portion 4*e* to which the stationary contact 3 is secured in the fixed contact 4 as described in the embodiments 86 and 87, the second conductor portion 4*e* may extend in a direction of a rotating center such that the current in the second conductor portion 4*e* can be substantially antiparallel to the current in the moving contact 1 at the closing time as shown in FIG. 235. In case the fixed contact 4 is provided as set forth above, the electromagnetic force generated by the current in the second conductor portion 4*e* to stretch the arc A on the side of the terminal 5 can be increased, and magnetic repulsion is applied between the moving contact 1 and the fixed contact 4, and between the moving contact 1 and a portion of the second conductor portion 4*e* at the closing time. Thus, a rotation speed of the moving contact 1 is increased so as to rapidly extend an arc length immediately after the contact opening. As a result, it is possible to provide more rapid rising of arc resistance, and a further improved current-limiting performance.

Embodiment 89

FIG. 236 is a side view showing a closing condition of a circuit breaker according to the embodiment 89, and FIG. 237 is a side view showing an opening condition of the circuit breaker of FIG. 236. In FIGS. 236 and 237, reference numeral 4 means a fixed contact, and the stationary contact 3 is secured to one end of the fixed contact 4. The fixed contact 4 includes the first conductor portion 4*a*, the second conductor portion 4*e* and the third conductor portion 4*d*.

More specifically, the circuit breaker in the embodiment is different from that shown in the embodiment 86 (FIG. 223) in an arc-extinguishing plate 6*d*. The arc-extinguishing plate 6*d* is provided with a convex portion opposed to a distal end of the moving contact 1, and contacts the upper portion 15*a* of the insulator 15. FIG. 238(*b*) is a perspective view concurrently illustrating the terminal 5, the fixed contact 4, the insulator 15 and the arc-extinguishing plate 6*d*.

A description will now be given of the operation. There is a magnetic field even in a space Z0 above the first conductor portion 4*a* due to an effect caused by the current in the second conductor portion 4*e* and the third conductor portion 4*d* as shown in FIG. 227(*c*). Accordingly, as shown in FIG. 239, even if a traveling contact surface is rotated up to a position above the first conductor portion 4*a*, force is applied to the arc A on the side of the terminal 5 in a slit of the first conductor portion 4*a*, and is pressed onto an insulator 15*a* covering an inner portion of the slit so as to be cooled. Further, the insulators 15*b* and 15*c* covering an inner surface and an upper surface of the first conductor portion 4*a* are positioned at positions which are exposed to the arc. The insulators contact the arc so as to discharge gas having cooling effect. However, there are some drawbacks in that, for example, the housing is cracked since the gas increase pressure in the breaker.

Therefore, the arc-extinguishing plate 6*a* is positioned in a surface contact with or adhered to the insulator 15*c* on the upper portion of the first conductor portion 4*a* as shown in FIG. 238(*b*). Consequently, it is possible to protect and reduce direct contact of the partial insulators 15*a*, 15*c* to the arc after the traveling contact surface is rotated up to a position above the first conductor portion 4*a* so as to reduce the pressure in the breaker. Further, the arc-extinguishing plate 6*a* never electrically contacts the first conductor portion 4*a*, and the arc is divided at two points, i.e., one point between the stationary contact 3 and the arc-extinguishing plate 6*d*, and the other point between the arc-extinguishing plate 6*d* and the traveling contact 2. The divided arcs are respectively stretched by driving magnetic field generated by the fixed contact 4 and the driving magnetic field generated by the conventional arc-extinguishing plate 6 so as to maintain high arc voltage. As a result, it is possible to provide a circuit breaker having an excellent current-limiting performance and high security. FIGS. 240(*a*) and (*b*) show sample configurations of the arc-extinguishing plate 6*d*.

Embodiment 90

FIG. 241 is a side view showing a closing condition of a circuit breaker according to the embodiment 90. In FIG. 241, reference numeral 15*d* means an insulator covering a lower portion of the first conductor portion 4*a* of the first conductor portion 4*a*, and 6*d* means an arc-extinguishing plate having a convex portion opposed to a distal end of the moving contact 1, and contacting the upper portion 15*a*. FIG. 242 is a perspective view concurrently illustrating the terminal 5, the fixed contact 4, the insulator 15 and the arc-extinguishing plate 6*d*. In FIGS. 241 and 242, a mechanism portion or the like are omitted. In the embodiment, it is possible to provide the same effects as those in the embodiment 89.

Instead of the second conductor portion 4*e* to which the stationary contact 3 is secured in the fixed contact 4 as described in the embodiments 89 and 90, the second conductor portion 4*e* may extend in a direction of a rotating center such that the current in the second conductor portion 4*e* can be substantially antiparallel to the current in the moving contact 1 at the closing time as shown in FIG. 243. In case the fixed contact 4 is provided as set forth above, the electromagnetic force generated by the current in the second conductor portion 4*e* to stretch the arc A on the side of the terminal 5 can be increased, and magnetic repulsion is applied between the moving contact 1 and a portion of the second conductor portion 4*e* of the fixed contact 4 at the closing time. Thus, a rotation speed of the moving contact 1 is increased so as to rapidly extend the arc length immediately after the contact opening. As a result, it is possible to provide more rapid rising of arc resistance, and a further improved current-limiting performance.

Embodiment 91

FIG. 244 is a perspective view of a circuit breaker according to the embodiment 91. In FIG. 244, reference numeral 4*f* means an end of a notched slit provided in the fixed contact 4, and 17 is an arc runner used to transfer and run an arc spot on an arc runner contact which is provided on the second conductor portion 4*e* having the secured stationary contact 3 to one end of the arc runner, and move the arc spot to the other end thereof. FIG. 245 shows an opening condition of the moving contact 1, and FIG. 246(*a*) is a perspective view of the fixed contact 4 connected to the terminal 5. FIG. 246(*b*) is a perspective view concurrently showing the terminal 5, the fixed contact 4, the arc runner 17 and the insulator 15. Other structures are identical with those in the embodiment 1, and descriptions thereof are omitted.

A description will now be given of the operation. FIG. 247 shows a condition where the contact surface of the traveling contact 2 is still positioned below the first conductor portion 4*a* connected to the terminal 5 of the fixed contact 4 immediately after opening of the contacts 2 and 3. In FIG. 247, the arrow means current, and the arc-extinguishing plate 6 is omitted for the sake of simplicity. An entire current path including an area from the terminal 5 to one portion first conductor portion 4*a* of the fixed contact 4 is positioned above the arc A. As a result, electromagnetic force which is generated by the current path and is applied to the arc can serve as force to stretch the arc on the side of the terminal 5. Further, current in one portion 4*d* of the fixed contact 4 has a direction opposed to that of the current of the arc so that electromagnetic force generated by the current in the third conductor portion 4*d* can also serve as the force to stretch the arc on the side of the terminal 5.

Therefore, entire electromagnetic force generated by current in the fixed contact 4 can serve as the force to stretch the arc on the side of the terminal 5. As a result, the arc is transferred to the arc runner 17 so as to be cooled, and is stretched by the electromagnetic force immediately after the contact opening so as to rapidly increase arc resistance.

As shown in FIG. 227(*c*), there is a magnetic field to stretch the arc on the side of the terminal 5 even in a space Z0 above the first conductor portion 4*a* due to an effect caused by the current in the second conductor portion 4*e* and the third conductor portion 4*d*. Accordingly, as shown in FIG. 248, even if a traveling contact surface is rotated up to a position above the first conductor portion 4*a*, the arc is pressed onto an insulator 15*a* covering an inner portion of the slit of the first conductor portion 4*a*, resulting in improved cooling effect. As a result, the arc resistance rapidly increasing immediately after the contact opening is further increased so as to maintain high arc voltage. Thus, it is possible to provide a breaker having reduced contact consumption, and an excellent current-limiting performance.

Embodiment 92

FIG. 249(*a*) is a side view showing an essential part according to the embodiment 92. In FIG. 249(*a*), reference numeral 17 means an arc runner. In the arc runner 17 as seen from an upper side, an end 17*a* is positioned on the side opposed to the stationary contact 3, and is positioned on the side of the terminal 5 with respect to an end 4*f* of a notched slit of the fixed contact 4. FIG. 249(*b*) is a top view in which the insulator 15 is omitted for the sake of simplicity. The arc forming between the contacts 2 and 3 is momentarily transferred to the arc runner by strong driving magnetic field generated by the fixed contact 4, and is further driven up to the end 17*a* on the side of the terminal 5 with respect to the end 4*f* of the slit. Accordingly, the arc is easily stretched, and arc resistance is increased. In addition, the end 17*a* of the arc runner is positioned on the side of the terminal 5 with respect to the end 4*f* of the notched slit. Consequently, even if a traveling contact surface is rotated up to a position above the first conductor portion 4*a* as shown in FIG. 250, the arc is strongly pressed onto an insulator 15*a* covering an inner portion of the slit of the first conductor portion 4*a*, resulting in improved cooling effect. As a result, the arc can be largely stretched immediately after the contact opening, and high arc voltage can be maintained even after the maximum rotated condition of the moving contact 1. Thus, it is possible to provide a breaker having reduced contact consumption, and an excellent current-limiting performance.

Embodiment 93

FIG. 251 is a side view showing a closing condition of a circuit breaker according to the embodiment 93. In FIG. 251, reference numeral 17 means an arc runner. In the arc runner 17 as seen from an upper side, an end 17*a* is positioned on the side opposed to the stationary contact 3, and is positioned on the side of a contact with respect to an end 4*f* of a notched slit of the fixed contact 4. That is, the end 17*a* is positioned so as not to reach the end 4*f* of the notched slit. Thereby, even if a travelling contact surface is rotated up to a position above the first conductor portion 4*a*, an arc spot on the arc runner can stay on the side of the stationary contact 3 with respect to the end 4*f* of the notched slit. Accordingly, it is possible to reduce damage by the arc to the insulator 15*a* partially covering the end 4*f* of the slit, avoid degradation of dielectric strength, and relax a rise of pressure in a breaker housing.

Embodiment 94

FIG. 252 is a side view showing a closing condition of a circuit breaker according to the embodiment 94. In FIG. 252, reference numeral 17 means an arc runner. In the arc runner 17, an end 17*a* is positioned on the side opposed to the stationary contact 3, and is positioned below a contact surface of the stationary contact 3. Thereby, a distance between the traveling contact 2 and the end 17*a* of the arc runner 17 is increased, and an arc length is also extended since the arc is driven by strong magnetic field generated by the fixed contact 4 to the end 17*a*. As a result, it is possible to provide high arc voltage.

Embodiment 95

FIG. 253(*a*) is a side view showing a closing condition of a circuit breaker according to the embodiment 95. In FIG. 253(*a*), reference numeral 17 means an arc runner. In the arc runner 17, an end 17*a* is positioned on the side opposed to the stationary contact 3, and is positioned above a contact surface of the stationary contact 3 and below a center of a thickness direction of the first conductor portion 4*a*. Thereby, the arc can be easily transferred directly to an end 17*a* from the stationary contact 3 in a process that the arc is driven in a direction of the terminal 5 by strong magnetic field generated by the fixed contact 4. The arc can be rapidly cooled so as to provide high arc voltage. Further, since the end 17*a*, that is, an arc spot for a later period of cutoff is positioned in the strong magnetic field generated by an entire current path of the fixed contact 4, the arc never turns back in the direction of the stationary contact 3, resulting in less contact consumption. FIG. 253(*b*) shows another embodiment of the arc runner as described before.

Embodiment 96

FIG. 254(*a*) is a side view showing a closing condition of a circuit breaker according to the embodiment 96. In FIG. 254(*a*), reference numeral 17 means an arc runner. In the arc runner 17, an end 17*a* is positioned on the side opposed to the stationary contact 3, and is positioned above a center of a thickness direction of the first conductor portion 4*a*. Thereby, it is possible to reduce damage by the arc to the insulator 15*a* partially covering the end 4*f* of the slit, avoid degradation of dielectric strength, and relax a rise of pressure in a breaker housing, which is caused by gas discharged due to the end 4*f* exposed to the arc. Further, it is possible to provide a breaker having a great arc cooling effect, and an excellent current-limiting performance. FIGS. 254(*b*) and (*c*) show other embodiments of the arc runner 17 as described above. In FIG. 254(*b*), the end 17*a* is bent in the direction of the terminal 5, and there is another effect in that the arc at an opening time is further stretched in the direction of the terminal 5 as well as the same effect as set forth above.

Embodiment 97

FIG. 255(*a*) is a side view showing an essential part according to the embodiment 97. In FIG. 255(*a*), reference numeral 17 means an arc runner. The arc runner 17 is provided so as to have a narrower width than that of an inner width of a notched slit of the first conductor portion 4*a* as seen from an upper side. FIG. 255(*b*) is a top view showing the fixed contact 4, the insulator 15 and the arc runner 17 in the above configuration. It is thereby possible to reduce extension of a root of an arc column after the arc column is transferred to the arc runner 17 so as to reduce a sectional area of the arc. Consequently, an action of driving force generated by the entire current in the fixed contact 4 can be reinforced, and a current-limiting performance can be improved. Further, the arc is difficult to contact the insulator 15*b* covering an inside of the first conductor portion 4*a* so that a rise of pressure can be reduced.

Embodiment 98

FIG. 256(*a*) is a side view showing an essential part according to the embodiment 98. In FIG. 256(*a*), reference numeral 17 means an arc runner. The arc runner 17 is provided so as to have a broader width than that of an inner width of a notched slit of the first conductor portion 4*a* as seen from an upper side. FIG. 256(*b*) is a top view showing the fixed contact 4, the insulator 15 and the arc runner 17 in the above configuration. Thereby, the arc contacts the insulators 15*a* and 15*b* even after the arc is transferred to the arc runner 17, and is continuously cooled. As a result, it is possible to provide an excellent current-limiting performance.

Embodiment 99

FIG. 257(*a*) is an essential part according to the embodiment 99. In FIG. 257(*a*), reference numeral 18 means a commutating portion serving to move an arc spot from the stationary contact 3 (the commutating portion means an exposed charging projection to move the arc spot on a contact to the commutating portion. The arc commutating portion is different from the arc runner in that motion of the arc spot is neglected). A center of the commutating portion 18 is positioned on the side of the contact with respect to the end 4*f* of a notched slit of the first conductor portion 4*a* as seen from an upper side. FIG. 257(*b*) is a top view showing the fixed contact 4, the stationary contact 3 and the commutating portion 18 in the above configuration. Strong driving force is generated by the fixed contact 4, and is applied to the arc forming between the traveling contact 2 and the stationary contact 3 so that the arc spot is transferred from the stationary contact 3 to the commutating portion 18 at a high speed. Further, magnetic field in a driving direction is continuously applied to the arc after the transfer, and the arc is difficult to turn back in the direction of the stationary contact 3 so that contact consumption will be considerably reduced. A portion between the stationary contact 3 and the commutating portion 18 may be insulated or a surface of the second conductor portion 4e around the commutating portion 18 may be insulated. In this case, the arc is more difficult to turn back. In addition, the center of the commutating portion 18 is positioned on the side of the contact with respect to the end 4f of the notched slit. Accordingly, it is possible to reduce damage by the arc to the insulator 15a partially covering the end 4f of the slit, avoid degradation of dielectric strength, and relax a rise of pressure in a breaker housing.

Embodiment 100

FIG. 258(*a*) is an essential part according to the embodiment 100. In FIG. 258(*a*), reference numeral 18 means a commutating portion to move an arc spot from the stationary contact 3. A center of the commutating portion 18 is positioned on the side of the terminal 5 with respect to the end 4f of a notched slit of the first conductor portion 4a as seen from an upper side. FIG. 258(*b*) is a top view showing the fixed contact 4, the stationary contact 3 and the commutating portion 18 in the above configuration. As in the embodiment 99, the arc spot is transferred from the stationary contact 3 to the commutating portion 18 at a high speed. Further, the arc spot is difficult to turn back after the transfer so that contact consumption will be considerably reduced. A portion between the stationary contact 3 and the commutating portion 18 may be insulated or a surface of the second conductor portion 4e around the commutating portion 18 may be insulated. In this case, the arc is more difficult to turn back. In addition, since the center of the commutating portion 18 is positioned on the side of the terminal 5 with respect to the end 4f of the notched slit, the arc can be easily stretched immediately after the commutation so as to increase the arc resistance. Further, the arc is strongly pressed onto an insulator 15a covering an inner portion of a slit of the first conductor portion 4a, resulting in improved cooling effect. As a result, the arc resistance rapidly increasing immediately after the contact opening is further increased so as to maintain high arc voltage. Thus, it is possible to provide a breaker having reduced contact consumption, and an excellent current-limiting performance.

Instead of the second conductor portion 4e to which the stationary contact 3 is secured in the fixed contact 4 as shown in the embodiments 91 to 100, the second conductor portion 4e may extend in a direction of a rotation center such that the current in the second conductor portion 4e can be substantially antiparallel to the current in the moving contact 1 at the closing time as shown in FIG. 259. In this case, the electromagnetic force generated by a current path of the second conductor portion 4e to stretch the arc A on the side of the terminal 5 can be increased, and magnetic repulsion is applied between the moving contact 1 and one portion 4e of the fixed contact 4 at the closing time. Thus, a rotation speed of the moving contact 1 is increased so as to rapidly extend an arc length immediately after the contact opening. As a result, it is possible to provide more rapid rising of the arc resistance, and an improved current-limiting performance.

Embodiment 101

FIG. 260 is a side view showing a closing condition of a circuit breaker according to the embodiment 101. In FIG. 260, reference numeral 17b means an arc runner electrically contacting the first conductor portion 4a. FIG. 261 shows an opening condition of the moving contact 1, and FIG. 262(*a*) is a perspective view of the fixed contact 4 connected to the terminal 5. FIG. 262(*b*) is a perspective view concurrently showing the terminal 5, the fixed contact 4, the arc runner 17 and the insulator 15. Other structures are identical with those in the embodiment 1, and descriptions thereof are omitted. FIGS. 263(*a*) to (*c*) are perspective views showing other embodiments of a configuration of the arc runner 17b.

A description will now be given of the operation. FIG. 264 shows a condition where the contact surface of the traveling contact 2 is still positioned below the first conductor portion 4a connected to the terminal 5 of the fixed contact 4 immediately after opening of the contacts 2 and 3. In FIG. 264, the arrow means current, and the arc-extinguishing plate 6 is omitted for the sake of simplicity. An entire current path including an area from the terminal 5 to one portion 4a of the fixed contact 4 is positioned above the arc A. As a result, electromagnetic force which is generated by the current path and is applied to the arc can serve as force to stretch the arc on the side of the terminal 5. Further, current in one portion 4d of the fixed contact 4 has a direction opposed to that of the current of the arc. Consequently, electromagnetic force generated by the current in the third conductor portion 4d can also serve as the force to stretch the arc on the side of the terminal 5. Therefore, the entire electromagnetic force generated by current in the fixed contact 4 can serve as the force to stretch the arc on the side of the terminal 5. As a result, the arc is strongly stretched immediately after the contact opening so as to rapidly increase arc resistance.

As shown in FIG. 227(*c*), there is a magnetic field even in a space Z0 above the first conductor portion 4a due to an effect caused by the current in the second conductor portion 4e and the third conductor portion 4d. Accordingly, as shown in FIG. 261, when a traveling contact surface is rotated up to a position above the first conductor portion 4a, force is applied to the arc on the side of the terminal 5 so that the arc A is immediately moved to the arc runner 17b positioned at an inner portion of a slit as shown by the arrow in FIG. 261. As a result, it is possible to reduce arc energy caused by high arc voltage, that is, a rise of internal pressure. Further, since an arc spot is positioned on the arc runner 17b for a later period of cutoff, the arc can easily contact the arc-extinguishing plate 6, and is easily extinguished by cooling and dividing. Thus, it is possible to provide a breaker having excellent current-limiting performance and cutoff performance.

Embodiment 102

FIG. 265 is a side view showing a closing condition of a circuit breaker according to the embodiment 102. In FIG. 265, reference numeral 17b means an arc runner electrically contacting the first conductor portion 4a, and the arc runner 17b is disposed on the side of the terminal 5 with respect to an end 4f of a notched slit of the first conductor portion 4a. Reference numeral 6 means an arc-extinguishing plate in which a notch is provided so as not to prevent the rotation of the moving contact 1. In FIG. 265, a mechanism portion or the like are omitted. FIG. 266(*a*) is a perspective view concurrently showing the fixed contact 4 connected to the terminal 5 and the arc runner 17b, and FIG. 266(*b*) is a perspective view of FIG. 266(*a*) with the insulator 15.

As in the embodiment 101, the arc immediately after the contact opening is strongly stretched so as to rapidly increase the arc resistance. Thereafter, force is applied to the arc on the side of the terminal 5 when a traveling contact surface is rotated up to a position above the first conductor portion 4a. However, the arc is first pressed onto the insulator 15a because the arc runner 17b is positioned on the side of the terminal 5 with respect to the end 4f of the notched slit. An arc length is large so that current is sufficiently limited, and subsequently the arc is transferred to the arc runner 17b, resulting in reduced pressure. Besides, the arc runner 17b is positioned on the side of the terminal 5 with respect to the end 4*f* of the notched slit, and portions around the arc are insulated. Hence, the arc is difficult to turn back in the direction of the stationary contact 3 even if current value is decreased so as to decrease driving magnetic field generated by the fixed contact. Accordingly, the arc spot for a later period of cutoff can be easily left on the arc runner 17*b* so that the arc easily contacts the arc-extinguishing plate 6, and is easily extinguished by cooling and dividing.

Embodiment 103

FIG. 267 is a side view showing a closing condition of a circuit breaker according to the embodiment 103. In FIG. 267, reference numeral 17*b* means an arc runner electrically contacting the first conductor portion 4*a*, and the arc runner 17*b* is provided so as to have a projecting portion projecting from a position of an end 14*f* of a notched slit of the first conductor portion 4*a* in a direction of the third conductor portion 4*d*. Reference numeral 6 means an arc-extinguishing plate in which a notch is provided so as not to prevent the rotation of the moving contact 1. In FIG. 267, a mechanism portion or the like are omitted. FIG. 268(*a*) is a perspective view concurrently showing the fixed contact 4 connected to the terminal 5 and the arc runner 17*b*, and FIG. 267(*b*) is a perspective view of FIG. 267(*a*) with the insulator 15.

As in the embodiment 102, the arc immediately after the contact opening is strongly stretched so as to rapidly increase the arc resistance. Thereafter, force is applied to the arc on the side of the terminal 5 when a traveling contact surface is rotated up to a position above the first conductor portion 4*a*. However, the arc is difficult to contact the insulator 15*a* or the conductor notch end 4*f* because the arc runner 17*b* is partially positioned on the side of the third conductor portion 4*d* with respect to the end 4*f* of the notched slit. Consequently, the arc is immediately transferred to the arc runner 17*b* so that damage to the insulator 15 or the conductors is reduced, and a rise of pressure can be reduced. Further, since the arc spot for a cutoff later period is positioned on the arc runner 17*b*, the arc easily contacts the arc-extinguishing plate 6, and is easily extinguished by cooling and dividing. FIGS. 269(*a*) to (*l*) are sectional views showing sample configurations of the arc runner 17*b*, taken along line 269—269 of FIG. 270 which is a top view.

Instead of the second conductor portion 4*e* to which the stationary contact 3 is secured in the fixed contact 4 as shown in the embodiments 101 to 103, the second conductor portion 4*e* may extend in a direction of a rotation center such that the current in the second conductor portion 4*e* can be substantially antiparallel to the current in the moving contact 1 at the closing time as shown in FIG. 271. In this case, the electromagnetic force generated by a current path of the second conductor portion 4*e* to stretch the arc A on the side of the terminal 5 can be increased, and magnetic repulsion is applied between the moving contact 1 and one portion 4*e* of the fixed contact 4 at the closing time. Thus, a rotation speed of the moving contact 1 is increased so as to rapidly extend an arc length immediately after the contact opening. As a result, it is possible to provide more rapid rising of the arc resistance, and an improved current-limiting performance.

Embodiment 104

FIG. 272 is a side view showing a closing condition of a circuit breaker according to the embodiment 104. In FIG. 272, reference numeral 19 means an electrode electrically insulated from the fixed contact 4. FIG. 273 shows an opening condition of the moving contact 1, and FIG. 274(*a*) is a perspective view of the fixed contact 4 connected to the terminal 5. FIG. 274(*b*) is a perspective view concurrently showing the terminal 5, the fixed contact 4, the electrode 19 and the insulator 15. Other structures are identical with those in the embodiment 86, and descriptions thereof are omitted.

A description will now be given of the operation. FIG. 275 shows a condition where the contact surface of the traveling contact 2 is still positioned below the first conductor portion 4*a* connected to the terminal 5 of the fixed contact 4 immediately after opening of the contacts 2 and 3. In FIG. 275, the arrow means current, and the arc-extinguishing plate 6 is omitted for the sake of simplicity. An entire current path including an area from the terminal 5 to one portion 4*a* of the fixed contact 4 is positioned above the arc A. As a result, electromagnetic force which is generated by the current path and is applied to the arc can serve as force to stretch the arc on the side of the terminal 5. Further, current in one portion 4*d* of the fixed contact 4 has a direction opposed to that of the current of the arc. Consequently, electromagnetic force generated by the current in the third conductor portion 4*d* can also serve as the force to stretch the arc on the side of the terminal 5. Therefore, entire electromagnetic force generated by current in the fixed contact 4 can serve as the force to stretch the arc on the side of the terminal 5. As a result, the arc is strongly stretched immediately after the contact opening so as to rapidly increase arc resistance.

As shown in FIG. 227(*c*), there is a magnetic field to stretch the arc on the side of the terminal 5 even in a space Z0 above the first conductor portion 4*a* due to an effect caused by the current in the second conductor portion 4*e* and the third conductor portion 4*d*. Accordingly, as shown in FIG. 273, if a traveling contact surface is rotated up to a position above the first conductor portion 4*a*, force is applied to the arc on the side of the terminal 5 so that the arc contacts the electrode 19 disposed on the insulator 15 covering the first conductor portion 4*a*, and is cooled. In the embodiment, since the electrode 19 is electrically insulated from the fixed contact 4, the arc spot on the side of the fixed contact 4 is positioned on the stationary contact 3 or the second conductor portion 4*e* to the very end so as to elongatedly hold an arc length of the arc A as shown in FIG. 273. As a result, it is possible to reduce a rise of the internal pressure while maintaining high arc voltage. Further, since the arc for a cutoff later period is introduced into the electrode 19, the arc easily contacts the arc-extinguishing plate 6, and is easily extinguished by cooling and dividing. Thus, it is possible to provide a breaker having excellent current-limiting performance and cutoff performance.

Embodiment 105

FIG. 276 is a side view showing a closing condition of a circuit breaker according to the embodiment 105. In FIG. 276, reference numeral 19 means an electrode electrically insulated from the first conductor portion 4*a*, and the electrode 19 is secured so as to cover the insulator 15*a* covering an end of a notched slit of the first conductor portion 4*a* from the side of the moving contact 1. Reference numeral 6 means an arc-extinguishing plate in which a notch is provided so as not to prevent the rotation of the moving contact 1. In FIG. 276, a mechanism portion or the like are omitted. FIG. 277(*a*) is a perspective view concurrently showing the fixed contact 4 connected to the terminal 5, the insulator 15, and the electrode 19. FIG. 277(*b*) is side view.

As in the embodiment 104, the arc immediately after the contact opening is strongly stretched so as to rapidly increase the arc resistance. Thereafter, force is applied to the arc on the side of the terminal 5 so as to contact the arc with the electrode 19 when a traveling contact surface is rotated up to a position above the first conductor portion 4a. The electrode 19 covers a position of the insulator 15a so that the insulator 15a is not damaged, and generating pressure can be reduced. Further, as shown in FIG. 276, the arc between the contacts for a cutoff later period is divided by the electrode 19, and the divided arcs are respectively stretched above and below the first conductor portion 4a so as to provide high arc voltage. The arc easily contacts the arc-extinguishing plate 6, and is easily extinguished by cooling and dividing. As a result, it is possible to provide a breaker secure from a crack of a housing, having excellent current-limiting performance and cutoff performance.

Embodiment 106

FIG. 278 is a side view showing a closing condition of a circuit breaker according to the embodiment 106. In FIG. 278, reference numeral 19 means an electrode electrically insulated from the first conductor portion 4a, and the electrode 19 passes through the first conductor portion 4a on the side of the terminal 5 with respect to a position of an end of a notched slit of the first conductor portion 4a. Upper and lower portions of the electrode 19 are externally exposed. Reference numeral 6 means an arc-extinguishing plate in which a notch is provided so as not to prevent the rotation of the moving contact 1. In FIG. 278, a mechanism portion or the like are omitted. FIG. 279(*a*) is a perspective view concurrently showing the fixed contact 4 connected to the terminal 5, the insulator 15, and the first electrode 19. FIG. 279(*b*) is a sectional view taken along line 279—279 of FIG. 279(*a*).

As in the embodiments 104 and 105, the arc immediately after the contact opening is strongly stretched so as to rapidly increase the arc resistance. Thereafter, force is applied to the arc on the side of the terminal 5 so that the arc is pressed onto a part of the insulator 15a so as to be cooled and cut off. When the arc is further driven, the arc reaches the electrode 19, and is further cooled. The arc is thereafter divided, and the divided arcs are respectively stretched above and below the first conductor portion 4a as shown in FIG. 278. A sectional area of the arc is reduced due to insulation around the electrode so that high arc voltage is generated, and the arc is difficult to turn back in the direction of the stationary contact 3. As a result, it is possible to maintain the high arc voltage as it is. Further, the arc is transferred to the electrode so as to reduce a rise of pressure. Since the arc spot for a cutoff later period is positioned on the electrode 19, the arc easily contacts the arc-extinguishing plate 6, and is easily extinguished by cooling and dividing.

Embodiment 107

FIG. 280 illustrates the embodiment 107. In FIG. 280, reference numeral 19 means a tubular electrode electrically insulated from the first conductor portion 4a, and the electrode 19 passes through the first conductor portion 4a on the side of the terminal 5 with respect to a position of an end 4f of a notched slit of the first conductor portion 4a. Upper and lower portions of the electrode 19 are externally exposed. Reference numeral 6 means an arc-extinguishing plate in which a notch is provided so as not to prevent the rotation of the moving contact 1. In FIG. 280, a mechanism portion or the like are omitted. FIG. 281(*a*) is a perspective view concurrently showing the fixed contact 4 connected to the terminal 5, the insulator 15, and the electrode 19. FIG. 281(*b*) is a sectional view taken along line 281b—281b of FIG. 281(*a*).

As in the embodiments 104 to 106, the arc immediately after the contact opening is strongly stretched so as to rapidly increase the arc resistance. Thereafter, force is applied to the arc on the side of the terminal 5 so that the arc is pressed onto a part of the insulator 15a so as to be cooled and cut off. When the arc is further driven, the arc reaches the electrode 19, and is further cooled because of an air flow from a hole of the tubular electrode 19. The arc is thereafter divided, and the divided arcs are respectively stretched above and below the first conductor portion 4a as shown in FIG. 280. A sectional area of the arc is reduced due to insulation around the electrode so that high arc voltage is generated, and the arc is difficult to turn back in the direction of the stationary contact 3. As a result, it is possible to maintain the high arc voltage as it is. Further, it is possible to reduce a rise of pressure because of the arc transferred to the electrode and exhaust from the electrode hole. Since the arc spot for a cutoff later period is positioned on the electrode 19, the arc easily contacts the arc-extinguishing plate 6, and is easily extinguished by cooling and dividing.

Instead of the second conductor portion 4e to which the stationary contact 3 is secured in the fixed contact 4 as shown in the embodiments 104 to 107, the second conductor portion 4e may extend in a direction of a rotation center such that the current in the second conductor portion 4e can be substantially antiparallel to the current in the moving contact 1 at the closing time as shown in FIG. 282. In this case, the electromagnetic force generated by a current path of the second conductor portion 4e to stretch the arc A on the side of the terminal 5 can be increased, and magnetic repulsion is applied between the moving contact 1 and one portion 4e of the fixed contact 4 at the closing time. Thus, a rotation speed of the moving contact 1 is increased so as to rapidly extend an arc length immediately after the contact opening. As a result, it is possible to provide more rapid rising of the arc resistance, and an improved current-limiting performance.

Embodiment 108

FIG. 283 is a side view showing a closing condition of a circuit breaker according to the embodiment 108. In FIG. 283, reference numeral 20 means a slit plate made of insulator, and the traveling contact 2 and the stationary contact 3 are interposed between the slit plates 20 at a narrow interval. Reference numeral 6 means an arc-extinguishing plate in which a notch is provided so as not to prevent the rotation of the moving contact 1. The slit plates 20 are internally positioned over almost entire area of the notch. FIG. 284 shows an opening condition of the moving contact 1, FIG. 285(*a*) is a perspective view of the fixed contact 4 connected to the terminal 5, and FIG. 285(*b*) is a perspective view concurrently showing the terminal 5, the fixed contact 4, the insulator 15, and the slit plates 20. Other structures are identical with those in the embodiment 86, and descriptions thereof are omitted.

A description will now be given of the operation. FIG. 286 shows a condition where the contact surface of the traveling contact 2 is still positioned below the first conductor portion 4a connected to the terminal 5 of the fixed contact 4 immediately after opening of the contacts 2 and 3. In FIG. 286, the arrow means current, and the slit plates 20 and the arc-extinguishing plate 6 are omitted for the sake of simplicity. An entire current path including an area from the terminal 5 to one portion 4a of the fixed contact 4 is positioned above the arc A. As a result, the electromagnetic force which is generated by the current path and is applied to the arc can serve as force to stretch the arc on the side of the terminal 5. Further, current in one portion 4d of the fixed contact 4 has a direction opposed to that of the current of the arc. Consequently, electromagnetic force generated by the current in the third conductor portion 4d can also serve as the force to stretch the arc on the side of the terminal 5.

Therefore, entire electromagnetic force generated by current in the fixed contact 4 can serve as the force to stretch the arc on the side of the terminal 5. As a result, the arc is strongly stretched so as to rapidly increase arc resistance.

FIG. 287 is a sectional view in a vicinity of a contact as seen in a direction of the moving contact 1 from the side of the terminal 5. In FIG. 287, the moving contact 1 is in the course of the rotation. The arc forming between the contacts 2 and 3 contacts the slit plates 20 which are disposed on both sides of a contact at a narrow interval (hereafter referring to a surface of the slit plate exposed to the arc as a slit surface) so as to be cooled, resulting in increased arc voltage. At this time, gas is discharged from the slit plates 20, and a rise of the gas pressure increases the rotation speed of the moving contact 1, and promotes drive of the arc.

As shown in FIG. 227(*c*), though there is a magnetic field even in a space Z0 above the first conductor portion 4*a* due to an effect caused by the current in the second conductor portion 4*e* and the third conductor portion 4*d*, the magnetic field is smaller than that below the first conductor portion 4*a*. Accordingly, the arc-extinguishing plates 6 are disposed as shown in FIG. 283 in order to absorb magnetic field generated by the first conductor portion 4*a* above the first conductor portion 4*a* to drive the arc in a direction opposed to the terminal 5. It is possible to reinforce the driving magnetic field because of the absorption and self-current of the arc. Hence, even if a traveling contact surface is rotated up to a position above the first conductor portion 4*a* as shown in FIG. 288, force is applied to the arc on the side of the terminal 5 so that the arc is pressed onto the insulator 15*a* covering an inner portion of a slit, and is cooled. In FIG. 288, the arrow means current, and the slit plates 20 and the arc-extinguishing plates 6 are omitted for the sake of simplicity. As a result, the arc resistance rapidly increasing immediately after the contact opening is further increased so as to maintain high arc voltage. Further, even if the traveling contact surface is rotated up to a position above the first conductor portion 4*a*, the slit plates 20 are exposed to the arc so that the rotation speed of the moving contact 1 can be prevented from being depressed due to the gas pressure. Thus, it is possible to provide a breaker having excellent current-limiting performance and cutoff performance.

Embodiment 109

FIG. 289 is a side view showing a closing condition of a circuit breaker according to the embodiment 109. In FIG. 289, reference numeral 20 means slit plates positioned on both sides of the contacts at a narrow interval, and 6 means an arc-extinguishing plate in which a notch is provided so as not to prevent the rotation of the moving contact 1. The slit plates 20 are internally positioned in a vicinity of a distal end of a leg of the notch.

The slit plates 20 prevent the arc from directly contacting the vicinity of distal end of the leg of the notch of the arc-extinguishing plate 6. Therefore, it is possible to avoid fusion of the arc-extinguishing plate 6 in the vicinity thereof, reduced reinforcement of the driving magnetic field, and bridging of the arc at the distal end of the notch of the arc-extinguishing plate 6. Further, it is possible to increase driving force generated by strong magnetic field immediately after the contact opening since an arc diameter of an initial arc can not extend. In addition, the rotation speed of the moving contact 1 can be prevented from being depressed by the gas pressure of the slit plates 20. As a result, it is possible to provide a breaker having excellent current-limiting performance and cutoff performance.

Embodiment 110

FIG. 290 is a side view showing a closing condition of a circuit breaker according to the embodiment 110. In FIG. 290, reference numeral 20 means slit plates positioned on both sides of the contacts at a narrow interval, and 6 means an arc-extinguishing plate in which a notch is provided so as not to prevent the rotation of the moving contact 1. The slit plates 20 are internally positioned in a vicinity of a root of a leg of the notch.

The arc is rapidly stretched by strong magnetic field generated by the fixed contact 4 immediately after the contact opening, and thereafter a traveling contact surface is rotated up to a position above the first conductor portion 4*a*. When the arc is driven to the slit plates 20, the arc is cooled and an arc diameter thereof is forcedly reduced. In case the arc passes by the slit plates 20 so as to once reach the arc-extinguishing plate 6, and the arc diameter is extended, the arc is difficult to turn back on the side of the traveling contact 2, resulting in an enhanced cutoff performance. The arc-extinguishing plate under the shade of the slit plates 20 is not fused so that reinforcement of the driving magnetic field above the first conductor portion 4*a* is prevented from being reduced. Further, the rotation of the moving contact 1 above the first conductor portion 4*a* can be prevented from being depressed due to rising of the gas pressure of the slit plates 20. As a result, it is possible to provide a breaker having excellent current-limiting performance and cutoff performance.

Embodiment 111

FIG. 291(*a*) is a side view showing an essential part according to the embodiment 111. In FIG. 291(*a*), reference numeral 20 means slit plates positioned on both sides of the contacts at a narrow interval, and 6 means an arc-extinguishing plate in which a notch is provided so as not to prevent the rotation of the moving contact 1. The slit plates 20 are internally positioned over almost entire portion of the notch. A portion of the arc-extinguishing plate 6 which is shaded with the slit plate 20 so as not to be directly exposed to the arc is more thick than another portion thereof directly contacting the arc. FIG. 291(*b*) is a top view of FIG. 291(*a*). FIGS. 292(*a*) to (*d*) are sample configurations of the arc-extinguishing plate 6 respectively having partially varied thickness as set forth above.

As in the above embodiment 86 to 110, the arc is strongly stretched immediately after the contact opening so as to rapidly increase arc resistance. Thereafter, when a traveling contact surface is rotated up to a position above the first conductor portion 4*a*, driving magnetic field in the area becomes weak as shown in FIG. 227(*c*). However, in case the arc-extinguishing plate 6 is disposed above the first conductor portion 4*a*, the arc-extinguishing plate 6 can absorb magnetic field generated by the first conductor portion 4*a* above the first conductor portion 4*a* to drive the arc in a direction opposed to the terminal 5. Accordingly, it is possible to reinforce the driving magnetic field because of the absorption and self-current of the arc. However, in case of large current such as short-circuit current, since the arc-extinguishing plate 6 is magnetically saturated in an earlier stage, it is impossible to effectively reinforce the arc driving magnetic field. The arc driving magnetic field above the first conductor portion 4*a* can be reinforced by employing the arc-extinguishing plate 6 including the notch having a thick leg as shown in FIGS. 291(*a*) and (*b*), and FIGS. 292(*a*) to (*d*). Further, the arc-extinguishing plate 6 is difficult to be magnetically saturated, and the arc can be further strongly stretched. There are the slit plates 20 on the inside of a thick leg portion, and the leg portion never directly contacts the arc and is never fused so as to avoid reduced reinforcement of the driving magnetic field. Since a portion of the arc-extinguishing plate 6 directly contacting the driven arc has the same distance as that in the prior art though a distance between the thick portions is small, bridging of the arc can be prevented. It is possible to retard the magnetic saturation by decreasing the distance between the thick portions. In addition, it is possible to prevent the rotation speed of the moving contact 1 above the first conductor portion 4*a* from being depressed due to a rise of gas pressure of gas discharged from the slit plates 20.

Embodiment 112

FIG. 293(*a*) is a side view showing an essential part according to the embodiment 112. In FIG. 293(*a*), reference numeral 20 means slit plates positioned on both sides of the contacts at a narrow interval, and 6 means an arc-extinguishing plate in which a notch is provided so as not to prevent the rotation of the moving contact 1. The slit plates 20 are internally positioned over almost entire portion of the notch, and the arc-extinguishing plates 6 are disposed in a sector form. A vertical interval between portions of the arc-extinguishing plates 6 which are shaded with the slit plate 20 so as not to be directly exposed to the arc is smaller than that between other portions thereof directly contacting the arc. FIG. 293(*b*) is a top view of the embodiment. FIGS. 294(*a*) and (*b*) show another embodiment with the arc-extinguishing plates disposed as set forth above.

As in the above embodiment 86 to 110, the arc is strongly stretched immediately after the contact opening so as to rapidly increase arc resistance. Thereafter, when a traveling contact surface is rotated up to a position above the first conductor portion 4*a*, driving magnetic field in the area becomes weak as shown in FIG. 227(*c*). However, in case the arc-extinguishing plate 6 is disposed above the first conductor portion 4*a*, the arc-extinguishing plate 6 can absorb magnetic field generated by the first conductor portion 4*a* above the first conductor portion 4*a* to drive the arc in a direction opposed to the terminal 5. Accordingly, it is possible to reinforce the driving magnetic field because of the absorption and self-current of the arc. As shown in FIGS. 293(*a*), (*b*), and FIGS. 294(*a*), (*b*), it is possible to decrease the vertical distance between portions of the arc-extinguishing plates 6 which are shaded with the slit plates 20 while a distance between portions directly contacting the arc is left as it is. In this case, the driving magnetic field can be concentrated in a vicinity of the contact, and the magnetic saturation can be retarded without bridging of the arc. Consequently, the arc in the vicinity thereof can be driven in the direction of the terminal 5, and the effect can be maintained so as to reduce contact consumption.

The arc-extinguishing plate 6 under the shade of the slit plates 20 is not fused so that reinforcement of the driving magnetic field above the first conductor portion 4*a* can be prevented from being reduced. Further, the rotation of the moving contact 1 above the first conductor portion 4*a* can be prevented from being depressed due to rising of the gas pressure of the slit plates 20.

Embodiment 113

FIG. 295 is a side view showing an essential part according to the embodiment 113. In FIG. 295, reference numeral 20 means slit plates positioned on both sides of a contact at a narrow interval, and 6 means an arc-extinguishing plate in which a notch is provided so as not to prevent the rotation of the moving contact 1. The slit plates 20 are positioned on the inside of almost entire portion of the notch. Holes 20*a* are provided in positions of the slit plate 20, at which the arc-extinguishing plate 6 can not be directly seen from the side of the slit surface exposed to the arc. FIG. 296 is a partial perspective view showing a configuration of the slit plate 20 and the arc-extinguishing plates 6.

FIG. 297 is a side view in a vicinity of the contact as seen from the side of the terminal 5 in the direction of the moving contact 1. In FIG. 297, the moving contact 1 is in the course of the rotation. When the arc forming between the contacts 2 and 3 contacts the slit plates 20 disposed at a narrow interval on both sides of a contact, the arc is cooled. However, local pressure of the arc-extinguishing plate 6 is rapidly increased by gas which is discharged from the slit plates 20 at this time. In case the holes 20*a* is provided in the slit plates 20 as shown in FIG. 297, there are generated air flows according to paths shown by the arrows in FIG. 297 so as to relax the rapid rise of the local pressure.

Dielectric breakdown may occur between the contacts 2 and 3 in the opening condition through carbonization of the slit surface which is caused at a time of cutoff, carbide adhering to the slit surface, metallic fused material and the like. However, since a large insulation distance between the contacts can be provided by the holes 20*a* passing through the slit plates 20, it is possible to sufficiently reduce the risk of the dielectric breakdown.

As in the embodiments 86 to 112, the arc-extinguishing plate 6 under the shade of the slit plates 20 is not fused so that reinforcement of the driving magnetic field above the first conductor portion 4*a* can be prevented from being reduced. Further, the rotation of the moving contact 1 above the first conductor portion 4*a* can be prevented from being depressed due to the rise of the gas pressure by the slit plates 20.

Embodiment 114

FIG. 298 is a perspective view showing an essential part according to the embodiment 114. In FIG. 298, reference numeral 20 means slit plates disposed at a narrow interval on both sides of a contact, and 6 means an arc-extinguishing plate in which a notch is provided so as not to prevent the rotation of the moving contact 1. The slit plates 20 are positioned on the inside of the notch. Grooves are provided in surfaces of the slit plates 20 opposed to the slit surfaces, and the arc-extinguishing plate 6 is inserted into the groove from the side of the terminal 5 and is held thereby.

Thus, the arc-extinguishing plate 6 is held by the slit plates 20 so that conventional arc-extinguishing side plates becomes unnecessary to hold the arc-extinguishing plate 6. Accordingly, the number of parts are reduced, and assembly thereof is facilitated because of a simple holding method. As in the embodiments set forth above, it is possible to avoid reduced reinforcement of driving magnetic field above a conductor, and prevent the rotation speed of the moving contact 1 above the conductor from being depressed due to a rise of the gas pressure by the slit plates 20. As a result, it is possible to provide an easy assembling breaker at lower cost, having excellent current-limiting performance and cutoff performance.

Embodiment 115

FIG. 299 is a perspective view showing an essential part according to the embodiment 115. In FIG. 299, reference numeral 20 means slit plates disposed at a narrow interval on both sides of a contact, and 6 means an arc-extinguishing plate in which a notch is provided so as not to prevent the rotation of the moving contact 1. The slit plates 20 are positioned on the inside of the notch. Grooves are provided in surfaces of the slit plates 20 opposed to the slit surfaces, and the arc-extinguishing plate 6 is inserted into the groove from the side of the terminal 5 and is held thereby.

Thus, the arc-extinguishing plate 6 is held by the slit plates 20 so that conventional arc-extinguishing side plates becomes unnecessary to hold the arc-extinguishing plate 6. Accordingly, the number of parts are reduced, and assembly thereof is facilitated because of a simple holding method. As in the above embodiments 86 to 114, it is possible to avoid reduced reinforcement of driving magnetic field above a conductor, and prevent the rotation speed of the moving contact 1 above the conductor from being depressed due to a rise of the gas pressure by the slit plates 20. As a result, it is possible to provide an easy assembling breaker at lower cost, having excellent current-limiting performance and cutoff performance.

Embodiment 116

FIG. 300 is a perspective view showing an essential part according to the embodiment 116. In FIG. 300, reference numeral 20 means slit plates disposed at a narrow interval on both sides of a contact, and 6 means an arc-extinguishing plate in which a notch is provided so as not to prevent the rotation of the moving contact 1. The slit plates 20 are positioned on the inside of the notch. Reference numeral 7 means arc-extinguishing side plates to hold the arc-extinguishing plates 6 therebetween. The slit plates 20 are provided with claw portions, and are suspended and held by the claw portions anchoring upper portions of the arc-extinguishing side plates 7. FIG. 301 illustrates another embodiment in which the slit plates 20 are held by the claw portions anchoring lower portions of the arc-extinguishing side plates 7. Alternatively, the claw portions may anchor both the upper and lower portions so as to hold the slit plates 20.

In case the slit plates 20 are held by the arc-extinguishing side plates 7 as set forth above, a structure is simplified and assembly thereof is facilitated. As in the above embodiments 86 to 115, it is possible to avoid reduced reinforcement of driving magnetic field above the first conductor portion 4*a*, and prevent the rotation speed of the moving contact 1 above the first conductor portion 4*a* from being depressed due to a rise of the gas pressure by the slit plates 20. As a result, it is possible to provide an easy assembling breaker having excellent current-limiting performance and cutoff performance.

Instead of the second conductor portion 4*e* to which the stationary contact 3 is secured in the fixed contact 4 as shown in the embodiments 108 to 116, the second conductor portion 4*e* may extend in a direction of a rotation center such that the current in the second conductor portion 4*e* can be substantially antiparallel to the current in the moving contact 1 at the closing time as shown in FIG. 302. In this case, the electromagnetic force generated by a current path of the second conductor portion 4*e* to stretch the arc A on the side of the terminal 5 can be increased, and magnetic repulsion is applied between the moving contact 1 and one portion 4*e* of the fixed contact 4 at the closing time. Thus, a rotation speed of the moving contact 1 is increased so as to rapidly extend an arc length immediately after the contact opening. As a result, it is possible to provide more rapid rising of the arc resistance, and an improved current-limiting performance.

Embodiment 117

FIG. 303 is a side view showing a closing condition of a circuit breaker according to the embodiment 117. In FIG. 303, reference numeral 20 means slit plates which are made of insulator, and are disposed at a narrow interval on both sides of a contact. Reference numeral 6 means an arc-extinguishing plate in which a notch is provided so as not to prevent the rotation of the moving contact 1. The slit plates 20 are internally positioned over almost entire area of the notch. FIG. 304 is a perspective view showing a sample configuration of the arc-extinguishing plate 6, and FIG. 305 is a sectional view in a vicinity of the contact as seen from the side of the terminal 5 in a direction of the moving contact 1, illustrating a structure of the arc-extinguishing plate 6 and the slit plates 20. Projections provided on the inside of the notch of the arc-extinguishing plate 6 are inserted into holes provided in the slit plates 20, and the projections slightly extend from slit surfaces. In FIG. 306, the moving contact 1 is in the opening condition, and a portion 4*a* of the fixed contact 4 connected to the terminal 5 is positioned below a contact surface of the traveling contact 2. FIG. 307(*a*) is a perspective view of the fixed contact 4 connected to the terminal 5, and FIG. 307(*b*) is a perspective view concurrently showing the terminal 5, the fixed contact 4, the insulator 15, the slit plates 20 and the arc-extinguishing plate 6. Other structures are identical with those in the embodiment 86, and descriptions thereof are omitted.

A description will now be given of the operation. FIG. 308 shows a condition where the contact surface of the traveling contact 2 is still positioned below the first conductor portion 4*a* connected to the terminal 5 of the fixed contact 4 immediately after opening of the contacts 2 and 3. In FIG. 308, the arrow means current, and the slit plates 20 and the arc-extinguishing plate 6 are omitted for the sake of simplicity. An entire current path including an area from the terminal 5 to one portion 4*a* of the fixed contact 4 is positioned above the arc A. As a result, electromagnetic force which is generated by the current path and is applied to the arc can serve as force to stretch the arc on the side of the terminal 5. Further, current in one portion 4*d* of the fixed contact 4 has a direction opposed to that of the current of the arc. Consequently, electromagnetic force generated by the current in the third conductor portion 4*d* can also serve as the force to stretch the arc on the side of the terminal 5. Therefore, the entire electromagnetic force generated by current in the fixed contact 4 can serve as the force to stretch the arc on the side of the terminal 5. As a result, the arc is strongly stretched so as to rapidly increase arc resistance.

In FIG. 305, the moving contact 1 is in the course of the rotation. The arc forming between the contacts 2 and 3 contacts the slit plates 20 which are disposed on both sides of a contact at a narrow interval (hereafter referring to a surface of the slit plate exposed to the arc as a slit surface) so as to be cooled, resulting in increased arc voltage. Further, the arc contacts the projection of the arc-extinguishing plate 6 slightly extending from the slit surfaces so as to improve a cooling effect, and relax a rise of pressure. At this time, gas is discharged from the slit plates 20, and rising of the gas pressure increases the rotation speed of the moving contact 1, and promotes drive of the arc.

As shown in FIG. 227(*c*), though there is a magnetic field even in a space Z0 above the first conductor portion 4*a* due to an effect caused by the current in the second conductor portion 4*e* and the third conductor portion 4*d*, the magnetic field is smaller than that below the first conductor portion 4*a*. Accordingly, the arc-extinguishing plates 6 are disposed as shown in FIG. 303 in order to absorb magnetic field generated by the first conductor portion 4*a* above the first conductor portion 4*a* to drive the arc in a direction opposed to the terminal 5. It is possible to reinforce the driving magnetic field because of the absorption and self-current of the arc. Hence, even if a traveling contact surface is rotated up to a position above the first conductor portion 4*a* as shown in FIG. 309, force is applied to the arc on the side of the terminal 5 so that the arc is pressed onto the insulator 15*a* covering an inner portion of a slit, and is cooled. In FIG. 309, the arrow means current, and the slit plates 20 and the arc-extinguishing plates 6 are omitted for the sake of simplicity. As a result, the arc resistance rapidly increasing immediately after the contact opening is further increased because of the cooling effect of the slit plates 20 and the arc-extinguishing plates 6 so as to maintain high arc voltage. At this time, the rise of pressure is relaxed by the arc contacting the arc-extinguishing plates 6 so as to avoid, for example, a crack of a housing. Further, even if the traveling contact surface is rotated up to a position above the first conductor portion 4*a*, the slit plates 20 are exposed to the arc so that the rotation speed of the moving contact 1 can be prevented from being depressed due to the gas pressure. Thus, it is possible to provide a breaker having excellent current-limiting performance and cutoff performance.

In addition, since the slit plates 20 can be held by the projections of the arc-extinguishing plates 6, it is possible to provide an easy assembling breaker at lower cost.

Embodiment 118

FIG. 310 is a side view showing a vicinity of a contact according to the embodiment 118. In FIG. 310, reference numeral 20 means slit plates disposed at a narrow interval on both sides of a contact, and several holes are provided in the slit plates 20. Reference numeral 6 means an arc-extinguishing plate in which a notch is provided so as not to prevent the rotation of the moving contact 1, and a projection extends on the inside of the notch, and the projection of the arc-extinguishing plate 6 is inserted into the hole of the slit plates 20. In FIG. 310, the projection of the arc-extinguishing plate 6 is positioned external to the slit surface.

In the embodiment, arc voltage is rapidly increased immediately after contact opening due to a structure of the fixed contact 4 as in the previous embodiment. Thereafter, though the arc contacts the slit plate 20 so as to be cooled, the arc easily contacts an edge of the hole in the slit surface since the projection of the arc-extinguishing plate 6 is positioned external to the slit surface. Consequently, the arc-extinguishing plate 6 is easily fused so as to improve a cooling effect. The arc further contacts the projection of the arc-extinguishing plate 6 so that pressure in a breaker can be reduced while little arc-extinguishing plate 6 is fused without interruption of reduction of the pressure. Further, even if the moving contact 1 is rotated up to a position above the first conductor portion 4*a*, a rotation speed of the moving contact 1 can be prevented from being depressed due to the gas pressure by the slit plate 20. Thus, it is possible to provide a breaker having excellent current-limiting performance and lower internal pressure.

In the embodiments 117, 118, the projection of the arc-extinguishing plate 6 may be coplanar with the slit surface. In this case, the arc can contact the arc-extinguishing plate 6 in conjunction with the slit plate 20 so that cooling and pressure reduction can be effectively performed in an earlier stage. In addition, the arc-extinguishing plate 6 is slightly fused, and the effect can be maintained.

Instead of the second conductor portion 4*e* to which the stationary contact 3 is secured in the fixed contact 4 as shown in the embodiments 117 and 118, the second conductor portion 4*e* may extend in a direction of a rotation center such that the current in the second conductor portion 4*e* can be substantially antiparallel to the current in the moving contact 1 at the closing time as shown in FIG. 311. In this case, the electromagnetic force generated by a current path of the second conductor portion 4*e* to stretch the arc A on the side of the terminal 5 can be increased, and magnetic repulsion is applied between the moving contact 1 and one portion 4*e* of the fixed contact 4 at the closing time. Thus, a rotation speed of the moving contact 1 is increased so as to rapidly extend an arc length immediately after the contact opening. As a result, it is possible to provide more rapid rising of the arc resistance, and an improved current-limiting performance.

Though the embodiments 86 to 118 have been described with reference to the circuit breaker, the present invention may be applied to another switch in order to provide the same effects as those in the embodiments 86 to 118.

Embodiment 119

A description will now be given of the embodiment 119 of the present invention with reference to the drawings. FIG. 312 is a side view of an arc-extinguishing plate, showing a closing condition of a circuit breaker serving as a switch according to the embodiment 119 with a housing broken away. FIG. 313 is a side view showing an opening condition of the circuit breaker of FIG. 312. The component parts common or equivalent to FIGS. 4 to 10 are designated by common reference numerals. The descriptions of the common component parts are omitted here to avoid unnecessary repetition.

In the drawings, reference numeral 107 means a first conductor portion connected to a terminal 105 on the side of a power source. As shown in FIG. 312, the first conductor portion 107 is disposed on an upper portion of a conductor portion 103*a* forming a repelling element 103 so as to horizontally extend at a closing time. Reference numeral 108 means a second conductor portion connecting the first conductor portion 107 to the repelling element 103, and the second conductor portion 108 includes a flexible conductor so as not to prevent rotation of the repelling element 103. Accordingly, the first conductor portion 107 and the second conductor portion 108 form a conductor to electrically connect the repelling element 103 to the terminal 105.

FIG. 314 is a plan view showing a related configuration between the repelling element, the first conductor portion and the second conductor portion shown in FIG. 312. FIG. 315 is a front view of FIG. 314, and FIG. 316 is a perspective view of FIG. 314.

In the drawings, reference numeral 170 means a substantially U-shaped slit provided in the first conductor portion 107, and the slit 170 is provided to allow a switching action of a moving element 101 and the repelling element 103. Reference numerals 170*a*, 170*b* mean conductor portions on both sides of the first conductor portion 107, which are formed by the slit 170, and 180*a*, 180*b* are two right and left flexible conductors forming the second conductor portion 108. The flexible conductors 108*a*, 108*b* connect an open end of the slit 170 of the first conductor portion 107 (i.e., an end on the side opposed to the terminal 105 of the first conductor portion 107) with the repelling element 103. Reference numeral 118 means an insulator covering a position of the first conductor portion 107 which can be surveyed from a surface of the traveling contact 102 at an opening time of the moving element 101. The insulator 118 continuously includes an insulator 118*d* covering a surface of the first conductor portion 107, an insulator 118*b* covering both side inner surfaces of the slit 170 of the first conductor portion 107, and an insulator 118*c* covering an inner end surface of the slit 170 on the side of the terminal 105. The repelling element 103 is rotatable by downward force which is stronger than upward force generated by a torsion spring 109, and the maximum opening position of the repelling element 103 is defined by a stopper 112. Other structures are identical with those in FIGS. 4 and 5.

A description will now be given of the operation.

In the closing condition shown in FIG. 312, the traveling contact 102 is in contact with a repelling contact 104 with a predetermined contact pressure by the torsion spring 109 generating upward rotating force of the repelling element 103 and a contact pressure spring (not shown) of the moving element 101. The contact pressure is set so as not to open the traveling contact 102 from the repelling contact 104 due to small current such as load current or overload current. In a small current cutoff operation, only the moving element 101 is rotated upward while the repelling element 103 is held in a position of the closing condition as in an operation of a conventional circuit breaker.

FIG. 317 is a side view of an electrode portion, showing a closing condition of the circuit breaker. In FIG. 317, a current path from the terminal 105 to the moving element 101 is shown by the thin arrows. Current enters the terminal 105, and exits from a vicinity of a rotating center P1 of the moving element 101.

When a large current such as short-circuit current flows, current in the moving element 101 has a direction opposed to that of current in the repelling element 103 so that electromagnetic repulsion is applied therebetween, resulting in force F in each opening direction as in the conventional circuit breaker.

However, in the electrode structure of the circuit breaker according to the invention, current in the conductor portion 103*a* forming the repelling element 103 has a direction opposed to that of current in the first conductor portion 107, and the conductor portion 103*a* of the repelling element 103 is positioned below the first conductor portion 107. Hence, electromagnetic repulsion is also applied between the repelling element 103 and the first conductor portion 107, and the electromagnetic repulsion can serve as the force F to rotate the repelling element 103 downward. Further, current in the second conductor portion 108 generates magnetic field at a portion of the conductor portion 103*a* of the repelling element 103, and the magnetic field exerts from the other side to this side facing FIG. 317. Consequently, the magnetic field can also serve as force to rotate the repelling element 103.

That is, the electromagnetic force to rotate the repelling element 103 in the opening direction is generated by the entire current path from the terminal 105 to the repelling element 103, as well as the moving element 101. Therefore, in the electrode structure of the circuit breaker according to the invention, it is possible to considerably increase the electromagnetic force to rotate the repelling element 103 in the opening direction. As set forth above, a rotation speed of the repelling element 103 having small moment of inertia contributes to increasing distance between the contacts 102 and 104 for an opening initial period. Accordingly, in the electrode structure of the circuit breaker according to the invention, it is possible to considerably increase a contact opening speed so as to provide rapid rising of arc voltage.

FIG. 318 is a side view of an electrode portion, showing a condition immediately after contact opening of the circuit breaker according to the embodiment 119.

An arc A forms below the first conductor portion 107 immediately after the contact opening. At this time, current passes through the first conductor portion 107, the second conductor portion 108, and the repelling element 103 in this order to generate magnetic field, and the magnetic field exerts from the other side to this side facing FIG. 318. The magnetic field exerts force Fm in a direction of the terminal 105 on the arc A on the repelling contact 104.

That is, the entire current between the terminal 105 and the terminal 105 can generate electromagnetic force so as to stretch the arc A. Therefore, an arc length is extended longer than the distance between the contacts, and rapid rising of the arc voltage can be provided.

FIG. 319 is a side view of an electrode portion, showing the maximum opening condition of the moving element 101 and the repelling element 103 shown in FIG. 318.

The moving element 101 is more largely separated from the repelling element 103 as the moving element 101 and the repelling element 103 are rotated in opening directions. Consequently, the electromagnetic repulsion of the moving element 101 to the repelling element 103 becomes weak, but there is not large variation in a relationship between the repelling element 103, the first conductor portion 107 and the second conductor portion 108. Hence, the electromagnetic force applied to the repelling element 103 by the first conductor portion 107 and the second conductor portion 108 is not so decreased. Therefore, even if the moving element 101 and the repelling element 103 are in the maximum opening condition, the force to rotate the repelling element 103 in the opening direction is not extremely reduced. Further, even if current becomes small, the repelling element 103 is difficult to turn back so as to maintain the maximum distance between the contacts for a long period. As a result, it is easy to maintain the maximum arc voltage.

In large current arc such as short-circuit current, it has been generally known that a metallic vapor flow is ejected from a leg of the arc on a contact surface in a direction perpendicular to the contact surface because of vaporization of the contact, and the vapor flow is an essential constituent component of the arc A.

In the embodiment 119, the metallic vapor flow ejected from the surface of the traveling contact 102 collides with the insulator 118 covering the first conductor portion 107 so as to cool the arc A as shown in FIG. 319. As set forth above, the entire current path exerts the electromagnetic force on the arc A below the first conductor portion 107 in the direction of the terminal 105. As a result, the arc A is pressed for a cooling effect onto the insulator 118 of the first conductor portion 107, in particular, onto the inner end surface insulator 118*c* of the slit 170 of the first conductor portion 107. The cooling effect enables further increase of the arc voltage. As described hereinbefore, according to the embodiment 119, it is possible to rapidly rise the arc voltage immediately after the contact opening, and maintain the high arc voltage. As a result, it is possible to provide a circuit breaker having an excellent current-limiting performance.

Embodiment 120

FIG. 320 is a side view of an electrode portion, showing a closing condition of a circuit breaker according to the embodiment 120.

In the embodiment 119, a description and a illustration have been given with reference to a case where a contact surface between a traveling contact 102 and a repelling contact 104 is positioned above a first conductor portion 107 when a moving element 101 and a repelling element 103 are in a closing condition. However, in the embodiment 120, the first conductor portion 107 is positioned above a conductor portion 103*a* of the repelling element 103 and positioned above the contact surface between the traveling contact 102 and the repelling contact 104 at the closing time shown in FIG. 320. In such a configuration, it is possible to provide the same effects as those in the embodiment 119.

According to the embodiment 120, even in case of small current cutoff in which the repelling element 103 is not operated, the repelling element 103 is positioned below the first conductor portion 107 as shown in FIG. 321, and the arc A exists below the first conductor portion 107 as well as above the first conductor portion 107. An entire current path including an area from the first conductor portion 107 to the repelling element 103 exerts electromagnetic force on the arc A in a direction of a terminal 105. Therefore, the arc A is largely stretched in the direction of the terminal 105, and is pressed onto an insulator 118 of the first conductor portion 107 so as to be cooled. As a result, in an electrode structure according to the embodiment 120, it is possible to enhance a cutoff performance at a time of small current cutoff.

Embodiment 121

FIG. 322 is a side view of an electrode portion, showing a closing condition of a circuit breaker according to the embodiment 121.

In the embodiment 121, a first conductor portion 107 is positioned above a conductor 103*a* of a moving element 101 at a closing time. In this configuration, it is possible to provide the same effect.

Further, current in the first conductor portion 107 has the same direction as that of current in a conductor 101*a* of the moving element 101 so as to attract each other at a closing time of contacts. Accordingly, for an initial period at a time of short-circuit current cutoff, force to rotate the moving element 101 in an opening direction may include electromagnetic force generated by current in the first conductor portion 107 as well as electromagnetic repulsion generated by the repelling element 103. Therefore, rotation of the moving element 101 is accelerated for the initial period at the time of the short-circuit current cutoff so as to increase a contact opening speed, resulting in an enhanced current-limiting performance.

As described in the above embodiments 119, 120 and 121, in case the terminal 105 is coplanar with the first conductor portion 107, the current in the terminal 105 and the current in the first conductor portion 107 can exert the same electromagnetic effect on the moving element 101, the repelling element 103 and the arc, resulting in a further improved current-limiting performance.

Embodiment 122

FIG. 323 is a side view of an electrode portion, showing a closing condition of a circuit breaker according to the embodiment 122.

In the embodiment 122, a terminal 105 and a first conductor portion 107 are continuously connected through a vertical third conductor portion 119 so as to position the terminal 105 above the first conductor portion 107. Further, a position of the third conductor portion 119 which can be surveyed from the side of a traveling contact 102 in an opening condition is coated with an insulator 118*e*. In the configuration, it is possible to provide the same effects as those in the embodiment 119.

According to embodiment 122, current in the third conductor portion 119 has a direction opposed to that of current in an arc A so as to repel each other in an opening condition of the moving element 101 shown in FIG. 323. The arc A above the first conductor portion 107 extends in a direction of the terminal 105, and is turned back by current in the third conductor portion 119 so that the arc A never contacts a power source barrier 120. Consequently, it is advantageously possible to reduce damage to the power source barrier 120, and reduce hot gas of the arc discharged from an exhaust hole 117.

FIG. 324 is a side view of an arc-extinguishing portion of a circuit breaker according to an alternative embodiment of the embodiment 122. In the alternative embodiment, the power source barrier 120 also serves as an insulator for the third conductor portion 119 instead of the insulator 118*e* of the third conductor portion 119 shown in FIG. 323. In this case, it is possible to provide the same effect.

Embodiment 123

FIG. 325 is a side view of an electrode portion, showing an opening condition of a circuit breaker according to the embodiment 123.

In the embodiment 123, in contrast with the embodiment 122, a terminal 105 and a first conductor portion 107 are continuously connected through a vertical third conductor portion 119 so as to position the terminal 105 below the first conductor portion 107, and a position of the third conductor portion 119 which can be surveyed from the side of a traveling contact 102 in an opening condition is coated with an insulator 118*e*. In the configuration, it is possible to provide the same effects as those in the embodiment 119.

According to the embodiment 123, as shown in FIG. 325, current in the third conductor portion 119 has the same direction as that of current in an arc A so as to attract each other. Accordingly, force to stretch the arc A below the first conductor portion 107 in a direction of the terminal 105 is increased, and the arc A is further strongly pressed onto an insulator 118 so as to be cooled. As a result, it is possible to enhance a cooling effect, and improve a current-limiting performance.

Embodiment 124

FIG. 326 is a side view of an electrode portion, showing an opening condition of a circuit breaker according to the embodiment 124.

In the embodiment 124, a terminal 105 is continuously connected to a first conductor portion 107 through a third conductor portion 119, and is positioned below the first conductor portion 107, and the terminal 105 is positioned above a surface of a repelling contact 104 of a repelling element 103 positioned at a closing position in the configuration shown in FIG. 325. In such a configuration, it is possible to provide the same effects as those in the embodiment 123.

According to the embodiment 124, current in the terminal 105 generates electromagnetic force in a direction of the terminal 105 to an arc A on the repelling contact 104 even if the repelling element 103 is not operated at a time of small current cutoff as shown in FIG. 326. Therefore, in an electrode structure of the embodiment 124, it is advantageously possible to increase the electromagnetic force to stretch the arc A, and enhance a small current cutoff performance.

Embodiment 125

FIG. 327 is a side view of an electrode portion, showing an opening condition of a circuit breaker according to the embodiment 125. FIG. 328 is a side view of the electrode portion, showing an opening condition of a repelling element shown in FIG. 327.

In the embodiment 125, a terminal 105 is continuously connected to a first conductor portion 107 through a third conductor portion 119, and is positioned below the first conductor portion 107 and below a surface of a repelling contact 104 of a repelling element 103 positioned at a closing position shown in FIG. 327. When the repelling element 103 is in the maximum opening condition, the terminal 105 is positioned above at least one portion 103*b* of the repelling element 103. In such a configuration, it is possible to provide the same effects as those in the embodiment 123.

According to the embodiment 125, since the one portion 103*b* of the repelling element 103 is positioned below the terminal 105 at the maximum opening time of the repelling element 103, current in the terminal 105 generates electromagnetic force in an opening direction to the one portion 103*b* of the repelling element 103. Therefore, electromagnetic force generated by a moving element 101 and the first conductor portion 107 to open the repelling element 103 is decreased by rotation of the repelling element 103. However, the decreased electromagnetic force can be compensated to some extent by electromagnetic force generated by current in the terminal 105. As a result, it is possible to provide a circuit breaker having a further improved current-limiting performance.

FIG. 329 is a side view showing an electrode portion in a condition where only a moving element is opened at a time of small current cutoff in a circuit breaker according to an alternative embodiment of the embodiment 125. FIG. 330 is a side view of the electrode portion, showing a condition where both the moving element and the repelling element are opened at a time of large current cutoff in FIG. 329.

In the alternative embodiment, a conductor portion 106 is provided so as to position a rotating center P2 of the repelling element 103 below the terminal 105. In this case, it is possible to provide the same effects as those in the embodiment 125.

Embodiment 126

FIG. 331 is a side view of an electrode portion, showing a closing condition of a circuit breaker according to the embodiment 126.

In the embodiment 126, a first conductor portion 107 is connected to a repelling element 103 through a second conductor portion 108 between a rotating center P2 of the repelling element 103 and a repelling contact 104. In such a configuration, it is possible to provide the same effects as those in the embodiment 119. In the embodiment 126, entire current in the repelling element 103 flows on the side of the repelling contact 104 with respect to the rotating center P2.

Magnetic field generated by a moving element 101 or a first conductor portion 107 exerts downward force on current in the repelling element 103. Therefore, if current flows in a conductor of the repelling element 103 with respect to the rotating center P2 on the side opposed to the secured repelling contact 104, the electromagnetic force to the current may serve as moment to rotate the repelling element 103 in a closing direction with respect to the rotating center P2.

However, in the embodiment 126, no current flows on the side opposed to the side of the repelling contact 104 with respect to the rotating center P2. Accordingly, the entire electromagnetic force can serve as moment to rotate the repelling element 103 in the opening direction with respect to the rotating center P2. As a result, a rotation speed of the repelling element 103 can be further increased.

FIGS. 332 and 333 are side views showing an electrode portion according to each different alternative embodiment of the embodiment 126.

In the alternative embodiment shown in FIG. 332, the first conductor portion 107 is connected to the repelling element 103 through the second conductor portion 108 at the rotating center P2 of the repelling element 103. In the alternative embodiment shown in FIG. 333, the second conductor portion 108 bypasses the rotating center P2 on the side opposed to a moving contact of the repelling element 103, and the second conductor portion 108 is connected to the repelling element 103 on the side of the repelling contact 104 with respect to the rotating center P2. In either case, it is possible to provide the same effects as those in the embodiment 126.

Embodiment 127

FIG. 334(*a*) is a side view of an electrode portion, showing a closing condition of a circuit breaker according to the embodiment 127. FIG. 334(*b*) is a sectional view taken along line 334*b*—334*b* of FIG. 334(*a*). In FIG. 334(*b*), a moving element in FIG. 334(*a*) is omitted.

In the embodiment 127, a rotating center P2 of a repelling element 103 is provided between a second conductor portion 108 and a repelling contact 104 as shown in FIG. 334(*a*). As shown in FIG. 334(*b*), conductor portions 107*a* and 107*b* on both sides of a slit 170 of a first conductor portion 107 are integrally connected to the repelling element 103 through flexible conductors 108*a* and 108*b* of the second conductor portion 108.

In such a configuration, in case large current such as short-circuit current flows at a closing time, parallel components of current in the flexible conductors 108*a*, 108*b* on both sides of the second conductor portion 108 attract each other as shown in FIG. 334(*b*). Thus, upward resultant force F is applied to the repelling element 103 because of flexibility of the flexible conductors 108*a* and 108*b*. A point of application of the resultant force F on the repelling element 103 is positioned at a position at which the flexible conductors 108*a* and 108*b* of the second conductor portion 108 are connected to the repelling element 103, that is, on the left side with respect to the rotating center P2 of the repelling element 103 in FIG. 334(*a*). Consequently, the resultant force F can serve as the moment to rotate the repelling element 103 in the opening direction. As a result, according to the embodiment 127, it is possible to transform the electromagnetic force applied to the second conductor portion 108 itself into the force to rotate the repelling element 103 in the opening direction, and improve a rotation speed of the repelling element 103.

Embodiment 128

FIG. 335 is a side view showing an electrode portion of a circuit breaker according to the embodiment 128, and FIG. 336 is a sectional view of FIG. 335. In FIG. 335, Pa is a plane including a locus of a moving element 101 and a repelling element 103 at a switching time, N is a surface center point of a repelling contact 104, and Pb is a plane perpendicular to a surface of the repelling contact 104, passing through the center point N, and perpendicular to the plane Pa. In FIG. 336, A is the center of gravity in a section of a conductor portion 103*a* of the repelling element 103, which is defined by the plane Pb. In FIG. 335, Pc is a plane passing through the center of gravity A and perpendicular to conductors 107*a* and 107*b* of a first conductor portion 107 on both sides of the plane Pa. Further, B and C shown in FIG. 336 are the respective centers of gravity in respective sections of the conductors 107*a* and 107*b*, which are defined by the plane Pc.

In the embodiment 128, a triangle ABC is an isosceles triangle with a base BC, and has angles A and B set to θ (θ=45°±10°) as shown in FIG. 336. In such a configuration, it is possible to provide the following advantages as well as the same effects as those in the embodiment 119.

In the embodiment 128, when current I enters the terminal 105, uniform current I/2 flows in the conductors 107*a* and 107*b* on both sides of the first conductor portion 107, and current I flows in the repelling element 103. It is approximately considered that these current pass through the centers of gravity B and C of the conductors 107*a*, 107*b*, and the center of gravity A. Assumed that the base BC of the isosceles triangle ABC shown in FIG. 336 has a middle point at the origin 0, and the x-axis be in a direction of OC and the y-axis be in a direction of OA. If current passing through the points B and C flows from the other side to this side facing FIG. 336, resultant magnetic field generated by the current at the point A has a direction of x. Since the current passing through the point A flows with respect to the view face from the other side to this side, the resultant magnetic field exerts electromagnetic force in a direction of y on the current in the point A. Therefore, the force to rotate in the opening direction is applied to the repelling element 103 by the current in the first conductor portion 107 as set forth above. When the resultant magnetic field is defined as Bx, it is possible to express as follows:

$$Bx=K\cdot\mu_0 I \sin 2\theta/(4\pi L)$$

where K is a proportional constant, $\mu_0$ is a magnetic permeability in vacuum, $\pi$ is a circle ratio, L is a distance between the centers of gravity B and C. Obviously, Bx can have the maximum value for $\theta=40°$. When the maximum is defined as Bmax, $Bx \geqq 0.94$ Bmax in a range of $\theta=45°\pm10°$.

Accordingly, for the maximum value of magnetic field to rotate the repelling element 103 in the opening direction, which is generated by the conductors 107*a* and 107*b* on both sides of the first conductor portion 107 at the closing time, it is possible to exert at least 0.94 times or more the magnetic field on the repelling element 103 in an electrode structure of the embodiment 128. As a result, it is possible to improve a rotation speed of the repelling element 103 for an initial period at a time of short-circuit current cutoff.

Embodiment 129

FIG. 337(*a*) is a side view showing an electrode portion of a circuit breaker according to the embodiment 129, and FIG. 337(*b*) is a sectional view of FIG. 337(*a*). In the drawings, a moving element 101 and an insulator 118 are omitted.

In the embodiment 129, the centers of gravity of the conductors 107*a* and 107*b* on both sides of the first conductor portion 107, and the center of gravity of a conductor 103*a* of the repelling element 103 are respectively defined as B, C, and A as in the embodiment 128. Further, as shown in FIG. 337(*b*), base angles B, C ($\theta=\theta'$) in a triangle ABC are set so as to have a value less than 45° when the repelling element 103 is in the opening condition.

FIG. 338(*a*) is a side view of an electrode portion, showing an opening condition of the repelling element 103 shown in FIG. 337(*a*), and FIG. 338(*b*) is a sectional view of FIG. 338(*a*).

As shown in FIG. 338(*a*), Pc' is a plane passing through the center of gravity A of the conductor 103*a* of the repelling element 103 and perpendicular to the conductors 107*a* and 107*b* of a first conductor portion 107 on both sides the first conductor portion 107 at the maximum opening time of the repelling element 103. As shown in FIG. 338(*b*), B', C' are respectively the centers of gravity in respective sections of the conductors 107*a*, 107*b* on both sides of the first conductor portion 107, and basic angles ($\theta=\theta''$) in a triangle AB'C' are set to a value of 40° or more. In such a configuration, it is possible to provide the following advantages as well as the same effects as those in the embodiment 119.

As described in the embodiment 128, when $\theta=45°$, there is provided the maximum magnetic field applied to the repelling element 103, which is generated the current in the conductors 107*a*, 107*b* on both sides of the first conductor portion 107.

Therefore, electromagnetic force applied to the repelling element 103 in the opening direction by the first conductor portion 107 is more increased as the repelling element 103 is rotated in an opening direction in an electrode structure according to the embodiment 129. As a result, though electromagnetic force to rotate the repelling element 103 in the opening direction which is generated by the moving element 101 is decreased according to the rotation of the repelling element 103, the decreased electromagnetic force can be compensated. Hence, it is possible to avoid a decreased rotation speed of the repelling element 103.

In addition, when the repelling element 103 is rotated so as to have $\theta$ which is more than 45°, electromagnetic force to rotate the repelling element 103 in the opening direction which is generated by the first conductor portion 107 is decreased, resulting in reduced rotation of the repelling element 103. In case the repelling element 103 is in the maximum opening condition, a downward rotation of the repelling element 103 is stopped by a stopper 112. At this time, since the rotation speed of the repelling element 103 is decreased, impact of the repelling element 103 on the stopper 112 can be avoided. Consequently, it is possible to prevent damage to the stopper 112, and bounce of the repelling element 103.

FIGS. 339 and 340 are side views of an electrode portion, showing each different alternative embodiment of a circuit breaker according to the embodiment of the present invention.

Although a first conductor portion 107 is substantially horizontally provided in the embodiments 119 to 129, the first conductor portion 107 may be provided in an inclined form as shown in FIGS. 339 and 340.

FIG. 341 is a plan view of an electrode portion showing a further alternative embodiment of the circuit breaker according to the embodiment of the present invention. FIG. 342 is a side view of FIG. 341, and FIG. 343 is a bottom view of FIG. 342.

In the alternative embodiment, a surface coated with an insulator 118*e* includes a lower surface of the first conductor portion 107 as well as an upper surface of the first conductor portion 107 (a moving element 101 facing the surface at an opening time of the moving element 101).

FIGS. 344 and 345 are side views of an electrode portion, showing still further alternative embodiments of the circuit breaker according to the embodiment of the present invention. In the alternative embodiments, an insulator 118*c* covering an inner end surface of a slit 170 of a first conductor portion 107 is upward extended such that an arc A can contact a further increased area of the moving element 101 at an opening time of a moving element 101.

FIG. 346(*a*) is a plan view of an electrode portion, showing a further alternative embodiment of the circuit breaker according to the embodiment of the present invention. FIG. 346(*b*) is a sectional view taken along line 346*b*—346*b* of FIG. 346(*a*).

In the alternative embodiment, a more increased thickness is provided for an insulator 118*c* covering an inner end surface of a slit 170 on the side of a terminal 105 which is most susceptible to damage by an arc than that of an insulator 118*b* in the insulators 118*b*, 118*c* covering an inner surface of the slit 170 of a first conductor portion 107.

FIG. 347 is a plan view of an electrode portion, showing a further alternative embodiment of the circuit breaker according to the embodiment of the present invention. FIG. 348 is a plan view of FIG. 347 without a moving element.

Though a second conductor portion 108 connecting a first conductor portion 107 to a repelling element 103 includes two flexible conductors 108*a*, 108*b* in the embodiments 119 to 127, 129 and 130, the second conductor portion 108 connecting the first conductor portion 107 to the repelling element 103 includes one flexible conductor in the alternative embodiment. That is, in the alternative embodiment, a window-like opening 170' is provided in the first conductor portion 107 as shown in FIG. 348 instead of a U-shaped slit 170 in the first conductor portion 107 of the embodiments. Further, an end of the first conductor portion 107 on the side opposed to the side of a terminal 105 is integrally connected to the repelling element 103 through the second conductor portion 108 including one flexible conductor.

FIG. 349 is a side view of an electrode portion, showing a further alternative embodiment of the circuit breaker according to the embodiment of the present invention. FIG. 350 is a front view of FIG. 349 without a moving element and an insulator.

In the alternative embodiment, trailing conductor portions 107*c* are integrally formed with a first conductor portion 107 having a slit 170 at ends of conductor portions 107*a*, 107*b* on both sides of the first conductor portion 107 on the side opposed to a terminal 105. Further, lower ends of the trailing conductor portions 107*c* are integrally connected through a horizontal conductor portion 170*d*, and the horizontal conductor portion 170*d* is integrally connected to the repelling element 103 through a second conductor portion 108 including one flexible conductor.

FIG. 351 is a side view of an electrode portion, showing a further alternative embodiment of the circuit breaker according to the embodiment of the present invention. FIG. 352 is a front view of FIG. 351 without insulators.

In the alternative embodiment, trailing second conductor portions 108 are integrally formed with a first conductor portion 107 having a slit 170 at ends of conductor portions 107*a*, 107*b* on both sides of the first conductor portion 107 on the side opposed to a terminal 105. Respective lower ends of the trailing second conductor portions 108 are integrally formed with bracket portions 120 between which a main portion of a repelling element 103 is interposed. A rotating center shaft P2 of the repelling element 103 is supported by the bracket portions 120.

Embodiment 130

FIG. 353 is a side view of an electrode portion, showing a closing condition of a repelling element of a circuit breaker according to the embodiment 130 of the invention. FIG. 354 is a side view of an electrode portion, showing an opening condition of a repelling element of FIG. 353.

In the drawings, reference numeral 112 means a convex stopper whose upper surface is substantially parallel to a repelling element 103 holding a substantially horizontal position. Reference numeral 121 means a guide rod integrally coupled with a lower surface of the repelling element 103, and 122 means a guide hole provided in the stopper 112. The guide rod 121 is slidably inserted into the guide hole 122. Reference numerals 109*a*, 109*b* are press springs which are interposed between the repelling element 103 and the stopper 112, and the press springs 109*a* and 109*b* load the repelling element 103 in a closing direction.

The embodiment 130 is different from the above embodiments in the following point. That is, while the repelling element 103 is rotated about a rotating center P2 so as to perform a switching action in the embodiments 119 to 126, 129 and 130, the repelling element 103 is vertically moved so as to perform a switching action in the embodiment 130. In such a configuration, it is possible to provide the same effects as those in the above embodiments.

FIG. 355 is a perspective view of an electrode portion, showing a further alternative embodiment of the circuit breaker according to the embodiment of the invention. In the alternative embodiment, a first conductor portion 107 is provided with a conductor portion 107*a* only on the single side. In this case, the same effects can be provided.

Although the respective embodiments 119 to 130 have been described with reference to a circuit breaker, the present invention may be applied to another switch in order to provide the same effects as those in the embodiments 119 to 130.

As set forth above, according to the first aspect of the present invention, an entire current path of a fixed contact generates electromagnetic force to stretch an arc on the side of a terminal immediately after contact opening so as to rapidly rise arc voltage. Further, even if an opening distance of a moving contact is increased, it is possible to generate and maintain high arc voltage because of an arc cooling action by an insulator of a slit. As a result, it is advantageously possible to provide a switch having an excellent current-limiting performance.

According to the second aspect of the present invention, there is provided a portion substantially parallel to a moving contact at a closing time at a position on the side opposed to a terminal with respect to a position of a stationary contact of a second conductor portion. As a result, it is advantageously possible to improve rising of an opening speed of the moving contact by electromagnetic force, and further enhance a current-limiting performance.

According to the third aspect of the present invention, a fixed contact is provided in a substantially U-shaped form so that fabrication of the fixed contact is very easy. A slit is provided in the fixed contact at a conductor position which is positioned above a secured surface of a stationary contact so as to allow a switching action of a moving contact. As a result, it is advantageously possible to eliminate a risk of prevention of the switching action of the moving contact by the fixed contact.

According to the fourth aspect of the present invention, a first conductor portion is provided on either side of both sides of a plane including a locus described by a switching action of a moving contact. As a result, it is advantageously possible to provide a switch having an excellent current-limiting performance, in which damage hardly occurs due to pressure generated in a housing at a time of large current cutoff.

According to the fifth aspect of the present invention, a moving conductor serving as one part of a moving contact has a lateral width narrower than that of a traveling contact. As a result, it is advantageously possible to prevent the traveling contact from dropping out, increase vertical mechanical strength of a moving contact, and avoid deformation of the moving contact.

According to the sixth aspect of the present invention, entire current in a fixed contact generates large electromagnetic force which is applied to a moving contact in an opening direction. Consequently, the moving contact can be quickly opened, and a distance between contacts can be increased. Further, an arc is stretched on a direction of a terminal by entire current in a conductor forming the fixed contact immediately after contact opening. Then, an arc length is extended so as to rapidly rise arc voltage, and thereafter the arc is left pressed onto an insulator covering a first conductor portion. As a result, it is advantageously possible to generate and maintain high arc voltage.

According to the seventh aspect of the present invention, it is advantageously possible to enhance a rise of an opening speed immediately after contact opening by substantially making full use of force of a first conductor portion of a fixed contact to attract a moving contact.

According to the eighth aspect of the present invention, an entire current path of a fixed contact generates electromagnetic force to stretch an arc on the side of a terminal immediately after contact opening so as to rapidly rise arc voltage. Further, electromagnetic force generated by current in the fixed contact can continuously serve as force in a rotating direction in a part of a moving contact. Consequently, even if an opening distance of the moving contact is increased, it is possible to generate and maintain high arc voltage because of arc cooling action by an insulator covering a first conductor portion of the fixed contact. As a result, it is advantageously possible to a switch having an excellent current-limiting performance.

According to the ninth aspect of the present invention, a fixed contact is provided in a substantially U-shaped form, and an entire current path of a fixed contact generates electromagnetic force to stretch an arc on the side of a terminal immediately after contact opening so as to rapidly rise arc voltage. Even if an opening distance of the moving contact is increased, it is possible to generate and maintain high arc voltage because of arc cooling action by an insulator covering a first conductor portion of the fixed contact. Further, no deviation occurs in the electromagnetic force to stretch the arc on the side of the terminal, which is generated at the fixed contact. As a result, it is advantageously possible to provide a switch having an excellent current-limiting performance without a risk of dielectric breakdown of the fixed contact.

According to the tenth aspect of the present invention, an arc forming between contacts is interposed between arc-extinguishing side plates on both sides. The arc is prevented by the arc-extinguishing side plates from extending in a lateral direction between the arc-extinguishing side plates. Consequently, it is possible to apply strong arc driving magnetic field to the arc immediately after contact opening, and achieve great effect of the arc-extinguishing side plates. Further, the arc is forcedly pressed onto an insulator so as to be cooled in an opening condition. As a result, it is advantageously possible to provide a switch having excellent current-limiting performance and cutoff performance.

According to the eleventh aspect of the present invention, it is possible to apply strong arc driving magnetic field to the arc immediately after contact opening, and achieve great effect of the arc-extinguishing side plates. Further, the arc is forcedly pressed onto an insulator so as to be cooled in an opening condition. In addition, the arc is upward blown away by increasing pressure in a space below a first conductor portion so as to elongatedly stretch the arc, and an opening speed of a moving contact is increased. As a result, it is advantageously possible to provide a switch having excellent current-limiting performance and cutoff performance.

According to the twelfth aspect of the present invention, an entire current path of a fixed contact generates electromagnetic force to stretch an arc on the side of a terminal immediately after contact opening so as to largely stretch the arc immediately after opening of a moving contact. The arc is cooled by contacting an arc-extinguishing plate disposed below a first conductor portion of the fixed contact so as to rapidly rise arc voltage. Further, even if an opening distance of the moving contact is increased, it is possible to generate and maintain high arc voltage because of arc cooling action by an insulator. As a result, it is advantageously possible to a switch having an excellent current-limiting performance.

According to the thirteenth aspect of the present invention, entire current in a fixed contact generates electromagnetic force in a direction of a power source system in a space below a first conductor portion of the fixed contact immediately after contact opening so as to stretch an arc on the side of a terminal. Therefore, it is possible to apply strong driving magnetic field to the arc immediately after the contact opening, and thereby rapidly rising arc voltage. Further, a magnetic material plate can absorb inverse magnetic field which is generated in a space above the first conductor portion by the current in the fixed contact. As a result, it is advantageously possible to having excellent current-limiting performance and cutoff performance.

According to the fourteenth aspect of the present invention, one of arc-extinguishing plates is in a surface contact with at least one of insulators covering upper and lower portions of a first conductor portion. Therefore, it is possible to avoid an abnormal rise of pressure in a switch, caused by gas which is generated by an arc contacting an insulator covering a first conductor portion, and concurrently avoid degradation of dielectric strength because of protection of the insulation. As a result, it is advantageously possible to provide a switch which can generated and maintain high arc voltage, and has an excellent current-limiting performance and high security. Besides, it is advantageously possible to increase the number of the arc-extinguishing plates effectively with respect to the arc, enhance an arc cooling effect, and immediately extinguish the arc.

According to the fifteenth aspect of the present invention, an arc runner is provided for a second conductor portion. Consequently, it is possible to quickly transfer an arc spot on a contact to the arc runner at a time of contact opening, and reduce damage to a stationary contact by an arc. As a result, it is advantageously possible to provide a switch having an excellent current-limiting performance and high durability.

According to the sixteenth aspect of the present invention, there is provided an arc runner electrically contacting a first conductor portion. An arc is transferred to the arc runner for a later period of cutoff so that the arc easily contacts an arc-extinguishing plate. As a result, it is advantageously possible to provide a switch having excellent current-limiting performance and cutoff performance. Further, it is advantageously possible to protect an insulator by transferring the arc to the arc runner, and avoid, for example, a crack of a housing by reducing rise of internal pressure for the later period of cutoff.

According to the seventeenth aspect of the present invention, there is provided an electrode insulated from a fixed contact on an insulator covering a first conductor portion. When a traveling contact surface is rotated up to a position above a first conductor portion, an arc can be cooled by the electrode, and an arc spot on the side of the fixed contact can be maintained to the very end so as to extend an arc length. As a result, it is advantageously possible to provide a switch having excellent current-limiting performance and cutoff performance. Further, it is advantageously possible to avoid, for example, a crack of a housing by reducing rise of internal pressure for the later period of cutoff.

According to the eighteenth aspect of the present invention, a conductor connecting a repelling element to the side of a power source system includes a first conductor portion and a second conductor portion. The first conductor portion is positioned between a traveling contact and a repelling contact so as to be connected to the side of the power source system at an opening time of the repelling element and a moving element paired therewith. The second conductor portion connects the first conductor portion to the repelling element at an end on the side opposed to the repelling contact. Current in the moving element and the repelling element generate electromagnetic repulsion at a time of short-circuit current cutoff. The repelling element performs a switching action when predetermined force or more as well as the electromagnetic repulsion are applied to the repelling element in an opening direction. Further, another electromagnetic repulsion to open the repelling element is generated by current in the first conductor portion connecting the repelling element to the power source system. As a result, it is advantageously possible to provide a very quick opening speed, and an excellent current-limiting performance.

According to the nineteenth aspect of the present invention, a first conductor portion is positioned above surfaces of a traveling contact and a repelling contact at a closing time of the moving element and the repelling element. Therefore, it is possible to provide strong magnetic field to stretch an arc on the repelling contact even at a time of small current cutoff. As a result, it is advantageously possible to provide a switch having excellent current-limiting performance and small current cutoff performance.

What is claimed is:

1. A switch comprising:

a moving contact having a first end and a traveling contact disposed at a second end;

a fixed element having a stationary contact at one end thereof, said stationary contact capable of making and breaking contact with said traveling contact by a switching action of said moving contact; and a terminal connected to the other end of said fixed element;

said fixed element including a first conductor portion connected to said terminal, a second conductor portion having said stationary contact and disposed parallel to and below said first conductor, and a third conductor portion vertically connecting said first conductor portion with said second conductor portion, wherein said traveling contact in a contact closing condition can be opened in an upward movement away from and with respect to said stationary contact, wherein said third conductor portion is disposed on a same side of said stationary contact as the first end of said moving contact and on a side of said stationary contact opposed to said terminal, said first conductor portion being disposed above a contact surface of said traveling contact in said contact closing condition, and being disposed below a contact surface of said traveling contact in a contact opening condition, and at least a portion of said first conductor portion being coated with an insulator over an area of the first conductor portion extending between the terminal and the third conductor portion, on a side of said first conductor opposed to said stationary contact, wherein an arc resulting from opening said traveling contact is pressed onto said insulator so as to generate and maintain a high arc voltage.

2. A switch according to claim 1, wherein said fixed element has a portion connected immediately to said stationary contact forming a connecting conductor connecting said terminal to said stationary contact, said portion extending substantially parallel to said moving contact in said contact closing condition on a side opposed to said terminal with respect to a position of said stationary contact.

3. A switch according to claim 1, wherein said first conductor, said second conductor, and said third conductor form a substantially U-shaped conductor, said stationary contact being secured to an inside of one end of said U-shaped conductor, said terminal being connected to the other end of said U-shaped conductor, and a slit being provided in a portion of said U-shaped conductor positioned above said stationary contact on said other end so as to allow a switching action of said moving contact to said fixed element, said slit being coated on an inner surface with said insulator.

4. A switch according to claim 1, wherein said fixed element includes a first conductor portion positioned above said stationary contact on either side of both sides of a plane including a locus described by a switching action of said moving contact.

5. A switch according to claim 1, wherein a moving conductor serving as one part of said moving contact has a narrower lateral width than that of said traveling contact when a direction perpendicular to a plane including a locus described by said switching action of said moving contact is defined as a lateral direction.

6. A switch according to claim 1, wherein said first conductor portion is disposed above a center of a conductive path of one end of said moving contact to which said traveling contact is mounted at said contact closing condition, and is disposed below a contact surface of said traveling contact at said contact opening condition.

7. A switch according to claim 6, wherein said fixed element comprises a first conductor portion having a notch along a plane including a locus described by switching action of said moving contact, and angles θ1 and θ2 being provided on the side of said plane including said locus to become 45°±10° between a line connecting a center of gravity P1 to the center of gravity P2 in respective sections of conductor portions on both sides of said notch and lines respectively connecting a center of gravity P3 in a section of a moving contact conductor portion serving as one portion of said moving contact to the centers of gravity P1 and P2 in a section at a contact closing condition perpendicular to said plane including said locus and perpendicular to said notch of said first conductor portion.

8. A switch according to claim 1, wherein said first conductor portion is continuously positioned above one portion of said moving contact for a time period from said contact closing condition to said contact opening condition.

9. A switch according to claim 1, wherein said fixed element is provided in a substantially U-shaped form, a surface of a stationary contact secured to one end of said fixed element making and breaking contact with said traveling contact, and facing a side of another end of said fixed element, a slit being provided in said fixed element so as not to prevent a switching action of said moving contact when said traveling contact makes and breaks contact with said stationary contact, one end of said slit being positioned on the side of the other end of said fixed element, and the other end of said slit being positioned closer to said stationary contact of said fixed element than a U-shaped bottom portion of said fixed element.

10. A switch according to claim 1, further comprising arc-extinguishing side plates disposed on both sides of a plane including a locus of a traveling contact at a time of switching said moving contact, and at least one of said arc-extinguishing side plates being disposed between said plane and a portion of said first conductor portion corresponding to said plane.

11. A switch according to claim 10, wherein said arc-extinguishing side plates have an upper side thereof which does not exceed a height range of said first conductor portion.

12. A switch according to claim 1, wherein a contact surface of said stationary contact contacting said traveling contact is disposed below said terminal, and further comprising arc-extinguishing plates disposed below said first conductor portion.

13. A switch according to claim 1, further comprising:

at least one magnetic material plate disposed above said first conductor portion so as to extend substantially parallel to said first conductor portion, and a notched space provided in said magnetic material plate so as to allow a switching action of said moving contact.

14. A switch according to claim 13, wherein one of said at least one magnetic material plate is in surface contact with at least one of insulators covering upper and lower portions of said first conductor portion.

15. A switch according to claim 1, wherein a contact surface of said stationary contact contacting said traveling contact is disposed below said terminal, and further comprising an arc runner provided for said second conductor portion to which a stationary contact is secured.

16. A switch according to claim 1, wherein a contact surface of said stationary contact contacting said traveling contact is disposed below said terminal, and further comprising an arc runner provided to electrically contact said first conductor portion.

17. A switch according to claim 1, wherein a contact surface of said stationary contact contacting said traveling contact is disposed below said terminal, and further comprising an electrode provided on an insulator covering said first conductor portion, and being insulated from said fixed element.

18. A switch comprising:

a housing;

a fixed element connected to said housing, said fixed element including a stationary contact at a first end and a terminal connected to a second end;

a moving element having a first end pivotally connected to said housing and a traveling contact at a second end, wherein said moving element can move between a contact closed position and a contact open position so as to make and break contact between said traveling contact and said moving contact;

said fixed element including:

a first conductor portion connected to said terminal, a second conductor portion having said stationary contact connected thereto and disposed parallel to and below said first conductor, and a third conductor portion vertically connecting said first conductor portion with said second conductor portion, said third conductor portion being disposed on a side of said stationary contact opposed to said terminal, said first conductor portion being disposed above a contact surface of said traveling contact at said contact closed position, and being disposed below a contact surface of said traveling contact at said contact opened position, and an insulator covering at least a portion of said first conductor portion over an area of the first conductor portion extending between the terminal and the third conductor portion, on a side of said first conductor opposed to said stationary contact, wherein an arc resulting from moving said moving element to a contact opening position is pressed onto said insulator so as to generate and maintain a high arc voltage.

19. A switch according to claim 18, wherein said fixed element comprises a connecting conductor having a portion connected immediately to said stationary contact and connecting said terminal to said stationary contact, said portion extending substantially parallel to said moving contact at said contact closed position on the side opposed to said terminal with respect to a position of said stationary contact.

20. A switch according to claim 18, wherein said first conductor, said second conductor, and said third conductor form a substantially U-shaped conductor, said stationary contact being secured to the inside of one end of said U-shaped conductor, said terminal being connected to another end of said U-shaped conductor, and a slit being provided in a portion of said U-shaped conductor positioned above said stationary contact on said other end so as to allow said moving contact to move towards and away from said fixed element during movement between said contact open position and said contact closed position, said slit being coated on an inner surface with said insulator.

21. A switch according to claim 18, wherein said fixed element includes a first conductor portion positioned above said stationary contact on either side of both sides of a plane including a locus described by pivotal movement of said moving contact.

22. A switch according to claim 18, wherein a moving conductor serving as one part of said moving contact has a narrower lateral width than that of said traveling contact when a direction perpendicular to a plane including a locus described by pivotal movement of said moving contact is defined as a lateral direction.

23. A switch according to claim 18, wherein said first conductor portion is disposed above a center of a conductive path of one end of said moving contact to which said traveling contact is mounted at said contact closed position, and is disposed below a contact surface of said traveling contact at said contact opened position.

24. A switch according to claim 23, wherein said fixed element comprises a first conductor portion having a notch along a plane including a locus described by pivotal movement of said moving contact, and angles $\theta 1$ and $\theta 2$ being provided on the side of said plane including said locus to become $45° \pm 10°$ between a line connecting a center of gravity P1 to a center of gravity P2 in respective sections of conductor portions on both sides of said notch and lines respectively connecting a center of gravity P3 in a section of a moving contact conductor portion serving as one portion of said moving contact to the centers of gravity P1 and P2 in a section at a contact closed position perpendicular to said plane including said locus and perpendicular to said notch of said first conductor portion.

25. A switch according to claim 18, wherein said first conductor portion is continuously positioned above one portion of said moving contact for a time period from said contact closed position to a contact opened position.

26. A switch according to claim 18, wherein said fixed element is provided in a substantially U-shaped form, a surface of a stationary contact secured to one end of said fixed element making and breaking contact with said traveling contact, and facing the side of the other end of said fixed element, a slit being provided in said fixed element so as not to allow movement of said moving contact when said traveling contact makes and breaks contact with said stationary contact, one end of said slit being positioned on the side of the other end of said fixed element, and the other end of said slit being positioned closer to said stationary contact of said fixed element than a U-shaped bottom portion of said fixed element.

27. A switch according to claim 18, further comprising arc-extinguishing side plates disposed on both sides of a plane including a locus of a traveling contact at a time of movement of said moving contact, and at least one of said arc-extinguishing side plates being disposed between said plate and a portion of said first conductor portion corresponding to said plane.

28. A switch according to claim 27, wherein said arc-extinguishing side plates have an upper side thereof which do not exceed a height range of said first conductor portion.

29. A switch according to claim 18, wherein a contact surface of said stationary contact contacting said traveling contact is disposed below said terminal, and further comprising arc-extinguishing plates disposed below said first conductor portion.

30. A switch according to claim 18, further comprising:

at least one magnetic material plate disposed above said first conductor portion so as to extend substantially parallel to said first conductor portion, and a notched space provided in said magnetic material plate so as to allow pivotal movement of said moving contact.

31. A switch according to claim 30, wherein one of said at least one magnetic material plate is in surface contact with at least one of insulators covering upper and lower portions of said first conductor portion.

32. A switch according to claim 18, wherein a contact surface of said stationary contact contacting said traveling contact is disposed below said terminal, and further comprising an arc runner provided for said second conductor portion to which a stationary contact is secured.

33. A switch according to claim 18, wherein a contact surface of said stationary contact contacting said traveling contact is disposed below said terminal, and further comprising an arc runner provided to electrically contact said first conductor portion.

34. A switch according to claim 18, wherein a contact surface of said stationary contact contacting said traveling contact is disposed below said terminal, and further comprising an electrode provided on an insulator covering said first conductor portion, and being insulated from said fixed element.

* * * * *